US008022899B2

(12) United States Patent
Takahara

(10) Patent No.: US 8,022,899 B2
(45) Date of Patent: Sep. 20, 2011

(54) EL DISPLAY APPARATUS AND DRIVE METHOD OF EL DISPLAY APPARATUS

(75) Inventor: Hiroshi Takahara, Osaka (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 1486 days.

(21) Appl. No.: 11/335,761

(22) Filed: Jan. 20, 2006

(65) Prior Publication Data

US 2007/0046587 A1 Mar. 1, 2007

(30) Foreign Application Priority Data

Jan. 28, 2005 (JP) ..... 2005-021550

(51) Int. Cl.
*G09G 3/30* (2006.01)

(52) U.S. Cl. ..... 345/76; 315/169.3; 313/463; 345/77; 345/82; 345/204

(58) Field of Classification Search ..... 345/82, 345/100, 98, 76–77, 83, 690; 315/169.3; 313/463, 498
See application file for complete search history.

(56) References Cited

U.S. PATENT DOCUMENTS

| | | | | |
|---|---|---|---|---|
| 5,684,365 | A | 11/1997 | Tang et al. | |
| 6,366,025 | B1 | 4/2002 | Yamada | |
| 6,597,349 | B1 | 7/2003 | Koyama et al. | |
| 6,760,004 | B2 * | 7/2004 | Koyama | 345/98 |
| 6,774,877 | B2 * | 8/2004 | Nishitoba et al. | 345/76 |
| 2003/0184236 | A1 | 10/2003 | Maede et al. | |
| 2004/0100429 | A1 * | 5/2004 | Kuriki | 345/76 |
| 2004/0108518 | A1 | 6/2004 | Jo | |
| 2004/0233141 | A1 | 11/2004 | Matsumoto | |
| 2005/0001794 | A1 | 1/2005 | Nakanishi et al. | |

FOREIGN PATENT DOCUMENTS

| | | |
|---|---|---|
| JP | 8-234683 | 9/1996 |
| JP | 2001-147666 | 5/2001 |
| JP | 2001-290441 | 10/2001 |
| JP | 2004-318093 | 11/2004 |
| JP | 2005-148415 | 6/2005 |
| KR | 1999-0036755 | 5/1999 |
| KR | 2003-0078012 | 10/2003 |
| KR | 2003-0078741 | 10/2003 |
| KR | 10-2004-0078438 | 9/2004 |
| KR | 10-2004-0092397 | 11/2004 |
| WO | WO 01/37249 A2 | 5/2001 |

OTHER PUBLICATIONS

U.S. Appl. No. 11/565,182, filed Nov. 30, 2006, Nakamura, et al.

* cited by examiner

*Primary Examiner* — Lun-Yi Lao
*Assistant Examiner* — Shaheda A Abdin
(74) *Attorney, Agent, or Firm* — Oblon, Spivak, McClelland, Maier & Neustadt, L.L.P.

(57) ABSTRACT

A precharge voltage Vp is applied in period A. The precharge voltage Vp is generated by applying a constant current Iw to a pixel driving transistor of a display panel and using gate terminal voltage of the driving transistor which passes the constant current Iw. The gate terminal potential is held in memory. When displaying images on a display panel, the gate terminal potential is read out of memory, and used as the precharge voltage Vp after arithmetic processing. By the application of the precharge voltage Vp, a source signal line is charged and discharged quickly so that an almost target tone current will flow through the driving transistor. Furthermore, a more accurate program current is written into the pixel during period B.

1 Claim, 154 Drawing Sheets

61 Write row 62 Non-display (non-illuminated) area 63 Display (illuminated) area Fig. 8 81 Current holding circuit
82 Polysilicon current holding circuit
83 Output terminal Fig. 15 151 Operational amplifier (buffer circuit) 152 Electronic regulator (voltage output circuit) 153 Constant current circuit 154 Current tone circuit

Fig. 34

KDATA

| | | Before the change (1H before) | | | | | | |
|---|---|---|---|---|---|---|---|---|
| | | 0 | 1 | 2 | 3 | ---------- | n-1 | n |
| After the change | 0 | 0 | — | — | — | | — | — |
| | 1 | 15 | 0 | — | — | | — | — |
| | 2 | 12 | 10 | 0 | — | | — | — |
| | 3 | 10 | 8 | 6 | 0 | | — | — |
| | 4 | 8 | 6 | 4 | 2 | | — | — |
| | ⋮ | | | | | ⋱ | | ⋮ |
| | n-1 | 0 | 0 | 0 | 0 | | — | — |
| | n | 0 | 0 | 0 | 0 | ---------- | — | — |

391 A/D conversion circuit

801 Control IC(circuit)

841 Short circuit wiring 842 Terminal electrode 843 Probe
844 Constant current source 845 Wiring 931 Lookup table 1092 Laser irradiation spot (Excimer laser spot)
1093 Positioning marker
1094 Glass substrate Vdd
17a
18
19a
11c
19b
17c
17b
11a
11b
11d
16
15

Vdd
17a
18
19
11c
11b
17b
11a
11e
11f
11b
16
15

Vdd
17a
18
19
6041
17b
15
16

1271 Constant current output circuit

16
Vdd
Vss
11a
11b
11c
11d
15
19
Va
Va+Vx
Va+Vc
Iw
Ie
18
SW1
SW2
SW3
SW4
SW5
151
VO
1341
231
154

1311 Switch circuit 1312 Constant current source
1313 Current output circuit

1481 Tone switch control circuit
1482 Precharge current control circuit
1483 Precharge-period determining circuit
1484 Inverter circuit 1531 Supporting point
1532 Image taking lens
1533 Storage section
1534 Switch 1541 Camera body
1542 Image taking body
1543 Photographic switch

EL DISPLAY APPARATUS AND DRIVE METHOD OF EL DISPLAY APPARATUS

BACKGROUND OF THE INVENTION

1. Field of the Invention

The present invention relates to EL display apparatus and drive method of EL display apparatus which employs a self-luminous display panel (display apparatus) such as an EL display panel (display apparatus) using organic or inorganic electroluminescent (EL) elements, or the like.

2. Related Art of the Invention

With active-matrix image display apparatus which employ an organic electroluminescent (EL) material or an inorganic EL material as an electrochemical substance, emission brightness changes according to current written into pixels. An EL display panel is of a self-luminous type in which each pixel has a light-emitting element. EL display panels have the advantages of being more viewable than liquid crystal display panels, having high light emission efficiency, requiring no backlighting, having high response speed, etc.

Such an organic EL display panel of an active-matrix type is disclosed in Japanese Patent Laid-Open No. 8-234683.

An equivalent circuit for one pixel of the display panel is shown in FIG. 2. A pixel 16 consists of an EL element 15 which is a light-emitting element, a first transistor (driving transistor) 11*a*, a second transistor (switching transistor) 11*b*, and a storage capacitance (capacitor) 19. The light-emitting element 15 is an organic electroluminescent (EL) element. According to this specification, the transistor 11*a* which supplies (controls) current to the EL element 15 is referred to as a driver transistor 11. A transistor, such as the transistor 11*b* shown in FIG. 2, which operates as a switch is referred to as a switching transistor 11.

The operation shown in FIG. 2 is described below. A video signal of voltage which represents brightness information is applied to the source signal line 18 with the gate signal line 17 selected. According to the selection by the gate signal line 17, the transistor 11*a* conducts (wherein the transistor 11*a* is closed: turned on) and the video signal is charged to the storage capacitance 19. When the gate signal line 17 is deselected, the transistor 11*a* is open (turned off). The transistor 11*b* is cut off electrically from the source signal line 18. However, the gate terminal potential of the transistor 11*a* is maintained by the storage capacitance (capacitor) 19. Current delivered to the light-emitting element 15 via the transistor 11*a* depends on gate-drain terminal voltage Vgd of the transistor 11*a*. The light-emitting element 15 continues to emit light at an intensity which corresponds to the amount of current supplied via the transistor 11*a*.

A driver circuit which drives a pixel configuration in FIG. 2 outputs a voltage video signal. The driver circuit which outputs the voltage video signal has a configuration similar to that of a driver circuit which drives a liquid crystal display panel. The driver circuit applies a voltage signal as the video signal to the source signal line 18. The applied voltage signal is applied to the pixel 16 and held in a capacitor 19.

However, an organic EL display panel uses transistor arrays made of low-temperature or high-temperature polysilicon, and variations in the characteristics of the transistors in the polysilicon transistor arrays of organic EL elements will cause display irregularities.

FIG. 2 shows a pixel configuration for voltage programming mode. The voltage programming mode involves a configuration, circuit, or drive method which applies a video signal or other voltage signal (program voltage) given as a magnitude or intensity of a voltage to a data signal line, source signal line, or pixel, converts the voltage signal into a current signal using pixel transistors, and applies the resulting current signal to the EL element.

Current programming mode involves applying a video signal or other current signal (program current) given as a magnitude or intensity of a current to a data signal line, source signal line, or pixel, and applies the resulting current signal using pixel transistors to the EL elements.

Both an act of causing a current to flow into an EL element 15 from a driving transistor 11 and act of causing a current to flow into a driving transistor from an EL element 15 are referred to as applying the current from a driving transistor 11 to an EL element 15. In other words, the current programming mode involves a configuration, circuit configuration, or drive method which applies a current signal (program current) that is approximately proportional to the applied current or obtained by converting the applied current in a predetermined manner, either directly or indirectly to the EL element.

With the pixel configuration illustrated in FIG. 2, a voltage video signal is converted into a current signal by the transistor 11*a*. Thus, any variation in the characteristics of the driving transistor 11*a* will cause variations in the resulting current signal. Generally, the driving transistors 11*a* have 50% or more variations in their characteristics. Consequently, the configuration in FIG. 2 causes display irregularities accordingly.

The voltage programming mode has a low capability to compensate for variations in transistor characteristics of the pixel 16. Thus, it involves display irregularities resulting from the variations in transistor characteristics. However, the voltage programming mode has a high capability to charge and discharge source signal lines and the like both in low tone and high tone regions. Thus, it can achieve proper image display without causing insufficient writing.

The display irregularities can be reduced by using the configuration of the current programming mode. The current programming mode provides low drive current in low tone regions. Consequently, parasitic capacitance of the source signal line 18 can prevent proper driving.

Incidentally, current programming (mode) is also called current driving and voltage programming (mode) is also called voltage driving.

To solve the conventional problem described above, the present invention has an object to provide an EL display apparatus and a drive method thereof which can eliminate insufficient writing in all tone regions while reducing display irregularities.

SUMMARY OF THE INVENTION

To solve the above problem, an EL display apparatus according to the present invention outputs a constant current, for example, from a driving transistor 11*a* of a pixel and measures a gate terminal potential of the driving transistor 11*a* via a source signal line 18 while the constant current is being outputted from the driving transistor 11*a*.

The measured potential is stored in memory after A/D (analog-digital) conversion. Preferably, data on the driving transistors 11*a* of all pixels are stored in the memory. For display on an EL display panel, voltage data of each pixel are read out of the memory and converted into a reference voltage by D/A (digital-analog) conversion. The reference voltage is applied as a precharge voltage Vp to the source signal line. After that, a program voltage is applied to the source signal line as required. Also, a target tone voltage is obtained by adding or subtracting a tone voltage to/from the reference voltage and applied to the driving transistor 11*a* of the pixel 16.

According to the present invention, voltage at the gate terminal of the pixel driver transistor is measured with a constant current being applied to the pixel transistor or outputted from the gate terminal of the pixel driver transistor. The gate terminal voltage varies among pixel driver transistors depending on the characteristics of the driver transistors.

Measuring the voltage at the gate terminal of the driver transistor with a constant current being applied to the driver transistor involves measuring the characteristics of the driver transistor. The measured voltage is stored in a memory placed or formed inside or outside a source driver IC (circuit) after A/D conversion. Alternatively, the measured or acquired voltage is sampled and held.

When displaying an image on the EL display apparatus, the voltage data stored in the memory are converted into analog voltage through D/A conversion, a target tone signal is obtained by adding or subtracting a tone voltage using the analog voltage as a reference or origin and is applied to the corresponding pixel. Alternatively, a target tone signal is obtained by adding or subtracting a tone voltage using the sampled and held voltage as a reference or origin and is applied to the corresponding pixel.

Thus, adding a video voltage corresponding to a tone or tone difference to the transistor with the measured voltage as a reference and applying the resulting signal to the transistor means applying a tone signal (voltage signal) acting as a video signal after compensating for the characteristics of the pixel driving transistor.

The gate terminal voltage of the driving transistor to be measured may be added/subtracted to/from the video voltage in real time after measurement but before application of the video voltage to the driving transistor of the pixel. The constant current may be zero (meaning that no current flows). In that case, the corresponding pixel can be selected and the driving transistor of the pixel can be shortened between gate and drain terminals without supplying a constant current Iw to the source signal line 18.

According to the present invention, the constant current Iw is a current set to a predetermined value or controlled to have a predetermined value and does not always need to be constant. That is, it means a current of a predetermined value. A constant current generating circuit may be included in a current tone circuit 154 or a separate constant current generating circuit may be provided. No constant current generating circuit is required for image display when passing the constant current Iw through the source signal line 18, measuring or acquiring the potential of the source signal line 18, and storing the measured or acquired potential as data in a memory or other storage device. That is, the constant current generating circuit is not part of the EL display apparatus.

The current programming mode has the disadvantage that it cannot compensate sufficiently for the characteristics of pixel transistors. However, by using current programming mode in which a constant current is applied to pixel transistors and measuring the gate terminal potential of the transistors, the present invention exercises its ability to compensate for transistor characteristics, which is an advantage of the current programming mode.

According to a first aspect of the present invention, the potential of the source signal line 18 is measured or acquired by selecting a pixel row and applying a constant current not lower than a predetermined level to the source single line 18. The measured potential represents the characteristics of the driving transistors 11 in the selected pixel row. The measured or acquired voltage is applied as a precharge voltage Vp to the source signal line 18 either directly or after an addition/subtraction process, thereby bringing the potential of the source signal line 18 close to a target potential. Then, a program current corresponding to a target video signal is written into the pixel 16.

A tone current for use in programming is determined using, as required, the measured or acquired voltage as a variable value for a function which determines tone for the video signal. The determined tone current is written into the pixel 16, and N-fold driving described with reference to FIGS. 6 and 9 is performed as required. By applying the precharge voltage Vp and using a constant current not lower than a predetermined level, it is possible to eliminate the problem of insufficient writing in low tone regions (low current regions), which is a weak point of the current programming mode.

According to a second aspect of the present invention, the potential of the source signal line 18 is measured by selecting a pixel row and applying a constant current not lower than a predetermined level to the source signal line 18. The measured potential represents the characteristics of the driving transistors 11 in the selected pixel row.

A target tone voltage is determined using the measured voltage as a variable value for a function which determines tone for the video signal. By applying the determined tone voltage to the source signal line 18, the driving transistors in the selected pixel row is programmed so that a target current will flow through the EL element 15. Thus, the signal corresponding to the video signal applied to the pixel 16 is a voltage signal. The use of the voltage signal makes it possible to avoid insufficient writing even in low tone regions.

Thus, by calculating or determining tone voltages through addition or subtraction based on the measured voltages of the source signal lines 18 and applying the tone voltages to pixel transistors, it is possible to demonstrate a feature of voltage driving, i.e., the advantage of avoiding insufficient writing in all tone regions.

Although it is stated herein that the gate terminal voltage of the transistor is measured or held either directly or indirectly by applying a constant current to the transistor, the present invention is not limited to this. Also, in addition to the magnitude of voltage, the amount of changes in the voltage before and after the application of the constant current, speed of voltage changes, difference value of the voltage may also be measured and stored in memory.

The measurement of voltage also includes the act of holding the measured voltage inside or outside a driver circuit after analog-digital conversion (A/D conversion) and configuration therefor as well as the act of holding the voltage as digital data in memory. Also, it includes the act of not only measuring, but also temporarily holding, latching, or storing the voltage in a capacitor or other holding medium and configuration therefor. Besides, the constant current includes a state in which no current (0 A) is applied.

The constant current is not limited to being a fixed value. It may vary in one horizontal scanning period as does a sine waveform. It may have any configuration or value as long as it has a predetermined value when averaged over a certain period.

BRIEF DESCRIPTION OF THE DRAWINGS

FIG. 34 is a block diagram of a driver circuit of an EL display panel according to the present invention;

FIG. 120 is a schematic diagram of a driving method of an EL display panel according to the present invention;

FIG. 121 is a schematic diagram of a driving method of an EL display panel according to the present invention;

FIG. 122 is a block diagram of a driver circuit of an EL display panel according to the present invention;

FIG. 123 is a schematic diagram of a driving method of an EL display panel according to the present invention;

FIG. 124 is a block diagram of a driver circuit of an EL display panel according to the present invention;

FIG. 125 is a block diagram of a driver circuit of an EL display panel according to the present invention;

FIG. 126 is a block diagram of a driver circuit of an EL display panel according to the present invention;

FIG. 127 is a block diagram of a driver circuit of an EL display panel according to the present invention;

FIG. 128 is a block diagram of a driver circuit of an EL display panel according to the present invention;

FIG. 129 is a block diagram of a driver circuit of an EL display panel according to the present invention;

FIG. 130 is a schematic diagram of a driving method of an EL display panel according to the present invention;

FIG. 131 is a schematic diagram of a driving method of an EL display panel according to the present invention;

Figure 132:
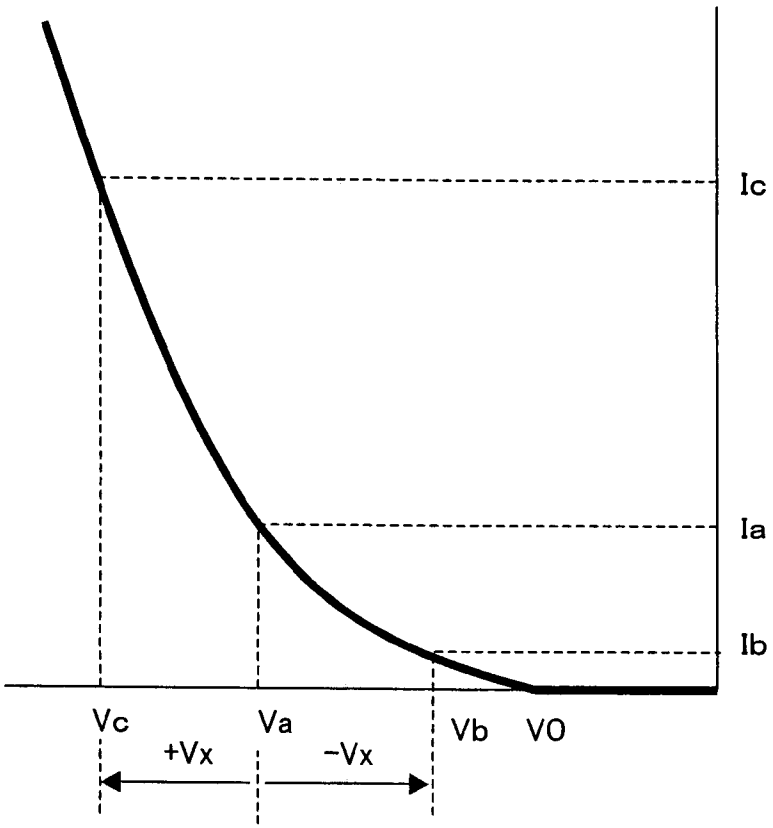
Figure 133:
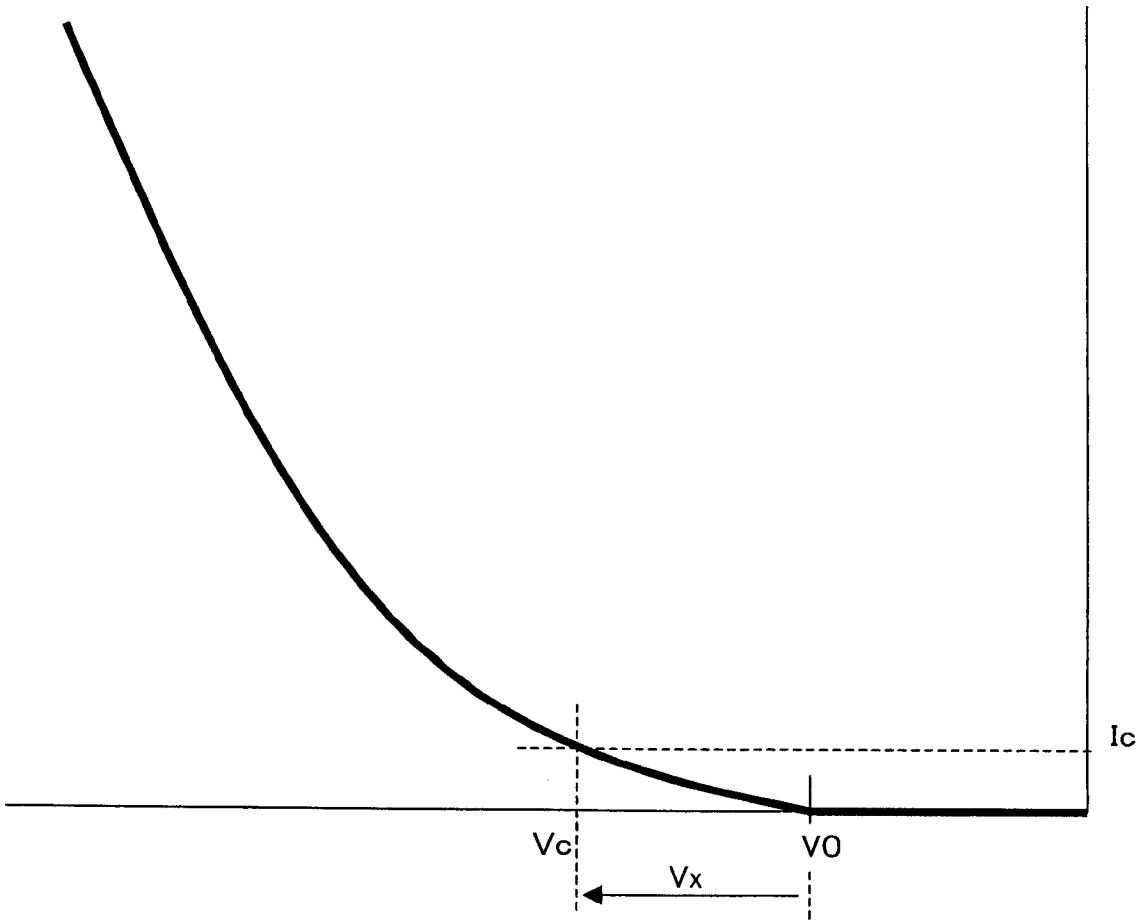
Figure 134:
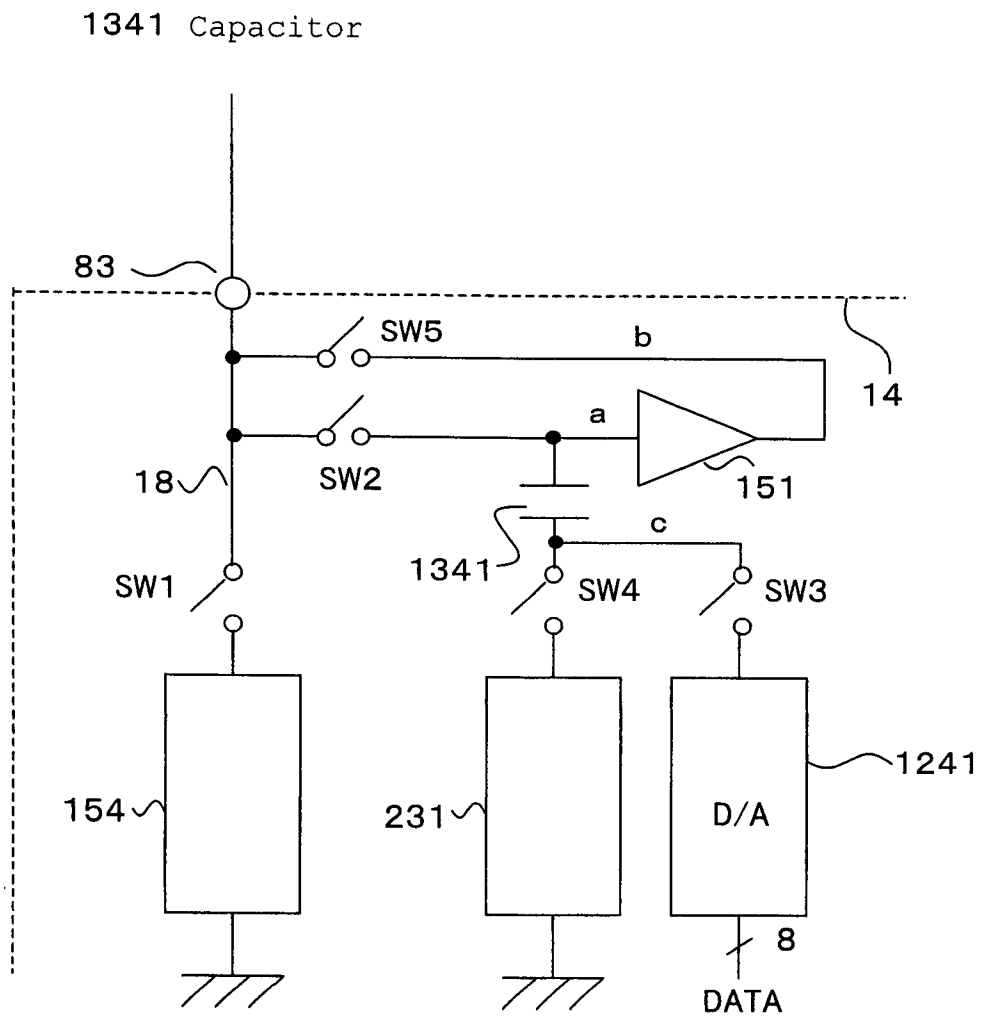
Figure 135:
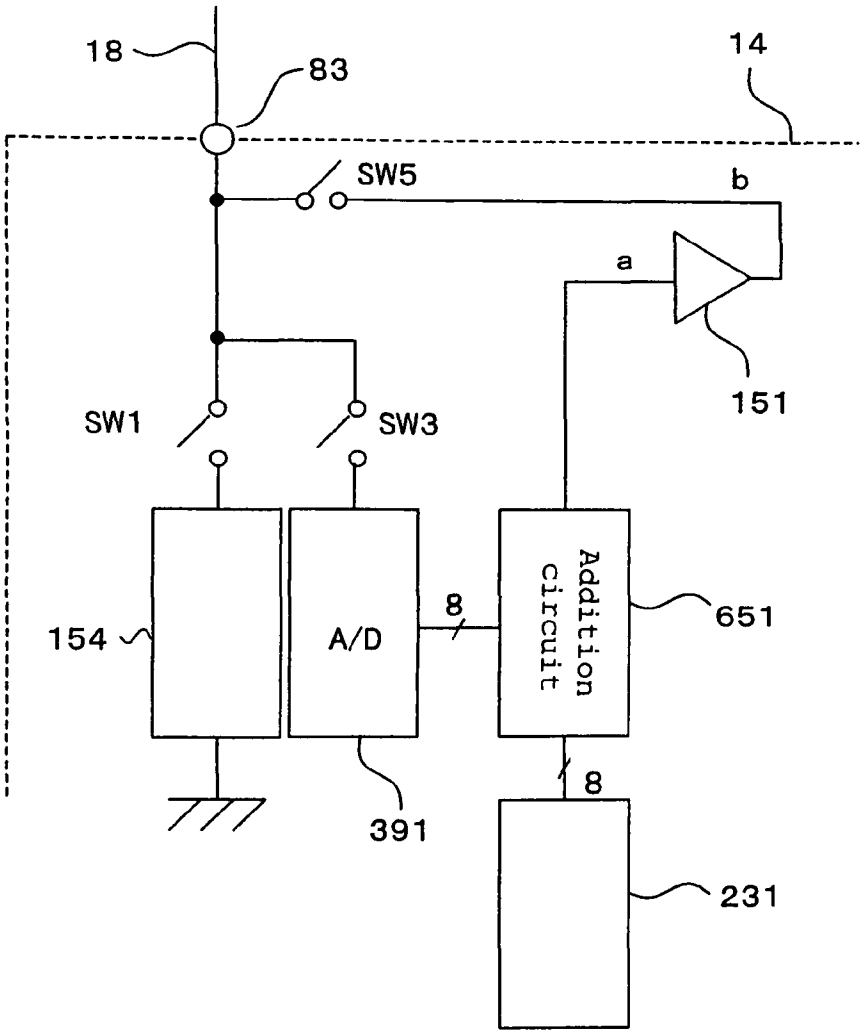
Figure 136:
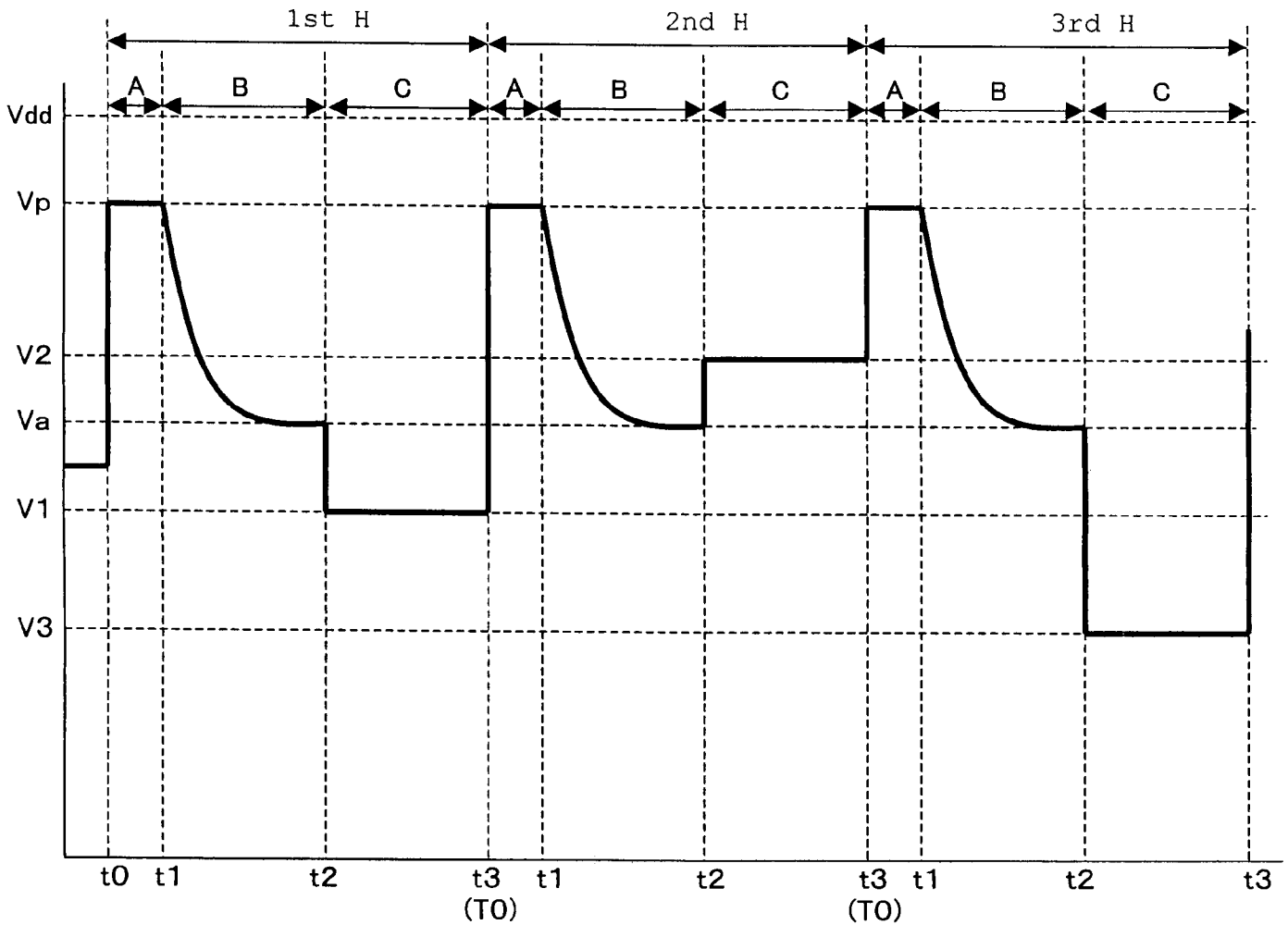
Figure 137:
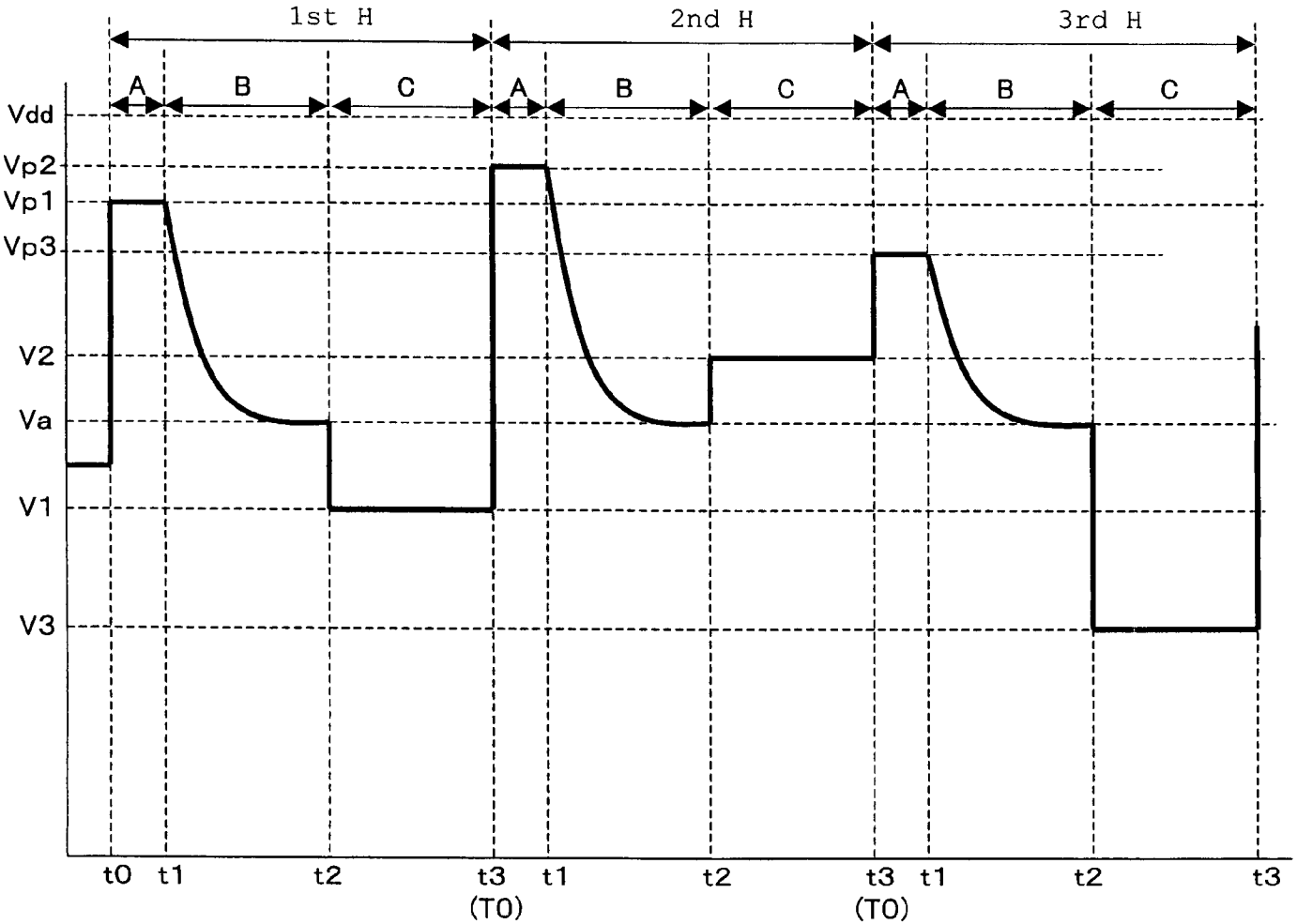
Figure 138:
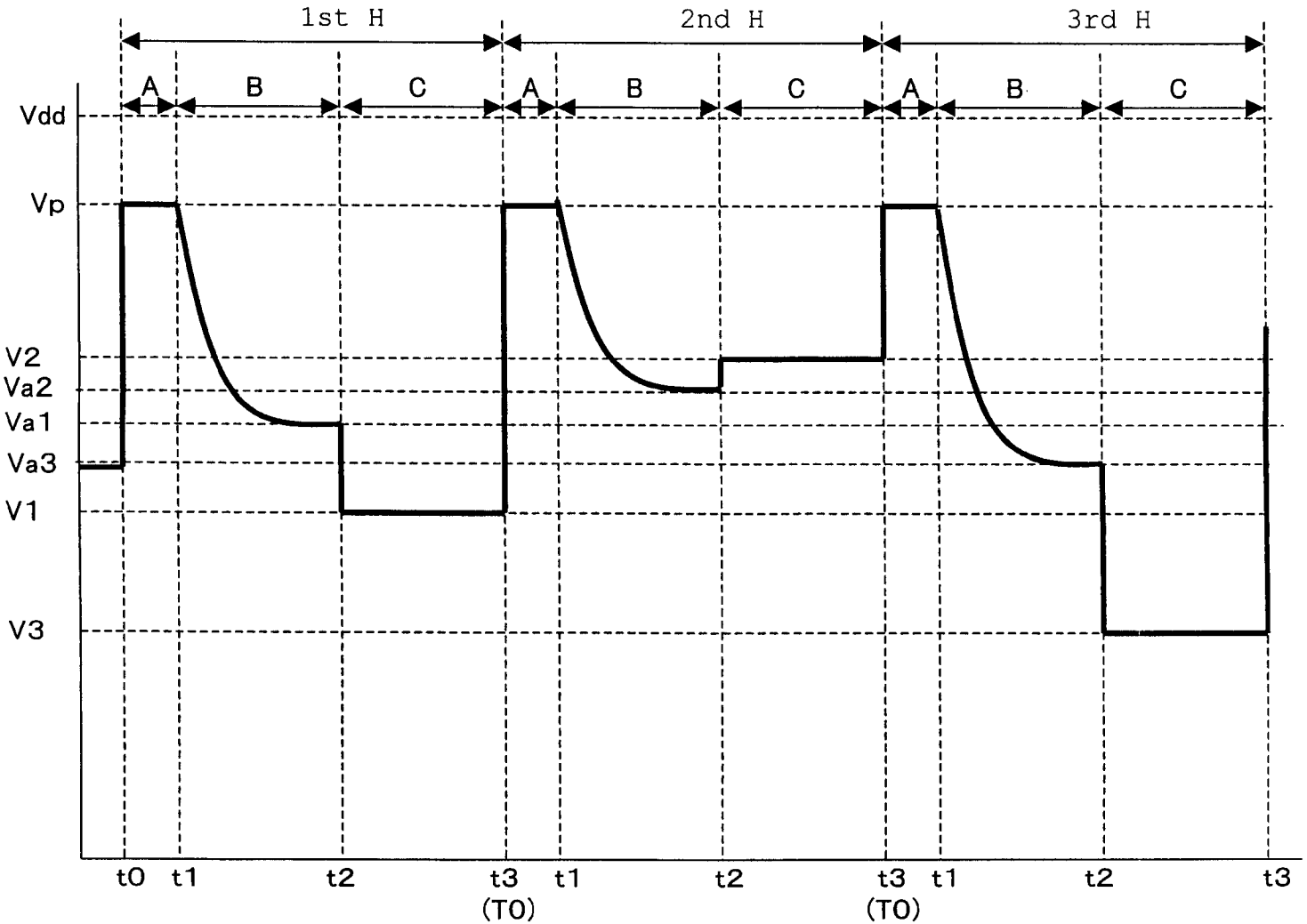
Figure 139:
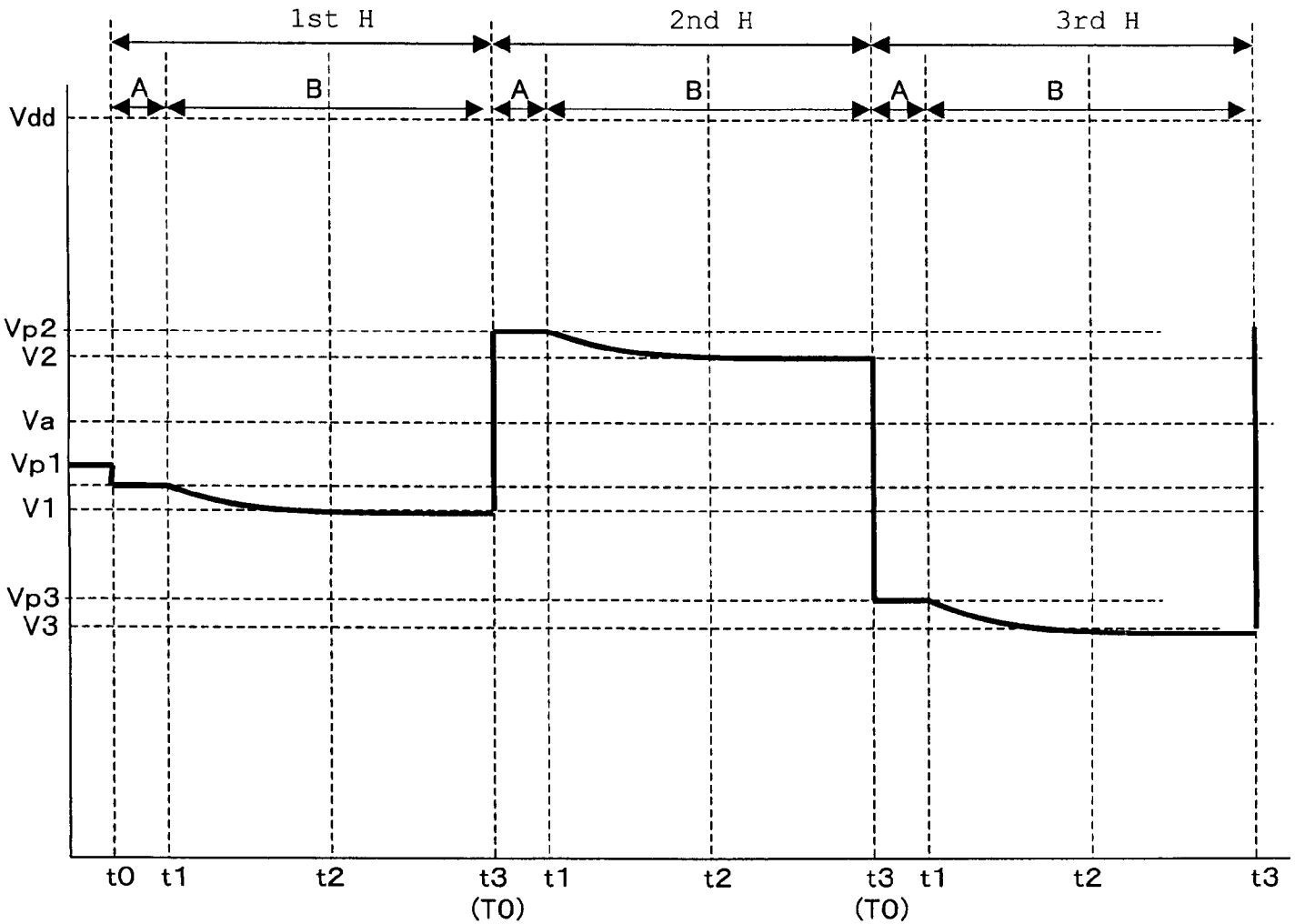
Figure 140:
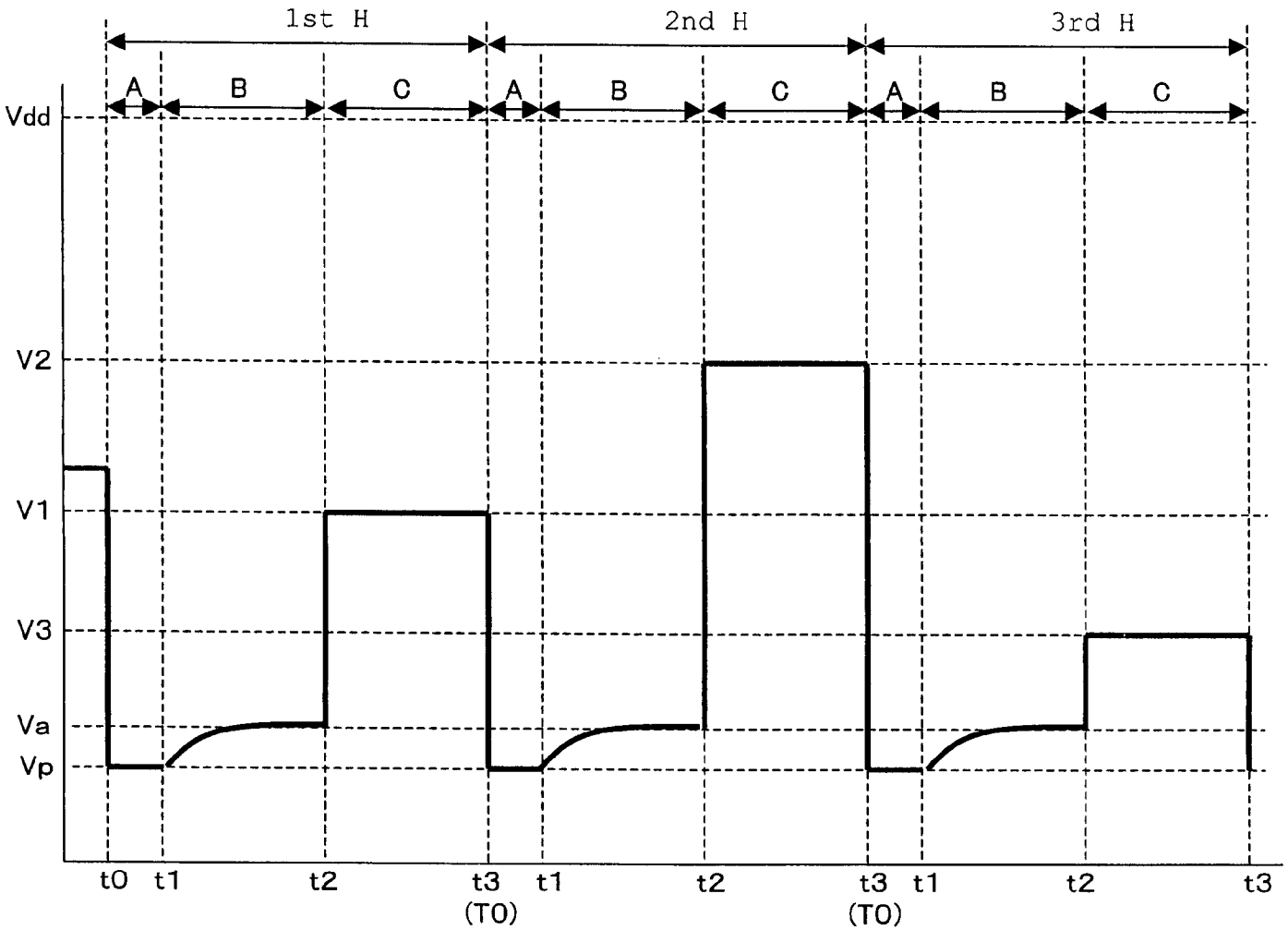
Figure 141:
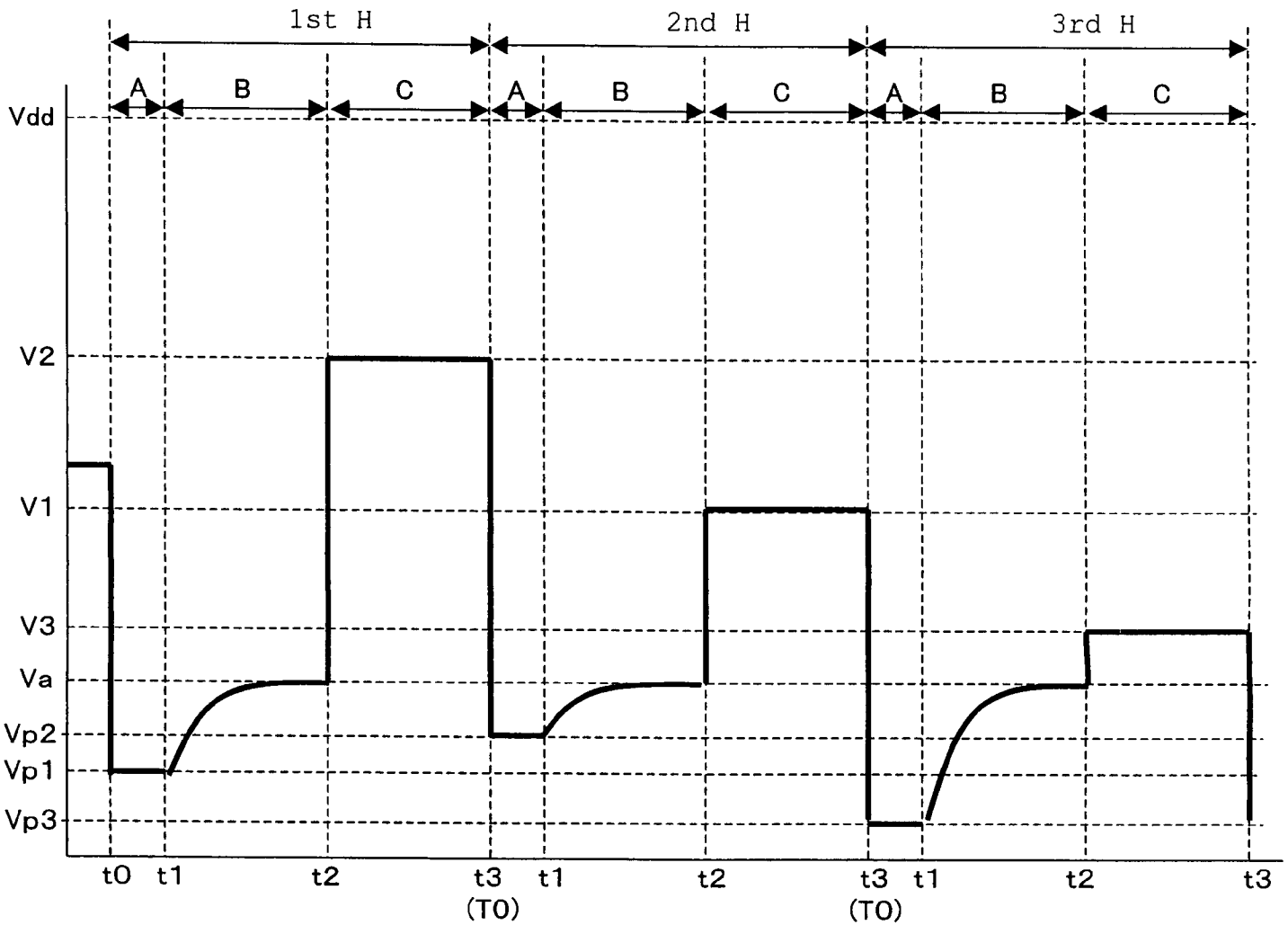
Figure 142:
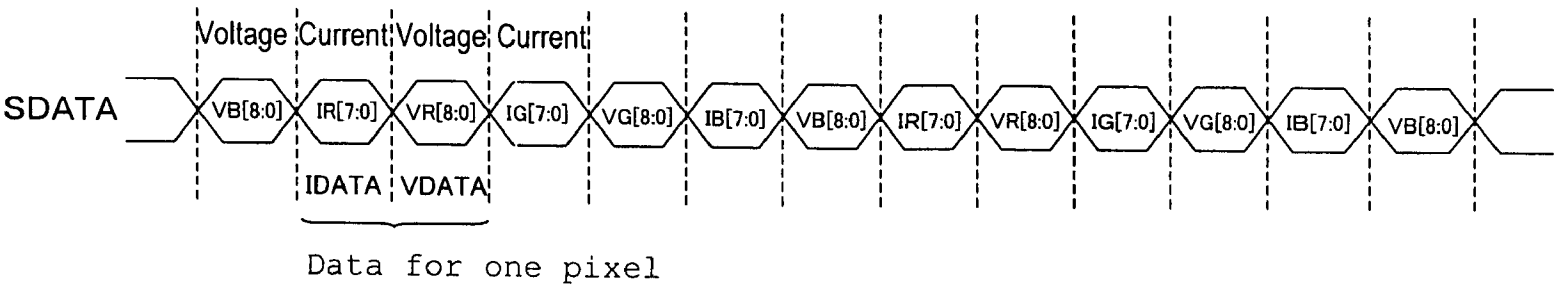
Figure 143:
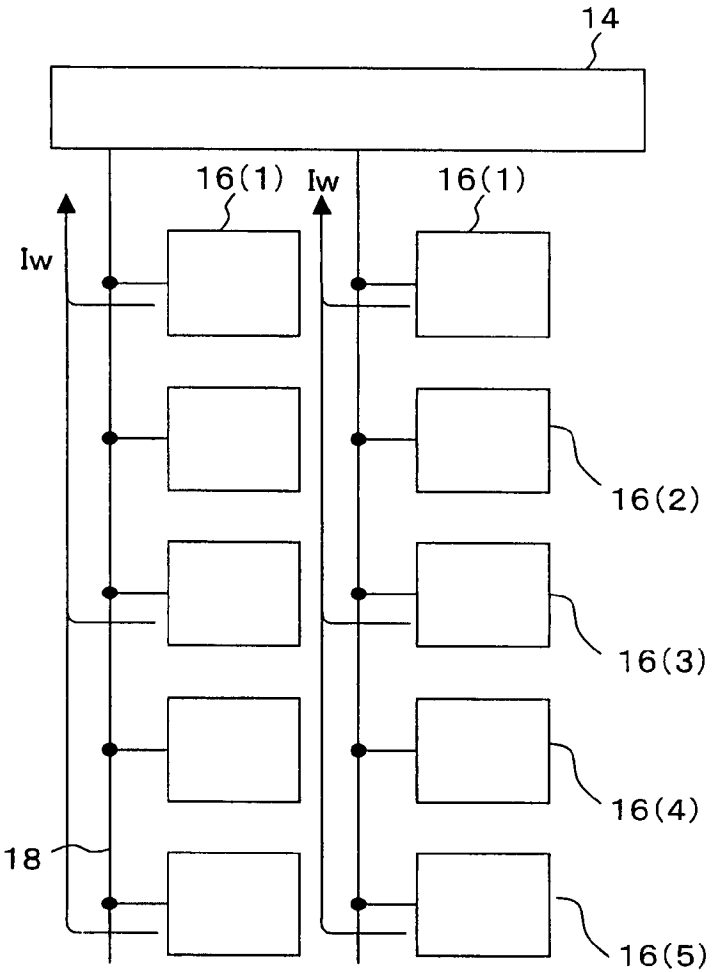
Figure 143:
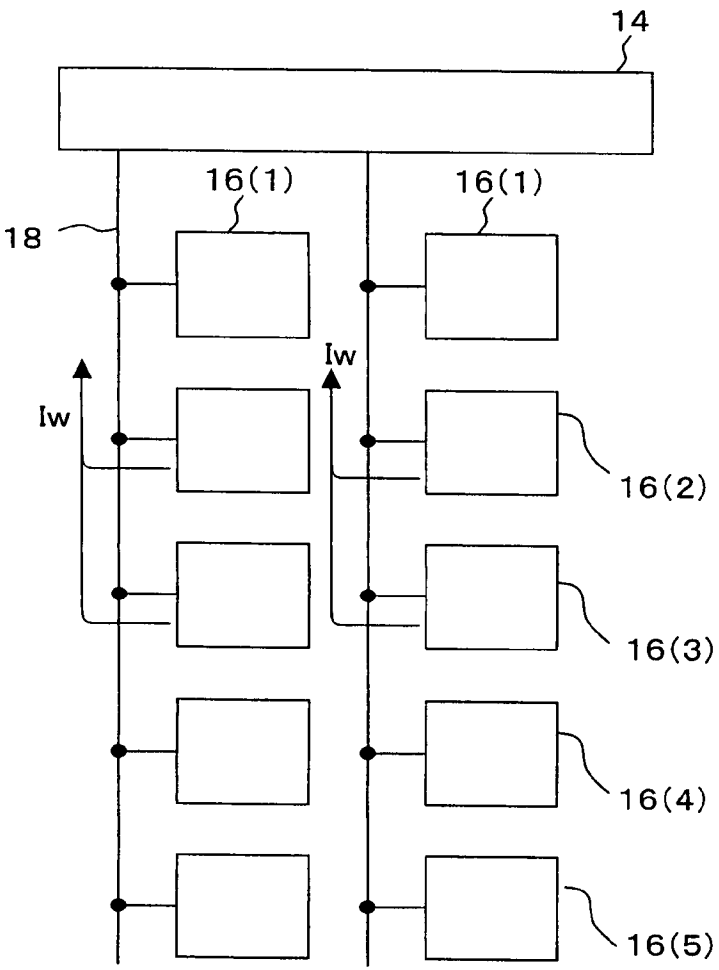
Figure 144:
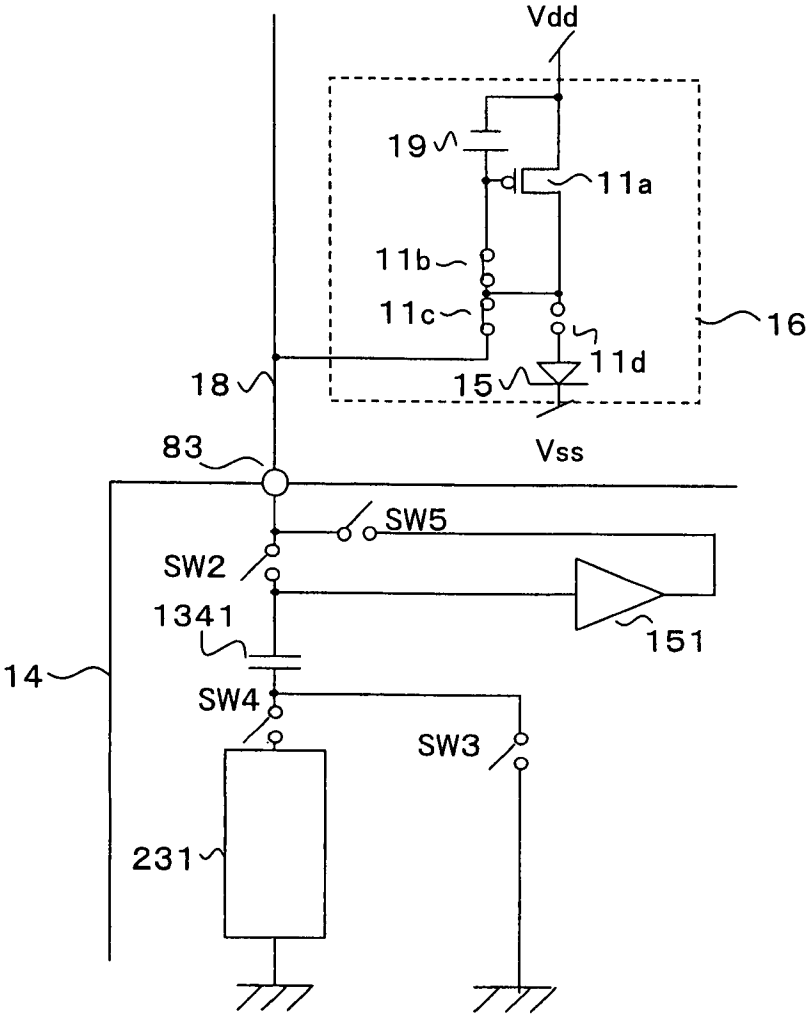
Figure 145:
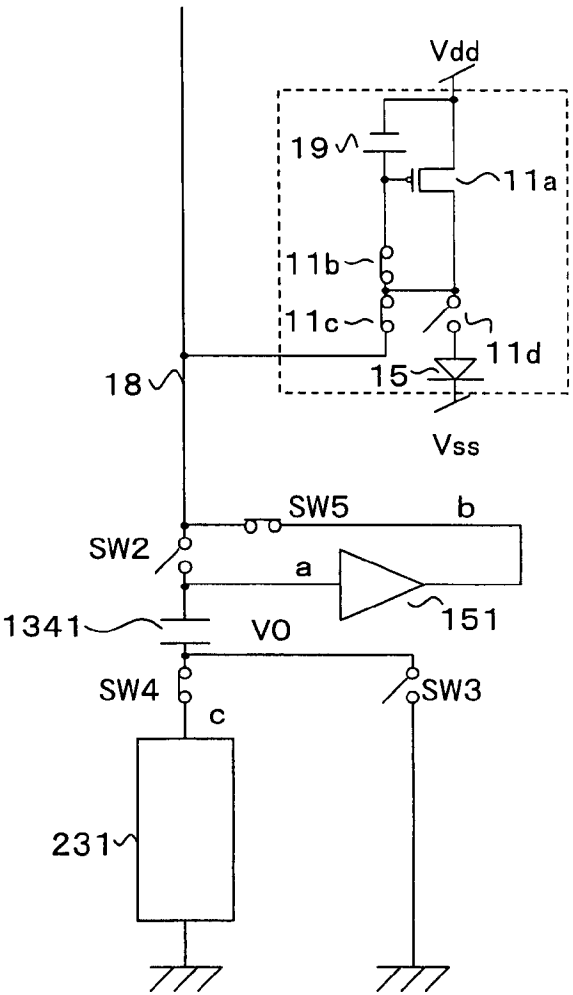
Figure 145:
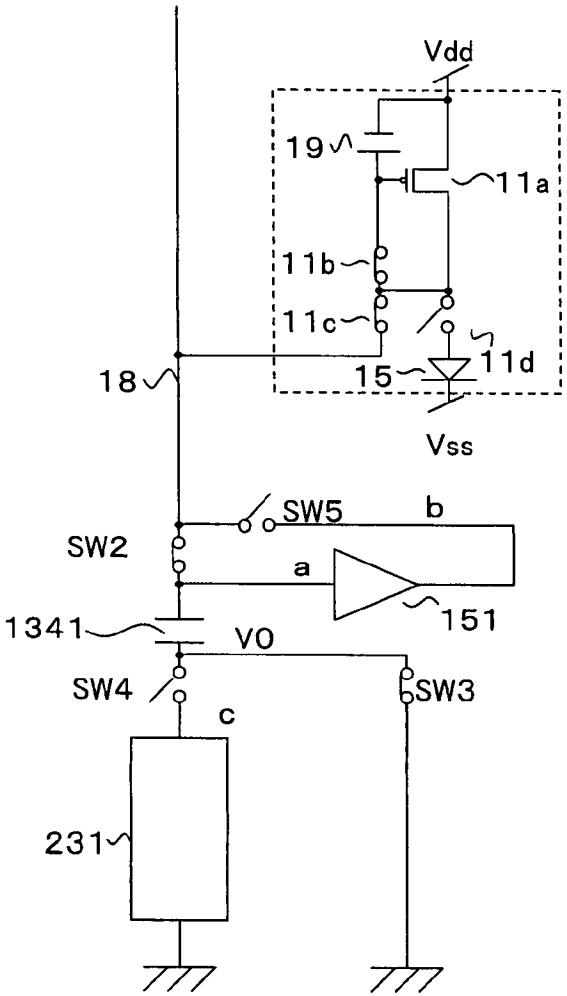
Figure 146:
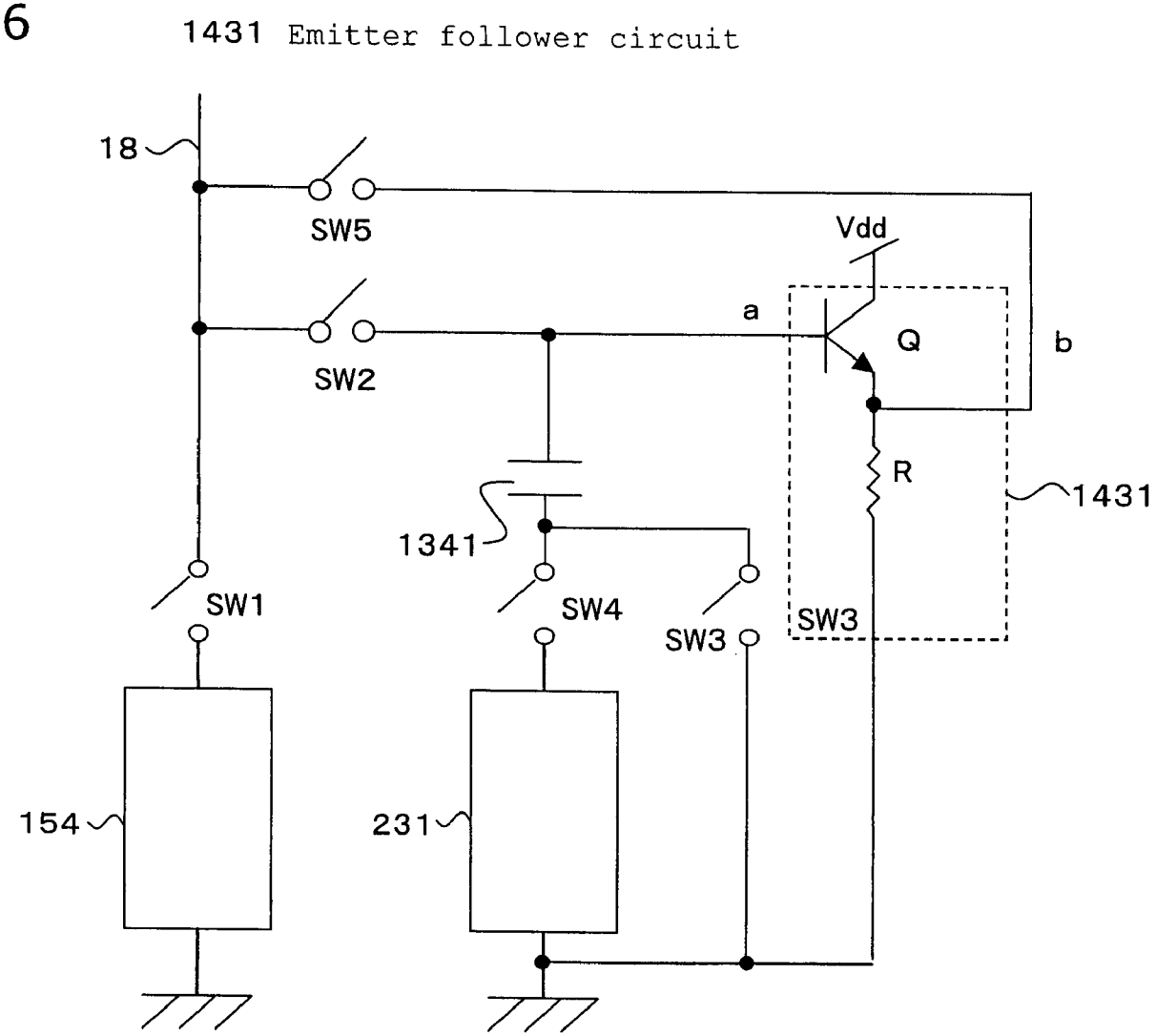
Figure 147:
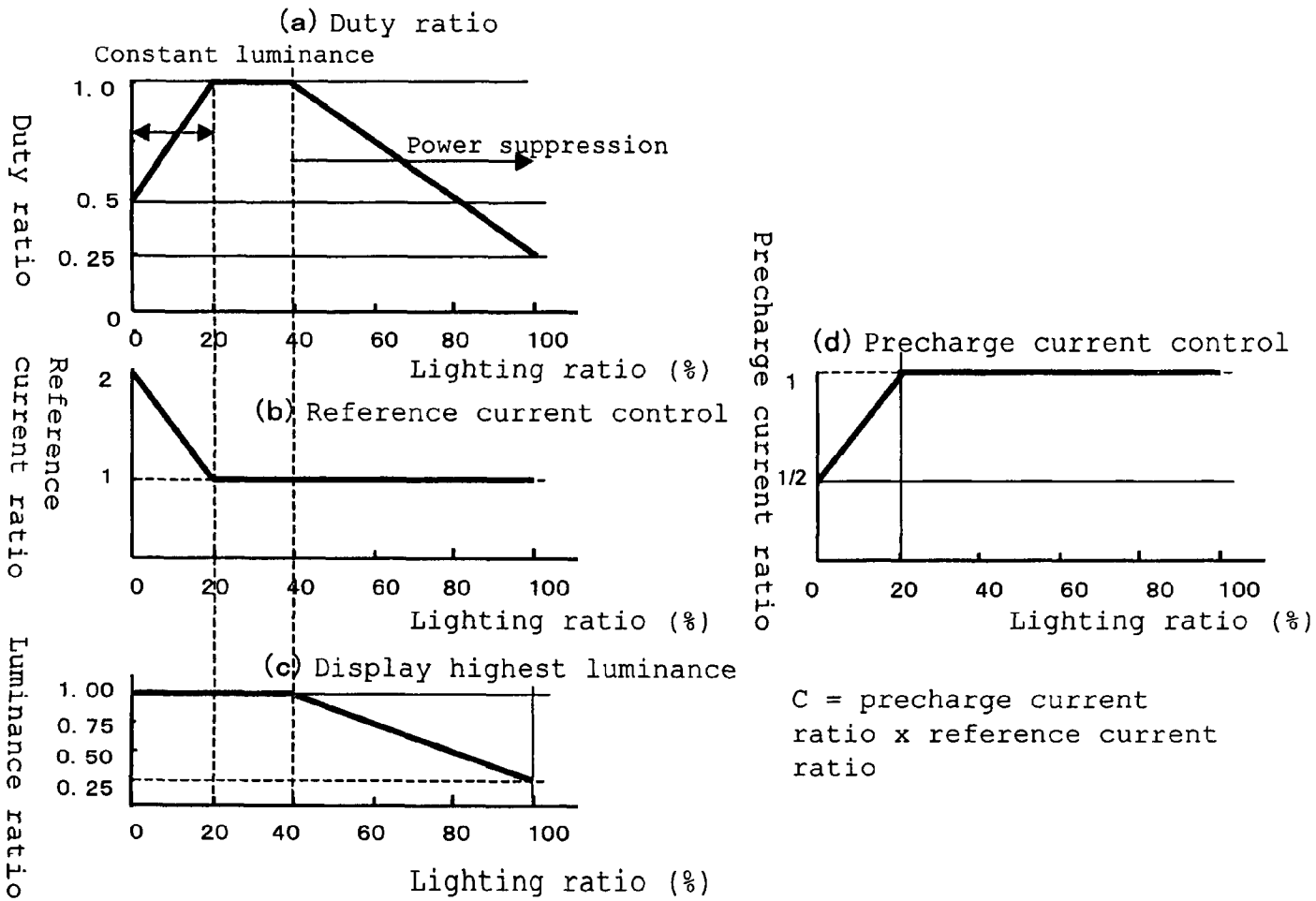
Figure 148:
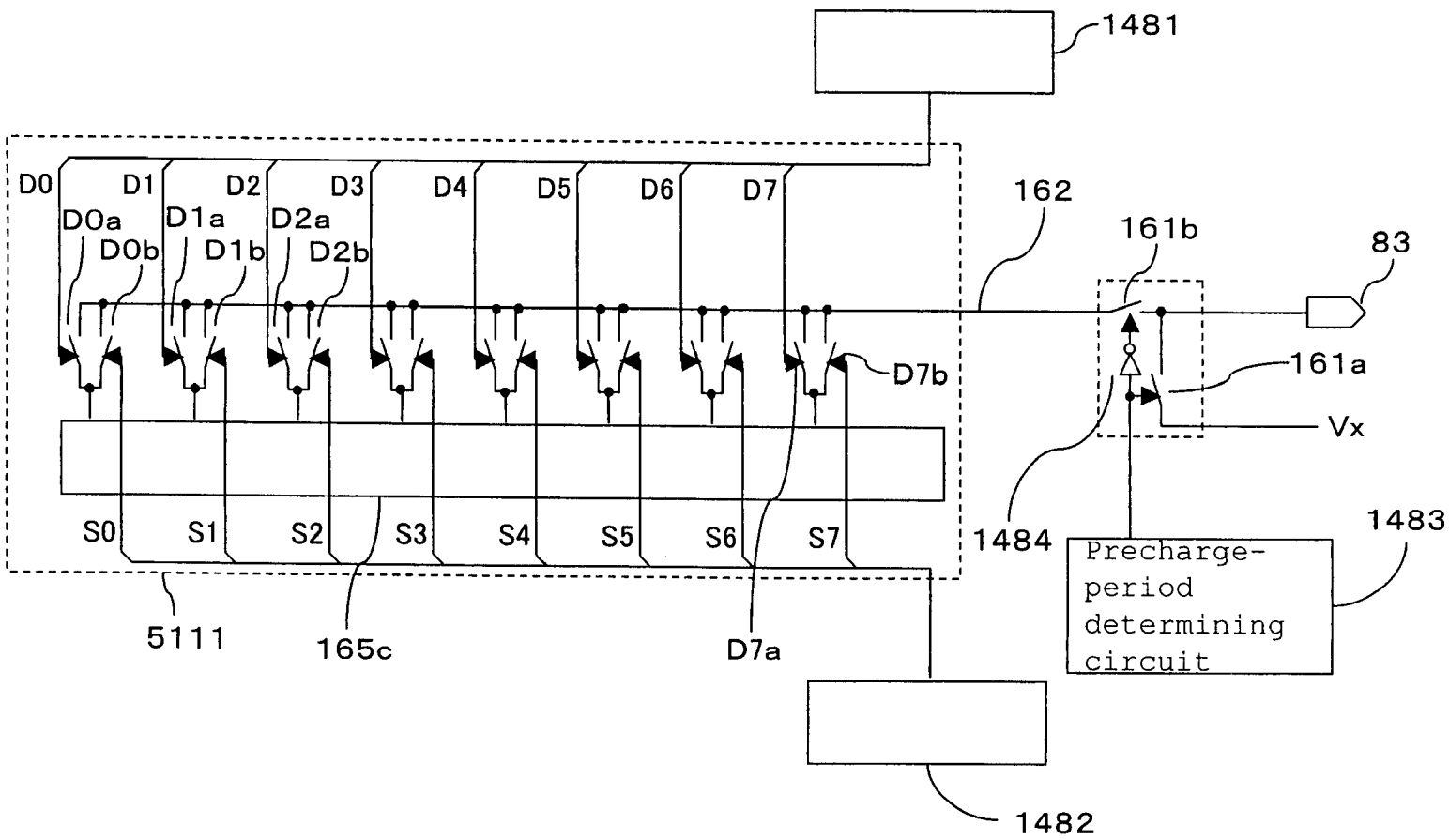
Figure 149:
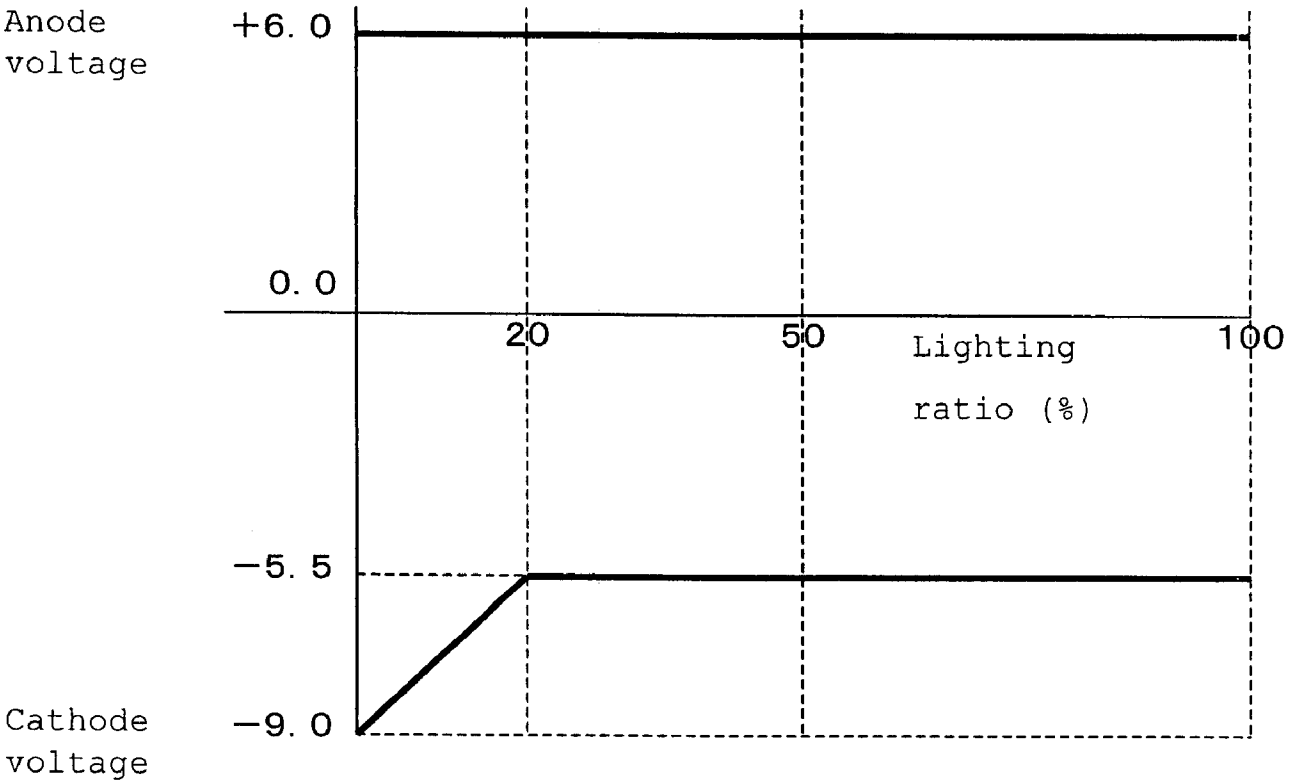
Figure 150:
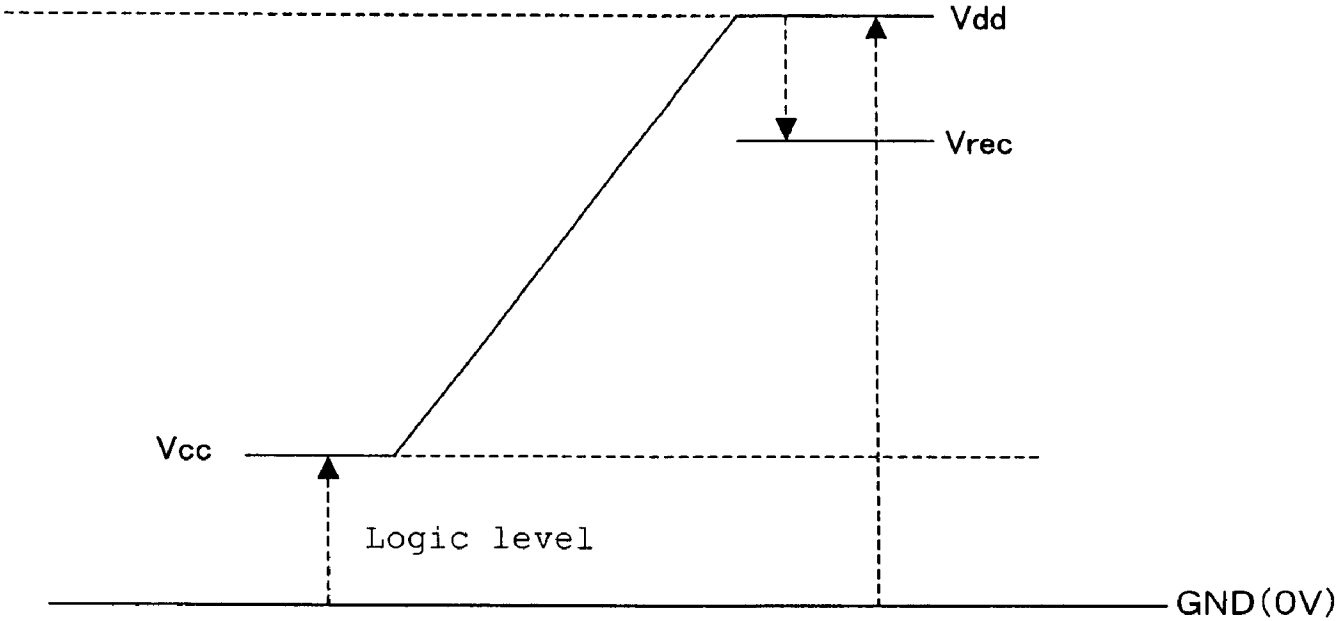
Figure 151:
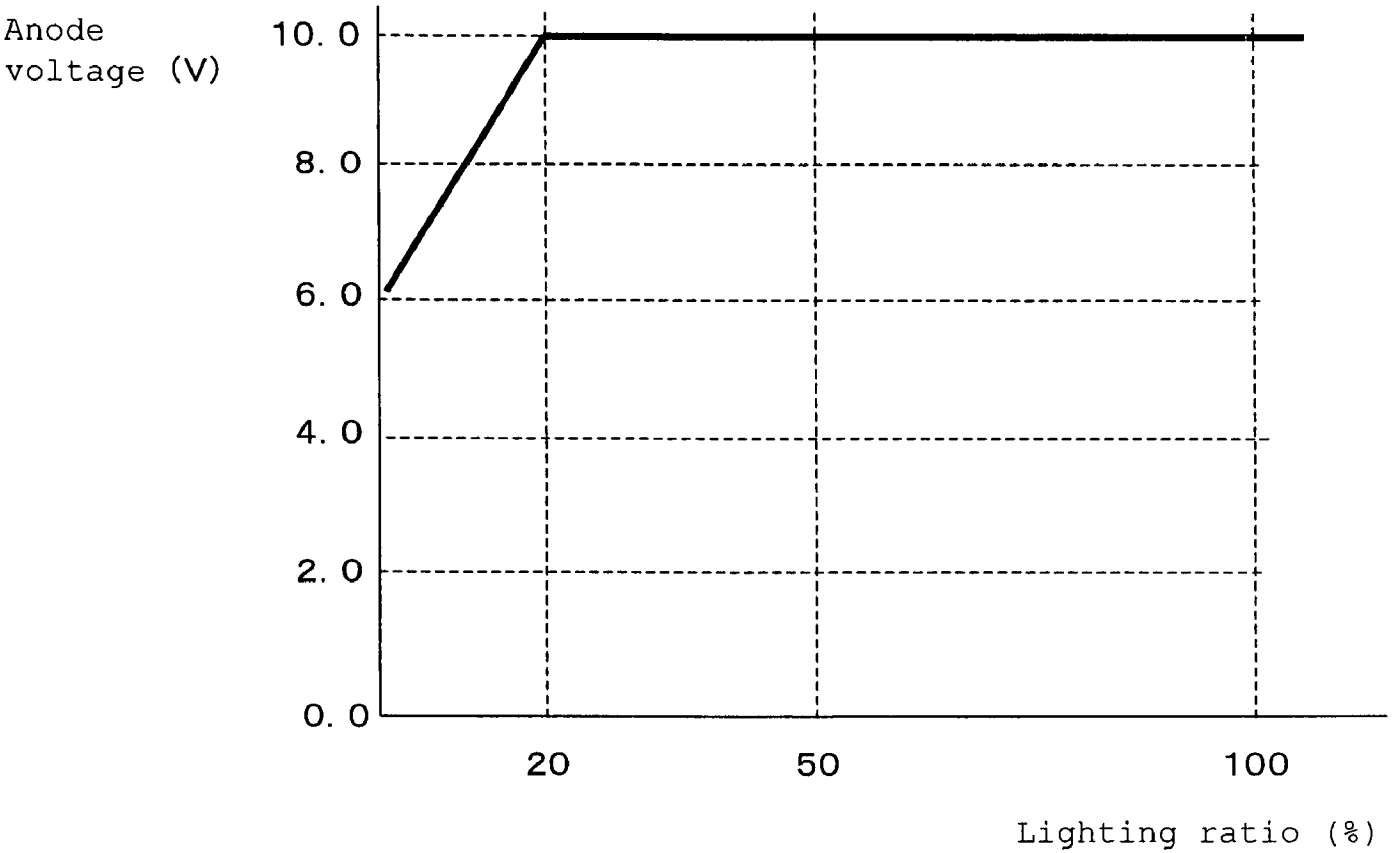
Figure 152:
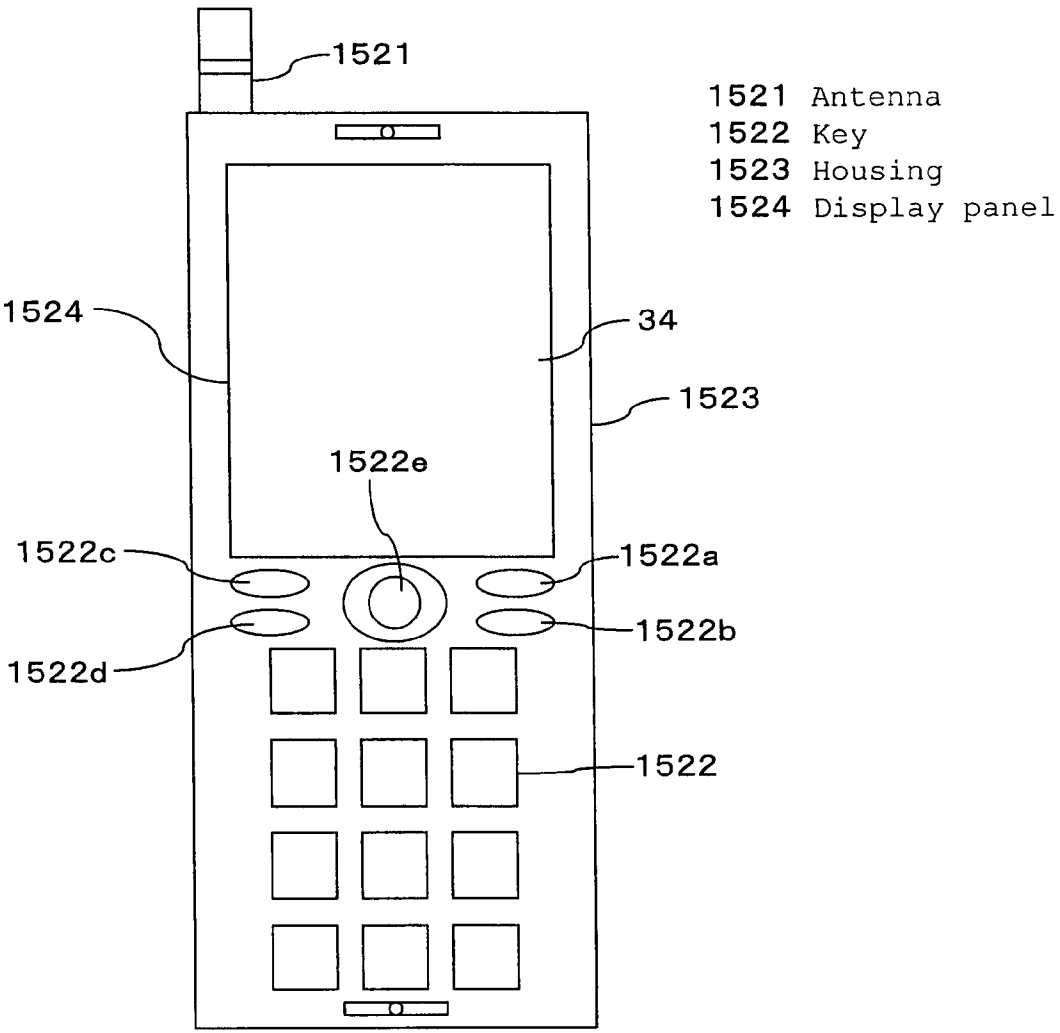
Figure 153:
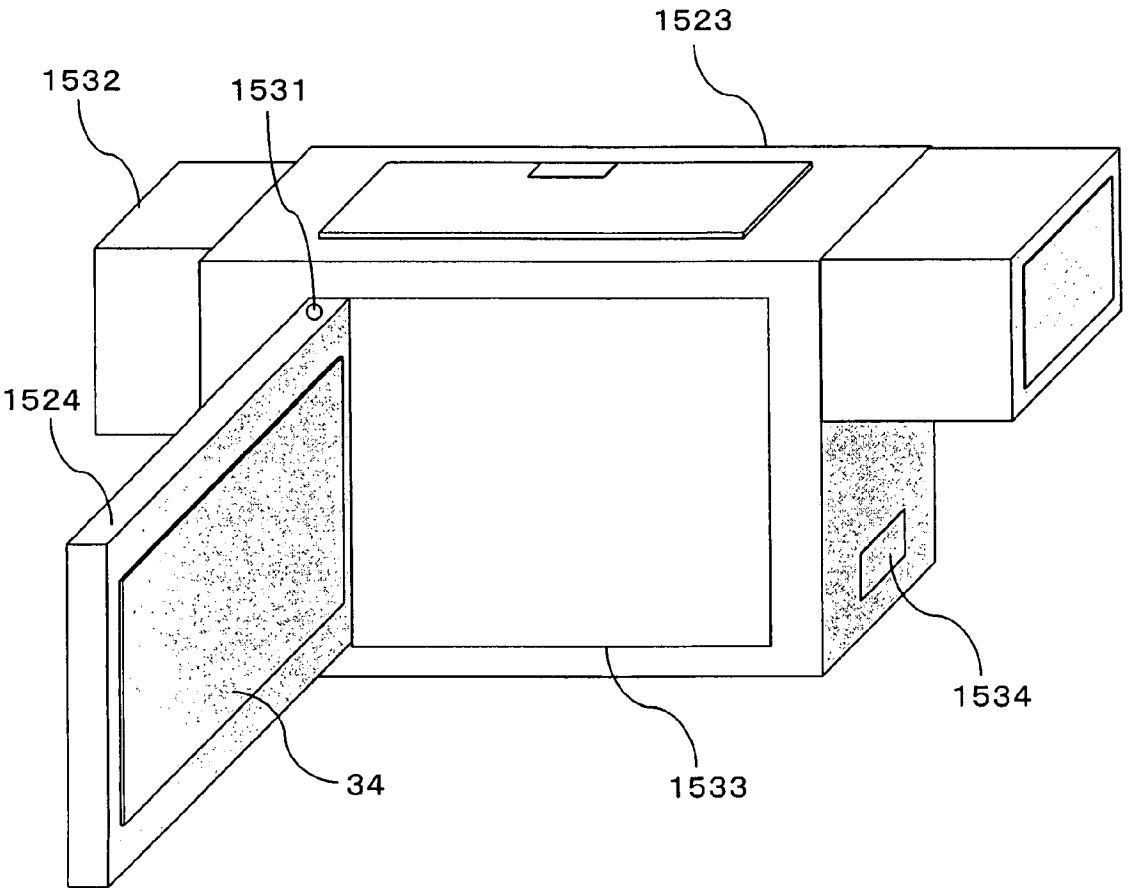
Figure 154:
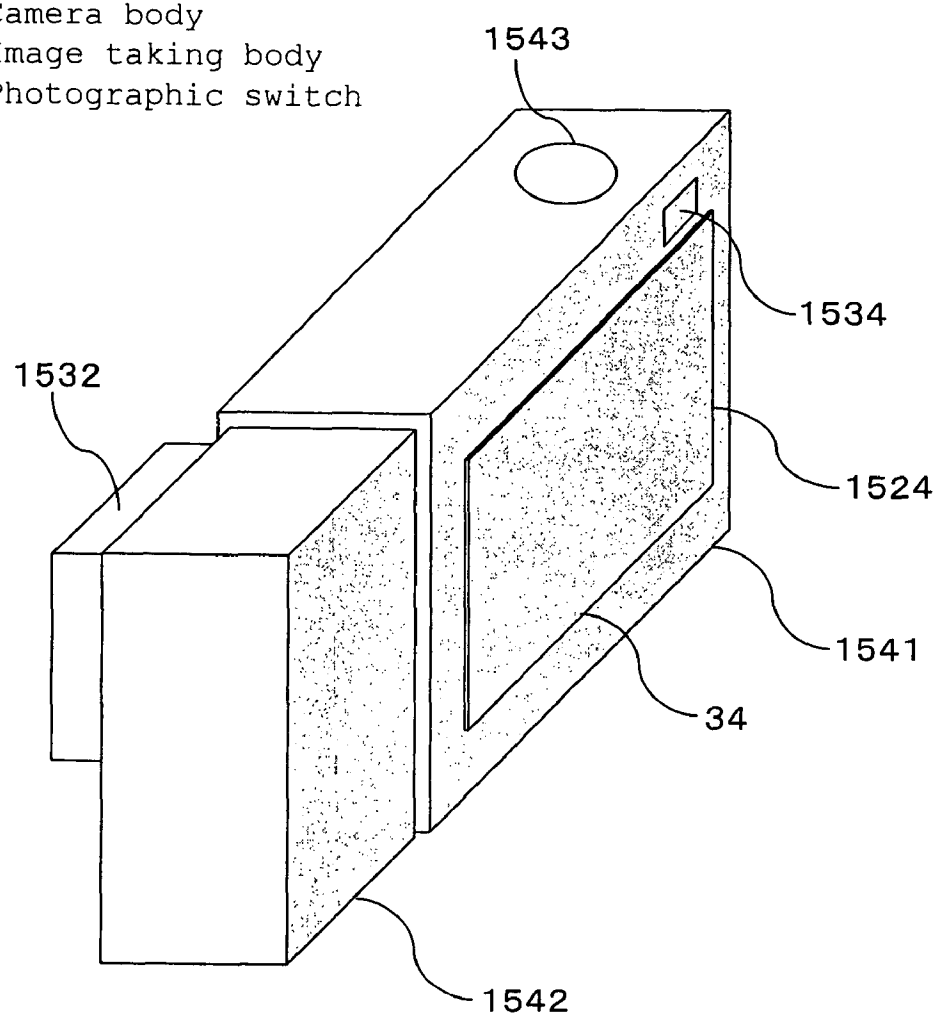

FIG. 132 is a schematic diagram of a driving method of an EL display panel according to the present invention;

FIG. 133 is a schematic diagram of a driving method of an EL display panel according to the present invention;

FIG. 134 is a schematic diagram of a driving method of an EL display panel according to the present invention;

FIG. 135 is a schematic diagram of a driving method of an EL display panel according to the present invention;

FIG. 136 is a schematic diagram of a driving method of an EL display panel according to the present invention;

FIG. 137 is a schematic diagram of a driving method of an EL display panel according to the present invention;

FIG. 138 is a schematic diagram of a driving method of an EL display panel according to the present invention;

FIG. 139 is a schematic diagram of a driving method of an EL display panel according to the present invention;

FIG. 140 is a schematic diagram of a driving method of an EL display panel according to the present invention;

FIG. 141 is a schematic diagram of a driving method of an EL display panel according to the present invention;

FIG. 142 is a schematic diagram of a driving method of an EL display panel according to the present invention;

FIG. 143 is a schematic diagram of a driving method of an EL display panel according to the present invention;

FIG. 144 is a schematic diagram of a driving method of an EL display panel according to the present invention;

FIG. 145 is a schematic diagram of a driving method of an EL display panel according to the present invention;

FIG. 146 is a schematic diagram of a driving method of an EL display panel according to the present invention;

FIG. 147 is a schematic diagram of a driving method of an EL display panel according to the present invention;

FIG. 148 is a schematic diagram of a driving method of an EL display panel according to the present invention;

FIG. 149 is a schematic diagram of a power circuit of an EL display apparatus according to the present invention;

FIG. 150 is a schematic diagram of a power circuit of an EL display apparatus according to the present invention;

FIG. 151 is a schematic diagram of a power circuit of an EL display apparatus according to the present invention;

FIG. 152 is a schematic diagram of an EL display apparatus according to the present invention;

FIG. 153 is a schematic diagram of an EL display apparatus according to the present invention, and FIG. 154 is a schematic diagram of an EL display apparatus according to the present invention.

DESCRIPTION OF SYMBOLS

11 Transistor (TFT)
12 Gate driver IC (circuit)
14 Source driver circuit (IC)
15 EL (element) (light-emitting element)
16 Pixel
17 Gate signal line
18 Source signal line
19 Storage capacitance (additional capacitance)
30 Array board (transparent board, glass board)
31 Shift register circuit
32 Buffer circuit
34 Display screen
61 Write row
62 Non-display area (non-illuminated area, black display area)
63 Display area (illuminated area, image display area)
81 Current holding circuit
82 Polysilicon current holding circuit (built-in current holding circuit)
83 Output terminal
151 Operation amplifier (buffer circuit)
152 Electronic regulator (voltage output circuit)
153 Constant current circuit
154 Current tone circuit
161 Switch (on-off instrument, selection instrument)
162 Internal wiring (current output wiring)
163 Gate wiring
164 Unit transistor (unit current source)
165 Transistor group
167 Transistor
168 Transistor
211 Coincidence circuit
212 Counter circuit
213 AND (circuit)
214 Precharge circuit (precharge voltage generating circuit)
221 Latch circuit
222 Selector circuit (selection circuit)
231 Voltage tone circuit (voltage output circuit)
241 Sample hold circuit
242 Source signal line terminal
291 Switching circuit
321 Unit transistor
331 Comparison circuit
381 Voltage measuring circuit (voltage obtaining circuit)
391 A/D conversion circuit
441 Switching circuit
443 Averaging circuit
501 Source signal line potential detection line
502 Memory (storage instrument)
521 Voltage measuring circuit (IC)
611 Voltage wiring
651 Calculation circuit (processing circuit)
801 Control IC (circuit)
841 Short circuit wiring
842 Terminal electrode
843 Probe
844 Constant current source
845 Wiring
851 Temperature compensation circuit
931 Lookup table
951 OR CIRCUIT
1051 Flash memory
1092 Laser irradiation spot (excimer laser spot)
1093 Positioning marker
1094 Glass substrate
1221 Cascade circuit
1222 Voltage wiring
1241 D/A conversion circuit
1271 Constant current output circuit
1311 Switch circuit
1312 Constant current source
1313 Current output circuit
1341 Capacitor
1431 Emitter follower circuit
1481 Tone switch control circuit
1482 Precharge current control circuit
1483 Precharge-period determining circuit
1484 Inverter circuit
1521 Antenna
1522 Key
1523 Housing
1524 Display panel
1531 Supporting point
1532 Image taking lens

1533 Storage section
1534 Switch
1541 Camera body
1542 Image taking body
1543 Photographic switch

PREFERRED EMBODIMENTS OF THE INVENTION

Some parts of drawings herein are omitted and enlarged and/or reduced herein for ease of understanding and illustration. Besides, the same or similar forms, materials, functions, or operations are denoted by the same reference numbers or characters.

Thin-film transistors are cited herein as driver transistors 11*a* and switching transistors 11*b*, and the like, this is not restrictive. Thin-film diodes (TFDs) or ring diodes may be used instead. Also, the present invention is not limited to thin-film elements, and transistors formed on silicon wafers may also be used. Needless to say, transistors may also be FETs, MOS-FETs, MOS transistors, or bipolar transistors. It goes without saying that the present invention may also use diodes, varistors, thyristors, ring diodes, photodiodes, phototransistors, or PLZT elements.

A source driver circuit (IC) 14 is not only a mere driver but may incorporate a power circuit (charge pump circuit, DCDC converter circuit), buffer circuit (including a circuit such as a shift register), level shifting circuit, data conversion circuit, latch circuit, command decoder, address conversion circuit, image memory, etc. A source driver circuit (IC) 14 may be formed on the array board 30 by polysilicon technology.

Although the array board 30 is described as being a glass substrate, it may be made of a silicon wafer. Also, the array board 30 may be made of a metal substrate, silicon or other semiconductor substrate, ceramic substrate, plastic sheet (board) or the like.

Needless to say, the transistors 11, gate driver circuits 12, and source driver circuits (ICs) 14 composing the display panel of the present invention may be formed on a glass substrate or the like and subsequently transferred to another substrate (plastic sheet) by transfer technology.

First, description will be given of configuration and operation of pixels 16 in an EL display apparatus according to the present invention as well as a source driver circuit (IC) 14 and the like.

Figure 1:
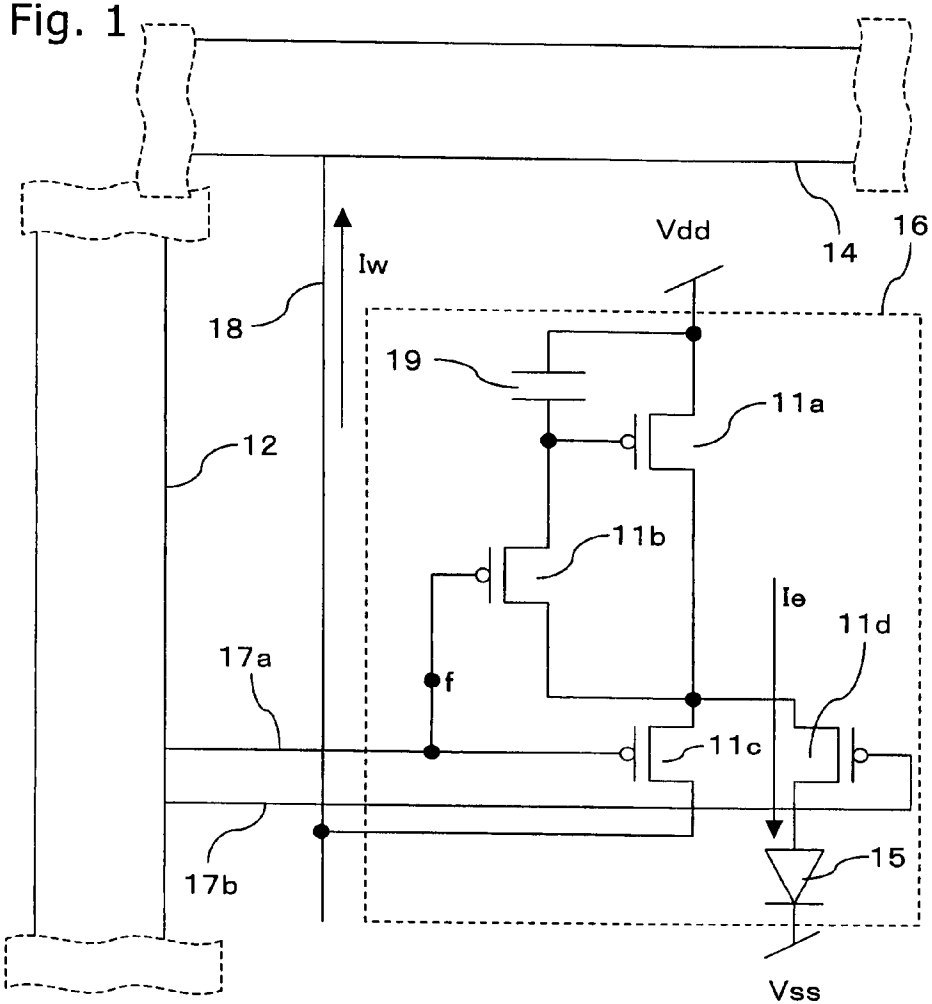
FIG. 1 is a pixel block diagram of an EL display panel according to the present invention.

FIG. 1 is a block diagram of a pixel in the EL display apparatus according to the present invention. There are four transistors (TFTs) 11 (11*a*, 11*b*, 11*c*, 11*d*) in a single pixel. A gate terminal of a driving transistor 11*a* is connected to a source terminal of a transistor 11*b*. Gate terminals of the transistor 11*b* and transistor 11*c* are connected to a gate signal line 17*a*. A drain terminal of the transistor 11*b* is connected to a source terminal of the transistor 11*c* and source terminal of the transistor 11*d* while a drain terminal of the transistor 11*c* is connected to a source signal line 18. A gate terminal of the transistor 11*d* is connected to a gate signal line 17*b* while a drain terminal of the transistor 11*d* is connected to an anode electrode (terminal) of an EL element 15.

In a pixel configuration shown in FIG. 1, the gate terminals of the transistors 11*b* and 11*c* are connected to the gate signal line 17*a*. The transistors 11*b* and 11*c* are turned on (closed) and off (opened) by an on/off control signal applied to the gate signal line 17*a*. The gate terminal of the transistor 11*d* is connected to the gate signal line 17*b*. The transistor 11*d* is turned on (closed) and off (opened) by an on/off control signal applied to the gate signal line 17*b*.

Figure 3:
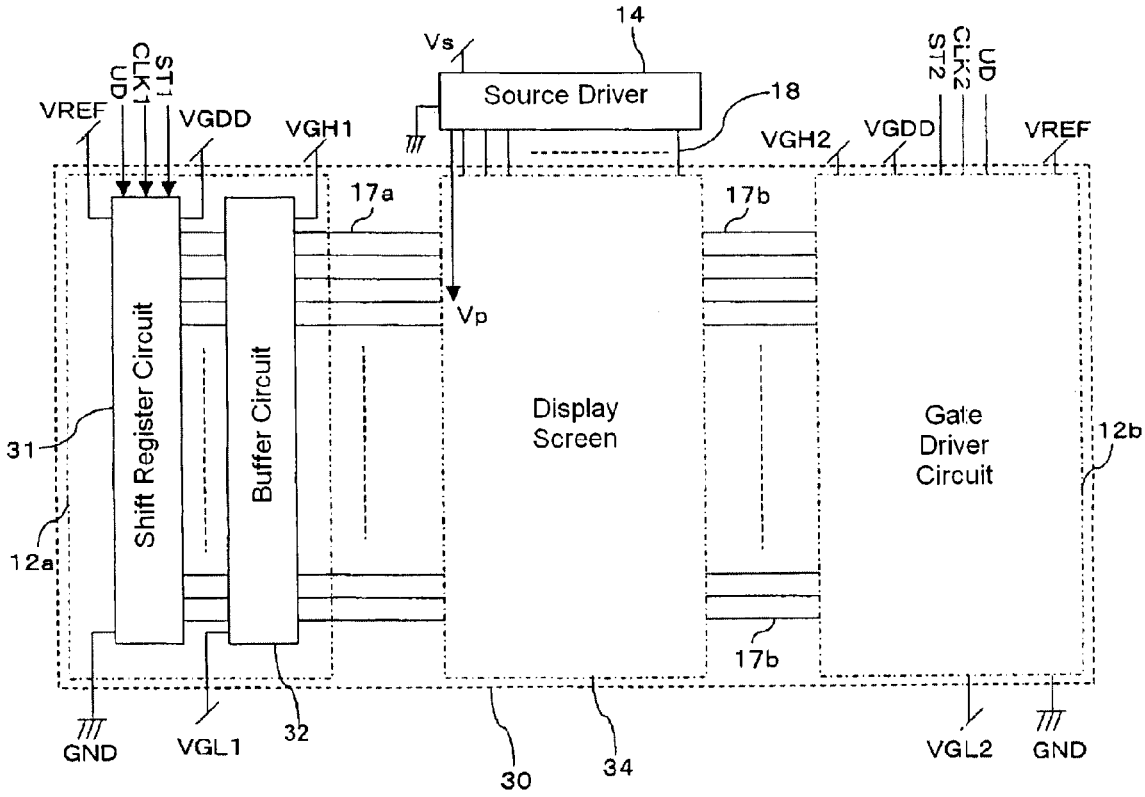
FIG. 3 is a block diagram of an EL display panel according to the present invention.

The gate driver 12 (gate driver circuits 12*a* and 12*b* in FIG. 3) controls the gate signal lines 17*a* and 17*b*. As illustrated in FIG. 3, the gate driver circuit 12*a* may be formed or placed on the left side of a display screen 34 and the gate driver circuit 12*b* may be formed or placed on the right side. The gate driver circuit 12*a* controls the gate signal lines 17*a* while the gate driver circuit 12*b* controls the gate signal lines 17*b*.

With the organic EL pixel configuration illustrated in FIG. 1, the first transistor 11*b* functions as a switching transistor for use to select the pixel. On the other hand, the second transistor 11*a* functions as a driving transistor for use to supply current to the EL element 15.

Clock signals CLK (CLK1 and CLK2), start signals ST (ST1 and ST2), and the like applied to the gate drivers 12 are applied to the source driver IC (circuit) 14 from the controller circuit 801. The clock signals CLK and start signals ST are applied to the gate driver circuits 12 after having their logic level changed by the source driver IC (circuit) 14. That is, the signals applied to the gate driver circuit 12 are supplied from the source driver IC (circuit) 14.

The gate driver circuit 12*a* may select not only a single gate signal line 17*a*, but also a plurality of pixel rows at a time. For example, it may select two gate signal lines 17*a* at a time. That is, it may select two pixel rows at a time.

In the display area 34, pixels for three primary colors of red (R), green (G), and blue (B) are formed in a matrix. The RGB pixels are formed by color filter deposition. Incidentally, a simple color or cyan, yellow, and magenta may be used instead of R, G, and B. Also, four colors may be used by adding white (R) to R, G, and B. In that case, color filters are used.

The display area 34 may have multiple screens for example, a main screen and sub screen. Separate gate driver circuits are provided for the main screen and sub screen while the source signal lines 18 are shared by the main screen and sub screen. Also, the source driver IC (circuit) 14 is shared by the main screen and sub screen.

Figure 109:
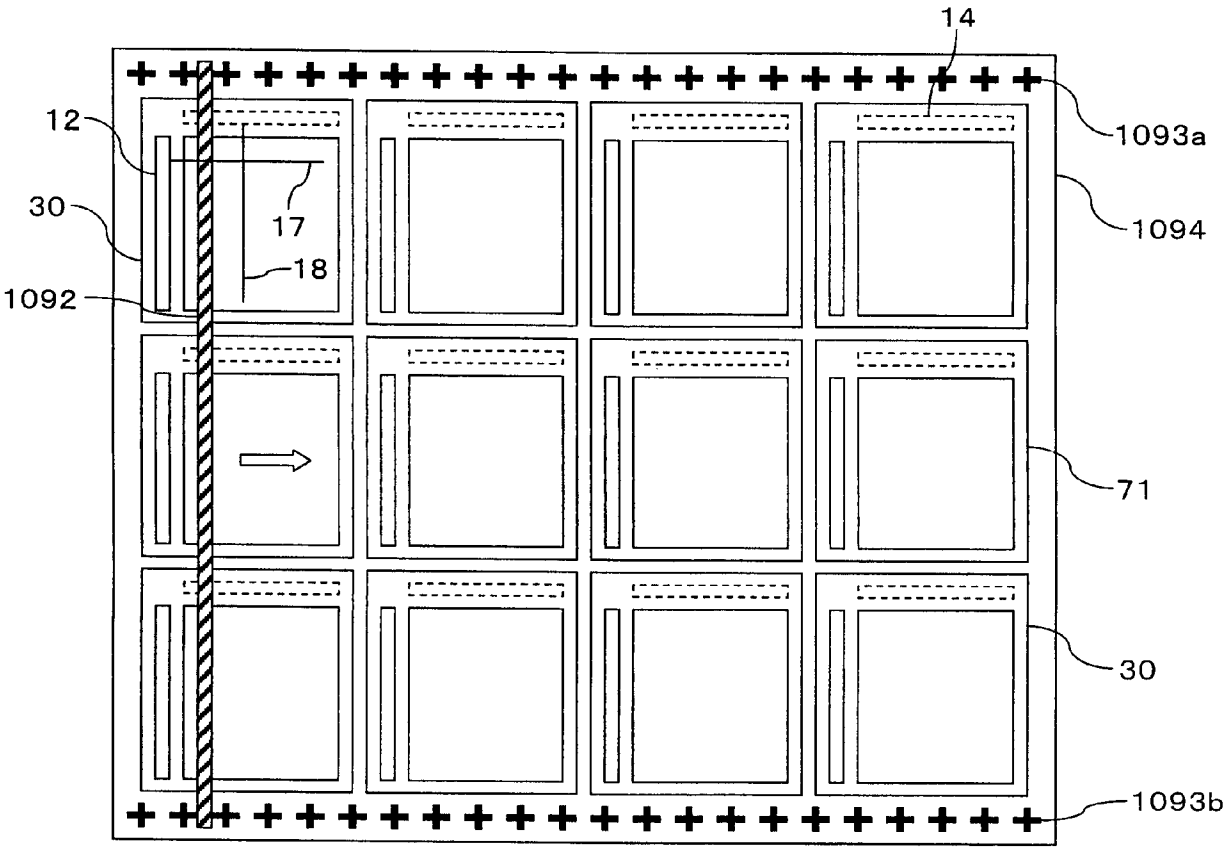
FIG. 109 is a schematic diagram of a driving method of an EL display panel according to the present invention.

In the display area 34, films composing the transistors of the pixel 16 are produced by directing a laser irradiation spot approximately in parallel to the source signal line longitudinally during laser annealing as illustrated in FIG. 109.

An on current of transistors is relatively uniform if the transistors are monocrystalline. However, in the case of low-temperature polycrystalline transistors formed by low-temperature polysilicon technology at a temperature not higher than 450 to 550 degrees (centigrade), their threshold varies in a range of ±0.2 V to 0.5 V. The on current flowing through the driving transistors 11*a* varies accordingly, causing display irregularities. The irregularities are caused not only by variations in the threshold voltage, but also by mobility of the transistors and thickness of gate insulating film. Characteristics also change due to degradation of the transistors 11.

The variations in transistor characteristics are not limited to the transistors formed by low-temperature polysilicon technology, and can occur in transistors formed by high-temperature polysilicon technology at a process temperature of 450 degrees (centigrade) or higher or transistors formed on semiconductor films produced by solid-phase growth method (CGS). Besides, such variations can occur in organic transistors and amorphous silicon transistors.

The present invention is applicable to configurations or drive methods of EL display apparatus or display panels which use transistors and the like formed by any of the above technologies.

The transistors 11 of the pixels 16 in the display panel according to the present invention shown in FIG. 1 and the like are p-channel polysilicon thin-film transistors while the transistors 11*b* and 11*d* are dual-gate or multi-gate transistors.

In FIG. 1, the transistor 11*b* of each pixel 16 in the display panel according to the present invention acts as a source-drain switch of the transistor 11*a*. Thus, as low leakage current characteristics as possible are required of the transistor 11*b*. The use of a dual-gate or multi-gate structure as the gate structure of the transistor 11*b* makes it possible to achieve low leakage current characteristics.

Incidentally, all the transistors in FIG. 1 are P-channel transistors. Compared to N-channel transistors, P-channel transistors have lower mobility, but they are more resistant to high voltage and degradation. Thus, it is preferable that EL display apparatus should employ P-channel transistors. However, the pixels and driver circuits of the EL display apparatus according to the present invention are not limited to P-Channel transistors, and the present invention may employ N-channel transistors alone. Also, the present invention may employ both N-channel and P-channel transistors.

However, to produce a panel at low cost, all the transistors 11 of pixels as well as the transistors in the gate driver circuits 12 should be P-channel transistors. By using only P-channel transistors for an array, it is possible to reduce the number of masks to 5, resulting in low costs and high yields.

When the driver transistor 11*a* and transistors (11*b* and 11*c*) of the pixel 16 are P-channel transistors as shown in FIG. 1, a punch-through voltage is generated. This is because potential fluctuations of the gate signal line 17*a* penetrates to a terminal of the capacitor 19 via G-S capacitance (parasitic capacitance) of the transistors (11*b* and 11*c*). When the P-channel transistor 11*b* turns off, the voltage is set to VGH (off voltage of the transistor). As a result, the terminal voltage of the capacitor 19 shifts slightly toward an anode voltage Vdd. Consequently, the gate (G) terminal voltage of the transistor 11*a* rises, causing the transistor 11*a* to pass less current and creating a more intense black display. This results in a proper black display.

This is because the amount of shift in punch-through voltage due to the capacitor 19 and the like is constant and the VGH voltage (off voltage of transistors) and VGL voltage (on voltage of transistors) have fixed values. In current driving mode (current programming mode), the program current for low tone is small, making it difficult to charge and discharge the parasitic capacitance of the source signal lines 18. The generation of the punch-through voltage has the effect of reducing the program current (change the gate voltage potential of transistor 11*a* in such a way as to prevent current flow). Consequently, a relatively large program current can be applied to the source signal line 18 and a smaller current than the program current can be passed by the driving transistor 11*a* through the EL element 15. This makes it possible to write a small program current (program current in low tone regions) into the pixel 16.

The punch-through voltage depends on voltage amplitude (Vg=VGH−VGL) of the gate signal line 17*a* which selects pixels 16. In the current driving mode, it is important that the punch-through voltage work effectively. According to the present invention, magnitude of Vg is 6 V or higher. If Vdd denotes anode voltage and Vss denotes cathode voltage, potential difference Ve (=Vdd−Vss) between the anode voltage and cathode voltage is set equal to or smaller than Vg−0.5 (V).

In the case of a P-channel transistor, VGH is a voltage which turns off (opens) the transistor and VGL is a voltage which turns on (closes) the transistor. In the case of an N-channel transistor, VGL is a voltage which turns off (opens) the transistor and VGH is a voltage which turns on (closes) the transistor.

According to the present invention, the driving transistor 11*a*, transistor 11*b*, and the like are not limited to P-channel transistors. However, the present invention is characterized in that the driving transistor 11*a* (transistor 11*b* (see FIG. 12, etc.) in the case of a current mirror circuit) and switching transistors 11*b* and 11*c* have the same polarity (P or N), or that the polarity of the transistors and amplitude changes of the gate signal line 17*b* are set to cause such a change in potential that the flow of current through the driving transistor 11*a* will be restricted when the switching transistors 11*b* and 11*c* are off.

Thus, by using P-channel transistors for both driving transistor 11*a* and switching transistor 11*b* of the pixel 16, the present invention provides a unique advantage capability to achieve proper black display (black and low tone regions). Incidentally, when the driving transistor 11*a* of the pixel 16 is an n-channel transistor, the switching transistor 11*b* is also an N-channel transistor. That is, it is preferable to use transistors of the same polarity for both driving transistor 11*a* and switching transistor 11*b*.

Next, a power supply (voltage) used by the EL display panel according to the present invention will be described with reference to FIG. 3. The gate driver circuit 12 consists mainly of a buffer circuit 32 and shift register circuit 31. The buffer circuit 32 uses an off voltage (VGH) and an on voltage (VGL) as power supply voltages. On the other hand, the shift register circuit 31 uses power supply VGDD and ground (GND) voltages of the shift register as well as a VREF voltage for use to generate inversion signals of input signals (CLK, UD, and ST). Besides, the source driver circuit (IC) 14 uses a power supply voltage Vs and ground (GND) voltage.

The gate driver circuit 12*a* performs on/off control of the gate signal lines 17*a*. The gate driver circuit 12*b* performs on/off control of the gate signal lines 17*b*. For ease of explanation, a pixel configuration in FIG. 1 will be cited as an example.

Each shift register circuit 31 is controlled by a positive-phase and negative-phase clock signals CLKx (CLKxP and CLKxN) and a start pulse (STx), where x is a subscript. Besides, it is preferable to add an enable (ENBL) signal which controls output and non-output from gate signal lines and up/down (UD) signal which turns a shifting direction upside down. Also, it is preferable to install an output terminal to ensure that the start pulse is shifted by the shift register circuit 31 and is outputted.

Incidentally, shift timings of the shift register circuits 31 are controlled by a control signal from a controller circuit (not shown). Also, a level shift circuit 31 which level-shifts external data is incorporated. The clock signals may consist of only positive-phase clock signals. By using only positive-phase clock signals, it is possible to reduce the number of signal lines and thereby reduce bezel width.

Incidentally, shift timings of the shift register circuits 31 are controlled by a control signal from a control IC (not shown). Also, the gate driver circuit 12 incorporates a level shift circuit which level-shifts external data. The clock signals may consist of only positive-phase clock signals. By using only positive-phase clock signals, it is possible to reduce the number of signal lines and thereby reduce bezel width.

Since the shift register circuits 31 have small driving capacity, they cannot drive the gate signal lines 17 directly. Therefore, at least two or more inverter circuits (included in the buffer circuit 32) are formed between output of each shift register circuit 31 and an output gate which drives the gate signal lines 17.

To facilitate understanding, voltage values will be prescribed here. First, the anode voltage Vdd is specified to be 6 V and the cathode voltage Vss is specified to be −9 V (see FIG. 1, etc.). The GND voltage is specified to be 0 V and the Vs voltage of the source driver circuit 14 is specified to be 6 V, which is equal to the Vdd voltage. Preferably, the VGH1 and VGH2 voltages are 0.5 to 3.0 V (both inclusive) higher than Vdd. Here, it is assumed that VGH1=VGH2=8(V).

It is necessary to decrease VGL1 of the gate driver circuit 12 to make on-resistance of the transistor 11*c* in FIG. 1 sufficiently small. To simplify circuit configuration, it is assumed here that VGL1 is −8 V which is equal in absolute value and different in polarity to VGH1. VGDD is the voltage of the shift register circuit. This voltage should be lower than VGH and higher than the GND voltage. To simplify the voltage generating circuit and reduce circuit cost, it is assumed here that VGDD is 4 V, which is ½ the VGH voltage. On the other hand, a too high VGL2 voltage may cause the transistor 11*b* to leak, and thus VGL2 is preferably set at a value midway between the VGDD voltage and VGL1 voltage. To simplify the voltage generating circuit and reduce circuit cost, it is assumed here that VGL2 is −4 V which is equal in absolute value and different in polarity to the VGDD voltage.

Voltages in various parts of the EL display apparatus according to the present invention will be described with reference to FIG. 4. According to the present invention, the cathode voltage Vss is designated as the ground (GND) voltage. The anode voltage Vdd and the power supply voltage Vd of the source driver IC (circuit) 14 are common. That is, they are equal. Of course, the cathode voltage Vss may be set to a voltage different from the GND voltage, but the configuration in FIG. 4 makes it possible to simplify the power supply circuit and improve efficiency.

Figure 4:
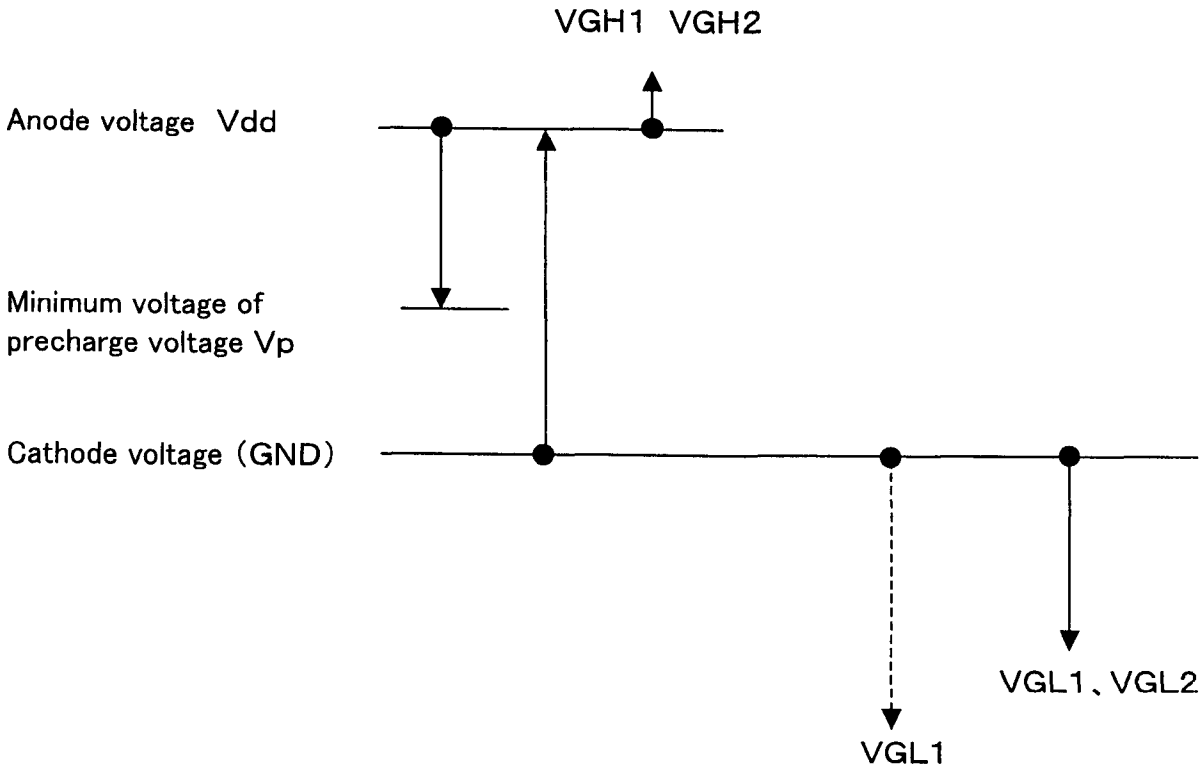
FIG. 4 is a block diagram of an EL display apparatus according to the present invention.

With the power supply circuit arrangement according to the present invention in FIG. 4, when the anode voltage Vdd fluctuates up and down, the power supply voltage Vd of the source driver IC (circuit) 14 fluctuates up and down in a similar manner. The maximum value of the precharge voltage Vp is set equal to the anode voltage Vdd while the minimum value is designated as Vmin, as illustrated in FIG. 4. Thus, potential of the precharge voltage Vp is set nearer to ground in relation to the anode voltage Vdd. The Vmin voltage can be generated easily by setting an input voltage at Vdd and ground (GND) using a negative regulator. Preferably, the value of Vdd−Vmin is between 2V and 4V (both inclusive). Input digital data of the precharge voltage Vp are outputted after being converted into analog data by an electronic regulator constituted by dividing the interval between the Vdd and Vmin voltages by the number of increments (number of tones). Incidentally, the term "precharge voltage Vp" means not only the precharge voltage Vp itself, but also a program voltage.

As illustrated in FIG. 4, gate-on voltages VGH outputted by the gate driver circuit 12 are made positive with respect to the anode voltage Vdd used as a reference (origin). VGH−Vdd should be between 0.5 V and 2.5 V (both inclusive). On the other hand, as illustrated in FIG. 4, gate-off voltages VGL outputted by the gate driver circuit 12 are made negative with respect to the ground voltage (GND) used as a reference (origin). GND−VGL should be between 0.5 V and 2.5 V (both inclusive). VGL may be generated with reference to Vdd. VGH and VGL are generated by a charge pump circuit.

If the amplitude of the gate signal line 17*a* which selects the pixel 16 is Vg=VGH−VGL, according to the present invention, Vg is set equal to or larger than 6 V. If the anode voltage is Vdd and the cathode voltage is Vss, the potential difference between the anode voltage and cathode voltage (Ve=Vdd−Vss) is equal to or larger than Vg+2 (V). The VGL voltages may be generated by a charge pump circuit or the like formed on the array board 30 by polysilicon technology. Preferably, an inrush current limiting circuit is installed at the input or output of a DC-DC (direct current-direct current) converter circuit which generates the anode voltage.

Although it has been stated with reference to FIG. 4 that VGL1 and VGL2 (see FIG. 3) have the same value, this is not restrictive, and preferably VGL1<VGL2. That is, VGL1 is lower than VGL2. However, this is true only when the driving transistor 1*a* is a p-channel transistor. If the driving transistor 11*a* is an n-channel transistor, an inverse relationship holds. Incidentally, VGL1 is an on voltage of the gate driver circuit 12*a* which selects a pixel row while VGL2 is an on voltage of the gate driver 12*b* which selects the transistor 11*d*.

When VGL1 is smaller than VGL2, the amplitude of the gate signal line 17*a* works to increase the punch-through voltage of the gate terminal of the driving transistor 11*a*, which when combined with the driving method of the present invention, achieves better black display. For example, VGL1=−9 V and VGL2=−3 V.

To increase the magnitude of the program current outputted by the driving transistor 11*a*, it is necessary to increase the anode voltage Vdd. When the program current is increased, the EL element 15 emits light at high brightness, causing the EL display apparatus to provide a bright display. The bright display is useful when using the EL display apparatus outdoors. However, constant use of the high anode voltage Vdd increases power consumption of the EL display apparatus. Thus, it is desired to minimize a period or state in which the driving transistor 11*a* outputs a large program current. The present invention increases the anode voltage Vdd when bright display is required. Also, the anode voltage is increased as shown in FIG. 4 when insufficient writing of program current occurs such as in a low tone display or at a low lighting ratio. This method will be described with reference to FIG. 147.

It has been stated with reference to FIG. 4 that the anode voltage Vdd is increased as shown in FIG. 4 if insufficient writing of program current occurs such as in a low tone display or at a low lighting ratio when a bright display is required. However, there can be a driving method which lowers the cathode voltage Vss. For example, there is a method which lowers the cathode voltage Vss if insufficient writing of program current occurs such as in a low tone display or at a low lighting ratio when a bright display is required. It is alternatively possible to use normal values of the anode voltage Vdd or cathode voltage Vss in the case where insufficient writing of program current occurs such as in a low tone display or at a low lighting ratio when a bright display is required, and lower the anode voltage Vdd or cathode voltage Vss at normal brightness or in the case where insufficient writing is allowable. Alternatively, both anode voltage Vdd and cathode voltage Vss may be varied.

Besides, the anode voltage Vdd and cathode voltage Vss may be varied according to the type or state of displayed images such as moving images or still images. Also, the anode voltage Vdd and cathode voltage Vss may be varied according to external illuminance. In that case, the anode voltage Vdd and the like are increased when the external illuminance is high and the anode voltage Vdd and the like are decreased when the illuminance is low. The illuminance is detected by a PIN photodiode or the like. Incidentally, write condition may change depending on panel temperature when a program voltage or program current is applied. Again, this situation can be dealt with by varying the anode voltage Vdd and the like. The temperature is detected by a thermistor or posistor mounted on an ineffective area (area which does not emit light available for display) at the back of the panel. The present invention employs a method which varies or adjusts the anode voltage Vdd and/or cathode voltage Vss according to display brightness, write condition of a program current, display condition, a lighting ratio, external illuminance, and the like.

When the anode voltage Vdd is varied as described above by generating or controlling the power supply voltage used in the display apparatus, the power supply voltage of the source driver IC (circuit) 14 and Vmin and VGH of the precharge voltage Vp change accordingly. Thus, even if the anode voltage Vdd and the like are varied when a bright display is required, relative values of VGH and precharge voltage Vp change accordingly, making it possible to maintain a proper image display. This method will prove particularly effective when combined with a lighting ratio control method described with reference to FIG. 147. It is also useful to use this method in combination with N-fold driving and duty ratio driving described with reference to FIGS. 6 and 9. When N is large, the anode voltage Vdd and the like are increased.

According to the present invention, the anode voltage Vdd and the like shown in FIG. 4 are varied depending on the lighting ratio. When the lighting ratio is low, insufficient writing during current driving is corrected by increasing the anode voltage Vdd over a steady-state value and increasing the reference current. Also, the brightness corresponding to the tone is controlled to be almost equal to the steady-state value by performing N-fold driving (non-illuminated area insertion driving) described with reference to FIGS. 9, 10, 11, etc.

The EL display apparatus and drive method thereof according to the first aspect of the present invention basically consists of two operations: a first operation (write operation) and second operation (light-emitting operation). The first operation is divided into a potential-varying operation which involves forcibly varying the potential of the source signal line 18 (including varying the gate terminal potential of the driving transistor 11*a* of the pixel 16) by applying the precharge voltage Vp and the like to the source signal line 18 and a current programming operation which involves applying program currents to the driving transistor 11*a* and the like. Besides, an initial operation of measuring or acquiring the potential of the source signal line 18 by the application of a constant current (which may be 0 A) to the source signal line 18 is performed as required before the first operation.

The second operation involves causing the EL element 15 to emit light by applying a programmed current to the EL element 15 of the pixel 16 or passing a programmed current through the EL element 15 of the pixel 16. In the second operation, the current supplied from the driving transistor 11*a* to the EL element 15 is passed or blocked by applying an on/off voltage to the gate signal line 17*b* as required, as described with reference to FIGS. 9, 10, 11, etc. Besides, lighting ratio control is performed as described with reference to FIG. 147.

The present invention is not limited to application of voltages such as a precharge voltage Vp (or Va or V0). The present invention also includes applying a current (over-current) larger than program current to the source signal line 18 and charging and discharging the source signal line in a short time. An example is described with reference to FIGS. 81 and 82. That is, any method may be used in the potential-varying operation as long as it varies the source signal line 18 or the gate terminal potential of the driving transistor 11*a*. Besides, a predetermined voltage may be applied to the source signal line 18 before the application of an over-current.

In the initial operation, the driving transistor 11*a* is operated by applying a constant current (predetermined program current) to the pixel driving transistor 11*a*, and when the operation of the driving transistor 11*a* enters a steady state, the gate terminal voltage of the driving transistor 11*a* or voltage of the source signal line 18 are measured. The measured voltage is stored in a memory or the like after A/D conversion. Alternatively, the voltage is held in a sample-and-hold circuit or the like. The acquired voltage is used for the potential-varying operation in the first operation.

Although it has been stated that a constant current is applied in the initial operation, the present invention is not limited to this. Instead of applying a constant current (constant current=0 A), the driving transistor 11*a* of the selected pixel 16 may be shorted between gate and drain terminals, and then the potential (Va or V0) may be measured or acquired when the driving transistor 11*a* is offset-cancelled (when the driving transistor 11*a* is cut off and does not pass a current). Since the source signal line 18 remains electrically connected with the gate terminal of the driving transistor 11*a* of the pixel 16 when the pixel 16 is selected, this potential can also be acquired by measuring the potential of the source signal line 18.

The EL display apparatus and drive method thereof according to the second aspect of the present invention consists of three operations: an initial operation, first operation (write operation), and second operation (light-emitting operation).

The initial operation is similar to that of the EL display apparatus (panel) and drive method thereof according to the first aspect of the present invention. In the initial operation, the driving transistor 11*a* is operated by applying a constant current (predetermined program current) to the pixel driving transistor 11*a*. When the operation of the driving transistor 11*a* enters a steady state, the gate terminal voltage of the driving transistor 11*a* or voltage (Va or V0) of the source signal line 18 is measured.

Preferably the constant current is varied according to the tone to be written. The constant current may be 0 A. A constant current of 0 A means that the driving transistor 11*a* has substantially been offset-cancelled. The measured voltage (Va or V0) is stored in a memory or the like after A/D conversion. Alternatively, the voltage is held in a sample-and-hold circuit or the like. The acquired voltage is used for the potential-varying operation in the first operation.

Preferably, a predetermined voltage is applied to the source signal line 18 before the initial operation to stabilize the potential of the source signal line 18 or set the potential to a predetermined voltage.

In the first operation, the voltage acquired in the initial operation is used as a reference voltage Va (or origin's voltage V0) and a target voltage is determined by adding or subtracting a tone voltage to/from the reference voltage. The determined target voltage is written into the pixel while the pixel is selected.

The second operation involves subjecting a programmed voltage (target voltage) to voltage-current conversion using the driving transistor 11*a* and applying the resulting current to the EL element 15 of the pixel 16. The target voltage is held in the capacitor 19 of the pixel 16. During the period of the second operation, the current supplied from the driving transistor 11*a* to the EL element 15 is passed or blocked by applying an on/off voltage to the gate signal line 17*b* as required. Also, reference current increase/decrease control and duty ratio control (FIGS. 9, 11, etc.) are performed. Besides, on/off control is performed according to the lighting ratio.

The present invention is not limited to the use of tone voltage. The present invention also includes applying a current (over-current) to the source signal line 18 and charging and discharging the source signal line in a short time. The potential of the source signal line 18 changes with the application of the current. That is, the application of a current is practically equivalent to the application of a voltage. Any method may be used in the potential-varying operation as long as it varies the potential of the source signal line 18 or the gate terminal potential of the driving transistor 11*a*.

Figure 5:
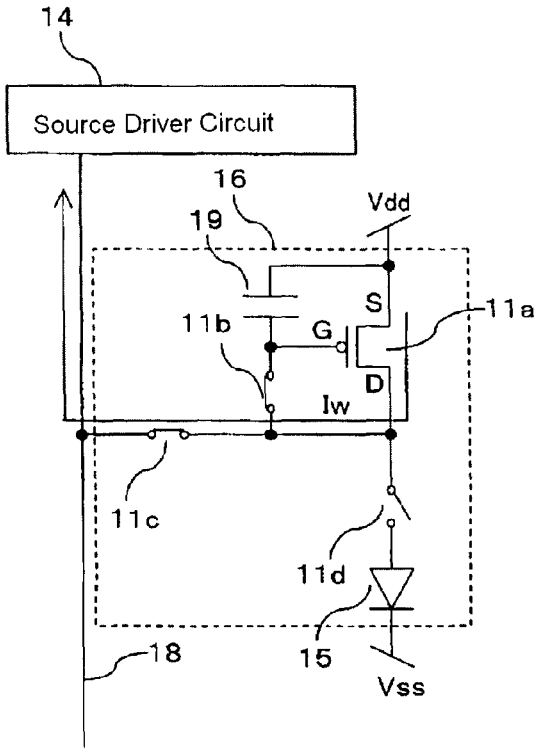
FIG. 5 is a schematic diagram of a driving method of an EL display panel according to the present invention.
Figure 5:
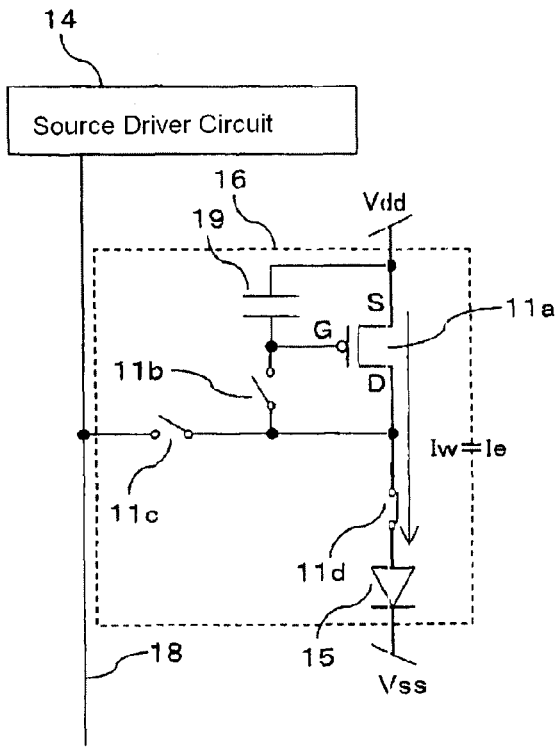

FIG. 5 is an explanatory diagram of the operation in FIG. 1. FIG. 5(A) shows how a constant current is supplied from the source driver IC (circuit) 14 and how a constant current Iw flows from the driving transistor 11*a* to the source driver IC (circuit) 14. When the driving transistor 11*a* passes the constant current Iw, the transistor 11*b* and 11*c* are closed (on). Thus, the gate terminal potential of the driving transistor 11*a* and the potential of the source signal line 18 are equal to each other.

FIG. 5(B) shows how a current Ie is supplied from the driving transistor 11*a* to the EL element 15. That is, it shows how the current is supplied to the EL element 15 to display images.

Figure 6:
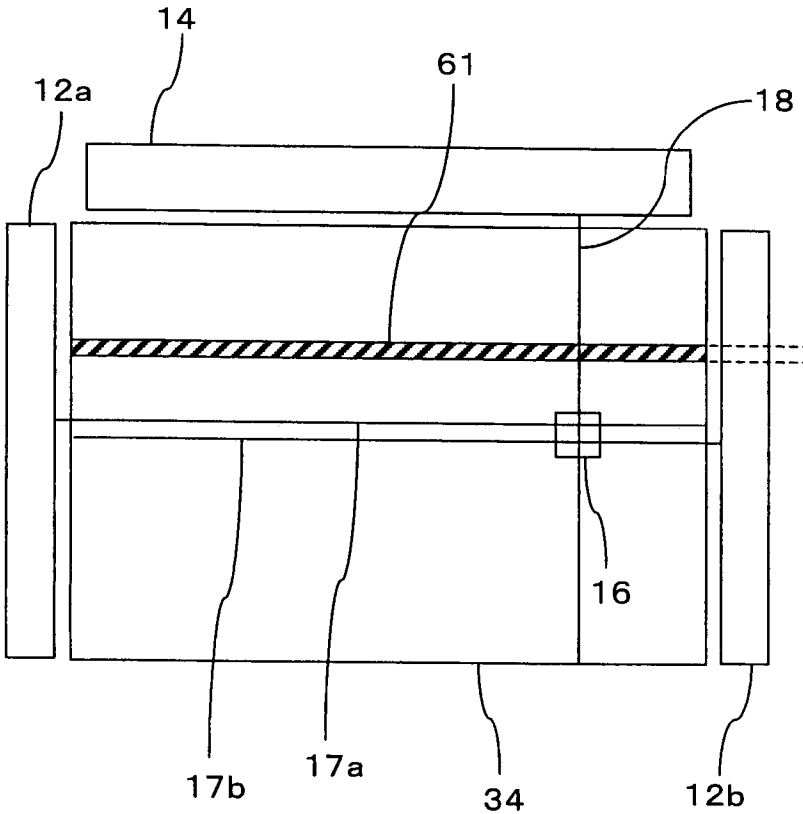
FIG. 6 is a schematic diagram of a driving method of an EL display panel according to the present invention.
Figure 6:
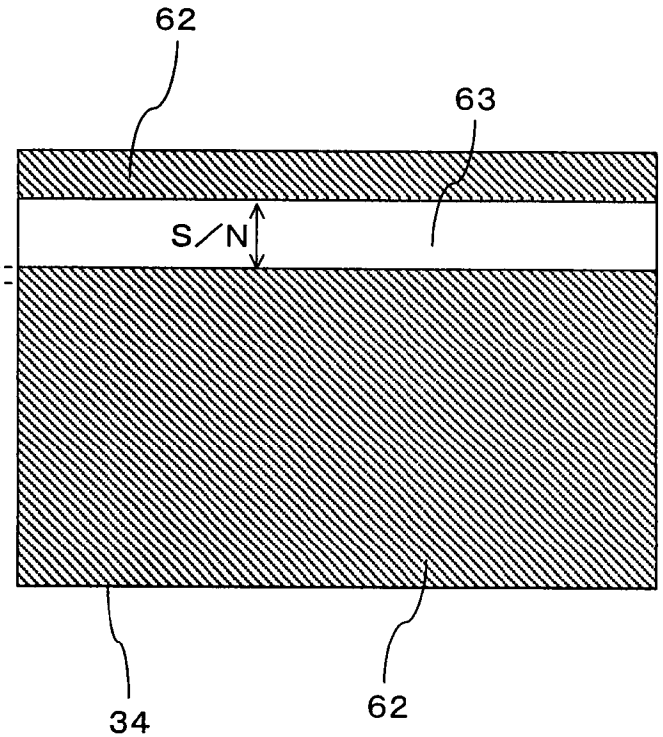

The above operation translates into a process on the display screen 34 as illustrated in FIG. 6. In FIG. 6(A), reference numeral 61 denotes pixels (a pixel row) which are being current-programmed on the display screen 34 at a given time point (write pixel row). In other words, it is a pixel row (pixels) on which the Va or V0 voltage is measured or a pixel row (pixels) into which a target voltage Vc is written.

Basically, it is assumed that the potential of the source signal line 18 is V0 when the constant current is 0 A. The potential of the source signal line 18 at the constant current Ia (Ia is an arbitrary value) is denoted by Va. However, for the sake of convenience or for ease of explanation, V0 may denote the voltage which corresponds to tone 0 in a video signal and Va may denote the voltage which corresponds to tone a in the video signal.

The pixels (pixel row) 61 are not illuminated (non-display pixels (pixel row)) They can be set to a non-illuminated state by opening the transistor 11*d* of the pixel 16 by controlling the gate driver circuit 12*b*. To open the transistor 11*d*, an off voltage is applied to the gate signal line 17*b*. The position where the gate driver circuit 12 applies an off voltage to the gate signal line 17 is shifted in sync with a horizontal synchronization signal.

The non-illuminated (non-display) state is a state in which no current or only a current lower than a certain level flows through the EL element 15. That is, it means a dimly displayed state. Thus, the non-illuminated pixel row means that the EL elements 15 of the pixel row are passing no current or that they are lit relatively dimly.

That area of the display screen 34 which is displaying nothing (non-illuminated) is referred to as anon-display area 62. That area of the display screen 34 which is displaying something (illuminated) is referred to as a display area 63. The switching transistors 11*d* of the pixels 16 in the display area 63 are closed and currents are flowing through the EL elements 15. However, in the case of image display in black display, naturally no current flows through the EL elements 15. The area in which the switching transistors 11*d* are open is a non-display area 62.

Figure 9:
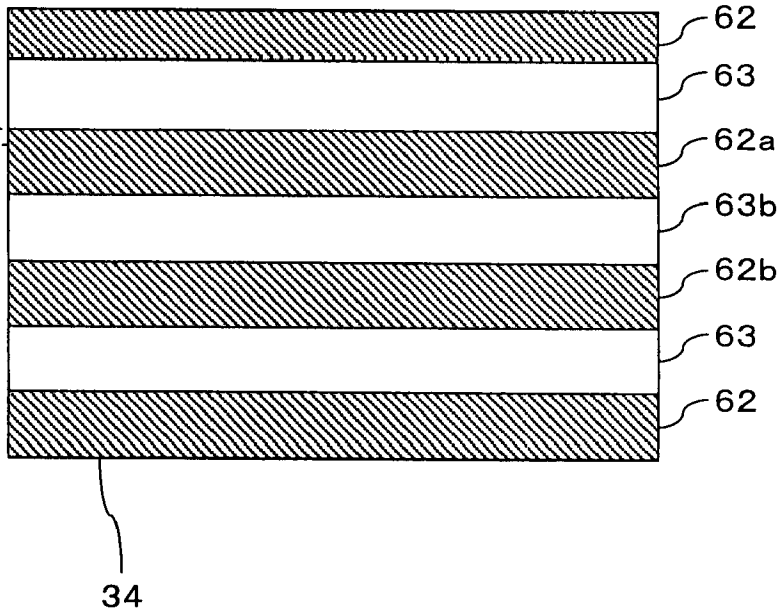
FIG. 9 is a schematic diagram of a driving method of an EL display panel according to the present invention.
Figure 9:
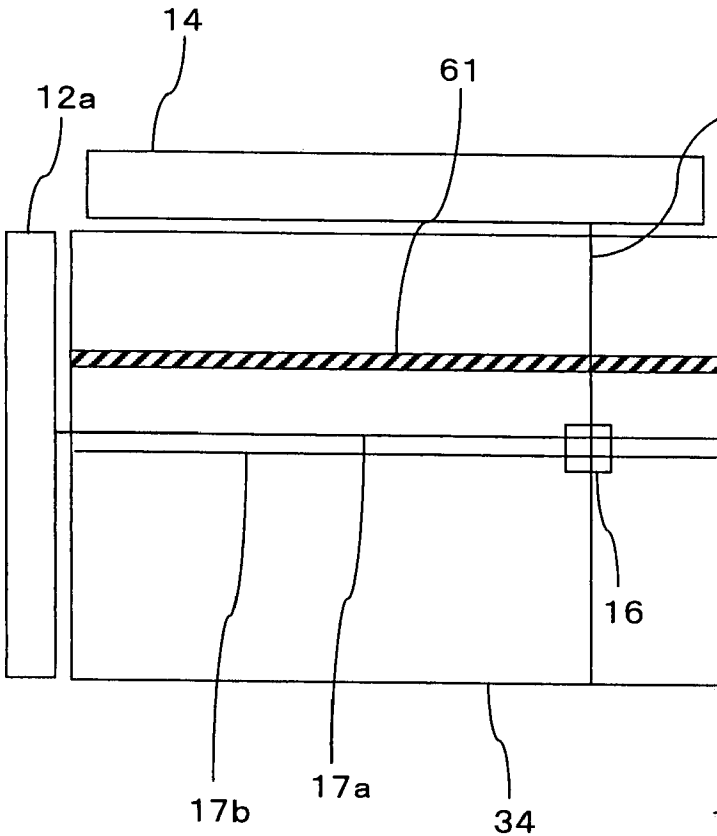

In FIGS. 6 and 9, a non-display area 62 and display area 63 are generated on the display screen 34. This type of drive method is referred to as a duty ratio driving method.

The present invention is characterized in that screen luminance or brightness is adjusted by varying the ratio between display area 63 and non-display area 62, varying the area ratio of non-display area 62 to the display screen 34, or increasing/decreasing the number of displayed pixels.

The present invention allows the display area 63 on the screen 34 to be divided into multiple parts. Also, it allows the number of pixel divisions of display area 63 or non-display area 62 to be varied between movie display and still-image display. The present invention is characterized in that bands of the non-display area 62 or display area 63 on the screen 34 move from top to bottom or from bottom to top.

Normally, an NTSC frame rate is 60 Hz (60 frames per second, i.e. the time required to refresh the screen is 1/60 second) and a PAL frame rate is 50 Hz (50 frames per second). As shown in FIGS. 6 and 9, when performing the duty ratio driving according to the present invention, the frame rate is increased 1.2 to 2.5 times (both inclusive) for display. For example, an input frame rate of 60 Hz is changed to between 72 Hz (=60×1.2) and 150 Hz (=60×2.5) (both inclusive). Preferably, it is changed to between 75 Hz (1.25 times) and 120 Hz (2 times) (both inclusive). Alternatively, the frame rate is selected from among 75 Hz (1.25 times), 90 Hz (1.5 times), and 120 Hz (2 times).

Input signals are accumulated in an image memory before frame rate conversion. Alternatively, input signals of a frame rate between 72 Hz and 150 Hz (both inclusive) are inputted in the display apparatus according to the present invention. The matters concerning the frame rate are also applicable to other examples of the present invention.

In the pixel configuration shown in FIG. 1, the program current (constant current) Iw flows through the source signal line 18 as illustrated in FIG. 5(A). A voltage is set (programmed) in the capacitor 19 so that a current will be held causing the program current Iw to flow through the driving transistor 11*a*. Alternatively, a voltage is held in the capacitor 19 so that a current will flow causing the program current Iw to flow through the gate terminal of the driving transistor 11*a*. At this time, the transistor 11*d* is open (off).

During a period when the current flows through the EL element 15, the transistors 11*c* and 11*b* turn off and the transistor 11*d* turns on as shown in FIG. 5(B). Specifically, an off voltage (VGH) is applied to the gate signal line 17*a*, turning off the transistors 11*b* and 11*c*. On the other hand, an on voltage (VGL) is applied to the gate signal line 17*b*, turning on the transistor 11*d*.

Figure 7:
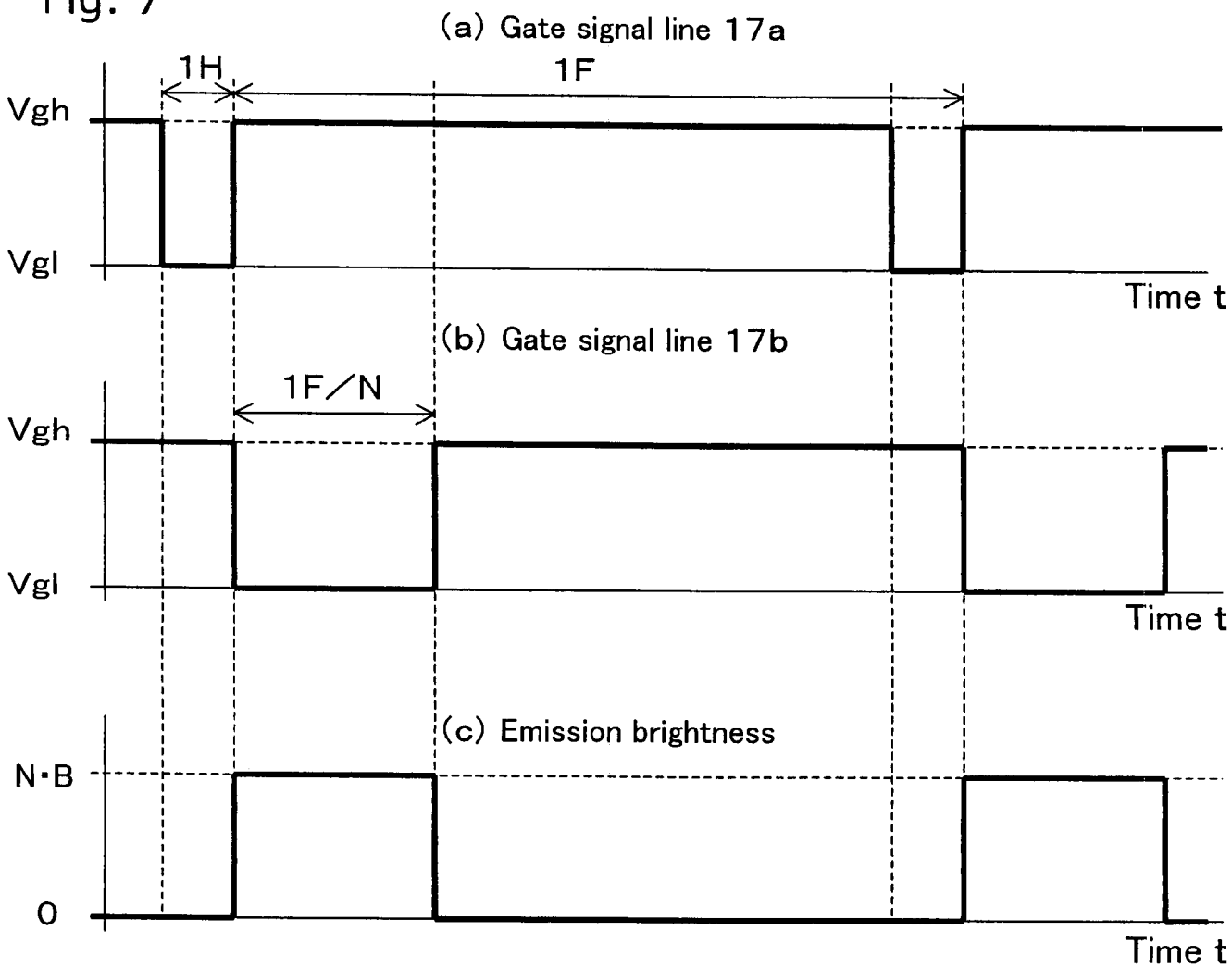
FIG. 7 is a schematic diagram of a driving method of an EL display panel according to the present invention.

A timing chart is shown in FIG. 7. As can be seen from FIG. 7, in the pixels 16 in the selected pixel row, when an on voltage (VGL) is applied to the gate signal line 17*a* (see FIG. 7(A)), an off voltage (VGH) is applied to the gate signal line 17*b* (see FIG. 7(B)). During this period, no current flows through the EL elements 15 in the selected pixel row (non-illumination mode). One selection period corresponds to one horizontal scanning period (1H).

In an illuminated pixel row in which no on voltage is applied to the gate signal line 17*a* (non-selected pixel row), an on voltage (VGL) is applied to the gate signal line 17*b*. A current flows through the EL elements 15 in the pixel row. The EL elements 15 emit light.

In a non-illuminated pixel row in which no on voltage is applied to the gate signal line 17*a* (non-selected pixel row), an off voltage (VGH) is applied to the gate signal line 17*b*. No current flows through the EL elements 15 in the pixel row. The EL elements 15 do not emit light.

The above operations are illustrated in FIG. 6. Reference numeral in FIG. 6(A) denotes pixels (a pixel row) (write pixel row) current-programmed in the display screen 34 at a given time point. The pixels (pixel row) 61 are non-illuminated (non-display pixels (pixel row)). The area in which the switching transistors 11*d* are closed causing a current to flow through the EL elements 15 is a display area 63 (however, no current flows during black display). The area in which the switching transistors 11*d* are open is a non-display area 62.

In the pixel configuration shown in FIG. 1, the current Iw flows through the driving transistor 11*a* as shown in FIG. 5(A). A voltage is set (programmed) in the capacitor 19 so that a current will be held causing the program current Iw to flow through the driving transistor 11*a*. Alternatively, a voltage is held in the capacitor 19 so that a current will flow causing the program current Iw to flow through the gate terminal of the driving transistor 11*a*. At this time, the transistor 11*d* is open (off).

During a next period when the current flows through the EL element 15, the transistors 11*c* and 11*b* turn off and the transistor 11*d* turns on as shown in FIG. 5(B). Specifically, an off voltage (VGH) is applied to the gate signal line 17*a*, turning off the transistors 11*b* and 11*c*. On the other hand, an on voltage (VGL) is applied to the gate signal line 17*b*, turning on the transistor 11*d*.

When charging and discharging the source signal line 18 rapidly during measurement or acquisition of the Va voltage or when inserting black (inserting a non-display area) in image display to improve viewability of moving pictures, the magnitude of the constant current is increased N times. Consequently, the current flowing through the EL element 15 also increases N times.

If Vx (x is a tone number) is multiplied by 1 as is conventionally done, the source signal line 18 can be charged and discharged rapidly due to the effect of the N-fold constant current. In this case, since the Va voltage used as a reference already provides an N-fold EL current, the Vx voltage used for addition and subtraction should be set taking this point into consideration. The same is true to the target voltage Vc.

For ease of explanation, it is assumed below that the current Iw used to measure the Va voltage is increased N times (the voltage Va used as a reference is also set to make the driving transistor 11*a* pass an N-fold current) and that Vx added to Va and V0 is also set to make the driving transistor 11*a* pass an N-fold current through the EL element 15. The brightness of the display screen 34 brought up on the EL display apparatus at a 1-fold current is assumed to be B and the brightness of a light-emitting part at an N-fold current is assumed to be B×N. Incidentally, although it is assumed that N is a number equal to or larger than 1, it goes without saying that the present invention is applicable even when N is smaller than 1.

In FIGS. 6 and 9, the pixels 16 in the display area 63 of the display screen 34 emit light at an N-fold brightness or pass an N-fold current. This method of driving is referred to as an N-fold driving method.

It is assumed that the constant current or program current Iw passed through the EL element 15 is N times the current needed to obtain the average (predetermined) brightness B of the display screen 34. Thus, the EL element 15 illuminates at N times the predetermined brightness (N-B). The illumination period is 1F/N, where 1F is one field (frame). For ease of explanation, it is assumed that there is no blanking period in one field (frame). Practically, however, there are blanking periods, and thus the brightness is not exactly N·B. That is, the EL element 15 emits light at N times the predetermined brightness (N·B) for a period of 1/N 1F. Thus, the display brightness of the display panel averaged over 1F is given by (N·B)×(1/N)=B (i.e., the predetermined brightness).

Incidentally, N may be any number. However, too large a value of N will result in a large instantaneous current flowing through the EL element 15, and thus it is preferable that N is 10 or less. Of course, it goes without saying that N may be 1 (N=1) so that a write pixel row other than the write pixel row 181 will become a display (illuminated) area 63. In that case, the current Iw passed through the EL element 15 should be the current needed to obtain the average (predetermined) brightness B of the display screen 34. Thus, the EL element 15 illuminates (emits light) at the predetermined brightness B.

One reason for passing the constant current or program current Iw which will provide an emission brightness of N*B is to reduce the influence of the parasitic capacitance of the source signal line 18. By passing a large current, it is possible to charge and discharge the parasitic capacitance in a short period of time.

In the above example, an IC consisting mainly of a silicon chip is used for the source driver circuit (IC) 14. However, the present invention is not limited to this and output stage circuits 81 and the like (polysilicon current holding circuits 82) may be formed or constructed directly on the array board 30 using polysilicon technology (CGS technology, low-temperature polysilicon technology, high-temperature polysilicon technology, or the like) as illustrated in FIG. 8 and the like.

Figure 8:
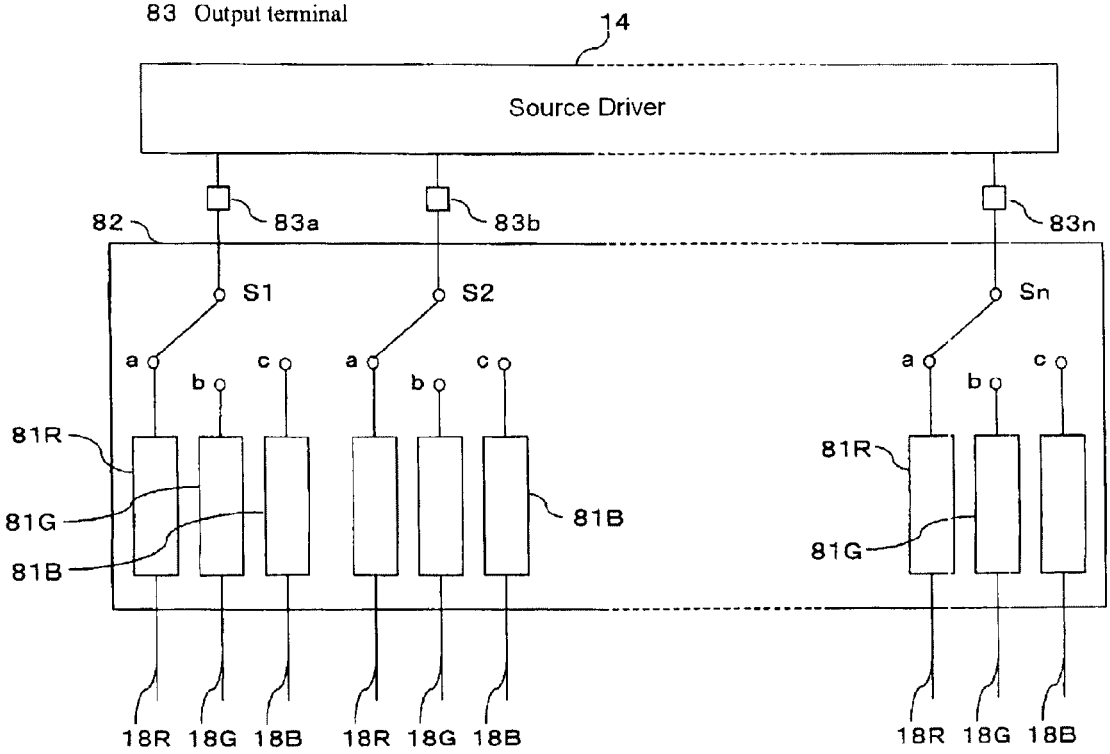
FIG. 8 is a block diagram of an EL display panel according to the present invention.

In FIG. 8, output stage circuits 81 for R, G, and B (81R for R, 81G for G, and 81B for B) and switches S for selecting R, G, and B output stage circuits 81 are formed (constructed) by polysilicon technology. The switches S operate by time-sharing one horizontal scanning period (1H period). Basically, each switch S is connected to the R output stage circuit 81R, G output stage circuit 81G, and B output stage circuit 81B for ⅓ of 1H each.

As illustrated in FIG. 8, the source driver (circuit) 14 which has the shift register circuit and sampling circuit is connected to the source signal lines 18 via the output terminals 83. The switches S made of polysilicon operate on a time-shared basis to close the output stage circuits 81R, 81G, and 81B. The output stage circuits 81 (81R, 81G, and 81B) hold currents consisting of RGB video data. Incidentally, although only a single stage of polysilicon current holding circuits 82 is illustrated in FIG. 8, it goes without saying that actually there are two states of polysilicon current holding circuits.

Although it has been stated with reference to FIG. 8 that each switch S is connected to the R output stage circuit 81R, G output stage circuit 81G, and B output stage circuit 81B for ⅓ of 1H each, the present invention is not limited to this. Selection periods may vary among R, G, and B. This is because the magnitudes of program currents Iw vary among R, G, and B due to differences in the efficiency of EL elements 15 among R, G, and B. A program current small in magnitude is susceptible to parasitic capacitance of the source signal lines 18, so its application duration should be increased to secure time to charge and discharge the parasitic capacitance of the source signal lines 18. On the other hand, the magnitude of the parasitic capacitance in the source signal lines 18 is often the same among R, G, and B.

In FIG. 6, a single display area 63 is provided. However, the present invention is not limited to this. For example, a plurality of display areas 63 and non-display areas 62 may be provided alternately as illustrated in FIG. 9.

As illustrated in FIG. 9, it is not necessary that the non-display areas 62 or display areas 63 will be spaced at equal intervals. For example, they may be spaced randomly (as long as the sum of display periods or non-display periods (or ratio between the display periods and non-display periods) is maintained at a predetermined value). That is, R, G, and B display periods or non-display periods can be adjusted (set) to predetermined values (a certain ratio) to achieve optimum white balance.

The non-display area 62 is a pixel 16 area of EL elements 15 not illuminated at a given time point. The display area 63 is a pixel 16 area of EL elements 15 illuminated at a given time point. The non-display area 62 and display area 63 are shifted by one pixel row at a time in sync with a horizontal synchronization signal.

Figure 10:
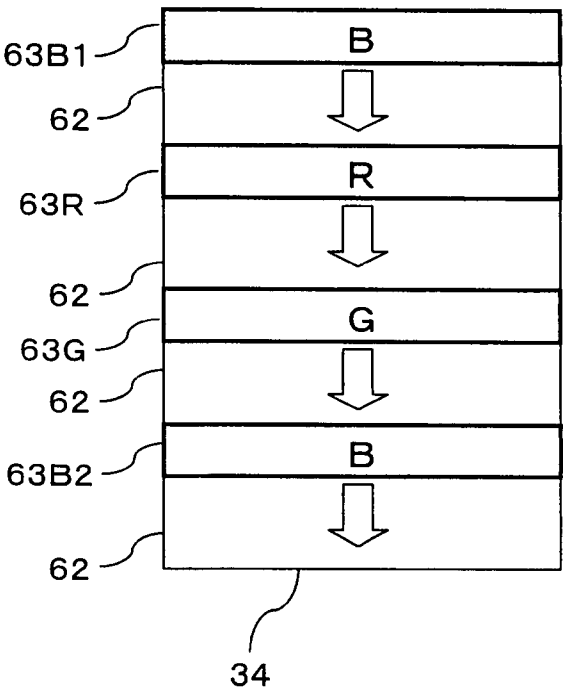
FIG. 10 is a schematic diagram of a driving method of an EL display panel according to the present invention.
Figure 10A:
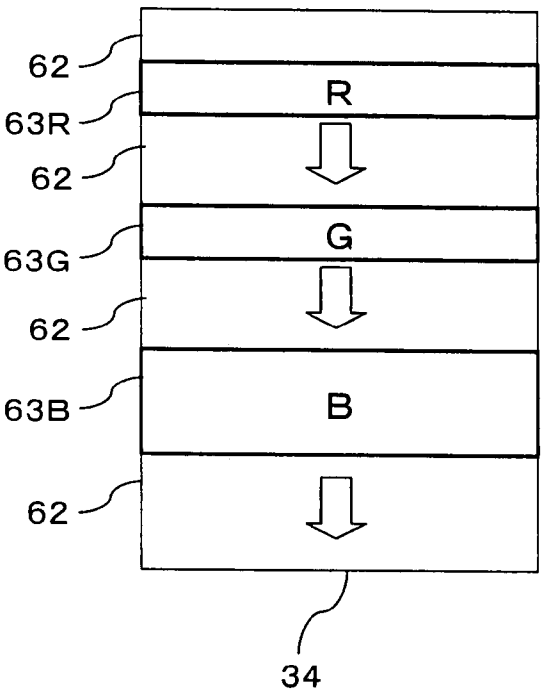

The drive method according to the present invention is capable of intermittent display as illustrated in FIG. 10. However, the intermittent display can be achieved by simply placing the transistor 11*d* under on/off control every 1H period. Thus, a main clock of the circuit does not differ from conventional ones, and thus there is no increase in the power consumption of the circuit. To achieve intermittent display, liquid crystal display panels need an image memory in order to store video data during the period of intermittent display. According to the present invention, image data is held in the capacitor 19 of each pixel 16. Thus, the present invention requires no image memory for intermittent display.

The drive method according to the present invention controls the current passed through the EL element 15 by simply turning on and off the switching transistor 11*d* and the like (see FIG. 1, etc.). That is, even if the current Iw flowing through the EL element 15 is turned off, the image data remain held in the capacitor 19 of the pixel 16. Thus, when the transistor 11*d* is turned on the next time, the current passed through the EL element 15 has the same value as the current flowing through the EL element 15 the previous time.

Even to achieve black insertion (intermittent display such as black display), the present invention does not need to speed up the main clock of the circuit. Also, it does not need to elongate a time axis, and thus requires no image memory. Besides, the organic EL element 15 responds quickly, requiring a short time from application of current to light emission. Thus, the present invention is suitable for movie display, and by using intermittent display, it can solve a problem with conventional data-holding display panels (liquid crystal display panels, EL display panels, etc.) in movie display.

Furthermore, in a large display apparatus, if increased wiring length of the source signal line 18 results in increased parasitic capacitance, this can be dealt with by increasing the value of N (N is a value larger than 1). When the value of the program current applied to the source signal line 18 is increased N times, the conduction period of the gate signal line 17*b* (the transistor 11*d*) can be set to 1F/N. This makes it possible to apply the present invention to television sets, monitors, and other large display apparatus.

According to one aspect of the present invention, in the EL display panel with a pixel configuration for current driving, the Va voltage or V0 voltage is measured or acquired by passing a constant current through the driving transistor 11*a* of each pixel or without passing a constant current (Iw=0). The measured/acquired voltage Va or V0 is stored in a memory or the like after A/D conversion. When displaying images, the Va or V0 voltage is read out, subjected to D/A conversion, and applied as the precharge voltage Vp to the source signal line 18. After the application of the precharge voltage Vp, a program current is applied as required.

According to another aspect of the present invention, the Va or V0 voltage is measured by applying a constant current to the driving transistor 11*a* of each pixel or without passing a current (Iw=0). The measured/acquired voltage is stored in a memory or the like after A/D conversion. When displaying images, the Va or V0 voltage is readout and subjected to D/A conversion, and the target voltage Vc is generated by adding a tone voltage Vx (x is a tone number) to the Va or V0 voltage.

Incidentally, the present invention is not limited to this. For example, a constant current Iw applied when measuring or acquiring the Va voltage may be a current Iwm corresponding to a maximum tone.

When the current Iwm corresponding to the maximum tone is applied to the driving transistor 11*a*, a voltage Vam is generated at the gate terminal of the driving transistor 11*a* such that the current for the maximum tone will flow through the driving transistor 11*a*. The target voltage Vc is generated by subtracting the tone voltage Vx from Vam. The generated voltage Vcm is applied to the gate terminal of the driving transistor 11*a*.

Thus, an important or unique operation of an important driving method according to the present invention consists of extracting the current flowing through the pixel in current driving mode to the source signal line 18 or measuring the potential of the source signal line 18. This requires a configuration or arrangement in which the driving transistor 11*a* or the drain terminal or source terminal of the transistor 11*b* which forms a current mirror with the driving transistor 11*a* is connected to the source signal line 18 in a DC manner. That is the driving transistors 11 (11*a* and 11*b*) must be configured in the above manner. The passage of current through the EL element 15 includes a case in which the current is supplied to the EL element 15 and a case in which the current flows from the EL element 15 into the driving transistors 11.

Thus, in this example, an approximately 1-fold current Ie is passed through the driving transistors 11 based on Va, V0, and Vam. However, the present invention is not limited to this. For example, needless to say, with a driving method which passes current through the EL element 15 only for a period of 1F/N, but does not pass current during the remaining period (1F(N−1)/N), the constant current may be increased N times. That is, the Va voltage which corresponds to the N-fold constant current (reset current) is determined, and the target voltage Vc is generated based on the voltage Va. Incidentally, although the N-fold constant current is cited here, this is not restrictive. N may be any number equal to or larger than 1.

This method is useful especially when the source signal lines 18 have high parasitic capacitance. Also, it is useful for 10-inch or larger EL display apparatus. When the source signal lines 18 have high parasitic capacitance, by increasing the reset current (program current Iw) N times (N should be at least equal to or larger than one), it is possible to correct "insufficient writing" of the constant current Iw.

Figure 11:
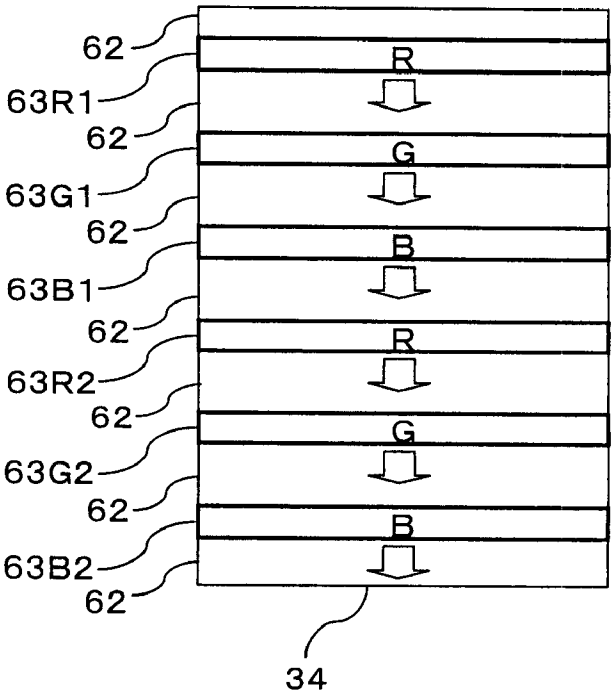
FIG. 11 is a schematic diagram of a driving method of an EL display panel according to the present invention.
Figure 11A:
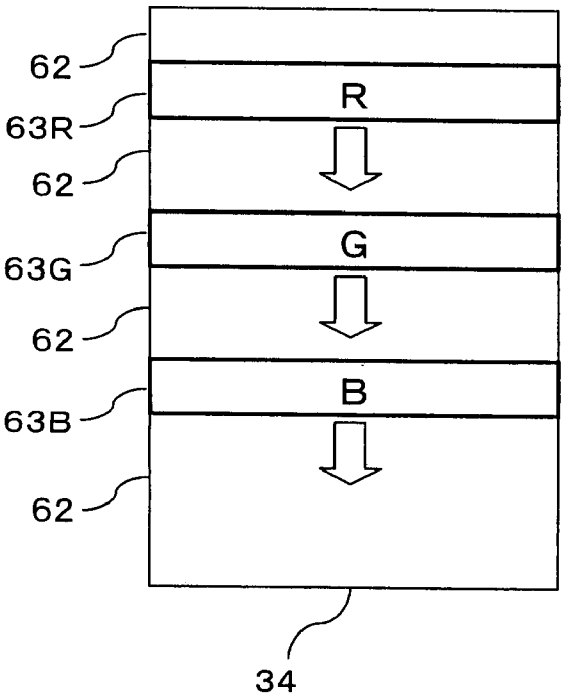

The drive method according to the present invention allows intermittent display of each of red (R), green (G), and blue (B) as illustrated in FIG. 11. However, the intermittent display can be achieved by simply placing the transistor 11*d* under on/off control every 1H period at the maximum. Thus, a main clock of the circuit does not differ from those used for non-intermittent display, and there is no increase in the power consumption of the circuit. Liquid crystal display panels need an image memory in order to achieve intermittent display.

Figure 12:
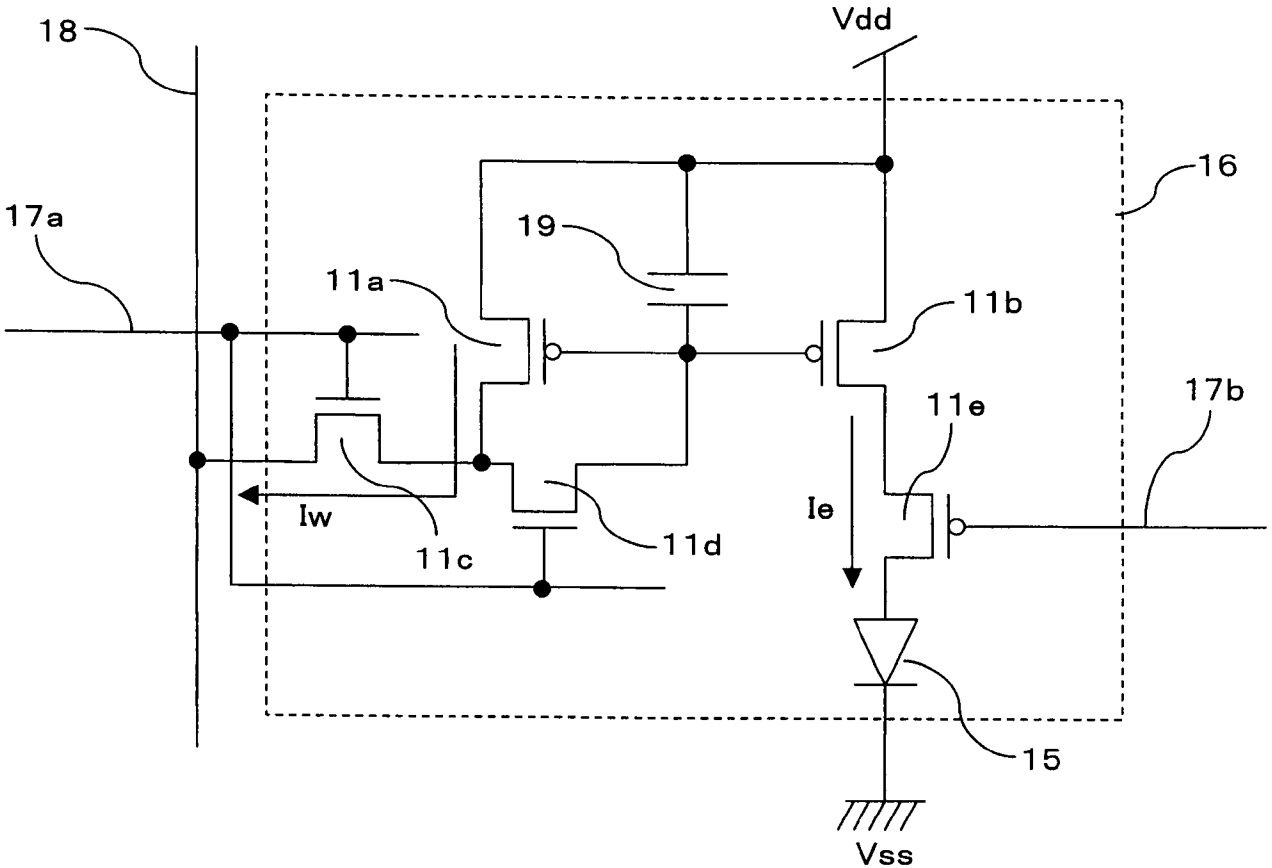
FIG. 12 is a schematic diagram of a pixel configuration of an EL display panel according to the present invention.

Although the pixel configuration of the present invention in FIG. 1 is cited as an example, this is not restrictive. For example, the pixel configuration shown in FIG. 12 is also available. With the pixel configuration in FIG. 12, the transistors 11*c* and 11*d* are turned on (closed) during current programming. The source driver IC (circuit) 14 outputs a program current (constant current) Iw. The program current (constant current) Iw flows through the transistor 11*a* which forms a current mirror with the driving transistor 11*b* and a voltage corresponding to the program current is held in the capacitor 19. Incidentally, the transistor 11*e* is turned on and off (closed and opened) by a control signal (on/off signal) applied to the gate signal line 17*b* to achieve the intermittent control and the like described with reference to FIGS. 11, 9, etc.

In the example shown in FIG. 12, the program current Iw is passed through the transistor 11*a*. The example does not involve passing the program current (constant current) Iw through the transistor 11*b* which applies the current Ie to the EL element 15 unlike the example in FIG. 1. With the pixel configuration in FIG. 12, the transistor 11*a* and transistor 11*b* forms a current mirror circuit and if a mirror ratio is 1, the current Iw flowing through the transistor 11*a* is equal to the current Ie flowing through the transistor 11*b*. However, this configuration is similar to the pixel configuration in FIG. 1 in that the characteristics of the transistor 11*b* are compensated for by passing the program current Iw through the transistor 11*a*.

A technical idea of the present invention lies in passing the program current, constant current Iw, or the like from the source driver IC (circuit) 14, and thereby compensating for the characteristics of the driving transistor 11*b* which passes current directly to the driving transistor 11*a* or indirectly to the EL element 15. This is because the characteristics of the driving transistor 11 is outputted as a gate terminal potential (=the potential of the source signal line 18) by the application of the constant current Iw. Tone current or tone voltage is determined using the outputted voltage as a variable. Thus, the pixel configuration in FIG. 12, which can implement the driving method according to the present invention, is also included in the scope of the present invention. Incidentally, the transistor 11*e* may be omitted from the pixel configuration in FIG. 12 because the constant current Iw will not branch into the EL element 15 during measurement of Va and the like.

With the pixel configuration in FIGS. 1, 12, or the like, the current passed by the transistor 11*d* through the EL element 15 is controlled by the transistor 11*d*. The present invention is not limited to this. For example, the present invention is also applicable to the pixel configuration illustrated in FIG. 13. The pixel configuration in FIG. 13 allows on/off control of the current applied to the EL element 15 to be performed without the transistor 11*d*.

Figure 13:
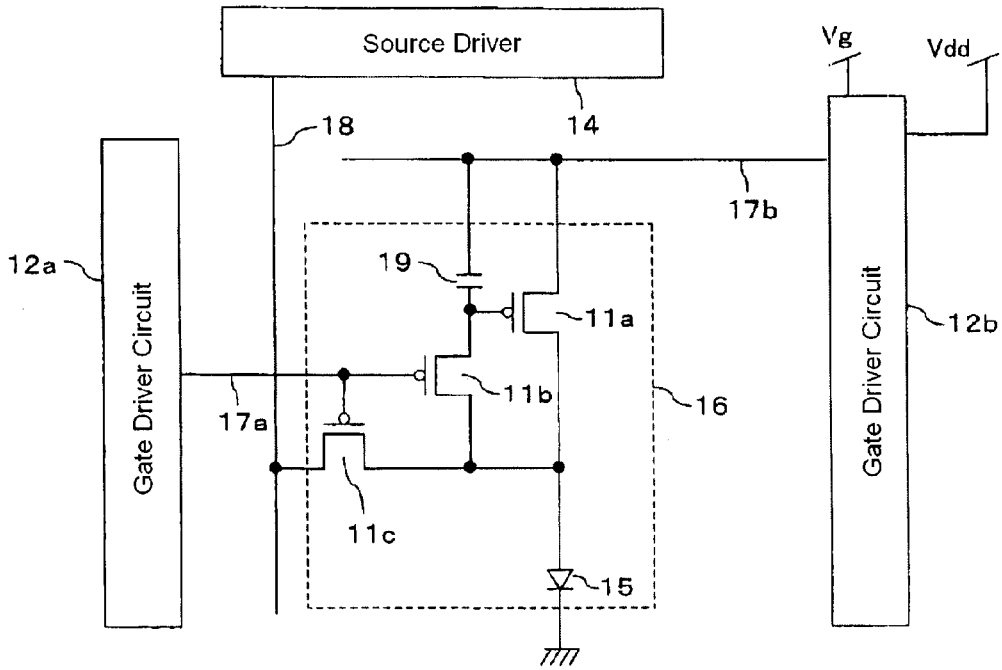
FIG. 13 is a schematic diagram of a pixel configuration of an EL display panel according to the present invention.

Referring to FIG. 13, the gate driver circuit 12*b* controls the gate signal line 17*b* and the potential of the gate signal line 17*b* is driven by the Vdd voltage and by a voltage Vg which is lower than the Vdd voltage and does not pass current through the EL element 15. That is, the Vdd and Vg voltages are outputted to the gate signal line 17*b*. When the Vdd voltage is applied to the gate signal line 17*b*, a current flows through the EL element 15. When the Vg voltage is applied to the gate signal line 17*b*, no current flows through the EL element 15. The configuration in FIG. 13 is similar to the configuration in FIG. 1 in that the constant current Iw is applied to the driving transistor 11*a*. Thus, a configuration such as in FIG. 13 which does not have a gate driver 12*b* is also included in the scope of the present invention. Similarly, it goes without saying that the present invention is also applicable to the configuration in FIG. 14 which is a variation of the pixel configuration in FIG. 1. The switching transistor 11*d* is placed under on/off control.

The number of driving transistors 11*a* or 11*b* is not limited to one and there may be two or more driving transistors 11*a* or 11*b*. Examples include a configuration in which five transistors 11*a* are arranged in parallel or in series. Also, two or more switching transistors 11*c*, 11*d*, or the like may be arranged in parallel or in series.

Figure 15:
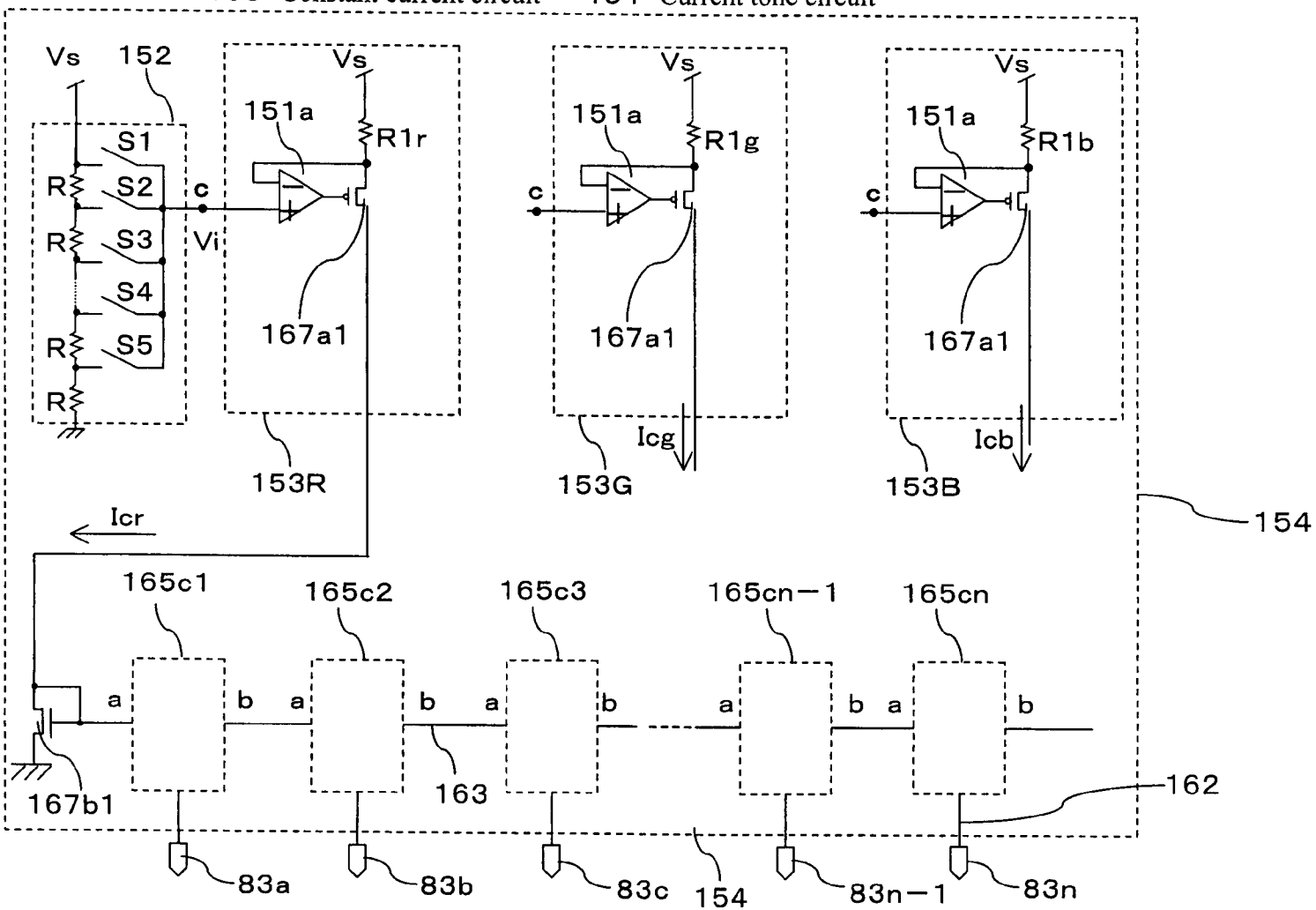
FIG. 15 is a block diagram of a driver circuit of an EL display panel according to the present invention.

The source driver IC (circuit) 14 as well as a current output circuit for the constant current or program current Iw will be described below. FIG. 15 is an explanatory diagram illustrating a configuration of the source driver IC (circuit) 14 according to the present invention. The source driver IC (circuit) 14 according to the present invention has reference current circuits 153 (153R, 153G, and 153B) for red (R), green (G), and blue (B).

Each reference current circuit 153 consists of a resister R1 (R1*r*, R1*g*, or R1*b*), operational amplifier 151*a*, and transistor 167*a*. The resisters R1 (R1*r*, R1*g*, and R1*b*) are configured such that their values can be set or adjusted separately according to R, G, and B tone currents. The resisters R1 are external resisters installed outside the source driver IC (circuit) 14.

A voltage Vi is applied to a positive terminal c of the operational amplifier by an electronic regulator 152. The voltage Vi is obtained by dividing a stable reference voltage Vs by the resister R, dividing the resulting value by switches S (S1, S2, S3, . . . ), and selecting a generated voltage.

The electronic regulator 152 varies the output voltage Vi by controlling the switches S using an external signal. Thus, it can be regarded as a voltage output circuit which varies output voltages using an external control signal. However, the present invention is not limited to this and the electronic regulator 152 may be an electronic resister which varies internal impedance. Besides, the electronic regulator 152 may vary not only voltage, but also output current. For example, in FIG. 15, the electronic regulator 152 may directly generate or supply the reference current Ic based on an external control signal. These concepts are also included in the technical idea of the electronic regulator 152.

The reference current Ic is expressed as (Vs−Vi)/R1. The RGB reference currents Ic (Icr, Icg, and Icb) are adjusted or varied by separate reference current circuits 153. They are varied by respective RGB electronic regulators. Thus, the values of the voltages Vi outputted from the electronic regulators 152 vary with the control signals applied to the electronic regulators 152. The magnitudes of the RGB reference currents vary with the voltages Vi, and the tone currents (program currents) Iw outputted from the terminals 83 vary proportionally.

The generated reference currents Ic (Icr, Icg, and Icb) are applied from the transistors 167*a* to the transistors 167*b*. Each transistor 167*b* forms a current mirror circuit with a transistor group 165*c*. Incidentally, although the transistor 167*b*1 is illustrated as a single transistor in FIG. 15, it is configured as a set of unit transistors 164 (a transistor group), as is the case with the transistor group 165*c*.

If the number of tones outputted by the source driver IC (circuit) 14 is K and the size of the unit transistor 164 is St (square μm), the unit transistor 164 satisfies the conditions $40 \leqq K/\sqrt{(St)}$ and $St \leqq 300$.

The program current Iw is outputted from the transistor group 165*c* via the output terminal 83. The gate terminal of each unit transistor 164 in the transistor group 165*c* is connected with the gate terminal of the transistor 167*b* via gate wiring 163.

Figure 16:
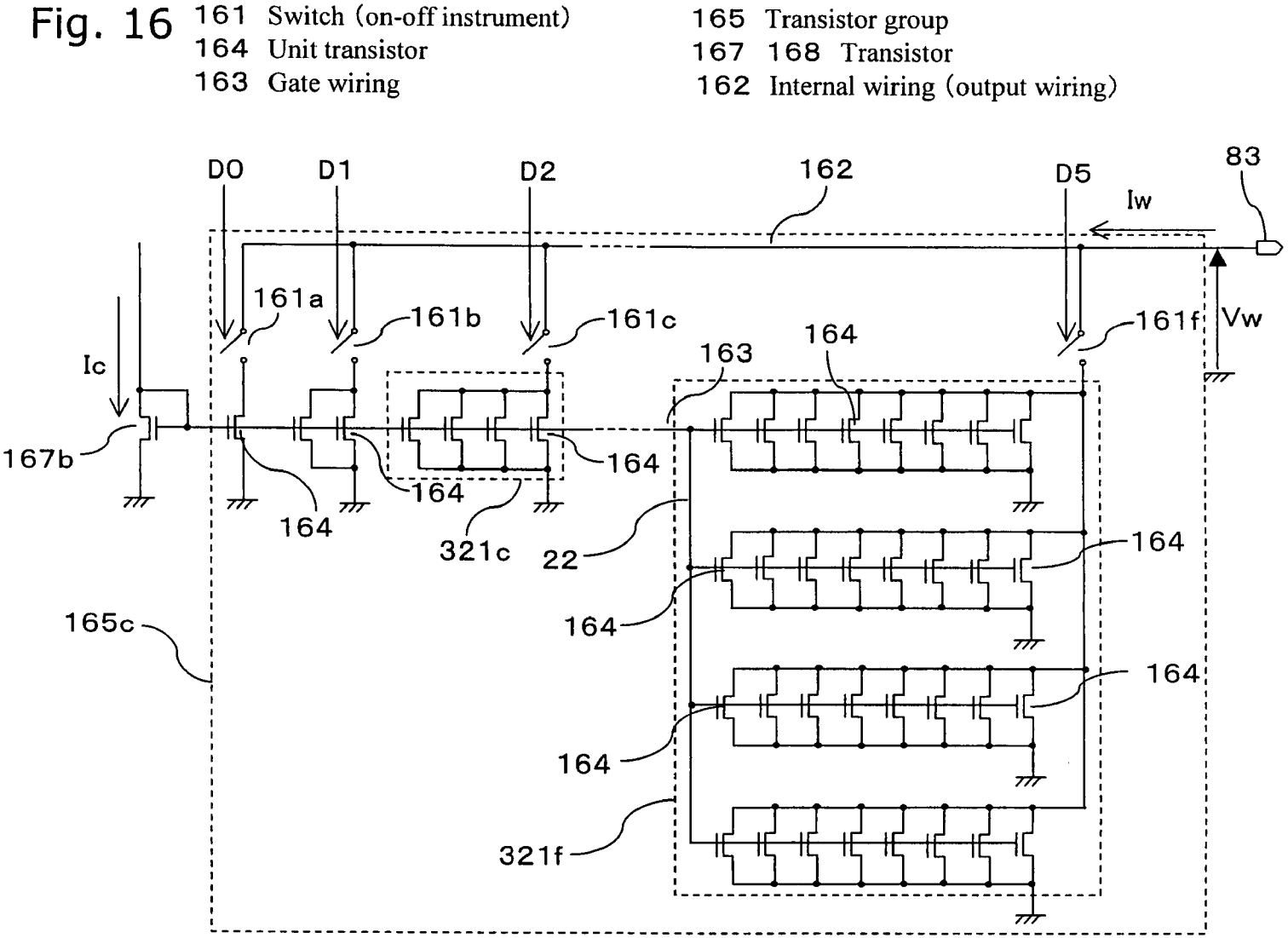
FIG. 16 is a block diagram of a driver circuit of an EL display panel according to the present invention.

As illustrated in FIG. 16, the transistor group 165*c* is configured as a set of unit transistors 164. To facilitate understanding, it is assumed that video data are converted into a program current in proportion or in correlation with each other. A switch 161 is selected by a video signal and consequently a program current Iw for the set of unit transistors 164 is generated. Thus, the video signal can be converted into the program current Iw. According to the present invention, a unit current of the unit transistor 164 corresponds to video data 1.

To generate the output current Iw without variations among the terminals 83, it is necessary to operate multiple unit transistors 164. To reduce variations in the output current Iw among terminals 83, the area occupied by the unit transistors 164 which generate the current must be larger than a certain size. Thus, to output the constant current Iw without variations among the terminals 83 (accurately), an output current source should be composed of multiple unit transistors 164 whose total area is larger than a predetermined size. Although the circuit shown in FIGS. 15 and 16 is described as being a tone current circuit it can produce a predetermined constant current Iw if the number of unit transistors 164 is fixed. Thus, the transistor group 165 is a generator of constant current Iw as well as the tone current circuit 154. Of course, the constant current circuit 153 in FIG. 15 and the like may be used.

The unit current is a program current of one unit outputted by the unit transistor 164 according to the magnitude of the reference current Ic. As the reference current Ic changes, the unit current outputted by the unit transistor 164 changes proportionally. This is because the transistor 167*b* and unit transistor 164 form a current mirror circuit.

Figure 20:
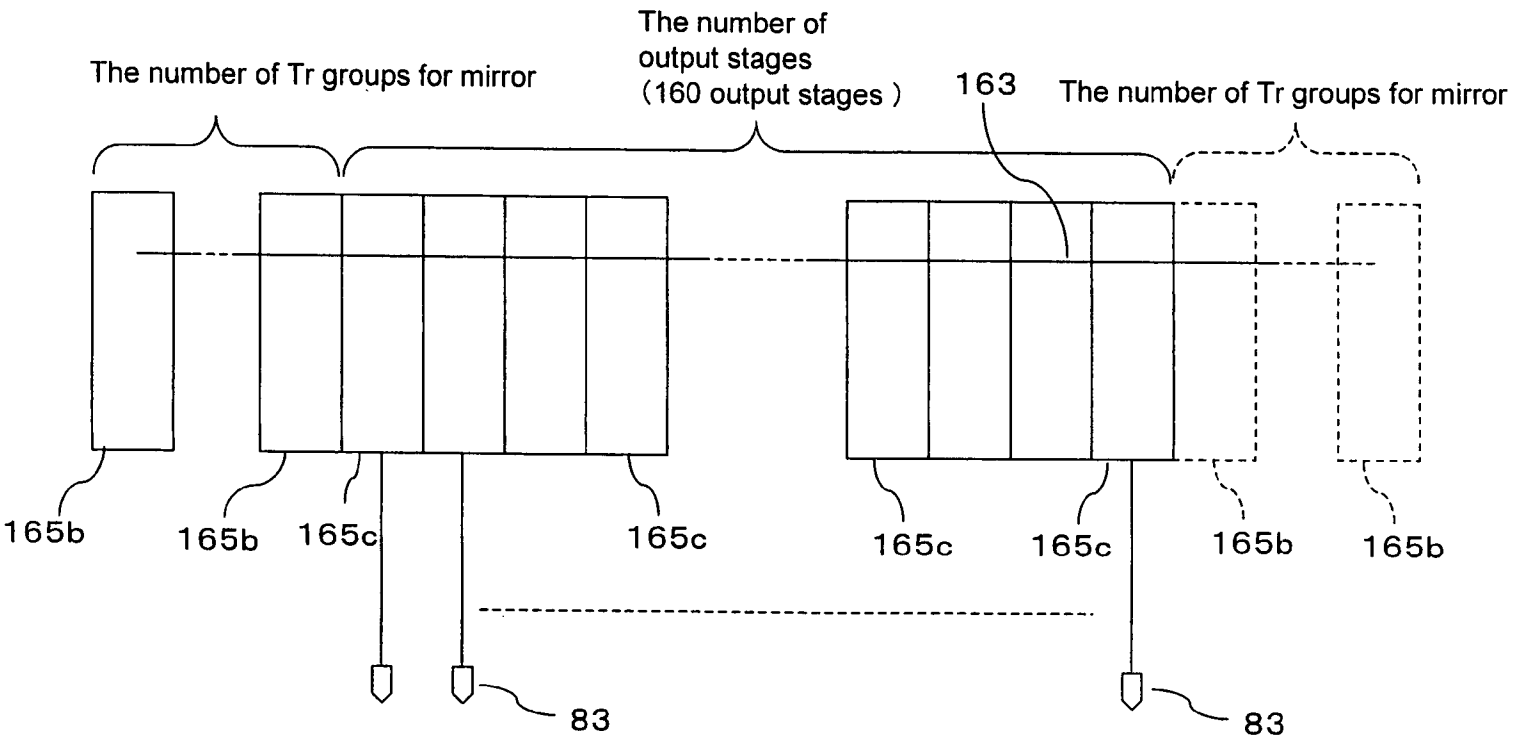
FIG. 20 is a block diagram of a driver circuit of an EL display panel according to the present invention.

The transistor 167*b*1 in FIG. 15 and transistor 167*b* in FIG. 16 are examples of the other transistor according to the present invention. Incidentally, the transistors 167*b* may form a transistor group 165*b*, which is illustrated in FIG. 20.

The unit transistor 164 is a transistor or current source which outputs a program current Iw of one unit or minimum unit. That is, a unit transistor 164 equals a unit current source. Also, a construction or part in which multiple unit transistors 164 gather together to output a program current corresponding to a tone is referred to as a transistor group (current output circuit) 165*c*.

The magnitude of the unit current can be varied by adjusting the magnitude or intensity of the reference current Ic outputted by the reference current circuit 153. The reference current Ic is adjusted with a built-in electronic regulator 152 or the like of the source driver IC (circuit) 14. The reference current circuit 153 which generates the reference current Ic is provided separately for the R, G, and B circuit.

Each of the R, G, and B transistor groups 165*c* consists of a set of unit transistors 164. The magnitude of the output current (unit program current) from the unit transistor 164 can be adjusted based on the magnitude of the reference current Ic. By adjusting the magnitude of the reference current Ic, it is possible to separately change or vary the magnitudes of the R, G, and B program currents (constant currents) Iw for each tone. Thus, under ideal conditions in which the R, G, and B unit transistors 164 have the same characteristics, it is possible to achieve a white balance for display images on the EL display apparatus by changing the ratio among the magnitudes of the reference currents Ic in the R, G, and B reference current circuits.

For ease of explanation or for ease of drawing, it is assumed below that the transistor groups 165*c* in the source driver circuit (IC) 14 have a 6-bit configuration. In FIG. 16, unit transistors 164 are provided for each bit of constant current data (D0 to D5). One unit transistor 164 is provided for the D0 bit, two unit transistors 164 are provided for the D1 bit, four unit transistors 164 are provided for the D2 bit, eight unit transistors 164 are provided for the D3 bit, and 16 unit transistors 164 are provided for the D4 bit. Similarly, 32 unit transistors 164 are provided for the D5 bit.

The output current of the unit transistors 164 for each bit is either outputted or not outputted to the output terminal 83 under the on/off control of analog switches 161 (161*a* to 161*f*). Each of the analog switches 161*a* to 161*f* corresponds to each bit (e.g., one of six bits) in the control signal of the constant current Iw. When the switch 161*a* which corresponds to the D0 bit is closed, one unit of current is outputted (inputted) from the output terminal 83. The output terminal 83 is connected with a source signal line 18. Similarly, when the switch 161*b* which corresponds to the D1 bit is closed, two units of current is outputted (inputted) from the output terminal 83.

Similarly, when the switch 161*c* which corresponds to the D2 bit is closed, four units of current is outputted (inputted) from the output terminal 83. When the switch 161*d* which corresponds to the D3 bit is closed, eight units of current is outputted (inputted) from the output terminal 83. When the switch 161*e* which corresponds to the D4 bit is closed, 16 units of current is outputted (inputted) from the output terminal 83. When the switch 161*f* which corresponds to the D5 bit is closed, 32 units of current is outputted (inputted) from the output terminal 83.

In this way, the switches 161 are opened and closed in a digital fashion according to the bits in the control signal of the constant current and the sum total of unit currents (the program current Iw) is outputted from the output terminal 83.

The program current Iw flows through the internal wiring 162. Potential Vw of the internal wiring 162 becomes the potential of the source signal line 18. The potential of the source signal line 18 causes the constant current Iw to be applied to the source signal line 18. In steady state, it corresponds to the gate terminal voltage of the driving transistor 11*a* of the pixel 16 (in the pixel configuration in FIG. 1).

The unit transistors 164 form a current mirror circuit with the transistor 167*b*. Incidentally, for ease of understanding, only one transistor 167*b* is illustrated in FIGS. 15, 16, and 17. Actually, however, it is constituted of multiple transistors (a transistor group). The transistor 167*b* and transistor group 165*c* form a current mirror circuit with a predetermined current mirror ratio.

That is, the transistor 167*b* consists of a group of many unit transistors 164. Needless to say, however, the unit transistors 164 in the transistor group 165*c* and the unit transistors of the transistor 167*b* may differ in size and output current characteristics. Needless to say, the transistor 167*a* may also be constituted of multiple transistors. Incidentally, a constant current output circuit which has unit transistors 164 is referred to as a transistor group 165*c*.

Thus, by configuring the transistor (167*b*, 167*a*, 168*a*, 168*b*, 165*b*, 165*c* in FIGS. 15, 16, 17, or the like) which performs one operation as a transistor group consisting of multiple unit transistors 164 of the same characteristics, it is possible to reduce variations in characteristics among output terminals 83 and among source driver ICs (circuits) 14 and thereby achieve proper operation.

The reference current Ic flows through the transistor 167*b* and a current corresponding to the current mirror ratio of the reference current Ic flows through the unit transistors 164. The 63 unit transistors 164 in FIG. 16 outputs the same unit current. In order for the unit currents of the unit transistors 164 to flow through the internal wiring 162, it is necessary to form current paths by closing the appropriate switches 161.

As described with reference to FIG. 15, the reference current Ic is generated by the constant current generating circuit 153 consisting of the operational amplifier 151*a* and resister R1. The reference current Ic is stabilized through stabilization and increased precision of the reference voltage Vs. The voltages Vi and Vs are applied across the resister R1. Thus, the following relationship holds: reference current Ic=(Vs−Vi)/R1. The reference current Ic can be set separately for R, G, and B. That is, the transistor group 165*c* is constructed (formed) for each of R, G, and B. The current Ic flowing through the transistors 167*b* in the transistor group 165*c* is adjustable. The resisters R1 are installed outside the source driver circuit (IC) 14. By adjusting the values of the resisters R1 separately for R, G, and B, it is possible to adjust or set white balance properly.

Figure 17A:
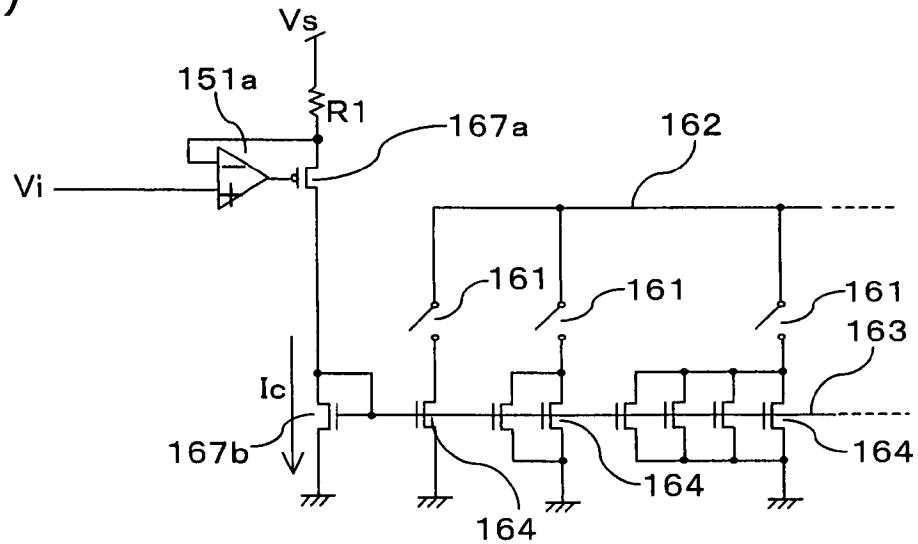
FIG. 17 is a block diagram of a driver circuit of an EL display panel according to the present invention.
Figure 17:
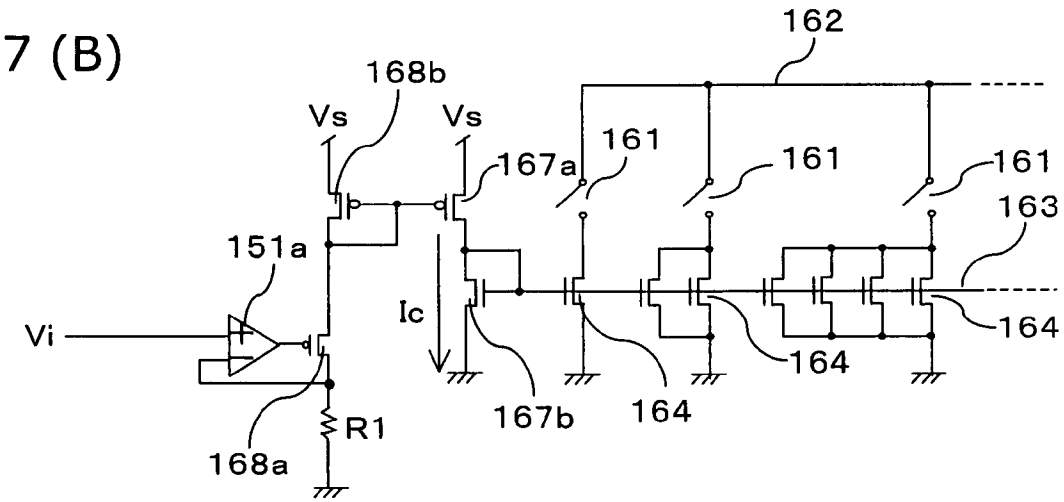

FIG. 17(A) shows a circuit configuration used to generate the reference current Ic by means of the Vs voltage. FIG. 17(B) shows a circuit configuration used to generate a basic current by means of the resister R1 placed (inserted) between GND and the negative terminal of the operational amplifier 151*a*, reflect the current by a current mirror circuit composed of the transistor 292*b* and transistor 167*a*, and thereby pass the reference current Ic through the transistor 167*b*. It is easier to adjust the magnitude of the reference current Ic with the circuit configuration in FIG. 17(B). However, since the current is reflected by the current mirror circuit composed of the transistor 292*b* and transistor 167*a*, the circuit is prone to variations in the output current Iw. Thus, the configuration in FIGS. 15 and 17(A) is preferable.

It has been stated that one or more unit transistors 164 are formed or placed for each bit as illustrated in FIG. 16(A). For example one unit transistor is formed for the first bit and two unit transistors are formed for the second bit.

However, the present invention is not limited to this. For example, needless to say, a unit transistor 164 which outputs a current corresponding to each bit may be formed or placed for the given bit. Specifically, one transistor which outputs a current twice larger than the 0th bit transistor is formed or placed for the first bit, one transistor which outputs a current four times larger than the 0th bit transistor is formed or placed for the second bit. Alternatively, two transistors each of which output a current twice larger than the first bit transistor may be formed or placed for the second bit.

In the case of 64 tones (6 bits each for R, G, and B), 63 unit transistors 164 are formed as illustrated in FIG. 16(A). It follows that in the case of 256 tones (8 bits each for R, G, and B), 255 unit transistors 164 are required.

The present invention has the unique advantage that the currents outputted by the transistor group 165*c* lend themselves to addition. Also, it has the unique property that if the channel width W of the unit transistor 164 is reduced to ½ with the channel length L kept constant, the current passed through the unit transistor 164 is reduced to approximately ½. Similarly, it has the unique property that if the channel width W is reduced to ¼ with the channel length L kept constant, the current passed through the unit transistor 164 is reduced to approximately ¼. Actually, the current is not reduced to exactly 1/n. For ease of explanation, however, it is assumed herein that the channel width W is reduced to 1/n. The spirit of the present invention is to form or place a unit transistor which outputs 1/n of the unit current of a given unit transistor.

Figure 18:
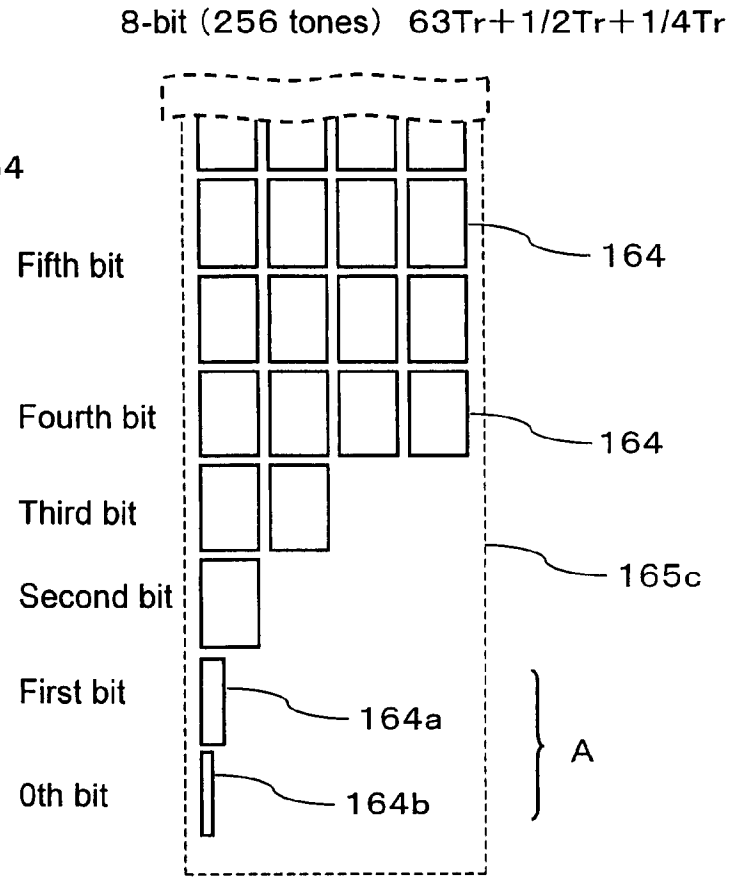
FIG. 18 is a block diagram of a driver circuit of an EL display panel according to the present invention.
Figure 18A:
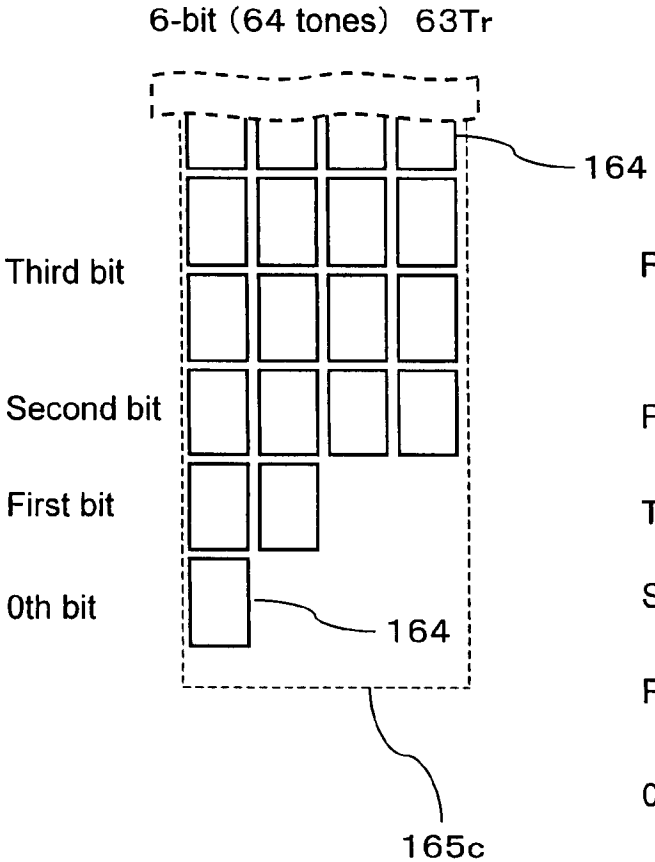

FIG. 18(A) shows a configuration of a transistor group 165*c* in which unit transistors 164 of the same size are provided for different bits. For ease of explanation, FIG. 18(A) shows that 63 unit transistors 164 form a 6-bit transistor group 165*c*. On the other hand, FIG. 18(B) shows an 8-bit configuration.

In FIG. 18(B), low-order two bits (indicated by A) consist of transistors smaller in size than the unit transistor 164. The least significant bit, i.e., the 0th bit consists of a transistor (unit transistor 164*b*) with a channel width ¼ the channel width W of the unit transistor 164. Also, the first bit consists of a transistor (unit transistor 164*a*) with a channel width ½ the channel width W of the unit transistor 164. Incidentally, the unit transistor 164*a* may be composed of two unit transistors 164*b* with a channel width ¼ the channel width W of the unit transistor 164.

In the above example, it has been stated that W of the unit transistor 164*b* is ¼ that of the unit transistor 164. The output current of the unit transistor 164*b* is ¼ that of the unit transistor 164. If W of the unit transistor 164 is 6 μm, W of the unit transistor 164*b* should be 1.5 μm, which is ¼ of 6 μm. However, this is the case when the unit transistor 164*b* has ideal characteristics. Actually, a channel width larger than 1.5 μm, such as 2.0 μm, is used. Generally, with small transistors, their output current and channel width are not proportional to each other. By using a channel width larger than the ideal value of ¼ the channel width of the unit transistor 164, it is possible to make the current of unit transistor 164*b*, when multiplied by 4, coincide with the current of the unit transistor 164. This will be described in more detail later.

Figure 19:
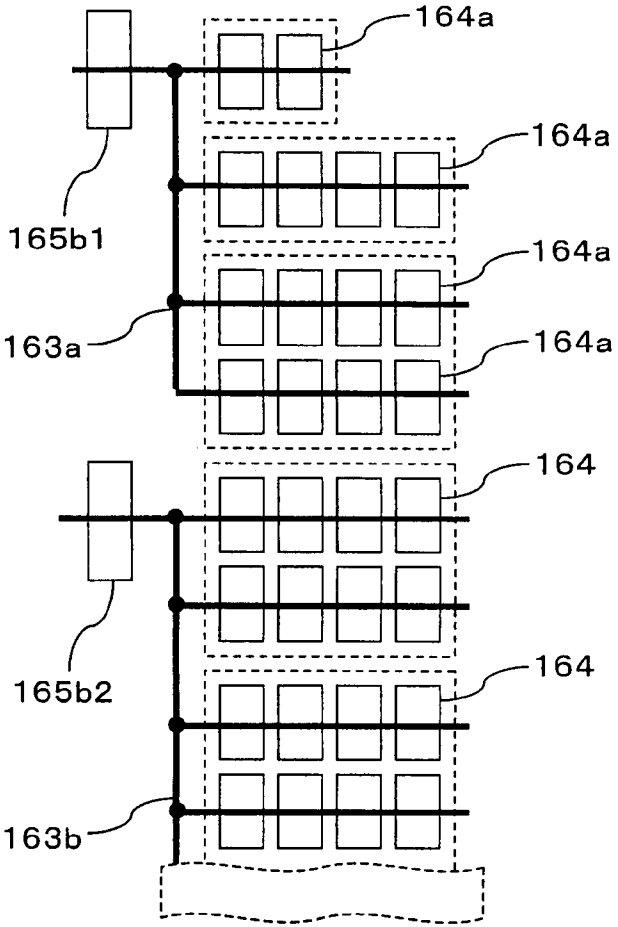
FIG. 19 is a block diagram of a driver circuit of an EL display panel according to the present invention.
Figure 19A:
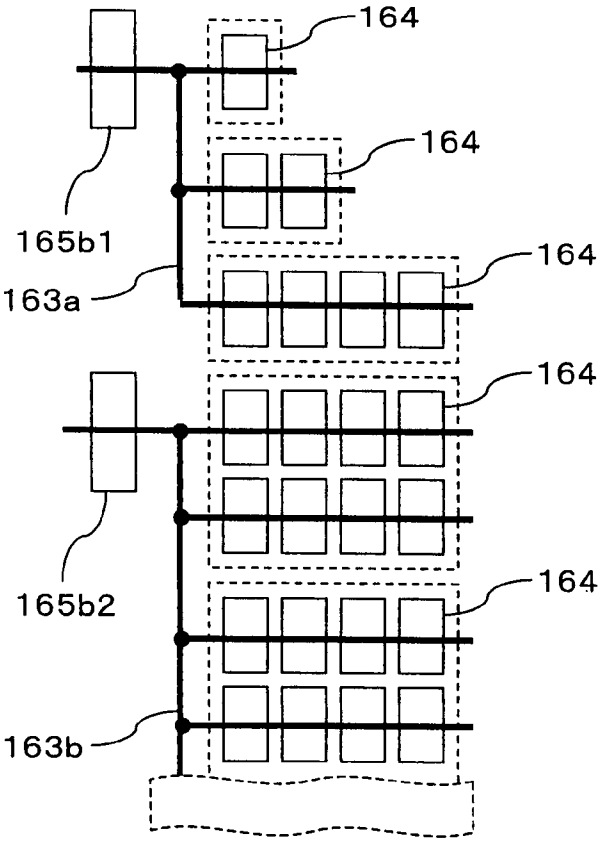

As illustrated in FIG. 19, the gate terminals of the unit transistors 164*a* (FIG. 19(B)), transistors 164*b* (FIG. 19(B)), and transistors 164 (FIG. 19(A)) are connected to the gate wiring 163, which is connected with the gate terminal of the transistor 167*b*.

The low-order two bits consist of transistors (164*a* and 164*b*) smaller in size than the higher-order unit transistors 164. Thus, the unit transistors 164*a* and 164*b* can output a unit current ½ or ¼ that of the unit transistor 164, respectively. The unit transistors 164*a* and 164*b* occupy minimal space. The number of regular unit transistors 164 is 63, which remains unchanged. Thus, even if a 6-bit configuration (64 tones) is changed to an 8-bit configuration (256 tones), there is not much difference in the formation area of the transistor group 165*c* between FIG. 18(A) and FIG. 18(B). That is, the chip size of the source driver IC (circuit) 14 used in current programming mode depends little on the number of tones. Conversely, the chip size of the source driver IC (circuit) 14 used in voltage programming mode depends heavily on the number of tones.

The reasons why there is no increase in the size of the transistor group 165*c* in the output stage of the source driver IC (circuit) 14 for current programming mode as illustrated in FIG. 18(B) even if a 6-bit configuration is changed to an 8-bit configuration are that the present invention makes good use of the properties that the program current (constant current) can be generated through the addition of unit currents (including 1/n unit currents) and that the current passed through the unit transistor 164 can be reduced to approximately 1/n by reducing the channel width W to 1/n with the channel length L kept constant.

Also, as exemplified by the unit transistors 164*a* and 164*b* illustrated in FIG. 18(B), variations in output current (constant current) increase with decreases in transistor size. However, how large the variations may be, the output currents of the unit transistors 164*a* or 164*b* are added. That is, no inversion of a tone can occur in principle. There is no difference in the variations in the program currents outputted at the maximum tone between the 6-bit and 8-bit configurations. This is because the variations in the output currents depend on the space occupied by the unit transistor group at the output stage.

Actually, the output current is not reduced to exactly 1/n even if the channel width W is reduced to 1/n. Some correction is necessary. There is not a significant meaning in halving the channel width W, but there is a technical meaning in reducing the output current of the transistor 24*a* to ½ of the output current of the unit transistor 164. Thus, it is only necessary to reduce the output current to an approximately integral submultiple such as ½ or ¼ by varying the channel length L in addition to the channel width W. Besides, the unit transistors 164, 164*a*, and 164*b* illustrated in FIG. 18(B) are operated at the same gate voltage. This can be accomplished easily by connecting the gate terminals of all the unit transistors to the internal wiring 162 as illustrated in FIG. 16. All the unit transistors (164, 164*a*, and 164*b*) can be configured to form current mirror circuits with the transistor 167*b*.

When a transistor is operated at the same gate terminal voltage, its output current is reduced to ½ or less if the channel width W is halved. Therefore, according to the present invention, when the sizes of the higher-bit transistors and lower-bit transistors are changed, the transistor sizes are set as follows when they need to be changed.

A small number of sizes such as two sizes are used for the unit transistors 164 of the source driver circuit (IC) 14. The unit transistors 164 are made to have the same channel length L. That is only the channel width W is varied. Alternatively, the unit transistors are formed by varying only one of the channel width W and channel length L. Preferably, less than four sizes or shapes are used for the unit transistors 164 which compose the transistor group 165*c*. More preferably, less than three sizes or shapes are used.

Transistors are configured such that when a ratio between a first unit output current of a first unit transistor and a second unit output current of a second unit transistor is n (first unit output current:second unit output current=1:n, where n is a value smaller than 1), the following relationship should hold: channel width W1 of the first unit transistor<channel width W2 of the second unit transistor W2×n×a.

When W1×n×a=W2, preferably the following relationship holds: 1.05<a<1.3. A correction coefficient a can be determined easily by forming a test transistor and measuring or assessing it.

According to the present invention, unit transistors 164 smaller than higher-bit unit transistors 164 are formed or placed to create (provide) lower-order bits. The term "smaller" here means that they are smaller in terms of output current than the unit transistors 164 which constitute higher-order bits. Thus, this concept includes smallness of not only channel width W, but also channel length L or other dimensions. This concept also includes the other shape. It has been stated that the output current of the unit transistor 164*a* is ½ that of the unit transistor 164, but this does not mean that accuracy is required. It is sufficient if the ratio is set within the range of 60% to 140% so that the output current in each bit will not be reversed. That is, the ratio can be roughly ½ or ¼.

It has been shown in FIG. 18(B) that multiple sizes are used for the unit transistors 164 which compose the transistor group 165*c*. Specifically, three sizes (164, 164*a* and 164*b*) are indicated in FIG. 18(B). The reason why the number of sizes is limited is that as described above, differing sizes of unit transistors 164 make the magnitude of output current no longer proportional to transistor dimensions, and thus make design difficult. Thus, it is preferable to use two sizes for the unit transistors 164 which compose the transistor group 165*c*: one for low tone and one for high tone. For example, in FIG. 18(B), the first bit may be constituted of two low-tone unit transistors 164*b*, the same unit transistors as the one used for the 0th bit. That is, high-tone unit transistors 164 should be used for the 2nd to the 7th bits and low-tone unit transistors 164*b* should be used for the 0th to the 1st bits.

As also illustrated in FIG. 16, the gate terminals of the unit transistors 164 composing the transistor group 165 are connected to the same internal wiring 162. The output currents of the unit transistors 164 depend on the voltage applied to the internal wiring 162. Thus, if the unit transistors 164 in the transistor group 165*c* have the same shape, the unit transistors 164 output the same unit current.

The present invention is not limited to the use of common internal wiring 162 for the unit transistors 164 in the transistor group 165. For example, a configuration shown in FIG. 19(A) is available. Incidentally, the transistor group 165*b* corresponds to the transistor 167*b*. That is, the transistor group 165*c* constitutes the transistor 167*b*. FIG. 19(A) shows unit transistors 164 which form a current mirror circuit with the transistor group 165*b*1 and unit transistors 164 which form a current mirror circuit with the transistor group 165*b*2.

The transistor group 165*b*1 is connected by internal wiring 162*a* and the transistor group 165*b*2 is connected by internal wiring 162*b*. In FIG. 19(A), the uppermost unit transistor 164 corresponds to the LSB (0th bit), the two unit transistors 164 in the second row correspond to the 1st bit, the four unit transistors 164 in the third row correspond to the 2nd bit, and the eight unit transistors 164 in the fourth row correspond to the 3rd bit.

In FIG. 19(A), by applying different voltages to the internal wiring 162*a* and internal wiring 162*b*, it is possible to vary (change) the output current among the unit transistors 164 even if the unit transistors 164 have the same size and shape.

Although it has been stated with reference to FIG. 19(A) that different voltages are applied to the internal wiring 162*a* and internal wiring 162*b* while using unit transistors 164 of the same size and the like, the present invention is not limited to this. Unit transistors 164 of different shapes may be made to produce equal output currents by adjusting the voltages applied to the internal wiring 162*a* and internal wiring 162*b*.

The minimum output current of the transistor 164 in the source driver circuit (C) 14 is between 0.5 nA and 10 nA (both inclusive). Preferably, the minimum output current of the unit transistor 164 should be between 2 nA and 20 nA (both inclusive) to ensure accuracy of the transistors 164 composing the transistor group 165*c* in the source driver IC 14.

Also, as illustrated in FIG. 20, the transistor 167*b* may be formed as a transistor group 165*b* constituted of a set of unit transistors 164. The unit transistors in the transistor group 165*b* share common gate terminals with the unit transistors 164 in the transistor group 165*c* to form a current mirror circuit. Preferably, multiple transistor groups 165*b* are formed.

Preferably, the transistors 167*b* or transistor groups 165*b* are formed or placed on both sides of the transistor group 165*c* as illustrated in FIG. 20. The transistor group 165*b* and transistors 167*b* are supplied with reference current Ic from a reference current generating circuit 153.

Although it is stated that the transistor group 165*c* according to the present invention outputs current, this is not restrictive. For example, the transistor group 165*c* may output voltage. That is, the transistor group 165*c* may output voltage in order for the source driver circuit (IC) 14 to perform voltage driving as in the case of a liquid crystal display panel. Besides, the transistor group 165*c* of an operational amplifier may output voltage. The present invention similarly applies in the case of a voltage-driven EL display panel. Also, although it is stated that selector circuits 222 and 291 are built into a source driver circuit (IC) 14 consisting of a silicon chip, this is not restrictive. For example, the transistor group 165*c* may be formed directly on a glass array board 30 by polysilicon technology or the like. Alternatively, it may be formed or constructed on a separate chip.

Figure 21:
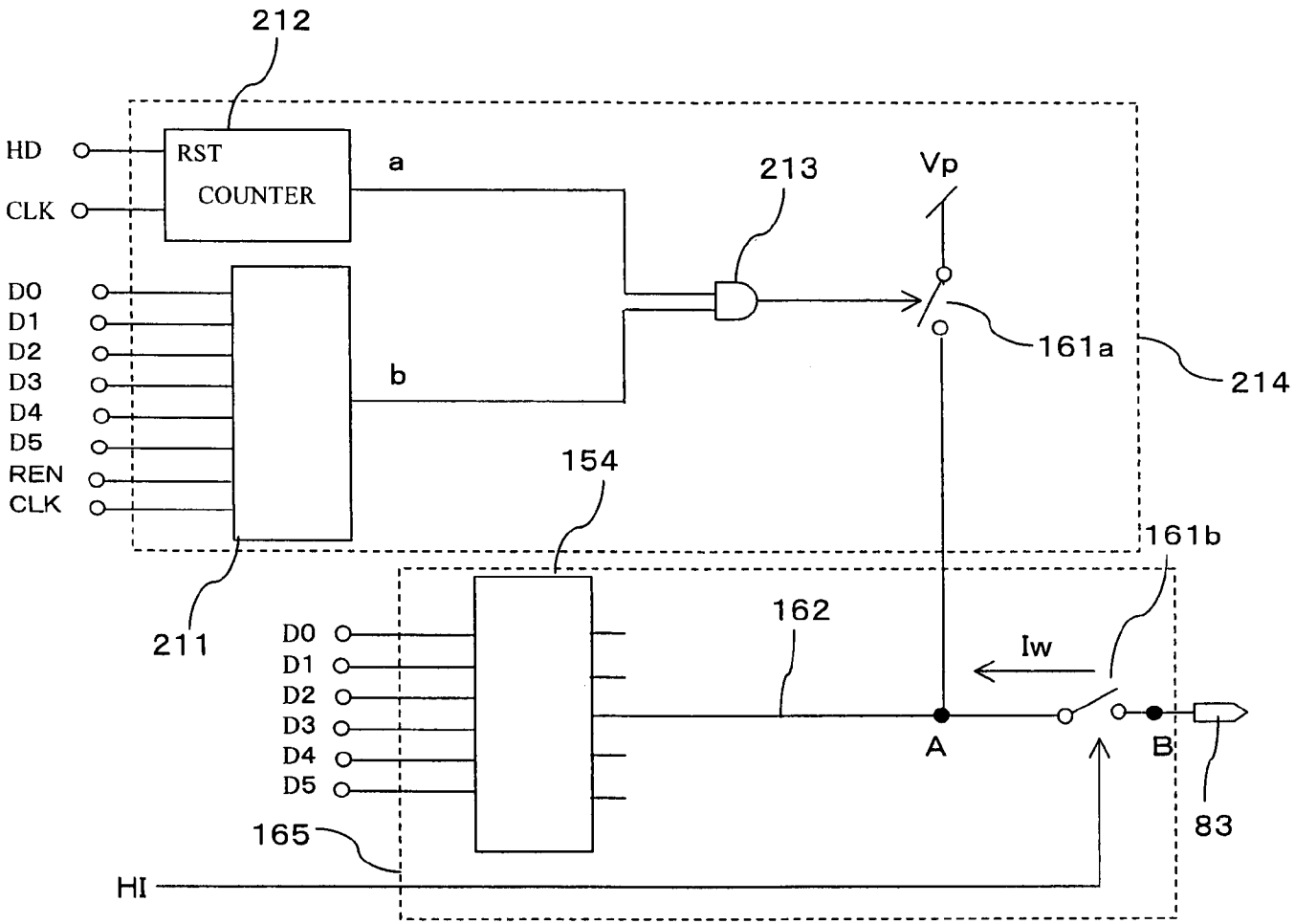
FIG. 21 is a block diagram of a driver circuit of an EL display panel according to the present invention.

As illustrated in FIG. 21, the source driver circuit (IC) 14 has a built-in precharge circuit 214 which charges or discharges the source signal lines 18 forcibly. The precharge circuit outputs precharge voltage Vp, which corresponds to the Va voltage and V0 voltage. The concept of the precharge voltage Vp includes both voltage which forcibly discharges the source signal line 18 and voltage which charges the source signal line 18. It also includes program voltage. That is, application of the precharge voltage Vp means applying some voltage. Basically, the precharge voltage Vp is applied to the source signal line 18. Of course, it may be applied directly to the gate terminal of the driving transistor 11*a* of the pixel 16. For example, the precharge voltage Vp may be applied using a probe pressed against a pixel electrode. Preferably, the precharge voltage Vp is configurable separately for R, G, and B. This is because a threshold of the EL element 15 varies among R, G, and B.

The precharge voltage Vp is applied to charge and discharge the source signal line 18 or to set the source signal line 18 to a predetermined voltage. The concept of application of the precharge voltage Vp also includes application of the Va or V0 voltage, application of a target tone voltage or program voltage at the beginning of a horizontal scanning period, and application of an overcurrent for the purpose of changing the source signal line potential.

FIG. 21 is a block diagram of a precharge circuit. An output period and range of the precharge voltage Vp are determined by video data D0 to D5. The precharge voltage Vp is outputted in sync with a horizontal scanning period and dot clock CLK. The time at which the precharge voltage Vp is outputted is determined starting from a horizontal synchronization signal HD based on a set value of a counter circuit 212. The counter circuit 212 counts up in sync with a clock (CLK) signal. The output period of the precharge voltage Vp starts from the beginning of a horizontal scanning period (1H).

When the counter circuit 212 counts up to the set value, the output period of the precharge voltage Vp is ended. Output from the counter circuit 212 provides input to part a of an AND circuit 213. The precharge voltage Vp can be switched on (applied) and off (not applied). The switching is performed based on a video signal applied to the source signal line 18, the magnitude of a program current or program voltage corresponding to the video signal, a change in the video signal (difference from the video signal applied during the previous horizontal scanning period), the magnitude of a program current or program voltage corresponding to the video signal (change from the program current or program voltage applied during the previous horizontal scanning period).

With the configuration in FIG. 21, a voltage range for precharging is determined by a coincidence circuit 211. The video data D0 to D5 are applied to the coincidence circuit 211. A precharge range is stored or set in the coincidence circuit. If the video data D0 to D5 are smaller than stored or set values, a precharge voltage is outputted from the terminal 83. The coincidence circuit 211 operates in sync with the clock CLK. The precharge voltage is outputted when an enable signal EN is High, but it is not outputted regardless of the video data, when the enable signal EN is Low. The output from the coincidence circuit 211 provides input to terminal b of the AND circuit 213.

The input in part a of the AND circuit 213 is High and the input in terminal b is High, the switch 161*a* closes, causing the precharge voltage Vp to be applied to the internal wiring 162. When an HI signal is High as well, the switch 161*b* closes, causing the precharge voltage Vp to be outputted from the output terminal 83.

Figure 22:
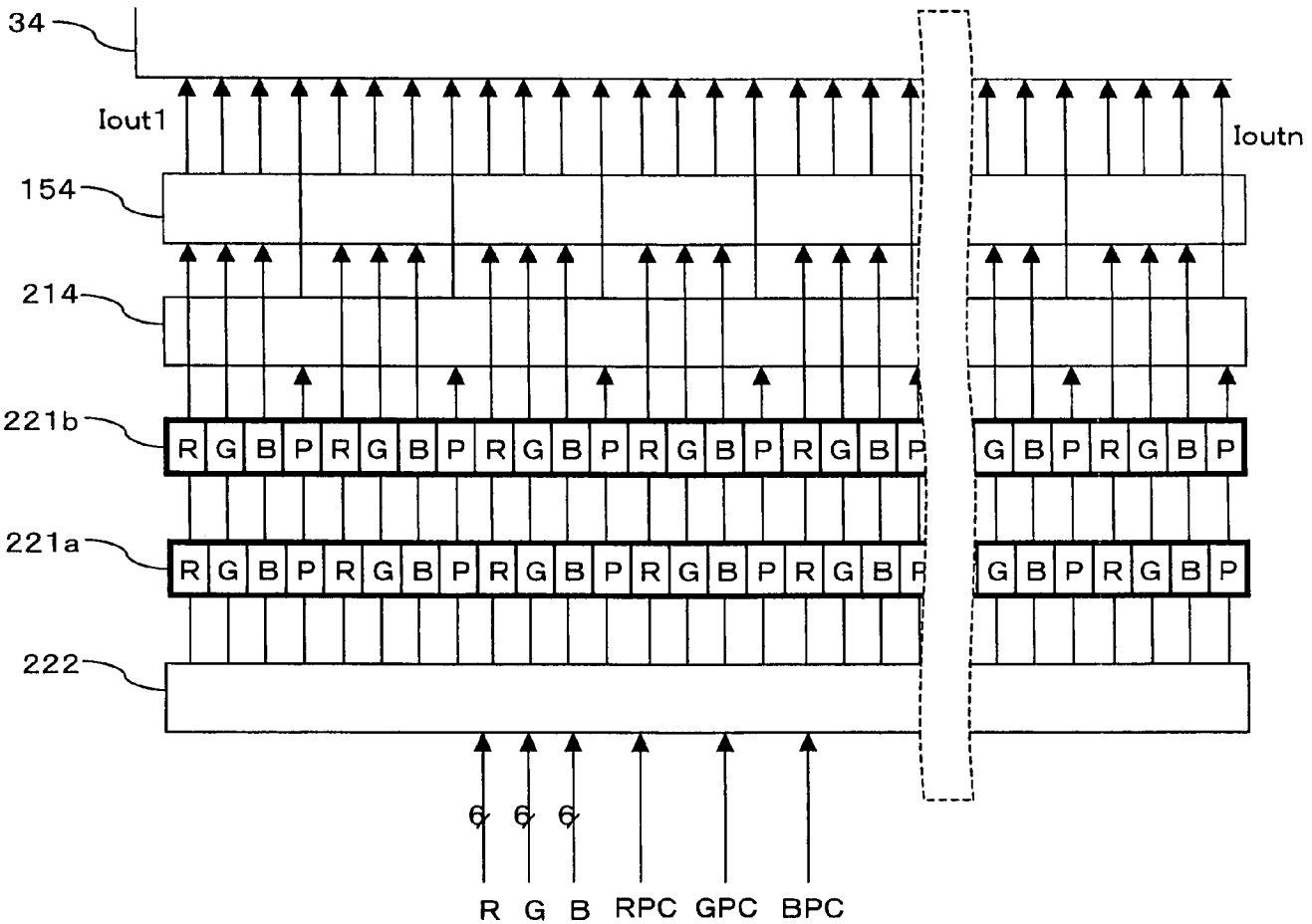
FIG. 22 is a block diagram of a driver circuit of an EL display panel according to the present invention.

FIG. 22 is a block diagram centered around the precharge circuit (a component which outputs a precharge voltage) of the source driver circuit (IC) 14. The precharge circuit 214 outputs precharge control signals (PC signals) (red (RPC), green (GPC), blue (BPC)) from a precharge control circuit.

The selector circuit 222 latches data onto a latch circuit 221 in sequence in sync with a main clock, where the latch circuit 221 corresponds to output stages. The latch circuit 221 consists of two stages: a latch circuit 221*a* and latch circuit 221*b*. The latch circuit 221*b* sends out data to the precharge circuit 214 in sync with a horizontal scanning clock (1H). That is, the selector latches one pixel row of image data and PC data in sequence and stores the data in the latch circuit 221*b* in sync with the horizontal scanning clock (1H).

Incidentally, in the latch circuit 221 in FIG. 22, R, G, and B indicate 6-bit latch circuits for R, G, and B image data while P indicates a latch circuit which holds a 3-bit precharge signal (RPC, GPC, and BPC).

When the output of the latch circuit 221*b* is High, the precharge circuit 214 turns on the switch 161*a* to output the precharge voltage Vp to the source signal line 18. The transistor group 165*c* outputs a program current (constant current) to the source signal line 18 according to image data.

Determination as to whether to apply the precharge voltage Vp is made based on the voltage applied to the source signal line 18 (potential held) before the determination. It is made based on the potential difference between the potential applied to the source signal line 18 before the determination and the voltage to be applied next (the potential of the source signal line 18 expected to be generated by the application of a program current potential) or on the amount of change in potential. If there is a small potential difference, for example, if the voltage applied to the pixels in the N-th (N is an integer not smaller than 1, but not larger than the maximum number of pixel rows) pixel row or a change in potential caused by application of a program current is 4.0 V and the voltage to be applied next is 4.1 V, the precharge voltage Vp is applied to the pixels in the (N+1)-th pixel row. Conversely, if there is a potential difference as large as 2.0 V, the precharge voltage Vp is not applied to the pixels in the (N+1)-th pixel row.

According to the present invention, when the driving transistor 11*a* of the pixel 16 is a P-channel transistor, determination as to whether a precharge voltage Vp is applied is made in the following range. For ease of explanation, let Vdd denote the anode voltage, let Vss denote the cathode voltage, let Vd denote power supply voltage of the source driver IC (circuit) 14, and let GND denote the ground potential of the source driver IC (circuit) 14. Also, let Vn denote the potential (the voltage applied 1H before) held by the source signal line 18 and let Vm denote the voltage (or the target voltage changed by the application of a program current) outputted from the source driver IC (circuit) 14. Incidentally, the anode Vdd, cathode Vss, Vn, and Vm are voltage values with respect to GND. Preferably, the relationship among potentials in FIG. 4 is satisfied.

When the driving transistor 11*a* of the pixel 16 is a P-channel transistor, the precharge voltage Vp is applied to the source signal line 18 or pixel 16 if at least one of the following conditions is satisfied.

$$0.5 \leqq (Vdd-Vm)/Vdd \leqq 0.9$$

$$0.5 \leqq (Vd-Vm)/Vdd \leqq 0.9$$

$$0.1 \leqq |(Vn-Vm)|/Vn \leqq 0.3, \text{ where } 0.5 \leqq (Vd-Vm)/Vdd$$

When the driving transistor 11*a* of the pixel 16 is an N-channel transistor, the precharge voltage Vp is applied to the source signal line 18 or pixel 16 if at least one of the following conditions is satisfied. Incidentally, Vn and Vm are Vss-side voltages of negative polarity.

$$0.5 \leqq |(Vss-Vm)|/Vss \leqq 0.9$$

$$0.5 \leqq |(Vss-Vn)|/Vss \leqq 0.9$$

$$0.1 \leqq |(Vn-Vm)|/Vn \leqq 0.3, \text{ where } 0.5 \leqq (Vss-Vm)/Vss$$

It has been stated in the above example that determination as to whether to apply the precharge voltage Vp is made based on the potential held by the source signal line 18, the voltage to be applied, or the like. Needless to say however, the determination may be made based on the tone of the video signal applied to the pixel 16. According to the present invention, the precharge voltage Vp is applied to each source signal line 18 if at least one of the following conditions is satisfied, where M is the maximum number of tones, N1 is the tone of the video signal applied 1H before, and N2 is the tone of the video signal to be applied next.

$$1 \leqq N2 \leqq M \times 0.25$$

$$1 \leqq |N2 - N1| \leqq 8$$

The determination about precharging is not limited to precharging on a pixel by pixel basis. For example, determination about precharging may be made in relation to image data of two or more pixel rows. Also, determination may be made taking into consideration image data around the pixel to be precharged (e.g., by means of weighing). Also, determination may be varied between moving images and still images. What is important is that the controller generates a precharge signal based on image data, thereby achieving good versatility.

The determination about precharging is not limited to precharging on a pixel by pixel basis. For example, determination about precharging may be made in relation to image data of two or more pixel rows. Also, determination may be made taking into consideration image data around the pixel to be precharged (e.g., by means of weighing). Also, determination may be varied between moving images and still images. What is important is that the controller generate a precharge signal based on image data, thereby achieving good versatility. The description below will focus on the determination about precharging and precharge mode.

The determination as to whether to carry out precharging may be made based on image data one pixel row before (or the image data applied to the source signal line just before). Suppose, for example, the image data applied to a source signal line 18 changes in the order: white, black, and black. A precharge voltage is applied when the image data changes from white to black. This is because black tone is difficult to write. When writing image data of black twice in succession, no precharge voltage is applied at the time of the second writing of black because the potential of the source signal line 18 remains ready for black display after the first writing of black. The above operation can be accomplished easily by forming (placing) one pixel row of line memory in the controller circuit (IC) 801 (two lines of memory are required because of FIFO).

Although it is stated herein that the precharge voltage Vp (Va or V0) is outputted in the case of precharge driving, this is not restrictive. A current larger than a program current may be written into the source signal line 18 for a period shorter than one horizontal scanning period. That is, a precharge current may be written into the source signal line 18 before writing a program current into the source signal line 18. The precharge current causes voltage changes all the same in a physical sense. Precharging by means of a precharge current is also included within the technical scope of the precharge driving according to the present invention (within the scope of the present invention).

In the precharge driving according to the present invention, a predetermined voltage is applied to the source signal line 18. It has been stated that the source driver IC outputs a program current. However, in the precharge driving according to the present invention, output voltage may be varied according to the tone. In that case, the precharge voltage outputted to the source signal line 18 is a program voltage. A circuit configuration in which a voltage tone circuit 231 for precharge voltage is incorporated in the source driver IC is shown in FIG. 23.

Although the voltage tone circuit 231 is described as being an arrangement on an operation which outputs tone voltage such as program voltage, the present invention is not limited to this. It is also used in referring to a circuit which outputs a predetermined constant voltage or program voltage. Besides, it is used in referring to a sample-and-hold circuit. In short, it is a circuit which can output voltage values at multiple stages. However, if the precharge voltage Vp is a fixed value, the voltage tone circuit 231 may be configured to output one type of voltage. This configuration is also included in the concept of the voltage tone circuit 231. Besides, the electronic regulator 152, which can vary or adjust output voltage using external input data, is also a voltage tone circuit. Furthermore, a D/A (digital-analog conversion) circuit 391 is also a voltage tone circuit.

Incidentally, the voltage tone circuit 231 includes not only circuits which output an analog voltage in response to input of a digital signal, but also circuits which output an analog voltage after impedance conversion, amplification, or reduction. In a wide sense, the voltage tone circuit 231 also includes circuits which select and output one predetermined voltage or multiple voltages. In short, the voltage tone circuit 231 can be understood as a constant voltage source.

Figure 23:
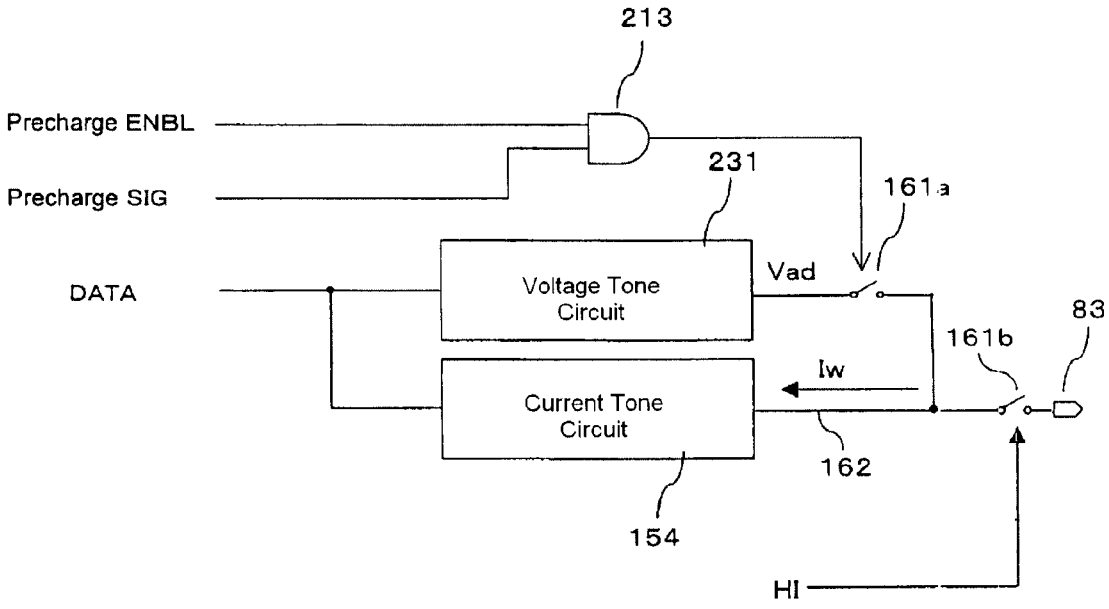
FIG. 23 is a block diagram of a driver circuit of an EL display panel according to the present invention.

FIG. 23 is a block diagram of a single-output circuit which serves mainly for a single source signal line 18. It consists of the current tone circuit 154 which outputs a program current according to the tone and voltage tone circuit 231 which outputs a precharge voltage according to the tone. Video data are applied to the current tone circuit 154 and voltage tone circuit 231. Output of the voltage tone circuit 231 is applied to the source signal line 18 as the switches 161*a* and 161*b* turn on. The switch 161*a* is controlled by a precharge enable (precharge ENBL) signal and precharge signal (precharge SIG).

Although it is stated that basically the current tone circuit 154 outputs tone current such as program current, the present invention is not limited to this. The term "current tone circuit" is also used in referring to a circuit (constant current output circuit) which outputs a predetermined constant current. Also, it is used in referring to a constant current source because any circuit configuration which can output tone current can output a constant current of a predetermined value such as 1 μA or 0.5 μA.

Naturally, it goes without saying that the current tone circuit 154 may be simplified and configured as a constant current circuit which outputs a constant current Iw. In order to measure Va or V0, it is sufficient to apply the constant current Iw. Needless to say, this function can be achieved by either the tone current circuit 154 or a simplified constant current circuit. Incidentally, in terms of the tone current, the program current Iw can be regarded as a constant current.

The voltage tone circuit 231 is constituted, for example, of a sample-and-hold circuit. Also, it is constituted of a D/A conversion circuit or the like as required. The tone voltage is converted into a precharge voltage by the D/A conversion circuit based on digital video data. The resulting precharge voltage is sampled and held by a sample-and-hold circuit 241 and applied to a terminal of the switch 161*a* via an operational amplifier.

There is no need to construct or form a D/A conversion circuit for each voltage tone circuit 231, and output from a D/A conversion circuit provided outside the source driver circuit (IC) 14 may be sampled and held in each voltage tone circuit 231. Also, the D/A conversion circuit may be formed by polysilicon technology.

Figure 24:
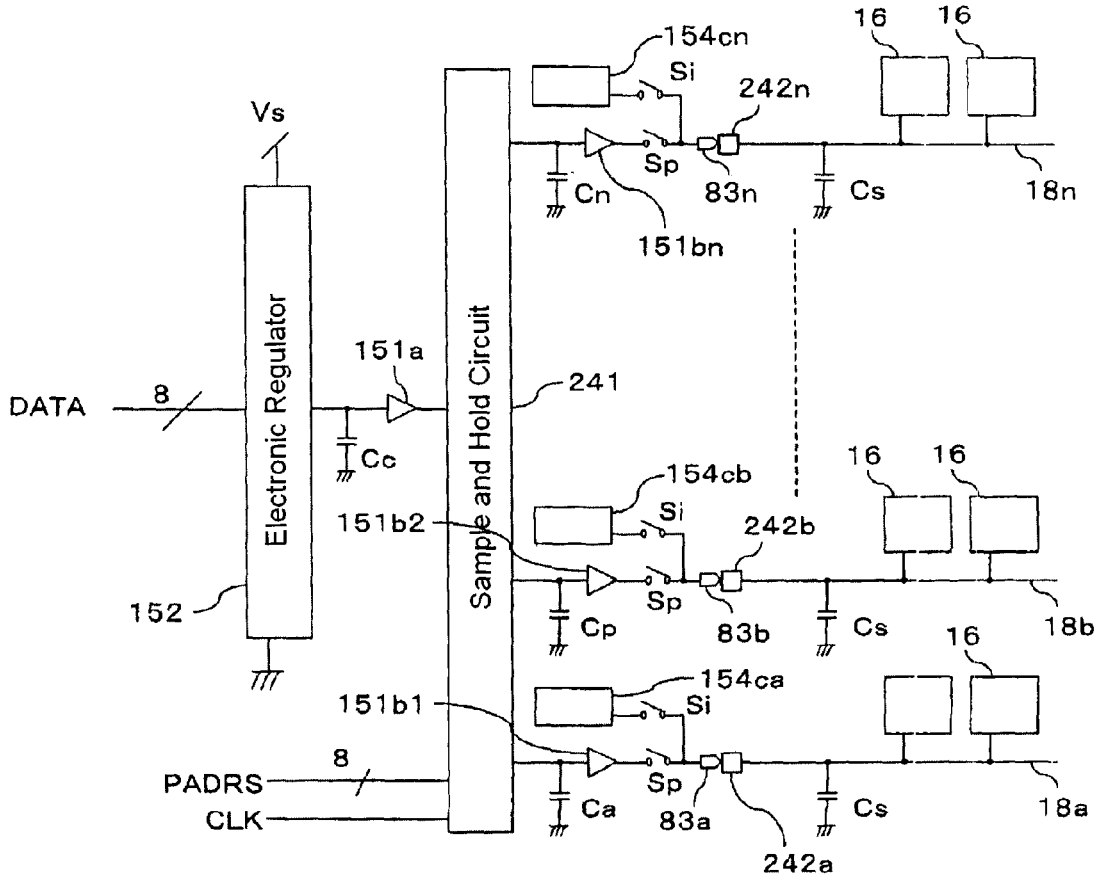
FIG. 24 is a block diagram of a driver circuit of an EL display panel according to the present invention.

As illustrated in FIG. 24, a voltage (program voltage) which corresponds to an 8-bit video signal DATA is outputted from the electronic regulator 152 in sync with a video clock. The program voltage is applied as a precharge voltage to the driving transistor 11*a*. Also, the program voltage is held in the gate terminal of the driving transistor 11*a* so that a current approximately corresponding to the tone will be applied to the EL element 15.

The program voltage is temporarily held in Cc capacitance and outputted from a buffer amplifier 151*a*. The outputted voltage is allocated to the output terminals 83 (output terminals 83*a*, 83*b*, 83*c*, 83*d*. . . , 83*n*, 83*a*, 83*b*, 83*c*, . . . 83*n*. . . ) in sequence by the sample-and-hold circuit (illustrated as a switching circuit, in this example) 241. The allocation is performed in sync with the clock CLK. Incidentally, according to the present invention, the program voltage can be allocated to a desired terminal by an 8-bit address signal PADRS. The configuration in which the program voltage can be allocated to a desired output terminal 83 (the use of eight bits allows the program voltage to be allocated to any of 256 terminals) according to the address signal PADRS makes it possible to apply a new program voltage only to a terminal which needs rewriting of program voltage. The allocation of program voltage can be randomized. The program voltage is held (sampled) in capacitance C, the output from the buffer circuit 151*b* is applied to the output terminal 83 or blocked under the control of a switch Sp. The switch Sp corresponds to the switch 161*a* in FIG. 23.

Specifically, the current tone circuit 154 corresponds to the circuit configuration in FIG. 16. Program current output from the current tone circuit 154 is controlled by a switch Si. Thus, outputs from the current tone circuit 154 and voltage tone circuit 231 are controlled by the switches Si and Sp to implement precharge driving (voltage programming)+current programming. The signals for that are applied to the source signal line terminal 242 from the output terminal 83. The program voltage charges and discharges parasitic capacitance Ca of the source signal line 18 in a short time.

Figure 25:
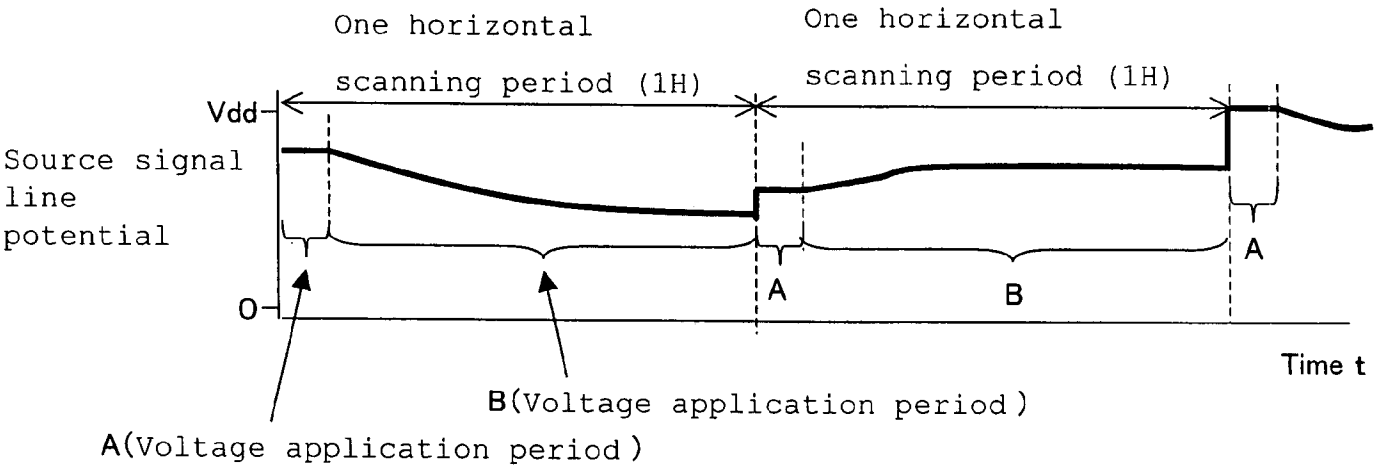
FIG. 25 is a schematic diagram of a driving method of an EL display panel according to the present invention.

The precharge voltage Vp outputted from the voltage tone circuit 231 is applied at the beginning of a horizontal scanning period (1H) (indicated by symbol A) as illustrated in FIG. 25. Subsequently, a program current is supplied from the current tone circuit 154 to the source signal line (indicated by symbol B). That is, the voltage is set approximately to the source signal line potential by the precharge voltage. Thus, the driving transistor 11*a* is brought close to a target current quickly. Then, it is set to the target current (=program current) for use to compensate for variations in the characteristics of the driving transistor 11*a*, by the program current outputted from the current tone circuit 154.

Preferably, period A during which a precharge voltage signal is applied is between 1/100 and 1/2 (both inclusive) of one horizontal scanning period (1H) or between 0.2 μsec and 40 μsec (both inclusive). More preferably, it is between 1/100 and 1/5 (both inclusive) of one horizontal scanning period (1H) or between 0.2 μsec and 10 μsec (both inclusive). The remaining part of the horizontal scanning period (1H) is period B which is an application period of the program current. If period A is too short, the source signal line 18 is not charged and discharged sufficiently, resulting in insufficient writing. On the other hand, if period A is too long, the current application period (B) becomes too short to apply the program current sufficiently. Consequently, the current in the driving transistor 11*a* cannot be corrected sufficiently.

It is preferable that the voltage application period (period A) is started from the beginning of 1H, but this is not restrictive. For example, it may be started from the blanking period at the end of 1H. Also, period A may be provided in the middle of 1H (horizontal scanning period). That is, the voltage application period may be provided in any part of 1H. Preferably, however, the voltage application period is provided within 1/(4H) (=0.25H) from the beginning of 1H.

Although in the example in FIG. 25, the current is applied (period B) after the voltage precharging period (A), this is not restrictive. For example, as illustrated in FIG. 26(A), the entire 1H period (or most of, or more than half of 1H) may be used as a voltage precharging period (indicated by *A) during which the precharge voltage Vp is applied.

Figure 26A:
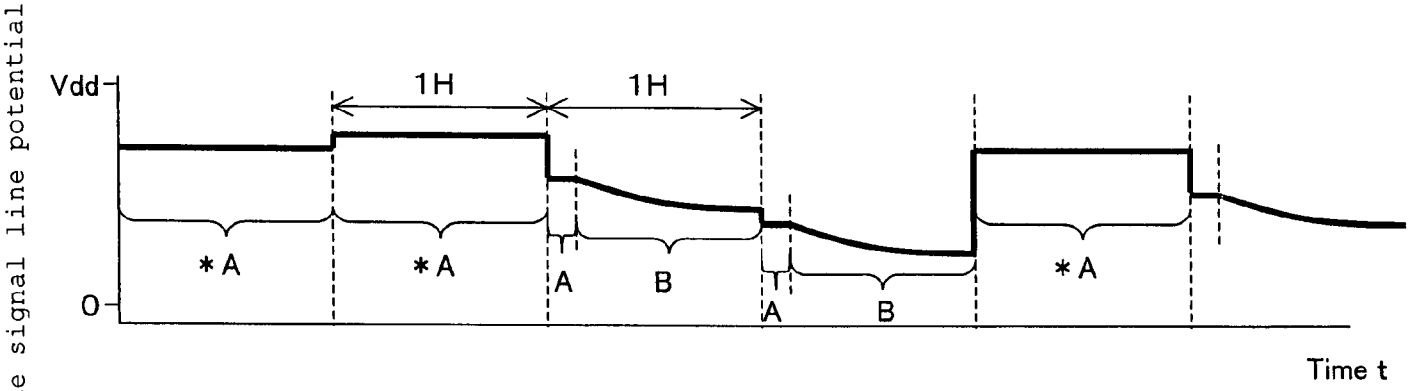
FIG. 26 is a schematic diagram of a driving method of an EL display panel according to the present invention.

As can be seen from FIG. 26(A), when the potential of the source signal line 18 is close to the anode potential (Vdd), voltage is applied for all of (most of) 1H. When the potential of the source signal line 18 approaches 0 V, voltage programming (period A) and current programming (B) are performed within the period of 1H. Incidentally, when the potential of the source signal line 18 is close to 0 V, current programming may be performed (in high tone regions) for the entire period of 1H.

Referring to FIG. 26(A), except for the periods indicated by *A, a voltage is applied to the source signal line 18 by voltage programming for a certain part of a 1H period (indicated by A), and then a current is applied by current programming for a period of B. Thus, through the voltage application in period A, a predetermined voltage is applied to the gate terminal of the driving transistor 11*a* of the pixel 16 so that a current of an almost desired value will flow through the EL element 15. Then, the program current in period B causes the current flowing through the EL element 15 to reach a predetermined value. During period *A, voltage programming is performed (voltage is applied) over the entire period of 1H.

FIG. 26(A) shows a signal waveform applied to the source signal line 18 when the transistor 11*a* (driving transistor) of the pixel 16 is a P-channel transistor. However, the present invention is not limited to this. The transistor 11*a* of the pixel 16 may be an N-channel transistor. In that case, as illustrated in FIG. 26(A), a voltage is applied for all of (most of) 1H when the potential of the source signal line 18 is close to 0 V. When the potential of the source signal line 18 approaches the anode voltage (Vdd), voltage programming (period A) and current programming (B) are performed within the period of 1H.

When the potential of the source signal line 18 is close to Vdd (in high tone regions), current programming may be performed for the entire period of 1H.

According to the present invention, the driving transistor 11*a* is described as being a P-channel transistor, but this is not restrictive and it goes without saying that the driving transistor 11*a* may be an N-channel transistor. The driving transistor 11*a* is assumed to be a P-channel transistor only for ease of explanation.

In the example of the present invention, voltage programming is mainly used for writing of pixels in low tone regions and current programming is mainly used for writing in high and halftone regions. That is, this example has the best of current driving and voltage driving. Voltage is used for display in a predetermined tone in low tone regions because in current driving, the voltage applied (by voltage driving or precharge driving) at the beginning of 1H becomes predominant due to weakness of write current (the precharge driving and voltage driving are conceptually identical, but if they have to be distinguished, it can be said that relatively few types of voltage are applied in precharge driving while many types of voltage are applied in voltage driving).

In halftone regions, after a voltage is written, deviations in the voltage are compensated for by program current. That is, the program current becomes predominant (current driving is predominant). In high tone regions, a program current is written. There is no need to apply a program voltage. Any applied voltage would be rewritten by a program current anyway. That is, the current driving is overwhelmingly predominant. Needless to say, a voltage may be applied, of course.

The output from the voltage tone circuit and output from the current tone circuit (including the precharge circuit) can be short-circuited at the output terminal 83 because the current tone circuit has a high impedance. That is, since the current tone circuit has a high impedance, even if a voltage is applied to the current tone circuit from the voltage tone circuit, there will be no circuit problem (such as a short circuit resulting in an overcurrent).

Although it has been stated that the present invention switches between voltage output and current output modes, this is not restrictive. Needless to say, a voltage may be applied to the output terminal 83 from the voltage tone circuit 231 by turning on the switch 161 (see FIG. 23) with a program current being outputted from the current tone circuit 154.

A program current may be outputted from the current tone circuit 154 by closing the switch 161 with a voltage applied to the output terminal 83. There will be no circuit problem because the current tone circuit 154 has a high impedance. This is also included in the act of switching between voltage driving mode and current driving mode according to the present invention. The present invention takes advantage of properties of current circuits and voltage circuits. This is a unique feature not encountered in other driver circuits.

Figure 27:
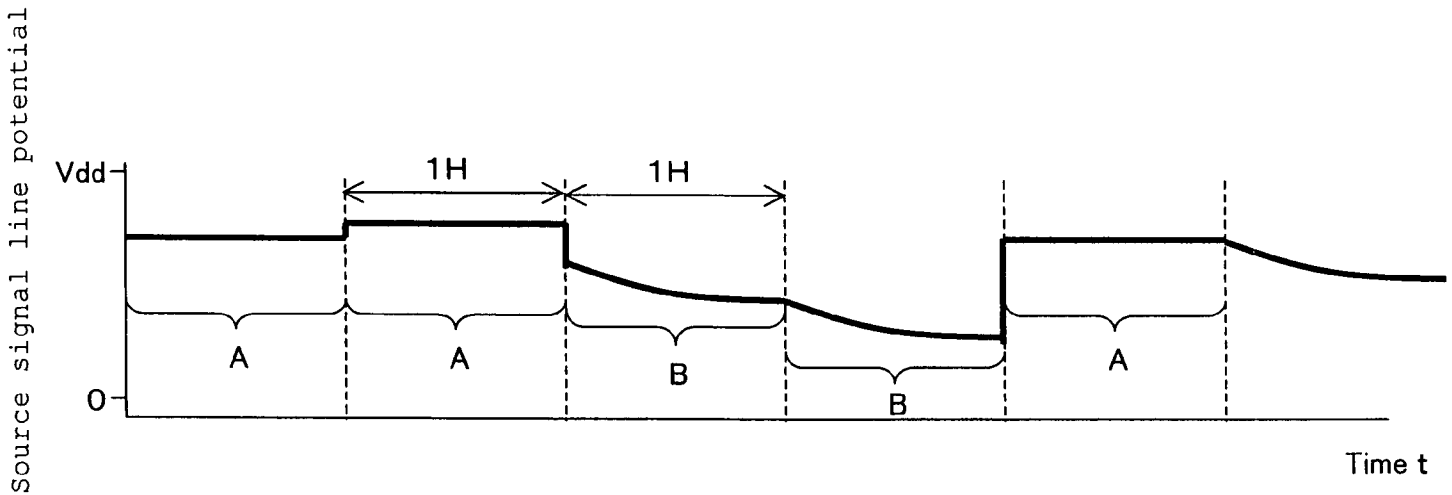
FIG. 27 is a schematic diagram of a driving method of an EL display panel according to the present invention.

As illustrated in FIG. 27, only one of the voltage and program currents may be applied in each 1H period. In FIG. 27, period A is a 1H period during which voltage programming is performed and period B is a 1H period during which current programming is performed. Mainly, voltage programming is performed in low tone regions (indicated by A) and current programming is performed in middle and higher tone regions (indicated by B). In this way, either voltage driving or current driving may be used selectively depending on the tone or the magnitude of the program current.

In the example of the present invention in FIG. 23, the same video signal DATA is inputted in the voltage tone circuit 231 and current tone circuit 154. Thus, a latch circuit of the video signal DATA may be shared by the voltage tone circuit 231 and current tone circuit 154. That is, there is no need to provide separate video signal (DATA) latch circuits for the voltage tone circuit 231 and current tone circuit 154. Based on data from the common video signal (DATA) latch circuit, current tone circuit 154 and/or voltage tone circuit 231 output data to the output terminal 83.

Figure 28:
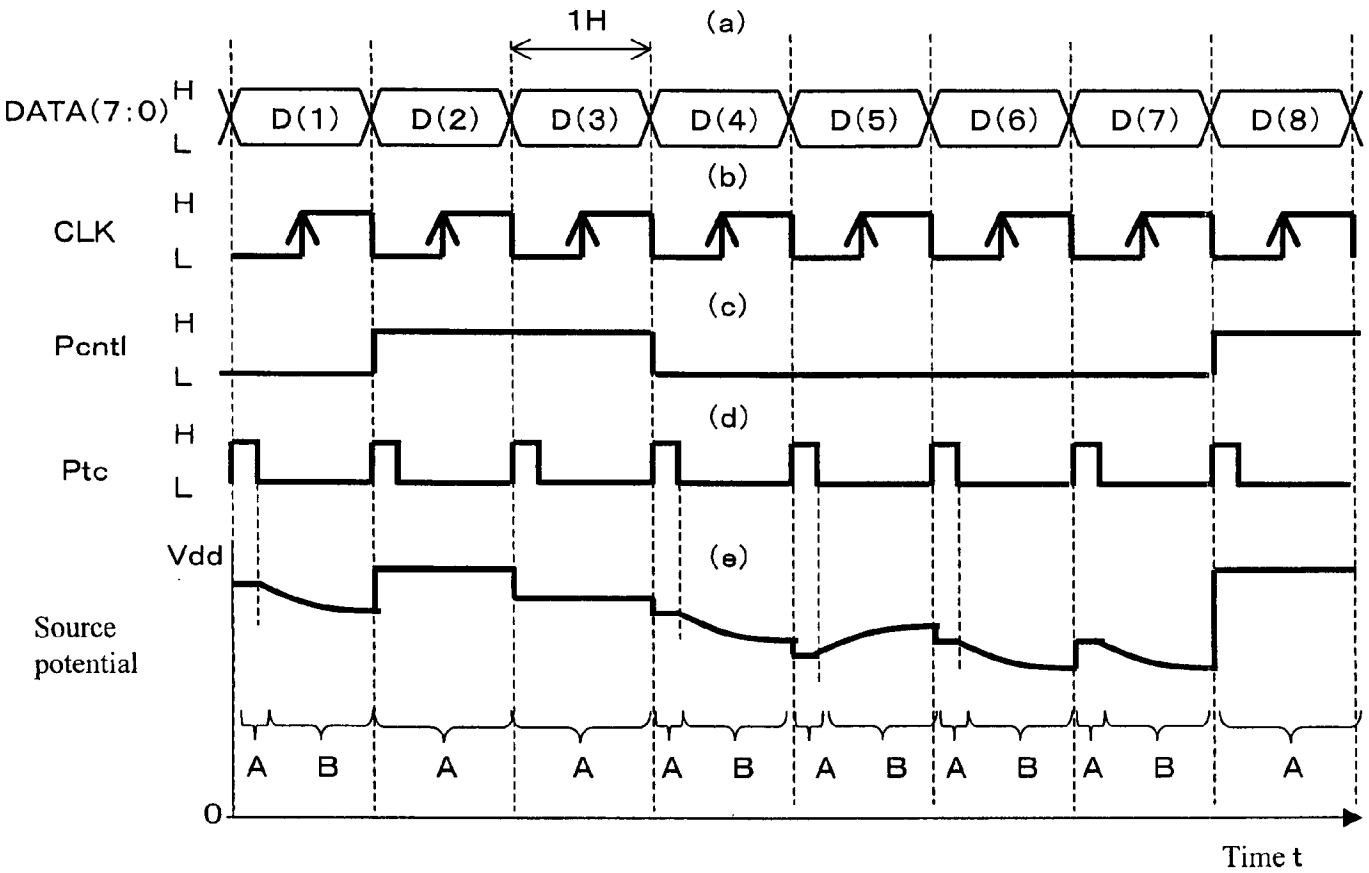
FIG. 28 is a schematic diagram of a driving method of an EL display panel according to the present invention.

FIG. 28 is a timing chart of the drive method according to the present invention. In FIG. 28, reference character DATA in (A) denotes image data, CLK in (B) denotes a circuit clock, and Pcntl in (C) denotes a precharge control signal. When the Pcntl signal is High, only voltage driving mode is used. When the Pcntl signal is Low, both voltage driving and current driving modes are used. Reference character Ptc in (D) denotes a precharge voltage or an output switching signal from the voltage tone circuit 231. When the Ptc signal is High, a precharge voltage or other voltage output is applied to the source signal line 18. When the Ptc signal is Low, the program current from the current tone circuit 154 is outputted to the source signal line.

For example, if video signal data consist of D(2), D(3), and D(8), since the Pcntl signal is High, a voltage is outputted to the source signal line 18 from the voltage tone circuit 231 (period A). When Pcntl is Low, first a voltage and then a program current are outputted to the source signal line 18. The period during which a voltage is outputted is indicated by A and the period during which a current is outputted is indicated by B. The period A during which a voltage is outputted is controlled by the Ptc signal. The Ptc signal controls on/off operation of the switch 161 in FIG. 23.

It has been stated that only voltage driving mode is used when the Pcntl signal is High and that both voltage driving and current driving modes are used when the Pcntl signal is Low. Preferably, the period during which a voltage is applied is varied with the lighting ratio or tone. In the case of low tones, it is not possible to write program current into pixels completely by current driving alone. Thus, it is preferable to use voltage driving. If the period during which a voltage is applied is extended, the voltage driving mode becomes predominant even in a combined voltage/current driving mode, making it possible to write a low tone into pixels properly. At a low lighting ratio, many pixels are in low-tone mode. Thus, even in a low-tone mode (at a low lighting ratio), if the period during which a voltage is applied is extended, the voltage driving mode becomes predominant even in a combined voltage/current driving mode, making it possible to write a low tone into pixels properly.

In this way, even in a combined voltage/current driving mode, it is preferable to vary the period of voltage driving according to the lighting ratio or the tone data (video data) written into the pixels. That is, it is preferable to ensure, through control, adjustment, or equipment configuration, that the period of voltage driving mode will be increased when the current passed through the EL element 15 is decreased (in a low lighting ratio range, according to the present invention) and that the period of voltage driving mode will be decreased or reduced to zero when the current passed through the EL element 15 is increased (in a high lighting ratio range, according to the present invention).

Although it has been stated with reference to FIG. 28 that voltage output period A and current output period B are switched, this is not restrictive. Needless to say, a voltage may be applied to the output terminal 83 from the voltage tone circuit 231 by turning on the switch 161 (see FIG. 23) with the state in which programming current is being outputted. Also, a program current may be outputted from the current tone circuit 154 by closing the switch 161 with a voltage applied to the output terminal 83. The switch 161 should be opened after period A. There will be no circuit problem because the current tone circuit 154 has a high impedance as described above.

Figure 29:
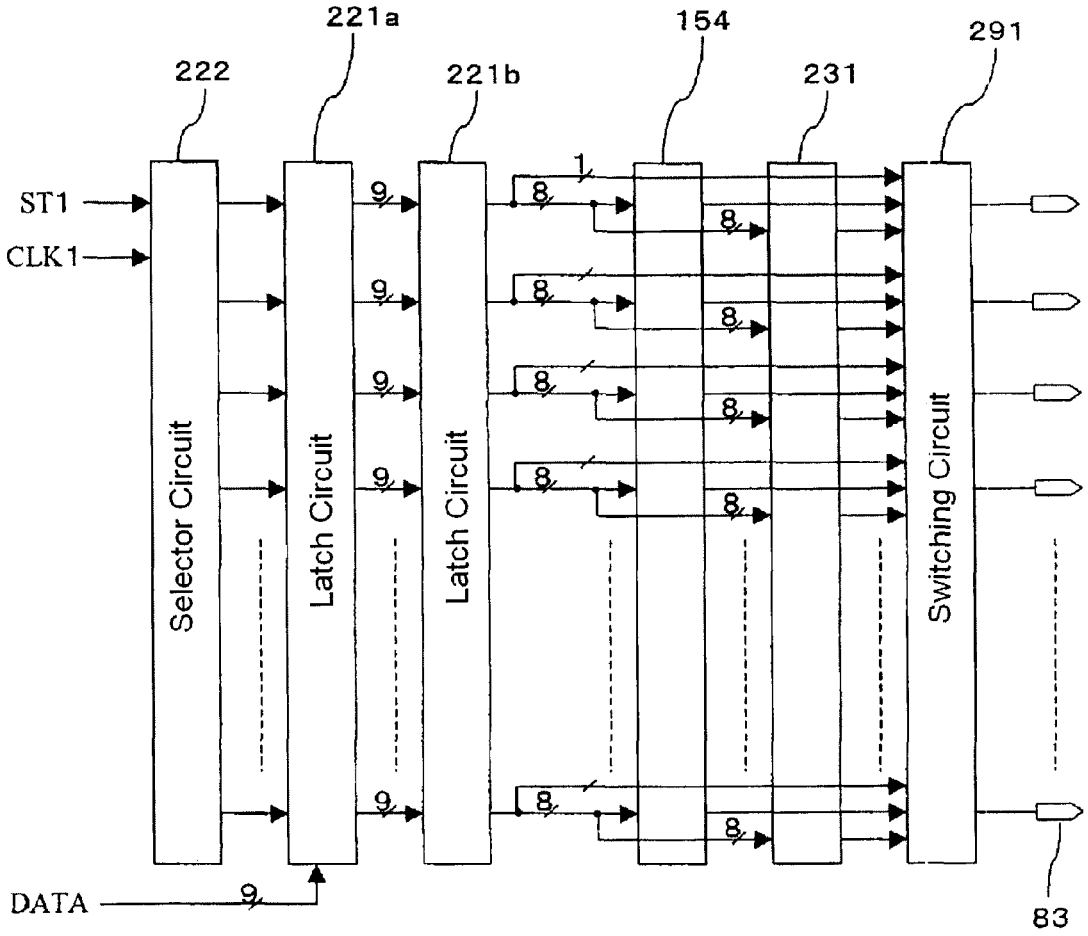
FIG. 29 is a block diagram of a driver circuit of an EL display panel according to the present invention.

FIG. 29 is a block diagram showing a more detailed view of components of the current tone circuit 154 and voltage tone circuit 231 shown in FIG. 23 and the like. A shift register circuit (selector circuit) 222 shifts in sequence in response to a start signal (ST1) and a clock (CLK1). The shift operation specifies holding position of 9-bit DATA to a first latch circuit (holding circuit) 221*a*. The nine bits of DATA consist of an 8-bit video signal and 1-bit precharge signal. The latch circuit 221*a* holds DATA in sequence during one horizontal scanning period.

DATA held by the first latch circuit is loaded onto a second latch circuit 221*b* at a second stage in response to a load signal (LD). DATA held by the latch circuit 221*b* becomes input for the voltage tone circuit 231 and current tone circuit 154. One bit in the precharge signal is a signal for switching between the program voltage from the voltage tone circuit 231 and program current from the current tone circuit 154. The precharge signal controls a switching circuit (such as the switch 161 in FIG. 23) 291 temporally. When the precharge signal is on, it outputs a precharge voltage first and then a program current from the output terminal 83.

Incidentally, since the sample-and-hold circuit in the voltage tone circuit operates relatively slowly, needless to say, the voltage tone circuit may be composed of three stages of latch circuits by adding one stage of latch circuits for sampling-and-holding. Also, the switching circuit 291 may be formed on the array board 30 by polysilicon technology.

Figure 30:
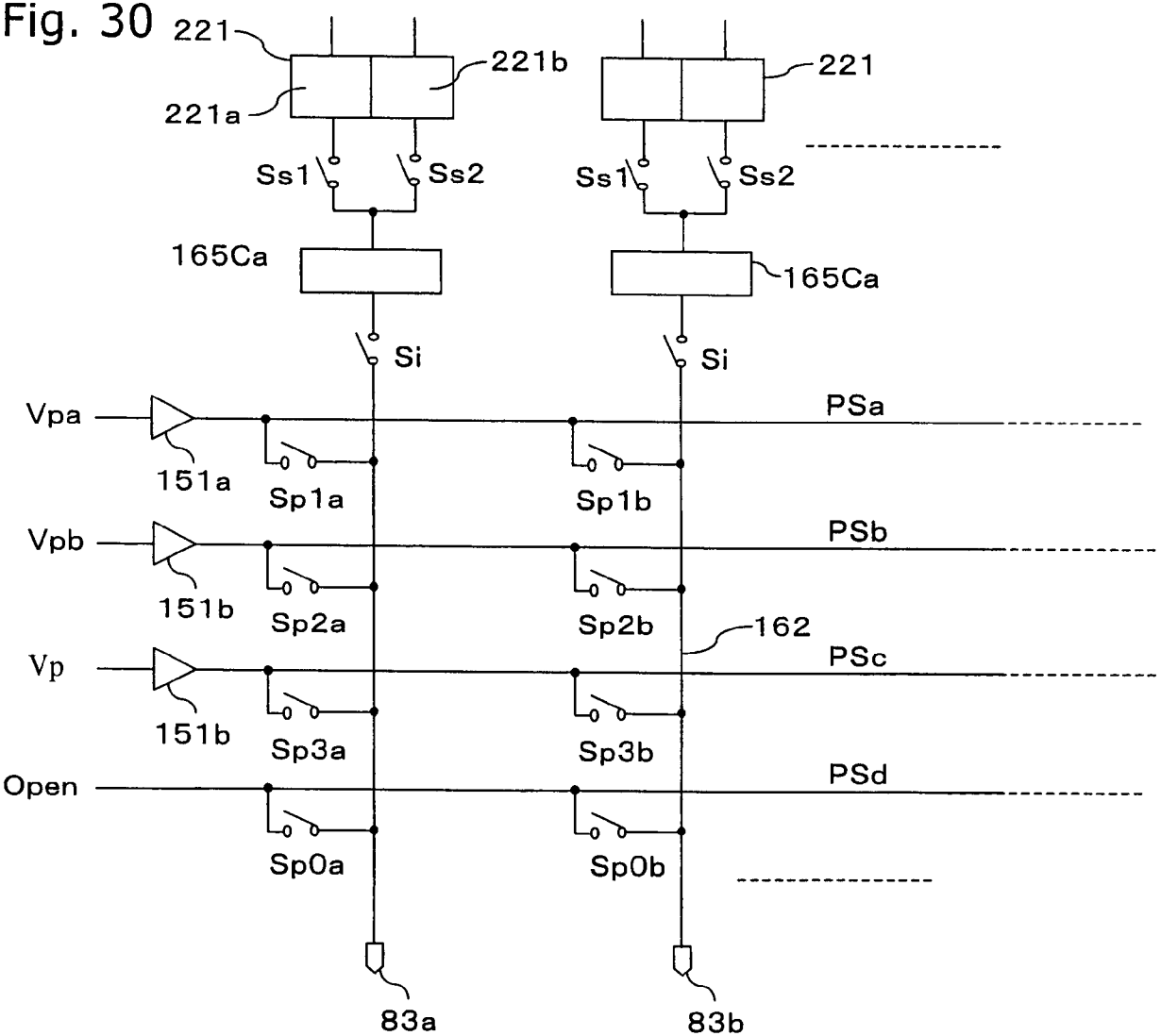
FIG. 30 is a block diagram of a driver circuit of an EL display panel according to the present invention.

FIG. 30 shows a configuration in which outputs (e.g., Vpa, Vpb, and Vp) from a precharge voltage generating circuit are transmitted via the internal wiring of the source driver IC (circuit) 14. The wiring is formed along the length of the IC chip (i.e., in a direction perpendicular to the transistor groups 165). Precharge voltage wirings PS (PSa, PSb, PSc, PSd) which transmit the precharge voltages Vp (Vpa, Vpb, Vp, and Open) are laid orthogonal to the source signal line 18. The precharge voltage wirings PS are orthogonal to the internal wirings 162 and a switch Sp is placed at each intersection. The switches Sp operate in response to SEL signals (including a precharge voltage selection signal Open). When Open is selected by a switch Sp0*a*, no precharge voltage is outputted. The switches Sp can be set freely for each output terminal 83. Appropriate switches Sp are selected according to the magnitude and changes of the video signal.

FIG. 29 differs from FIG. 30 in that a precharge voltage is generated through sampling and holding for each video signal. The sampled and held precharge voltage is applied according to a decision made for each output terminal based on a precharge bit (decision bit which specifies whether to apply the precharge voltage). FIG. 30 shows a configuration in which multiple precharge voltages are generated and one of them is selected. A precharge voltage is selected based on a precharge bit and applied to the source signal line 18 (where the precharge bit is a SEL signal—a bit that specifies which precharge voltage to apply, including Open which means no precharge voltage).

In the above example, the precharge voltages Vp (Va and V0) are generated in the source driver IC (circuit) 14 and applied therefrom to the source signal line 18, but the present invention is not limited to this. For example, needless to say, transistor elements for precharge voltages may be formed on the array board 30 and the precharge voltages Vp applied to the precharge voltage lines may be applied to the source signal lines 18 through on/off control of the transistor elements.

In FIG. 30 and the like, an Open function (selection of Open, i.e., no precharging) is provided. However, it is not necessarily restrictive to configure or form this function within the source driver IC (circuit) 14.

In the above example, the precharge voltages Vp (Va and V0) have been described as being close to the anode voltage Vdd (from Vdd to Vdd−3 V), but the precharge voltages Vp may be close to the cathode voltage (from Vss to Vss+3 V) depending on the pixel configuration. For example, in case that the driving transistor 11*a* is an N-channel transistor, the driving transistor 11*a* is a P-channel transistor and current programming is performed by a discharge current (or sink current in the case of the pixel configuration in FIG. 1). In that case, the precharge voltages Vp must be close to the cathode voltage.

Figure 31A:
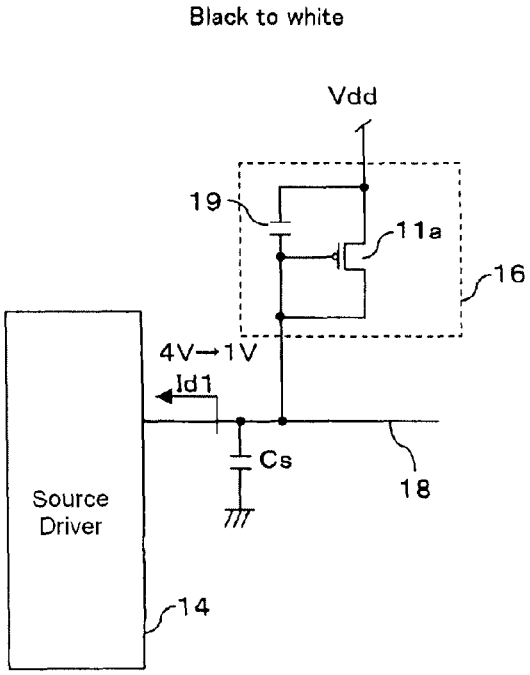
FIG. 31 is a block diagram of a driver circuit of an EL display panel according to the present invention.
Figure 31:
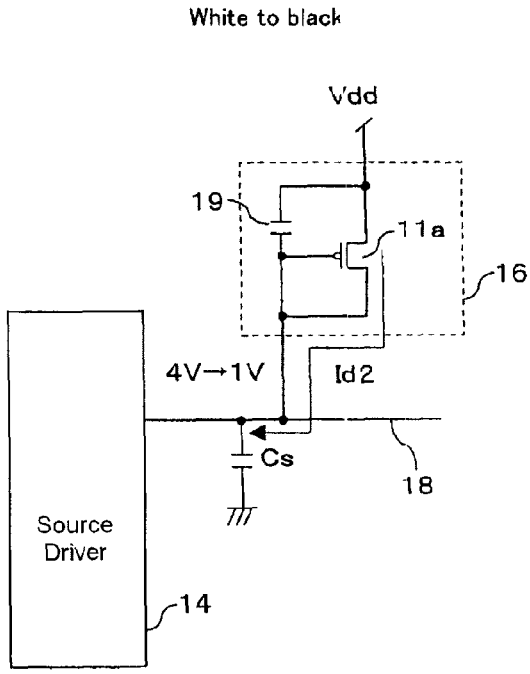

In current driving, insufficient writing is mainly caused by parasitic capacitance Cs of the source signal lines 18 as illustrated in FIG. 31. The parasitic capacitance Cs is generated at intersections between the gate signal lines 17 and source signal lines 18, etc.

For ease of explanation, it is assumed below that the driving transistor 11*a* of the pixel 16 is a P-channel transistor and that current programming is performed by a sink current (current absorbed into the source driver circuit (IC) 14).

Incidentally, the relationship is reversed when the driving transistor 11*a* is an N-channel transistor or the driving transistor 11*a* is current-programmed by a discharge (source) current (current discharged from the source driver IC (circuit) 14). In that case, the unit transistors 164 formed in the source driver IC (circuit) 14 are P-channel transistors. That is, although the use of sink current is cited herein, when using discharge (source) current, the pixel configuration or operation as well as the configuration or operation of the source driver IC (circuit) 14 are reversed. This will be readily understood by those skilled in the art, and thus description whereof will be omitted.

As illustrated in FIG. 31(A), a change from black display (low tone display) to white display (high tone display) mainly involves a sink current outputted from the source driver circuit (IC) 14. The source driver circuit (IC) 14 absorbs charges from the parasitic capacitance Cs by means of a program current Id1 (Iw). As the current is absorbed, the parasitic capacitance Cs is discharged, lowering the potential of the source signal line 18. Consequently, the gate terminal potential of the driving transistor 11*a* of the pixel 16 lowers, causing current programming to be performed in such a way as to pass the program current Iw.

A change from white display (high tone display) to black display (low tone display) mainly involves operation of the driving transistor 11*a* of the pixel 16. Although the source driver circuit (IC) 14 outputs a black display current, it is too weak to work effectively. The driving transistor 11*a* operates and charges the parasitic capacitance Cs, bringing it to the same potential as the program current Id2 (Iw). As the parasitic capacitance Cs is charged, the potential of the source signal line 18 rises. Consequently, the gate terminal potential of the driving transistor 11*a* of the pixel 16 rises, causing current programming to be performed in such a way as to pass the program current Iw.

However, with the driving in FIG. 31(A), it takes a very long time to discharge the parasitic capacitance Cs because the current Id1 is small in low tone regions and because of constant current operation. In particular, it takes a long time to reach white brightness, and thus brightness on an upper edge of white window display is lower than a predetermined level. This is because the potential of the source signal line 18 cannot change from black display potential (close to the anode voltage Vdd) to white display potential (e.g., anode voltage Vdd−3V) within one horizontal scanning period. Black display brightness of the next pixel row on a lower edge of white display tends to get relatively close to a target black display. Changes take place mainly in the driving transistor 11*a* as illustrated in FIG. 31(B). Also, in FIG. 31(B), the current Id2 is relatively large because the driving transistor 11*a* operates non-linearly. Consequently, charging time of Cs is relatively short. Thus, the brightness in the black display pixel row located next to the last white display pixel of the white window changes to, or to around, target brightness.

Precharge driving is used to correct insufficient writing of program current. However, with this method alone, it may be difficult to change from white display to black display in FIG. 31(B) in the case of a very large panel (assuming that the potential of the source signal line 18 is changed toward the anode Vdd using the precharge voltage Vp to achieve a black display).

To deal with this situation, the present invention increases the program current outputted from the source driver circuit (IC) 14 in the first half of 1H. In the second half, the regular program current Iw is outputted. However, the regular program current is increased N times in the case of FIGS. 6, 9, and the like. That is, under predetermined conditions, a current larger than the predetermined program current is passed through the source signal line 18 at the beginning of 1H and the regular program current is passed through the source signal line 18 in the second half. This example will be described below.

The drive method (driver or driving method) described below is referred to as overcurrent driving. Needless to say, the overcurrent driving may be combined with another driver or driving method according to the present invention. For example, it is conceivable to apply the precharge voltage Vp, perform overcurrent driving, and then apply a program current (program current driving). Alternatively, it is conceivable to perform overcurrent driving without applying the precharge voltage Vp and then perform program current driving.

Incidentally, the overcurrent driving is a method which involves charging and discharging the source signal line 18, and thus its technical idea is included in the concept of precharge voltage driving.

Incidentally, the overcurrent may be either a discharge current or sink current. The overcurrent driving is performed according to the polarity of the driving transistor 11*a* of the pixel 16. If the driving transistor 11*a* of the pixel 16 is a P-channel transistor, the overcurrent flows into the source driver IC (circuit) 14 (sink current) and if the driving transistor 11*a* of the pixel 16 is an N-channel transistor, the overcurrent is discharged from the source driver IC (circuit) 14 (source current). The overcurrent driving is not performed with respect to all the pixels 16, but performed depending on a tone value applied to the given pixel 16, the potential of the source signal line 18, or a change in potential expected to be caused by the tone applied next. Besides, the magnitude and application period of the overcurrent are varied.

Figure 32:
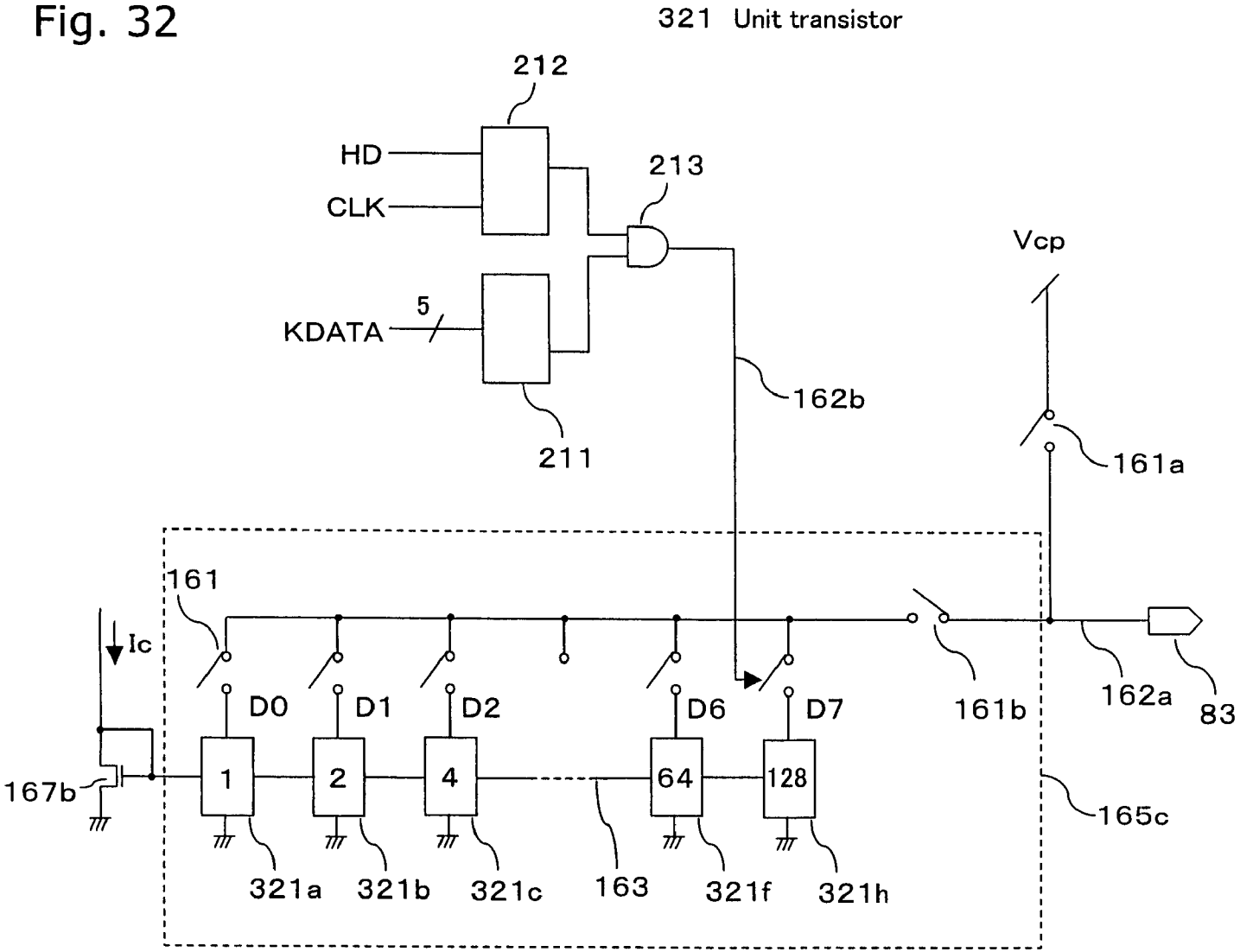
FIG. 32 is a block diagram of a driver circuit of an EL display panel according to the present invention.

FIG. 32 is an explanatory diagram illustrating a source driver circuit (IC) 14 which implements the overcurrent driving method according to the present invention. For ease of illustration, a current circuit consisting of one unit transistor 164 is designated as a unit transistor group 321*a* and indicated by '1.' Similarly, a current circuit (current mirror circuit) consisting of two unit transistors 164 is designated as a unit transistor group 321*b* and indicated by '2,' a current circuit consisting of four unit transistors 164 is designated as a unit transistor group 321*c* and indicated by '4,' and a current circuit consisting of eight unit transistors 164 is designated as a unit transistor group 321*d* and indicated by '8.'

Similarly, a current circuit consisting of 64 unit transistors 164 is designated as a unit transistor group 321*g* and indicated by '64' and a current circuit consisting of 128 unit transistors 164 is designated as a unit transistor group 321*h* and indicated by '128.' However, as described with reference to FIG. 18(B), it is not absolutely necessary to physically form required unit transistors 164 in each unit transistor group 321. Any configuration or method may be used as long as it outputs the unit current needed for each unit transistor group 321.

One set of the unit transistor group 321 (321*a* to 321*h*) is the transistor group 165*c*. For ease of drawing and explanation, it is assumed that each of the unit transistor groups 321 is 8-bit. Needless to say, the transistor groups 321 may be 6-bit or 10-bit.

The unit transistor groups 321 are formed separately for R, G, and B. The number of bits to be formed may be varied among R, G, and B. For example, a 6-bit configuration may be used for R and B while using an 8-bit configuration for G which needs a large number of tones. It is also preferable to vary the magnitude of overcurrent among R, G, and B. For example, there can be a configuration or method in which the magnitude of overcurrent is increased for R and B while decreasing the magnitude of overcurrent for G. The above items also apply to other examples of the present invention. They also apply to the transistor group 165*c* and transistor group 165*b*.

In the configuration in FIG. 32, the transistor group which passes an overcurrent as the program current is the unit transistor group 321*h*. That is, the unit transistor group 321*h* passes the overcurrent through the source signal line 18 by turning on and off the switch D7 for the most significant bit of tone data. The flow of the overcurrent allows the parasitic capacitance Cs to be discharged in a short time. For example, in the case of tone 5, for which five units of program current are passed by closing the switches D0 to D2, 128 units of current (overcurrent) are applied to the source signal line 18 before the application of the program current by turning on the switch D7. Also, before the application of the overcurrent, a precharge voltage Vp is applied to the source signal line 18 as required or essentially.

The most significant bit is used to control overcurrent (generate overcurrent) for the following reasons. First, for ease of explanation, it is assumed that a change from the 1st tone to the 4th tone is made. Also, it is assumed that the number of tones is 256 (8 bits each for R, G, and B).

Even when making a change from the 1st tone to a white tone, insufficient writing of program current does not occur if the change is from the first tone to a tone not lower than the middle tone (e.g., the 128th or higher tone). This is because the program current is relatively large and the parasitic capacitance Cs is charged and discharged relatively quickly.

However, when making a change from the 1st tone to a tone lower than the middle tone (e.g., the 127th or lower tone), the program current is too small to charge and discharge the parasitic capacitance Cs in a 1H period. Thus, it is necessary to improve the method for making a change from the 1st tone to a tone lower than the middle tone such as from the 1st tone to the 4th tone. The overcurrent driving according to the present invention is performed for that purpose.

Since the target tone is lower than the middle tone as described above, the most significant bit is not used to specify the program current. That is, when making a change from the 1st tone, the target tone is lower than '01111111' (The switch D7 for the most significant bit is always off). The present invention performs overcurrent driving by keeping the most significant bit off.

If the original tone (tone before the change) is tone 1, one unit transistor 164 operates and the switch D0 turns on. If the target tone is tone 4, the switch D2 operates, bringing four unit transistors 164 into operation. However, the four unit transistors 164 are not enough to discharge the parasitic capacitance Cs to a target level. Thus, the switch D7 is closed to bring the unit transistor group 321*h* into operation.

Incidentally, the D7 switch may be operated together with the D2 switch (i.e., the D7 and D2 switches may be turned on in the first half or at the beginning of 1H while turning on only the D2 switch in the second half) Alternatively, only the switch D7 may be turned on in the first half or at the beginning of 1H while turning on only the switch D2 in the second half.

When the D7 switch turns on, 128 unit transistors 164 operate (or unit currents corresponding to 128 unit transistors are outputted). Thus, the parasitic capacitance Cs is discharged 32 (=128/4) times faster than when only the D2 switch is used. This makes it possible to improve the writing of program current.

Determination as to whether to turn on the switch D7 is made separately for R, G, and B video data by a controller circuit (IC) (not shown). A decision bit KDATA is applied to the source driver circuit (IC) 14 by the controller circuit (IC). KDATA is, for example, 5-bit. KDATA consists of MSB (1 bit) and low-order 4 bits. When the MSB of KDATA is 0 (Low), overcurrent driving is not performed. When the MSB of KDATA is 1 (High), overcurrent driving is performed. That is, overcurrent driving is performed, and then a program current corresponding to the target tone is applied.

A precharge bit is used to specify whether to apply the precharge voltage Vp. When the precharge bit is 0 (Low), the precharge voltage Vp is not applied. When the precharge bit is 1 (High), the precharge voltage Vp is applied. Also, overcurrent driving is performed according to the setting of KDATA, and then a program current corresponding to the target tone is applied.

The low-order 4 bits of KDATA specifies the application duration of the overcurrent in 15 steps. Overcurrent driving using 16 durations is performed based on this value. Thus, the value of the low-order 4 bits of KDATA specifies the time period during which the D5 bit is turned on.

KDATA is held in the latch circuit 221 for a period of 1H. The counter circuit 212 is reset in response to HD (horizontal synchronization signal) and counts in sync with a clock CLK. Data are compared between the counter circuit 212 and latch circuit 221. When the count value of the counter circuit 212 is smaller than the data value (the low-order 4 bits of KDATA) of the latch circuit 221, the AND circuit 213 continues to output an on voltage to the internal wiring 162*b*, maintaining the on state of the switch D5. Thus, current flows from the unit transistors 164 in the unit transistor group 321*h* to the internal wiring 162*a* and source signal line 18. Incidentally, the switch 161*b* is closed during current programming while the switch 161*a* is closed and the switch 161*b* is open during precharge driving.

Figure 33:
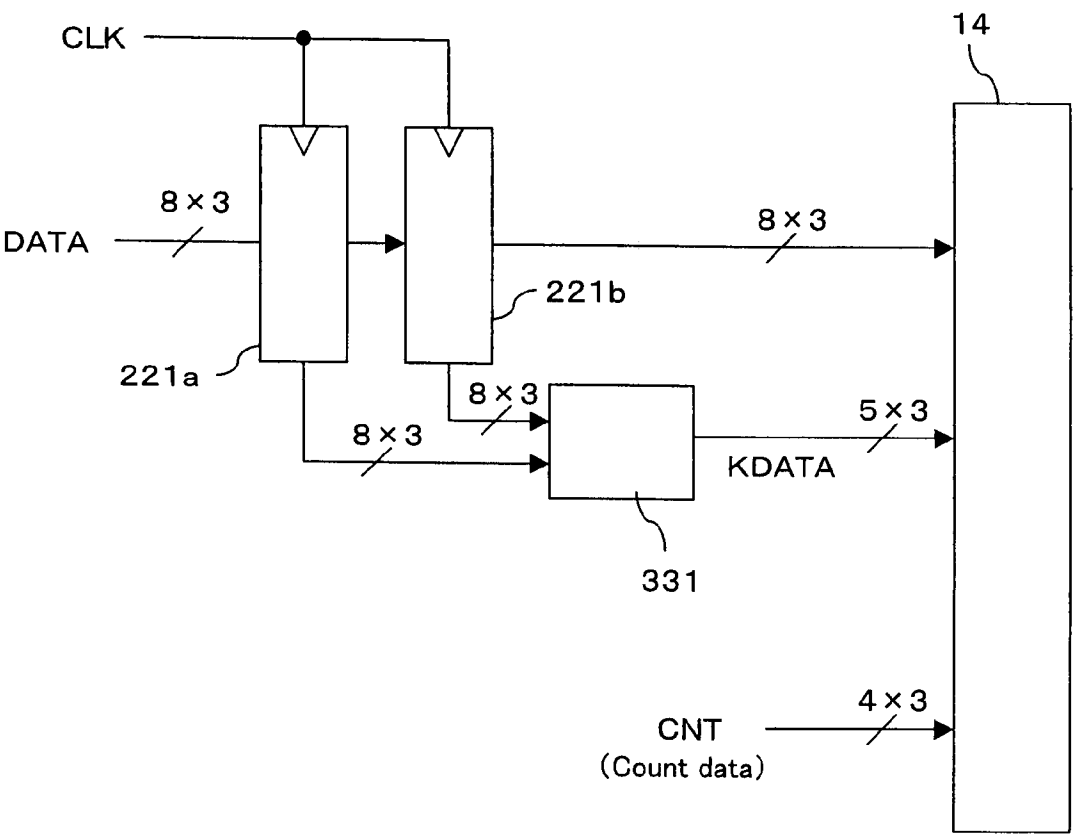
FIG. 33 is a block diagram of a driver circuit of an EL display panel according to the present invention.

FIG. 33 is an explanatory diagram illustrating operation of the controller IC (circuit), where processing of one pixel column (a set of R, G, and B) is illustrated. Video data DATA (8 bits each for R, G, and B) is latched in two stages by latch circuits 221*a* and 221*b* in sync with an internal clock. Specifically, the latch circuit 221*b* holds the video data 1H before and the latch circuit 221*a* holds the current video data.

A comparison circuit 331 compares the video data 1H before and the current video data, and thereby derives values of KDATA. The values derived are the value of the MSB (1 bit) which specifies whether to perform overcurrent driving and the value of the low-order 4 bits which specifies the application duration of the overcurrent. Also, the precharge bit is available to specify, as required, whether to apply the precharge voltage Vp. Besides, settings may be made, as required, to specify which of the switches D0 to D7 to turn on (to close) in overcurrent driving or to specify the magnitude of the precharge voltage Vp.

The video data DATA is transferred to the source driver circuit (IC) 14. The controller IC (circuit) transfers an upper count limit CNT of the counter circuit 212 to the source driver circuit (IC) 14.

KDATA is determined by the comparison circuit 331 based on the video data before the change (data 1H before) and video data after the change (current data). The data 1H before is the current potential of the source signal line 18. The current data is the target potential of the source signal line 18 to change to. Since the potential of the source signal line 18 corresponds to the tone of the video data, it may be determined based on the video data.

As illustrated in FIG. 31, it is important to take the potential of the source signal line 18 into consideration in writing a program current. A write time T can be expressed as T=ACV/I (where A is a proportionality constant, C is the parasitic capacitance, V is the potential difference, and I is the program current). Thus, the larger the potential difference V before and after the change, the longer the write time. On the other hand, the larger the program current I (=Iw), the shorter the write time.

According to the present invention, I is increased during overcurrent driving. In any case, however, increased I may cause the target potential of the source signal line 18 to be exceeded. Thus, when performing overcurrent driving, it is necessary to take the potential difference V into consideration. KDATA is determined based on the current potential of the source signal line 18 and the target potential of the source signal line 18 found from the next video data (current video data (video data to be applied next=(after the change vertical direction in FIG. 34))).

KDATA may specify the duration for which the D7 switch is kept on or the magnitude of the current used in overcurrent driving. Alternatively, it may specify a combination of the ON time of the D7 switch (the longer the ON time, the longer the duration of application of the overcurrent to the source signal line 18, increasing an effective value of the overcurrent) and the magnitude of the overcurrent (the larger the overcurrent, the larger the effective value of the overcurrent applied to the source signal line 18). For ease of explanation, it is assumed that KDATA specifies the ON time of the D7 switch first.

The comparison circuit 331 compares the video data 1H before and the video data after the change (see FIG. 34), and thereby determines the value of KDATA. If KDATA has a value other than 0, the following conditions are satisfied.

KDATA is specified when the video data 1H before is in a low tone region (preferably the region containing the lower ⅛ of all tones starting from the 0th tone—for example, if there are 256 tones, this is between the 0th tone and 32nd tone) and the video data after the change is not higher than the halftone region (preferably the region containing the lower ½ of all the tones starting from the 1st tone—for example, if there are 256 tones, this is between the 1st tone and 128th tone). The value to be specified is determined by taking in to consideration a VI characteristic curve of the driving transistor 11*a*. There is a large potential difference between the Vdd voltage of the source signal line 18 and V0 voltage for the 0th tone (complete black display). Also, there is a large potential difference between the V0 voltage and V1 voltage for the 1st tone. There is a considerably smaller potential difference between the V2 voltage for the 2nd tone and the V1 voltage than the potential difference between the V0 voltage and V1 voltage. In this way, the potential differences between V3 and V2, between V4 and V3, and so on decrease gradually with increases in tone due to nothing but the non-linear VI characteristics of the driving transistor 11*a*.

The potential difference between tones is proportional to the amount of discharge of the parasitic capacitance Cs. Thus, it changes with the application duration of the program current, i.e., the application duration and magnitude of the overcurrent Id in the case of overcurrent driving. For example, even though the tone difference between V0 (tone 0) 1H before and V1 (tone 1) after the change is small, the application duration of the overcurrent Id cannot be decreased because of the large potential difference.

Conversely, even if atone difference is large, there are cases in which it is not necessary to increase the overcurrent. For example, the potential difference between the potential V10 of tone 10 and potential V32 of tone 32 is small and the program current Iw of tone 32 is large, and thus the parasitic capacitance Cs can be charged and discharged in a short time.

In FIG. 34, the horizontal axis represents the tone number of image data 1H before (before the change, i.e., the current potential of the source signal line 18) while the vertical axis represents the tone number of current image data (after the change, i.e., the target potential of the source signal line 18 to change to).

When changing from the 0th tone (1H before) to the 0th tone (after the change), KDATA is 0 because there is no change in potential. When changing from the 0th tone (1H before) to the 1st tone (after the change), it is necessary to change from the V0 potential to the V1 potential. Since the V1 voltage minus V0 voltage is large, the MSB of KDATA is set to 1 and the low-order 4 bits are set to 15—the highest value (as an example). This is because the change in the potential of the source signal line 18 is large. A change from the 1st tone (1H before) to the 2nd tone (after the change) involves a change from the V1 potential to the V2 potential. Since the V2 voltage minus V1 voltage is relatively large, the low-order 4 bits of KDATA are set to 12—a value close to the highest value (as an example). This is because the change in the potential of the source signal line 18 is large. A change from the 3rd tone (1H before) to the 4th tone (after the change) involves a change from the V3 potential to the V4 potential. However, since the V4 voltage minus V3 voltage is relatively small, the low-order 4 bits of KDATA are set to a small value of 2. This is because the change in the potential of the source signal line 18 can be small and the parasitic capacitance Cs can be charged and discharged relatively quickly, making it possible to write the target program current into the pixel 16.

When changing from a low tone region to a region not lower than the halftone, both MSB and low-order 4 bits of KDATA can be set to 0. This is because the program current corresponding to the tone after the change is large and the potential of the source signal line 18 can be brought to or close to the target potential within a period of 1H. For example, when changing from the 2nd tone to the 38th tone, KDATA=0.

When changing to a lower tone, overcurrent driving is not performed. When changing from the 38th tone to the 2nd tone, the MSB of KDATA is set to 0 and the low-order 4 bits are set to 0. This is illustrated in FIG. 31(B), where the program current Id is supplied mainly from the driving transistor of the pixel 16 to the parasitic capacitance Cs. In FIG. 31(B), preferably either a combination of voltage driving method and current driving method or precharge voltage driving is performed instead of performing overcurrent driving.

It is useful to combine the overcurrent driving method according to the present invention with the N-fold driving method, duty ratio control driving method, or the like described with reference to FIGS. 6, 9, etc. It is also useful to increase the reference current when applying the overcurrent. The reference current is varied using the electronic regulator 152 or the like described with reference to FIG. 15 and the like. This is because the overcurrent can be increased by increasing the reference current in the configuration in FIG. 32 or the like. This reduces the charging and discharging time of the parasitic capacitance Cs. The capability to control the magnitude of overcurrent in the overcurrent driving method by controlling the magnitude of reference current and reference current ratio is also a unique feature of the present invention.

As described above, KDATA is determined by the control IC (circuit) and it is transmitted to the source driver circuit (IC) 14 in response to a differential signal. The transmitted KDATA is held in the latch circuit 221 shown in FIG. 32 to control the D7 switch. Incidentally, the switches D7 and D6 may be controlled simultaneously instead of controlling the switch D7 alone. Also, the switches may be controlled on a time-shared basis. That is, multiple switches may be controlled during the application of the overcurrent.

To determine the relationship in the table in FIG. 34, KDATA may be set using a matrix ROM table or a lookup table 931 or calculated (derived) using a multiplier of a microcomputer or controller IC (circuit) by programming a formula. Needless to say, this can be done not only on the controller IC (circuit), but also on a built-in control circuit or arithmetic circuit of the source driver circuit (IC) 14.

According to the present invention, the magnitude of the program current Iw varies in proportion to the magnitude of reference current. Thus, the magnitude of the overcurrent in overcurrent driving in FIG. 32 and the like varies in proportion to the magnitude of reference current as well. Needless to say, the magnitude of KDATA described with reference to FIG. 34 must be varied together with changes in the magnitude of the reference current. That is, it is preferable that the magnitude of KDATA is varied together with the magnitude of the reference current or set by taking the magnitude of the reference current into consideration. This is because the magnitude of the overcurrent increases and decreases in proportion to the magnitude of the reference current.

The technical idea of the overcurrent driving method according to the present invention consists in setting the magnitude of overcurrent, application duration (application period), and effective value of overcurrent according to the magnitude of program current, output current from the driving transistor 11*a*, etc. and combining overcurrent driving and precharge driving.

The comparison circuit 331 or comparison instrument makes comparisons separately for R, G, and B video data. Needless to say, however, KDATA may be calculated by determining the brightness (Y value) from RGB data. That is, instead of simply making comparisons for R, G, and B, KDATA may be calculated, determined, or computed by taking into consideration continuity, periodicity, and variation ratio of tone data as well as chromaticity changes and brightness changes. Also, it goes without saying that KDATA may be derived by taking video data or similar data of surrounding pixels into consideration rather than on a pixel-by-pixel basis. For example, possible methods include one that divides the display screen 34 into multiple blocks and determines KDATA by taking into consideration the video data or the like in each block.

In FIG. 32 and the like, preferably a closed period of the switch selected (e.g., the time during which the D7 switch remains selected) to pass the overcurrent during overcurrent driving is set to between ¾ and 1/32 (both inclusive) of 1H (one horizontal scanning period). More preferably, it is set to between ½ and 1/16 (both inclusive) of 1H (one horizontal scanning period). Along application period of overcurrent will reduce the application period of a regular program current, which may obstruct compensation by current. Also, temperature dependence of parasitic capacitance can cause excessive application of overcurrent. On the other hand, a short application period of overcurrent will prevent the change in the potential of the source signal line 18 from reaching its target value and thus cause a large deviation from the target value of the potential.

If the application of overcurrent is short, the target potential of the source signal line 18 cannot be reached. In overcurrent driving, needless to say, it is preferable that the target potential of the source signal line 18 be reached. However, it is not necessary to reach the target potential of the source signal line by overcurrent driving alone. Regular current driving may be used after performing overcurrent driving in the first half of 1H. Then, any error caused by the overcurrent driving can be corrected by the program current used in the regular current driving. Thus, it is preferable to set the target potential for overcurrent driving a little smaller than the target potential of the source signal line 18. It is a feature of the present invention that any deviation caused by overcurrent driving can be corrected by program current for the video signal.

Figure 35:
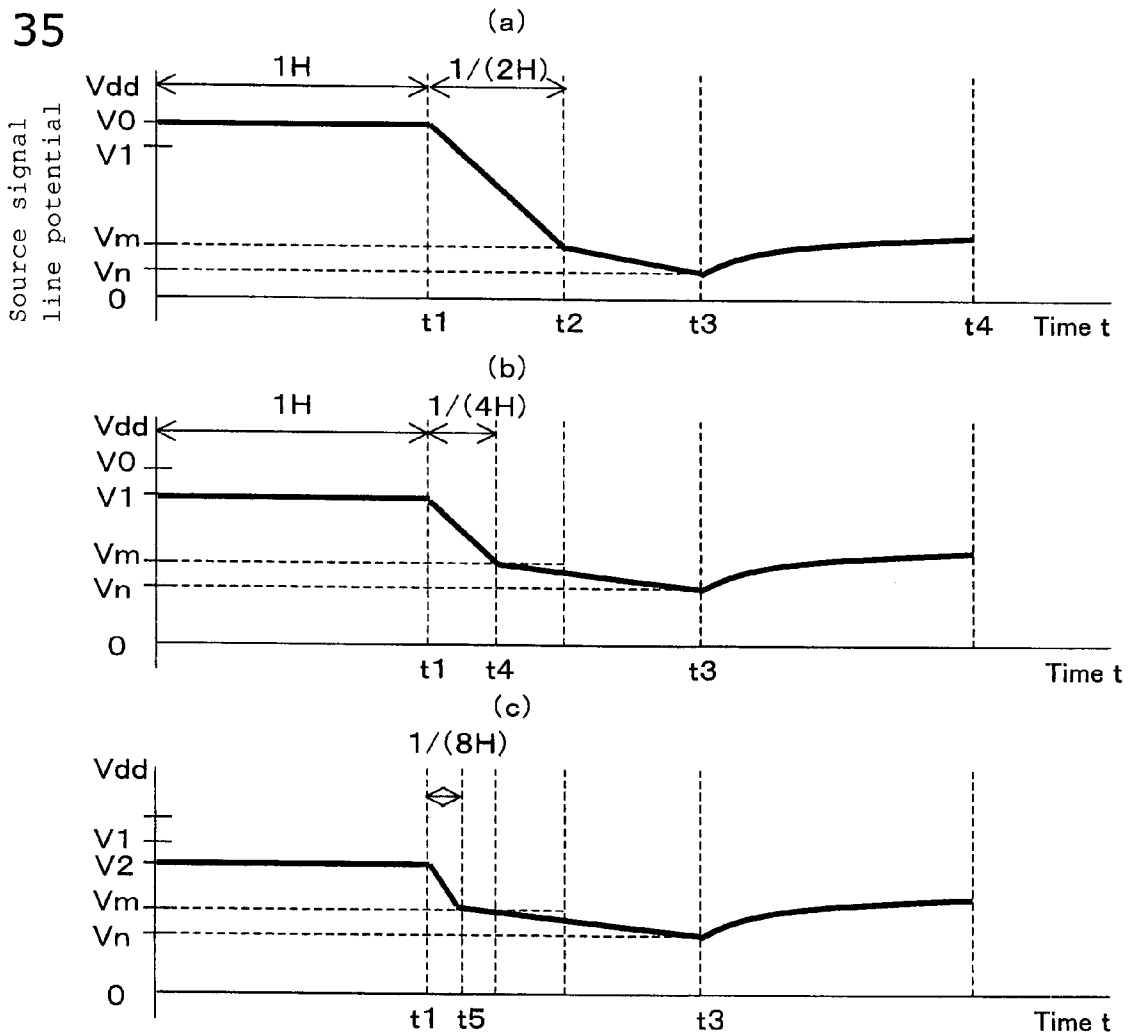
FIG. 35 is a schematic diagram of a driving method of an EL display panel according to the present invention.

FIG. 35 illustrates changes in the potential of the source signal line 18 when the overcurrent driving method is used. FIG. 35(A) shows a state which takes place when the D7 switch is kept on for a period of 1/(2H), as an example. At t1, i.e., at the beginning of a horizontal scanning period (1H), the D7 switch is turned on, and the unit currents of 128 unit transistors 164 are absorbed through the output terminal 83. The D7 switch remains on for a period of 1/(2H) until t2 with the overcurrent Id2 flowing through the source signal line 18. Consequently, the potential of the source signal line 18 lowers to a potential Vm close to the target potential Vn. Subsequently (after t2), the D5 switch is turned off, the regular program current Iw flows through the source signal line 18 until the end of 1H (until t3), and the potential of the source signal line 18 reaches the target potential Vn.

The source driver circuit (IC) 14 operates at a constant current. Thus, a constant program current Iw flows for the period from t2 to t3. As the parasitic capacitance Cs is charged and discharged by the program current Iw until the target potential is reached, a current I flows through the driving transistor 11*a* of the pixel 16, maintaining the potential of the source signal line 18 so that the target program current Iw will flow. Thus, the predetermined program current Iw is kept flowing through the driving transistor 11*a*. In this way, accuracy is not required of overcurrent in overcurrent driving. The lack of accuracy is compensated for by the driving transistor 11*a* of the pixel 16.

FIG. 35(B) shows a state which takes place when the D7 switch is kept on for a period of 1/(4H). At t1, i.e., at the beginning of a horizontal scanning period (1H), the D7 switch is turned on, and the unit currents of 32 unit transistors 164 are absorbed through the output terminal 83. The D7 switch remains on for a period of 1/(4H) until t4 with the overcurrent Id2 flowing through the source signal line 18. Consequently, the potential of the source signal line 18 lowers to a potential Vm close to the target potential Vn. Subsequently (after t4), the D7 switch is turned off, the regular program current Iw flows through the source signal line 18 until the end of 1H (until t3), and the potential of the source signal line 18 reaches the target potential Vn.

The source driver circuit (IC) 14 operates at a constant current. Thus, a constant program current Iw flows for the period from t4 to t3. As the parasitic capacitance Cs is charged and discharged by the program current Iw until the target potential is reached, a current I flows through the driving transistor 11*a* of the pixel 16, maintaining the potential of the source signal line 18 so that the target program current Iw will flow. Thus, the predetermined program current Iw is kept flowing through driving transistor 11*a*. In this way, accuracy is not required of overcurrent in overcurrent driving. The lack of accuracy is compensated for by the driving transistor 11*a* of the pixel 16.

FIG. 35(C) shows a state which takes place when the D7 switch is kept on for a period of 1/(8H). At t1, i.e., at the beginning of a horizontal scanning period (1H), the D7 switch is turned on, and the unit currents of 32 unit transistors 164 are absorbed through the output terminal 83. The D7 switch remains on for a period of 1/(8H) until t5 with the overcurrent Id2 flowing through the source signal line 18. Consequently, the potential of the source signal line 18 lowers to a potential Vm close to the target potential Vn. Subsequently (after t5), the D7 switch is turned off, the regular program current Iw flows through the source signal line 18 until the end of 1H (until t3), and the potential of the source signal line 18 reaches the target potential Vn.

In this way, the number of operating unit transistors 164 and the magnitude of unit current per unit transistor 164 are fixed. Thus, the charging and discharging time of the parasitic capacitance Cs and the potential of the source signal line 18 can be controlled in proportion to the ON period of the D7 switch. Incidentally, although it is assumed for ease of explanation that the parasitic capacitance Cs is charged and discharged by the overcurrent, this is not restrictive considering leakage of the switch transistor of the pixel 16.

Thus, it is a unique feature of the present invention that the magnitude of overcurrent can be known from the number of operating unit transistors 164. Since the write time t can be expressed as T=ACV/I (where A is a proportionality constant, C is the parasitic capacitance, V is the potential difference, and I is the program current), the value of KDATA can be determined logically from the parasitic capacitance (known at the time of array design), VI characteristics of the driving transistor 11*a* (known at the time of array design), and the like.

The example in FIG. 32 involves controlling the magnitude and application duration of overcurrent Id in overcurrent driving by operating the D7 switch for the most significant bit. However, the present invention is not limited to this. Needless to say, the switches for bits other than the most significant bit may be operated or controlled.

Figure 36:
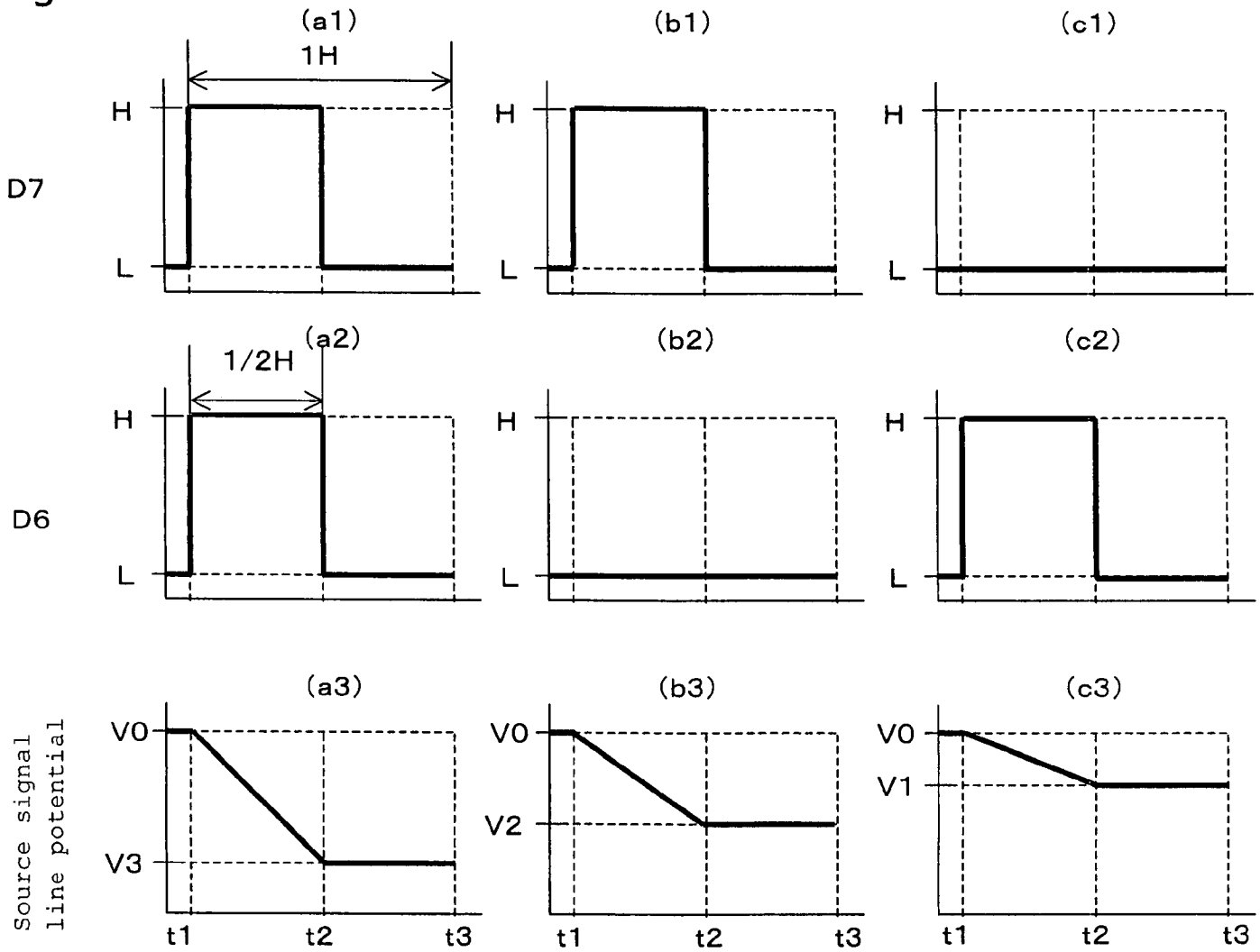
FIG. 36 is a schematic diagram of a driving method of an EL display panel according to the present invention.

FIG. 36 shows how the switch D7 for the most significant bit and switch D6 for the second most significant bit are controlled by KDATA in a configuration in which the source driver circuit (IC) is configured for 8 bits each of R, G, and B data. For ease of explanation, it is assumed that the D7 bit is provided by 128 unit transistors 164 and the D6 bit is provided by 64 unit transistors 164.

FIG. 36(A1) shows operation of the D7 switch. FIG. 36(A2) shows operation of the D6 switch. FIG. 36(A3) shows changes in the potential of the source signal line 18. In FIG. 36(A), the D7 and D6 switches operate simultaneously, and thus 128+64 unit transistors 164 operate simultaneously with currents flowing from the output terminal 83 into the source driver circuit (IC) 14. Consequently, the potential of the source signal line 18 can be changed from the V0 voltage for tone 0 to the V3 voltage for tone 3 quickly. After t2, the regular switch D is closed and the regular program current Iw is absorbed into the source driver circuit (IC) 14 from the output terminal 83.

Similarly, FIG. 36(B1) shows operation of the D7 switch, FIG. 36(B2) shows operation of the D6 switch, and FIG. 36(B3) shows changes in the potential of the source signal line 18. In FIG. 36(B), only the D7 switch operates, and thus 128 unit transistors 164 operate simultaneously with currents flowing from the output terminal 83 into the source driver circuit (IC) 14. Consequently, the potential of the source signal line 18 can be changed from the V0 voltage for tone 0 to the V2 voltage for tone 2. The change takes place more slowly than in FIG. 36(A), but this is appropriate because the potential changes only from V0 to V2. After t2, the regular switch D is closed and the regular program current Iw is absorbed into the source driver circuit (IC) 14 from the output terminal 83.

Incidentally, the above example concerns sink current. When the driving transistors 11*a* are N-channel transistors, P-channel transistors are used as the unit transistors 164 in the source driver IC (circuit) 14. Thus, output current (overcurrent) from the unit transistors 164 are discharged to the source signal line 18.

Although a case in which the source driver IC (circuit) 14 handles sink current has been cited in the above example, the present invention is not limited to this. The use of source current (discharge current), which is made possible by simple modification of the wording in the above description, is also included in the scope of the present invention.

Similarly, FIG. 36(C1) shows operation of the D7 switch, FIG. 36(C2) shows operation of the D6 switch, and FIG. 36(C3) shows changes in the potential of the source signal line 18. In FIG. 36(C), only the D6 switch operates, and thus 64 unit transistors 164 operate simultaneously with currents flowing from the output terminal 83 into the source driver circuit (IC) 14. Consequently, the potentials of the source signal line 18 can be changed from the V0 voltage for tone 0 to the V1 voltage for tone 1. The change takes place more slowly than in FIG. 36(B), but this is appropriate because the potential changes only from V0 to V1. After t2, the regular switch D is closed and the regular program current Iw is absorbed into the source driver circuit (IC) 14 from the output terminal 83.

Thus, by operating multiple switches including their ON periods based on KDATA, thereby changing or adjusting the number of operating unit transistors 164 or magnitudes of unit currents, it is possible to set or change the source signal line to an appropriate potential.

Although it has been stated with reference to FIG. 36 that switches D (D6 and D7) are operated simultaneously by overcurrent driving during the period from t1 to t2, this is not restrictive. Needless to say, the period may be varied or changed to t2, t3, t4, or the like according to the values of KDATA as illustrated or described in FIG. 28. Also, the magnitude of overcurrent may be adjusted during application of the overcurrent by controlling or changing the reference current or its magnitude. Even in that case, the reference current or its magnitude is set to a regular value during application of a regular program current.

The switches to be operated are not limited to D7 and D6. It goes without saying that other switches such as D7 may be selected simultaneously for operation or control. In the case of period a, the D7 switch is kept on for a period of 1/(2H) to apply the overcurrent composed of 128 unit currents to the source signal line 18 for overcurrent driving.

In the case of period b, the D7 and D6 switches are kept on for a period of 1/(2H) to apply the overcurrent composed of 128+64 unit currents to the source signal line 18 for overcurrent driving.

In the case of period c, the D7, D6, and D5 switches are kept on for a period of 1/(2H) to apply the overcurrent composed of 128+64+32 unit currents to the source signal line 18 for overcurrent driving.

In the case of period c, the D7, D6, and D5 switches and another video data switch (D2 switch in the case of 4th-tone video data) are kept on for a period of 1/(2H) to apply the overcurrent composed of 128+64+32+α unit currents to the source signal line 18 for overcurrent driving.

The above example is a method which involves generating overcurrents in predetermined periods by controlling the switch D7 and the like as described with reference to FIG. 32 and the like. Other available methods include, for example, one that varies the reference current Ic described with reference to FIG. 15. Specifically, the method increases the reference current Ic in a predetermined period by controlling the electronic regulator 152 and thereby increases the program current Iw outputted from the output terminal 83. The increased program current Iw can be regarded as an overcurrent such as described with reference to FIG. 32 and the like. Thus, the effect described with reference to FIG. 32 and the like can be achieved. Needless to say, the method which involves increasing the reference current in predetermined periods (described above) may be used in combination with the method which involves controlling the switches D in predetermined periods (described with reference to FIG. 32 and the like). Also, it goes without saying that the method described above may be used in combination with the lighting ratio control method described with reference to FIG. 147, duty ratio control, N fold driving method, precharge driving, or the like.

According to the present invention, the source driver circuit (IC) 14 incorporates the transistor group 165*c* which can output unit currents (program currents) corresponding to tones as the switches D are turned on and off. Thus, by outputting a program current corresponding to a predetermined tone from the transistor group 165*c* and thereby operating the driving transistor 11*a* of the pixel 16, it is possible to make settings or adjustments such that the driving transistor 11*a* of the pixel 16 can pass the program current.

During this operation, with the pixel configuration illustrated in FIG. 1, since the transistors 11*b* and 11*c* are closed, the source signal line 18 and the gate terminal of the driving transistor 11*a* of the pixel 16 have the same potential. Thus, the potential of the source signal line 18 when the driving transistor 11*a* of the pixel 16 is passing the program current Iw is equal to the potential (voltage) needed for the driving transistor 11*a* of the pixel 16 to pass the program current Iw. If this voltage is the precharge voltage Vp, the driving transistor 11*a* of the pixel 16 passes the program current Iw when the precharge voltage Vp is applied to the source signal line 18.

The precharge voltage Vp is applied to the source signal line 18 from the source driver IC (circuit) 14 and an appropriate pixel row is selected by applying an on voltage to the gate signal line 17*a* of the pixel row. The precharge voltage Vp is applied to the gate terminal of the driving transistor 11*a* of the pixel 16, thereby programming (setting) the driving transistor 11*a* to pass program current Iw. Thus, if the precharge voltage Vp is applied according to the characteristics of the driving transistor 11*a* of the pixel 16, the driving transistor 11*a* is programmed with the program current Iw accurately. Since the precharge voltage Vp is a voltage, even if the source signal line 18 has parasitic capacitance, the potential of the source signal line 18 can be charged and discharged in sequence. This makes it possible to take advantage of precharge driving.

According to the present invention, both the program current corresponding to a video tone signal and constant current are denoted by Iw. This is because the constant current Iw is generated by the source driver IC (circuit) 14 using an element of the same structure as the one used to generate the program current and the constant current is generated when the program current corresponding to a tone is set to a predetermined level.

As described above, the potential of the source signal line 18 measured by applying a constant current (predetermined current) Iw to the source signal line 18 has been referred to as a precharge voltage Vp. Also, the voltage applied in period A in FIG. 25 has been referred to as a precharge voltage Vp. The two differ more or less in meaning, but they are the same in their function to charge and discharge the source signal line 18 by being applied to the source signal line 18. Thus, both of them are referred to as a precharge voltage Vp.

Thus, if the potential at which the driving transistor 11*a* of each pixel 16 passes a program current Iw can be measured or determined and can be used as the precharge voltage Vp during programming (writing of a tone), it is possible to write the tone into the pixel 16 quickly without being affected by the parasitic capacitance of the source signal line 18. Of course, if a program current Iw is applied after the application of the precharge voltage Vp, the pixel can be programmed with high accuracy.

That is, according to the present invention, the constant current Iw (including Iw=0 A) is applied to the driving transistor 11*a*, and the gate terminal potential of the driving transistor 11*a* at that time is measured or acquired via the source signal line 18. The measured/acquired potential is applied as a precharge voltage Vp to the source signal line 18—either directly or after computation or other predetermined processing—to perform tone writing (voltage programming or current programming) by reflecting the characteristics of the driving transistor 11*a* of the pixel 16.

According to the present invention, a constant current Iw is applied to pixel transistors or outputted from the pixels driver transistor 11*a*, and the gate terminal voltage of the pixels driver transistor 11*a* is measured with the constant current Iw being applied or outputted. The gate terminal voltage of the pixels driver transistor 11*a* varies with the characteristics of the driver transistor 11*a*. Thus, measuring the gate terminal voltage of the driver transistor 11*a* with a constant current being applied to the driver transistor 11*a* is equivalent to measuring the characteristics of the driver transistor 11*a*.

The measured voltage is stored after A/D conversion in a memory placed or formed inside or outside the source driver IC (circuit) 14. When displaying an image on the EL display apparatus, the voltage data stored in the memory are converted into analog voltage through D/A conversion, and then either the analog voltage is applied directly as a precharge voltage Vp to the corresponding pixel or a target tone signal (precharge voltage Vp) obtained by adding or subtracting a tone voltage to/from the analog voltage (used as a base or origin) is applied to the corresponding pixel.

Thus, adding a video voltage corresponding to a tone or tone difference to the measured voltage used as a base and applying the resulting signal to the transistor 11*a* means applying a tone signal (voltage signal) acting as a video signal after compensating for the characteristics of the pixel driving transistor 11*a*.

The measured or acquired gate terminal voltage of the driving transistor 11*a* may be applied to the driving transistor of the pixel after the measurement either directly or after addition or subtraction of the video voltage in real time. The constant current Iw may be 0 A (meaning that no constant current flows). In that case, the appropriate pixel can be selected and the driving transistor 11*a* of the pixel can be shorted between gate and drain terminals.

The current programming mode has the disadvantage that it cannot compensate sufficiently for the characteristics of pixel transistors 11*a*. However, by using current programming mode in which a constant current is applied to pixel transistors 11*a* and measuring the gate terminal potential of the transistors, the present invention exercises its ability to compensate for transistor characteristics, which is an advantage of the current programming mode.

The use of a constant current Iw not lower than a predetermined level makes it possible to eliminate the problem of insufficient writing in low tone regions (low current regions), which is a weak point of the current programming mode. The video signal applied to the pixels during video display is a voltage signal, which makes it possible to avoid insufficient writing even in low tone regions. That is, by calculating or determining tone voltages through addition or subtraction of a voltage based on the measured voltages and applying the tone voltages to pixel transistors 11*a*, it is possible to demonstrate a feature of voltage driving, i.e., the advantage of avoiding insufficient writing in all tone regions.

Although it is stated herein that the gate terminal voltage of the transistor 11*a* is measured or held either directly or indirectly by applying a constant current to the transistor 11*a*, the present invention is not limited to this. Also, in addition to the magnitude of voltage, the amount of changes in the voltage before and after the application of the constant current, speed of voltage changes, and difference value of the voltage may also be measured and stored in memory. In short, any data may be used as long as the data are related to generation of the precharge voltage Vp.

The measurement of voltage also includes the act of holding the measured voltage inside or outside a driver circuit after analog-digital conversion (A/D conversion) and configuration therefor as well as the act of holding the voltage as digital data in memory. Also, it includes the act of not only measuring, but also temporarily holding, latching, or storing the voltage in a capacitor or other holding medium and configuration therefor. Incidentally, the constant current Iw includes 0 A.

The pixel 16 must be configured such that the output current of the driving transistor 11*a* can be inputted and outputted to/from the source signal line 18 as shown in FIG. 1 and allow the output current of the transistor 11*a* which forms a current mirror circuit with the driving transistor 11*b* can be inputted and outputted to/from the source signal line 18 as shown in FIG. 12. Alternatively, the pixel 16 must be configured such that the gate terminal potential of the driving transistor 11*a* can be measured or determined from the source signal line 18 as shown in FIG. 1 or that the gate terminal potentials of the transistors 11*a* and 11*b* which form a current mirror circuit with the driving transistor 11*b* can be measured or determined from the source signal line 18 as shown in FIG. 12. Such is a pixel configuration for current driving.

The above operation or configuration makes it possible to pass a program current corresponding to the precharge voltage Vp through the driving transistor 11*a* of the pixel 16. By measuring the potential of source signal line 18 at this time, it is possible to acquire the precharge voltage Vp corresponding to the predetermined tone.

Although the above example involves applying a constant current (including 0) to the driving transistor 11*a* of each pixel 16 and measuring the precharge voltage Vp at which the driving transistor 11*a* of the pixel 16 passes the constant current Iw, the presentinvention is not limited to this. Although the characteristics of the driving transistors 11*a* formed in a matrix on an array 30 vary from lot to lot, the characteristics do not vary much among arrays within each lot. The gate terminal potential Vp of a particular transistor in an array 30 may be measured by passing a constant current (including 0) through the transistor and then the Vp may be applied to the driving transistors 11*a* of the other pixels. Although the applied Vp deviates more or less from the voltage at which the driving transistor 11*a* of the pixel passes the constant current Iw, there will be no problem because a program current is applied subsequently.

According to the present invention, the gate terminal voltage of the driving transistor 11*a* is varied such that a program current (constant current) corresponding to the tone needed to set the precharge voltage Vp is outputted from the source driver circuit (IC) 14 and passed through the driving transistor 11*a*. Then, the gate terminal voltage of the driving transistor

11*a* is measured and fed back as a precharge voltage Vp. This operation or setup makes it possible to set an accurate precharge voltage Vp by feeding back the characteristics of the source driver circuit (IC) 14 and characteristics of the array.

A method for acquiring a precharge voltage Vp accurately will be described below with reference to drawings. Incidentally, it is assumed that the precharge voltage Vp is a program voltage and the gate terminal voltage of the driving transistor 11*a*. A target current is supplied to the EL element 15 by the application of the program voltage.

As an example of measuring or acquiring the precharge voltage Vp, a method for applying a constant current to measurement pixels 16*s* formed or placed on an array 30 will be described first. Measurement pixels 16*s* are formed on the periphery (an area which does not contribute to image display) of the display screen 34 and the like. Of course the pixels 16 used for image display may be used as the measurement pixels 16*s*.

Figure 37:
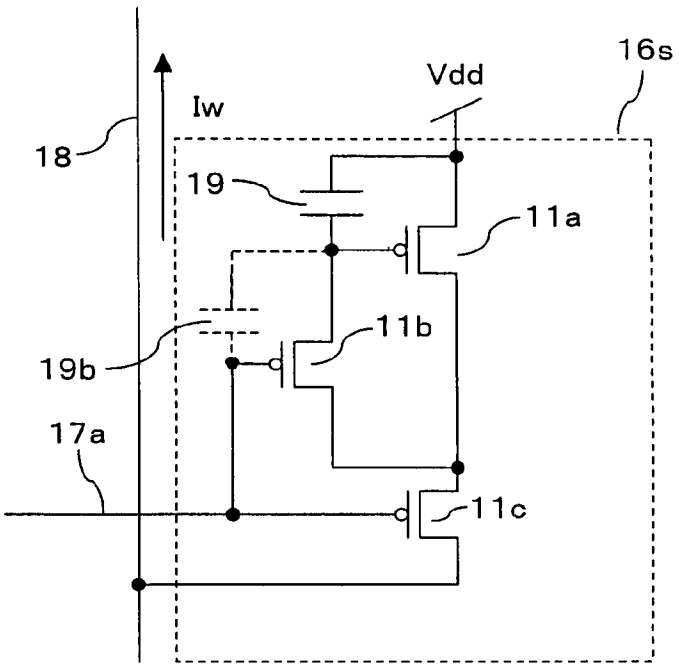
FIG. 37 is a block diagram of a driver circuit of an EL display panel according to the present invention.
Figure 37A:
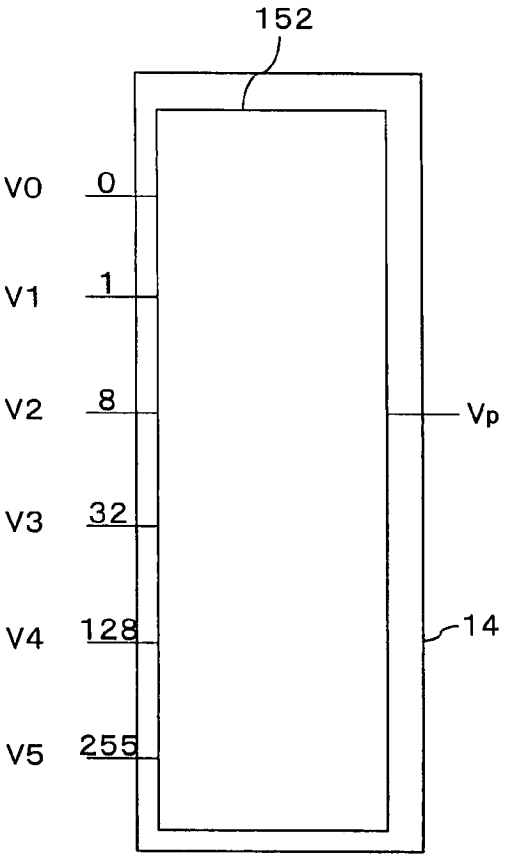

FIG. 37(A) shows relationship between tone and precharge voltage Vp for ease of explanation. As illustrated in FIG. 37(A), the precharge voltage Vp corresponding to tone 0 is denoted by V0 as an example. The precharge voltage Vp corresponding to tone 1 is denoted by V1, the precharge voltage Vp corresponding to tone 8 is denoted by V2, the precharge voltage Vp corresponding to tone 32 is denoted by V3, the precharge voltage Vp corresponding to tone 128 is denoted by V4, and the precharge voltage Vp corresponding to tone 255 is denoted by V5. Of course, the precharge voltages corresponding to other tones may be set to V0 to V5. Of course, available voltage settings are not limited to V0 to V5, and there may be more than six.

FIG. 37(B) shows a measurement pixel 16*s* which has a driving transistor 11*a* for use to generate precharge voltage Vp. Since the measurement pixel 16*s* generates program current, there is no need to form an EL element 15. Thus, the transistor 11*d* shown in FIG. 1 is unnecessary. The gate signal line 17*b* is not necessary either. Of course, an EL element 15 may be formed as in the case of the pixel 16 for image display. In that case, the measurement pixel 16*s* will have the same parasitic capacitance and the like as the pixel 16, making it possible to measure the precharge voltage Vp properly. Incidentally, the measurement pixel 16*s* is a pixel 16 used to measure the precharge voltage Vp.

In the measurement pixel 16*s*, when an on voltage is applied to the gate signal line 17*a* and a program current is applied to the source signal line 18, the driving transistor 11*a* comes into operation and its gate terminal voltage changes. At this time, the precharge voltage Vp can be acquired by reading the potential of the source signal line 18.

For example, to acquire the precharge voltage V1 for tone 1, the program current (normally, the output current from a single unit transistor) corresponding to tone 1 is applied to the source signal line 18, thereby bringing the driving transistor 11*a* of the measurement pixel 16*s* into operation. The precharge voltage V1 can be acquired by measuring the potential of the source signal line 18 at the completion of the operation.

Although it has been stated in the example of the present invention that the potential of the source signal line 18 is measured, the present invention is not limited to this. For example, measurements may be taken by pressing a probe stylus against the gate terminal of the driving transistor 11*a* of the pixel 16. Also, the gate terminal potentials of the driving transistors 11*a* of multiple pixels 16 may be measured/determined simultaneously or on average, for example, by selecting two or more pixel rows at a time rather than measuring the gate terminal potential of a single driving transistor 11*a*. The Vp voltage is measured by scanning the positions of the selected gate signal line 17*a* in sequence by controlling the gate driver circuit 12.

Although it has been stated in the example of the present invention that voltages are measured, the concept of measurement includes the acts of holding, obtaining, or determining voltages. That is, any configuration, form, or method may be used as long as it can use acquired potential of the source signal line 18 as the precharge voltage Vp. For example, possible configurations include one that uses the potential of the source signal line 18*s* by sampling and holding it, one that performs analog-digital conversion (A/D conversion) of the analog potential of the source signal line 18*s* and uses the resulting digital data directly as precharge voltage V0 to V5, one that uses results of analog conversion as V0 to V5, and one that uses the potential of source signal line 18*s* as V0 to V5 by feeding it back directly.

Needless to say, in the method according to the present invention, the acquired/measured potential, voltage, or potential change of the source signal line 18*s* may be padded, multiplied by a fixed ratio, weighted, or level-shifted, or may undergo predetermined processing or have another voltage value added or subtracted. Also, it goes without saying that a desired value may be obtained by averaging multiple measurements. Besides, a target voltage may be predicted or inferred from changes in the potential of the source signal line 18*s*. For ease of explanation, it is assumed herein that the concept of measurement includes the above-mentioned concepts, methods, or configurations.

The precharge voltage V0 to V5 can be used not only as the precharge voltage Vp, but also for voltage driving or gamma curve generation. Thus, the technical idea of the present invention is applicable not only to current programming mode (driving), but also to voltage programming mode (driving).

In FIG. 37(B), by adding the capacitor 19*b*, it is possible to level-shift the current flowing through the driving transistor 11*a*. Also, by varying the amplitude value of the potential of the gate signal line 17*a*, it is possible to level-shift the current flowing through the driving transistor 11*a*. By varying the size of the capacitor 19*b* from that of the pixel 16 for image display, it is possible to change (shift) the precharge voltage Vp to an appropriate value in an analog fashion.

Suppose, for example, when a pixel 16*s* is selected by the application of an on voltage (VGL) to the gate signal line 17*a* and a constant current Iw is passed through the driving transistor 11*a*, the gate terminal potential of the driving transistor 11*a* is 3.8 V. Next, an off voltage (VGH) is applied to the gate signal line 17*a* to complete selection of the pixel 16. Consequently, the potential of the gate signal line 17*a* changes from VGL to VGH. As a result, the gate terminal potential of the driving transistor 11*a* shifts toward the anode potential Vdd as the potential penetrates into the capacitors 19*a* and 19*b*. For example, if the change in the potential caused by the penetration is 0.5 V, the gate terminal potential of the driving transistor 11*a* becomes 4.3 V (=3.8V+0.5V), holding the driving transistor 11*a* in a state in which it passes a current smaller than Iw.

The above example means that the pixel 16 can be configured such that a current smaller than the constant current Iw will flow. Current driving is not good at writing a small program current into the pixel 16. However, the above configuration or operation allows programming with a small current. This is a big advantage.

Figure 38:
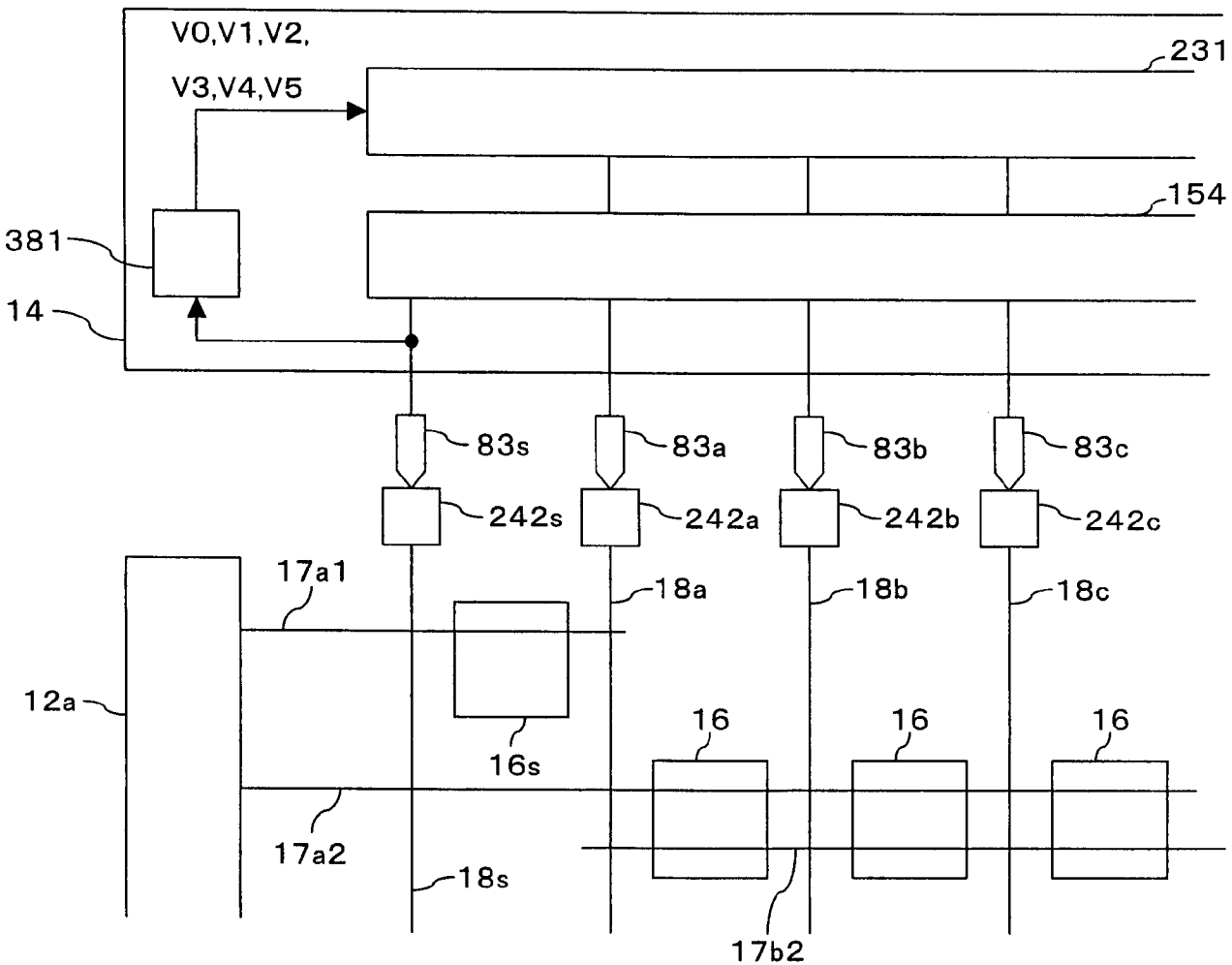
FIG. 38 is a block diagram of a driver circuit of an EL display panel according to the present invention.

FIG. 38 is an explanatory diagram illustrating a measuring circuit of the precharge voltage Vp according to the present invention. The voltage measuring circuit 381 of the precharge voltage Vp is formed or constructed in the source driver IC (circuit) 14. Needless to say, of course, it may be formed or constructed directly on the array board 30 by polysilicon technology.

By forming the voltage measuring circuit 381 in the source driver IC (circuit) 14, it is possible to acquire the precharge voltage Vp from an output terminal 83*s* connected to the source signal line 18*s*. Thus, it is not necessary to form a new output terminal 83 to measure the precharge voltage Vp. Also, if the source driver IC (circuit) 14 is formed or constructed from a semiconductor chip, a sample-and-hold circuit, operational amplifier, analog switch, and the like used to measure the precharge voltage Vp can be built, formed, or constructed accurately with a small area.

A program current generating circuit which outputs the precharge voltage Vp for measurement has a configuration similar to that of the current tone circuit 154 which outputs the program current. The current tone circuit has been described with reference to FIGS. 16, 17, 18, 23, etc., and thus description thereof will be omitted here.

The gate driver circuit 12*a* controls the gate signal line 17*a*1 which selects measurement pixels 16*s* and the gate signal line 17*a*2 (which corresponds to the gate signal line 17*a* in FIG. 1 and the like) which selects pixels 16 for image display in sequence. The gate signal line 17*a*1 is selected or deselected irrespective of image display. The gate signal line 17*a*1 is selected for measurement of the precharge voltage Vp. Otherwise, it is deselected. The source signal line 18*s* is a dedicated line formed to measure the precharge voltage Vp.

The current tone circuit 154 outputs a program current corresponding to tone 0. The program current Iw corresponding to tone 0 is 0. Thus, the switch 161*b* (see FIG. 21) is as well as open. That is, no program current is supplied to the source signal line 18*s* and the gate signal line 17*a*1 is selected. The driving transistor 11*a* of the measurement pixel 16*s* charges or discharges the source signal line 18*s* until no current flow through the source signal line 18*s* any more. When the potential of the source signal line 18*s* settles to a fixed value, the potential of the source signal line 18*s* is measured by operating the voltage measuring circuit 381. The potential here is the potential of the driving transistor 11*a* of the measurement pixel 16*s*. Of course, the potential of the source signal line 18*s* may be used as the precharge voltage Vp after it stabilizes by keeping the voltage measuring circuit 381 in operation.

The voltage measuring circuit 381 measures the voltage of the source signal line 18*s* and holds it in the voltage tone circuit 231. Alternatively, it stores the measured or acquired value in memory. The held precharge voltage V0 is used as the V0 voltage in FIG. 37 and the like. The concept of voltage measurement by the voltage measuring circuit 381 also includes the concept of acquiring the voltage or holding the voltage for a certain period or temporarily. Also, it includes the concept of indirectly or directly measuring or acquiring data correlated to the voltage. Incidentally, the D/A conversion circuit 391 may be constructed internally. The voltage measuring circuit 381 may be formed inside the source driver IC (circuit) 14 or placed outside the source driver IC (circuit) 14.

Similarly, the current tone circuit 154 outputs a program current Iw corresponding to tone 1. The program current corresponding to tone 1 is an output current (one unit current) of one unit transistor 164. One unit of program current is supplied to the source signal line 18*s* to select the gate signal line 17*a*1. However, when measuring the precharge voltages V0 to V5 successively, the gate signal line 17*a*1 may remain selected. The driving transistor 11*a* of the measurement pixel 16*s* operates such that one unit of program current will flow through the source signal line 18*s* in steady state. The steady-state flow of the unit current causes the potential of the source signal line 18*s* to change in such a way as to maintain the steady-state unit current. The driving transistor 11*a* charges or discharges the source signal line 18*s* until one unit current flows steadily.

When the potential of the source signal line 18*s* settles to a fixed value, the potential V1 of the source signal line 18*s* is measured by operating the voltage measuring circuit 381. Of course, the measured voltage V1 may be used as the precharge voltage Vp after the potential of the source signal line 18*s* stabilizes, by keeping the voltage measuring circuit 381 in operation.

Although it is stated that the gate signal line 17*a*1 remains deselected while the voltage measuring circuit 381 is measuring the voltage V1, it goes without saying that the gate signal line 17*a*1 may remain selected. The voltage measuring circuit 381 measures the voltage V1 of the source signal line 18*s* and holds it in the voltage tone circuit 231 or stores it in memory. The measured V1 voltage is used as the V1 voltage in FIG. 37 and the like.

The same applies to the precharge voltage V2. The current tone circuit 154 outputs a program current corresponding to tone 8 (see FIG. 37(A). For ease of explanation, it is assumed in FIG. 37 that the V2 voltage corresponds to the 8th tone). The program current corresponding to tone 2 consists of output currents (eight unit currents) of eight unit transistors 164. Although not shown in FIG. 16, the switch 161*d* is closed and other switches 161 are controlled to be open.

Eight units of program current are supplied to the source signal line 18*s* to select the gate signal line 17*a*1. The driving transistor 11*a* of the measurement pixel 16*s* operates such that eight units of program current will flow through the source signal line 18*s* in steady state. The steady-state flow of the unit current causes the potential of the source signal line 18*s* to change in such a way as to maintain the steady-state unit current.

When the potential of the source signal line 18*s* settles to a fixed value or after the time when it is estimated to settle to a fixed value, the potential of the source signal line 18*s* is measured by operating the voltage measuring circuit 381. Of course, by keeping the voltage measuring circuit 381 in operation, the measurement may be taken when the potential of the source signal line 18*s* stabilizes or after the time when it is estimated to stabilize. Measurements may be taken even when the source signal line 18 is changing if the steady-state potential of the source signal line 18 can be estimated. The measured voltage is used as the precharge voltage Vp (=V2). The voltage measuring circuit 381 measures the voltage (precharge voltage V2) of the source signal line 18*s* and holds it in the voltage tone circuit 231.

Similar operation is performed for V3 which is the precharge voltage Vp for tone 32, V4 which is the precharge voltage Vp for tone 128, and V5 which is the precharge voltage Vp for tone 255.

Although it has been stated in the above example that the precharge voltages Vp are measured in order from V0 to V5, this order is not restrictive. The precharge voltages may be measured in order form V5 to V0. Alternatively, they may be measured randomly. Besides, it is not strictly necessary to measure all V0 to V5. For example, only V0, V3, and V5 may be measured and the potentials of V1, V2, and V4 may be calculated from the voltage values of V0, V3, and V5. Alternatively, unit currents corresponding to the precharge voltages Vp may be applied to the source signal line 18*s* after setting the potential of the source signal line 18*s* to a predetermined level by the application of a fixed voltage (black voltage or reset voltage) to the source signal line 18*s*. Also, the precharge voltages V0 to V5 may be measured by taking and averaging multiple measurements. Besides, only the precharge voltage Vp=V0 may be measured. V0 is the precharge voltage Vp when the constant current Iw is 0 A and corresponds to tone 0. Thus, it is the origin of the gamma curve. Once the origin can be measured or determined, other tones (tones 1 to 255 in the case of 8 bits) can be generated easily.

Measuring time may be varied among precharge voltages Vp such as measuring the precharge voltage V0 for a longer time and measuring the precharge voltage V5 for a shorter time. This is because a small current (constant current Iw) flows into the source signal line 18*s* and the potential of the source signal line 18*s* changes slowly in the case of the precharge voltage V1 and the like.

On the other hand, in the case of the precharge voltage V5 and the like, a large current (constant current Iw) flows into the source signal line 18*s* and the potential of the source signal line 18*s* changes quickly. Incidentally, it is not strictly necessary to generate the constant current Iw in the source driver IC (circuit) 14. A constant current Iw outputted by a constant current generating circuit formed or placed outside the source driver IC (circuit) 14 may be supplied to the pixel 16 either directly or via the source driver IC (circuit) 14.

In the present invention shown in FIG. 38, the driving transistor 11*a* in the measurement pixel 16*s* is formed in the array board 30; the driving transistor 11*a* reflects the characteristics of the driving transistor 11*a* in the corresponding one of the display pixels 16 arranged in a matrix. That is, the driving transistor 11*a* in the measurement pixel 16*s* reflects the characteristics of the transistor for the corresponding display pixel 16 in the array board 30.

The program current Iw from the source driver circuit (IC) 14 is supplied to the driving transistor 11*a* in the measurement pixel 16*s*. The resulting precharge voltage Vp is then measured. Consequently, the precharge voltages V0 to V5 reflect the characteristics of the driving transistor 11*a* in the pixel 16 in the array board 30. Further, with respect to the dependence on temperature, the driving transistor 11*a* reflects the temperature at which the display panel in accordance with the present invention is driven.

As described above, in the present invention, the source driver IC (circuit) 14 generates an accurate program current. The program current corresponds to a tone used to actually display an image on the display apparatus. Accordingly, the size and costs of the entire source driver circuit (IC) 14 can be reduced. Further, the measurement pixel 16*s* is produced or formed in the array board 30, in which the pixels 16 are formed. The measurement pixels 16*s* are formed simultaneously with the pixels 16, which display images (during the same process or step). Further, when the same program current is applied to the pixel 16 and to the measurement pixel 16*s*, the source signal line 18 has substantially the same potential as the source signal line 18*s*.

The driving transistor 11*a* in the pixel 16 and the driving transistor 11*a* in the measurement pixel 16*s* are configured or formed so as to have the same characteristics. In order that the driving transistor 11*a* in the pixel 16 and the driving transistor 11*a* in the measurement pixel 16*s* may have the same characteristics, the pixels 16 and 16*s* may basically have the same configuration or layout. It is easiest and preferable to configure the driving transistors 11*a* so that they have a channel width W and a channel length L. In the present invention, the driving transistor 11*a* in the pixel 16 and the driving transistor 11*a* in the measurement pixel 16*s* have the same size and shape.

Figure 39:
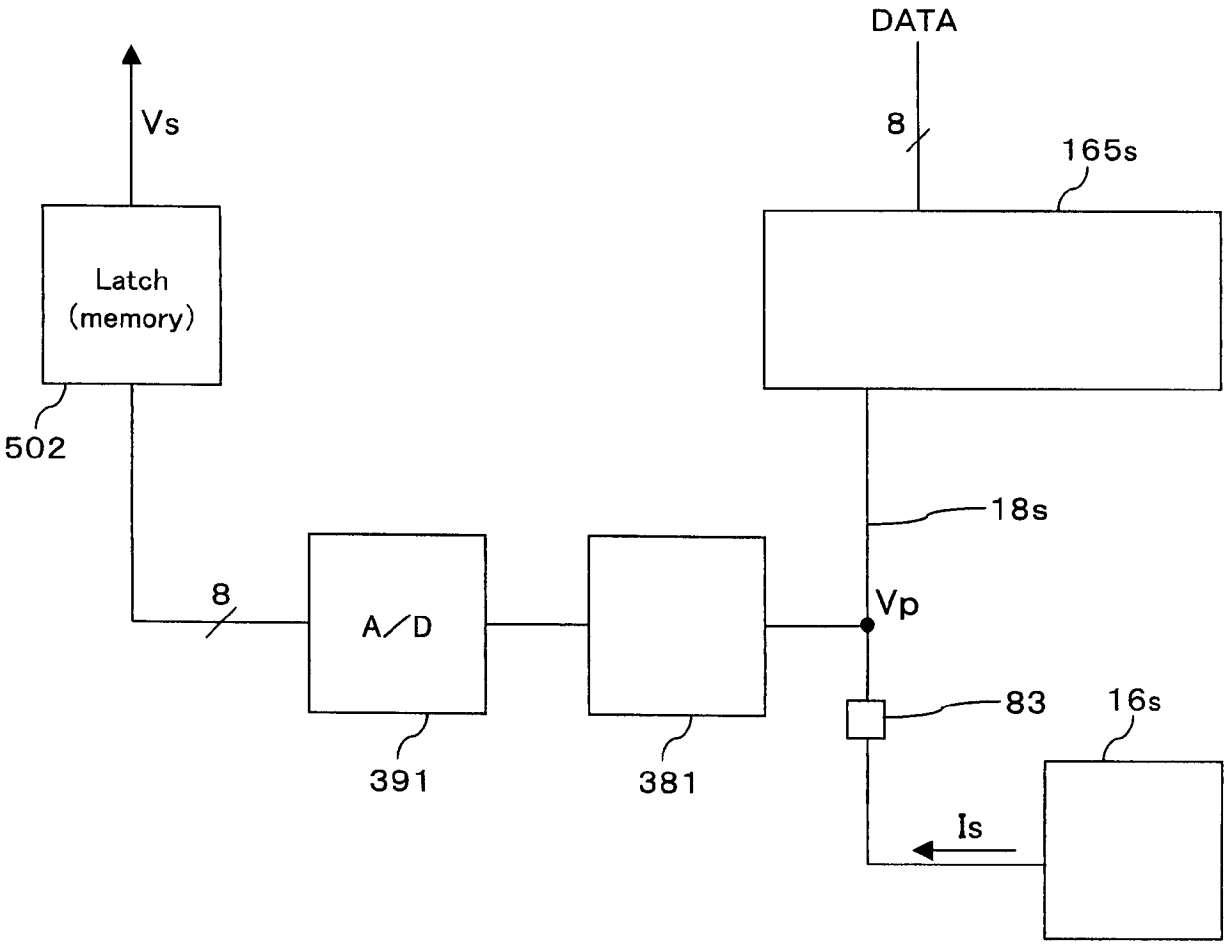
FIG. 39 is a block diagram of a driver circuit of an EL display panel according to the present invention.

FIG. 39 shows a configuration using the analog-digital (A/D) conversion circuit 391. A transistor group 165*s* (which has the same configuration as the transistor group 165*c*, described in FIGS. 16 and 18 and others) in the current tone circuit 154 outputs a program current to the source signal line 18*s*.

In the above embodiment, the program current is a sink current. However, the present invention is not limited to this. If the driving transistor 11*a* in the pixel 16 is an N-channel transistor, the program current is a source current. In this case, the unit transistors 164 constituting the transistor group 165*c* are composed of P-channel transistors.

The driving transistor 11*a* in the measurement pixel 16*s* is operated by the program current to vary the potential of the source signal line 18*s*. The potential of the source signal line 18 corresponding to the program current is defined as Vp. The Vp voltage is measured by a voltage measuring circuit 381. The voltage is converted into digital data by the A/D conversion circuit 391. The digital data is then accumulated or held in the memory or holding circuit (latch circuit or the like). The held data is applied to the voltage tone circuit 231. The voltage tone circuit 231 executes a digital-analog (DA) conversion to obtain a precharge voltage Vp, which is then applied to the source signal line 18.

In the above description, the precharge voltage Vp is applied to the source signal line 18. However, the present invention is not limited to this. For example, a probe needle may be brought into pressure contact with the gate terminal of the driving transistor 11*a* in the pixel 16 or with the pixel electrode of the EL element 15. The precharge voltage Vp may then be applied to the probe needle.

The measuring precharge voltage VP output to the source signal line 18 may be converted into digital data directly by the A/D conversion circuit 391 not through the voltage measuring circuit 381. That is, in the description of the present invention, the voltage measuring circuit 381 is formed, located, and used or operated. However, any configuration or instrument may be used provided that it can acquire a voltage for the source signal line 18*s* or source signal line 18 using a certain configuration, instrument, or method. For example, a sample hold circuit may be used to sample and hold the precharge voltage Vp for a given period.

The transistor group 165*s*, the voltage measuring circuit 381, and the like may be separated from the source driver circuit (IC) and formed on another chip (IC); the transistor group 165*s*, the voltage measuring circuit 381, and the like conduct the program current through the source signal line 18*s*. This chip (IC) is mounted on the array board 30 by the COG technique. Alternatively, the TAB technique may be used for mounting.

Figure 40:
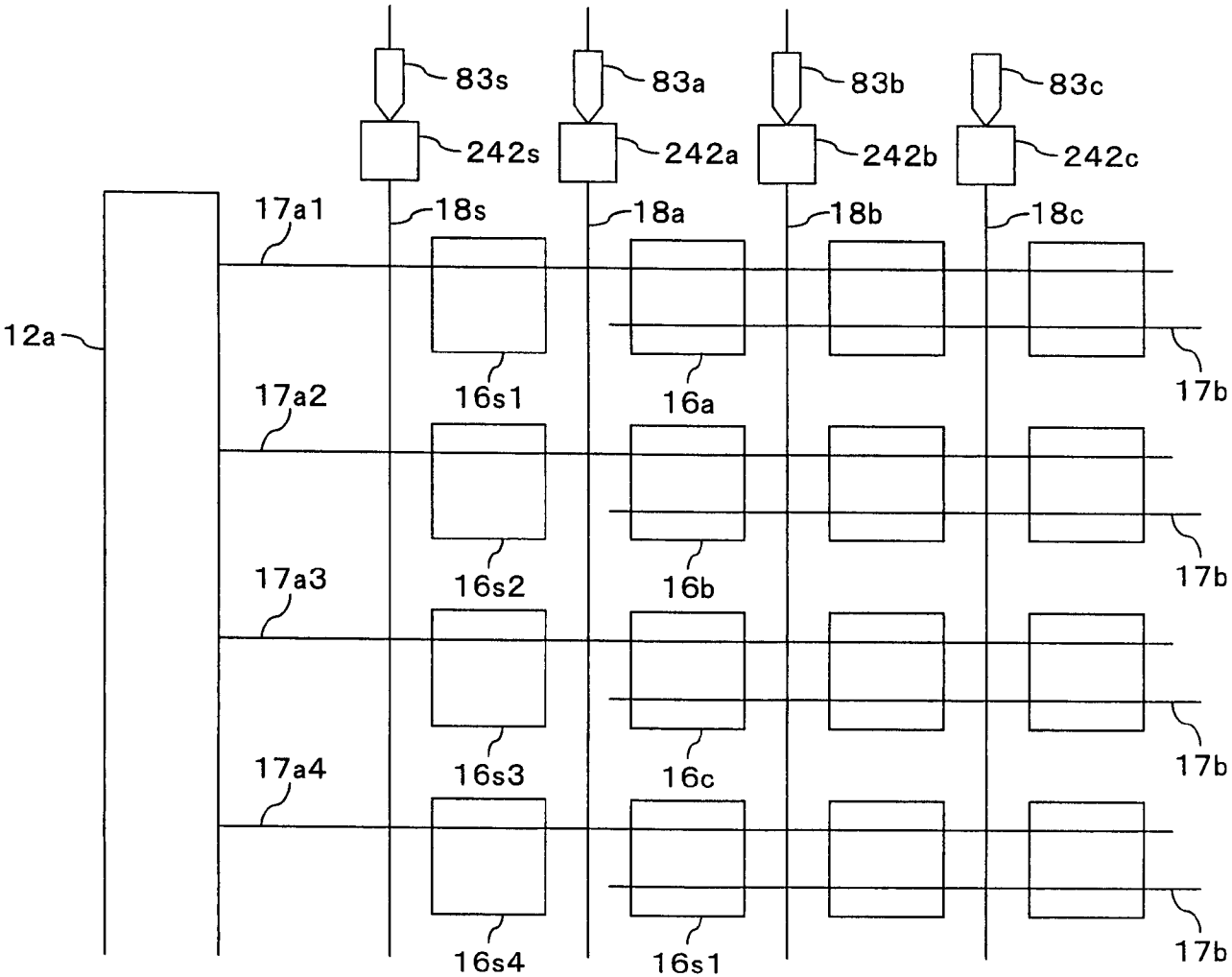
FIG. 40 is a block diagram of a driver circuit of an EL display panel according to the present invention.

In the embodiment shown in FIG. 38, one measurement pixel 16*s* is shown. However, the present invention is not limited to this. For example, as shown in FIG. 40, a plurality of measurement pixels 16*s* (16*s*1, 16*s*2, 16*s*3, 16*s*4, . . . ) may be formed or constructed and sequentially selected through the gate signal lines 17*a* (17*a*1, 17*a*2, 17*a*3, 17*a*4, . . . ).

Each measurement pixel 16*s* is used to measure precharge voltages V0 to V5. By averaging each of the precharge voltages V0 to V5 measured via the plurality of measurement pixels 16*s*, it is possible to determine accurate precharge voltage values V0 to V5.

Different precharge voltages Vp may be assigned to the respective measurement pixels 16*s*; the measurement pixel 16*s*1 is used to measure the precharge voltage V0, the measurement pixel 16*s*2 is used to measure the precharge voltage V1, the measurement pixel 16*s*3 is used to measure the precharge voltage V2, . . . the measurement pixel 16s6 is used to measure the precharge voltage V5.

The precharge voltage Vp to which each measurement pixel 16s is assigned may change every given period of time. For example, during the first period, the measurement pixel 16s1 is used to measure the precharge voltage V0, the measurement pixel 16s2 is used to measure the precharge voltage V1, the measurement pixel 16s3 is used to measure the precharge voltage V2, . . . the measurement pixel 16s6 is used to measure the precharge voltage V5.

During the second period, the measurement pixel 16s1 is used to measure the precharge voltage V5, the measurement pixel 16s2 is used to measure the precharge voltage V4, the measurement pixel 16s3 is used to measure the precharge voltage V3, . . . the measurement pixel 16s6 is used to measure the precharge voltage V0.

The period may be one or more frames or a fraction of one frame. Alternatively, the gate signal lines 17a may be sequentially selected in synchronism with the scanning of the gate signal lines 17b. That is, the period in which one gate signal line 17a is selected is one horizontal scan period (1H).

Figure 41:
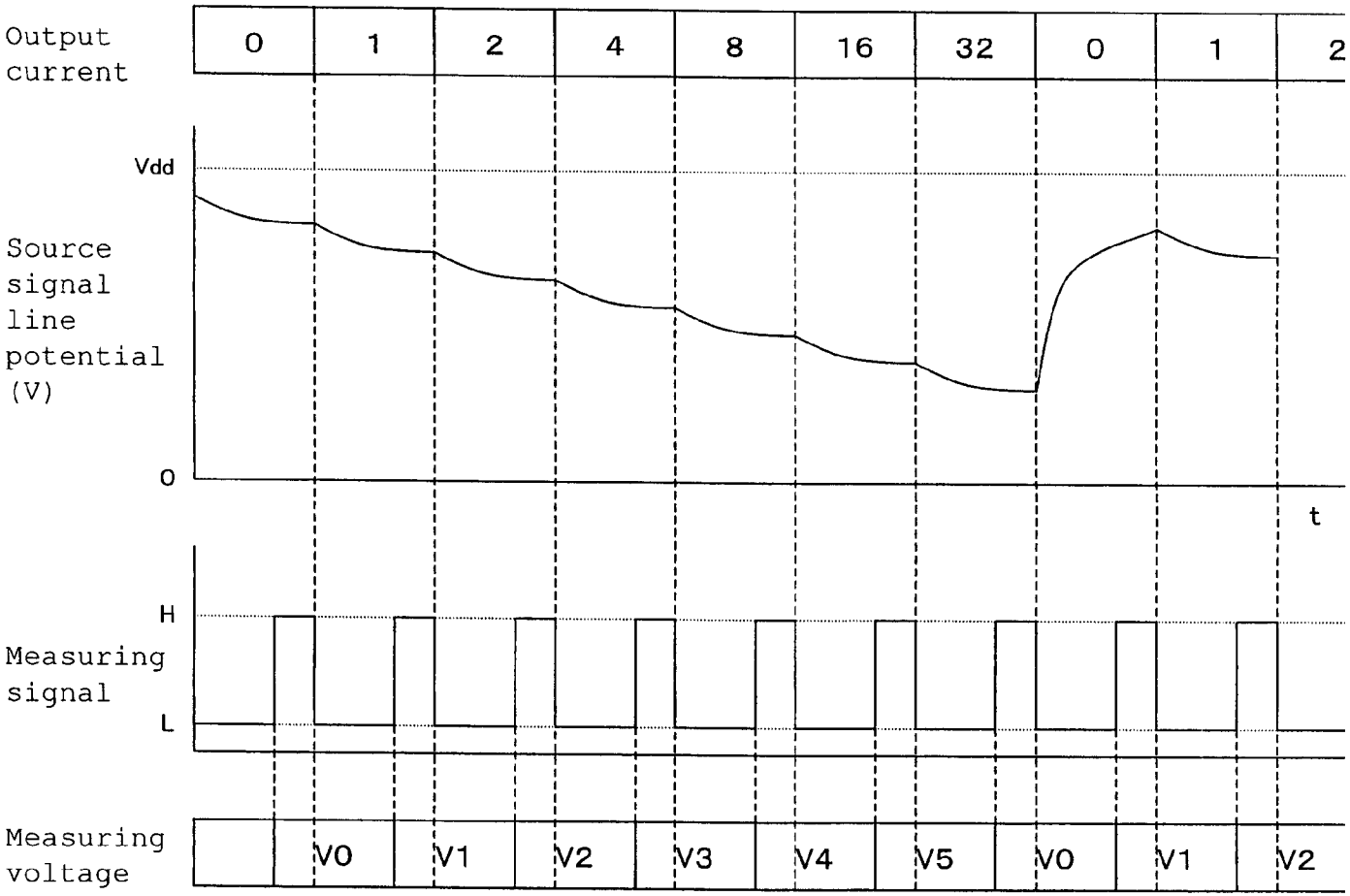
FIG. 41 is a schematic diagram of a driving method of an EL display panel according to the present invention.

As shown in FIG. 41, the voltage measuring circuit 381 measures the precharge voltage Vp in synchronism with a measuring signal. In FIG. 41, the precharge voltage Vp is measured at an H level and is not measured at an L level. The upper stage of FIG. 41 shows the magnitude of a unit current output by the transistor group 165s. 0 indicates the state in which none of the unit transistors 164 are selected (tone 0). 1 indicates that one unit transistor 164 is selected (tone 1). 2 indicates that two unit transistors 164 are selected (tone 2). Similarly, 4 indicates that four unit transistors 164 are selected (tone 1), . . . 32 indicates that 32 unit transistors 164 are selected (tone 32).

In the embodiment in FIG. 41, the value of the output current varies as two to the ordinal power, that is, 1, 2, 4, 8, 16, . . . . That is, in FIG. 16, the switches 161a, 161b, 161c, 161d, . . . are sequentially closed. The precharge voltage Vp is measured and acquired by multiplying the tone by two to the ordinal power. The configuration in FIG. 41 easily controls the transistor group 165s and accurately measures the precharge voltage Vp.

An output current from the transistor group 165s in FIG. 39 operates the driving transistor 11a in the measurement pixel 16s or the like to change the potential of the source signal line 18s. With the configuration in accordance with the present invention, the potential of the source signal line 18s decreases with increasing magnitude of the unit current (magnitude of the program current). This is because, in the description, the driving transistor 11a has a P channel.

A variation in the magnitude of the program current varies the potential of the source signal line 18s. The source signal line 18s has a parasitic capacitance and thus requires a certain period before its potential reaches a target value. In FIG. 41, the measuring signal is at the L level and the voltage measuring circuit 381 does not operate. When the parasitic capacitance of the source signal level 18s is charged or discharged so that its potential reaches the target value, the measuring signal changes to the H level. The precharge voltage Vp (potential of the source signal line 18s) is then measured. The above measurement is sequentially repeated in association with the program current applied to the source signal line 18s. The precharge voltage Vp is thus measured and held.

Figure 42:
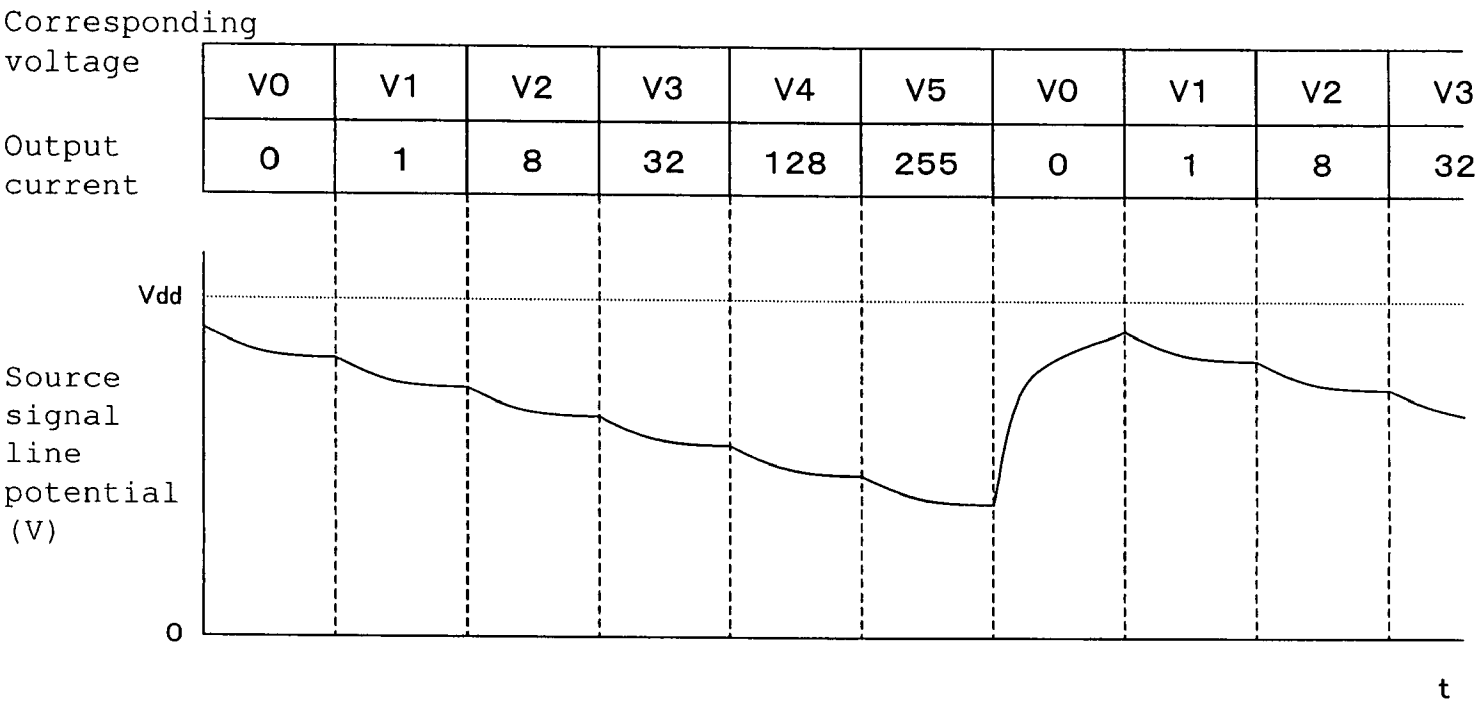
FIG. 42 is a schematic diagram of a driving method of an EL display panel according to the present invention.

In FIG. 41, the precharge voltage Vp is measured (acquired) by varying the magnitude of the program current as two to the ordinal power. FIG. 42 shows a method of measuring (acquiring) the precharge voltages V0, V1, V2, V3, V4, and V5 as shown in FIG. 37. The transistor group 165s sequentially supplies the program currents 0, 1, 8, 32, 128, and 255 to the source signal line 18s. The potential of the source signal line 18s varies with the program current. The voltage measuring circuit 381 measures the potential of the source signal line 18s.

In the above description, the precharge voltage Vp is measured or acquired in association with the predetermined tone. However, the present invention is not limited to this. The precharge voltage Vp may be measured (acquired) for all tones (for example, for 256 tones, the 0th to 255th tones). Appropriate voltage driving can be achieved by using the precharge voltage Vp as a tone signal.

In the above embodiment, at least three precharge voltages Vp are measured. However, the maximum tone, the tone 255 (for 256 tones), and the minimum tone, the tone 0, may be measured so as to generate a precharge voltage Vp midway between the voltages corresponding to the maximum and minimum tones.

Figure 43:
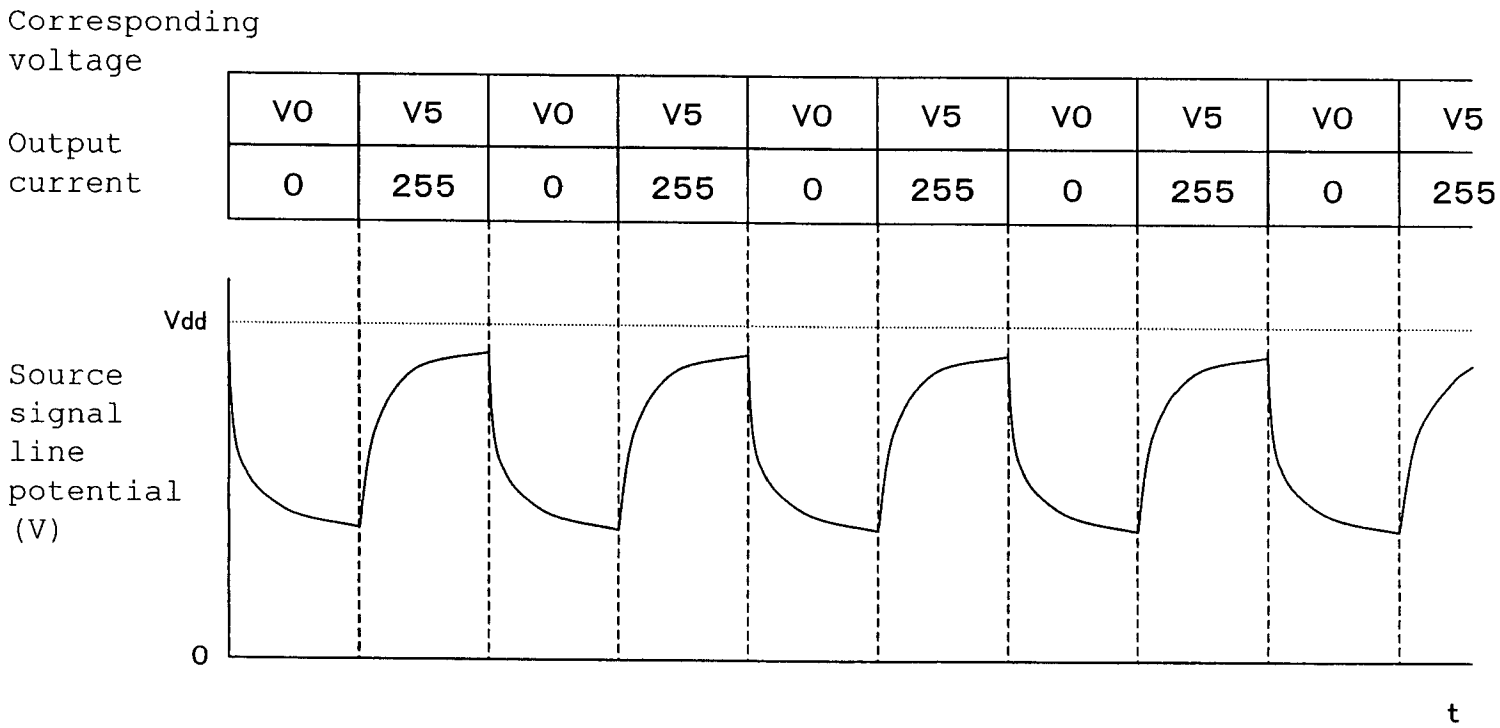
FIG. 43 is a schematic diagram of a driving method of an EL display panel according to the present invention.
Figure 44:
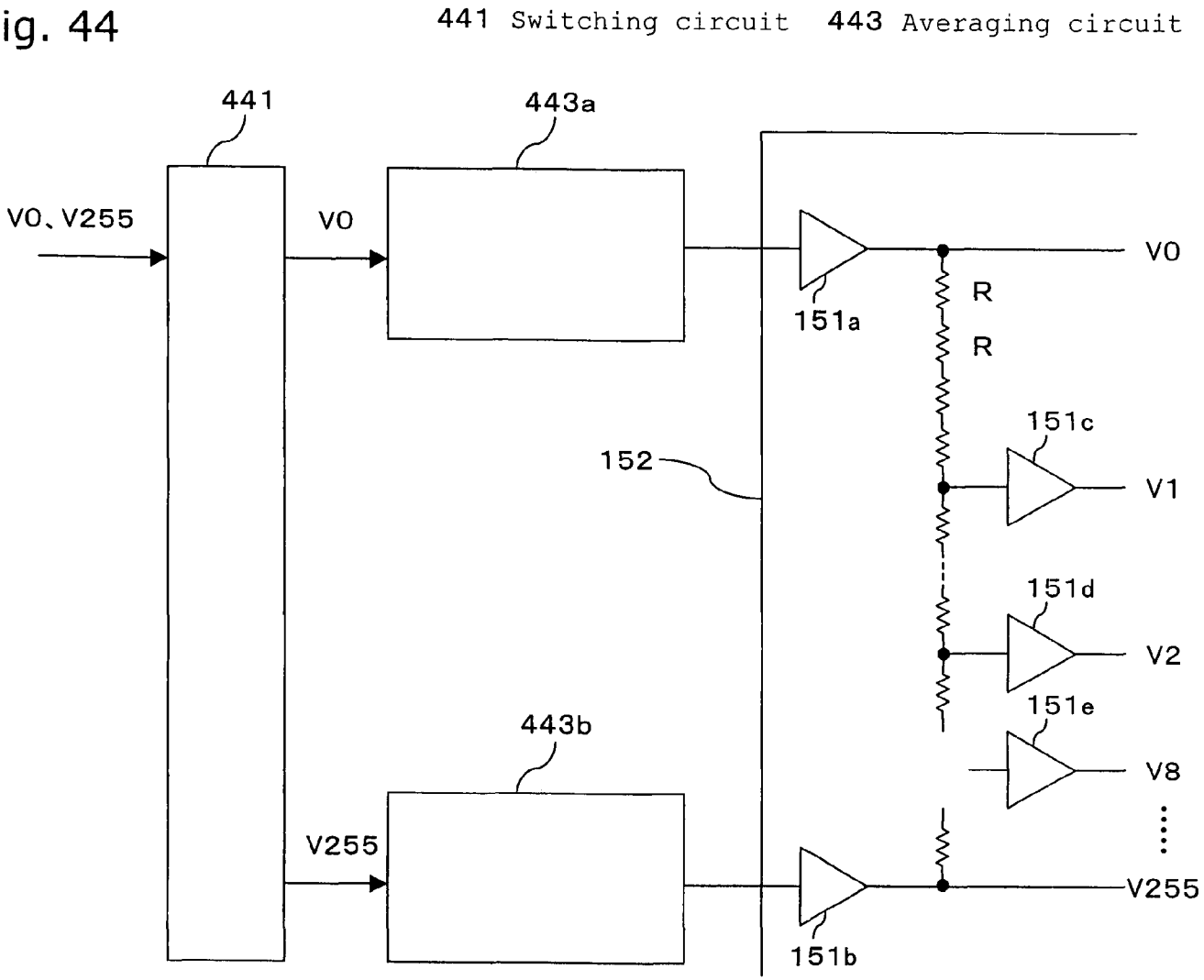
FIG. 44 is a block diagram of a driver circuit of an EL display panel according to the present invention.

The driving scheme shown in FIG. 43 is used to measure the precharge voltage Vp=V0, V255. The scheme shown in FIG. 44 uses the precharge voltages V0 and V255, measured in FIG. 43. In FIG. 44, a switching circuit (which selectively supplies the V0 and V255 voltages) 441 inputs the V0 voltage to an averaging circuit 443a. Further, for the measured precharge voltage Vp, the switching circuit (which selectively supplies the V0 and V255 voltages) 441 inputs the V255 voltage to an averaging circuit 443b. The averaging circuit 443a averages the alternately or consecutively measured precharge voltages V0 and V255 to obtain stable precharge voltages V0 and V255.

An output from the averaging circuit 443 is input to the operational amplifier 151 to reduce impedance. The output is then input to the electronic regulator 152. The electronic regulator 152 uses the resistor R to divide the input precharge voltage Vp=V0, V55 to generate a precharge voltage (V0 to V255) corresponding to the tone.

As shown in FIG. 43, an output current (0 or 255) from the transistor group 165s operates the driving transistor 11a and the like to vary the potential of the source signal line 18s. A variation in the magnitude of the program current varies the potential of the source signal line 18s. Owing to the parasitic capacitance of the source signal line 18s, a certain period of time is required for the potential of the source signal line 18s to reach a target value. This results in a curved variation in the potential of the source signal line 18. A voltage measuring circuit 381 measures the precharge voltage Vp (potential of the source signal line 18s) for the tone and the precharge voltage Vp for the tone 255. The above measurement is sequentially repeated in association with the program current applied to the source signal line 18s. The measured precharge voltages V0 and V255 are transmitted to the switching circuit 441, shown in FIG. 44.

Figure 45:
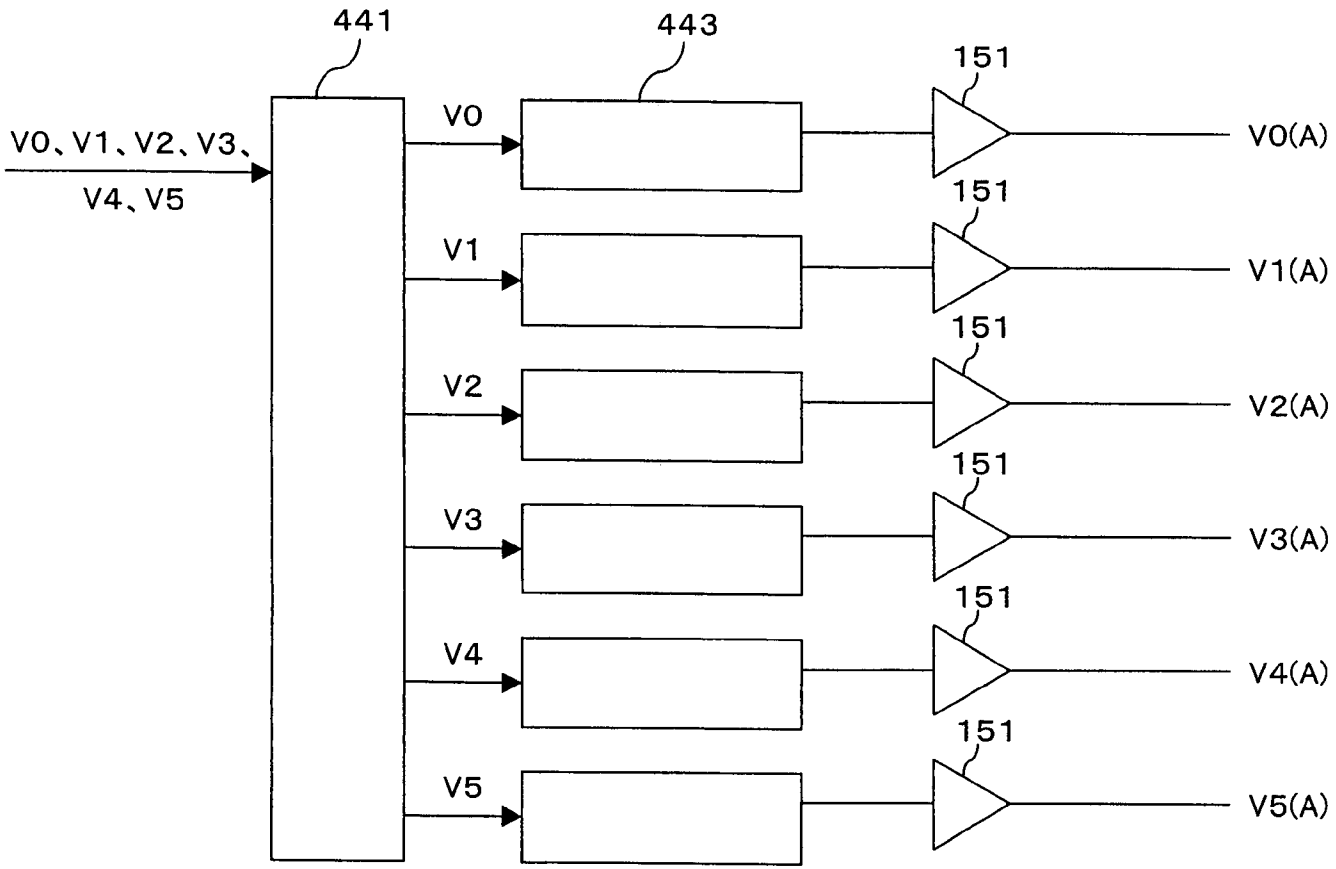
FIG. 45 is a block diagram of a driver circuit of an EL display panel according to the present invention.

FIG. 43 shows the case of the precharge voltages V0 and V255. However, the present invention is not limited to this. As shown in FIG. 45, the precharge voltages V0 to V5 are sequentially measured by the voltage measuring circuit 381 and sequentially transmitted to the switching circuit 441. The switching circuit 441 selectively supplies the received precharge voltages V0 to V5 to the averaging circuit 443, which then averages each precharge voltage Vp. The V0 to V5 voltages are stabilized to obtain V0(A) to V5(A), which are then applied to the electronic regulator 152.

Figure 46:
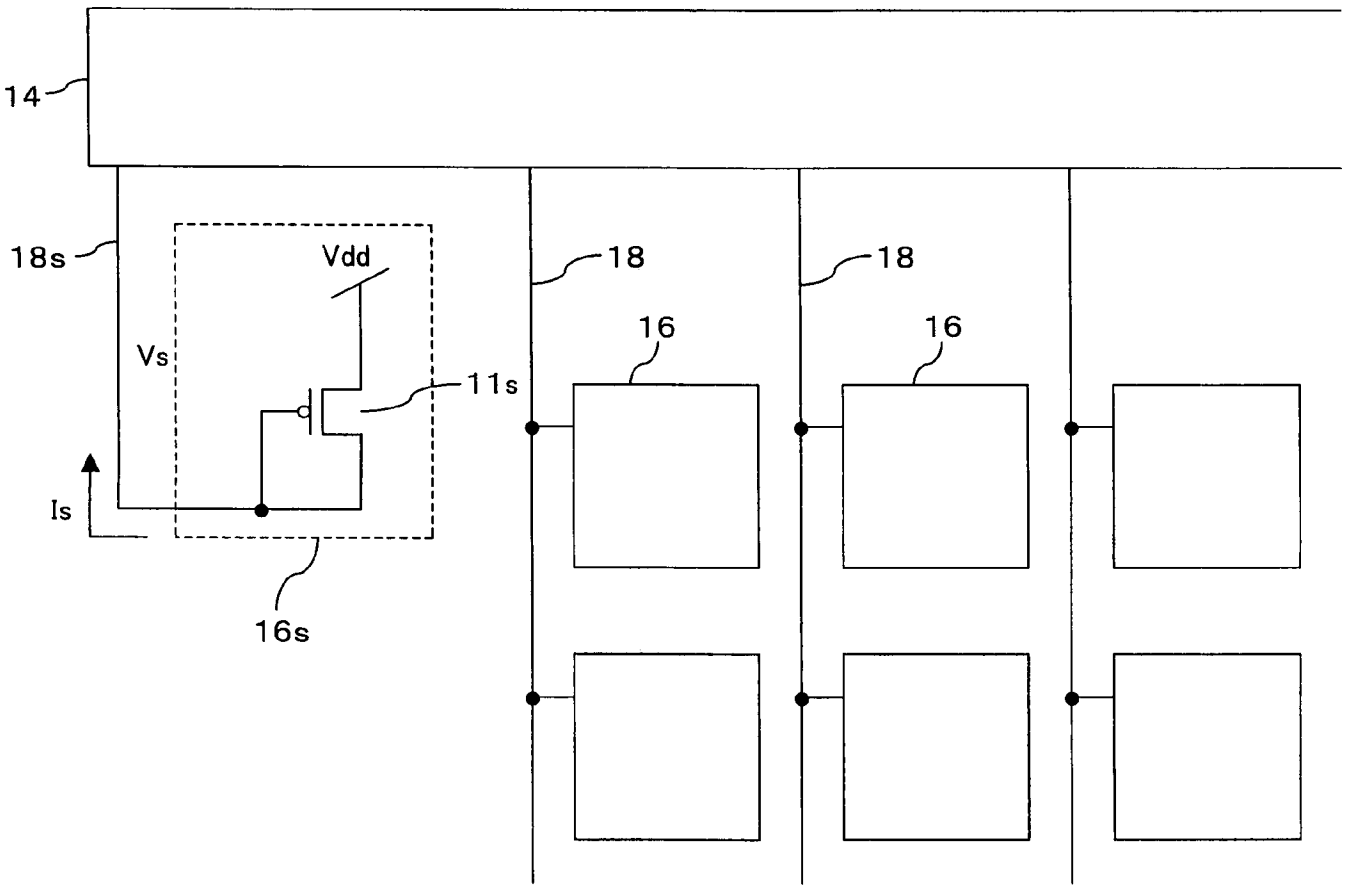
FIG. 46 is a schematic diagram of an EL display panel according to the present invention.

As described in FIG. 37(B), the measurement pixel 16s free from the EL element 15 is formed and used to measure the precharge voltage Vp. However, as shown in FIG. 46, the measurement pixel 16s consisting of the driving transistor 11a may be formed and operated so as to enable the measurement of the precharge voltage Vp. In FIG. 46, the gate and drain terminals of the measurement pixel 16*s* are short-circuited. The source terminal is connected to the anode voltage Vdd similarly to the driving transistor for the pixel 16.

Figure 47:
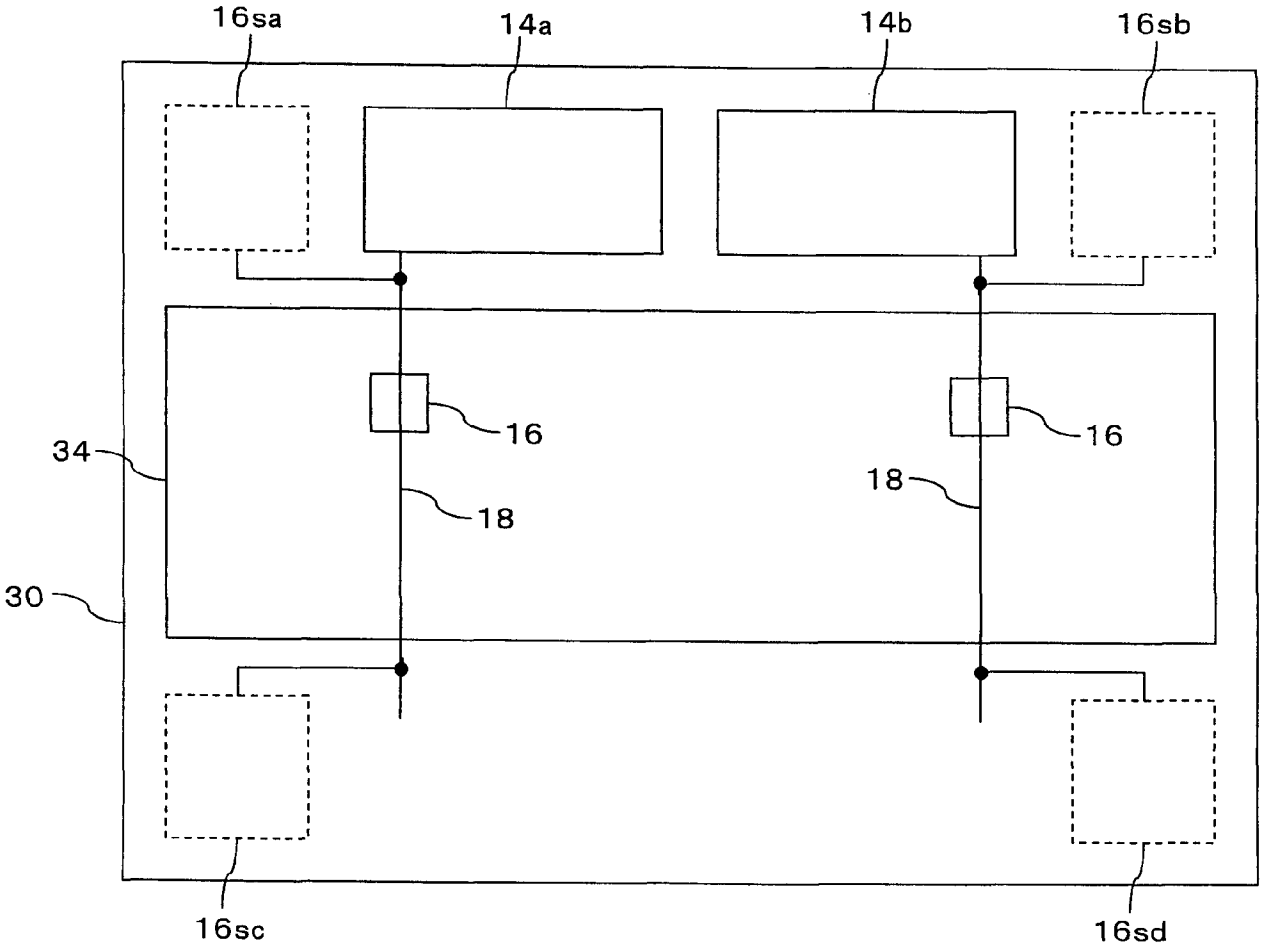
FIG. 47 is a schematic diagram of an EL display panel according to the present invention.

As shown in FIG. 47, the measurement pixel 16*s* is desirably divided into a plurality of pixels (16*sa*, 16*sb*, 16*sc*, and 16*sd*) arranged at the respective positions on the array board 30. The precharge voltage Vp is preferably measured by operating the driving transistors 11*a* for the measurement pixels 16*s* formed at the plurality of positions. This is because the characteristics of the driving transistors 11*a* may vary depending on where they are constructed in the array board 30. The precharge voltages Vp measured at the plurality of measurement pixels 16*s* are averaged to acquire the desired precharge voltages V0 to V5. When the plurality of measurement pixels 16*s* are formed at the respective positions, even if one of them is defective, the precharge voltages V0 to V5 can be acquired from the other measurement pixels 16*s*.

Figure 48:
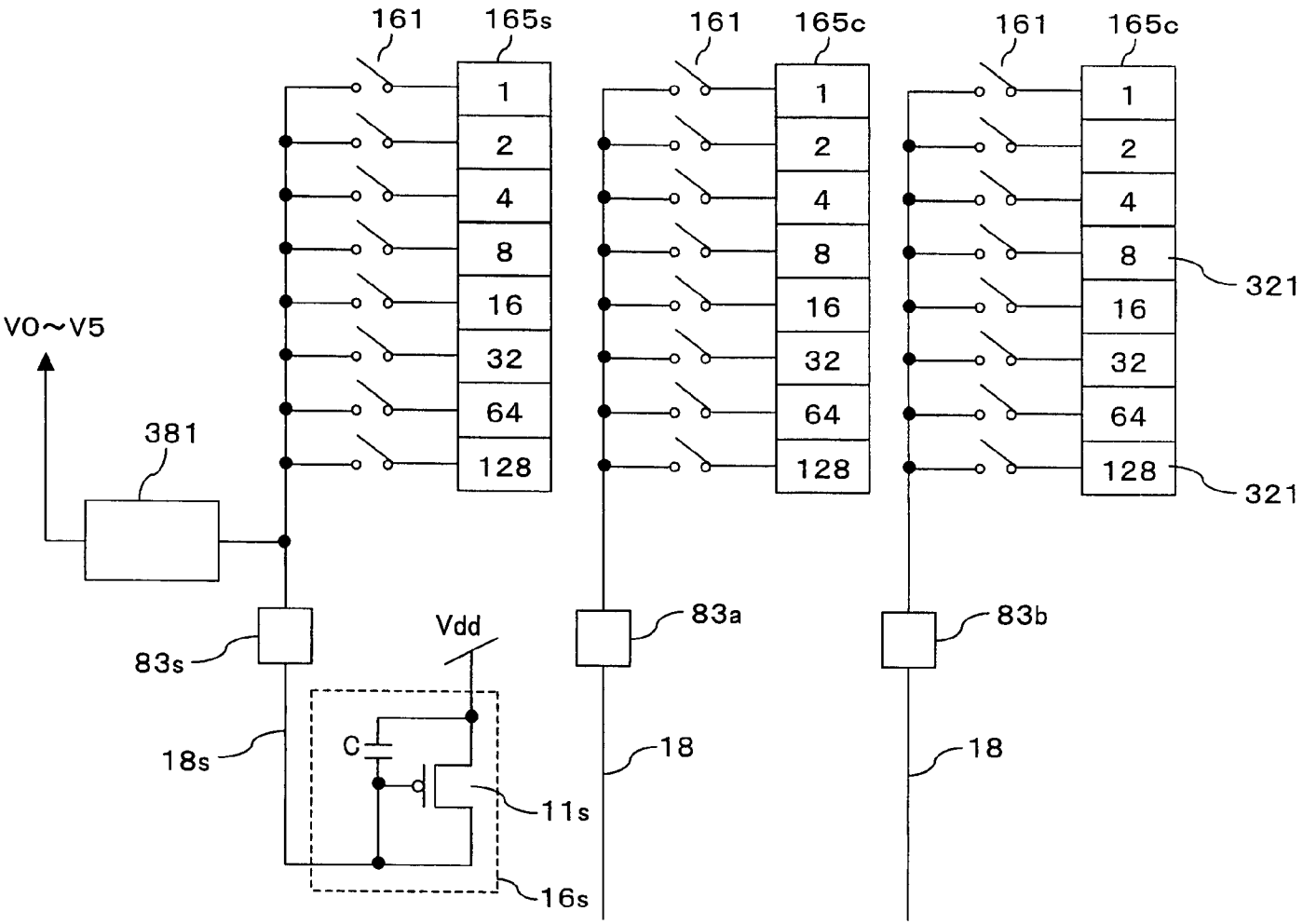
FIG. 48 is a schematic diagram of an EL display panel according to the present invention.

As shown in FIG. 48, similarly to the transistor group 165*c* used to display images, a transistor group 165*s* may be formed which is used to measure the precharge voltage Vp. The number of unit transistors 164 in the transistor group 165*s* is selected and applied to the measurement pixels 16*s*.

The numbers in the transistor groups 165*c* and 165*s* in FIG. 48 show the numbers of unit transistors 164. That is, 1 indicates one unit transistor 164, 2 indicates two unit transistors, 4 indicates four unit transistors, 8 indicates eight unit transistors, . . . 128 indicates 128 unit transistors. The switch 161 is used to switch the number of unit transistors 164 so as to measure the precharge voltage Vp corresponding to the number of unit transistors 164 (tones).

In the configuration shown in FIG. 48 and others, the transistor group 165*c*, which outputs a program current to the source signal line 18, has the same arrangements as those of the transistor group 165*s*, which outputs the program current to the source signal line 18*s* (see FIG. 16 or 20 or others). Consequently, the transistor group 165*s* outputs the same unit current as that output by the unit transistor of the transistor group 165*c*. However, the present invention is not limited to this. For example, as shown in FIG. 49, it is possible to generate, regardless of the transistor group 165*c*, a reference current flowing through the transistor 167*b* or a transistor group that constitutes, in combination with the transistor group 165*s*, a current mirror circuit.

Figure 49:
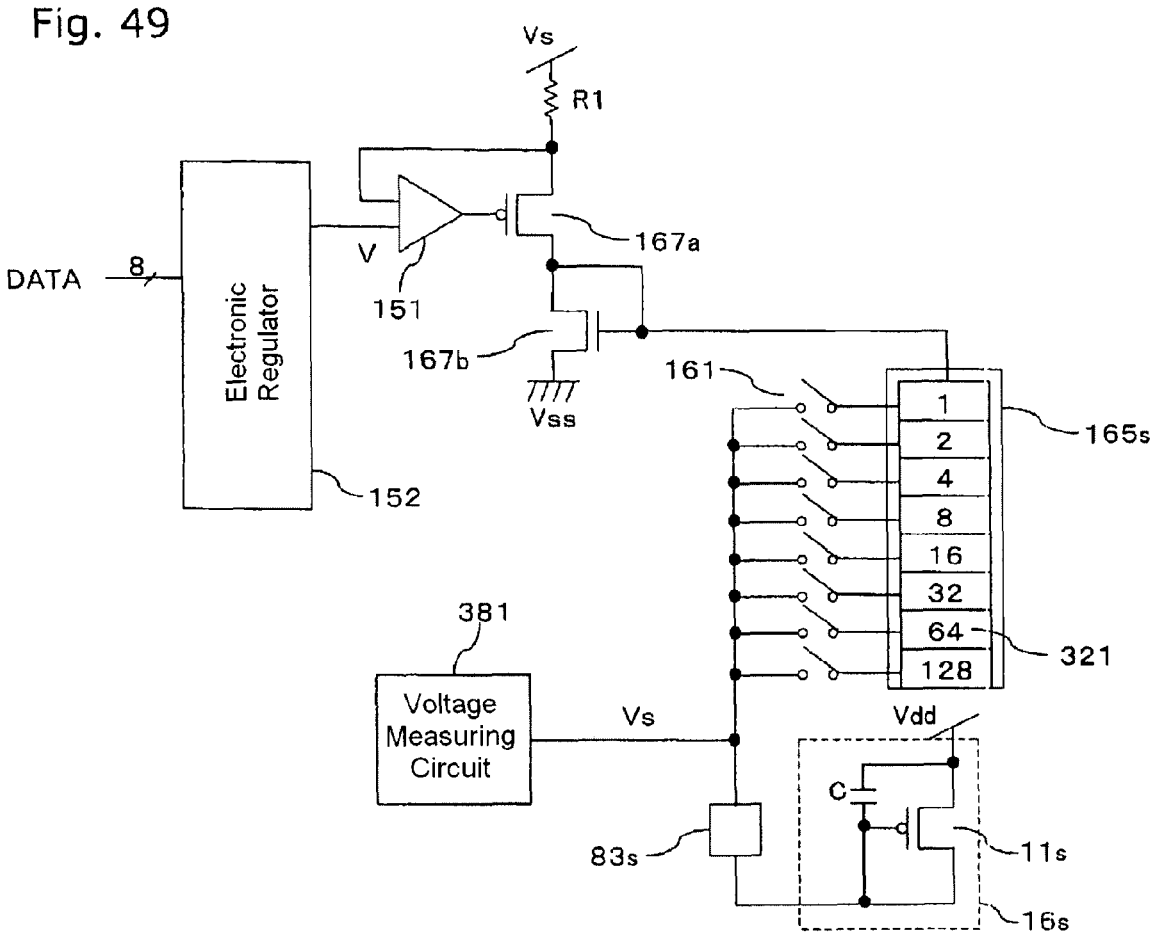
FIG. 49 is a schematic diagram of an EL display panel according to the present invention.

The electronic regulator 152 in FIG. 49 is controlled by 8-bit DATA that varies the voltage V. The DATA is controlled by a controller (not shown). The voltage V and the resistor R1 enable the variation of a reference current Ic flowing through the transistor 167*b*. The transistor 167*b* in combination with the transistor group 167*b* constitutes a current mirror circuit.

Figure 50:
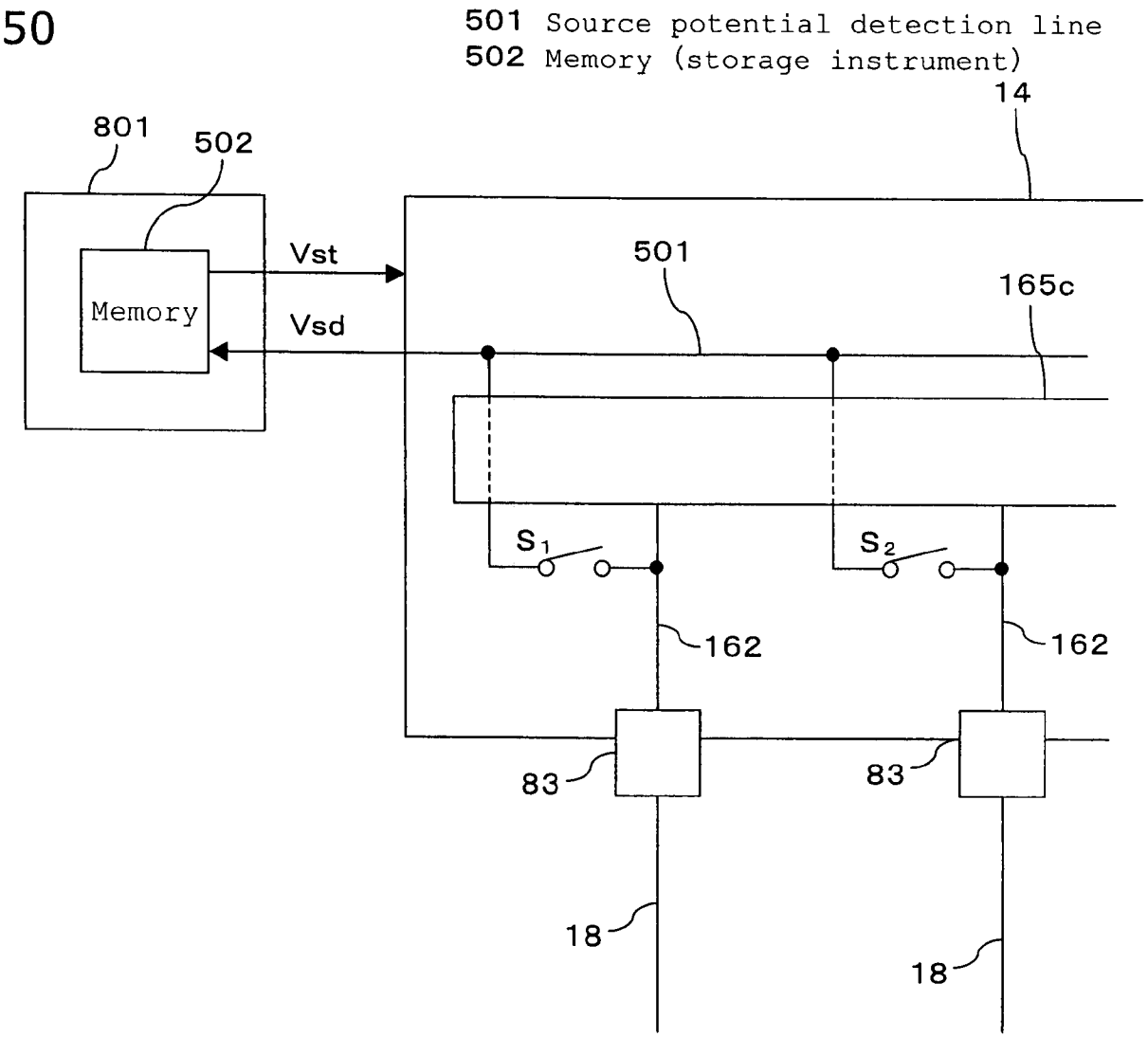
FIG. 50 is a schematic diagram of an EL display panel according to the present invention.

In the embodiment shown in FIG. 50, the switch S (S1, S2, S3, . . . ) is formed in the source driver circuit (IC) 14. Selection of one switch S causes the potential of the source signal line 18 from the output terminal 83 to be applied to a source signal line potential detection line 501; the output terminal 83 is connected to the selected switch S.

In FIG. 50, the transistor group 165*c* connected to each output terminal 83 outputs a program current Iw=I0 (corresponding to a tone 0; with the tone 0, the program current Iw=0). The potential of the source signal line 18 varies to the value corresponding to the program current I0. Under these conditions, the switches S0 to Sn (n is the maximum number value of the output terminal 83) are sequentially closed. The potential of the source signal line 18 is applied to the source signal line potential detection line 501. The measured voltage is defined as Vsd and is transmitted to a controller circuit (IC) 801. In the controller circuit (IC) 801, the potential of the source signal line 18 for the program current I0 is stored in a memory 502 as a Vst0 voltage. The Vst0 corresponds to the precharge voltage V0.

Figure 51:
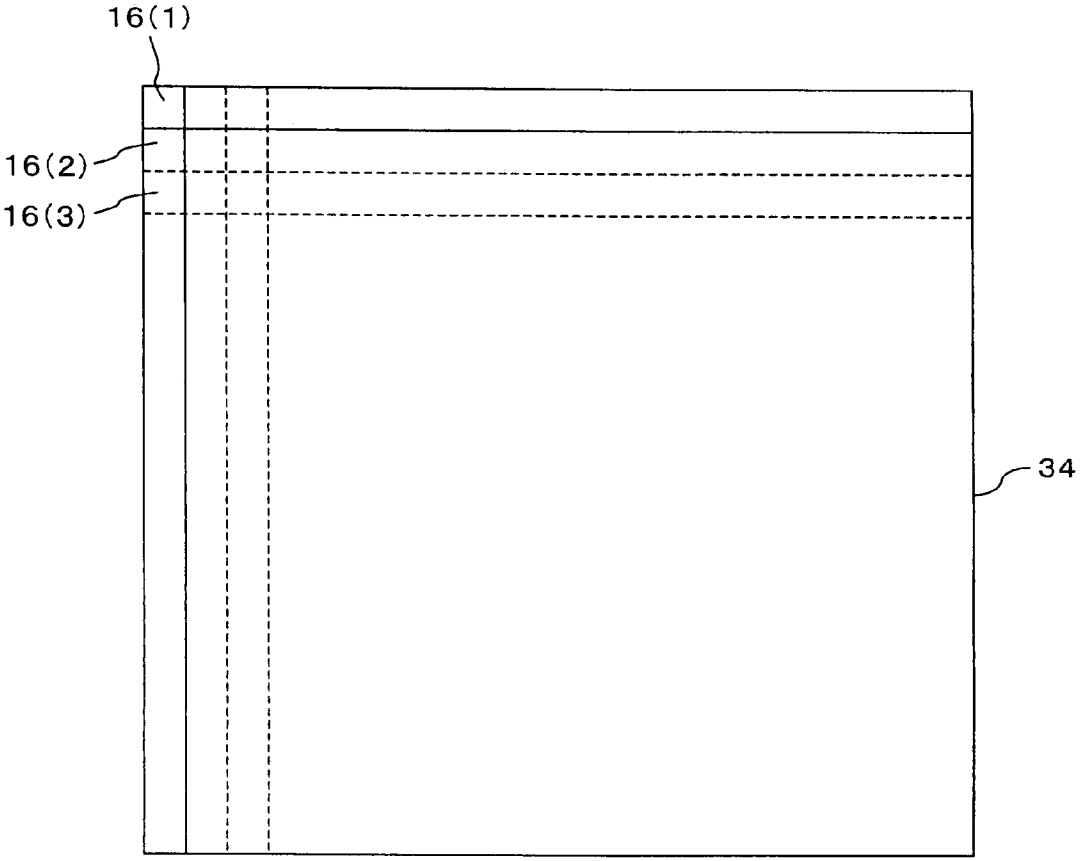
FIG. 51 is a schematic diagram of an EL display panel according to the present invention.

The potential of the source signal line 18 may of course be detected by specifying a particular pixel row or column such as the first pixel row or column as shown in FIG. 51.

For the precharge voltage V1, the transistor group 165*c* connected to each output terminal 83 outputs a program current I1. The potential of the source signal line 18 varies to the value corresponding to the program current I1. Under these conditions, the switches S0 to Sn (n is the maximum number value of the output terminal 83) are sequentially closed. The potential of the source signal line 18 is applied to the source signal line potential detection line 501. The measured voltage is defined as Vsd1 and is transmitted to a controller circuit (IC) 801. The controller circuit (IC) 801 causes this voltage data to be stored in the memory (SRAM or EEPROM) 502 as the potential Vst1 of the source signal line 18 for the program current I1. The Vst1 corresponds to the precharge voltage Vp=V1.

For the precharge voltage Vp=V2, the transistor group 165*c* connected to each output terminal 83 outputs the program current Iw=12. Under these conditions, the switches S0 to Sn (n is the maximum number value of the output terminal 83) are sequentially closed. The potential of the source signal line 18 is applied to the source signal line potential detection line 501. The measured voltage is defined as Vsd2 and is transmitted to a controller circuit (IC) 801. The subsequent steps are as described above.

The thus measured precharge voltages V0 to V5 are transmitted to the source driver circuit (IC) 14 as the set values Vst of the precharge voltage Vp and as required. The precharge voltages V0 to V5 are then used as set values for the electronic regulator 152.

The above configuration allows the variation of the transistor group 165*c* to vary the program current Iw, used to measure the precharge voltage Vp. This enables the precharge voltage Vp to be measured more flexibly and appropriately.

Figure 52:
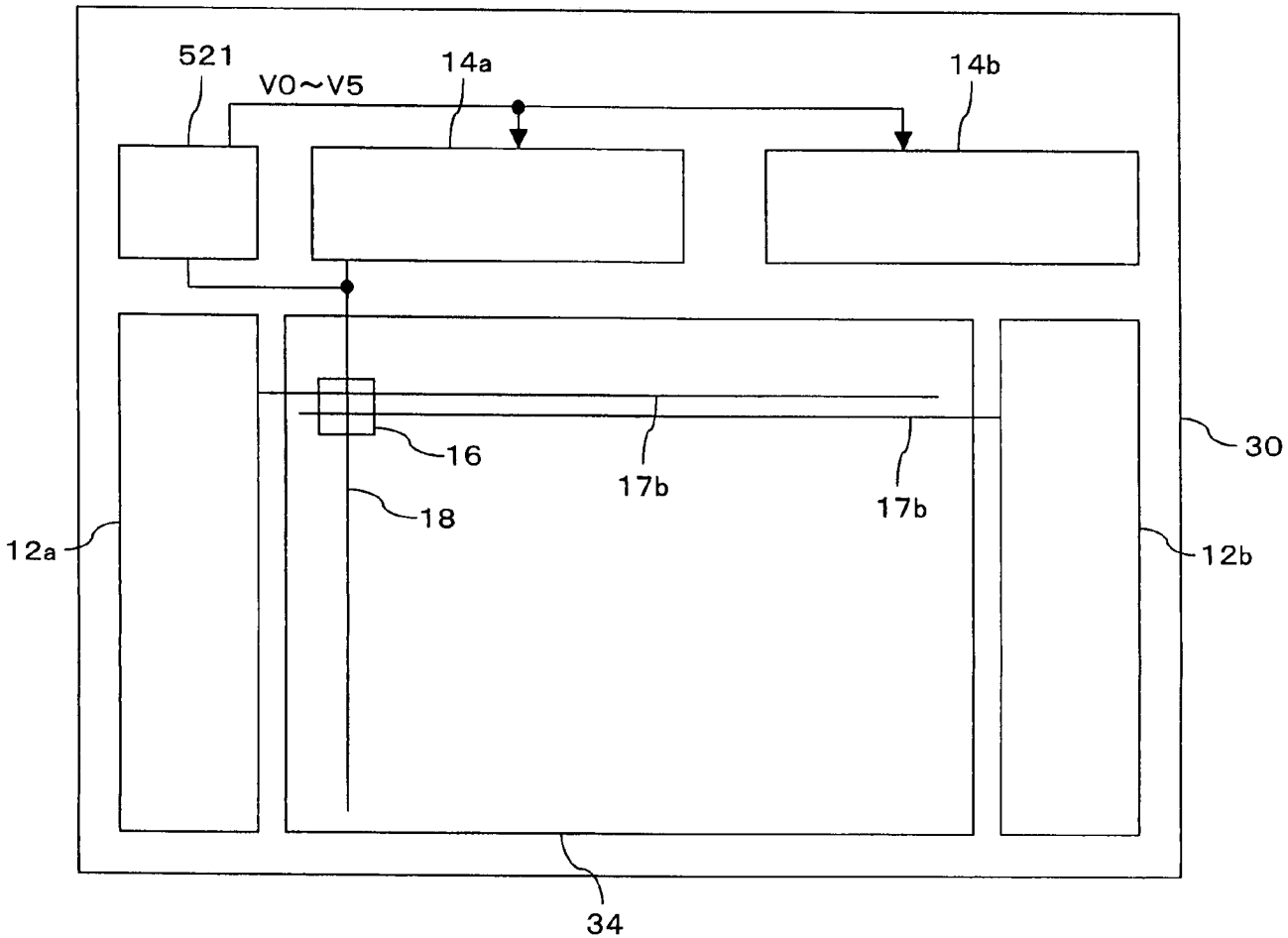
FIG. 52 is a schematic diagram of an EL display panel according to the present invention.
Figure 53:
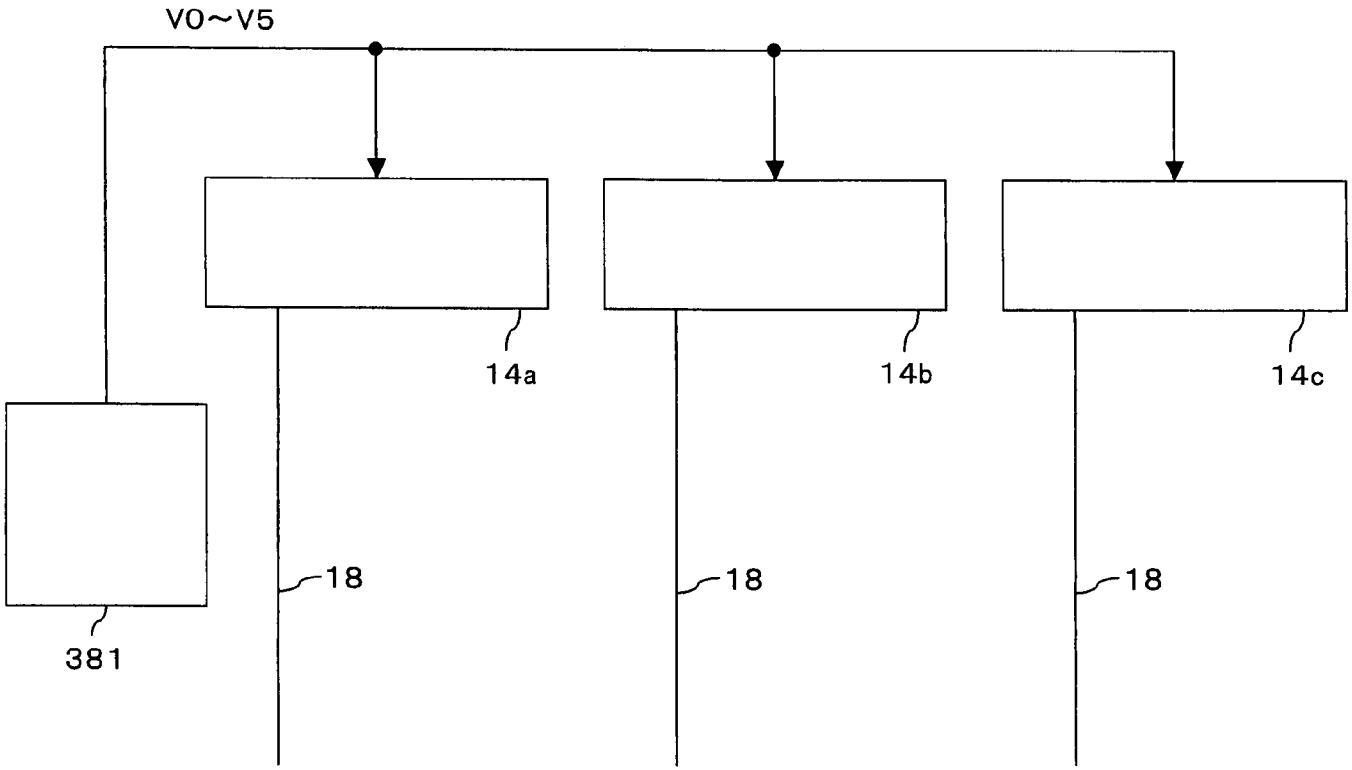
FIG. 53 is a schematic diagram of an EL display panel according to the present invention.
Figure 54:
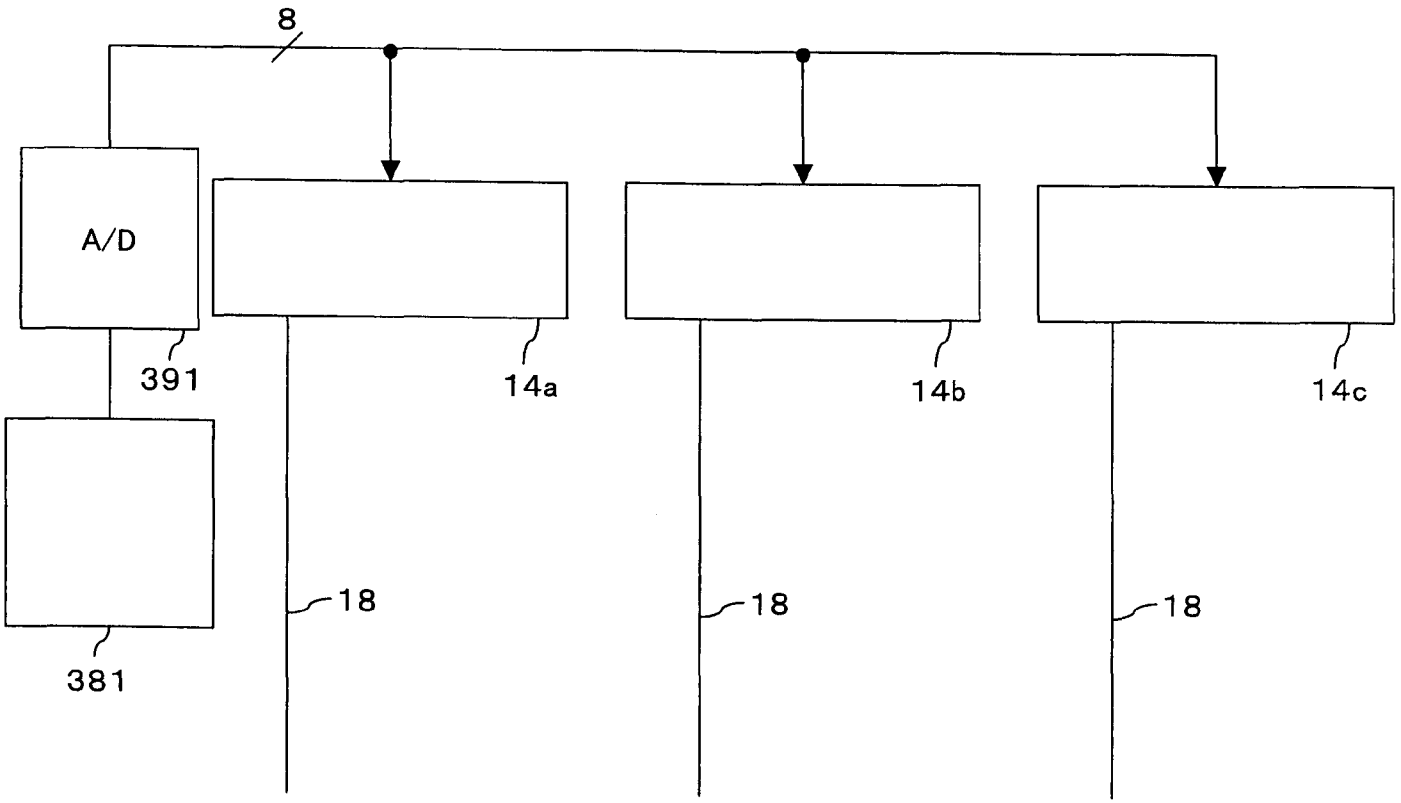
FIG. 54 is a schematic diagram of an EL display panel according to the present invention.

As shown in FIG. 52, the measuring circuit for the precharge voltage Vp may be different from the source driver circuit (IC) 14 or may be an IC. In the embodiment shown in FIG. 52, a voltage measuring circuit IC 621 having a voltage measuring circuit function is COG-mounted on the array board 30. Further, in FIG. 53, an output from the voltage measuring circuit 381 is applied to three source driver circuits (IC) 14. Furthermore, in FIG. 54, the digital signal from the A/D conversion circuit 391 is applied to three source driver circuits (IC) 14; the precharge voltage Vp has been converted into the digital signal.

Figure 55:
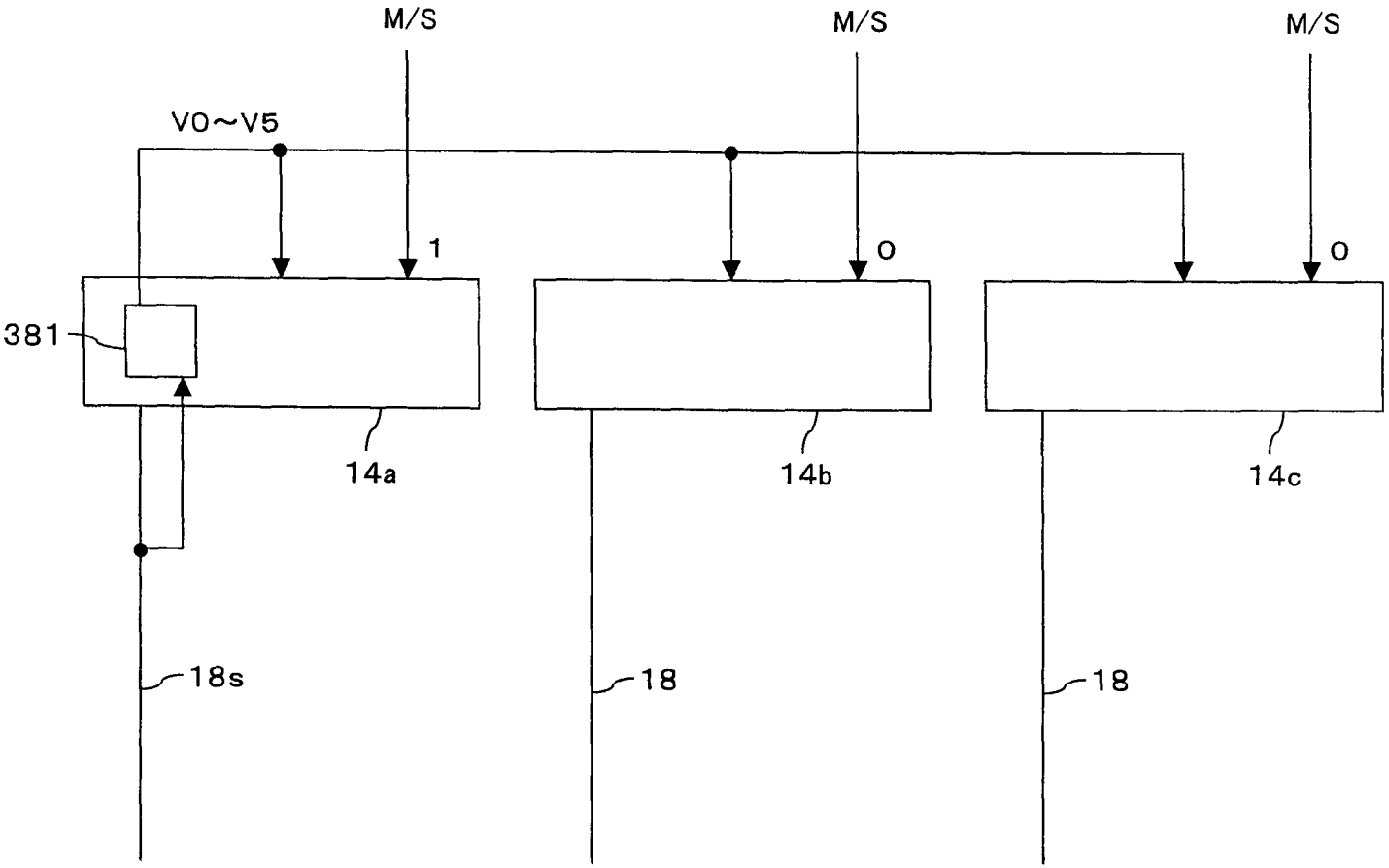
FIG. 55 is a schematic diagram of an EL display panel according to the present invention.

If a plurality of source driver circuits (IC) 14 are used, the voltage measuring circuit 381 is constructed or formed in each source driver circuit (IC) 14. Then, the voltage measuring circuit 381 in one of the plurality of source driver circuits (IC) 14 is operated. The precharge voltage Vp from the voltage measuring circuit 381 is supplied or applied to the other source driver circuit (IC) 14. FIG. 55 illustrates this configuration. A master/slave selection terminal (M/S) logically sets the three source driver circuits (IC) 14 so that each of them operates either as a master or a slave. For a master mode, the M/S terminal is set to a logic level 1. For a slave mode, the M/S terminal is set to a logic level 0.

In FIG. 55, the source driver circuit (IC) 14*a* is set to the master mode, whereas the source driver circuits (IC) 14*b* and 14*c* are set to the slave mode. In the master mode, the voltage measuring circuit 381 in the source driver circuit (IC) 14*a* operates to measure the potential of the source signal line 18*s*. The voltage measuring circuit 381 then outputs the precharge voltages V0 to V5. The output precharge voltages V0 to V5 are applied to the electronic regulator circuit for the source driver circuit (IC) 14 (14*b* and 14*c*) in the slave mode. The voltage measuring circuits 381 in the source driver circuits (IC) 14 (14*b* and 14*c*) set to the slave mode does not operate.

The master and slave modes are thus set for the source driver circuit (IC) 14 because the source signal line 18*s* or measurement pixel 16*s* used to measure the precharge voltage Vp is formed at a position outside the display screen 34. The measurement pixel 16*s* is thus constructed at an end of the display screen 34. Accordingly, the source driver circuit (IC) 14 used to measure the precharge voltage Vp is selected to lie at an end of the display screen 34 (in FIG. 55, the source driver circuit (IC) 14*a*). The selection is set by the M/S terminal. The master mode allows the circuit to perform an operation or function for measuring the precharge voltage Vp. The slave mode does not allow the circuit to perform an operation or function for measuring the precharge voltage Vp.

Figure 57:
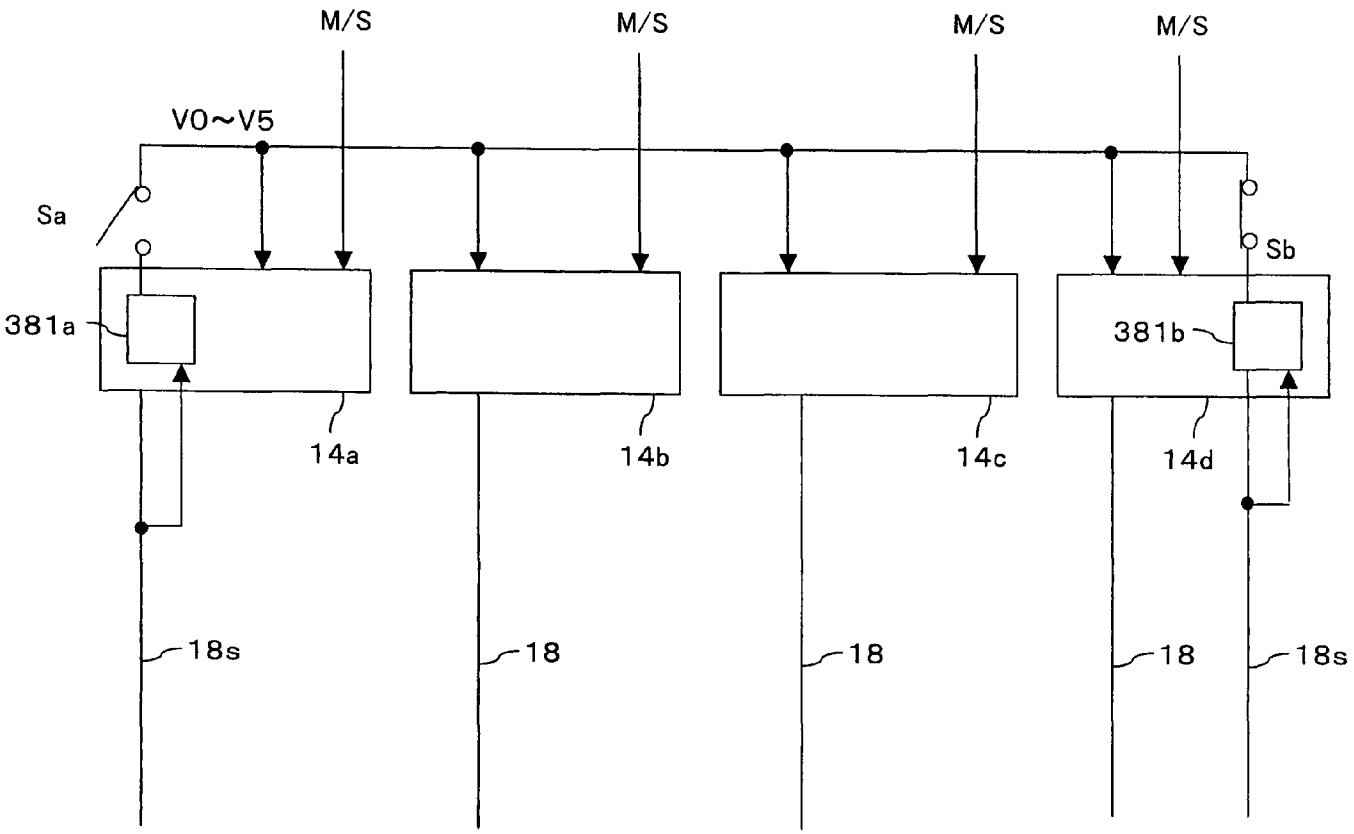
FIG. 57 is a schematic diagram of an EL display panel according to the present invention.

If the source signal line 18*s* and the measurement pixel 16*s* can be formed at the opposite ends of the display screen 34, as shown in FIG. 57 the source driver circuits (IC) 14 (14*a* and 14*d*) located at the opposite ends of the display screen 34 are set in the master mode. The switches Sa and Sb are used to select either the precharge voltage Vp output by the source driver circuit (IC) 14*a* or the precharge voltage Vp output by the source driver circuit (IC) 14*d*, which is applied to the source driver circuit (IC) 14 in the slave mode. Of course, both the switches Sa and Sb may be selected for the measurement of the precharge voltage Vp.

To set the source driver circuit (IC) 14*a* to the master mode, the switch Sa is closed, the source driver circuit (IC) 14*d* is set to the slave mode, and the switch Sb is opened. The other source driver circuits (IC) 14 (14*b* and 14*c*) operate in the slave mode. To set the source driver circuit (IC) 14*d* to the master mode, the switch Sb is closed, the source driver circuit (IC) 14*a* is set to the slave mode, and the switch Sa is opened. The other source driver circuits (IC) 14 (14*b* and 14*c*) always operate in the slave mode.

It is also possible to always fix the source driver circuit (IC) 14*a* or 14*d* to the master mode. However, alternatively operating the source driver circuits (IC) 14*a* and 14*d* in the master mode averages the precharge voltage Vp and thus produces good results.

The switching is carried out periodically, for example, for each field or frame. Of course, the switching may be based on periods; it may be carried out during each horizontal scan period. Further, two or more source driver circuits (IC) 14 may operate in the master mode. For example, if four source driver circuits (IC) 14 operate in the master mode, they may control one switch S so as to apply the precharge voltage Vp to the other source driver circuits (IC) 14.

For example, for the first frame, the source driver circuit (IC) 14*a* is set to the master mode, the switch Sa is closed, the source driver circuit (IC) 14*d* is set to the slave mode, and the switch Sb is opened. The other source driver circuits (IC) 14 (14*b* and 14*c*) operate in the slave mode. For the second frame succeeding the first frame, the source driver circuit (IC) 14*d* is set to the master mode, the switch Sb is closed, the source driver circuit (IC) 14*a* is set to the slave mode, and the switch Sa is opened. Similarly, for the third frame succeeding the second frame, the source driver circuit (IC) 14*a* is set to the master mode, the switch Sa is closed, the source driver circuit (IC) 14*d* is set to the slave mode, and the switch Sb is opened. The other source driver circuits (IC) 14 (14*b* and 14*c*) operate in the slave mode.

Figure 58:
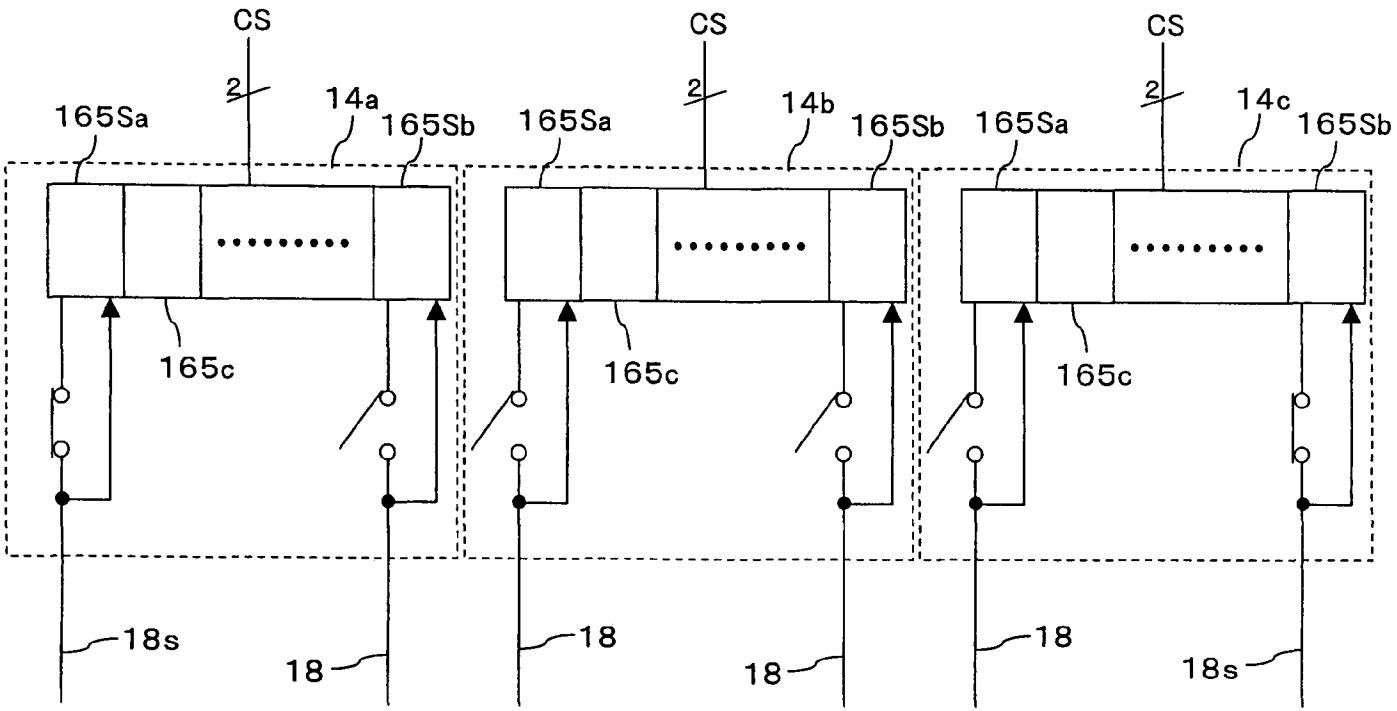
FIG. 58 is a schematic diagram of an EL display panel according to the present invention.

In another embodiment shown in FIG. 58, a 2-bit selector signal (CS) may be used for the switching. In FIG. 58, when CS=1, the transistor group 165Sa in the left of the chip 14*a* is operated. In the chip 14*c*, CS=2. When CS=2, the transistor group 165Sa in the right of the chip 14*c* is operated. In the chip 14*b*, CS=0. When CS=0, neither of the transistor groups 165S on the chip 14*b* is selected.

The transistor group 165*s* may be constructed or placed inside a voltage measuring circuit (IC) 521 in FIG. 52. Further, the A/D conversion circuit 391 may be constructed or placed inside the source driver IC (circuit) 14. The precharge voltages V0 to V5 measured by the voltage measuring circuit IC 521 are supplied (applied) to the source driver circuit (IC) 14 as analog or digital data. If a plurality of source driver circuits (IC) 14 are provided, the precharge voltages V0 to V5 are applied to each of these source driver circuits (IC) 14.

Figure 59:
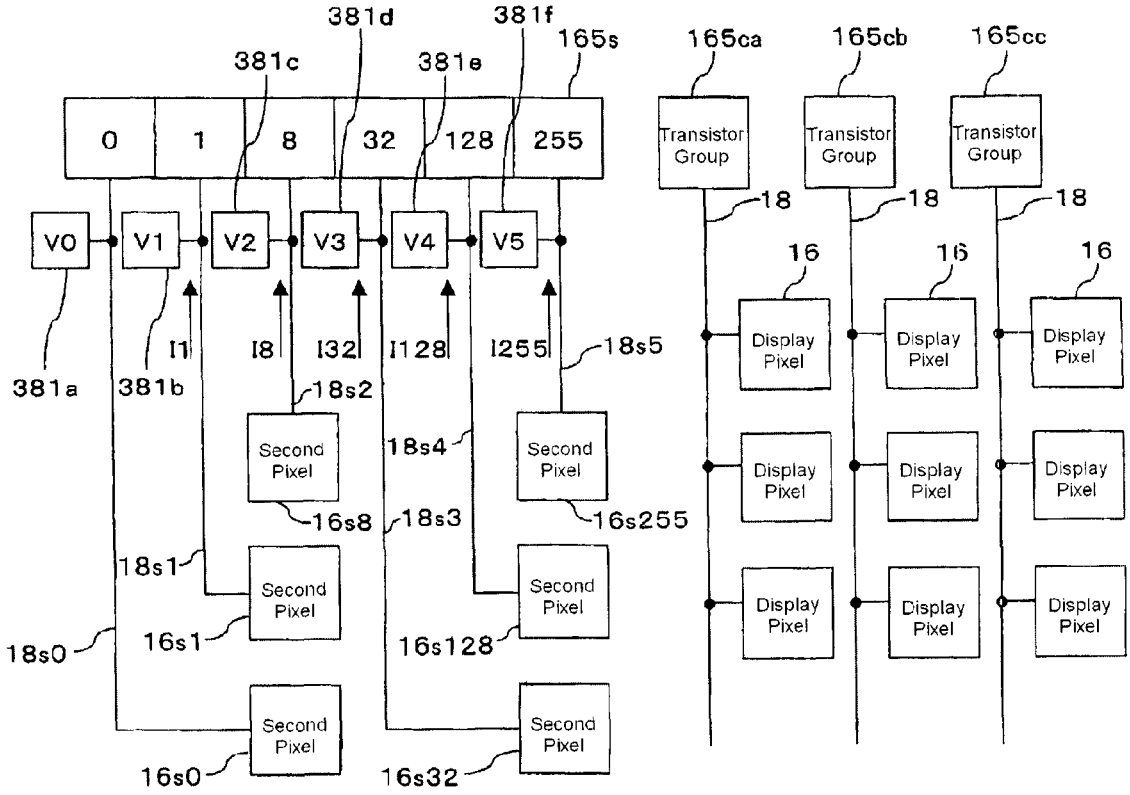
FIG. 59 is a schematic diagram of an EL display panel according to the present invention.

The scheme described in the above embodiments applies a program current from one transistor group 165*s* to one measurement pixel 16*s* to acquire a plurality of precharge voltages Vp. The present invention is not limited to this. As shown in FIG. 59, a program current from one transistor group 165*s* may be applied to a plurality of measurement pixels 16*s* to acquire a precharge voltage Vp.

In the configuration in FIG. 59, the transistor group 165*s* is composed of the unit transistors 164 corresponding to the precharge voltages V0 to V5. In FIG. 59, 10' in the transistor group 165*s* means zero unit transistor generating a precharge voltage V0 (unit transistor group 0). '1' in the transistor group 165*s* means one unit transistor generating a precharge voltage V1 (unit transistor group 1). Similarly, '8' in the transistor group 165*s* means eight unit transistors generating a precharge voltage V2 (unit transistor group 8).

Likewise, '32' in the transistor group 165*s* means 32 unit transistors generating a precharge voltage V3 (unit transistor group 32). '128' in the transistor group 165*s* means 128 unit transistors generating a precharge voltage V4 (unit transistor group 128). '255' in the transistor group 165*s* means 255 unit transistors generating a precharge voltage V5 (unit transistor group 255).

A transistor group 165*s*1 outputs the program current I1. A transistor group 165*s*8 outputs a program current I8. Similarly, a transistor group 165*s*32 outputs a program current I32. A transistor group 165*s*128 outputs a program current I128. A transistor group 165*s*255 outputs a program current I255.

A unit transistor group 165*s*0 is exceptional and has no unit transistors. That is, the current Iw=0. A voltage measuring circuit 381*a* measuring the precharge voltage V0 is connected to a source signal line 18*s*0. A measurement pixel 16*s*0 is also connected to the source signal line 18*s*0. The measurement pixel 16*s*0 sets the voltage corresponding to the precharge voltage V0 for the source signal line 18*s*0. The voltage measuring circuit 381*a* measures and outputs the precharge voltage V0.

One unit transistor is formed or placed in the unit transistor group 165*s*1. Alternatively, the unit transistor group 165*s*1 can output a program current corresponding to the tone 1. The unit transistor group 165*s*1 has a voltage measuring circuit 381*b* connected to a source signal line 18*s*1 to measure the precharge voltage V1. The measurement pixel 16*s*1 is also connected to the unit transistor group 165*s*1. When the program current Iw corresponding to the tone 1 is applied to the measurement pixel 16*s*1, the measurement pixel 16*s*1 sets or adjusts the voltage corresponding to the precharge voltage V1 for the source signal line 18*s*1, or is operated. The voltage measuring circuit 381*b* measures and outputs the precharge voltage V1.

Eight unit transistors are formed or placed in the unit transistor group 165*s*8. Alternatively, the unit transistor group 165*s*8 can output the program current Iw corresponding to the tone 8. For example, one transistor is formed which has a channel width eight times as large as that of the unit transistor. However, the transistor group 165*s* is advantageously composed of a set of identical unit transistors 164 like the transistor group 165*c*. This prevents the output constant current Iw from varying.

The unit transistor group 165*s*8 has a voltage measuring circuit 381*c* connected to a source signal line 18*s*8 to measure the precharge voltage V2. The measurement pixel 16*s*2 is also connected to the unit transistor group 165*s*8. When the program current Iw=I8 corresponding to the tone 8 is applied to the measurement pixel 16*s*2, the measurement pixel 16*s*2 sets or adjusts the voltage corresponding to the precharge voltage V2 for a source signal line 18*s*2, or is operated. The voltage measuring circuit 381*c* measures and outputs the precharge voltage V2.

Likewise, the unit transistor group 165*s*32 has a voltage measuring circuit 381*d* connected to a source signal line 18*s*3 to measure the precharge voltage V3. The measurement pixel 16*s*3 is also connected to the unit transistor group 165*s*32. When the program current Iw=I32 corresponding to the tone 32 is applied to the measurement pixel 16*s*3, the measurement pixel 16*s*3 sets or adjusts the voltage corresponding to the precharge voltage V3 for a source signal line 18*s*3, or is operated. The voltage measuring circuit 381*d* measures and outputs the precharge voltage V3.

The unit transistor group 165*s*128 has a voltage measuring circuit 381*e* connected to a source signal line 18*s*4 to measure the precharge voltage V4. The measurement pixel 16*s*4 is also connected to the unit transistor group 165*s*128. When the program current Iw=I128 corresponding to a tone 128 is applied to the measurement pixel 16*s*4, the measurement pixel 16*s*4 sets or adjusts the voltage corresponding to the precharge voltage V4 for a source signal line 18*s*4, or is operated. The voltage measuring circuit 381*e* measures and outputs the precharge voltage V4.

Likewise, the unit transistor group 165*s*255 has a voltage measuring circuit 381*f* connected to a source signal line 18*s*5 to measure the precharge voltage V5. The measurement pixel 16*s*5 is also connected to the unit transistor group 165*s*255. When the program current Iw=I255 corresponding to the tone 255 is applied to the measurement pixel 16*s*5, the measurement pixel 16*s*5 sets or adjusts the voltage corresponding to the precharge voltage V5 for a source signal line 18*s*5, or is operated. The voltage measuring circuit 381*f* measures and outputs the precharge voltage V5.

Figure 60:
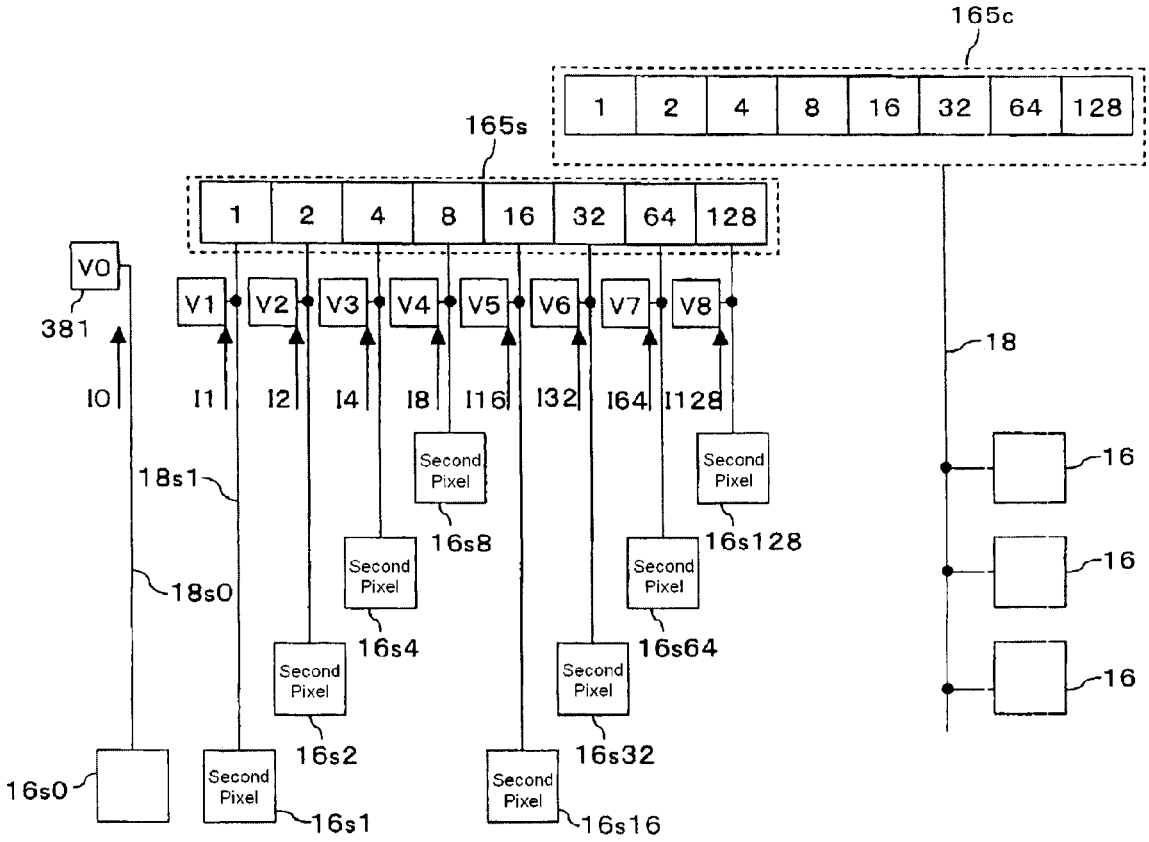
FIG. 60 is a schematic diagram of an EL display panel according to the present invention.

FIG. 59 shows the case of the precharge voltages V0 to V5. However, the present invention is not limited to the V0 to V5. As shown in FIG. 60, precharge voltages V0 to V8 may be used. Further, the precharge voltage Vp may be set at any of the voltages V0 to V255. The other arrangements are similar to those shown in FIG. 59 and will thus not be described below.

First pixels in accordance with the present invention are formed in a matrix to display an image. Second pixels in accordance with the present invention correspond to, for example, the pixels 16*s*0, 16*s*1, 16*s*8, 16*s*32, 16*s*128, and 16*s*255 in FIG. 59. The pixels 16*s*0, 16*s*1, 16*s*2, 16*s*4, 16*s*8, 16*s*16, 16*s*32, 16*s*64, and 16*s*128 in FIG. 60 also correspond to the second pixels in accordance with the present invention. The 16S in FIG. 73 also corresponds to the second pixel in accordance with the present invention. The second pixels in accordance with the present invention may be arranged in a matrix like the pixels 16S in FIG. 75.

The first and second pixels in accordance with the present invention correspond to examples of the pixels in accordance with the present invention.

In the above embodiments, the source signal line 18*s* and the measurement pixel 16*s* are formed, and the program current Iw is applied to the source signal line 18*s*. The voltage measuring circuit 381 then measures the potential of the source signal line 18*s*. However, the present invention is not limited to this. For example, the program current Iw may be applied to the source signal line 18 and pixel 16 formed in the display screen 34. The potential of the source signal line 18 may then be measured to acquire the precharge voltage Vp.

Figure 61:
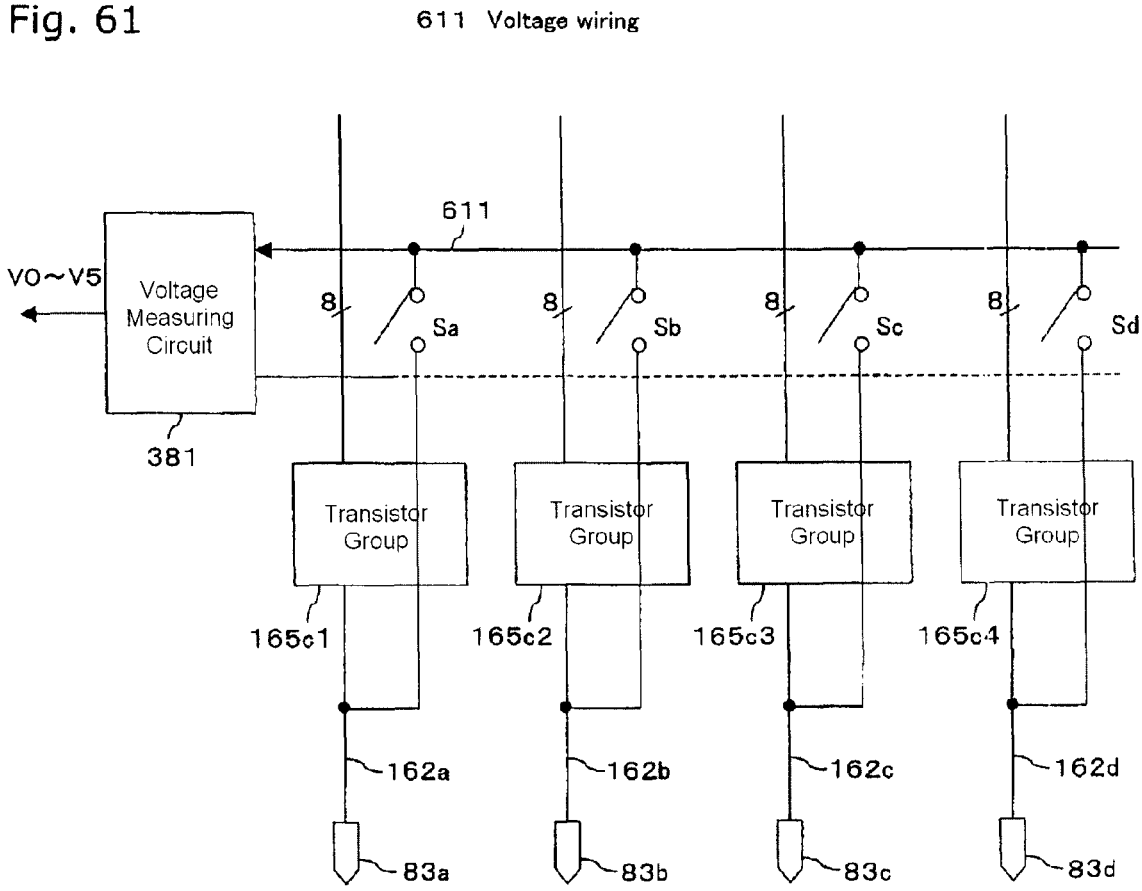
FIG. 61 is a schematic diagram of an EL display panel according to the present invention.

FIG. 61 shows an embodiment of this circuit configuration. The basic configuration and operation of this configuration are the same as that previously described. The present embodiment is obtained simply by replacing the source signal line 18*s* and pixel 16*s* with the source signal line 18 and pixel 16, respectively. Accordingly, the configuration and operation of the present embodiment are the same as or similar to those previously described and will thus not be described. That is, the display pixels 16 formed in a matrix are used to measure or acquire the precharge voltage Vp without the need to separately form a measurement pixel 16*s*.

In addition to these arrangements, FIG. 61 shows an arrangement for using the switch S (Sa, Sb, Sc, . . . Sn) to select from the precharge voltages Vp measured across the source signal lines 18. For example, if the transistor group 165*c*1 outputs a program current allowing the precharge voltage Vp to be measured, the switch Sa is selected to apply the precharge voltage Vp to the voltage measuring circuit 381. If the transistor group 165*c*2 outputs a program current allowing the precharge voltage Vp to be measured, the switch Sb is selected to apply the precharge voltage to the voltage measuring circuit 381.

Of course, if the program current Iw allowing the precharge voltage Vp to be measured is applied to all or a plurality of the source signal lines 18, the switches S connected to the corresponding source signal lines are selected or sequentially selected to apply the precharge voltage Vp to the voltage measuring circuit 381.

The circuit for generating a program current Iw may be constructed or located outside the source driver IC (circuit) 14. A constant current output by the circuit generating a program current Iw is applied to the source signal line 18. Further, the constant current is not limited to a fixed value. Of course, the constant current may be varied every given period of time. The constant current may be varied like a pulse. The above mentioned are applicable to the other embodiments of the present invention.

In FIG. 61, the number of switches S selected is not limited to one. A plurality of switches S may be simultaneously selected so that the corresponding precharge voltages are applied to the voltage measuring circuit 381. For example, all transistor groups 165*c* output the program current corresponding to the tone 1. The gate signal line 17*a* is then selected to operate the driving transistor 11*a* in the pixel 16 connected to the source signal line 18 to which the program current corresponding to the tone 1 is applied.

The driving transistor 11*a* in each pixel 16 outputs the program current corresponding to the tone 1, to each source signal line 18. At this time, the switch is closed which connects to the source signal line 18 subjected to the program current corresponding to the tone 1. Then, each source signal line is short-circuited by voltage wiring 611. Consequently, the potentials of the source signal lines 18 have the same value. This voltage V1 is obtained by averaging the precharge voltages Vp from the source signal lines 18, which correspond to the tone 1. Therefore, a good precharge voltage V1 can be acquired by allowing the voltage measuring circuit 3811 to measure the precharge voltage V1 across the voltage wiring 611. This applies to the measurement of the precharge voltages Vp corresponding to the other tones.

In the above embodiments, the precharge voltage Vp is acquired by applying the program current Iw (including Iw=0 (A)) corresponding to the tone to all source signal lines 18 and closing all switches S. However, the present invention is not limited to this. Of course, the precharge voltage Vp may be acquired by applying the program current corresponding to the tone to an arbitrary number of source signal lines 18 and closing the arbitrary selected switches S. For example, the following process may be executed. The switches for the even-numbered source signal lines 18 are closed, and the voltage Vp is measured. In the next timing, the switches for the odd-numbered source signal lines 18 are closed, and the voltage Vp is measured. It is also possible to sequentially select two or four switches to allow the precharge voltage Vp to be sequentially measured.

The program current corresponding to the same tone need not be applied to all source signal lines 18. For example, the following process may be executed. The program current corresponding to the tone 1 is applied to the odd-numbered transistor groups 165. The program current corresponding to the tone 32 is applied to the even-numbered transistor groups 165. The switches connected to the odd-numbered source signal lines 18 are then closed. The precharge voltage V1 corresponding to the tone 1 is then measured. The switches connected to the even-numbered source signal lines 18 are then closed. The precharge voltage V3 corresponding to the tone 32 is then measured.

The number of source signal lines 18 selected need not be equal to that of switches selected. If the program current is applied to 32 source signal lines 18, only the switches connected to 16 source signal lines 18 may be selected and closed. Further, the time required to measure the precharge voltage Vp is effectively reduced by applying the constant current Iw to the source signal line 18 before the corresponding switch S is closed.

Of course, the program current applied to each source signal line 18 and corresponding to the tone may be sequentially varied so as to allow the sequential measurement of the precharge voltage Vp. Further, the apparatus is preferably configured or operated so as to periodically change the source signal line 18 to measure each precharge voltage Vp rather than using the fixed source signal line 18 to measure a precharge voltage Vp in a particular tone.

A measurement period and a wait period (period of time before measurement is carried out) for the precharge voltage Vp to be measured preferably vary with the tone. The apparatus is provided with a program function for varying the wait period in accordance with an instruction from the controller circuit (IC) 801. The wait time is varied because, for example, the V1 voltage involves a smaller program current and thus requires a long time for completion of a change in the potential of the source signal line 18. Furthermore, the V5 voltage corresponding to the tone 255 involves a larger program current and thus requires only a short time for completion of a change in the potential of the source signal line 18. This leads to the need of little wait time. Further, the formation of a plurality of voltage measuring circuits 381 enables a plurality of precharge voltages Vp to be simultaneously measured. This makes it possible to reduce the time (period) required for measurement of the precharge voltage Vp.

In the embodiment shown in FIG. 61, the pixels 16 in the display screen 34 are used to measure the precharge voltage Vp. Consequently, the precharge voltage Vp cannot be measured during the display of an image. However, when the program current for the tone of the display image matches the program current used to acquire the precharge voltage Vp, the precharge voltage Vp can of course be acquired.

Figure 62:
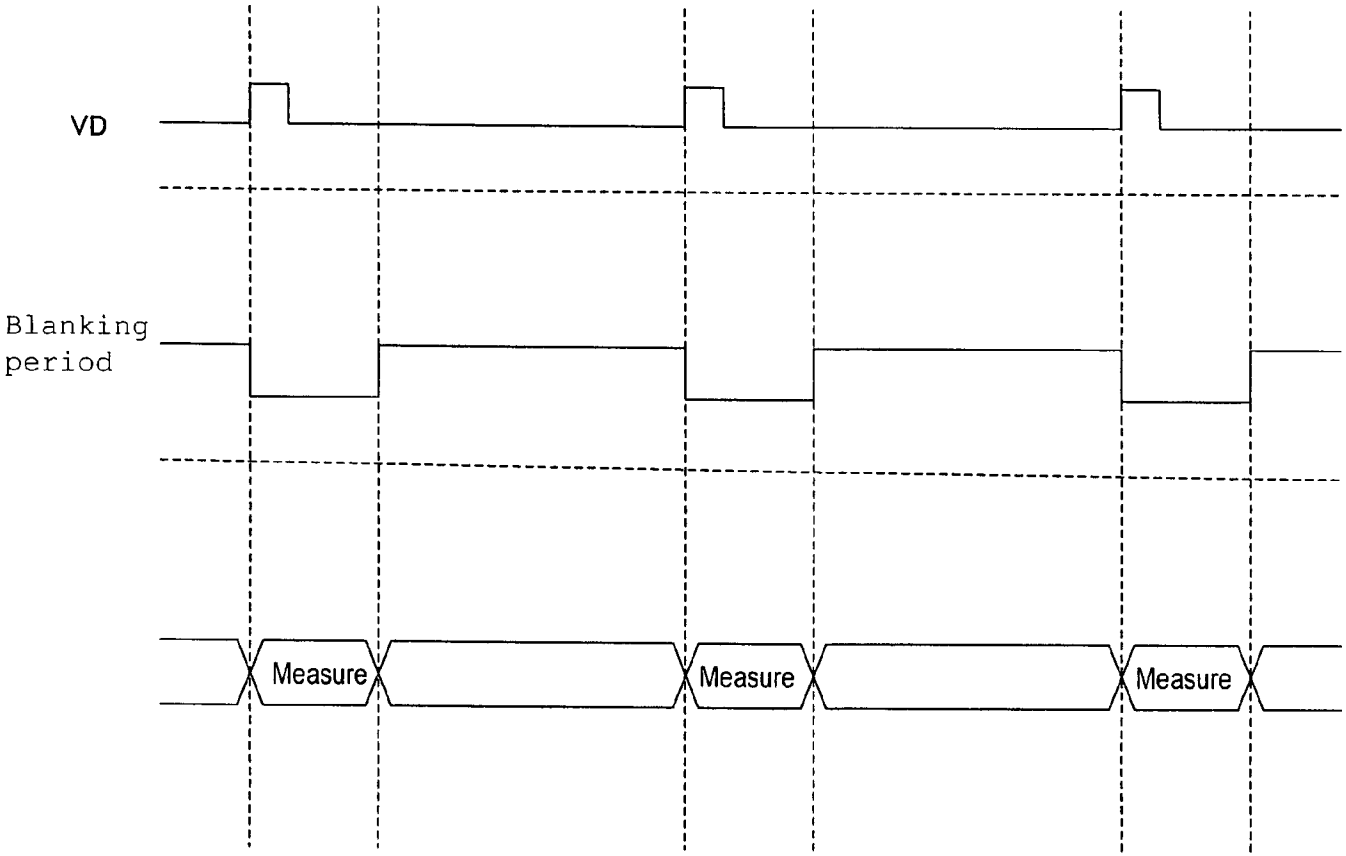
FIG. 62 is a schematic diagram of a driving method of an EL display panel according to the present invention.

Basically, the precharge voltage Vp is acquired during a blanking period corresponding to one field or frame or one horizontal scan period, as shown in FIG. 62. During a blanking period, the program current corresponding to the precharge current Vp is applied to the source signal line 18. The voltage measuring circuit 381 then measures the precharge voltage Vp.

Figure 63:
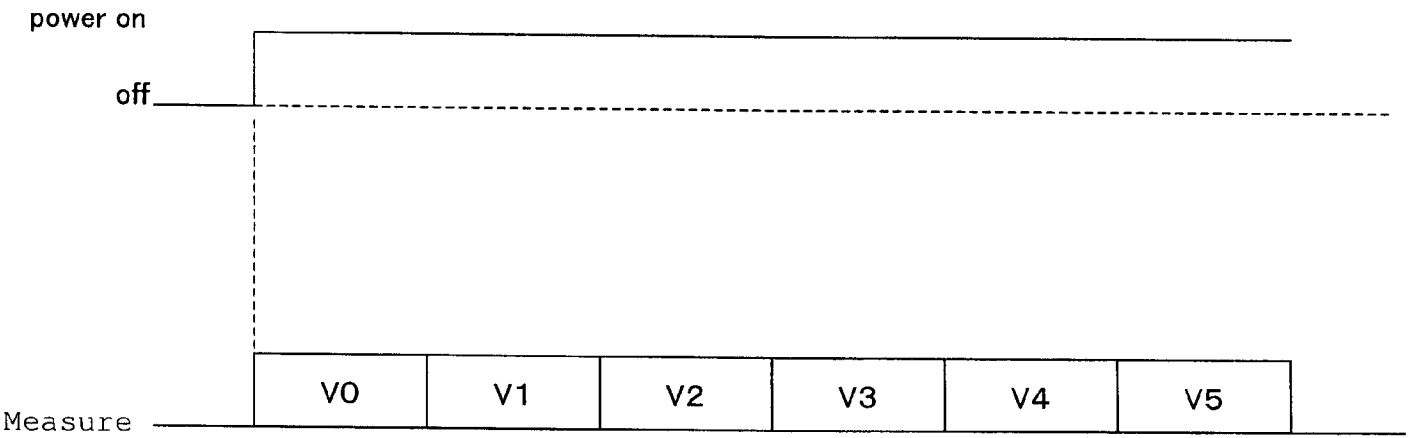
FIG. 63 is a schematic diagram of a driving method of an EL display panel according to the present invention.

As shown in FIG. 63, before image display, that is, before the power supply to the display apparatus is turned on (power ON) to display an image, a program current corresponding to a recharge voltage may be applied to the source signal line 18 so that the voltage measuring circuit 381 can measure the precharge voltage Vp.

Moreover, a measured precharge voltage Vp or a precharge voltage Vp measured during the preceding operation may be digitalized and stored in the memory of the display apparatus. During the next operation, a precharge voltage Vp may be generated using the stored digital data as an initial voltage (start voltage). Alternatively, on the basis of the digital data corresponding to the precharge voltage Vp, the corresponding constant current Iw is calculated or determined and then applied to the source signal line 18.

In the embodiment shown in FIG. 63, the precharge voltage Vp is measured before image display. However, the present invention is not limited to this. For example, before the power supply to the display apparatus has been turned off, the precharge voltage Vp may be measured and the measured data may be written to and held in the flash memory. That is, in the present invention, the precharge voltage Vp may be measured at any time provided that the measured precharge voltage Vp is used.

In the embodiments of the present invention, the voltage measuring circuit 381 measures the voltage across the source signal line 18. However, the present invention is not limited to this. The voltage measuring circuit 381 may measure the voltage across any line as long as the potential can be falsely varied as with the source signal line 18. For example, the voltage measuring circuit 381 may measure the voltage across separately formed wiring. Alternatively, the voltage measuring circuit 381 may be connected directly to the gate terminal of the driving transistor 11*a* in the measurement pixel 16*s*. Alternatively, a probe needle may be brought into pressure contact with the gate terminal of the driving transistor 11*a* in the pixel 16 to measure the potential (voltage).

The function of the voltage measuring circuit 381 is not limited to the measurement of the potential (voltage) across the source signal line 18. The voltage measuring circuit 381 may determine the precharge voltage Vp from charges in or electric fields from the source signal line 18. Alternatively, the voltage measuring circuit 381 may determine the precharge voltage Vp from the speed of a variation in the magnitude of charges or electric fields. For example, a pickup coil may be placed on the pixel 16 so that the precharge voltage Vp can be indirectly acquired on the basis of the magnitude of lines of electric force emitted by the pixel 16. It is also possible to irradiate the pixel 16 with electron beams to measure the magnitude of electrons.

In the above embodiments, the program current is applied to one measurement pixel 16*s* so that the voltage measuring circuit 381 can measure the potential across the source signal line 18. The present invention is not limited to this. For example, as shown in FIG. 64, a plurality of pixels 16 (16*a* to 16*n*) may be operated so that the voltage measuring circuit 381 can measure the voltage across each of the corresponding source signal lines 18.

Figure 64:
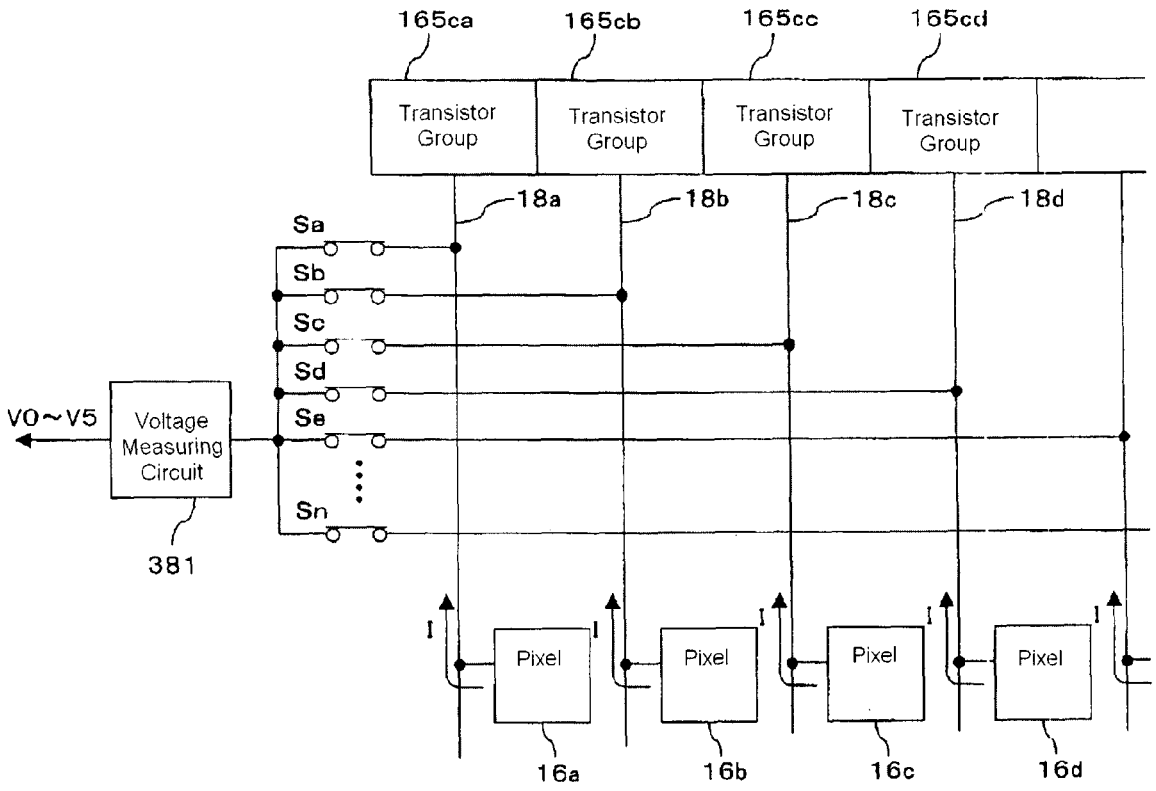
FIG. 64 is a schematic diagram of an EL display panel according to the present invention.

In FIG. 64, each transistor group 165*c* applies a program current to the display pixel 16, and the driving transistor 11*a* in the display pixel 16 is operated. For example, the transistor group 165*ca* applies, to the pixel 16*a*, the program current corresponding to a predetermined precharge voltage Vp to be measured. The driving transistor 11*a* in the pixel 16*a* conducts the program current to change the potential across the source signal line 18*a* to a value corresponding to the program current.

The transistor group 165*cb* applies, to the pixel 16*b*, the program current corresponding to a predetermined precharge voltage Vp to be measured. The driving transistor 11*a* in the pixel 16*b* conducts the program current to charge or discharge the source signal line 18*b* so that its voltage reaches a value corresponding to the program current. Similarly, the transistor group 165 cc applies, to the pixel 16*c*, the program current corresponding to a predetermined precharge voltage Vp to be measured. The driving transistor 11*a* in the pixel 16*c* conducts the program current to charge or discharge the source signal line 18*c* so that its voltage reaches a value corresponding to the program current.

The voltage measuring circuit 381 closes the switch Sa to measure the precharge voltage Vp held in the source signal line 18*a*. The voltage measuring circuit 381 also closes the switch Sb to measure the precharge voltage Vp held in the source signal line 18*b*. Likewise, the voltage measuring circuit 381 closes the switch Sc to measure the precharge voltage Vp held in the source signal line 18*c*.

Further, the voltage measuring circuit 381 simultaneously selects any of the plurality of switches S (Sa to Sn). Selection of a plurality of switches S averages the precharge voltages Vp held in the selected plurality of source signal lines 18. This enables the acquisition of a precharge voltage Vp reflecting the characteristics of the driving transistor 11*a* in the display area.

As described above, the present invention allows a plurality of pixels 16 to be selected so as to enable the measurement of the precharge voltage Vp held in each of the corresponding source signal lines 18. Alternatively, a plurality of source signal lines 18 may be selected so as to enable their precharge voltages Vp to be measured. Alternatively, an n-times program current may be applied to one or more pixels 16 to operate the driving transistors 11*a* in the pixels 16 to charge or discharge the corresponding source signal lines 18 so that their potentials can be measured. The measured potentials across the source signal lines 18 are calculated to acquire precharge voltages Vp.

The internal wiring 162 in the source driver IC (circuit) 14 is connected to the source signal line 18 via an output terminal 83. The present invention acquires the precharge voltage Vp by measuring the potential of the source signal line 18 or the potential across the internal wiring 162 in the source driver IC (circuit) 14. However, the precharge voltage Vp measured (acquired) by the voltage measuring circuit 381 may not be used as it is. For example, the precharge voltage Vp corresponding to the 0 or 1 tone realizes a perfect black display. This precharge voltage Vp thus needs to be biased toward the anode (shifted toward the anode voltage) compared to that acquired by using the transistor group 165 to apply the program current corresponding to the 0 or 1 tone. This applies to the case where the driving transistor 11*a* is of the P channel type and where the source terminal of the transistor is connected to the anode terminal.

Figure 65:
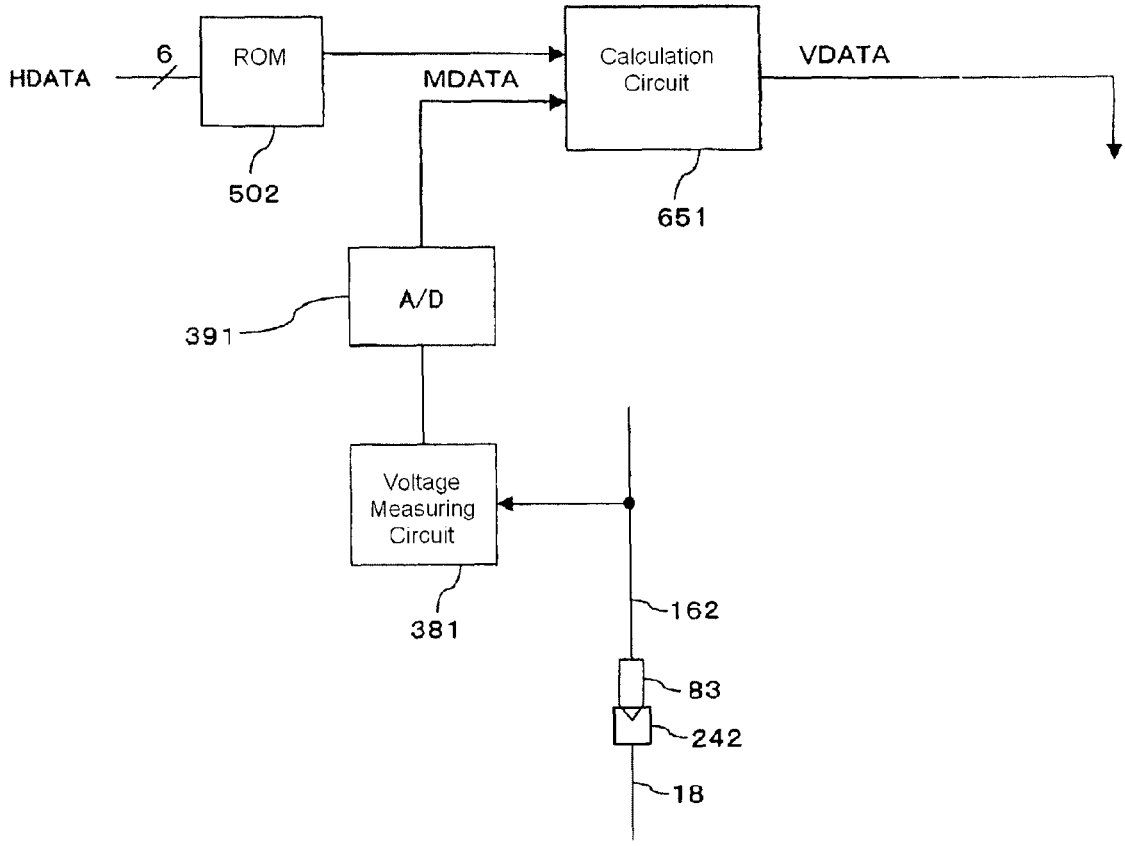
FIG. 65 is a schematic diagram of an EL display panel according to the present invention.

FIG. 65 shows a scheme for solving the above problem. The precharge voltage Vp measured by the voltage measuring circuit 381 is converted into digital data MDATA by the A/D conversion circuit 391. On the other hand, data HDATA is held in a latch circuit 221; the data HDATA indicates the amount by which the precharge voltage Vp is shifted toward the anode voltage. The HDATA is set by the controller circuit (IC) 801, located outside the source driver IC (circuit) 14.

A calculation circuit 651 adds the HDATA and MDATA together to obtain target VDATA. The digital data VDATA is converted into analog data, which is then output as a precharge voltage Vp or input to the electronic regulator 152. In this operation, the HDATA and MDATA are added together. However, the VDATA may be determined by a subtraction. The VDATA may of course be determined by weighting the HDATA or MDATA at a given rate. This of course applies to the other embodiments of the present invention.

Figure 66:
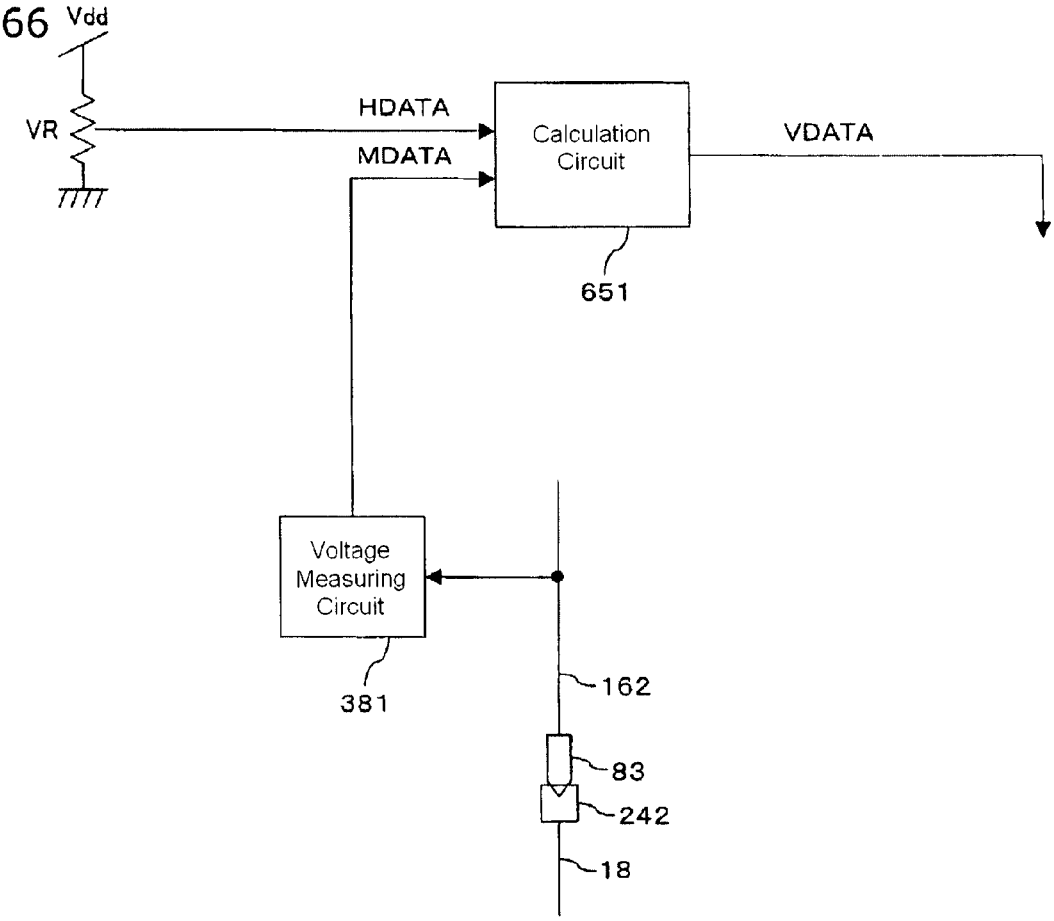
FIG. 66 is a schematic diagram of an EL display panel according to the present invention.

Description has been given of the method of processing measured data or the like by converting it into a digital signal. However, the present invention is not limited to this. As shown in FIG. 66, an analog process may be executed instead. The precharge voltage Vp measured by the voltage measuring circuit 381 is applied to the calculation circuit 651 as analog data MDATA. On the other hand, a variable resistor VR generates data HDATA indicating the amount by which the precharge voltage Vp is shifted toward the anode voltage. In this case, the HDATA is an analog value. The calculation circuit 651 adds the HDATA and MDATA together to obtain target VDATA. The digital data VDATA is then converted into analog data, which is then applied to the electronic regulator 152 and the like.

The HDATA and VDATA shown in FIGS. 65 and 66 and others may be varied depending on temperature. These data may also be varied depending on the display luminance of the panel. The temperature is detected by a temperature sensor. The display luminance is indirectly detected or acquired via a current flowing through the anode. Of course, the display luminance may be a luminance meter or a photo sensor. The temperature sensor may be, for example, a thermistor.

Figure 67:
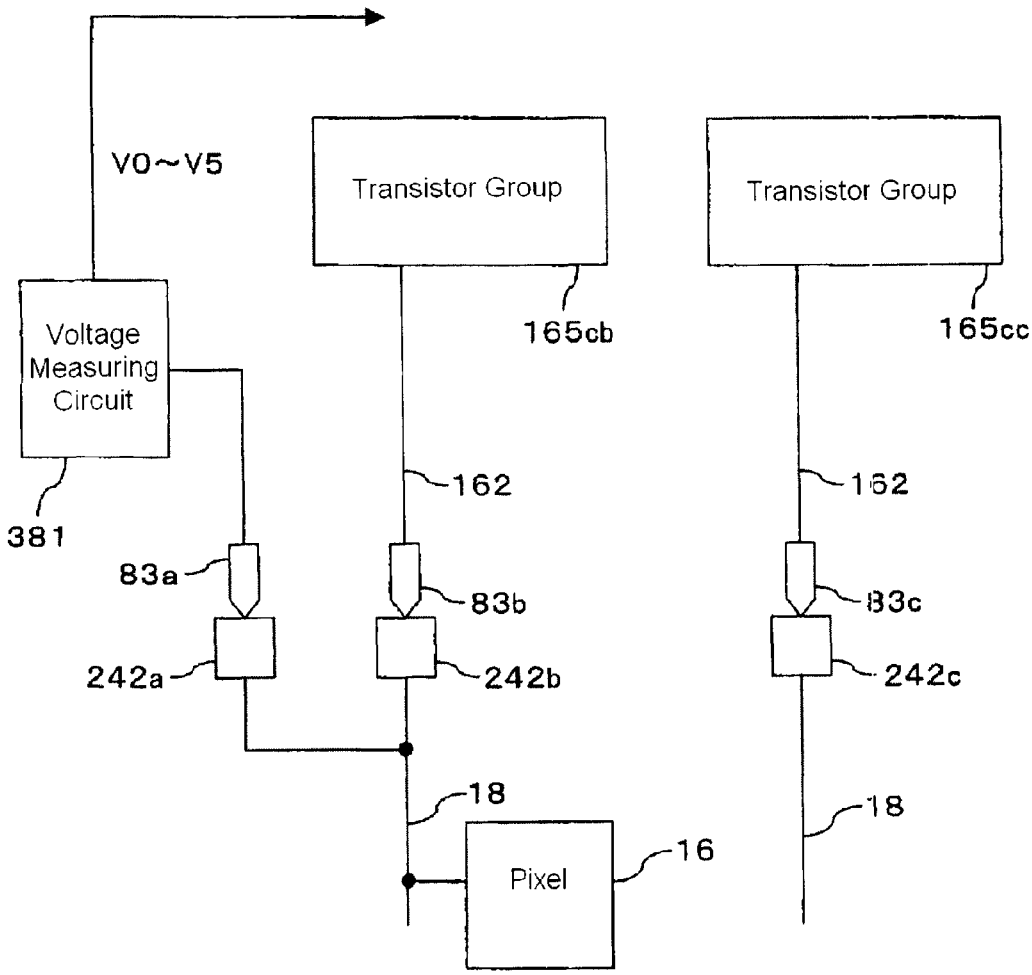
FIG. 67 is a schematic diagram of an EL display panel according to the present invention.

The precharge voltages V0 to V5 are acquired by applying the corresponding program current Iw to the pixel 16. In FIG. 67, the transistor group 165*cb* outputs the program current Iw to operate the pixel 16. To measure the voltage V0, no program current is passed through the source signal line 18. That is, the source signal line 18 is floating. The gate and drain terminals of the driving transistor 11*a* in the selected pixel 16 are short-circuited. The short circuit changes the gate terminal potential so that the transistor 11*a* will not output any current. The completely changed potential is equal to the V0 voltage. The voltage measuring circuit 381 measures and outputs the voltage V0. The output voltage is subjected to an A/D conversion and then stored in the memory (storage means).

The transistor group 165*cb* outputs the program current corresponding to the voltage V1. The voltage measuring circuit 381 measures and outputs the voltage V1. Similarly, the transistor group 165*cb* outputs the program current corresponding to the voltage V2. The voltage measuring circuit 381 measures and outputs the voltage V2. This operation is repeated until the V5 is processed. Once the V5 is processed, the same process is executed again starting with the operation of measuring (acquiring) the V0.

In FIG. 67, the voltage measuring circuit 381 is connected to the output terminal 83*a*. The transistor group 165*cb* is connected to the output terminal 83*b*. The output terminal 83*a* contacts a source signal line terminal 242*a* on the array board 30 for electric connection. The output terminal 83*b* contacts a source signal line terminal 242*b* on the array board 30 for electric connection.

In FIG. 48 and others, the terminal of the voltage measuring circuit 381 is the same as the output terminal 83*s* of the transistor group 165. In FIG. 67, the output terminal 83*b* of the transistor group 165*c* is separate from the output terminal 83*a* of the voltage measuring circuit 831. The configuration in FIG. 67 increases the number of terminals but enables the voltage measuring circuit 381 and the transistor group 165*c* to be separately inspected.

Figure 68:
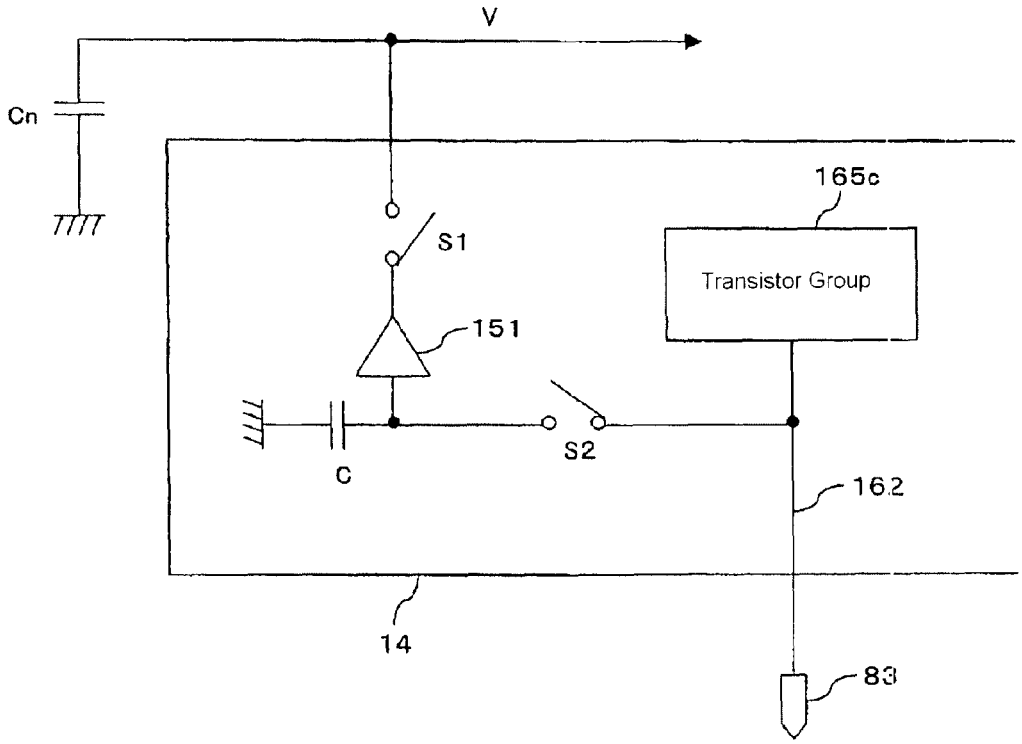
FIG. 68 is a schematic diagram of an EL display panel according to the present invention.

In the above embodiments, the voltage measuring circuit 381 measures the potential across the source signal line 18. The concept or operation of the voltage measuring circuit 381 or the memory storing operation involve a sample hold circuit as shown in FIG. 68. For example, the sample hold circuit is composed of the switches S1 and S2, the capacitor C, and the operational amplifier 151.

As shown in FIG. 68, the program current Iw output by the transistor group 165*c* is applied to the source signal line 18 through the internal wiring 162 and output terminal 183 of the source driver IC (circuit) 14. The program current Iw is then supplied to the pixel 16. The precharge voltage Vp corresponding to the program current Iw is output to the source signal line 18. The precharge voltage Vp is applied to the internal wiring 162.

The switch S2 is closed to apply the precharge voltage Vp to the capacitor C. Even if the switch S2 is subsequently closed, the precharge voltage Vp is held. The precharge voltage Vp has its impedance reduced by the operational amplifier 151 and is then output. The switch S1 is closed to hold the precharge voltage Vp in Cn. The held precharge voltage Vp is applied to the electronic regulator 152 and others. The above configuration or scheme also involves the voltage measuring circuit 381. The configuration in FIG. 68 also shares a memory circuit that holds the precharge voltage Vp. This enables a reduction in costs.

Figure 69:
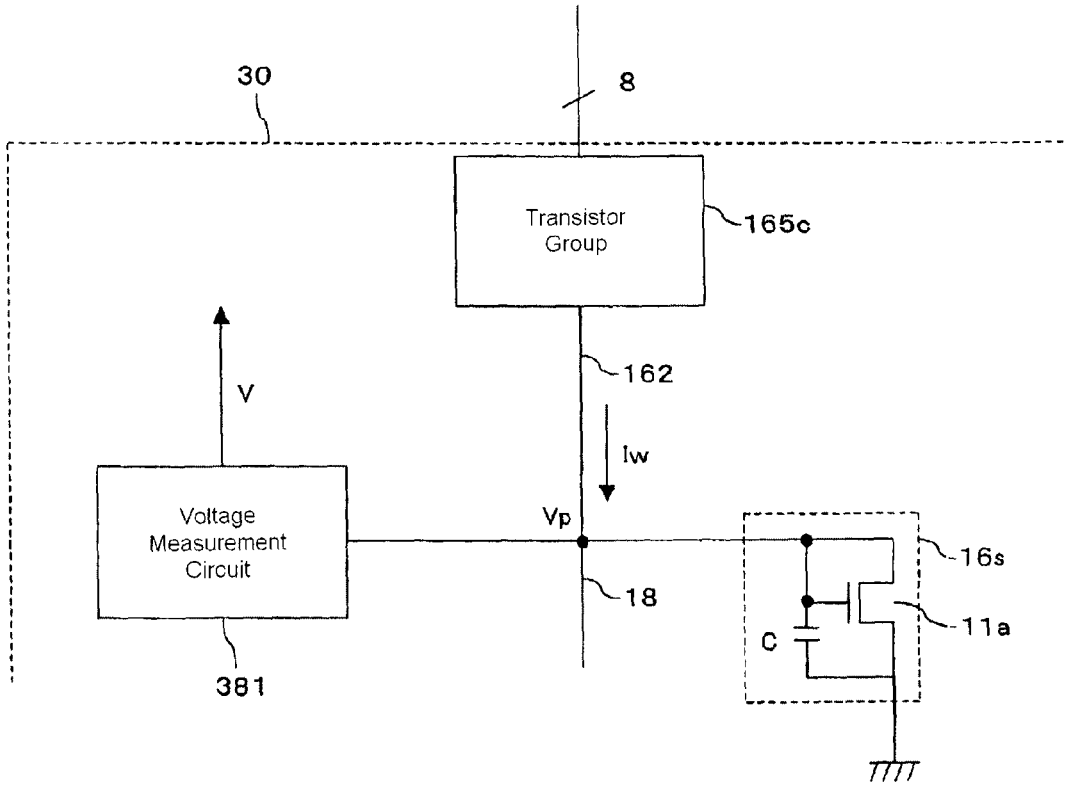
FIG. 69 is a schematic diagram of an EL display panel according to the present invention.

In the above configuration, the transistor group 165*s* and others are formed into a semiconductor chip. However, as shown in FIG. 69, one or both of the transistor group 165*c* and voltage measuring circuit 381 may be constructed or formed directly on the array board 30. Further, as shown in FIG. 69, the driving transistor 11*a* in the pixel 16 or measurement pixel 16*s* may be of the N channel type instead of the P channel type.

As shown in FIG. 69, the program current Iw output by the transistor group 165*c* operates the driving transistor 11*a*. The source signal line 18 outputs the voltage corresponding to the precharge voltage Vp (the precharge voltage Vp can be considered to be applied to the source signal line 18 by the program current Iw), which is measured by the voltage measuring circuit 381, formed on the array board 30. Of course, the transistor group 165*c* may be formed directly on the array board 30, while the voltage measuring circuit 381 may be formed into a semiconductor chip.

In the display panel, independent transistor groups 165*c* are formed for R, G, and B. The precharge voltage Vp=V0 corresponding to the tone 0 can be shared by the R, G, and B. The V1 to Vn are set for other precharge voltage Vp. The R, G, and B offer different light emission efficiencies for the program current Iw. Of course, if the same or substantially the same program current is used for the R, G, and B, then for each tone, the same precharge voltage Vp may be used for the R, G, and B.

Figure 70:
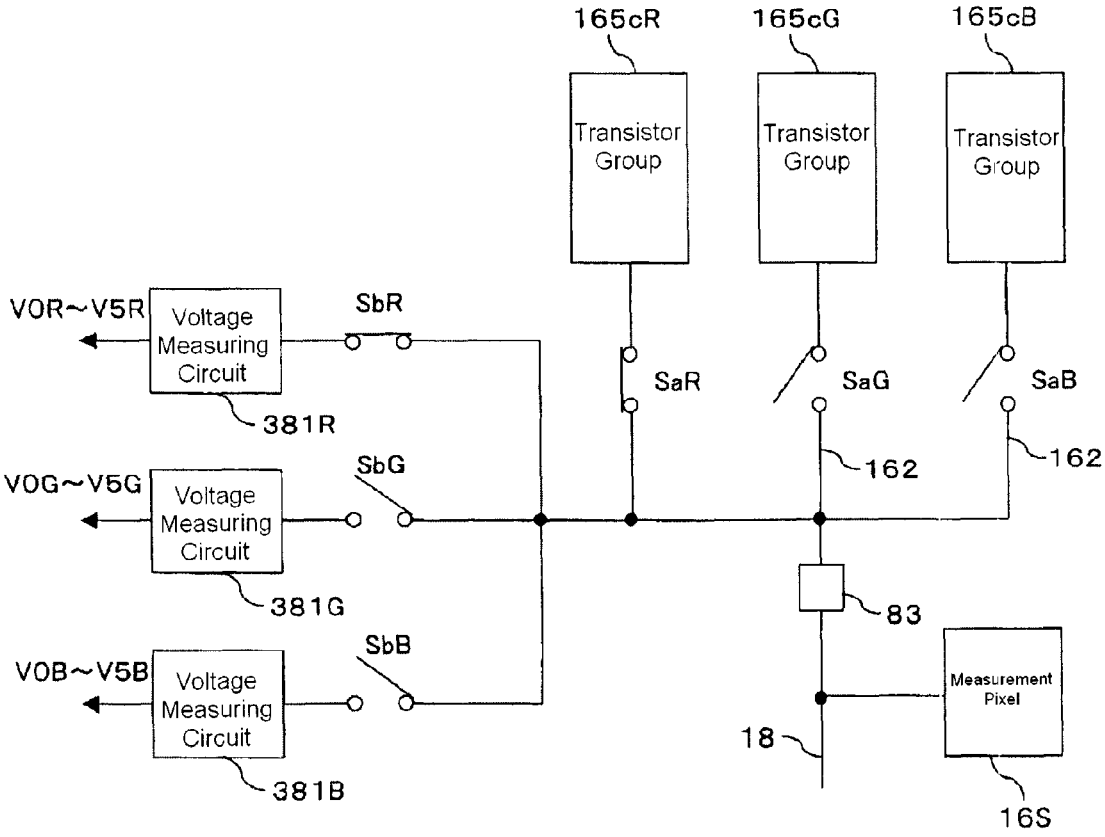
FIG. 70 is a schematic diagram of an EL display panel according to the present invention.

If the precharge voltage Vp varies among the R, G, and B, the apparatus is configured as shown in FIG. 70. The transistor group 165*c* (165*c*R, 165*c*G, or 165*c*B) is selected by the switch Sa (SaR, SaG, or SaB) and connected to the internal wiring 162 in the source driver IC (circuit) 14. The switches Sa and Sb may be analog switches or transistors. The switches Sa and Sb correspond to selected means. The internal wiring 162 is connected to the measurement pixel 16S via the output terminal 83. Consequently, the switch Sa (SaR, SaG, or SaB) selects the transistor group 165*c* (165*c*R, 165*c*G, or 165*c*B) so that the program current I from the transistor group 165*c* is applied to the voltage measurement pixel 16S (or pixel 16).

The program current from the transistor group 165*c*R is applied to the measurement pixel 16S by closing the switch SaR. Closing the switch SaR closes the SbR to apply the potential across the source signal line 18 to an R voltage measuring circuit 381R, which measures or acquires a precharge voltage V0R to VmR (m is the maximum number value of the precharge voltage Vp).

The program current from the transistor group 165*c*G is applied to the measurement pixel 16S by closing the switch SaG. Closing the switch SaG closes the SbG to apply the potential across the source signal line 18 to a G voltage measuring circuit 381G, which measures or acquires a precharge voltage V0G to VmG.

The program current from the transistor group 165*c*B is applied to the measurement pixel 16S by closing the switch SaB. Closing the switch SaB closes the SbB to apply the potential across the source signal line 18 to a B voltage measuring circuit 381B, which measures or acquires a precharge voltage V0B to VmB.

Figure 71:
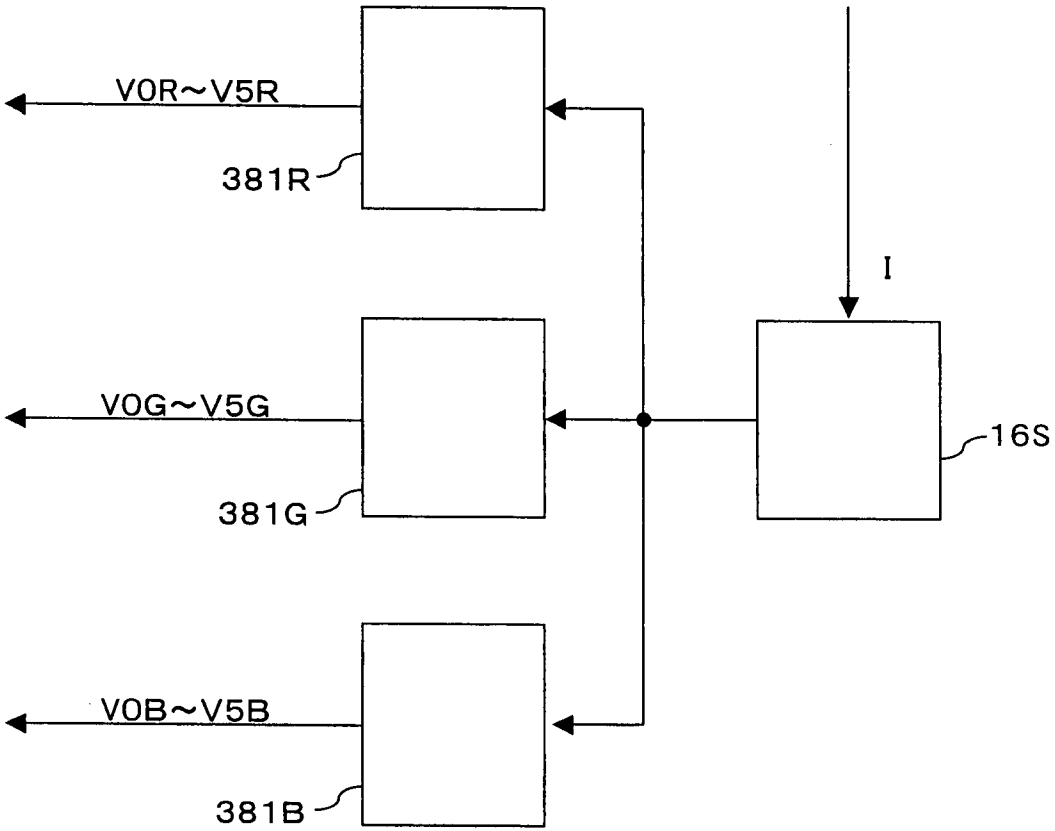
FIG. 71 is a schematic diagram of an EL display panel according to the present invention.

One voltage measuring circuit 381 may be used as each of the voltage measuring circuits 381R, 381G, and 381B. The internal wiring 162 and the measurement pixel 16S may each be separated into three pieces for the R, G, and B. Further, as shown in FIG. 71, the switch Sb may be omitted.

Figure 72:
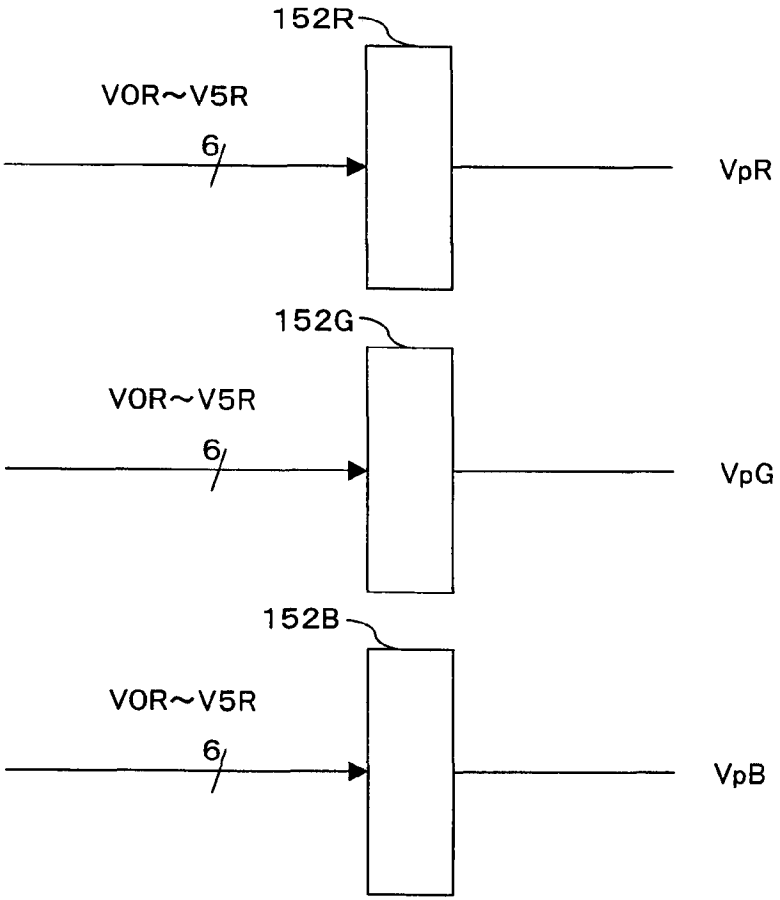
FIG. 72 is a schematic diagram of an EL display panel according to the present invention.

FIG. 72 is a diagram showing a configuration in which different precharge voltages Vp are used for the R, G, and B. A digitalized precharge voltage Vp is applied to the electronic regulator 152. Precharge voltages V0R to V5R are applied to an electronic regulator 152R. Precharge voltages V0G to V5G are applied to an electronic regulator 152G. Precharge voltages V0B to V5B are applied to an electronic regulator 152B.

The program current I output by the transistor group 165*s* or 165*c* may be multiplied by n before output. The multiplication by n is illustrated in FIG. 6 and others. If the n-times program current is applied to acquire a precharge voltage Vp, n driving transistors 11*a* are formed in the measurement pixel 16*s*. Alternatively, the apparatus may be configured or formed so that the n-times program current is used to obtain a predefined precharge voltage Vp (precharge voltage Vp acquired if the pixel 16 is composed of one driving transistor 11*a*). Alternatively, the magnitude of the program current may be set or adjusted.

Figure 73:
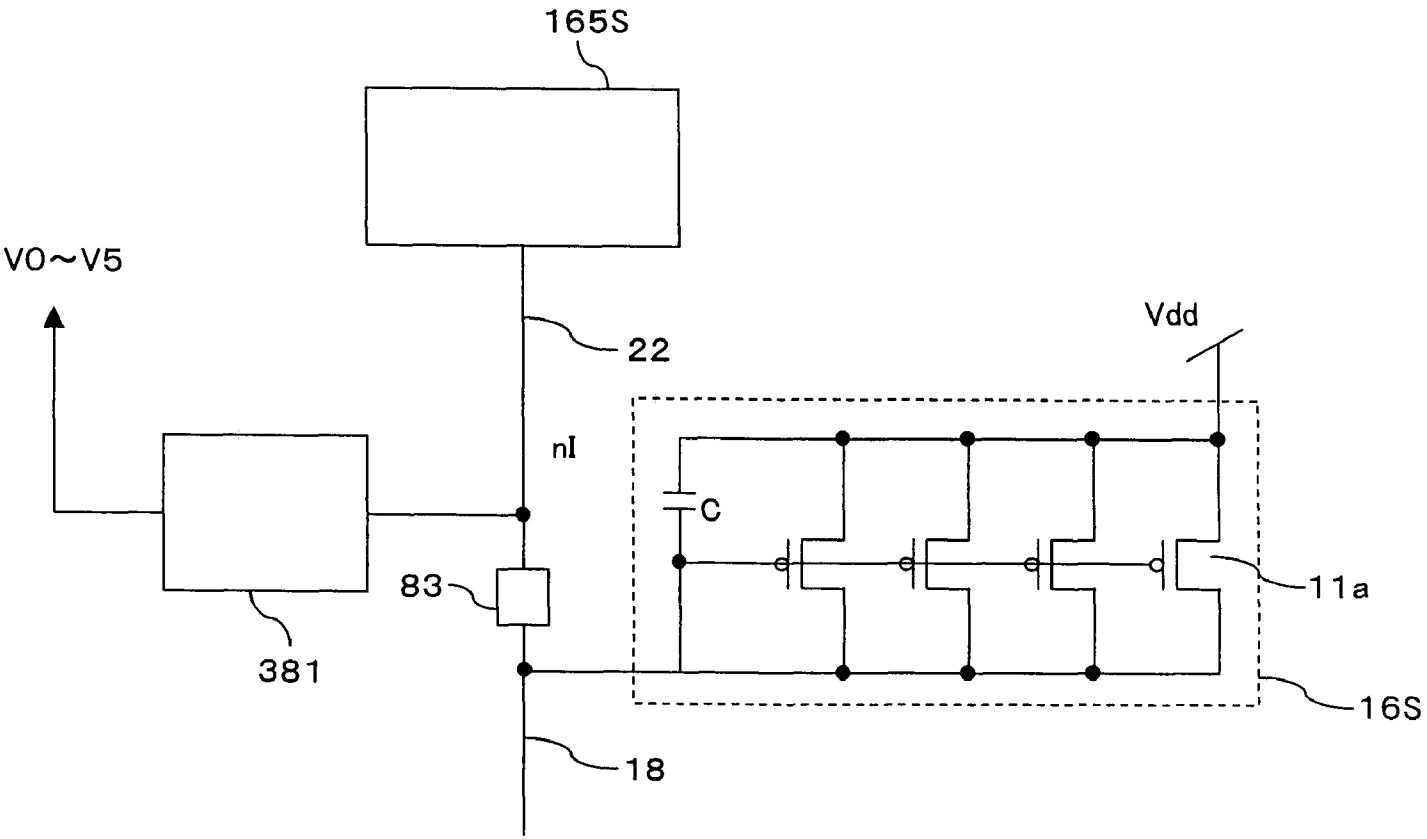
FIG. 73 is a schematic diagram of an EL display panel according to the present invention.

As shown in FIG. 73, when the pixel 16*s* used to measure the precharge voltage Vp is composed of n driving transistors 11*a*, a variation in precharge voltage Vp can be reduced which is caused by a variation in the characteristics of the driving transistor 11*a*. That is, the precharge voltage Vp can be more accurately obtained.

In FIG. 73, the program current output by the transistor group 165*s* is applied to the source signal line 18 through the internal wiring 162 and output terminal 83 of the source driver IC (circuit) 14. The program current is then supplied (applied) to the pixel 16*s* or 16. The n driving transistors 11*a* in the pixel 16*s* output the precharge voltage Vp corresponding to the program current nI to the source signal line 18. The precharge voltage Vp is applied to the internal wiring 162. In FIG. 73, n=4, and four driving transistors 11*a* are formed in the pixel 16*s*.

In FIG. 73, 4×I=4I program currents are applied, and four driving transistors 11*a* operate. Consequently, a program current of magnitude I flows through each of the driving transistors 11*a*. The transistor group 165*c* conducts a program current of magnitude 4I, but the current of magnitude I flows through a driving transistor 11*a*. This refers to the case where if the pixel 16 is composed of one driving transistor 11*a*, the transistor group 165*c* conducts a program current of magnitude I, so that the current of magnitude I flows through the driving transistor 11*a* in the pixel 16. However, since the plurality of driving transistors 11*a* are formed in the pixel 11*s*, an accurate precharge voltage Vp can be acquired even with a slight variation among the driving transistors 11*a*. The other arrangements and operations of the present embodiment are similar to those of the other embodiments and will not be described.

The present invention uses the measurement pixel 16*s* or the pixel 16 to acquire a precharge voltage Vp. However, means is required for achieving this scheme if the pixel 16 or the like from which the precharge voltage Vp is to be acquired is defective. The defective pixel does not output a normal precharge voltage Vp or provides no precharge voltage Vp. Means is also required for achieving the scheme if the driving transistor 11*a* from which the precharge voltage Vp is to be acquired exhibits abnormal characteristics.

Figure 74:
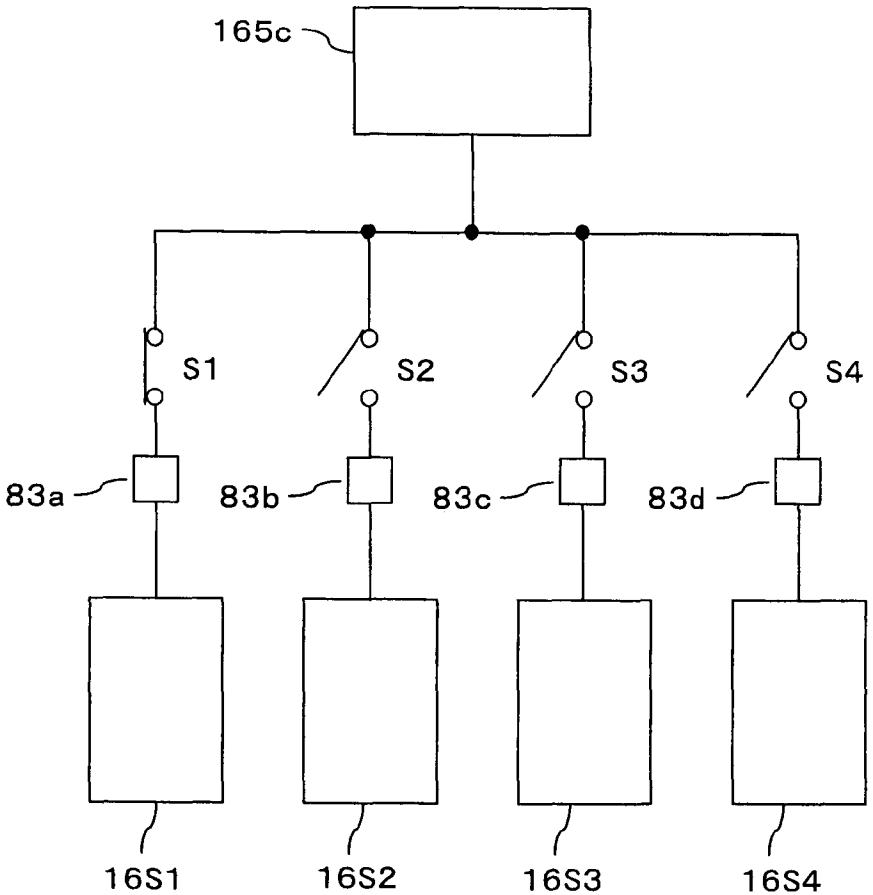
FIG. 74 is a schematic diagram of an EL display panel according to the present invention.

The present invention achieves this object by forming a plurality of pixels 16*s* from which the precharge voltage Vp is to be acquired and selecting a normal one of the plurality of pixels 16*s*. This is illustrated in FIG. 74, where four measurement pixels 16*s* are formed to acquire the precharge voltage Vp. The switch S (S1 to S4) determines the measurement pixel 16*s* to be selected. In FIG. 74, the switch S1 is closed, while the other switches S2 to S4 are open. This causes the measurement pixel 16*s*1 to be selected. Consequently, the program current from the transistor group 165*c* is applied to the measurement pixel 16*s*1.

The measurement pixel 16*s* to be selected is selected or set in advance by measuring the characteristics of the plurality of pixels 16*s*. The selected or set information is held in the nonvolatile memory as close information for the switch S (S1 to S4). A switch S (S1, S2, S3, or S4) to be selected by default is predetermined.

Of course, n switches S may be closed, with an n-times program current applied, as shown in FIG. 73. If a plurality of measurement pixels 16*s* are normal, the switches S to which the normal measurement pixels 16*s* are connected may be sequentially switched to acquire a precharge voltage Vp.

Figure 75:
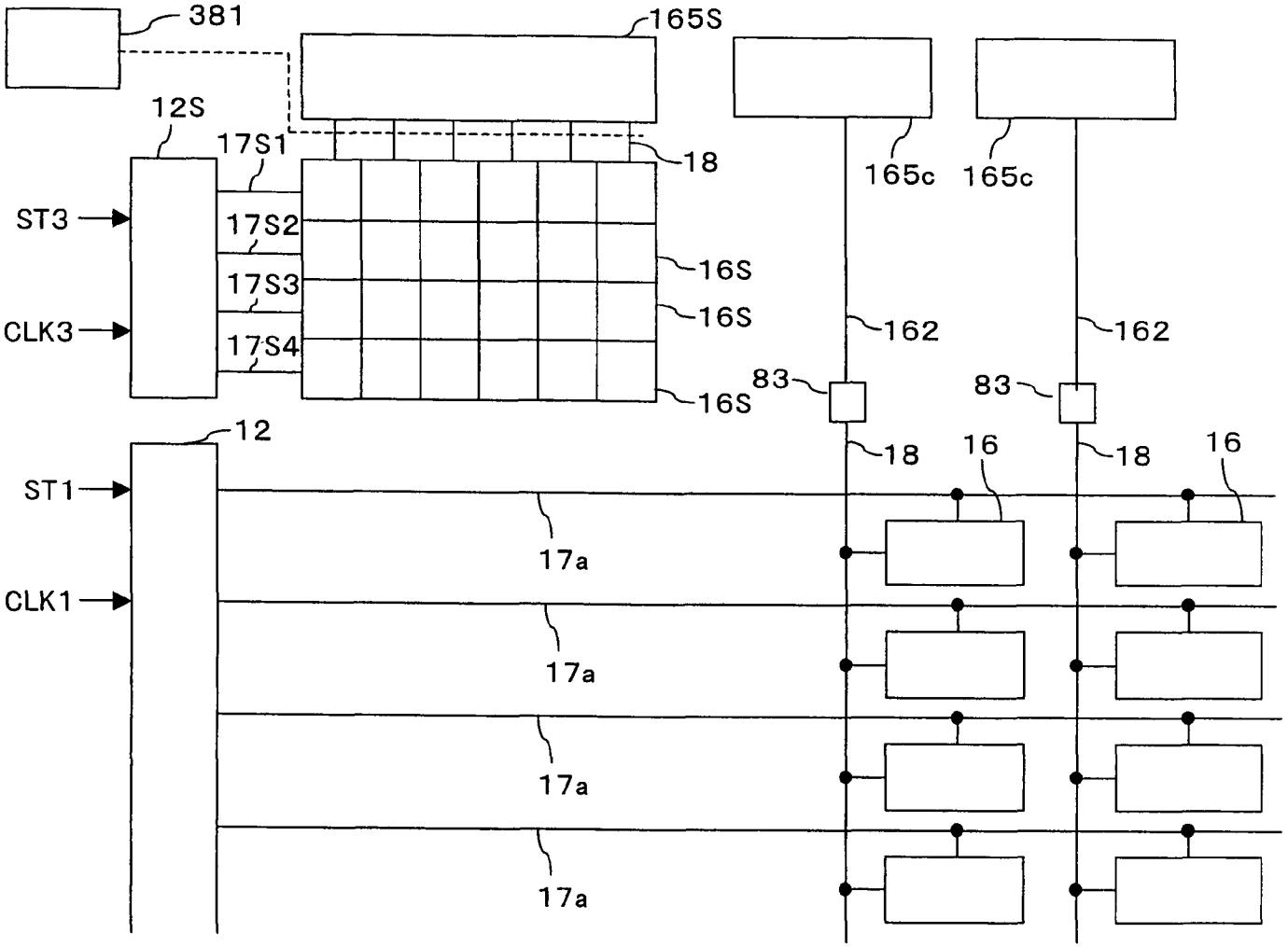
FIG. 75 is a schematic diagram of an EL display panel according to the present invention.

The measurement pixels 16*s* may be formed in a matrix as shown in FIG. 75. Alternatively, the plurality of measurement pixels 16*s* may be formed into one pixel column or row. FIG. 75 shows that the measurement pixels 16*s* are formed into a 4×6 matrix.

The pixels 16*s* formed in a matrix are configured in the same manner as that for the display screen 34. The gate driver circuit 12*s* is connected to or formed adjacent to the measurement pixels 16*s* in the pixel row direction. The transistor group 165*s* in the source driver circuit (IC) 14 is connected to or formed adjacent to the measurement pixels 16*s* in the pixel column direction. The measurement pixel 16*s* to be selected is determined under the control of the selected source signal line 18 and gate driver 12*s*. The source signal line 18 the precharge voltage Vp of which is to be measured is determined under the control of the voltage measuring circuit 381.

Selection of the measurement pixel row by the gate driver circuit 12*s* is controlled by the ST3 and CLK3 as in the case of the ST1 and CLK1 (also see FIG. 3). The gate driver circuit 12*s* sequentially selects the gate signal line 17*s* (having functions similar to those of the gate signal line 17*a*) to operate the driving transistors 11*a* in the selected pixel row.

The gate driver circuit 12*s* selects a prespecified (predetermined) gate signal line 17*s* (having functions similar to those of the gate signal line 17*a*) to operate the driving transistors 11*a* in the selected pixel row. The measurement pixel row to be selected and the measurement pixel to be selected are preselected by measuring the characteristics of a plurality of pixels 16*s*. The selected information is held in the nonvolatile memory. A default measurement pixel row or pixel 16*s* is also predetermined. The program current Iw is applied to the measurement pixel row under the control of the source driver circuit (IC) 14.

As in the case of FIG. 73, n measurement pixels 16*s* may be selected and an n-times program current may be applied. Further, the precharge voltage Vp may be acquired by scanning the gate driver 12*s* and sequentially switching the measurement pixel 16*s* used to measure the precharge voltage Vp.

In FIG. 75, the gate driver circuit 12*s* and the gate driver 12 constitute different circuits. However, the present invention is not limited to this. The gate driver circuit 12*s* and the gate driver 12 may be formed into one circuit. This single gate driver circuit may be scanned to select the measurement pixel row during the first blanking period of the 1F and then to select the pixel row from the display screen 34.

In FIG. 75, the source driver circuits (IC) 14 for the measurement pixel and for the display area constitute different circuits. However, the present invention is not limited to this. These source driver circuits (IC) 14 may be formed into one circuit. This single source driver circuit (IC) 14 may be controlled to apply a program current to the measurement pixel row during the first blanking period of the 1F and then to apply a program current to the pixel row in the display screen 34.

Figure 76:
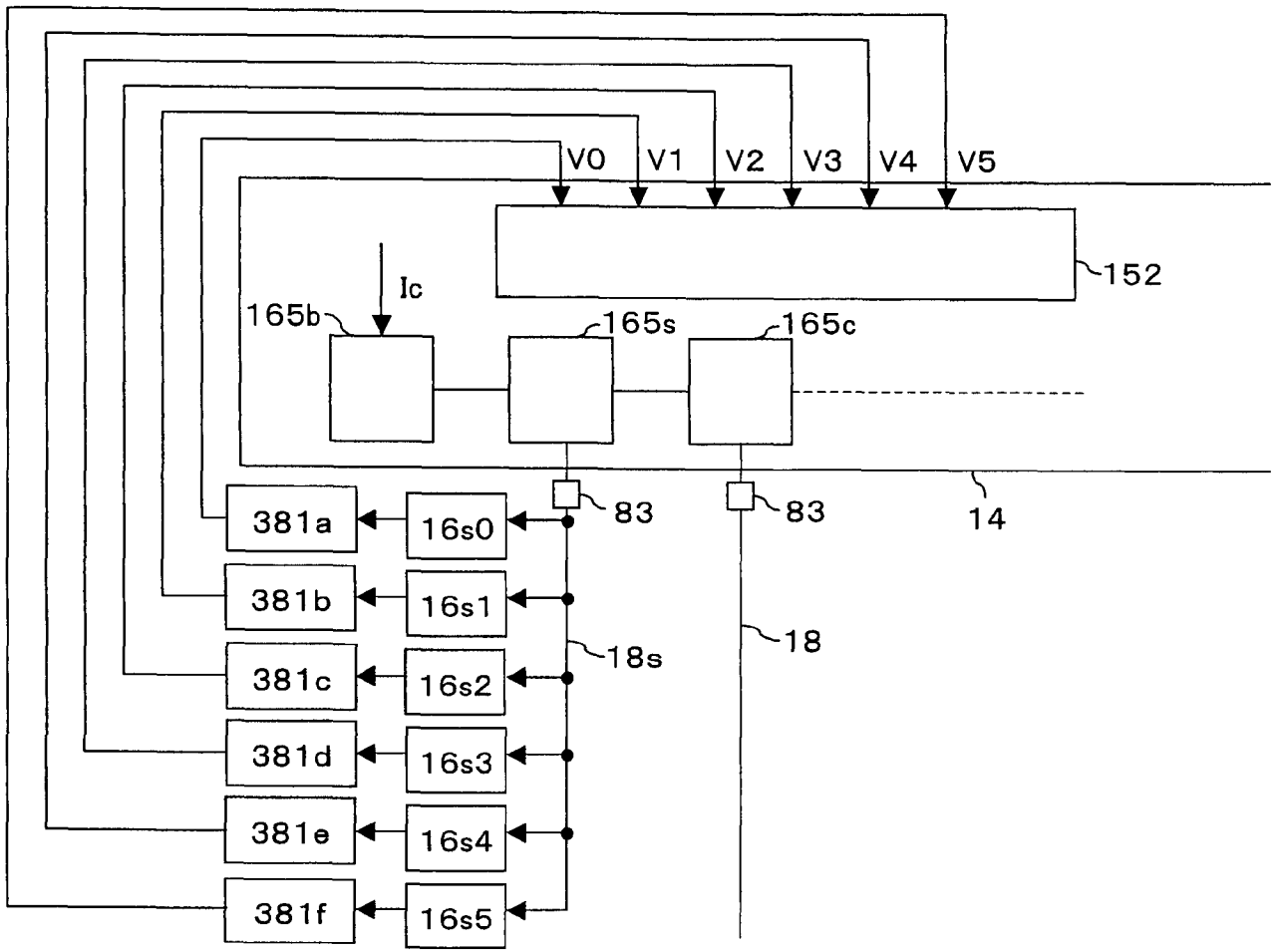
FIG. 76 is a schematic diagram of an EL display panel according to the present invention.

FIG. 76 shows a configuration in which the measurement pixels 16*s* used to measure the precharge voltages V0 to V5 and the voltage measuring circuit 381 are formed or arranged. In this embodiment, a current mirror circuit is composed of the transistor group 165*s* acquiring the precharge voltage Vp, the transistor group 165*c* displaying images, and the transistor group 165*b* executing both acquisition of the precharge voltage Vp and display of images.

In FIG. 76, the transistor group 165*s* sequentially outputs program currents Iw corresponding to the precharge voltages V0 to V5. When the program current Iw (=0 (A)) corresponding to the precharge voltage V0 is applied to the source signal line 18*s*, the measurement pixel 16*s*0 is selected. The voltage measuring circuit 381*a* then measures and applies the voltage V0 to the electronic regulator 152 and the like.

When the program current Iw corresponding to the precharge voltage V1 is applied to the source signal line 18*s*, the measurement pixel 16*s*1 is selected. The voltage measuring circuit 381*b* then measures and applies the voltage V1 to the electronic regulator 152 and the like. Similarly, when the program current corresponding to the precharge voltage V2 is applied to the source signal line 18*s*, the measurement pixel 16*s*2 is selected. The voltage measuring circuit 381*c* then measures the precharge voltage V2. When the program current corresponding to the precharge voltage V3 is applied to the source signal line 18*s*, the measurement pixel 16*s*3 is selected. The voltage measuring circuit 381*d* then measures the precharge voltage V3. When the program current corresponding to the precharge voltage V4 is applied to the source signal line 18*s*, the measurement pixel 16*s*4 is selected. The voltage measuring circuit 381*e* then measures the precharge voltage V4. When the program current corresponding to the precharge voltage V5 is applied to the source signal line 18*s*, the measurement pixel 16*s*5 is selected. The voltage measuring circuit 381*f* then measures and applies the precharge voltage V5 to the electronic regulator 152 and the like.

Figure 77:
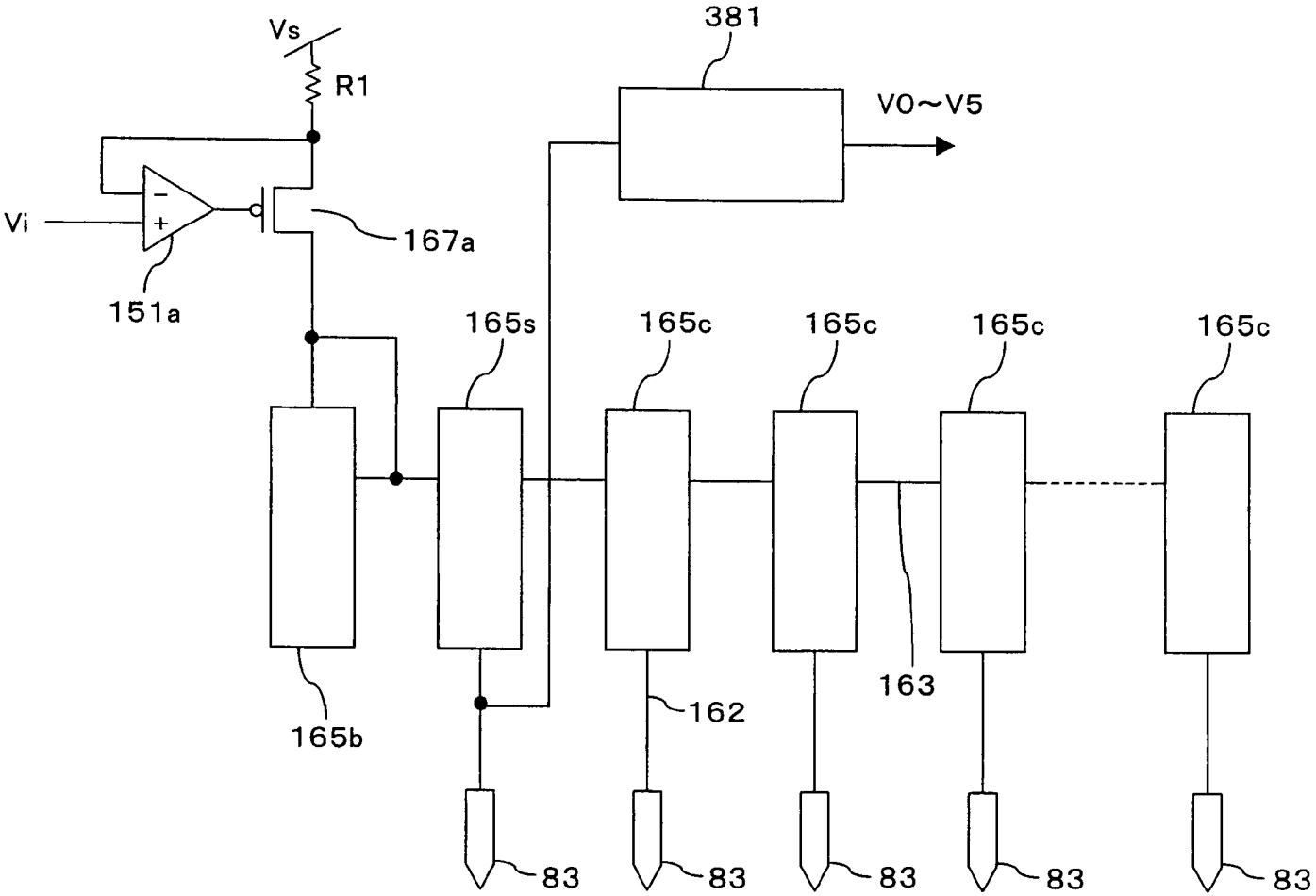
FIG. 77 is a schematic diagram of an EL display panel according to the present invention.
Figure 78:
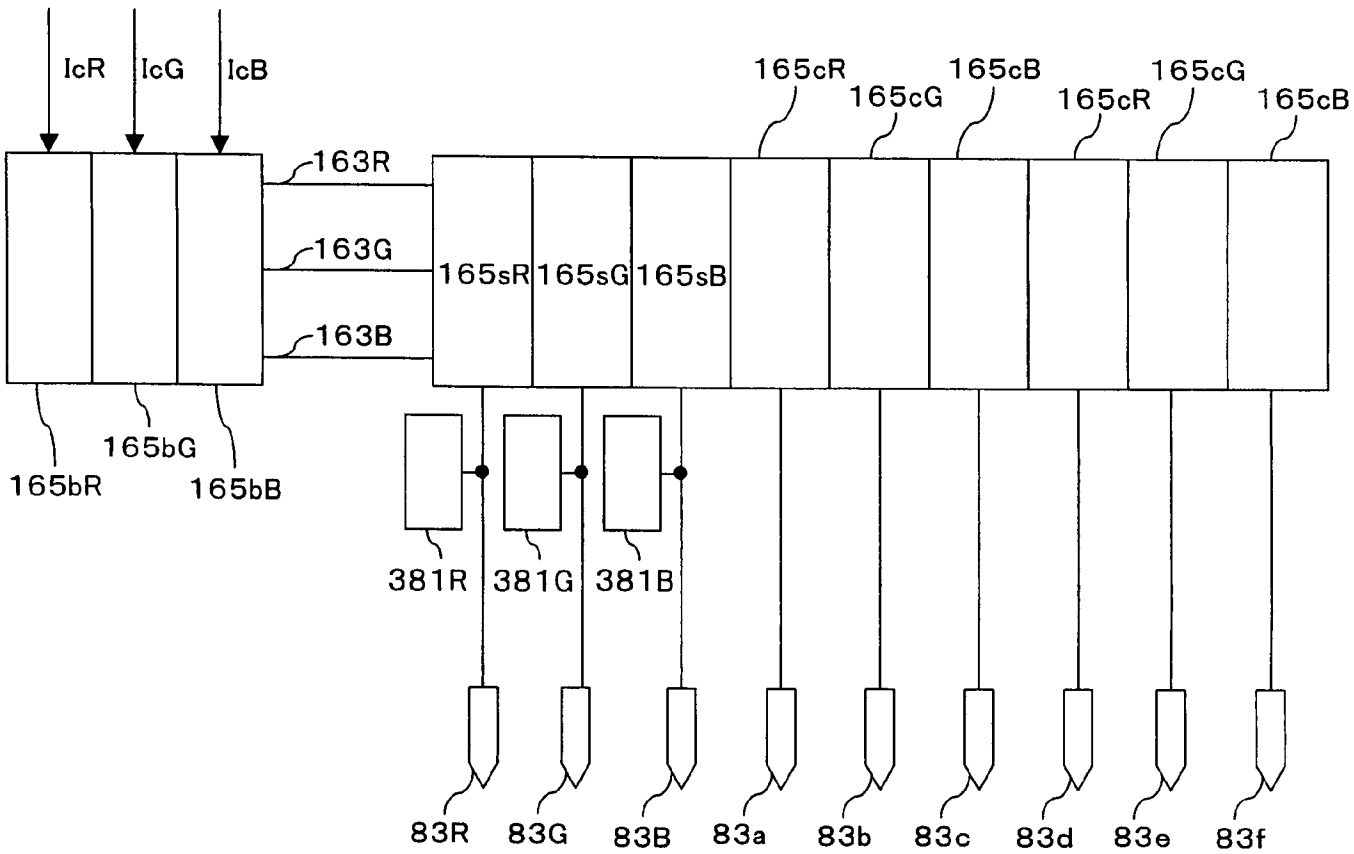
FIG. 78 is a schematic diagram of an EL display panel according to the present invention.

The present invention is not limited to the configuration shown in FIG. 76. The plurality of voltage measuring circuits 381 may be combined into a single circuit as shown in FIG. 77. Further, of course, the transistor group 261*s* and the voltage measuring circuit 381 may be provided for each of the R, G, and B as shown in FIG. 78.

Figure 79:
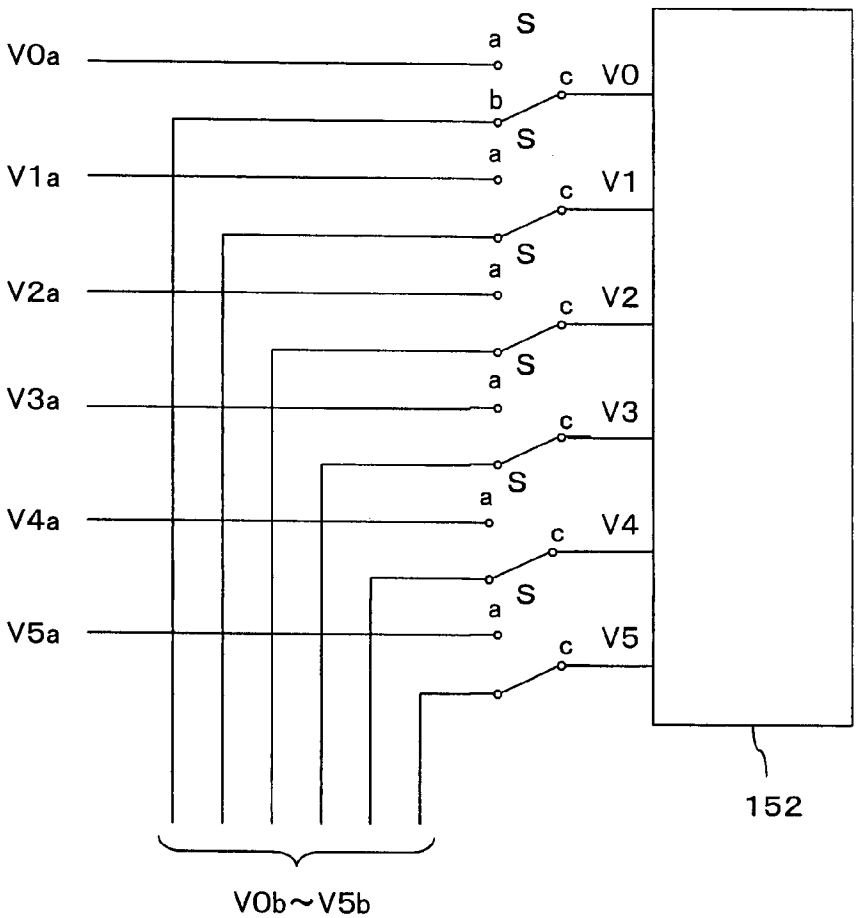
FIG. 79 is a schematic diagram of an EL display panel according to the present invention.

The above embodiment acquires the precharge voltage Vp by operating the measurement pixel 16*s* or the pixel 16. However, the precharge voltage Vp may be generated outside the panel before application. For example, as shown in FIG. 79, externally generated precharge voltages V0*b* to V5*b* and precharge voltages V0*a* to V5*a* acquired by operating the measurement pixel 16*s* or pixel 16 may be selected or switched using the switch S. To select the externally generated precharge voltages V0*b* to V5*b*, the switch is set to a b side. To select the precharge voltages V0*a* to V5*a* acquired by operating the measurement pixel 16*s* or pixel 16 (internally generated precharge voltage Vp), the switch is set to an a side. The switch S may be set manually by the user or automatically on the basis of an output from an external light sensor, a temperature sensor, or the like.

Figure 80:
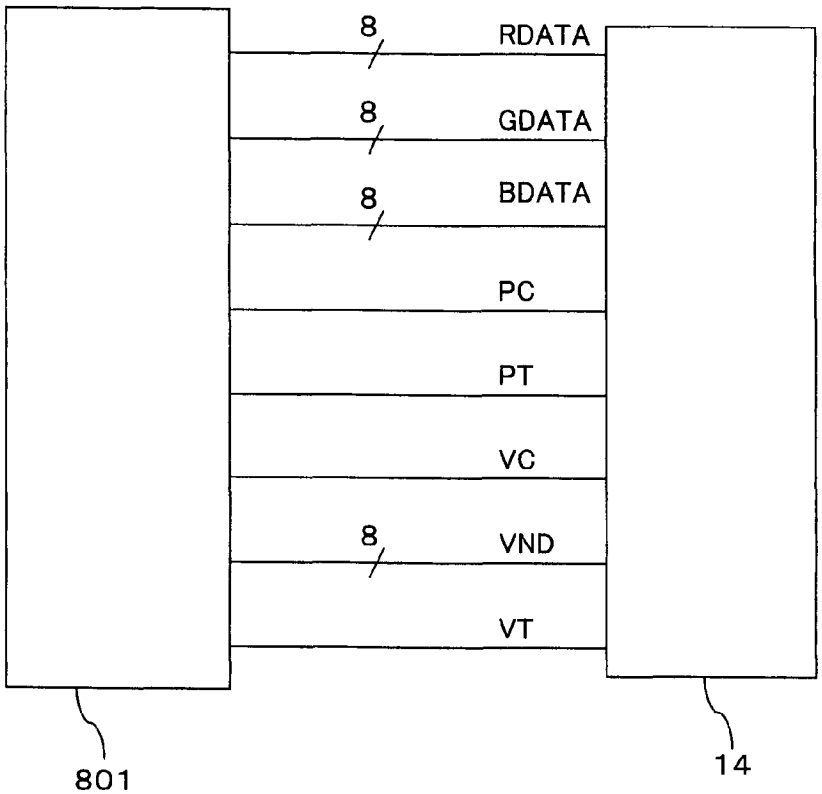
FIG. 80 is a schematic diagram of an EL display panel according to the present invention.

The following are controlled out by the controller circuit (IC) 801 as shown in FIG. 80: timing at which the precharge voltage Vp is measured, measuring time, specification of the measurement pixel 16*s*, and the period for which and time at which the precharge voltage Vp is applied. The user may independently set or vary the timing at which the precharge voltage Vp is measured, the measuring time, specification of the measurement pixel 16*s*, and the period for which and time at which the precharge voltage Vp is applied.

In FIG. 80, reference characters RDATA, GDATA, and BDATA denote red, green, and blue video data, respectively. Reference characters PC and PT denote a signal controlling whether or not to execute precharging and a precharge period signal, respectively. Reference characters VC and VNO respectively denote a measuring signal for the precharge voltage Vp and a signal specifying which precharge voltage Vp is to be measured, that is, one of the V0 to V5. Reference character VT denotes a signal specifying the period for which the precharge voltage Vp is measured.

As described above, the present invention measures the precharge voltage Vp by applying the constant current Iw (including 0 (A) corresponding to the tone 0) to the source signal line 18 and operating the driving transistor 11*a*. The precharge voltage Vp is measured before or during the display of an image; the measurement before the display includes inspections or adjustments carried out immediately after the manufacture of the panel and the period during the display includes a blanking period, the beginning of one horizontal scan period and the like.

The measured or acquired precharge voltage Vp is applied during the A period, described with reference to FIGS. 25, 26, 27, 28, and 32, as the precharge voltage Vp (which should be called a tone voltage). However, the precharge voltage Vp applied during the A period need not necessarily be the same as the measured one Vp. The measured precharge voltage Vp may of course be converted into the voltage to be applied during the A period, on the basis of the tone number of the video signal to be displayed.

For example, it is assumed that the constant current Iw 16 corresponding to the tone 16 is applied to the driving transistor 11*a* in the pixel 16, so that the precharge voltage Vp 16 corresponding to the constant current Iw=16 is measured. Then, to apply the tone 32 to the pixel 16, the potential difference Vsd between the tones 32 and 16 is added to the precharge voltage Vp16 to determine a precharge voltage Vp32, which is then applied to the source signal line 18 during the A period. The potential difference Vsd between tones such as the tones 32 and 16 to be added to the precharge voltage Vp 16 is predetermined by measuring the characteristics of a standard driving transistor 11*a*.

Further, the above embodiment of the present invention effectively determines the precharge voltage Vp=V0 corresponding to the tone 0. This is because the same precharge voltage Vp=V0 is used for the R, G, and B pixels if the driving transistors 11*a* in the R, G, and B pixels exhibit the same characteristics. That is, the precharge voltage Vp=V0 can be used as an origin voltage.

The V0 voltage is obtained by selecting the pixel 16 and applying the on voltage to the gate signal line 17*a* to short circuit the gate and drain terminals of the target driving transistor 11*a*. Since the applied program current Iw=0 (A), each source signal line 18 is electrically disconnected from the source driver IC (circuit) 14 (floating state). The driving transistor 11*a* changes the potential across the source signal line 18 so as to avoid passing a current through itself. The potential at which no current flows through the driving transistor 11*a* (cutoff state) is the V0 voltage.

The measured or acquired V0 voltage may contain the effect of a punch-through voltage or the like. Accordingly, the target precharge voltage Vp=V0 is obtained by addition or subtraction of a given voltage or multiplication of a given ratio.

Figure 81A:
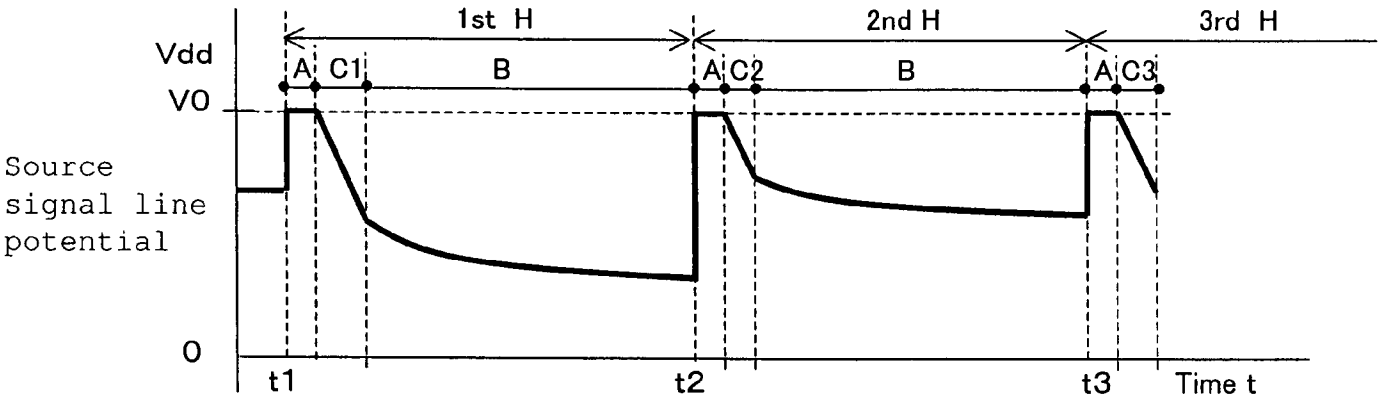
FIG. 81 is a schematic diagram of a driving method of an EL display panel according to the present invention.
Figure 81:
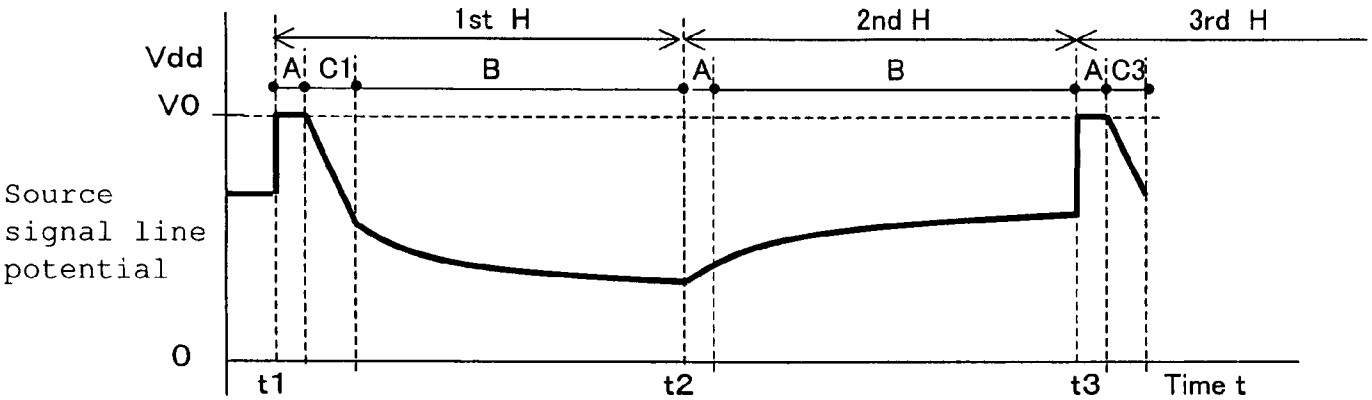

The precharge voltage Vp=V0 is applied during the A period as shown in FIG. 81. For easy description, the period during which the first pixel row is selected is defined as a "first H", the period during which the second pixel row is selected is defined as a "second H", the period during which the third pixel row is selected is defined as a "third H", and so on.

FIG. 81(A) shows that the same V0 voltage is used for each pixel row. Although the common V0 voltage is used for each pixel row, it may be varied depending on the precharge voltage Vp measured in each pixel 16 (the V0 voltage may be individually set for each pixel 16).

In FIG. 81(A), the V0 voltage is applied during the first A period of a horizontal scan period (pixel row selection period) as the precharge voltage Vp. Application of the V0 voltage causes the driving transistor 11*a* in the pixel 16 to display black (no current flows). Alternatively, the V0 voltage is set to a voltage for a low tone area so that the driving transistor 11*a* outputs a current equal to or smaller than that for the low tone area.

Below the low tone areas, a small program current is used for the tone. Consequently, these tone areas are significantly affected by the parasitic capacitance of the source signal line 18, resulting in frequent insufficient writing. Therefore, a high program accuracy cannot be achieved. Application of the precharge voltage Vp=V0 sets the potential across the source signal line 18 at the value for the tone 0. Even if a program current for a low tone area is programmed for the driving transistor 11*a*, the potential across the source signal line 18 varies from the value for the tone 0. This reduces the amount of charges involved in the charging or discharging of the source signal line 18. The potential can therefore be changed to the value for the target low tone area.

In FIG. 81, a C1 period of the first H, a C2 period of the second H, and a C3 period of the third H vary depending on the magnitude of a program current corresponding to the target tone which is applied during the B period. Overcurrent driving is carried out during the C1, C2, and C3 periods. The overcurrent driving is based on the scheme described with reference to FIG. 32 and others. Application of an overcurrent quickly changes the potential across the source signal line 18 from the precharge voltage Vp=V0 to the potential for the target tone.

If the V0 voltage reflects the characteristics of the driving transistor 11*a*, the potential varied by the overcurrent driving reflects the characteristics of the driving transistor 11*a*. This is because the potential varies linearly under the overcurrent driving. Consequently, even with a variation in characteristics among the driving transistors 11*a* in each of the pixels 16 formed in a matrix, an even image can be displayed by application of the precharge voltage Vp=V0 corresponding to the tone 0 for each driving transistor 11*a*.

During the B period, the program current is applied which corresponds to the tone to be displayed on the pixel 16. If the target potential has been optimally reached by application of the precharge voltage Vp=V0 and overcurrent, the potential does not change during the period B. Even if the target potential has not been reached, it can be accurately reached by applying the program current during the B period (compensation). This enables the application of a current accurately programmed in the EL element 15 in the pixel 16.

In FIG. 81(B), neither the V0 voltage nor the overcurrent is applied during the second H period. This is because the potential across the source signal line 18 changes insignificantly between the first H and the second H, leading to the determination that the program current enables the target potential to be sufficiently achieved. The determination is made by a determination routine programmed in the controller circuit (IC) 801.

Figure 82:
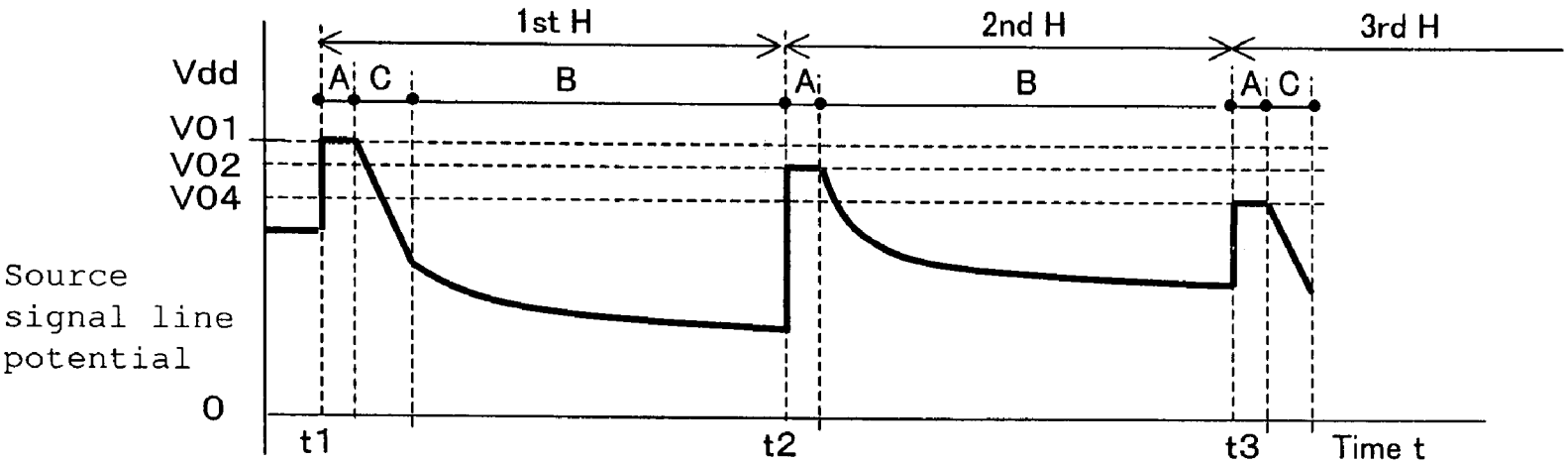
FIG. 82 is a schematic diagram of a driving method of an EL display panel according to the present invention.

In FIG. 82, the second H period does not include the C period. That is, no overcurrent is applied during the second H period. This is because there is only a small difference between the V0 voltage and the potential across the source signal line 18 during the second H, leading to the determination that the program current enables the target potential to be sufficiently achieved. The determination is made by a determination routine programmed in the controller circuit (IC) 801.

As described above, the following are determined on the basis of the tone written to the pixel 16 or a change in potential: whether or not to apply the precharge voltage Vp at the beginning of a horizontal scan period and whether or not to carry out overcurrent driving.

The optimum V0 voltage varies with the temperature of the panel. The precharge voltage Vp=V1, V2, V3, . . . also varies with the temperature. Thus, preferably, the temperature of the panel is monitored (using a temperature sensor such as a thermistor) and multiplied by a correction factor for temperature to determine a V0 voltage, which is then applied during the A period.

Further, the precharge voltage Vp applied during the A period is preferably changed or adjusted on the basis of the written tone or potential or a change from the source signal line potential during the preceding horizontal scan period or from the tone written to the pixel during the preceding horizontal scan period. Further, the V0 voltage need not necessarily be applied and the applied voltage may be changed in association with the written tone.

The V0 voltage corresponding to the 0 tone is determined by the driving transistor 11*a* in the pixel 16. The driving transistor 11*a* normally has the same size for the R, G, and B. Accordingly, the V0 voltage is the same for the R, G, and B. The charging or discharging of the parasitic capacitance Cs is often based on the V0 voltage. Therefore, the V0 voltage corresponds to the origin (tone 0) in the current or voltage driving scheme.

The above embodiment acquires the precharge voltage Vp from the potential across the source signal line 18 or the like. However, the precharge voltage Vp can be acquired from potential other than that across the source signal line 18. For simplification, description will be given of a scheme for determining the precharge voltage Vp=V0.

Figure 83:
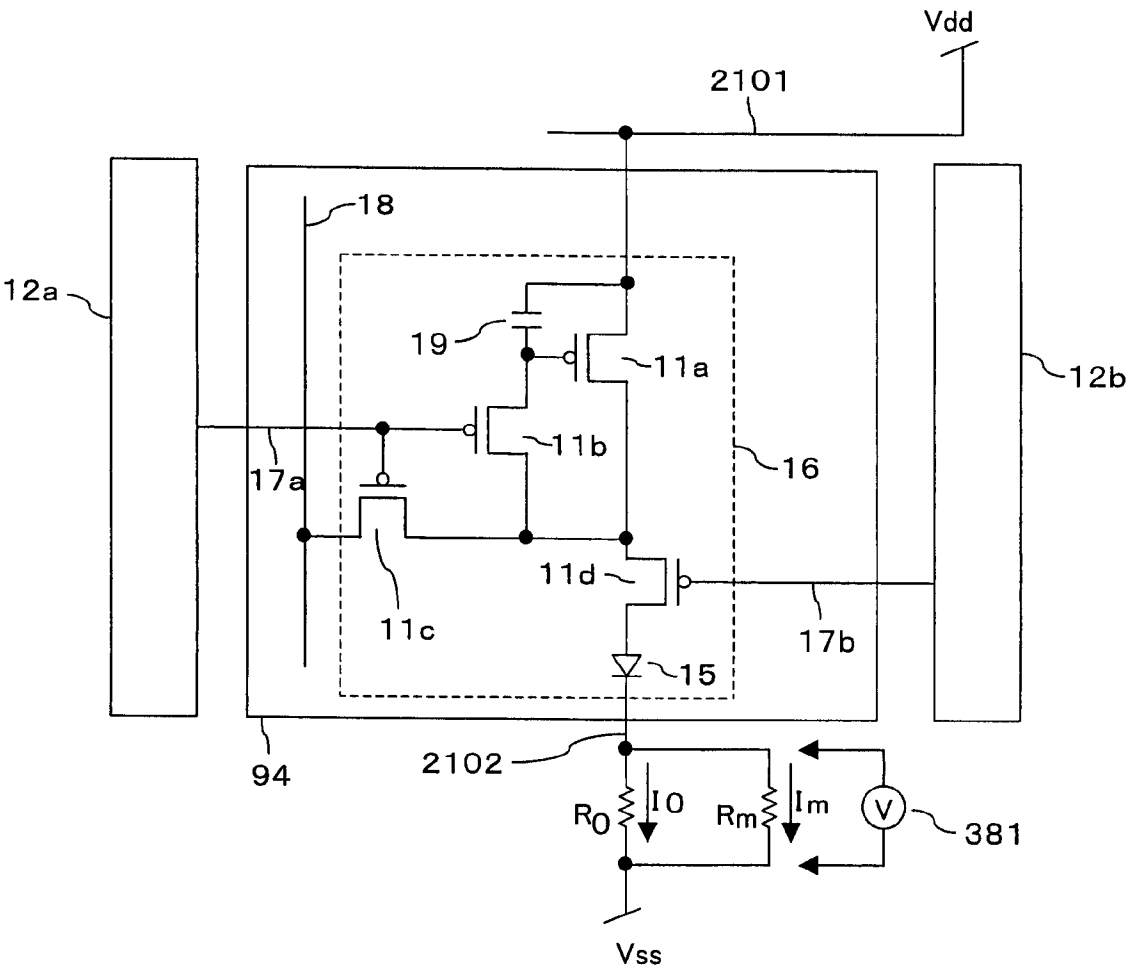
FIG. 83 is a schematic diagram of a driving method of an EL display panel according to the present invention.
Figure 84:
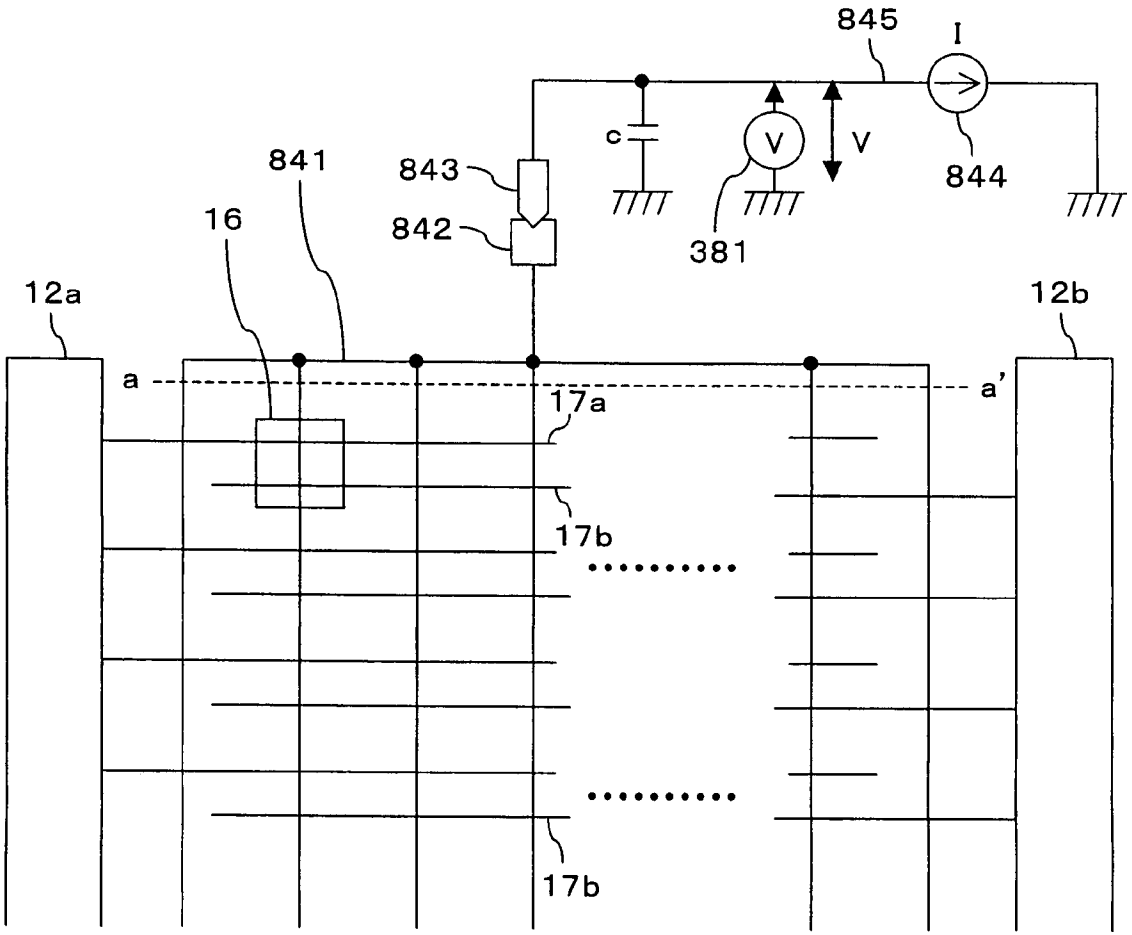
FIG. 84 is a schematic diagram of a driving method of an EL display panel according to the present invention.

The V0 voltage can be measured, acquired, or determined using the configuration shown in FIGS. 83 and 84. FIG. 83 shows a method of acquiring the V0 voltage by measuring the cathode current. The method shown in FIG. 83 short circuits the source signal line 18, and in the short-circuited state, applies a V0' voltage to be set for the source signal line. Under these conditions, the gate drivers 12*a* and 12*b* are scanned and the V0 voltage applied to the source signal line 18 is written to the pixel 16. On the other hand, the potential at a resistor Rm18 is measured by the voltage measuring circuit 381.

In FIG. 83, a resistor R0 connected in series with the cathode terminal is connected to the shunting resistor Rm. The voltage measuring circuit 381 then measures the terminal voltage of the resistor Rm. An object of the present invention is to measure current flowing through the cathode. Accordingly, a current measuring instrument may be placed directly at the cathode terminal. The current may also be measured at the anode terminal side. This is because the cathode current is substantially the same as the anode current in the EL display apparatus.

The V0' voltage applied to the source signal line 18 is written to the pixel 16. The V0' voltage is adjusted so that the set maximum current value Im becomes equal to (or smaller than) a target value. The maximum current Im is the current value I0 corresponding to the tone 0, ideally I0=0 (A). However, setting the current value I0 exactly at 0 (A) is difficult. Further, when the current value at the tone 0 is too close to zero, the potential at the tone 0 is too close to the anode voltage Vdd. This makes it difficult to change to another tone during the next horizontal scan period. Therefore, the Im, the maximum value of the I0, is set.

The V0 voltage is defined as the V0 voltage applied to the source signal line 18 when the Im reaches the target value. In the pixel configuration shown in FIG. 83, the V0' voltage set to the anode terminal side reduces the I0 current. However, when the V0' voltage is set closer to the anode voltage than required, application of the V0 voltage corresponding to the tone 0 provides a good black display, whereas the tone 0 potential is too deep to allow the tone 1 to be easily written when the tone 0 changes to the tone 1.

The I0 current providing the proper V0 voltage is preferably such that when the diagonal length of the display area of the display panel is defined as d (inches), the unit of I0 is mA, and K=10/d, K=at least 0.2 and at most 2. More preferably, K is at least 0.3 and at most 1.0. The I0 current is set as the Im. These settings enable a good black display to be achieved. Furthermore, even if precharge driving (overcurrent driving) is carried out so as to change the 0 tone to another tone, the tone change can be properly effected.

As described above, the V0' voltage is changed and the I0 current is measured in association with the change. When the value of the I0 current meets the range of the K (the I0 is equal to or smaller than the Im), the V0' voltage being applied to the source signal line 18 is set to the precharge voltage V0.

The precharge voltage V0 is also preferably acquired as shown in FIG. 84. In FIG. 84, the plurality of source signal lines 18 are short circuited by short circuit wiring 841. The short circuit wiring 841 is broken along a line a-a' after the measurement of the black voltage (precharge voltage V0).

In FIG. 84, all source signal lines 18 are short circuited by the short circuit wiring 841. Accordingly, each source signal line 18 is in the floating state. A terminal electrode 842 is formed or placed at the short circuit wiring 841. A probe 843 is in pressure contact with the terminal electrode 842. A constant current source 844 is connected to the probe 843 via wiring 845. The precharge voltage V0 causes the constant current source 844 to output a zero current.

The voltage measuring circuit 381 is connected to the wiring 845 to measure the potential across the wiring 845. The voltage measuring circuit 381 thus measures the potential across the source signal line 18 via a probe 843. Since the constant current source 844 outputs the zero current, no current is applied to the source signal line 18. That is, the source signal line 18 provides the precharge voltage V0 (tone 0).

Figure 85:
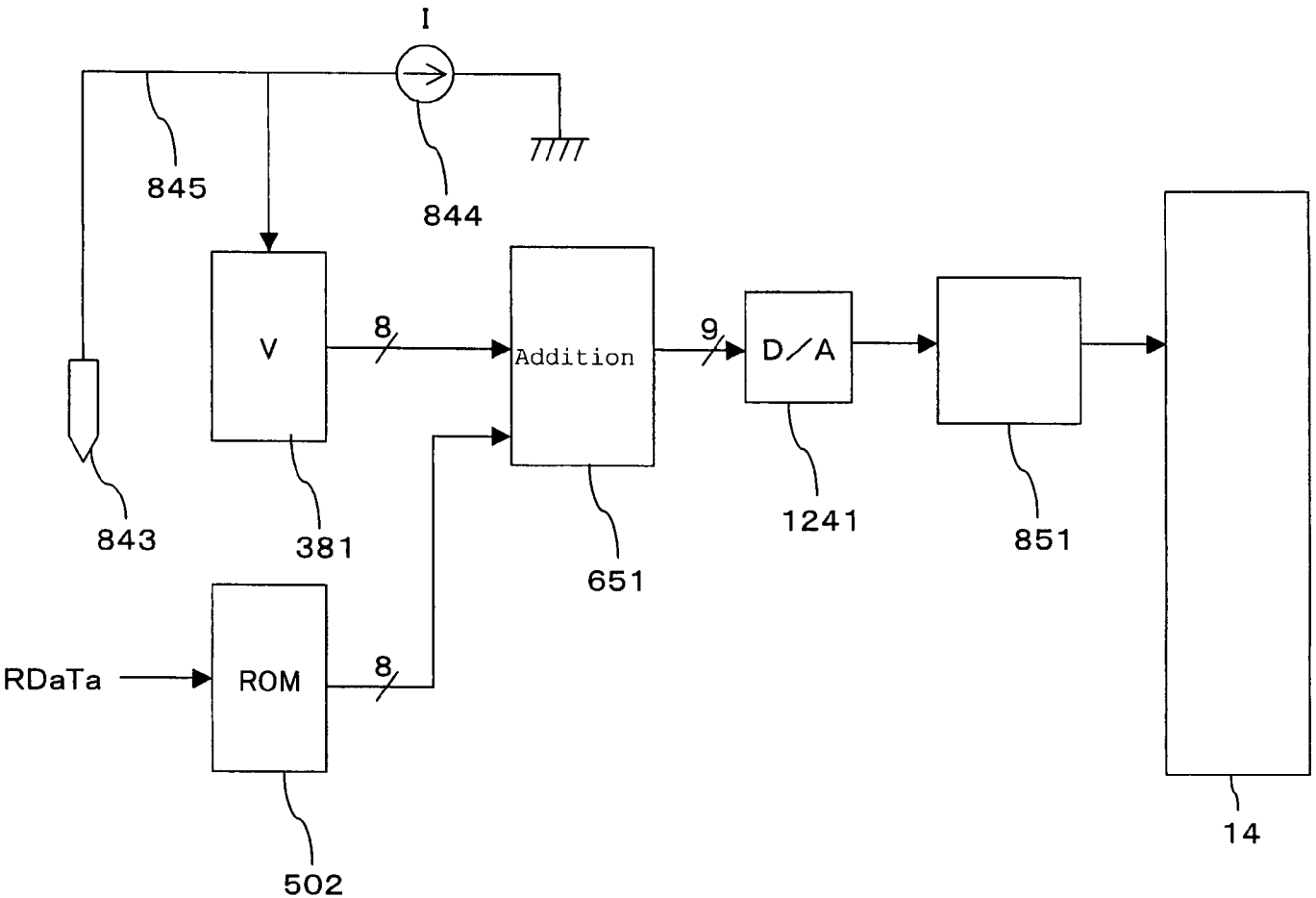
FIG. 85 is a schematic diagram of a driving method of an EL display panel according to the present invention.

FIG. 85 illustrates a method which corrects the acquired V0 voltage to obtain the proper V0 voltage. The precharge voltage V0 obtained is preferably subjected to a specific correction. For example, the precharge voltage V0 may be corrected so as to achieve a blacker display.

In FIG. 85, the probe 843 is connected to the terminal 842. The potential across the wiring 841 is converted into 8-bit digital data by the voltage measuring circuit 381. The magnitude of the correction is held in the ROM 502. The ROM data may be changed to RDaTa by an external apparatus.

The data held in the ROM 502 is also composed of 8 bits. The ROM data and the data from the voltage measuring circuit 381 are added together by the addition (or subtraction) circuit 651. In general, the addition data shifts the data toward the anode voltage side.

After the addition, the data is composed of 9 bits. The data is converted into analog data by the D/A (digital-analog conversion) circuit 391. The analog data is then subjected to temperature compensation by a temperature compensation circuit 851 which detects a panel temperature. The compensated data is then applied to the source driver circuit (IC) 14. The temperature compensation circuit 851 is required because the precharge voltage Vp is used for voltage driving and thus depends on temperature. This is in turn because the current flowing through the driving transistor 11*a* varies with temperature in spite of the fixed value of the gate terminal potential. In FIG. 85, the V0 voltage is corrected. However, a similar process may be executed on other precharge voltages Vp.

Figure 86A:
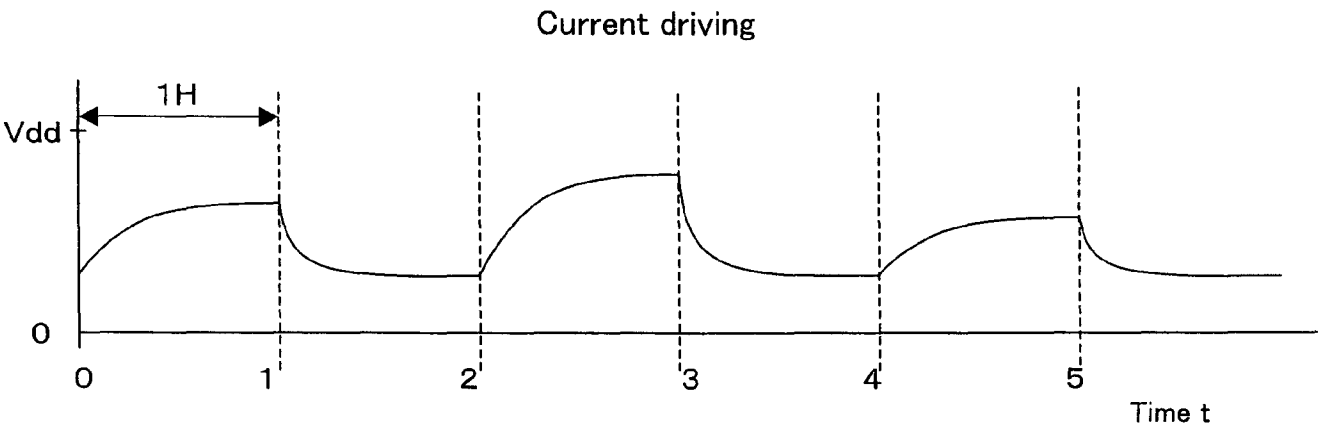
FIG. 86 is a schematic diagram of a driving method of an EL display panel according to the present invention.
Figure 86:
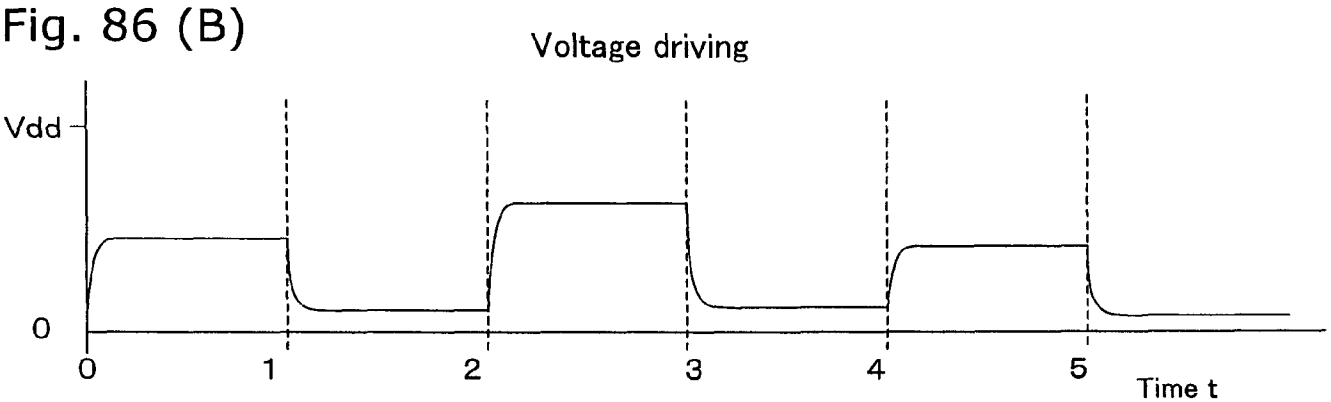

FIG. 86 shows the waveform of a signal from the source signal line 18. With the current driving shown in FIG. 86(A), since the program current is very weak, the parasitic capacitance makes the signal waveform round. With the voltage driving shown in FIG. 86(B), since the source driver circuit (IC) 14 has a small output impedance, the waveform of a signal applied to the source signal line 18 is substantially prevented from being rounded. Accordingly, the voltage driving scheme is better as a method which ensures that the driving signal is written to the pixel 16. However, the voltage driving scheme cannot compensate the pixel 16 for a variation among the driving transistors 11*a*. The current driving can properly compensate for the driving transistor 11*a* in the pixel 16.

Another driving scheme in accordance with the present invention will be described with reference to FIG. 87 and others. The current tone circuit 154 outputs a current corresponding to a predetermined tone number. For easy description, by way of example, an output tone current I1 corresponds to the 128th of the 256 tones and has a value I1 of 1 μA.

The current tone circuit 154 need not output program currents corresponding to all tones. The current tone circuit 154 has only to be able to output currents for particular tones such as the 128th, 64th, 0th, 1st, and 255th tones. Of course, the voltage tone circuit 231 is desirably configured to be able to output all tone voltages. Further, the voltage tone circuit 231 can desirably output program voltages for lower tones (127th or lower tones).

For easy description, the current tone circuit 154 is formed or constructed inside the source driver circuit (IC) 14. However, the present invention is not limited to this. For example, a circuit generating a constant current Iw=I1 may be provided outside the source driver circuit (IC) 14 to supply the constant current I1 to the source signal line 18 via the switch circuit so as to allow the measurement of the gate terminal voltage (source signal line 18) V1 of the driving transistor 11*a* in the pixel 16. Further, the measured voltage may be written to an EEPROM placed outside the source driver circuit (IC) 14 so that a V-I curve of the driving transistor 11*a* in the pixel 16 can be generated from the written data. Of course, the above measurements may be carried out during a panel adjusting process before panel shipment.

First, description will be given of a measuring step which measures or generates driving voltage data. The measuring step is executed while image display is not being carried out, for example, immediately after power-on. The measuring step is also carried out so as not to affect the image display.

Figure 14:
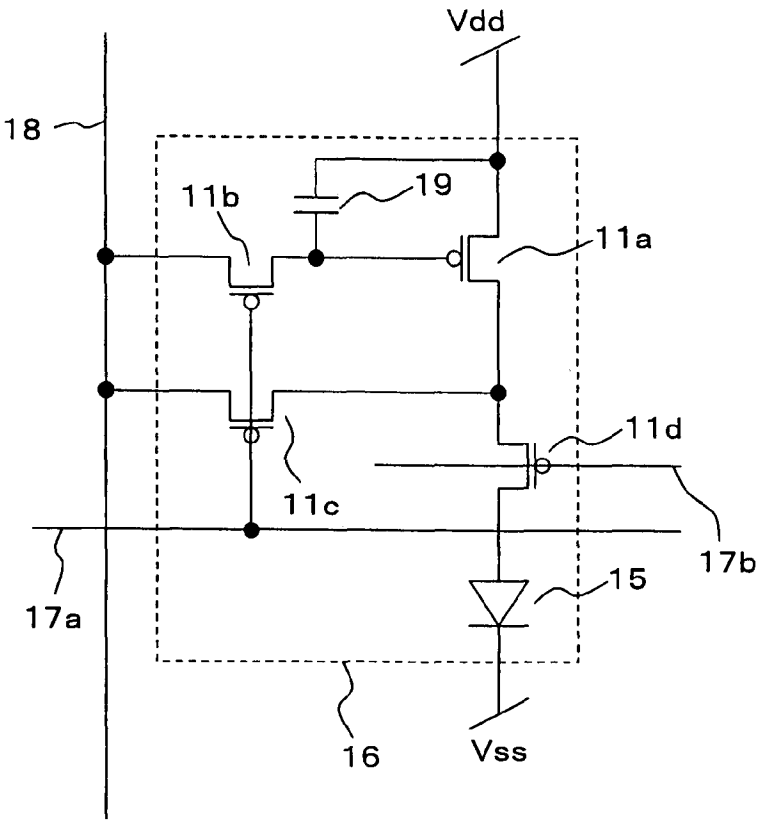
FIG. 14 is a schematic diagram of a pixel configuration of an EL display panel according to the present invention.

As previously described, with the driving scheme in accordance with the present invention, the pixel configuration needs to be of the current driving type as shown in FIGS. 1, 12, 14, and others. The reason is as follows. The driving scheme in accordance with the present invention, the embodiment of which is shown in FIG. 87, needs to pass the constant current applied by the source driver circuit (IC) 14, though the corresponding driving transistor 11*a* or the like to change the potential at the gate terminal of the driving transistor 11*a* so as to allow the measurement of the potential across the source signal line 18. That is, the pixel 16 needs to be configured so that the current passed through the driving circuit 11*a* flows into or out to the source signal line 18.

In the voltage driving pixel (for example, the pixel configuration shown in FIG. 2), an output current from the driving transistor 11*a* does not flow into the source signal line 18. Further, in a voltage offset cancel type pixel configuration, the capacitor between the source signal line 18 and the driving transistor 11*a* cuts a DC current. Basically, the voltage offset cancel type pixel configuration cannot be used for the EL display panel in accordance with the present invention.

The present invention uses the current driving pixel configuration to apply a program voltage to the pixel to carry out voltage driving (application of the program voltage). The present invention measures the voltage for a characteristic curve of the driving transistor 11*a* in at least one pixel 16 and generates a characteristic curve corresponding to voltage driving on the basis of the measured voltage, to drive the pixel. The voltage scheme in accordance with the preset invention is the same as or similar to the voltage offset cancel type in that the voltage V0 for the tone 0 is measured or generated and in that voltage program data is generated on the basis of the voltage V0 for the tone 0 to drive the pixel.

Of course, the present invention is not limited to the voltage corresponding to the tone 0. However, voltage offsetting can be precisely carried out by accurately measuring the voltage value for the tone 0. If the tone 0 is not used, a characteristic curve is preferably obtained using a voltage value measured or determined in connection with an intermediate tone (at least one-eighth and at most half of the maximum tone). This is because the characteristics of the driving transistor vary significantly within this range.

A voltage-current (V-I) characteristic curve of the driving transistor 11*a* (a transistor that supplies a current to the EL element 15 or a transistor that defines a current flowing through the above described transistor) can be generated by calculating a polynominal or referencing a matrix table or a lookup table 931. The above described process may be sequentially executed for each video signal data or may be pre-executed. The voltage-current (V-I) characteristic curve need not be obtained for all video signal data but may be determined intermittently or at intervals. This is because the video signal data and the characteristics of the driving transistors or the like in the array 30 are approximate among pixels located close to one another.

The above configuration enables the EL display apparatus in accordance with the present invention to carry out both voltage driving and current driving. The EL display apparatus can thus carry out voltage+current driving (see FIGS. 25, 81, and others). In particular, the present invention can carry out precise voltage driving in a lower tone area with a smaller program current. The present invention can carry out precise current driving in a higher tone area with a larger program current. The present invention can also provide a driving scheme that can carry our both voltage driving and current driving in a complementary manner.

Figure 87:
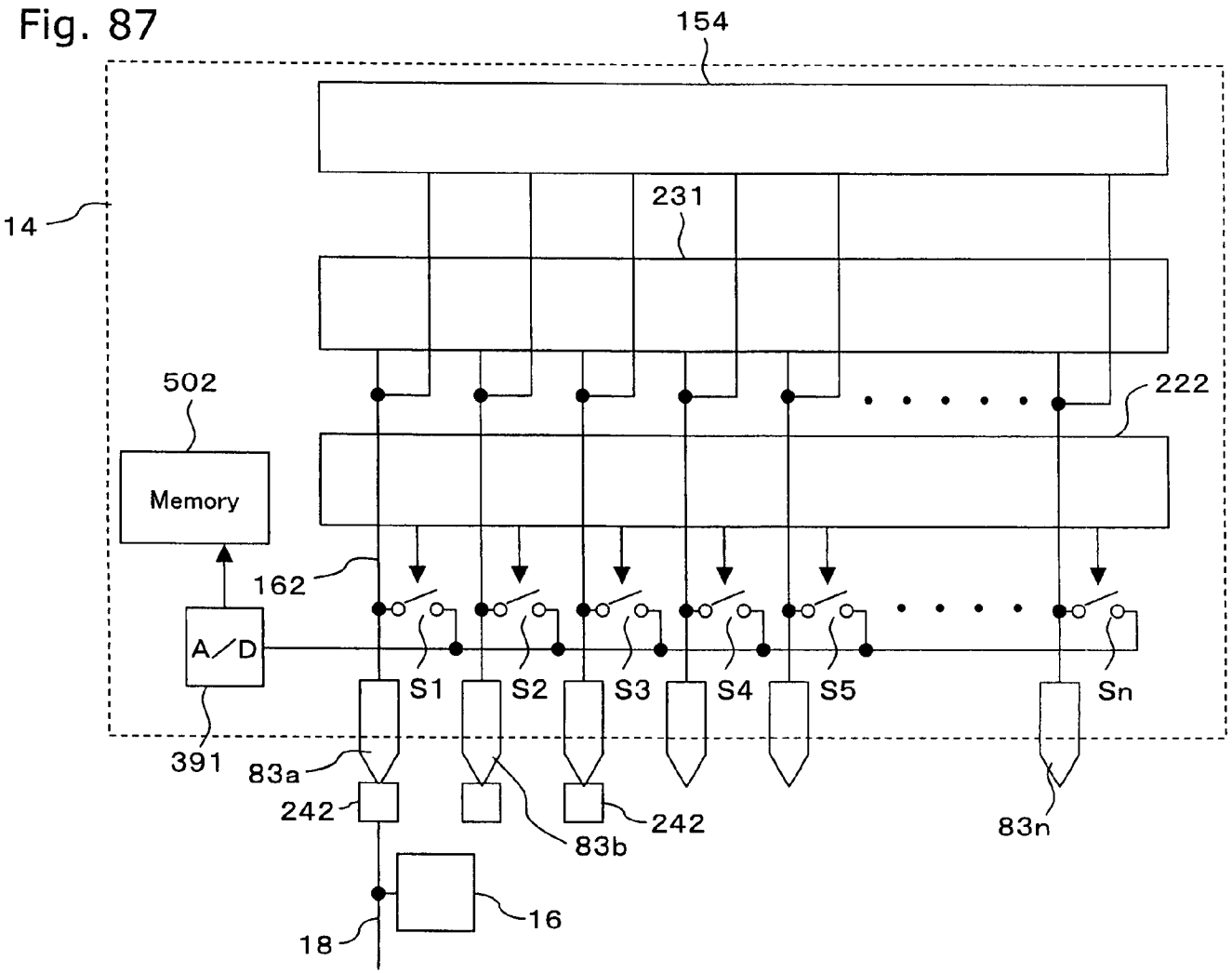
FIG. 87 is a block diagram of a driver circuit of an EL display panel according to the present invention.

The configuration shown in FIG. 87 corresponds to the source driver circuit (IC) 14 in accordance with the present invention which further includes a switch Sx (x=1 to n: n is the number of source signal lines 18) which allows the potential generated in the source signal line 18 to be sequentially selectively output or which selects a plurality of source signal lines 18 to allow the potentials across these source signal lines 18 to be output.

In the above description, the potential across the source signal line 18 is measured. The present invention is not limited to this. For example, the potential across the source signal line 18 may be approximately measured or estimated by detecting the migration of charges or measuring the intensity of electric fields. Further, the present invention is not limited to the potential across the source signal line 18. Any configuration may be used provided that it can directly or indirectly measure the gate terminal voltage of the driving transistor 11 in the pixel 16.

The present invention is also characterized by controlling the gate driver circuit 12*a* to sequentially select the gate signal line 17*a* and sequentially measuring the gate terminal voltages of the driving transistors 11*a* in the selected pixel row. That is, the present invention selects a pixel row, applies a specified constant current to the source signal line 18, and then measures the gate terminal voltages of the driving transistors in the selected pixel row. A sufficient time is used for the measurement. The V-I characteristics of each of the driving transistors are estimated on the basis of the corresponding measured gate terminal voltage. The video signal is converted into a program voltage on the basis of the estimated V-I curve. The program voltage is applied to the source signal line during image display.

The switch Sx (x=1 to n) is formed in each source signal line 18. The switch Sx is normally formed of an analog switch. The switch Sx only detects voltages and rarely conducts current. The switch Sx may thus be small-sized and has only to offer a high impedance.

Figure 88:
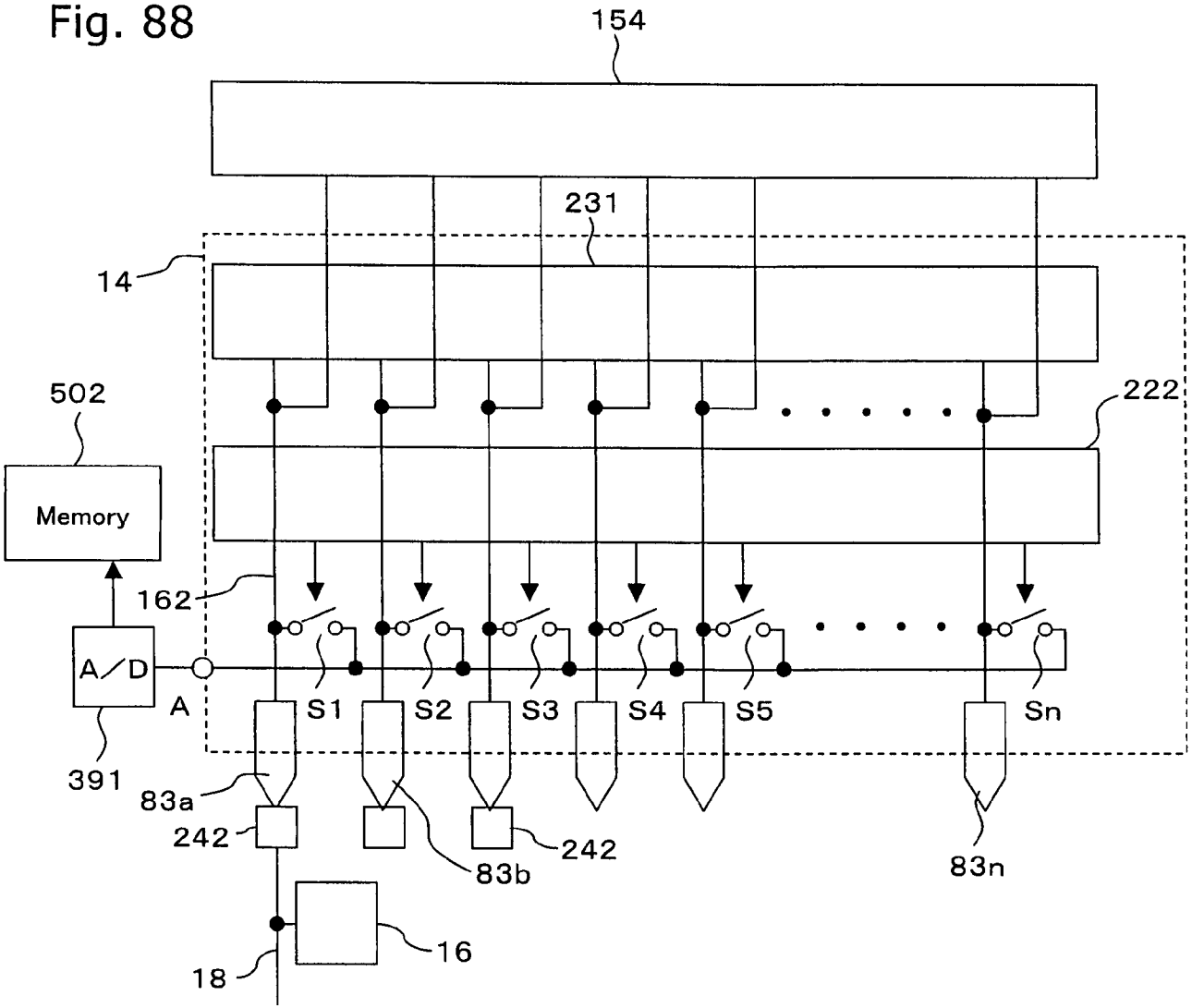
FIG. 88 is a block diagram of a driver circuit of an EL display panel according to the present invention.
Figure 89:
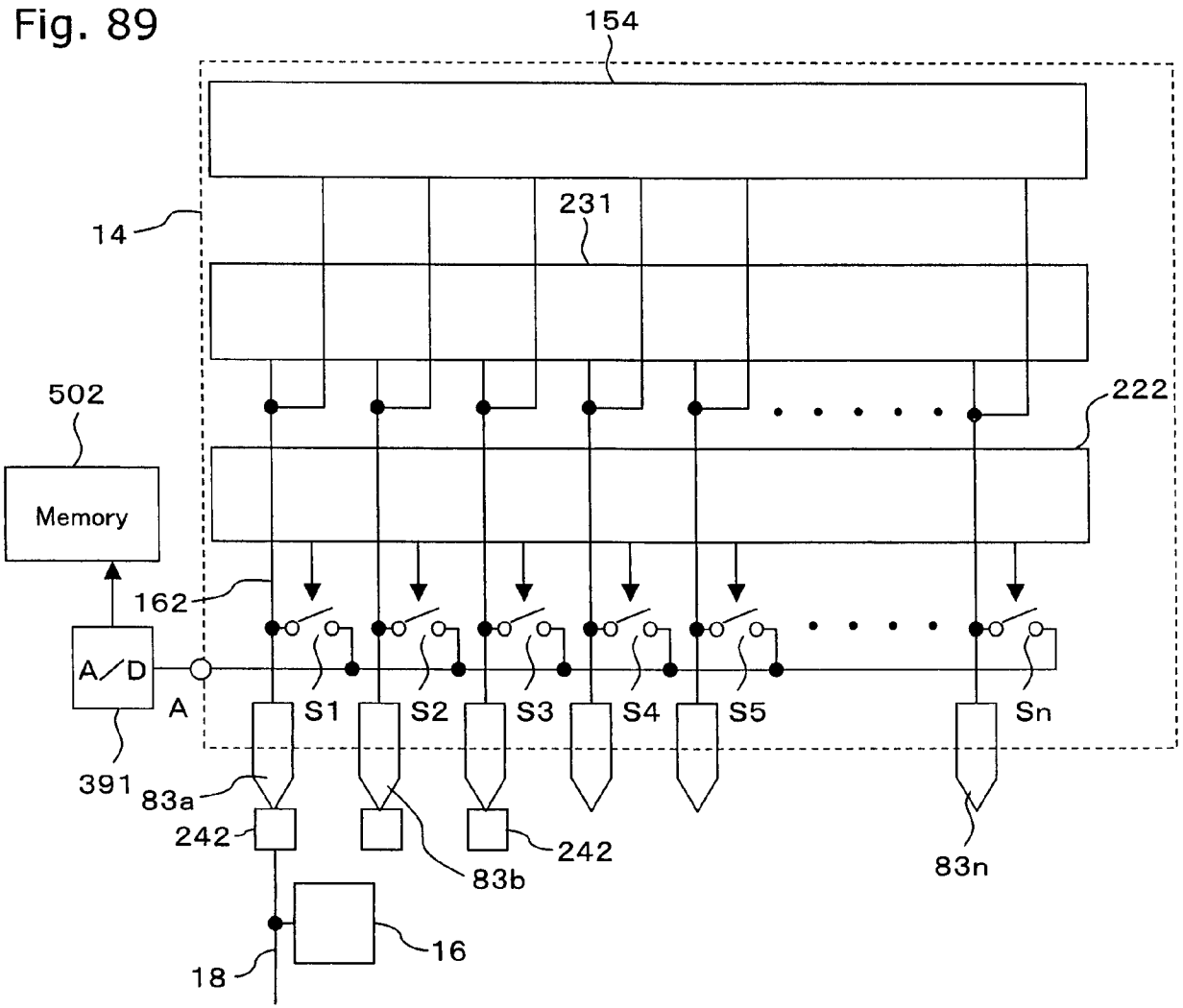
FIG. 89 is a block diagram of a driver circuit of an EL display panel according to the present invention.

The switch Sx may be configured to be able to input or output a potential from an A terminal to each source signal line 18 as shown in FIGS. 89 and 88. Further, of course, the switch Sx may allow not only voltages but also currents or charges to be input and output. Furthermore, the switch Sx need not necessarily be formed inside the source driver circuit (IC) 14 but may be formed outside the source driver circuit (IC) 14. For example, it is possible to connect a probe needle to each source signal line 18 and select one of the probe needles via a rely circuit or the like to apply a voltage or current to or extract a current from the corresponding source signal line 18.

In the above description, the switch Sx is formed in each source signal line 18. However, the present invention is not limited to this. For example, the switch Sx may be formed only in the odd number-th source signal lines 18. Alternatively, the switch Sx may be formed in the multiple-of-four numbered source signal lines 18. Alternatively, depending on the configuration of the display panel, a switch or the like may be formed on or connected to the gate signal line 17.

As described with reference to FIG. 90, the switch Sx may of course be formed to select one of the cathode lines (anode lines). That is, the present invention may use any configuration provided that it can detect or output or select and process a voltage applied to or a current (which, for example, flows through or into the EL element 15) output to each pixel 16 or a selected pixel 16, or a similar current or voltage.

In the diagram in FIG. 87, the A/D (Analog-Digital) conversion circuit, the memory (flash memory or the like) 502, and the like are formed or arranged inside the source driver circuit (IC) 14. However, the present invention is not limited to this. For example, as shown in FIG. 89, the terminal A may be provided in the source driver circuit (IC) 14 to output the voltage applied or output to the source signal line 18 so that the voltage can be applied to the externally placed or constructed A/D conversion circuit 391.

As shown in FIG. 89, the memory 502 may be externally attached to the apparatus. Alternatively, as shown in FIG. 88, the current tone circuit 154 (or current tone circuit) may also be formed or placed outside the source driver circuit (IC) 14 so that an output current from the current tone circuit 154 can be applied to each source signal line 18.

The block diagram in FIG. 87 illustrates the source driver circuit (IC) 14 in accordance with the present invention. The output terminal 83 is connected to the terminal of the source signal line 18 on the array board. The current tone circuit 154 is a current tone circuit. The voltage tone circuit 231 is a voltage output instrument that outputs a program voltage. The selector circuit 222 sequentially selects the switch circuit S (S1 to Sn; n denotes the number of pixel rows) in accordance with an external clock. The selector circuit 222 thus connects the voltage being applied to the output terminal 83 to the analog-digital (A/D) conversion circuit 391.

The A/D conversion circuit 391 digitalizes and holds the voltage applied to the source signal line 18 (applied to the output terminal 83) in the memory 502 in the source driver circuit (IC) 14. Each memory contains 8 bits, and the number of memories 502 produced or formed is equal to that of the pixels.

In the above description, the A/D conversion circuit 391 digitalizes the voltage applied to the output terminal 83 (potential across the source signal line 18=voltage at the gate terminal of the driving transistor 11*a*). However, the present invention is not limited to this. If an analog signal can be sampled and held so that voltage tone data can be generated from the analog signal, the A/D conversion circuit 391 is not required. In FIG. 87, components not required for description are omitted. The source driver circuit (IC) 14 shown in FIG. 87 may of course be combined with any other embodiment of the present invention.

Figure 91:
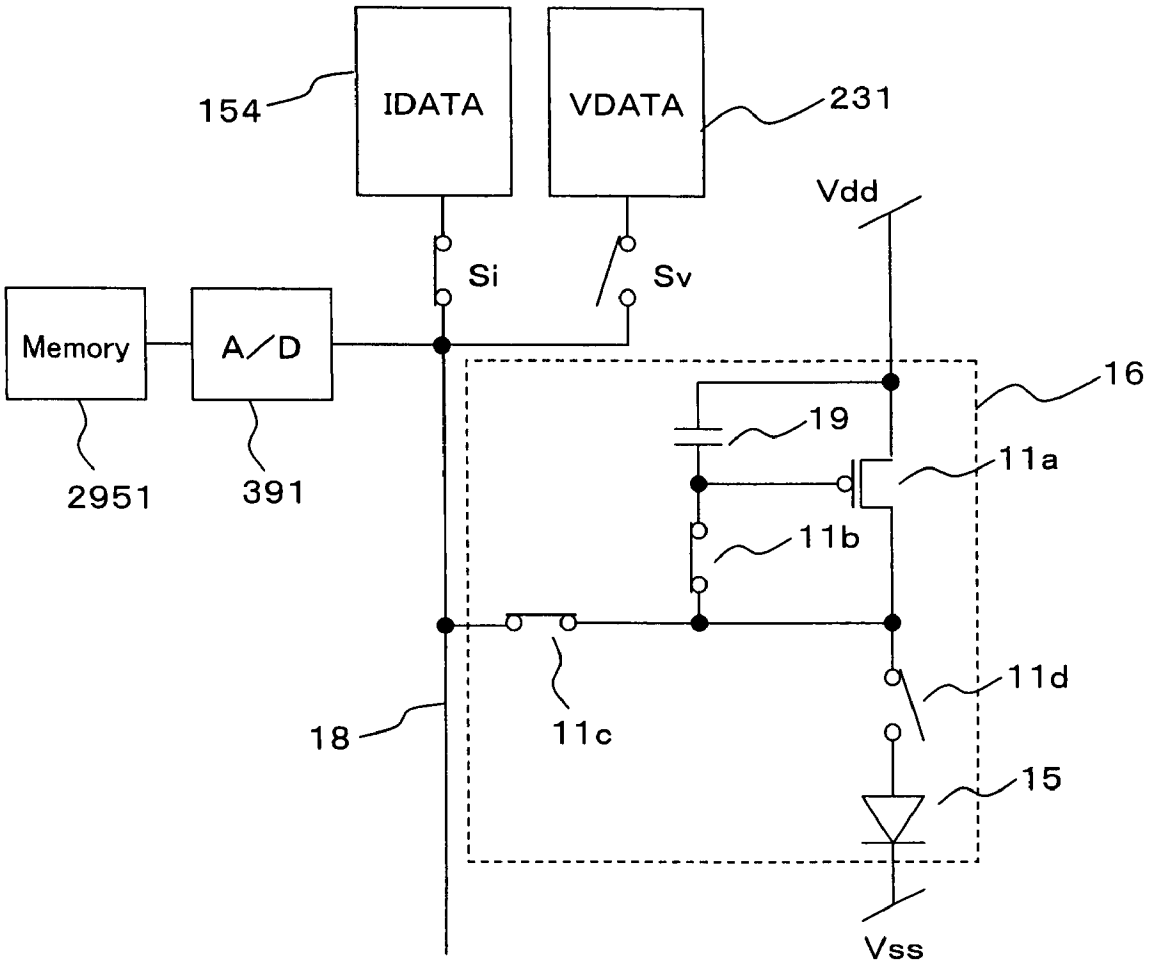
FIG. 91 is a schematic diagram of a driving method of an EL display panel according to the present invention.

FIG. 91 shows a configuration corresponding to an essential part of FIG. 87. Closing the switch Sv causes a program voltage to be output to the source signal line. Closing the switch Si causes the constant current to be output. The current tone circuit 154 is composed of unit transistors 164 as shown in FIG. 16 by way of example. The current tone circuit 154 may be configured to selectively output a specified current of for example, 1 or 0.5 μA.

Figure 92:
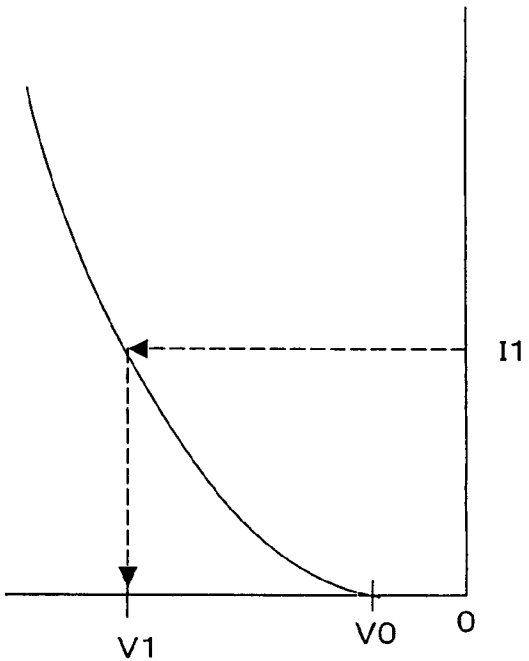
FIG. 92 is a schematic diagram of a driving method of an EL display panel according to the present invention.
Figure 92A:
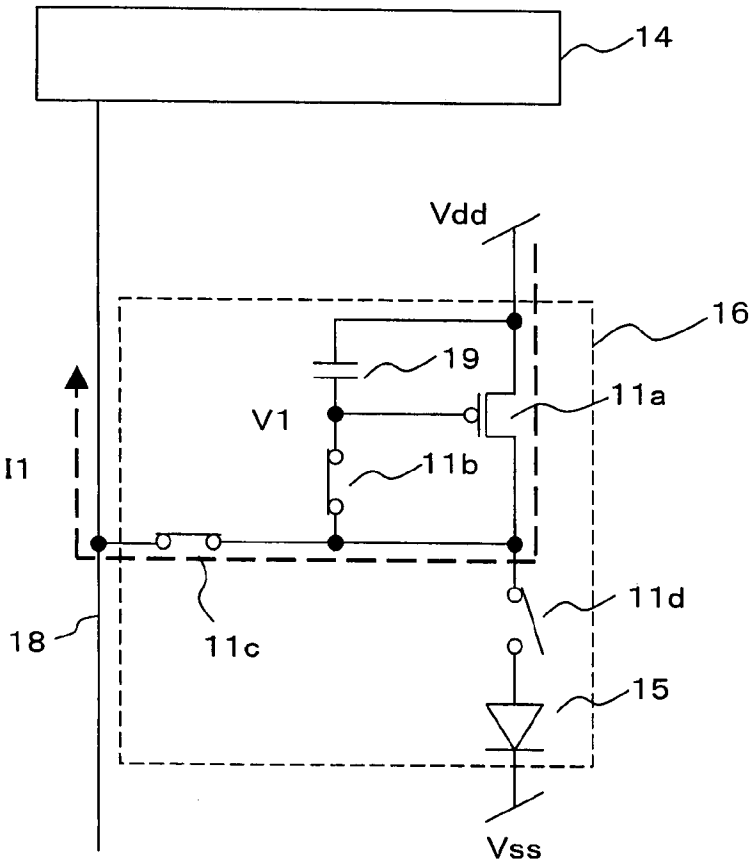

The EL display panel (display apparatus) in accordance with the present invention uses the source driver circuit (IC) 14 in accordance with the present invention. In FIG. 87, the current tone circuit 154 supplies a predetermined constant current I1 to the source signal line 18. The gate driver circuit 12 sequentially selects the pixel row. As shown in FIG. 92(A), the pixel 16 supplies the constant current I1 to the source signal line 18 via the driving transistor 11*a*. The gate terminal of the driving transistor 11*a* has its potential varied so as to pass the constant current I1 through the driving transistor 11*a* (see FIG. 92(B)). The potential at the gate terminal of the driving transistor 11*a* is connected to the source signal line 18 via the switch transistor 11*c*. Consequently, by using the A/D conversion circuit to measure the potential across the source signal line 18, it is possible to measure or determine the voltage at the gate terminal of the driving transistor 11*a* obtained when the constant current I1 is passed through the driving transistor 11*a*.

This enables the measurement of the program voltage V1 that allows the flow of the constant current I1. The program voltage V1 is a point on a characteristic curve (gate voltage-output current (V−1) curve) of the driving transistor 11*a*. The characteristic curve can be estimated on the basis of the V1. The program voltage V1 may be an arbitrary point on the characteristic curve. The voltage V0, corresponding to the tone 0, may also be used. However, the constant current corresponding to the tone 0 is zero. The V0 is the voltage at the gate terminal of the driving transistor 11*a* obtained at the current 0.

The pixels 16 on the display screen 34 have varying characteristics owing to a laser anneal characteristic variation or the like. However, it is possible to pass the constant current I1 through the driving transistor 11*a* and measure the V1 voltage so that the characteristics of each pixel can be determined on the basis of the magnitude of the V1 voltage. Consequently, a characteristic curve of each pixel 16 can be determined on the basis of the magnitude of the V1 voltage. The characteristic curve is determined in real time by converting V1 data with reference to the matrix table or lookup table 931. Alternatively, the characteristic curve may be calculated using a monomial or polynominal.

Figure 56:
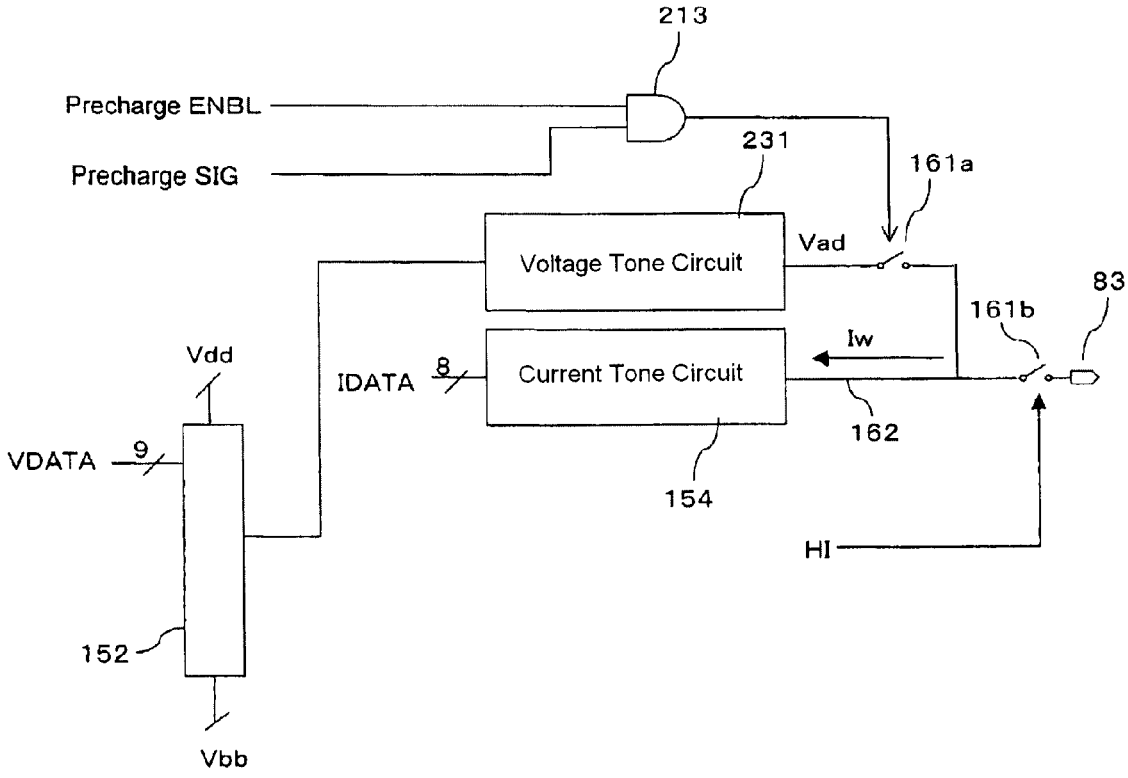
FIG. 56 is a schematic diagram of an EL display panel according to the present invention.
Figure 93:
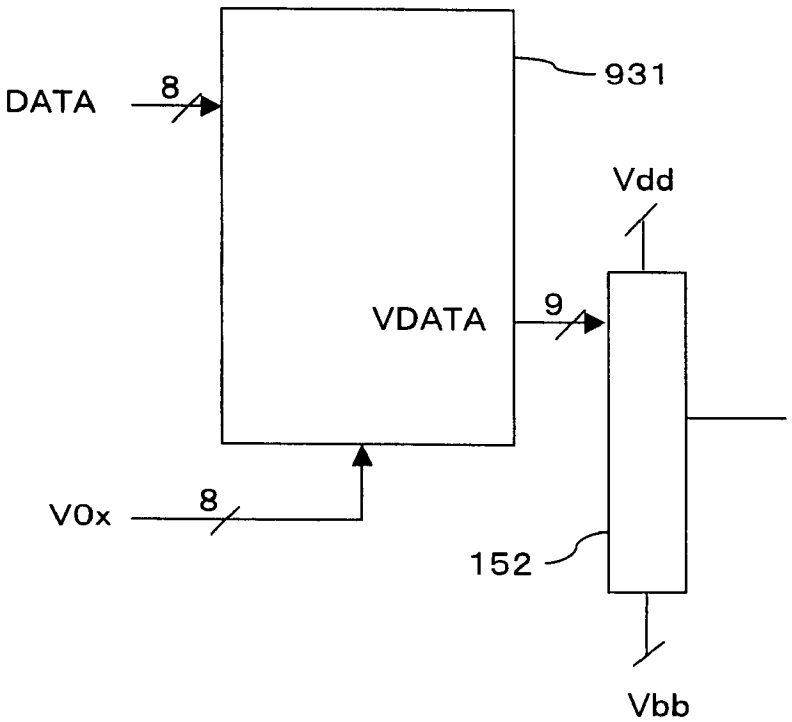
FIG. 93 is a schematic diagram of a driving method of an EL display panel according to the present invention.

FIG. 93 shows a conversion based on the lookup table 931. 8-bit video data DATA is input to the lookup table 931. Measured 8-bit V0x (V1x) data is also input to the lookup table 931. The V0x (V1x) data indicates an address that specifies one tone characteristic data in the lookup table 931. Further, the tone characteristic data specified by the video data DATA allows the selection of tone VDATA corresponding to the video data DATA. The VDATA is output as 9-bit data. As shown in FIG. 56, the VDATA is input to the electronic regulator 152, which then divides the voltage between Vbb and Vdd into a plurality of pieces for output. The output from the electronic regulator 152 is input to the voltage tone circuit 231.

Video tone program data is thus obtained. That is, the video tone data is converted into voltage tone program data in accordance with the estimated or measured V-I curve. The conversion is carried out for each pixel 16. To obtain more accurate voltage tone data, the current tone circuit 154 may generate a plurality of constant currents each of which is passed through the corresponding pixel 16 on the display screen 34 so as to allow the measurement of the potential across the corresponding source signal line 18.

To measure the voltage V1, the output terminals 83*a* to 83*n* provide the constant current I1 to select the gate driver circuit 12*a* so as to supply the I1 current to the driving transistors 11*a* in the selected pixel 16 row. Under the above described condition, the selector circuit 222 sequentially selects the switches S1 to Sn. The A/D conversion circuit 391 measures the potential across the source signal line 18. 8-bit voltage data resulting from a digital conversion by the A/D conversion circuit 391 is stored in a SRAM in a matrix as shown in FIG. 94(A). The present invention is not limited to 8 bits. Any number of bits may be used provided that the number is at least 4.

Figure 94:
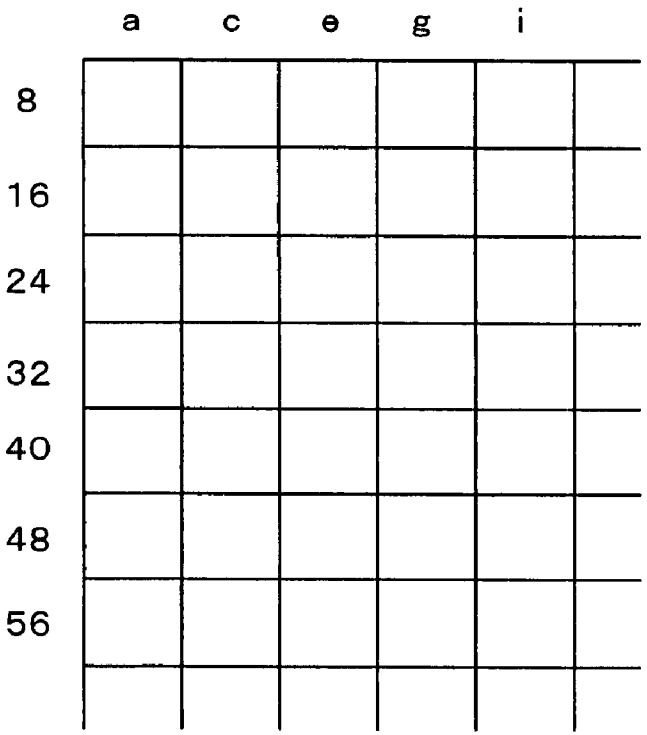
FIG. 94 is a schematic diagram of a driving method of an EL display panel according to the present invention.
Figure 94A:
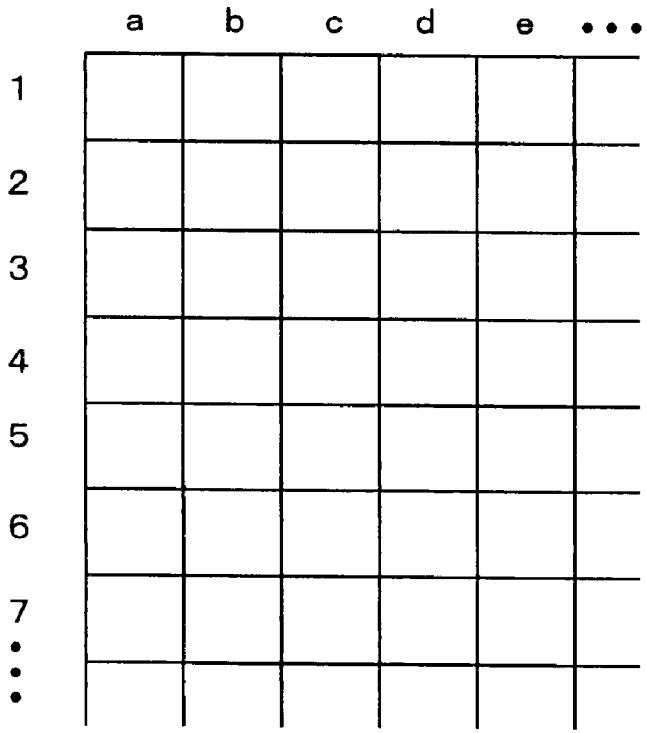

In FIG. 94, a, b, c, d, . . . denote pixel columns, and 1, 2, 3, 4, . . . denote pixel rows. When the switches S1 to sn are sequentially selected to complete measuring the characteristics of the driving transistors 11*a* in the pixels 16 in one pixel row, the gate driver circuit 12*a* is controlled to shift the selected position by one pixel row. The characteristics of the pixels 16 in the next pixel row are then measured.

Figure 95:
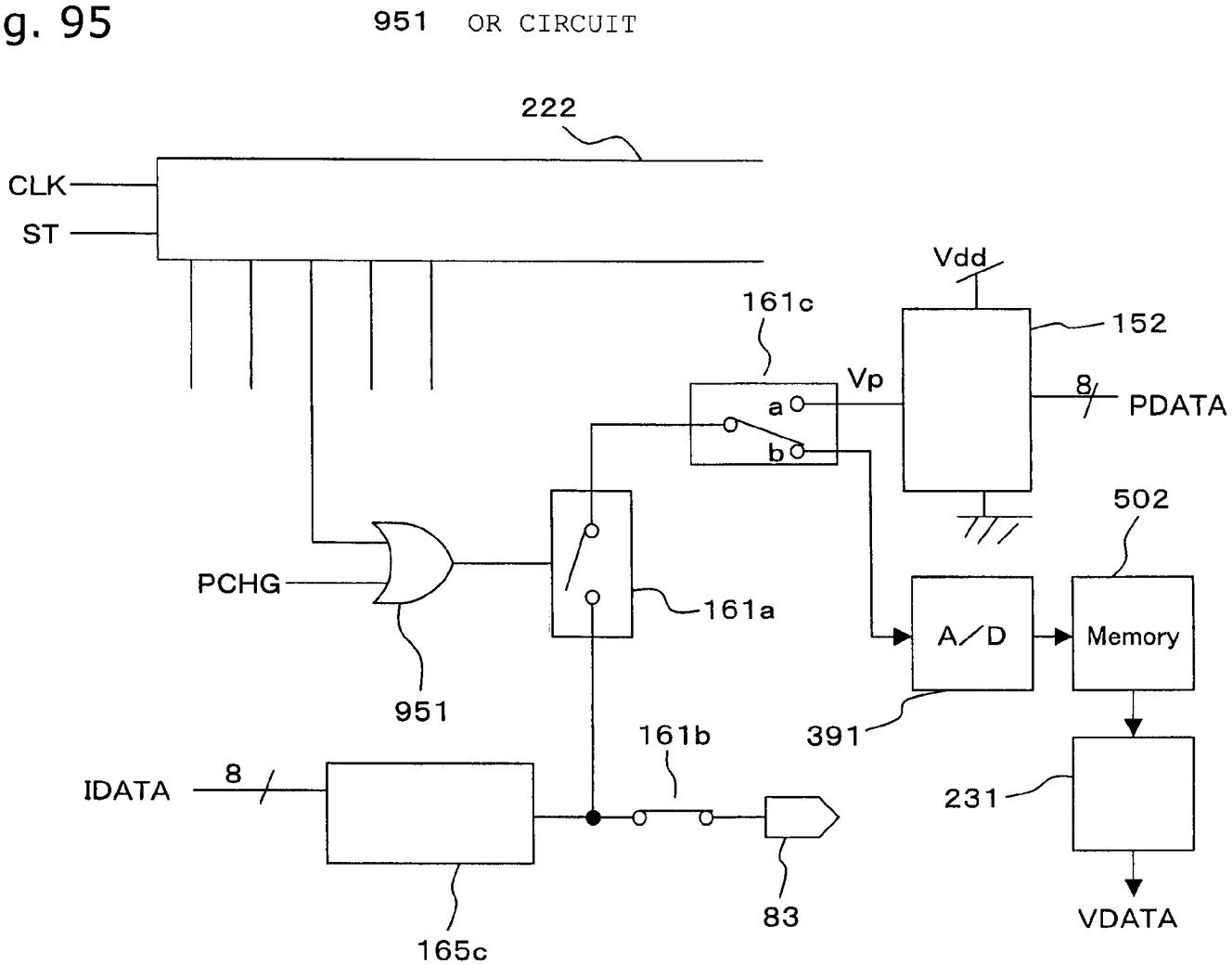
FIG. 95 is a schematic diagram of a driving method of an EL display panel according to the present invention.

FIG. 95 is a block diagram showing FIG. 87 in further detail. The VDATA generates voltage program data. Application of the precharge voltage Vp causes an H level signal to be applied to a PCHG terminal of an OR CIRCUIT 951 to close the switch 161*a*. Further, data PDATA in the precharge voltage Vp causes the electronic regulator 152 to generate a precharge voltage Vp. The switch 161*c* then selects an a terminal to cause the output terminal 83 to output a precharge voltage Vp. To measure the potential across the source signal line 18 (V1 voltage), the selector circuit 222 sequentially closes the switch 161*a* via the OR CIRCUIT. Further, the switch 161*c* is set to a b terminal side and connected to the A/D conversion circuit 391. The measured V1 data is stored in the memory 502. The stored data is converted, by the voltage tone circuit 231, into tone data VDATA corresponding to each video data. The data is then output from the output terminal 83 during an image display period.

The voltage data need not be stored for all pixels 16. For example, the voltage data may be stored for some selected pixels as shown in FIG. 94(B). In FIG. 94(B), the data is stored in the pixel columns a, c, e, g, i, . . . and in every eight rows, that is, in the pixel rows 8, 16, 24, 32, 40, . . . . Since pixels located close to one another have approximate characteristics, the characteristics of the pixels 16 not stored in the SRAM can be determined from the characteristics of the pixels 16 selected to be stored in the SRAM.

The above embodiment uses the source driver circuit (IC) 14 to supply a constant current I1 of 1 or 0.5 μA to the source signal line 18 or driving transistor 11*a* so as to allow the measurement of the potential V1 across the source signal line 18. Alternatively, the potential may be estimated. Alternatively, the voltage at the gate terminal of the driving transistor 11*a* of the appropriate pixel 16 is measured. Further, the potential V0 across the source signal line 18 is measured, which corresponds to the passage of no constant current (see FIG. 96(A)). A characteristic curve of the driving transistor 11*a* is thus determined on the basis of the measured V1 and V0 to create voltage program data corresponding to each tone. The characteristic curve is a substantially square curve. Accordingly, the V0 is defined as a base point, to which given increments are added to determine a voltage value for each tone. Alternatively, the V0 is defined as a base point and a characteristic curve is estimated on the basis of the V0 and V1. A voltage value is then determined for each tone.

The V0 data on each pixel 16 or the V0 and V1 data on each pixel 16 is stored in the source driver circuit (IC) 14. Voltage values for the other tones are generated from the stored V0 data or V0 and V1 data in association with the video signal data as required. The program voltage generated is applied to the source signal line 18. The applied program voltage is applied to the gate terminal of the driving transistor 11*a* in each pixel 16 in synchronism with the gate driver circuit 12*a*. The program voltage is then held for a period corresponding to one field (frame).

Alternatively, only the V0 may be measured so that a characteristic curve can be estimated on the basis of the V0 to determine a voltage tone. As shown in FIG. 96(B), it is also possible to apply the constant current 12 to the source signal line 18 to supply the I2 current to the driving transistor 11*a* in the pixel 16 and then to determine the potential V2 across the source signal line 18 in association with the I2 current so as to allow the tone voltage to be determined from the V0, V2, and V1. That is, the driving scheme in accordance with the present invention uses at least one constant current (including the current 0) to measure the potential across the source signal line 18. The driving scheme then determines the voltage (program voltage) corresponding to the tone, from the measured potential.

Figure 97:
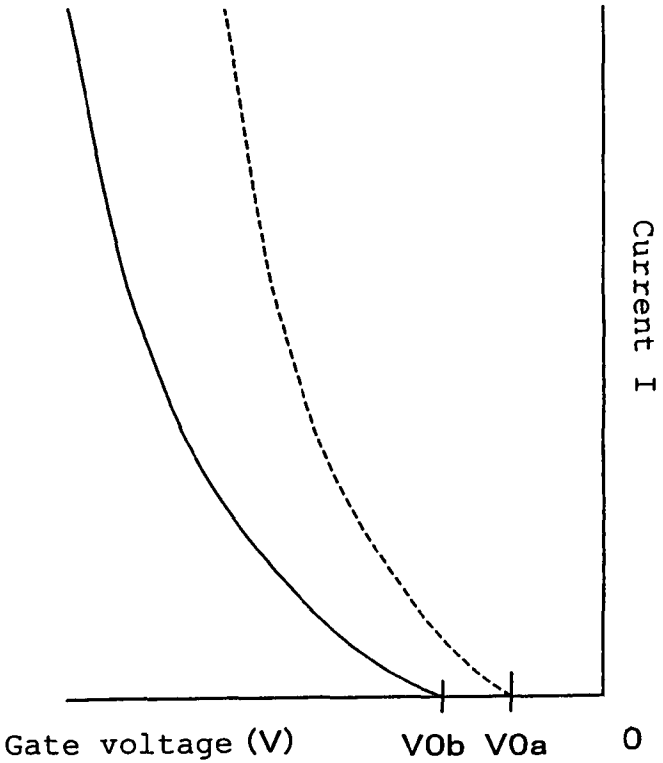
FIG. 97 is a schematic diagram of a driving method of an EL display panel according to the present invention.
Figure 97A:
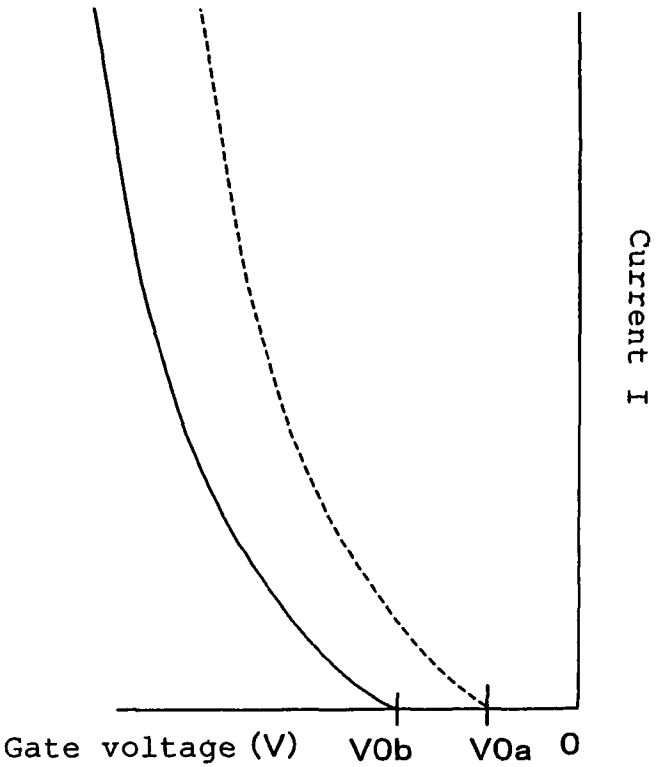

If a characteristic curve is determined on the basis of the V0 voltage or the like, the inclination of the characteristic curve (V-I curve) to the V0 voltage may be fixed. FIG. 97(A) shows an embodiment. The voltage value of the 0th tone of a certain pixel 16 is defined as V0*a*. The voltage value of the 0th tone of the other pixels 16 is defined as V0*b*. The V0*a* is used to generate a dotted characteristic curve. The V0*b* is used to generate a solid characteristic curve. Characteristic curves are generated on the assumption that the dotted and solid characteristic curves have the same inclination. That is, characteristic curves are generated on the assumption that the base points V0*a* and V0*b* have been shifted.

In FIG. 97(B), the inclinations of the characteristic curves are changed. A higher rising voltage (in FIG. 97(B), the V0*b* has a higher rising voltage than the V0*a*) requires the inclination of the characteristic curve to be reduced (in FIG. 97(B), the solid line has a smaller inclination than the dotted line). This is because a higher rising voltage often indicates the degraded mobility of the driving transistor 11*a*. A lower rising voltage requires the inclination of the characteristic curve to be increased. This is because a lower rising voltage often indicates the excellent mobility of the driving transistor 11*a*.

Figure 98:
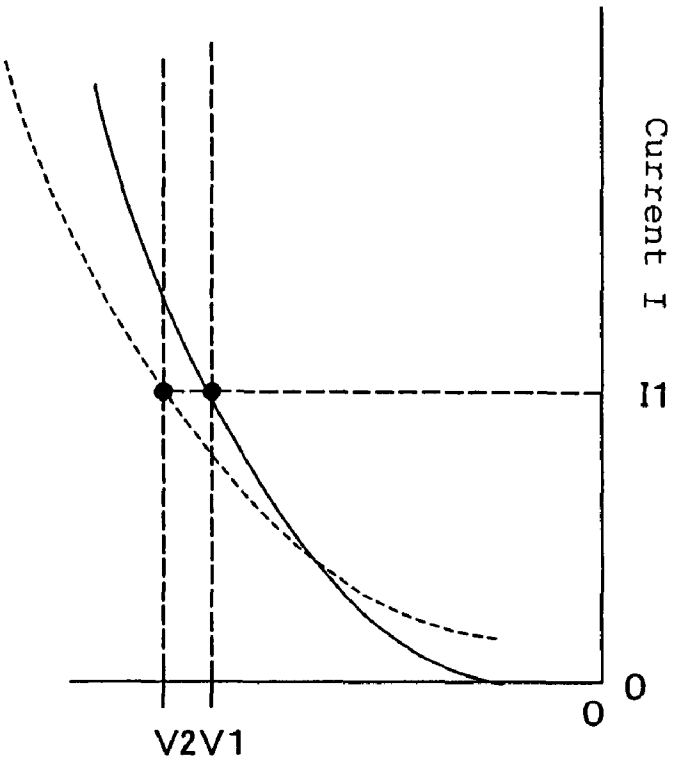
FIG. 98 is a schematic diagram of a driving method of an EL display panel according to the present invention.

As shown by a solid and dot lines in FIG. 98 by way of example, the V-I (gate voltage-drain current) characteristic of the driving transistor 11*a* may vary owing to the laser anneal characteristic variation or the like. However, if the gate voltage V (V1 for the driving transistor 11*a* shown by the solid line and V2 for the driving transistor 11*a* shown by the dot line) of the driving transistor 11*a* can be measured when, by way of example, I1=1 μA is passed through the driving transistor 11*a*, the output current I corresponding to the gate voltage V can be estimated. Further, since the output current I corresponding to the V1 or V2 can be accurately determined to be 1 μA, the output current for each tone (=the current flowing through the EL element 15) can be almost accurately determined.

The above embodiment measures I=1 μA to estimate a V-I curve so as to allow each tone current to be calculated. If the I can be measured at a plurality of points such as 0 μA (corresponding to the tone 0), 2 μA, and 0.5 μA and the voltage at the gate terminal of the driving transistor 11*a* which corresponds to each of the current values can be measured, better V-I curves can be determined to realize good image display with even characteristics.

With the driving method, the display panel, and the flat display apparatus using the display apparatus and the display panel in accordance with the present invention, the V0 or V1 voltage or the I1 current is measured or the corresponding data is determined so as to allow a V-I curve of driving transistor 11*a* or the like to be estimated or generated on the basis of the measured or determined data. Of course, it is also possible to determine or estimate a V-I curve on the basis of appropriate data and then accumulate the program current or voltage corresponding to each tone in the memory or the like so as to allow data corresponding to the program voltage or current to be read from the memory (storage instrument) and applied to the pixel 16.

The display panel in accordance with the present invention, during other than display period, applies a predetermined constant current to each pixel 16 via the current tone circuit 154 or the like to acquire the gate voltage V of a transistor which corresponds to the constant current, the transistor supplying a current to the EL element 15 such as the driving transistor 11*a* or performing a similar operation. The voltage V acquired is one or more voltage data. The voltage data is used to determine tone voltage data corresponding to a video signal generated by the voltage tone circuit 231. Alternatively, the voltage V acquired may be used. Of course, the predetermined constant current may be generated outside the source driver circuit (IC) 14 and then supplied to each source signal line 18.

The tone voltage data is applied during the A period shown in FIG. 25. The A period is not necessarily required as previously described. This is because a larger tone enables sufficient driving with the data in the current tone circuit 154. The voltage applied during the A period causes the driving transistor or the like to be programmed up to a luminance close to a target value. Moreover, the driving transistor 11*a* is further programmed closer to the target value by a tone current (program current) applied during the B period by the current tone circuit 231.

This also applies to the case where the V0 or V1 voltage or a larger voltage value is measured. In the above description, a characteristic curve is generated from the measured V0 or V1 voltage. However, the voltage data measured from the source signal line 18 is not used as it is. For example, the pixel configuration shown in FIG. 1 and others generates a tone voltage taking into account the magnitude and adverse effect of a punch-through voltage resulting from application of an off voltage to the gate signal line 17*a* and emitted to the gate terminal of the driving transistor 11*a*. That is, a V-I curve is created taking the above described effect into account on the basis of the measured voltage.

Figure 99A:
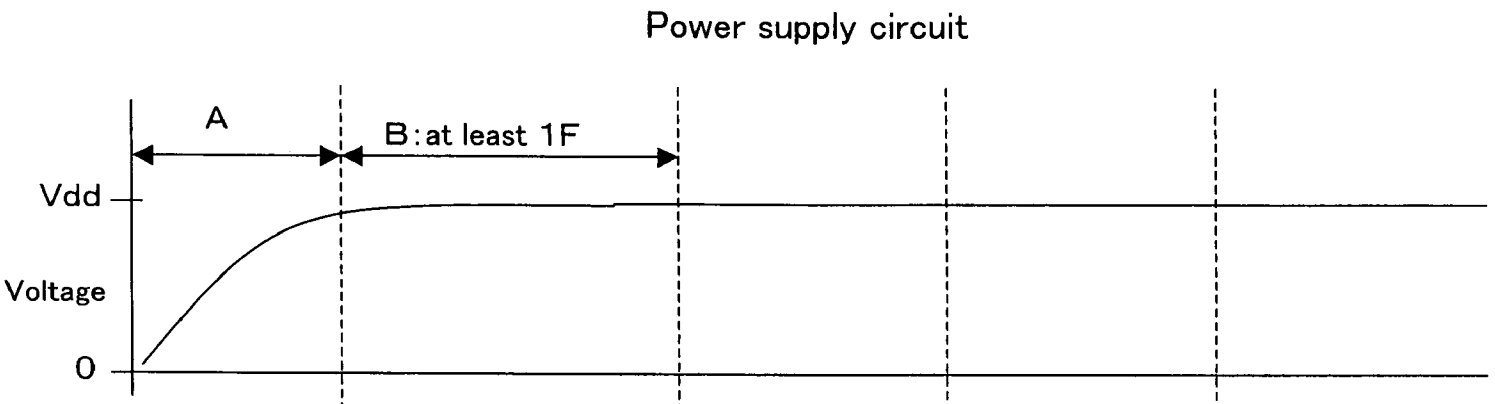
FIG. 99 is a schematic diagram of a driving method of an EL display panel according to the present invention.

The following are carried out at the time of power on: the measurement of the voltage across the source signal line 18 and determination of a tone voltage from the measured potential. That is, these operations are performed before image display. FIG. 99(A) shows a rising waveform of the power supply. During an A period, the voltage reaches Vdd. During this period, the entire circuit in the EL display apparatus is unstable. Consequently, the voltage across the source signal line cannot be measured. During a B period, the power supply rises and is stabilized. The apparatus is not in an image display state. The B period lasts a time corresponding to one field (frame). During this period, the potential across the source signal line 18 which corresponds to the constant current is measured and a tone voltage value is generated. Subsequently, during a C period, an image is displayed on the EL display panel (see FIG. 99(B)).

Figure 100:
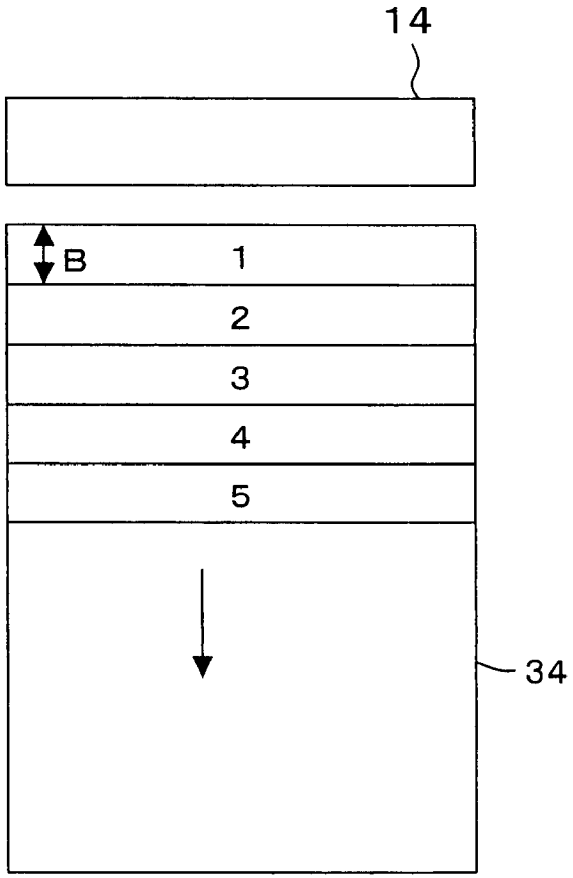
FIG. 100 is a schematic diagram of a driving method of an EL display panel according to the present invention.
Figure 100:
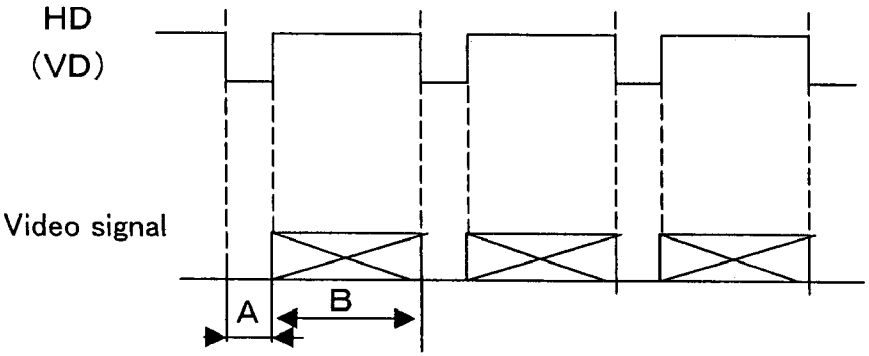

The following may be carried out during a vertical or horizontal blanking period: the measurement of the voltage across the source signal line 18 and determination of a tone voltage from the measured potential. FIG. 100(A) shows an embodiment in which these operations are performed during a horizontal blanking period. A video signal is applied to the source signal line 18 during a B period shown in FIG. 100. An A period is a blanking period during which no video signal is applied to the source signal line 18. During the A period, the source driver circuit (IC) 14 outputs the constant current and supplies the current I1 to the appropriate pixel row. Further, the potential across the source signal line 18 is measured, and a tone voltage is determined from the measured potential. During a horizontal blanking period, the tone voltage cannot be determined for the entire display screen 34. As shown in FIG. 100(B), the determination is made for each of the areas (1, 2, 3, 4, 5, . . . ) into which the display screen 34 is divided and each of which corresponds to a b period.

Figure 99:
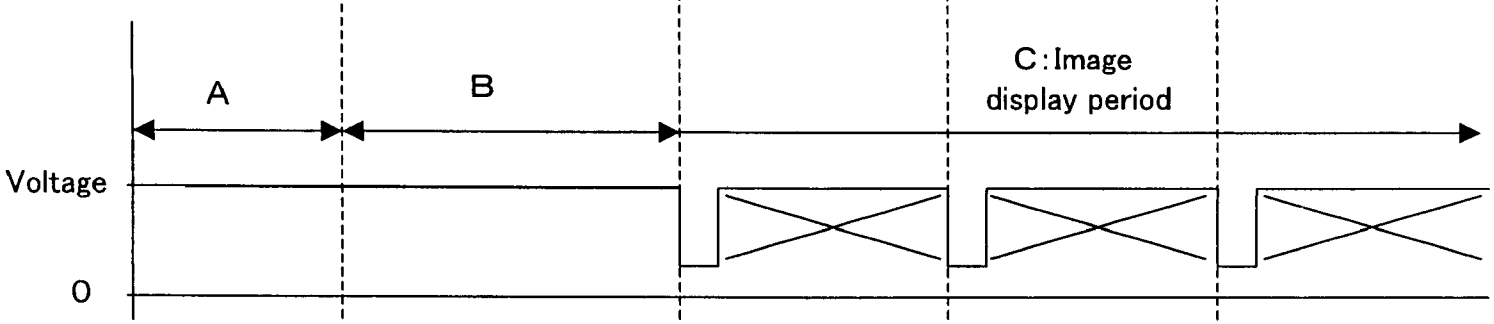

The V0 voltage corresponding to the 0th tone may be measured at the time of power on as shown in FIG. 99. The V1 voltage corresponding to the intermediate or maximum tone may then be measured during a blanking period as shown in FIG. 100.

The V0 voltage or the like which corresponds to a lower tone portion is measured by applying a very small constant current (program current) to the source signal line 18. These voltages are thus affected by the parasitic capacitance of the source signal line 18 and have large time constants. Accordingly, the voltage corresponding to the lower tone portion is measured over a sufficient time by delaying a clock for the gate driver circuit 12*a*. Therefore, the voltage corresponding to the lower tone portion is preferably measured at the time of power on or the like.

In the embodiment of the present invention, the source driver circuit (IC) 14 outputs the constant current Iw (including the Iw=0 (A)) (either a discharge or sink current) to select the pixel 16. The constant current Iw or the constant current Iw in a substantially steady state flows through the driving transistor 11*a* in the pixel 16. Under this condition, the potential across the source signal line 18 or the potential at the gate or drain terminal of the driving transistor 11*a* is measured or acquired. Measurement or acquisition of the potential need not necessarily be carried out in a steady potential state. If the steady state is estimated or predicted, the measurement or acquisition may be carried out in a varying state to determine the potential in the steady state.

The above embodiment applies the constant current Iw and measures the potential across the source signal line 18 to determine the characteristics of the driving transistor 11*a* in the pixel 16. However, the reverse operation may be performed in order to determine the characteristics of the driving transistor 11*a*. That is, a predetermined constant voltage Va is applied to the source signal line 18 or to the driving transistor 11*a* in the pixel 16. A current Ia is then measured which flows through the driving transistor 11*a* when the constant voltage Va is applied. The current Ia depends on the characteristics of the selected driving transistor 11*a*. Accordingly, the current Ia enables the determination of characteristics of the driving transistor 11*a*. The measured or acquired current Ia is subjected to a current-voltage conversion and then to an A/D conversion, with the resulting data held in the storage instrument such as the memory. Of course, the above description is applicable to the other embodiments of the present invention.

The above embodiment passes the constant current through all pixels on the display screen 34 and then measures the potential across the source signal line 18 in each pixel (voltage at the gate terminal of the driving transistor 11*a* in each pixel 16). However, the present invention is not limited to this. Measurement need not be carried on all pixels because the characteristics of an arbitrary pixel are similar to those of pixels around this pixel.

Figure 101:
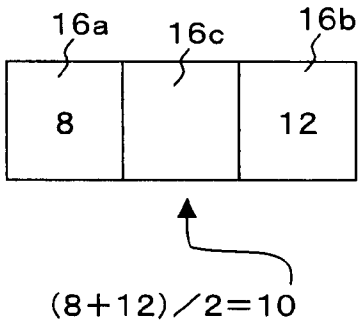
FIG. 101 is a schematic diagram of a driving method of an EL display panel according to the present invention.
Figure 101:
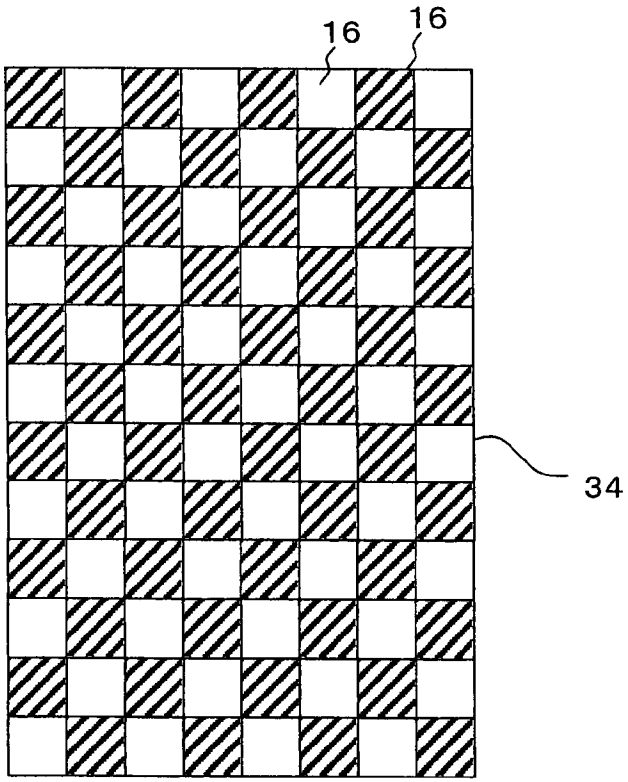

For example, in FIG. 101(A), measurement is carried out on every other pixel 16 (shaded pixels). Pixels 16 on which measurement is not carried out are created from the respective adjacent pixels (shaded pixels). As shown in FIG. 101(B), to determine a driving voltage for a pixel 16*c*, the constant current is passed through adjacent pixels 16*a* and 16*b* and the potential across the corresponding source signal line 18 is measured. For example, it is assumed that the measured data is 3 (V) when the pixel 16*a* is selected and is 2.8 (V) when the pixel 16*b* is selected. The driving voltage for the pixel 16*c* is determined by (3+2.8)/2=2.9 (V).

Not all pixels 16 need be subjected to the operation of applying the constant current to the pixel 16 to change the potential across the source signal line 18. Further, the measurement is not limited to the adjacent pixel 16. For example, the characteristics of every two pixels 16 may be measured. It is also possible to select even-numbered pixel columns and to measure the characteristics of the driving transistors 11*a* in the even-numbered pixel columns so as to allow the characteristics of the driving transistors 11*a* in odd-numbered pixel columns to be determined on the basis of the results of the measurement. It is also possible to select even-numbered pixel rows and to measure the characteristics of the driving transistors 11*a* in the even-numbered pixel rows so as to allow the characteristics of the driving transistors 11*a* in odd-numbered pixel rows to be determined on the basis of the results of the measurement. The above process may be executed for every plural pixel rows or every plural pixel columns.

Figure 102:
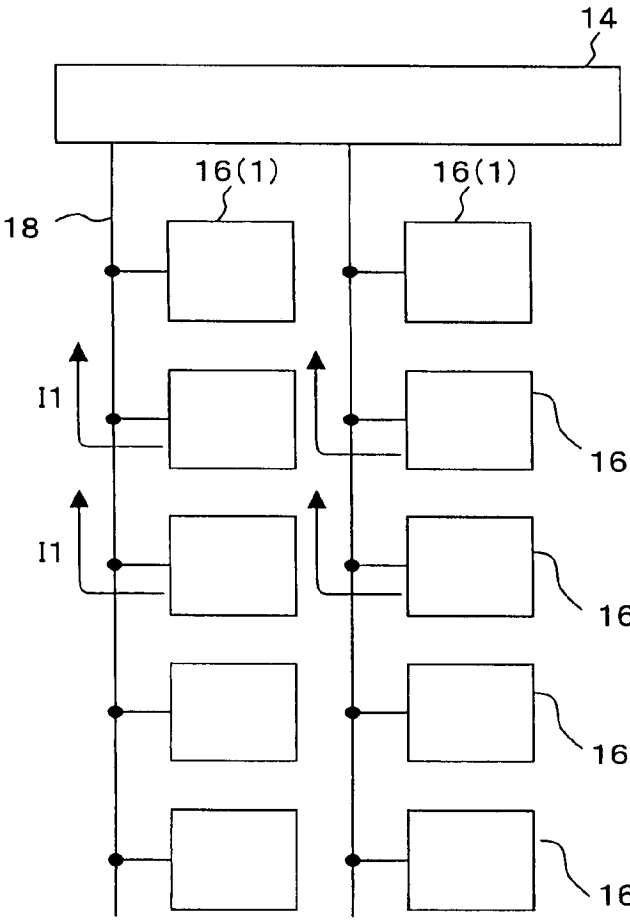
FIG. 102 is a schematic diagram of a driving method of an EL display panel according to the present invention.
Figure 102:
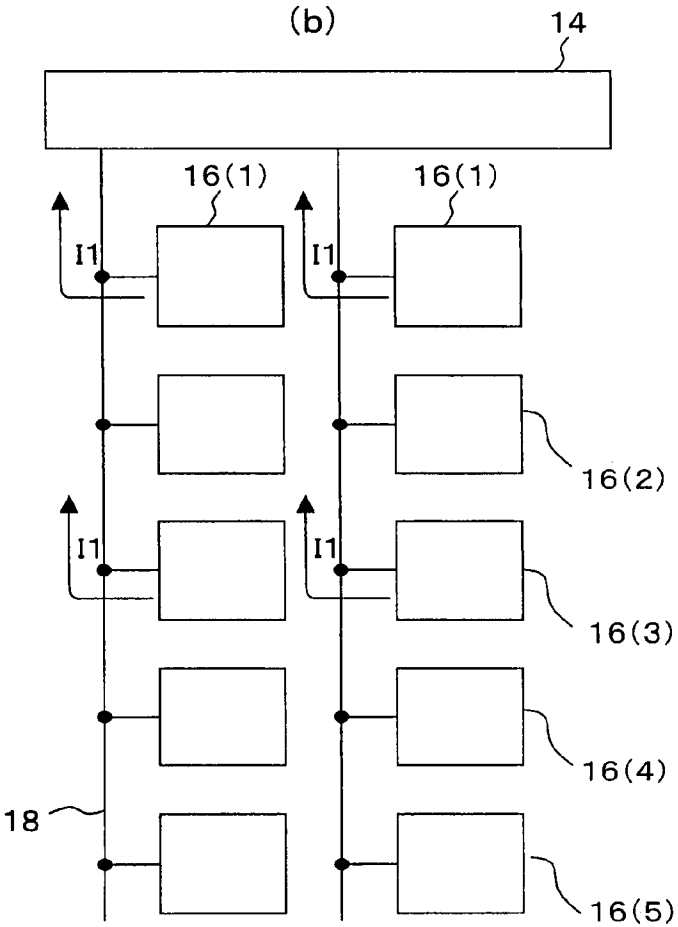

It is not necessary to select one pixel row at a time. Further, the measurement of the potential across the source signal line need not be carried out on one pixel at a time. For example, as shown in FIG. 102(A), two pixel rows (plural pixel rows) may be simultaneously selected, with the constant current Iw passed through them. If two pixel rows are simultaneously selected as shown in FIG. 102, the source driver circuit (IC) 14 supplies double the constant current I1 (that is, Iw=I1×2) to the source signal line 18. Of course, the Iw is not limited to the double of the I1 but may be equal to the I1 or its any other multiple.

FIG. 102(A) shows that the second and third pixel rows have been selected. At the next clock, driving may be carried out so as to select pixels (3) and (4) or pixels (4) and (5). More or less than three pixel rows may be simultaneously selected. In some embodiments, all pixel rows may be simultaneously selected.

The source driver circuit (IC) 14 supplies the constant current Iw=2×11 to pixels 16(2) and 16(3). A current output by the pixel 16(2) and a current output by the pixel 16(3) are added together to obtain the current 2×11. However, the current output by the pixel 16(2) may be different from the current output by the pixel 16(3). The potential across the source signal line 18 corresponds to the balance between the potentials of the gate terminals of driving transistors 11*a* in the pixels 16(2) and 16(3). The potential is often the average of the potentials of the gate terminals of driving transistors 11*a* in the pixels 16(2) and 16(3). However, since adjacent pixels have approximate characteristics, voltage tone data obtained from potentials measured by the A/D conversion circuit 391 pose no problems in a practical sense.

If a plurality of pixel rows are selected, they need not be adjacent to each other as shown in FIG. 102(B). In FIG. 102(B), a plurality of pixel rows not adjacent to one another are selected. Alternatively, the gate signal line 17*a* may be selected for about 10 consecutive pixel rows (that is, a block of pixel rows) to allow the measurement of the potentials across the corresponding source signal lines 18.

The above embodiment passes a current through the driving transistor 11*a* and measures the voltage at the gate terminal of the driving transistor 11*a* through which the current is flowing. However, the present invention is not limited to this.

For example, a current meter (not shown) is connected to a Vss terminal (cathode terminal) connected to or formed at each pixel column. Then, the V0 voltage corresponding to the 0th tone is applied and adjusted so that the current flowing through the current meter during application of the V0 voltage is zeroed or has a very small value. This enables the program voltage V0 corresponding to the tone 0 to be accurately determined.

Alternatively, by adjusting the voltage applied to the driving transistor 11*a* so that a current of 1 μA is measured by the current meter, it is possible to measure the voltage causing the conductance of 1 μA. A more accurate V-I curve can be estimated or determined by measuring the relationship between the voltage and current at a plurality of points.

The above embodiment simultaneously selects a plurality of pixel rows. Of course, a plurality of pixel columns may be simultaneously selected instead.

The above embodiment simultaneously selects a plurality of pixel rows and applies the constant current Iw to these pixel rows to allow the measurement or acquisition of a potential characteristic corresponding to the average of the potentials at the gate terminals of the driving transistors 11*a* in the plurality of pixel rows. That is, the embodiment measures the average of the potentials at the gate terminals of the driving transistors 11*a* in the plurality of pixel rows.

The above embodiment selects a plurality of pixel rows or columns, applies the constant current Iw to these pixel rows or columns, and measures the potentials across the corresponding source signal lines 18 to determine the characteristics of the driving transistors 11*a* in the pixels 16. However, the reverse operation may be performed in order to determine the characteristics of the driving transistor 11*a*. That is, the predetermined constant voltage Va is applied to the source signal line 18 or to the driving transistor 11*a* in the pixel 16. The current Ia is then measured which flows through a selected plurality of the driving transistors 11*a* when the voltage Va is applied. The current Ia depends on the characteristics of the selected driving transistors 1*a*. Accordingly, the current Ia enables the determination of characteristics of the driving transistor 11*a*. The measured or acquired current Ia is subjected to a current-voltage conversion and then to an A/D conversion, with the resulting data held in the storage instrument such as the memory. Of course, the description in this paragraph is applicable to the other embodiments of the present invention.

Figure 2:
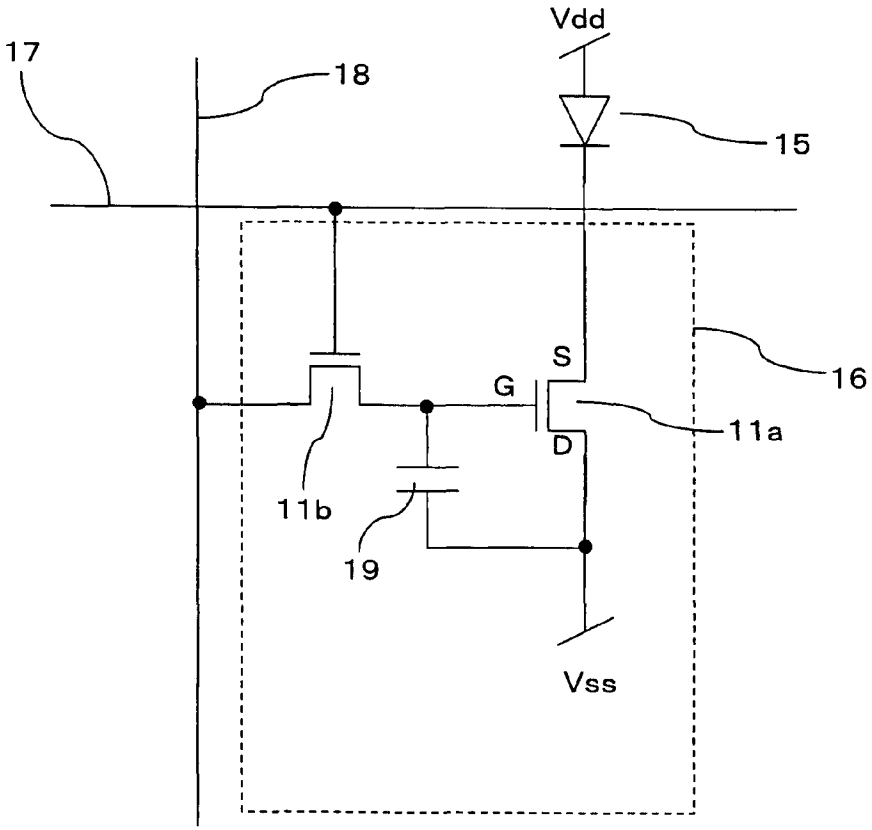
Fig. 2 PRIOR ART
FIG. 2 is a pixel block diagram of a conventional EL display panel.

The present invention can be implemented with a pixel configuration based on the voltage driving scheme such as the one shown in FIG. 2. This is illustrated in FIG. 90. In FIG. 90, the pixels 16 are formed or arranged in a matrix. However, for easy description, only two pixels 16 are shown. Of course, the switch Sx selecting a cathode (anode) current flowing through each pixel 16 may be formed or configured or located so as to extract the cathode (anode) current.

With the voltage driving, the predetermined voltage V1 is applied to the gate terminal of the driving transistor 11*a*. The current I resulting from the voltage V1 is measured at a cathode Vss terminal. For example, the current meter is connected to the Vss terminal (cathode terminal) connected to or formed at each pixel row. Alternatively, as shown in FIG. 90, a pickup resistor R may be connected to a path through which the cathode current flows so as to allow the potential at the resistor R to be measured with a volt meter (voltage measuring circuit) 391.

The position at which the pickup resistor R is inserted into the path is not limited to the cathode terminal but may be the anode terminal. Alternatively, the current may be measured at both the cathode and anode terminals. Further, the present invention is not limited to the direct measurement of the current I1. A pickup coil or the like may be used for the measurement. Alternatively, measurement may be carried out on electric lines of force. When a high accuracy is not particularly required, it is possible to short circuit a plurality or all of the cathode or anode terminals and to connect current meters to the short-circuited positions. That is, any method which measures the current I1 may be used provided that it enables the direct or indirect measurement or determination of the current I1.

As described above, the voltage tone circuit 231 applies the known voltage V1 to the source signal lines 18 for the driving transistor 11*a*. The output current I1 corresponding to this voltage is then measured. Of course, it is possible to select one or more source signal lines 18 and to apply a known voltage to these source signal lines 18. Alternatively, a plurality of pixel rows may be simultaneously selected or scanned and selected. Consequently, the resulting relationship is reverse to that shown in FIG. 92(B). That is, the I1 is measured on the basis of application of the V1. The V-I characteristic of the driving transistor 11*a* shown by a solid line in FIG. 92(B) is then determined on the basis of the relationship between the V1 and the I1. The program voltage V0, corresponding to the tone 0, can be accurately determined by applying the V0 voltage, corresponding to the 0th tone, in addition to the V1 and adjusting the applied V0 so that the current flowing through the current meter during application of the V0 voltage is zeroed or has a very small predetermined value. In this case, the output voltage from the voltage tone circuit 231 is varied and adjusted to zero. Further, a voltage Vx applied to the driving transistor 11*a* is adjusted so that, for example, 1 μA flows through the driving transistor 11*a*. A more accurate V-I curve can be estimated or determined by measuring the relationship between the voltage V and current at a plurality of points.

Figure 90:
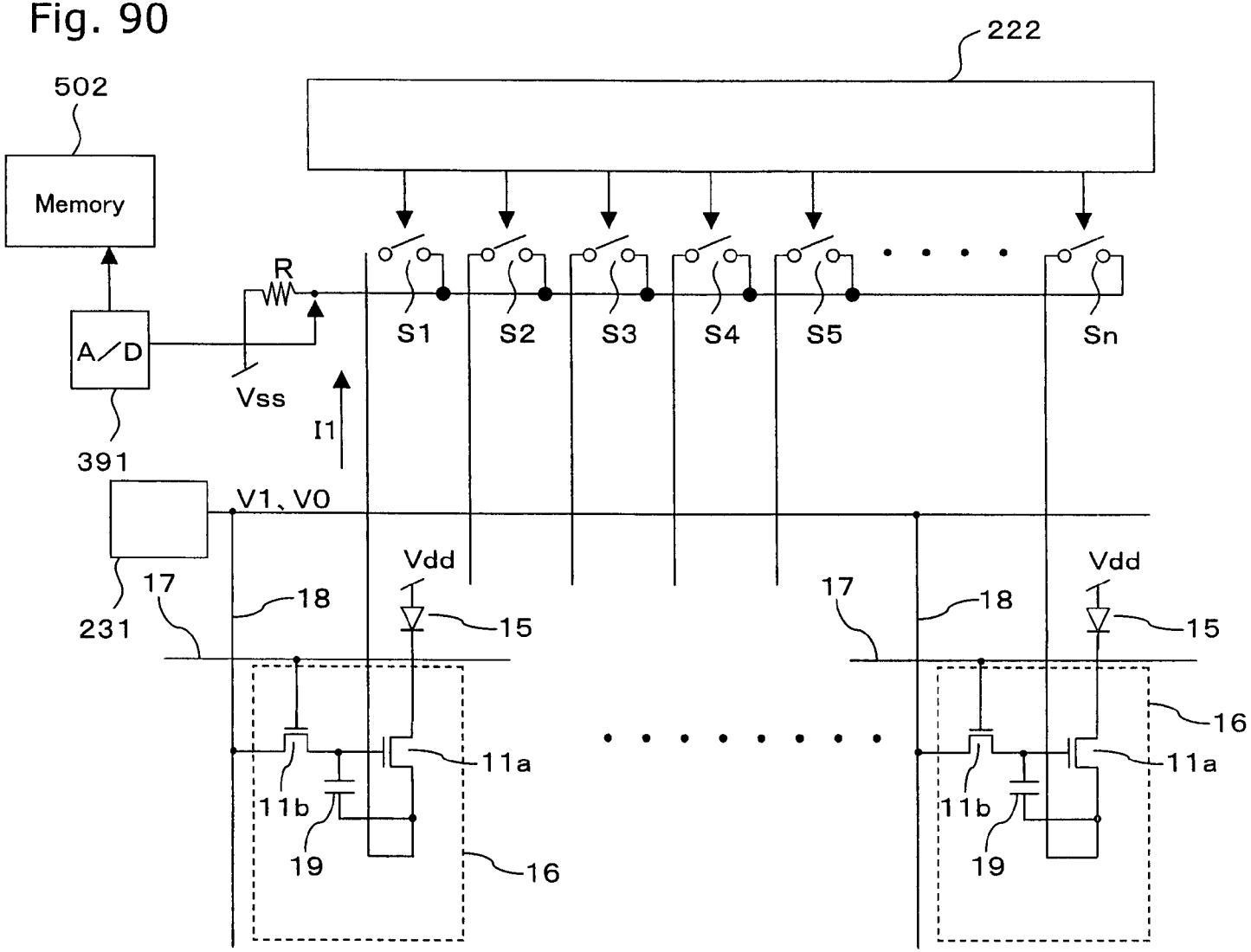
FIG. 90 is a block diagram of a driver circuit of an EL display panel according to the present invention.

The embodiment shown in FIG. 90 uses the selector circuit 222 to sequentially close the switches S in synchronism with the clock. The switch Sx (x=1 to n) selects the pixel 16 connected to each source signal line 18. Further, the gate driver 12*a* selects one of the pixels 16 in the selected pixel row, the position of which is sequentially shifted.

Selection of each switch S allows the cathode current I1 (or anode current) to flow through the selected pixel 16 into the resistor R. A plurality of switches S may be simultaneously selected. Voltages generated at the opposite ends of the resistor R by the cathode current or the like are digitalized by the A/D conversion circuit 391 and stored in the memory 502. The tone voltage corresponding to the program voltage is calculated or determined on the basis of the stored data. Of course, the current meter may be used to measure the cathode current I1 or the like. The tone 0 of course involves zero voltages generated at the opposite ends of the resistor R. The cathode current may flow in a discharge direction. The present invention is applicable in any case.

Figure 103:
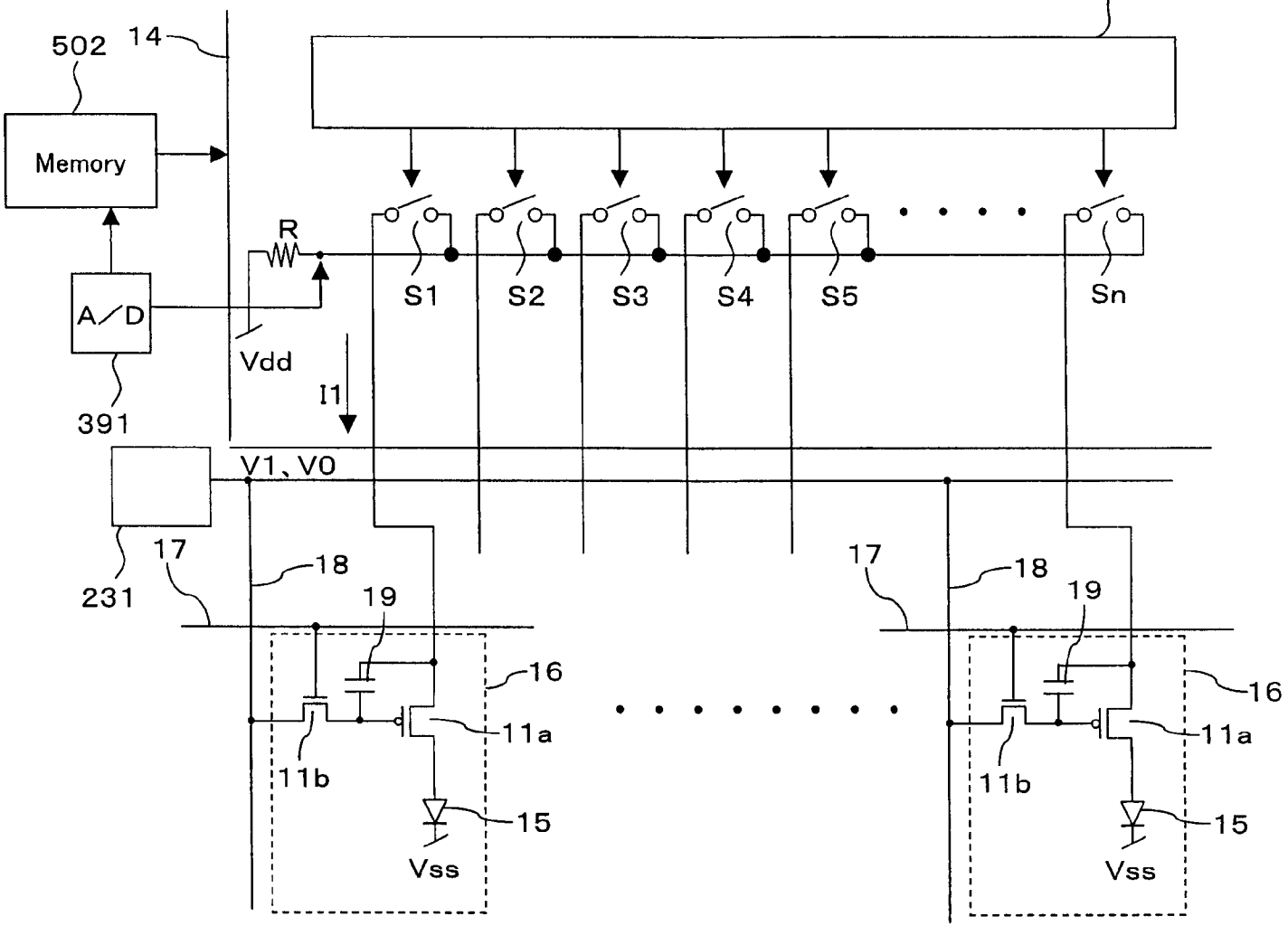
FIG. 103 is a block diagram of a driver circuit of an EL display panel according to the present invention.
Figure 104:
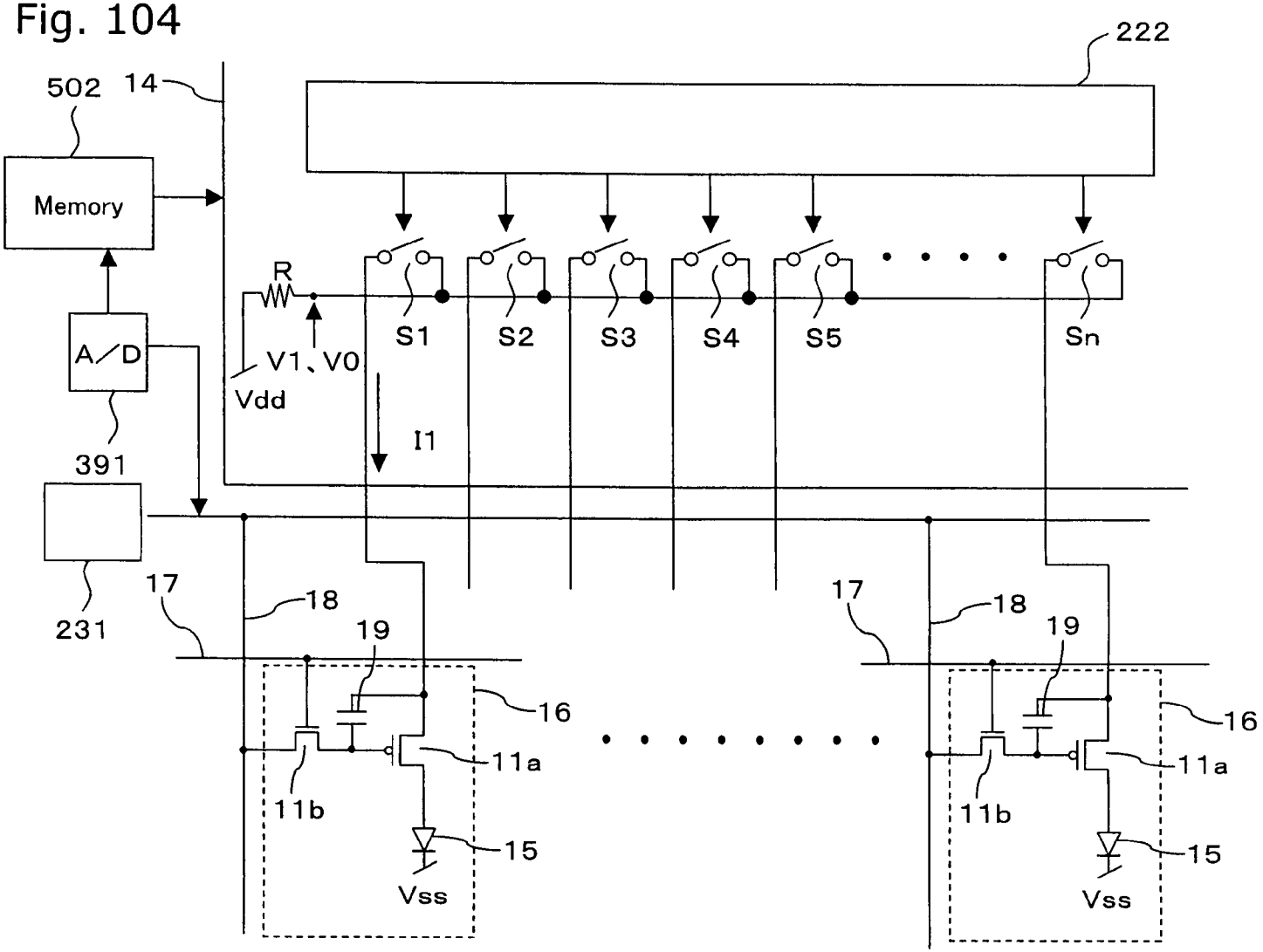
FIG. 104 is a block diagram of a driver circuit of an EL display panel according to the present invention.

FIGS. 103 and 104 show an applied example of the voltage program pixel configuration in accordance with the second embodiment of the present invention. The driving transistor 11*a* in the pixel 16 is formed of a P channel transistor. Further, the current I1 is supplied to the anode terminal Vdd.

The voltage driving requires the voltage V1 to be applied to the driving transistor 11*a*. Further, the current I1 resulting from the voltage V1 is measured at the Vdd terminal. For example, as shown in FIG. 103, the pickup resistor R is connected to the path through which the anode current flows to allow the voltages at the opposite ends of the R to be measured with the volt meter (A/D conversion circuit 391) or the like.

As described above, the voltage tone circuit 231 applies the known voltage V1 to the source signal line 18 for the driving transistor 11*a*. The output (input) current I1 corresponding to this voltage is then measured. Of course, it is possible to select one or more source signal lines 18 and to apply a known voltage to these source signal lines 18. Consequently, the resulting relationship is reverse to that shown in FIG. 92(B). That is, the I1 is measured on the basis of application of the V1. The V-I characteristic of the driving transistor 11*a* shown by the solid line in FIG. 92(B) is then determined on the basis of the relationship between the V1 and the I1. In addition to the V1, the V0 voltage, corresponding to the 0th tone, may be applied.

With the V0 voltage, the program voltage V0, corresponding to the tone 0, can be accurately determined by adjusting the applied V0 so that the current flowing through the current meter during application of the V0 voltage is zeroed or has a very small value. In this case, the output voltage from the voltage tone circuit 231 is varied and adjusted to zero. Further, the voltage Vx, applied to the driving transistor 11*a*, is adjusted so that, for example, 1 μA flows through the driving transistor 11*a*. A more accurate V-I curve can be estimated or determined by measuring the relationship between the voltage V and current at a plurality of points.

As in the case of FIG. 90, the embodiment shown in FIG. 103 uses the selector circuit 222 to sequentially close the switches S in synchronism with the clock. The switch Sx (x=1 to n) selects the pixel 16 connected to each source signal line 18. Further, the gate driver 12*a* selects one of the pixels 16 in the selected pixel row, the position of which is sequentially shifted.

Selection of each switch S allows the anode current to flow through the selected pixel 16. The anode current generates voltages at the opposite ends of the resistor R. The resulting voltages are digitalized by the A/D conversion circuit 391 and stored in the memory 502. The tone voltage corresponding to the program voltage is calculated or determined on the basis of the stored data. Of course, the current meter may be used to measure the cathode current I1 or the like. The tone 0 of course involves zero voltages generated at the opposite ends of the resistor R.

In FIGS. 90 and 103, the voltage Vx is applied to the source signal line 18 and the resulting current I1 is measured to determine the V-I characteristic. However, the present invention is not limited to this. For example, as shown in FIG. 104, the voltage Vx applied to the source signal line 18, may be adjusted so that the voltage at the pickup resistor R has a predetermined value (V1 or V0; this means the measurement of the current I1). That is, the voltage Vx is adjusted which is applied to the source signal line 18 so as to obtain the I1 current. The V-I characteristic is determined on the Vx–I1 relationship.

Application of the voltage Vx to the source signal line 18 causes the cathode current I1 from the driving transistor 11*a* to flow through the source signal line 18. The cathode current I1 is converted into a voltage by the pickup resistor R, with the voltage then measured. The voltage Vx, applied to the source signal line 18, is adjusted so as to allow the measurement of the voltage V=I1×R.

As in the case of FIG. 90, the embodiment shown in FIG. 104 uses the selector circuit 222 to sequentially close the switches S in synchronism with the clock. The switch Sx (x=1 to n) selects the pixel 16 connected to each source signal line 18. Further, the gate driver 12*a* selects one of the pixels 16 in the selected pixel row, the position of which is sequentially shifted.

Selection of each switch S allows the anode current to flow through the selected pixel 16. The anode current generates voltages at the opposite ends of the resistor R. The voltages applied to the source signal line 18 are digitalized by the A/D conversion circuit 391 and stored in the memory 502. The tone voltage corresponding to the program voltage is calculated or determined on the basis of the stored data. The other arrangements are similar to those in FIGS. 90 and 103 and their description is thus omitted.

Figure 115:
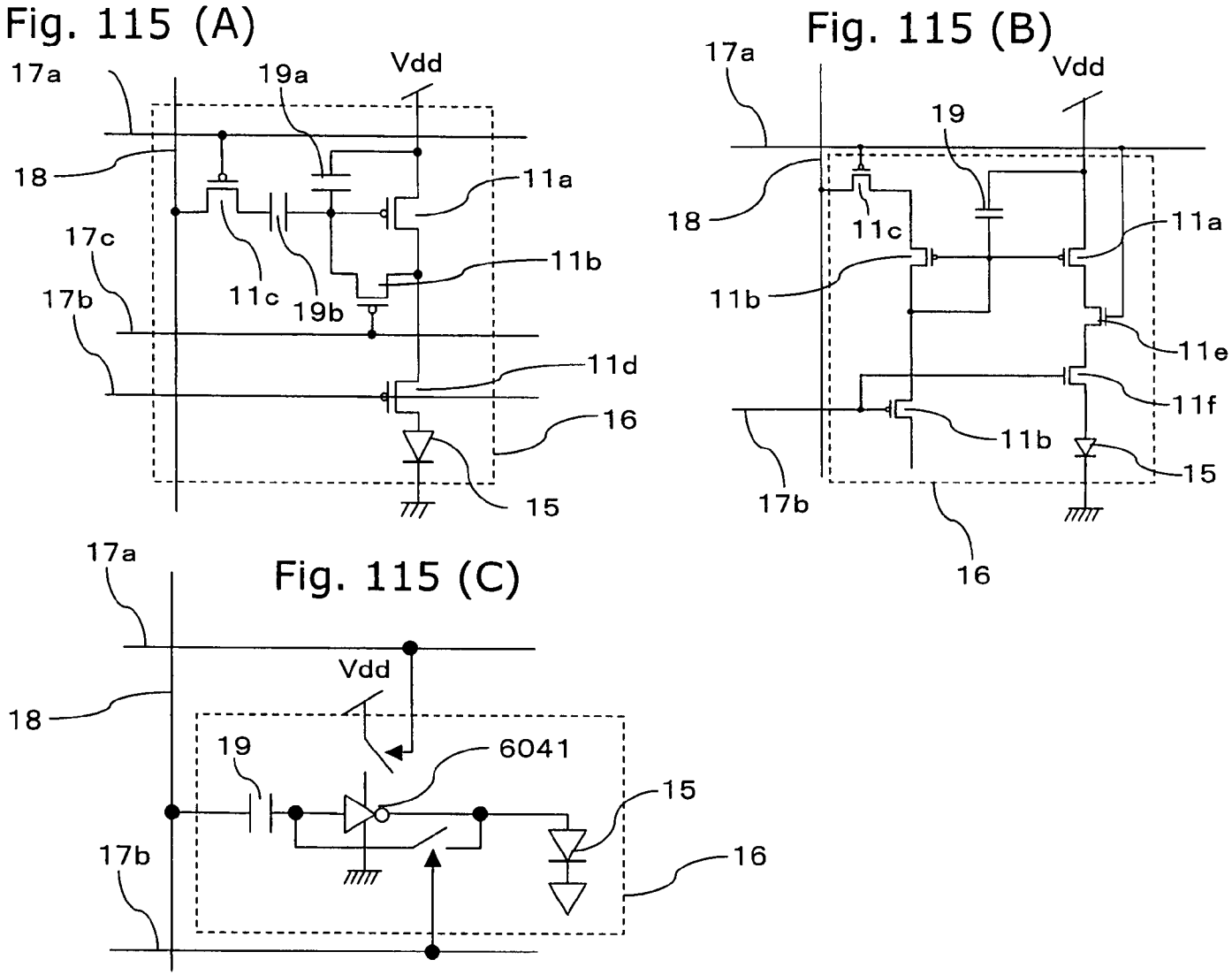
FIG. 115 is a schematic diagram of an EL display panel according to the present invention.

In the embodiment shown in FIGS. 90, 103, and 104, the pixels are configured for the voltage driving (pixel configuration that carries out voltage programming) as shown in FIG. 2. It is thus possible to apply not only the pixel configuration shown in FIG. 2 but also the one shown in FIG. 115. Further, the present invention corresponding to the above embodiment detects or measures or acquires the current flowing through the anode or cathode terminal. Consequently, the present invention is of course also applicable to the current driving (pixel configuration that carries out current programming). That is, the embodiment of the present invention is applicable even if the configuration of the pixels 16 in FIGS. 90, 103, 104 and others is replaced with the pixel configuration shown in FIGS. 1, 12, 13, 14, and others.

Further, the present invention stores the measured voltage or current in the flash memory or the like. On the basis of the stored data, the program voltage or current corresponding to the video signal is determined and applied to the pixel 16. Therefore, the embodiment of the present invention is applicable to both pixel configurations, that is, the current program shown in FIGS. 1, 12, 13, 14, and others and the voltage program shown in FIGS. 2 and 115.

Figure 105:
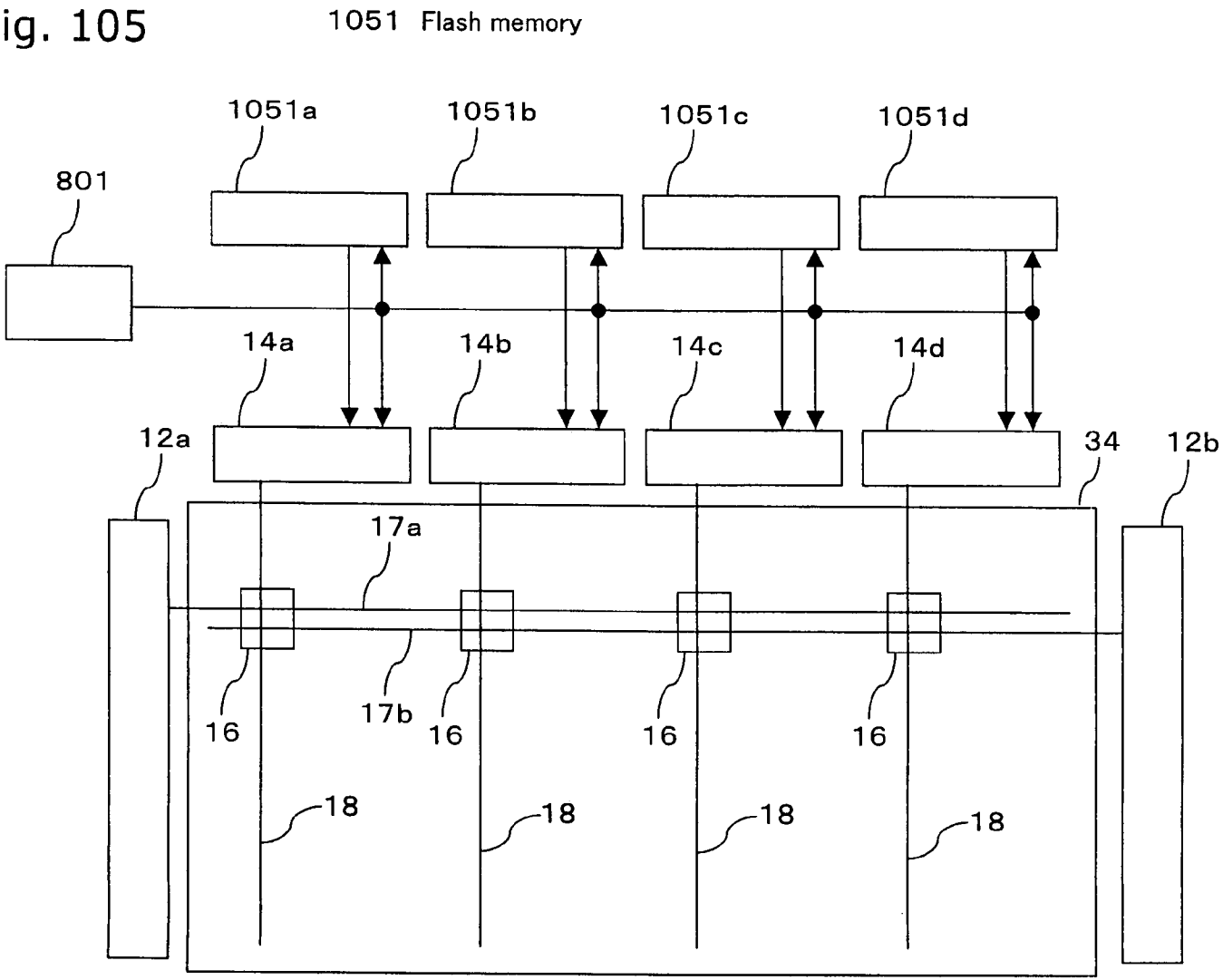
FIG. 105 is a schematic diagram of an EL display panel according to the present invention.

The measured or acquired voltage data V is stored in the flash memory or the like and then transferred to the memory in the controller circuit (IC) 801. A program voltage or current corresponding to the video data is then generated. However, data cannot be read fast from the flash memory. The present invention mounts a plurality of flash memories 1051 in the display apparatus as shown in FIG. 105. Under the control of the controller circuit (IC) 801, the mounted flash memories 1051 transfer the voltage data to the corresponding source driver circuits (IC) 14. Each of the source driver circuits (IC) 14 generates a V-I curve on the basis of the transferred voltage data. The source driver circuit (IC) 14 outputs the program voltage or current corresponding to the video data to the source signal line 18 to apply it to the driving transistor 11*a* in the corresponding pixel 16.

Of course, the technical concept of the present invention described above can be combined with the other embodiments of the present invention. Further, of course, the technical concept of the present invention can be used to construct a semiconductor such as the source driver circuit (IC) 14, a display panel, or a display apparatus. Furthermore, the switch S, resistor R, A/D conversion circuit 391, voltage tone circuit 231, and the like may be formed directly on the array board 30 using a polysilicon technique.

For easy description, the above embodiment accumulates the measured voltage or current data in the memory. However, any memory may be used for the present invention provided that it can temporarily hold data in a digital or analog form. For example, the memory may be a sample hold circuit that samples analog data. Of course, the concept of the memory includes a semiconductor such as a flash memory, a SRAM, or a DRAM. The memory may be constructed inside or outside the source driver IC (circuit) 14. The above description is applicable to the other embodiments of the present invention.

As described above, the present invention applies or supplies a voltage or current to the driving transistor 11*a* and measures a current or voltage output by the driving transistor or the like (in the current mirror pixel configuration shown in FIG. 12, the transistor 11*b*) in response to the applied voltage or current. The present invention thus obtains a V-I curve of the driving transistor to determine the program voltage or current corresponding to each tone on the basis of the V-I curve determined.

The present invention applies a known voltage or current to each source signal line 18 and measures an output current or voltage. Alternatively, the present invention adjusts the voltage or current applied to the source signal line 18 so that the output current or voltage has a predetermined value. The present invention thus determines or estimates a V-I curve of the driving transistor 11 supplying a current to the EL element 15. The present invention therefore determines the program voltage or current corresponding to each tone.

The above embodiment enables a V-I curve of each driving transistor 11*a* to be accurately determined. The voltage determined is a program voltage or current. Each program current or voltage corresponds to the video signal.

Figure 106:
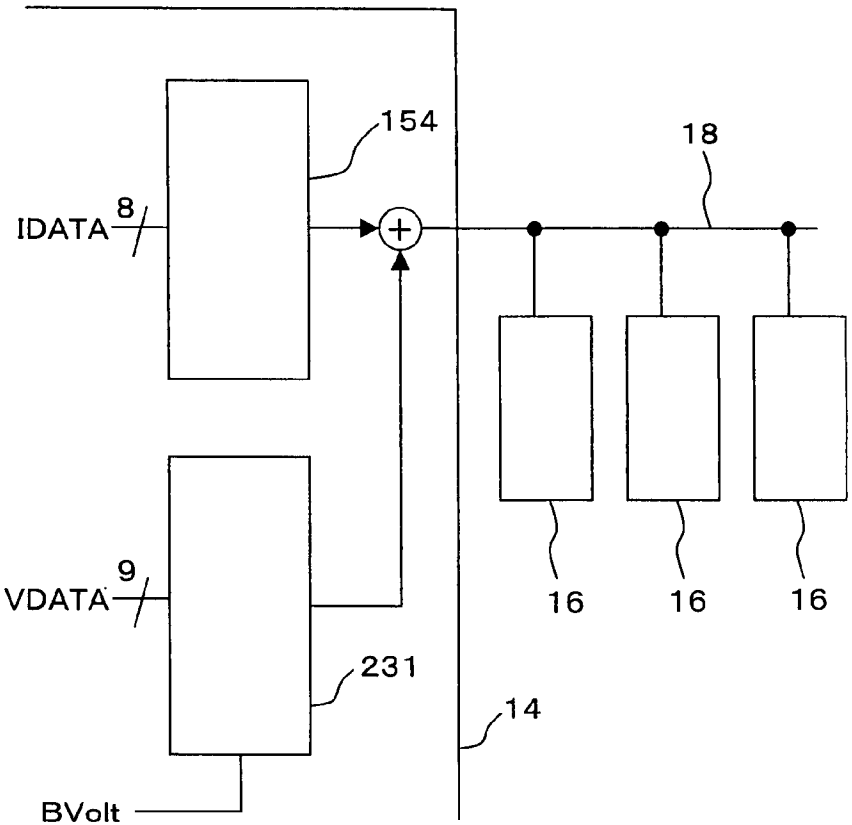
FIG. 106 is a schematic diagram of an EL display panel according to the present invention.

As shown in FIG. 106, the voltage data is converted into 9-bit data (VDATA) corresponding to the video signal data, on the basis of the determined V-I curve of the driving transistor 11*a*. 9 bits are used instead of 8 bits in order to generate a voltage equal to or lower than a rising voltage Vt. This compensates for the effect of a punch-through voltage resulting from an on or off operation of the gate signal line 17*a* and emitted to the gate terminal of the driving transistor 11*a*, and realizes a proper black display or display of low tone areas.

A predetermined voltage is added to or subtracted from the measured voltage or the measured voltage is corrected, so as to correct the punch-through voltage. The measured voltage is further processed so as to be compatible with the gamma curve or EL characteristic of the video data. The measured voltage thus becomes a precharge voltage Vp serving as tone data on the video signal. Since the precharge voltage Vp corresponds to multi-bit video data, it will be called VDATA in the description below. Further, since the VDATA is a voltage programmed (written) into the pixel 16, it may be called a program voltage VDATA.

As shown in FIG. 106, the VDATA corresponding to the video signal is input to the voltage tone circuit 231. The VDATA is applied, as a program voltage, to the source signal line 18 during the A period (voltage) shown in FIGS. 25, 81, and others. The voltage VDATA applied during the A period quickly charges or discharges the parasitic capacitance of the source signal line 18 and thus functions as the precharge voltage Vp. Accordingly, in the present specification, the precharge voltage Vp and the program voltage VDATA have the same or similar functions and operations. The scheme by which the voltage is applied during the A period in FIGS. 25, 81, and others has already been described in detail. Its description is thus omitted.

The program voltage VDATA (precharge voltage Vp) is obtained by applying the constant current Iw (including Iw=0 (A)) to the source signal line 18 to pass the constant current Iw through the driving transistor 11*a* and then measuring the potential across the source signal line 18. The program voltage VDATA is corrected on the basis of the characteristics (V-I curve) of the driving transistor 11*a*. The applied program voltage VDATA reflects a variation in characteristics among the driving transistors 11*a* in the respective pixels 16.

The VDATA has an error 0 (no errors; for example, application of the Iw uniquely determines the Va on the basis of the V-I curve) at a characteristic position (for example, Va) on the V-I curve. The error 0 means that the error is cancelled at a particular position (for example, Va). At a position preceding or following the particular one (for example, Va), the VDATA deviates from the ideal value, resulting in an error with respect to the ideal characteristics. However, at the particular position, the VDATA operates at the ideal value. This scheme is called voltage offset canceling for the following reason: the measured voltage of the source signal line 18 (voltage being processed so as to be compatible with the video tone) is applied to cancel the error, and an error with respect to the ideal value occurs with respect to the voltage position (for example, Va).

The program voltage VDATA has a voltage offset canceled value. The program voltage VDATA during the A period causes the source signal line 18 to be charged or discharged so as to pass the target current through the EL element 15. The highest accuracy is achieved by an offset voltage (for example, Va) and its neighborhoods. The error with respect to the target current increases consistently with the distance from the offset voltage.

After applying the program voltage VDATA during the A period, the present invention applies a program current IDATA during a B period (during which an overcurrent is applied as required as shown in FIG. 81). The IDATA is atone current finally written (programmed) into the pixel 16.

The present invention applies the program current IDATA during the B period. By applying the VDATA at a position different from the neighborhood of the offset voltage, it is possible to perform an ideal, error-free (accurate) write operation through the program current IDATA applied during the B period, in spite of an increase in the error with respect to the target current (target value written into the pixel 16).

The IDATA is converted into a program current by the current tone circuit 154, and the resulting current is supplied to the source signal line 18. The supply occurs during the B period shown in FIG. 25. As described with reference to FIG. 25 and others, the program current is very accurate. Accordingly, the accurate program voltages during the A and B periods allow the capacitor 19 in the pixel 16 to be programmed so that the target current flows through the EL element 15. That is, voltage+current programming can be achieved.

In FIGS. 25, 81, and 106, both voltage application during the A period and current application during the B period are carried out during a 1H period (one horizontal scan period). However, the present invention is not limited to this. For example, for low tone areas, all of the 1H period may be defined as the A period. Further, for high tone areas, all of the 1H period may be defined as the B period. This is because, in the low tone areas, the program current is so small that the charging or discharging of the source signal line 18 is not substantially affected. Further, in the low tone areas, the program voltage is predominant.

The above embodiment carries out the voltage+current program driving so that voltage offset canceling seems to be executed in the low tone areas, whereas current program driving is executed in the high tone areas. Consequently, the effects of the voltage driving and current driving are produced in a supplementary manner.

Figure 107:
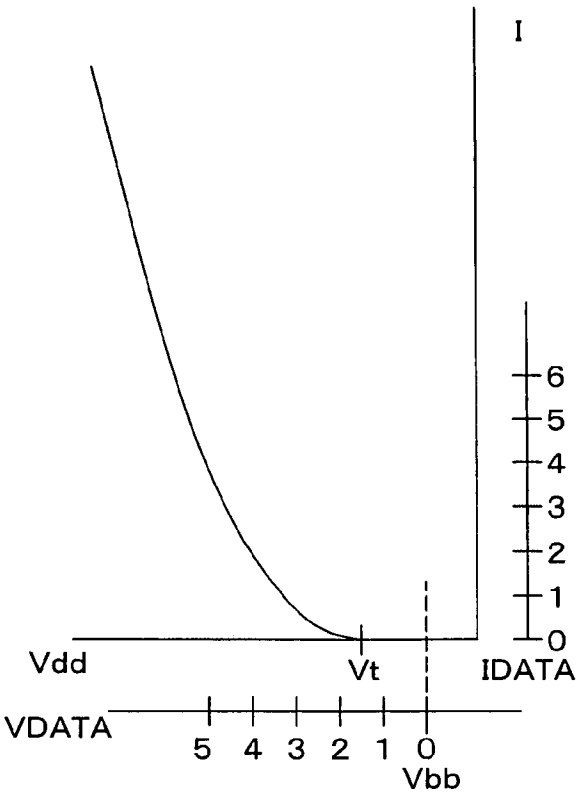
FIG. 107 is a schematic diagram of a driving method of an EL display panel according to the present invention.

FIG. 107 shows the relationship between the current data IDATA and voltage data VDATA, shown in FIG. 106. In FIG. 106, Vt denotes the rising voltage of the driving transistor. A voltage equal to or lower than the Vt precludes the EL element 15 from being supplied with a current. The Vt voltage varies among the driving transistors owing to a variation in characteristics among the driving transistors. The present invention defines the Vt voltage or its neighborhood as V0. The V0 is defined as the neighborhood of the Vt voltage because the on/off control of the gate signal line 17 causes a punch-through voltage to be generated at the gate terminal of the driving transistor 11*a*. In view of this adverse effect, the Vbb is defined (assumed) as a voltage for the tone 0, which enables the driving transistor 11*a* to provide a perfect black display or a black display that is ideal or practical as an image display.

The present invention performs processes or operations using, as an origin, the voltage Vbb, which turns the driving transistor off (avoids the passage of a current through the driving transistor). That is, the VDATA sets the Vbb voltage at zero and increments by 9 bits (512 pieces). On the other hand, the IDATA, the program current, is zero when no current flows through the EL element. The IDATA thus has its origin at zero and increments by 8 bits (256 pieces).

The configuration shown in FIG. 106 is shown in FIG. 56 in further detail. The VDATA is input to the electronic regulator 152, which then divides the voltage between the Vbb and the anode voltage Vdd into a plurality of (in this embodiment, 9 bits=512) pieces for output. The output from the electronic regulator 152 is input to the voltage tone circuit 231. The voltage tone circuit 231 may be considered to include the electronic regulator 152. The other arrangements are similar to those shown in FIG. 23 and their description is thus omitted.

Figure 108:
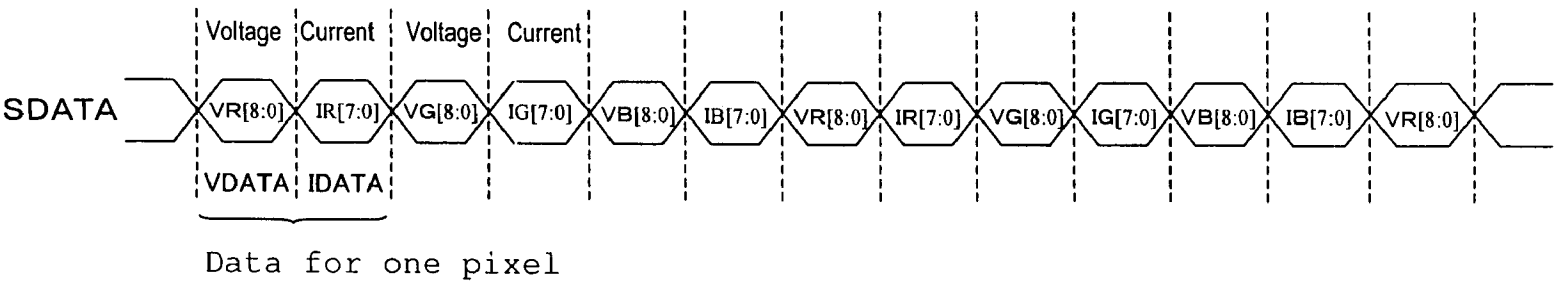
FIG. 108 is a schematic diagram of a driving method of an EL display panel according to the present invention.
Figure 108:
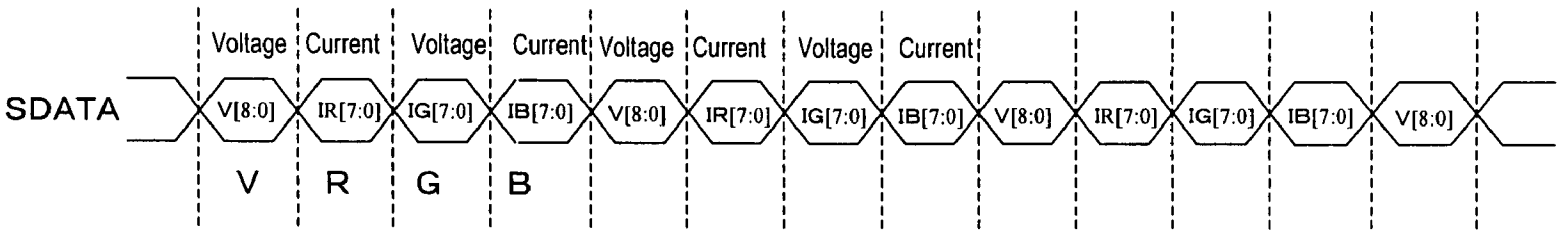

As shown in FIGS. 106 and 56, each pixel 16 requires program current data (IDATA) and program voltage data (VDATA). Accordingly, as shown in FIG. 108(A), the IDATA and VDATA are transmitted at a double rate. However, the double rate transfer imposes a heavy burden on the circuit system. To solve this problem, measures also need to be taken for the array board 30. Thus, first, with reference to FIG. 109 and others, description will be given of a method of manufacturing the array 30 in accordance with the present invention.

The pixels are produced so that a combination of an R, G, and B pixels constitute a square. Each of the R, G, and B pixels is oblong. Accordingly, annealing with an oblong laser irradiation spot 1092 makes it possible to prevent a variation in characteristics among the transistors 11 from occurring within one pixel. The characteristics (mobility, Vt, S value, and the like) of the transistors 11 connected to one source signal line 18 can also be made uniform (that is, the transistors 11 connected to the adjacent source signal lines 18 may have different characteristics but the characteristics of the transistors 11 connected to one source signal line can be made almost uniform).

In general, the laser irradiation spot 1092 has a fixed length of, for example, 10 inches. Since this laser irradiation spot 1092 is moved, the panel needs to be placed within the movable range of one laser irradiation spot 1092 (that is, laser irradiation spots 1092 are prevented from overlapping in the center of the display screen 34 of the panel).

The configuration shown in FIG. 109 is formed so that three panels are arranged within the range of the length of the laser irradiation spot 1092. An anneal device irradiating the panels with the laser irradiation spot 1092 recognizes positioning markers 1093*a* and 1093*b* on a glass substrate 1094 (automatic positioning based on pattern recognition) to move the laser irradiation spot 1092. The positioning marker 1093 is recognized by a pattern recognizing device. The anneal device (not shown) recognizes the positioning marker 1093 to index to the position of the appropriate pixel column (make the laser irradiation range 1092 parallel to the source signal line 18). Annealing is sequentially carried out by applying the laser irradiation spot 1092 so that the spot 1092 overlaps the pixel column position.

The laser anneal method described with reference to FIG. 109 (scheme which applies a linear laser spot parallel to the source signal line 18) is preferably adopted for the method of driving the organic EL display panel in accordance with the present invention. This is because the transistors 11 have matching characteristics in a direction parallel to the source signal line (pixel transistors located adjacent to one another in the vertical direction have approximate characteristics). Thus, during the current driving, the voltage level of the source signal line varies insignificantly, thus preventing insufficient current write operations. The matching characteristics of the driving transistors 11*a* mean that, for example, in FIG. 107, their Vt voltages are the same or similar. Consequently, the program voltages corresponding to the Vt of the driving transistors 11*a* in the pixels arranged along the source signal line 18 are almost the same. This is because laser beams are applied parallel to the source signal line 18 and because the laser irradiation range 1092 moves perpendicularly to the source signal line 18.

The matching characteristics of the driving transistors 11*a* connected to one source signal line 18 are advantageous for the current driving in the respects described below. For example, with white raster display, almost the same current is passed through the transistors 11*a* in the adjacent pixels. This reduces a variation in the amplitude of a current output by the source driver IC (circuit) 14. If the transistors 11*a* in FIG. 1 have the same characteristics and a current value programmed in each pixel is equal among the pixel columns, the potential across the source signal line 18 is fixed during current programming. This avoids a variation in the potential across the source signal line 18. Further, with the voltage+current driving, the applied voltage (program voltage) need not be varied.

If the transistors 11*a* connected to one source signal line 18 have almost the same characteristics, the potential across the corresponding source signal line 18 varies insignificantly. This means that the V0 or Vbb voltages of the pixels located along the source signal line 18 may have substantially the same value. Further, substantially the same V-I characteristic allows the Va voltages or the like of the pixels to have the same value. That is, the pixels located along the source signal line 18 may be considered to have a substantially equal V-I characteristic.

That is, if laser beams are applied parallel to the gate signal line 7, while the laser irradiation range 1092 moves perpendicularly to the gate signal line 17, then the V0 voltages of the pixels located along the gate signal line 17 may have substantially the same value. Further, since the V-I characteristics of the pixels are substantially equal, their V1 voltages and the like may also be the same. That is, of course, the embodiments described below are applied on the assumption that the pixels located along the gate signal line 17 have a substantially equal V-I characteristic.

In the description below, the V0 voltage means the voltage for the tone 0. In a broad sense, the V0 voltage also means the Vt voltage, the Vbb voltage, and the like. The V0 voltage is for the tone 0 and thus corresponds to a perfect black display. Thus, the relationship between the V0 voltage and the video signal is easy to understand. The description below is thus based on the V0 voltage. Actually, a current starts to flow through the driving transistor 11*a* at the Vt voltage. The Vbb voltage enables the ideal black display.

Producing an array as shown in FIG. 109 allows the driving transistors 11*a* located along the source signal line 18 to have substantially equal program voltages such as the V0 characteristic. Accordingly, processing (generation of a VDATA and the like) may be executed on the assumption that a plurality of pixels have the same V0 voltage or the like.

Figure 110:
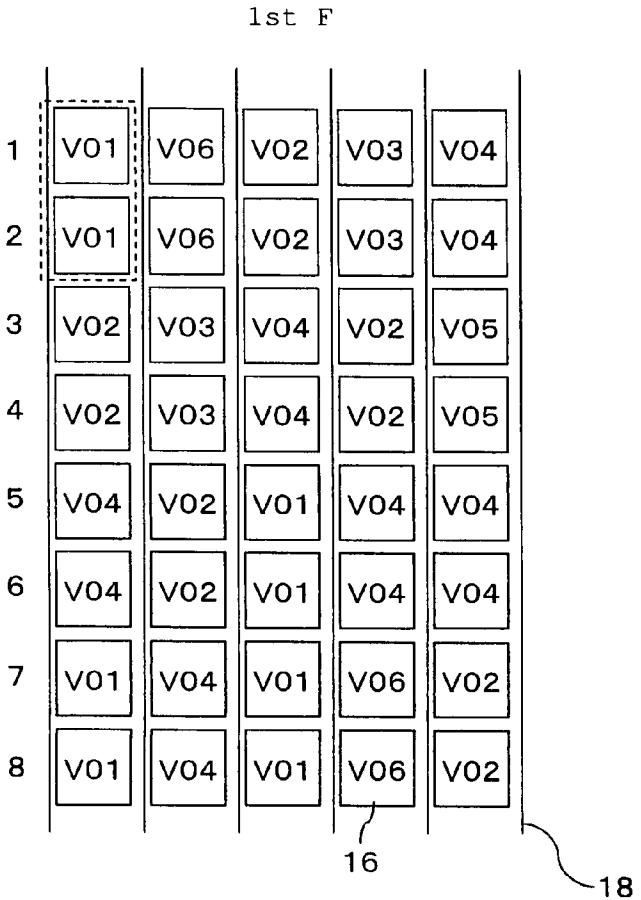
FIG. 110 is a schematic diagram of a driving method of an EL display panel according to the present invention.
Figure 110:
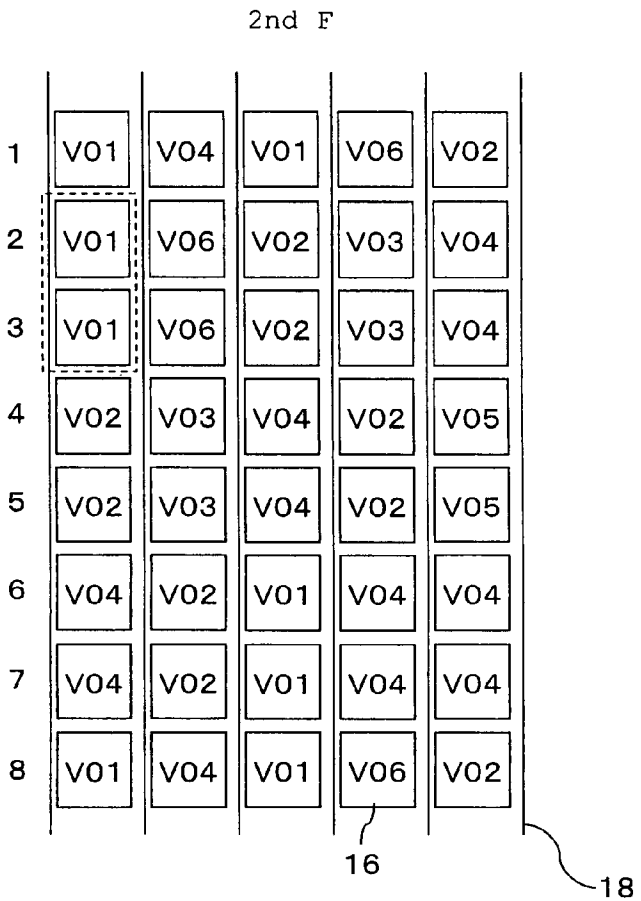

FIG. 110 shows an embodiment in which two pixels located along the source signal line 18 have the same V0 voltage. The array 30 is produced by the manufacture method described in FIG. 109.

The V0 voltage varies among the driving transistors 11*a*. In an embodiment described below with reference to FIG. 110 and others, a different V0 voltage is shown with a suffix x, that is, as V0*x* (V01, V02, and so on). A plurality of pixels have common VDATA such as a common V0 but have different IDATA in association with the video signal. Of course, if the resolution of the image need not be high, a plurality of pixels may have common IDATA.

FIG. 110(A) shows the state of the first F (Field (Frame)). As shown by dotted lines in FIG. 110(A), an odd- and even-numbered pixel rows have a common V0 voltage. This configuration requires only one VDATA to be transmitted for two IDATA. Consequently, the IDATA and VDATA, tone data in a video signal SDATA in FIG. 108, have only to be transmitted at a 1.5-times rate.

However, the use of a common VDATA for two pixels may result in a reduced resolution. To solve this problem, an even- and odd-numbered pixel rows (shown by dotted lines) have the same VDATA in the second F (Field (Frame)), following the first F (Field (Frame)) as shown in FIG. 110(B). In the third F (Field (Frame)), the pixels have common VDATA as shown in FIG. 110(A) (the pixels have a common V-I curve).

Figure 111:
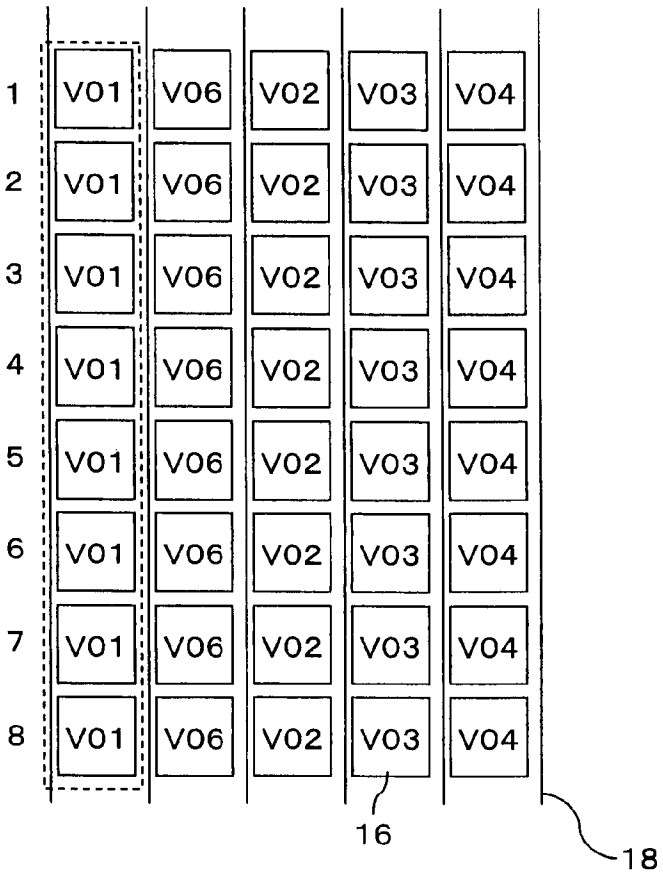
FIG. 111 is a schematic diagram of a driving method of an EL display panel according to the present invention.

FIG. 111 shows an embodiment in which the pixels 16 located along the source signal line 18 have a common V0 data (V-I curve). This configuration is effective on an array formed as shown in the embodiment in FIG. 109. The average of the V0 and V1 and V-I curve of one pixel column is used as the V0 voltage.

The averaging method involves applying the constant current (including the 0 current) to the source signal line 18 for each pixel column, sequentially selecting the first to last pixel rows, and measuring the V0 or V1 voltage across the source signal line 18. After the measurement, the V1 or V0 voltage obtained is averaged to determine the program voltages V0 or V1.

Figure 112:
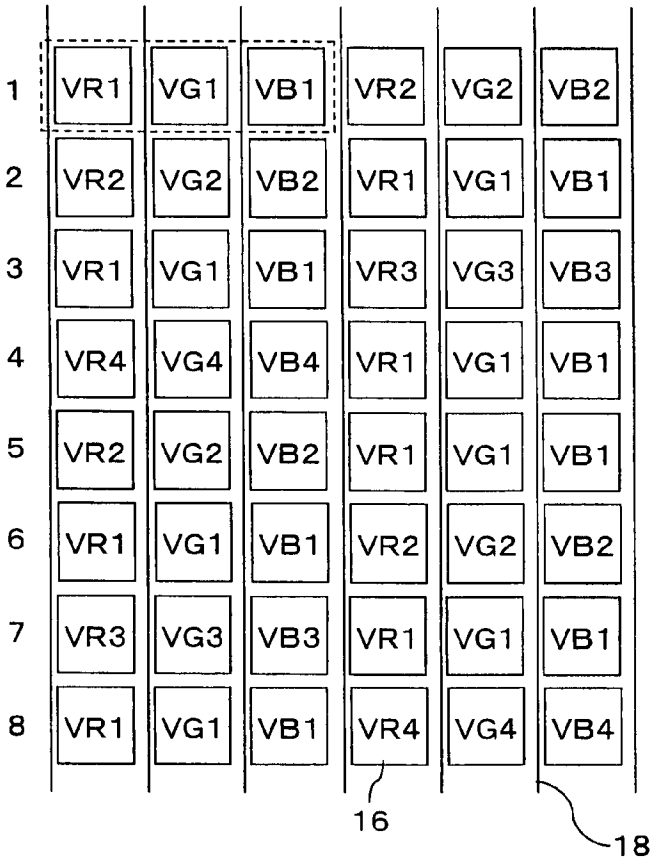
FIG. 112 is a schematic diagram of a driving method of an EL display panel according to the present invention.

FIG. 112 shows an embodiment in which the R, G, and B pixels have a common V0 voltage or the like. This configuration is adoptable because V0 voltages of close values are substantially equal. If the R, G, and B have a common V0 voltage as shown in FIG. 112, the IDATA and VDATA are transmitted as shown in FIG. 108(B). Common VDATA is transmitted for all of the R, G, and B, and different IDATA for the R, G, and B pixels are then transmitted. This configuration prevents a substantial increase in transmission rate.

Figure 113:
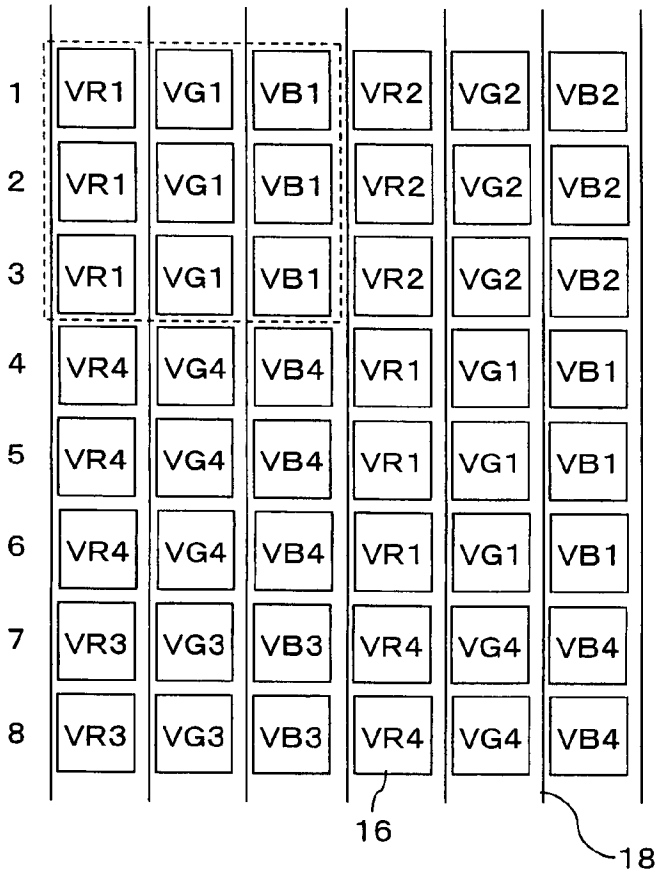
FIG. 113 is a schematic diagram of a driving method of an EL display panel according to the present invention.

Naturally, a common V0 voltage and the like may be arranged in a matrix (block) form as shown in FIG. 113. In FIG. 113, one block is enclosed by a dotted line.

In the embodiment shown in FIG. 110 and others, a plurality of pixels have a common V0 voltage. However, the present invention is not limited to this. A plurality of pixels may have a common V1 voltage or the like. Further, a technical concept of the present invention is that a plurality of pixels have a common V-I characteristic. Accordingly, the present invention is not limited to the case where a plurality of pixels have a common V0 or V1 voltage. A plurality of pixels may have a common V-I curve. Further, of course, the present invention is not limited to two pixels.

The above embodiment applies the constant current Iw to the source signal line 18 and measures the voltage (Va, V0 voltage, or the like) corresponding to the constant current Iw. The measured or acquired voltage value is used as a reference or processing is executed, to determine a V-I curve indicative of the characteristics of each driving transistor 11*a* or all driving transistors 11*a* within the display area or of the average of the characteristics of the driving transistors 11*a*.

The embodiment of the present invention measures the V0 voltage of each pixel. However, the present invention is not limited to this. For example, if the array 30 is formed as shown in FIG. 109, of course, the entire pixel column (pixel area located along the laser irradiation range) located along the source signal line 18 may have a common V0, V1, or V-I curve. For example, if the entire pixel column has a common V0 voltage, of course, the V0 voltage of only one pixel needs to be measured for each pixel column. The V-I curve and program voltage V0, V1, Va and the like may be set as shown in FIGS. 110, 111, 112, and 113.

The above embodiment uses a scheme which measures the V0, V1, Va, or the like, determines or calculates a V-I curve, and carries out the voltage+current driving or the like. However, the present invention is not limited to this. For example, an embodiment shown in FIG. 114 may be used.

Figure 114:
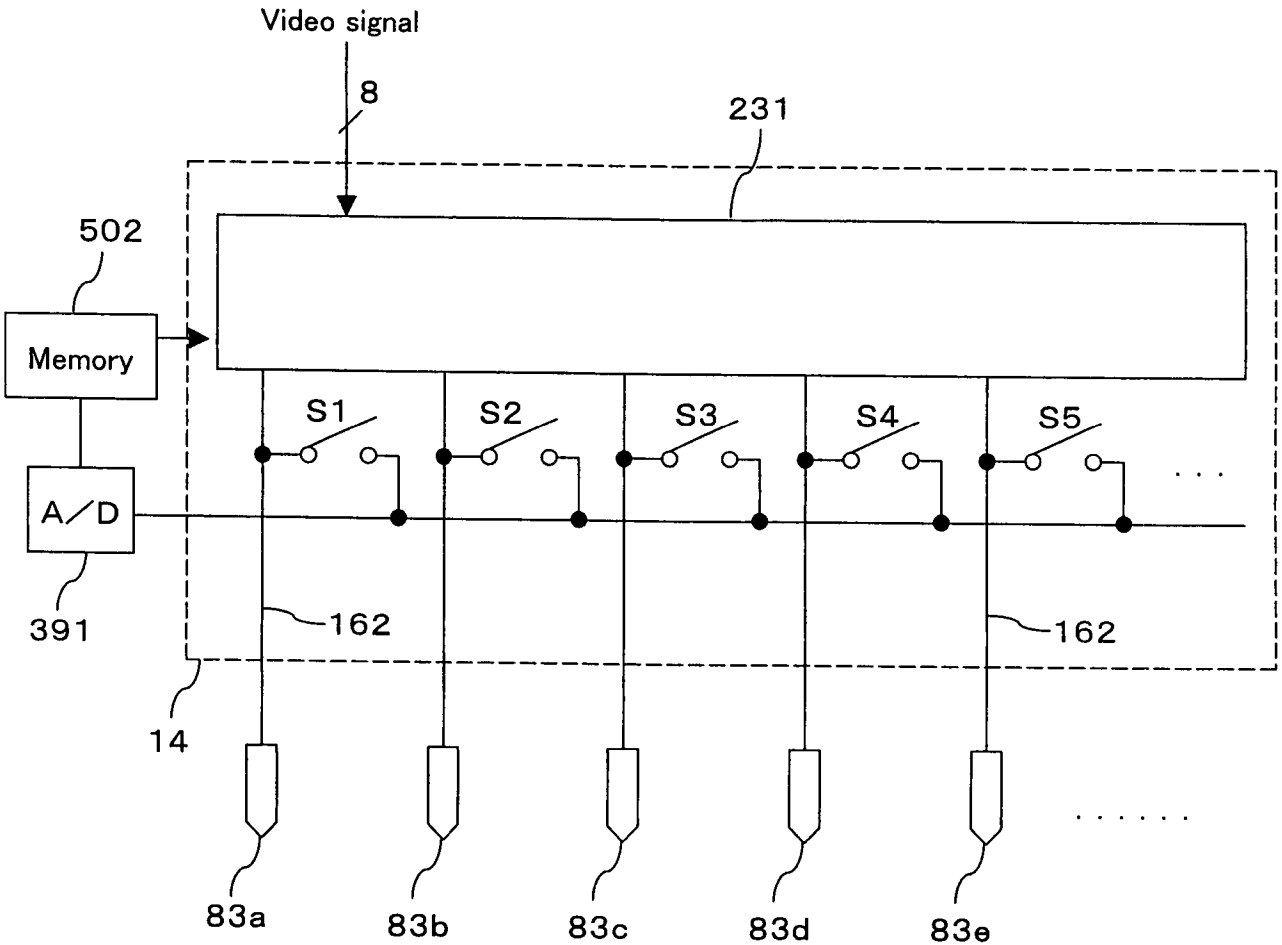
FIG. 114 is a block diagram of a driver circuit of an EL display panel according to the present invention.

In FIG. 114, the switches S1 to Sn (n denotes the maximum value of the number of the source signal line 14) are sequentially closed, and the potential across the source signal line 14 is measured. The measured potential is subjected to an A/D conversion by the A/D conversion circuit 391. The resulting data is held in the nonvolatile memory 502 such as the EEPROM. The holding may be carried out using a compression algorithm such as JPEG. The held data and video signal are used to apply a voltage tone signal from the voltage tone circuit 231 to the source signal line 18 to carry out voltage driving.

Figure 96:
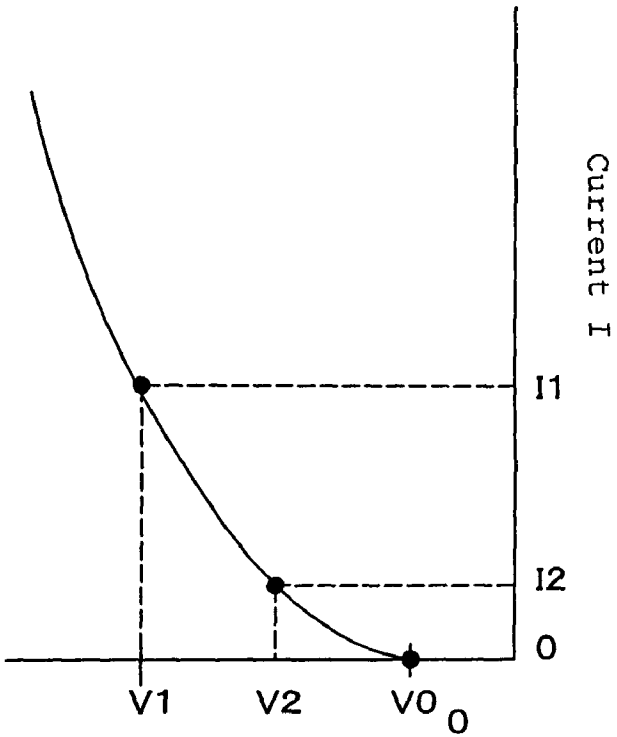
FIG. 96 is a schematic diagram of a driving method of an EL display panel according to the present invention.
Figure 96A:
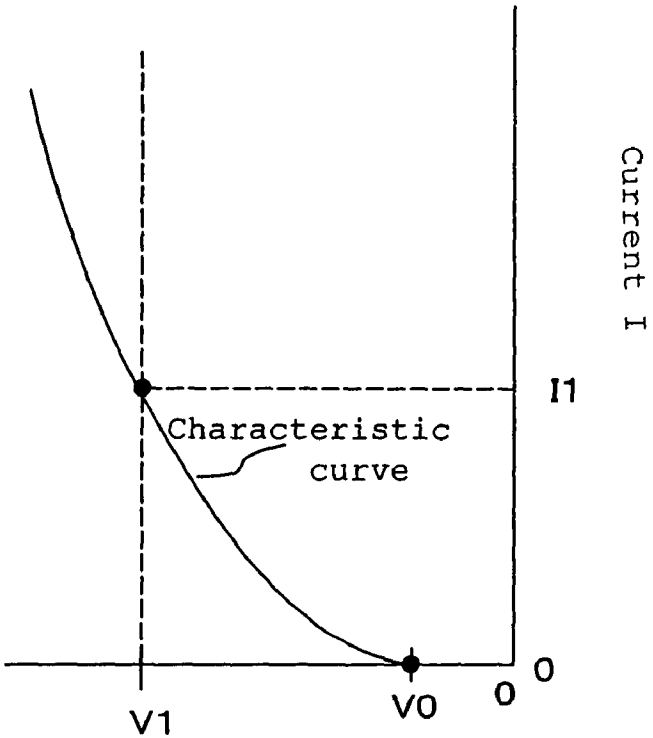

To measure the V0 or V1, described with reference to FIG. 96, it is possible to provide the constant current generation circuit or current tone circuit 154 in the source driver circuit 14, to allow the circuit 154 to generate a constant current to sequentially close the switches SI1 to SIn (n is the maximum value of the source signal line 18) and the switches S1 to Sn, and to measure the potential across the source signal line 18.

For example, the switch SI2 is closed, and the constant current Ix is applied to the source signal line 18. The switch S2 is closed, and the potential Vx across the source signal line 18 is measured. The measured Vx is subjected to an A/D conversion by the A/D conversion circuit 391 and held in the memory 502.

The above operation is performed on all or selected required source signal lines 18. The potentials across the source signal lines 18 is measured and held in the memory 502. A V-I curve or a rising voltage is generated on the basis of the held data. The voltage tone circuit 231, the current tone circuit, or the like is then used to carry out voltage driving, voltage+current driving, or overcurrent+tone current driving (see FIGS. 25 and 81, their description and others).

Figure 116:
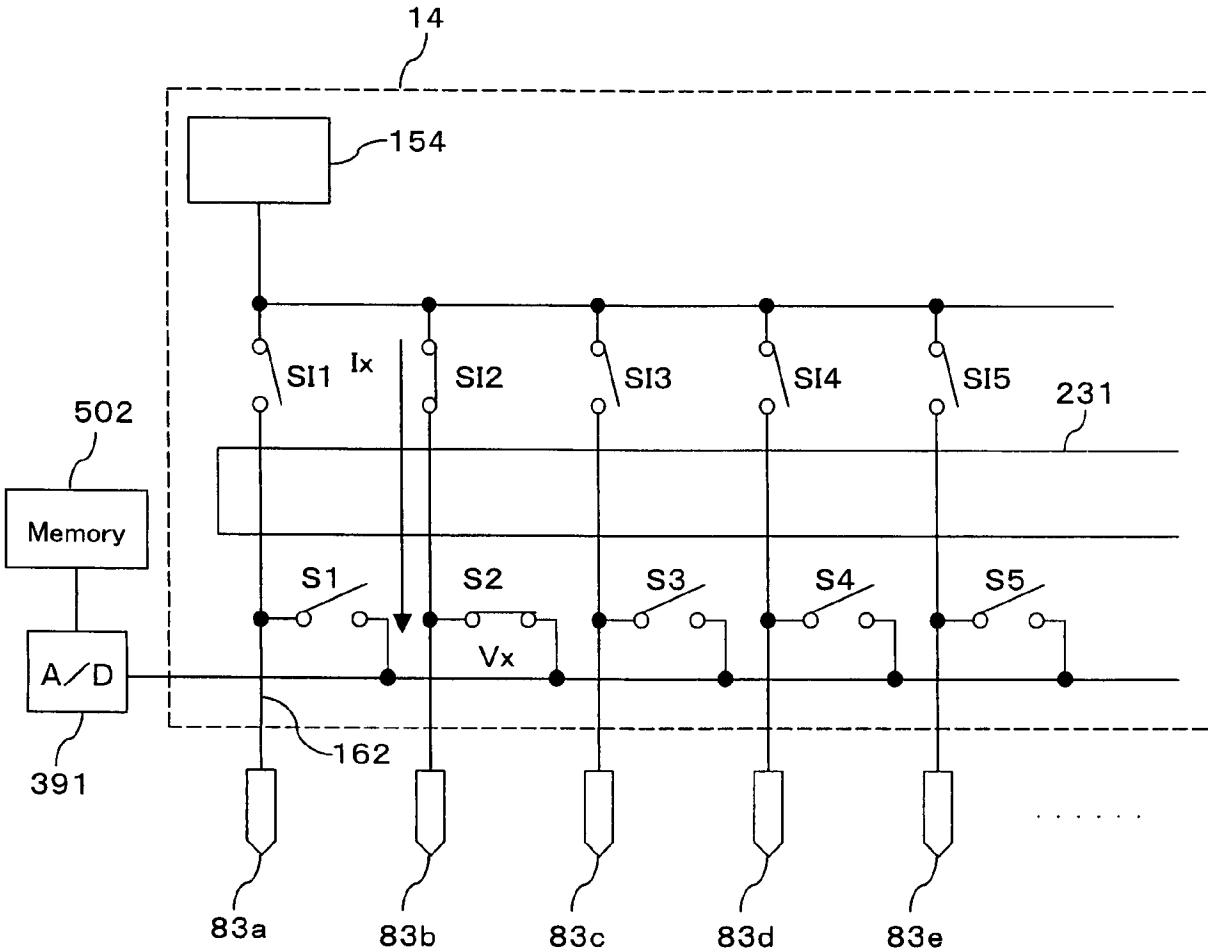
FIG. 116 is a block diagram of a driver circuit of an EL display panel according to the present invention.
Figure 117:
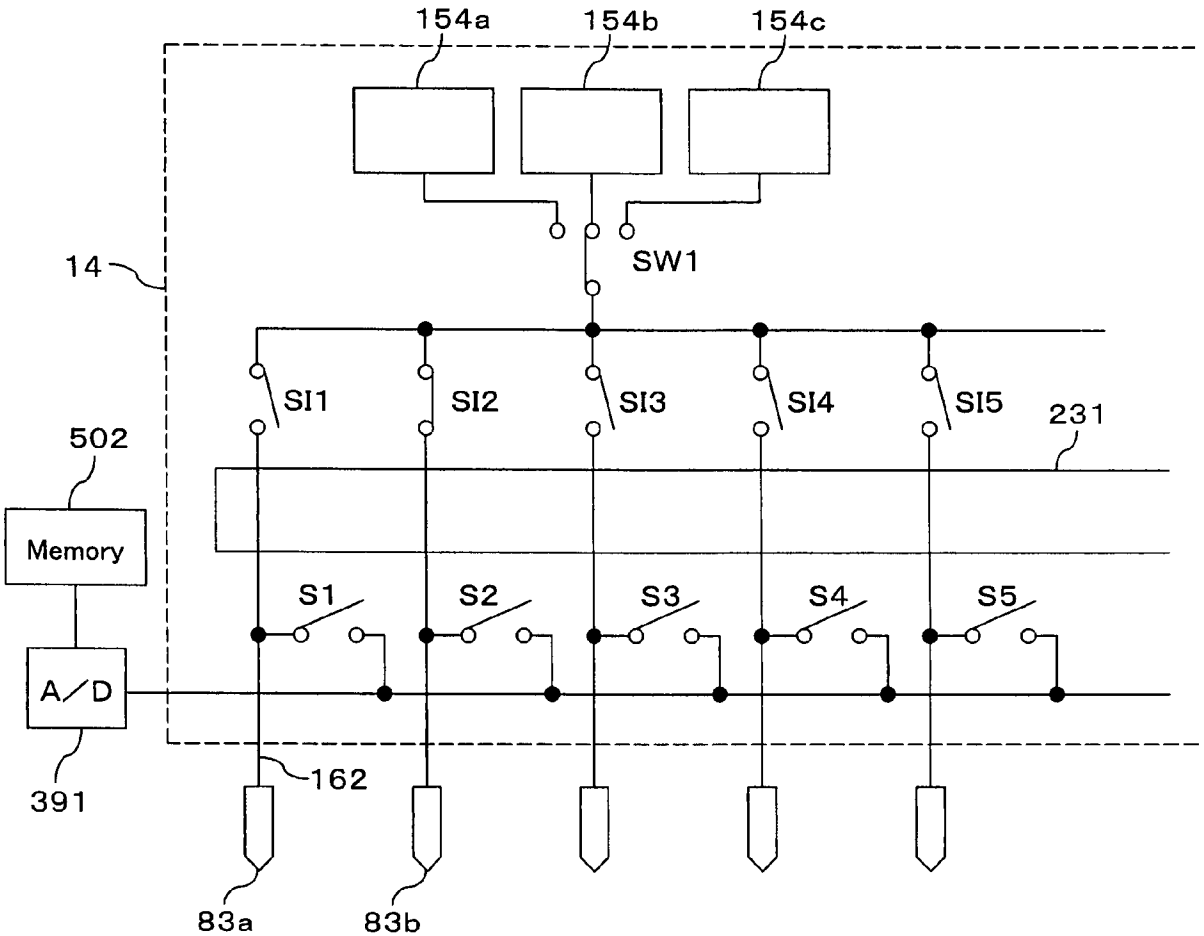
FIG. 117 is a block diagram of a driver circuit of an EL display panel according to the present invention.

FIG. 116 shows the configuration using one current tone circuit 154. However, the present invention is not limited to this. For example, as shown in FIG. 117, a constant current circuit may be constructed which is composed of a plurality of (in FIG. 117, three) current tone circuits 154 (154*a*, 154*b*, and 154*c*).

Each current tone circuit 154 has a fixed output constant current value. For example, the current tone circuit 154*a* outputs a constant current I1, the current tone circuit 154*b* outputs a constant current I2, and the current tone circuit 154*c* outputs a constant current I3. The switch SW1 is used to select one of the current tone circuits 154. The relative magnitude of the constant current output by the current tone circuit 154 can be varied by a resistor installed outside the source driver circuit 14.

As described in FIGS. 38, 59, 61, 67, 102, 111, 112, and 113, the constant current Iw or the like is applied to each source signal line 18, the gate signal lines 17*a* are sequentially selected, and the potential across the source signal line 18 is measured. However, the present invention is not limited to this. For example, as shown in FIG. 118, all gate signal lines 17*a* may be selected to make the transistors 11*a* in the pixels 16 operative.

Figure 118:
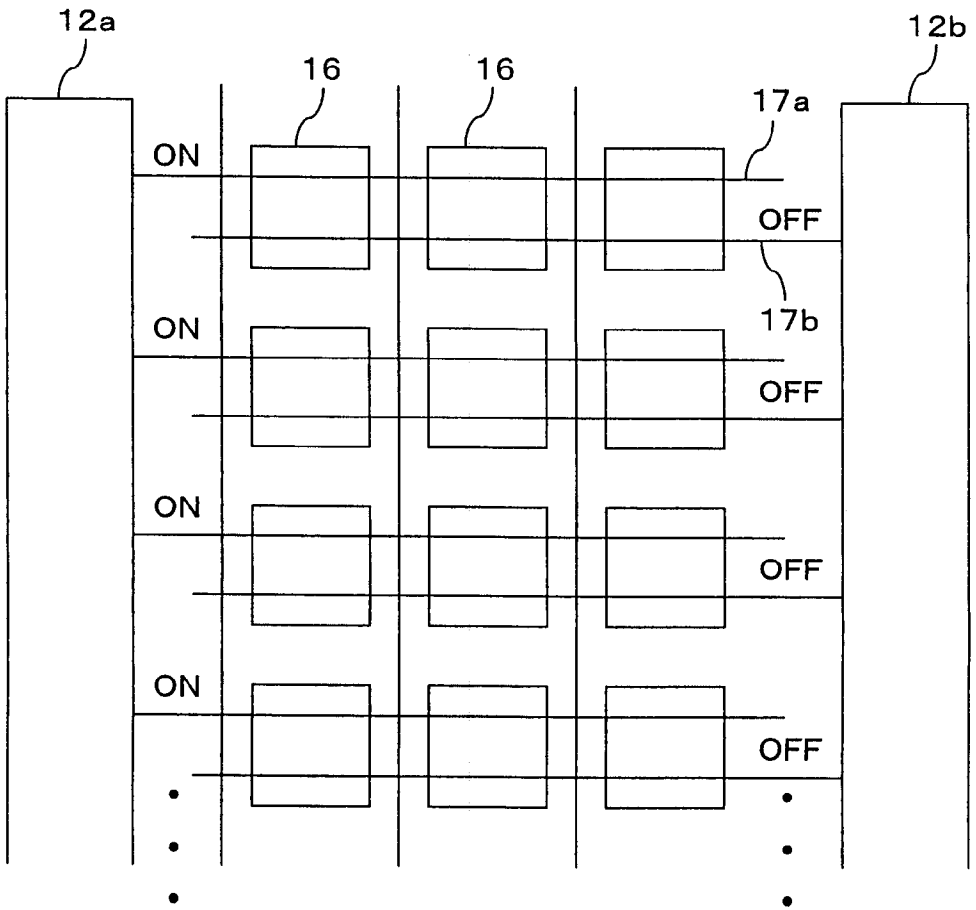
FIG. 118 is a schematic diagram of a driving method of an EL display panel according to the present invention.

In FIG. 118, by way of example, the gate driver circuit 12*a* is used to apply an on voltage to all gate signal lines 17*a*. With the on voltage applied, the constant current is applied to each source signal line 18 or one or more source signal lines 18. On the other hand, the gate driver circuit 12*b* is operated with the off voltage applied to the gate signal line 17*b*. That is, no current paths are generated in the EL element 15. The other operations are similar to those described in the above embodiments and their description is thus omitted.

Further, no current is passed through the source signal line 18. That is, the source driver circuit 14 opens a switch 161*b* shown in FIG. 23. The driving transistors 11*a* in all pixels 16 on the display screen 34 are automatically adjusted to minimize, on the average, the amount of current flowing through the current EL element 15. The voltage across the source signal line 18 in this state is held in the memory as a V0 voltage. The other operations are similar to those described in the above embodiments and their description is thus omitted.

Figure 119:
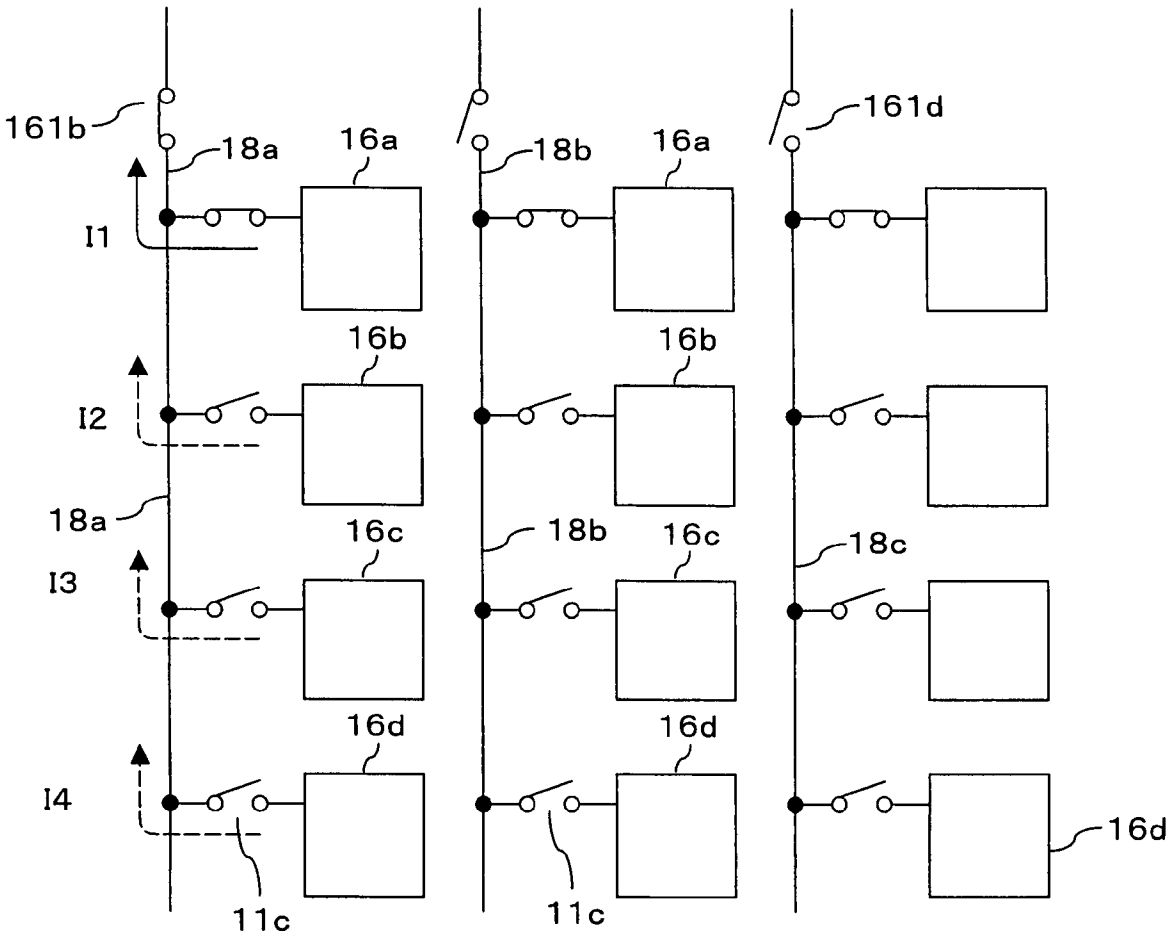
FIG. 119 is a schematic diagram of a driving method of an EL display panel according to the present invention.

Of course, as shown in FIG. 119, it is possible to select one source signal line 18 to apply the constant current (Iw=11) to it, to sequentially select one or more gate signal lines 17*a*, and to measure the V1 voltage or the like. Further, the switch 161*b* in FIG. 23 is opened and the V0 voltage is measured.

Figure 120:
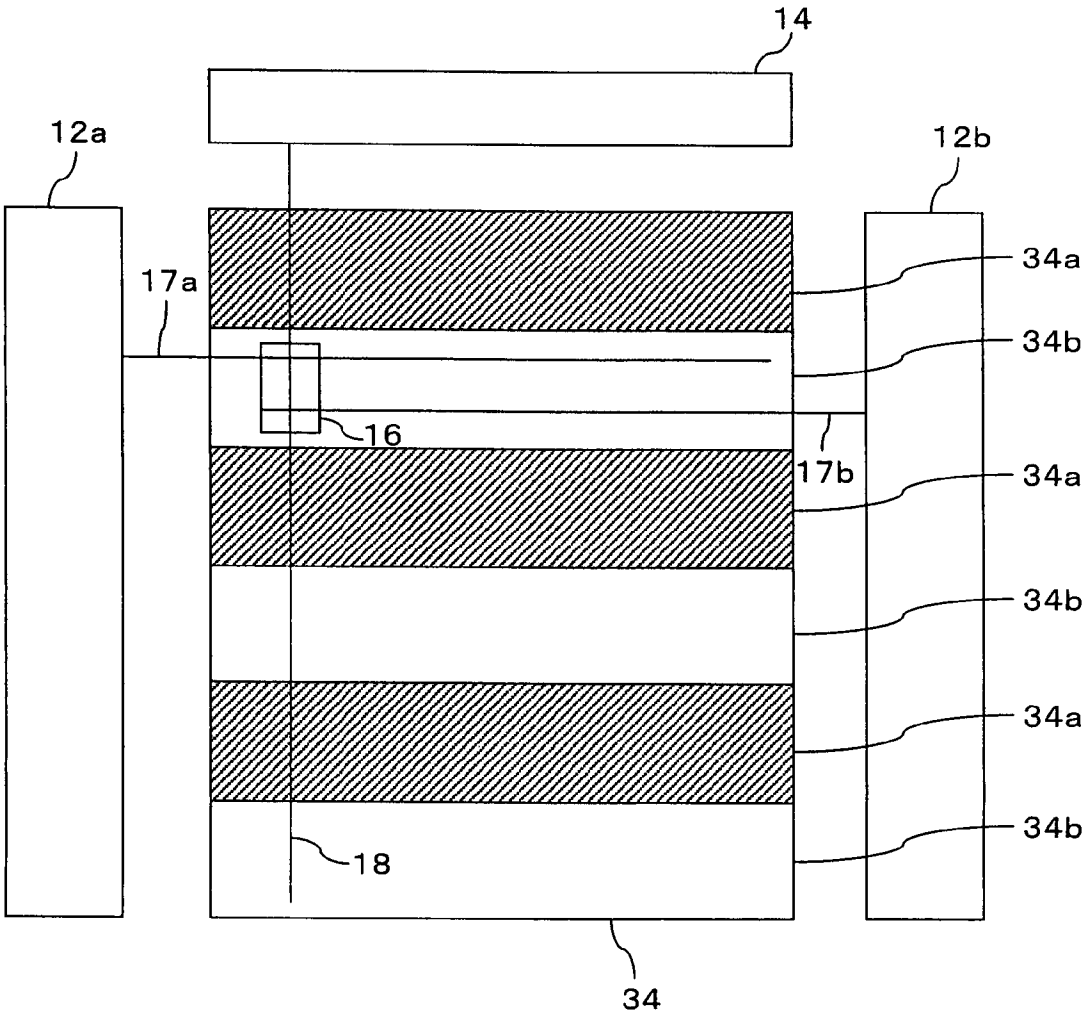

Further, as shown in FIG. 120, it is of course possible to divide the display screen 34 into selection blocks (34*a* and 34*b*), to select one of the display blocks (apply the on voltage to the gate signal line 17*a* in the selected block), to apply the constant current or the like to each block or disconnect the source signal line 18 from the source driver circuit 14 to bring the source signal line 18 into a high impedance state, and to measure the V0 or V0 voltage. In this case, an averaging process is executed by measuring the V0 or V1 voltage or the like of each selected block. For example, if a V01 and V02 voltages are obtained by measurement on two blocks 34*a* and 34*b*, V0=(V01+V2)/2.

As described above, the averaged voltage V0 or V1 or the like can be measured by simultaneously selecting a plurality of pixel rows and applying the constant current to them. This eliminates the need for a post-averaging process or the like.

The present invention is not limited to the case where the measured V0 or V1 voltages or the like are subjected to an A/D conversion and then stored in the memory 502 or the like and are read from the memory and then subjected to a D/A conversion. The V0*s* or V1*s* obtained by measurement or the like are processed so as to be compatible with the display state (for example, black display of the 0th tone). For example, a given value is added to or subtracted from the V0*s* or V1*s* obtained by measurement or the like. Alternatively, the V0*s* or V1*s* obtained by measurement or the like may be divided or multiplied by a given value. Alternatively, they may be corrected on the basis of the panel temperature or the like.

For example, for V0=4.1 V obtained by measurement on the source signal line S1 and V0=3.9 V obtained by measurement on the source signal line S2, a given value of 0.2 V is added to the V0*s*. Thus, 4.3 V is applied to the source signal line S1, and 4.1 V is applied to the source signal line S2 as a voltage for the 0th tone. After application of the voltage for the 0th tone, current precharging with the voltage Vp is carried out, followed by application of a tone current.

Figure 121:
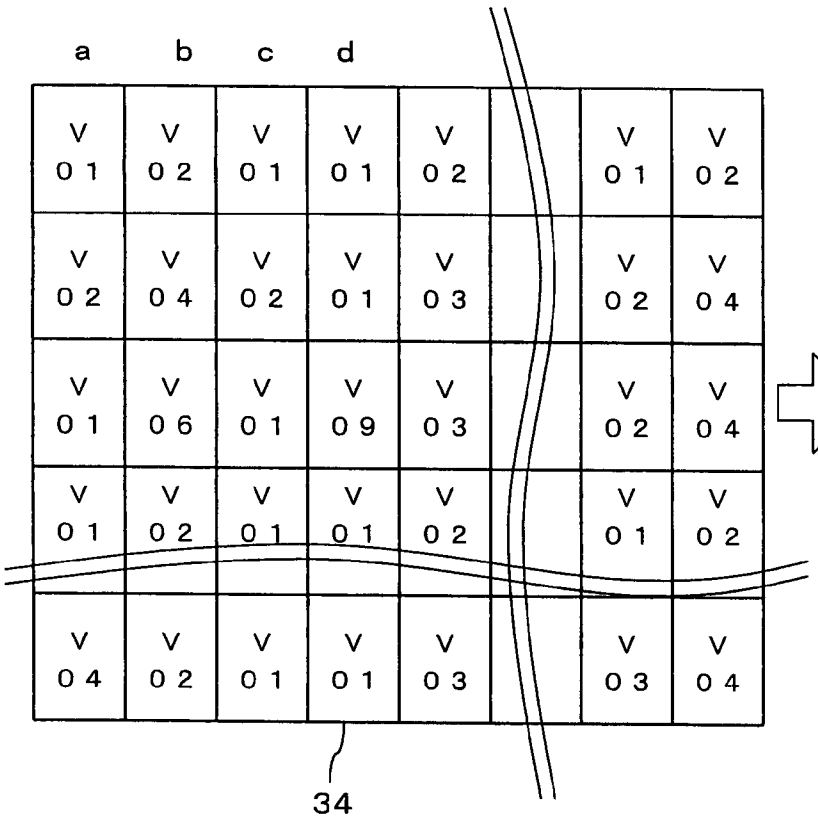
Figure 121:
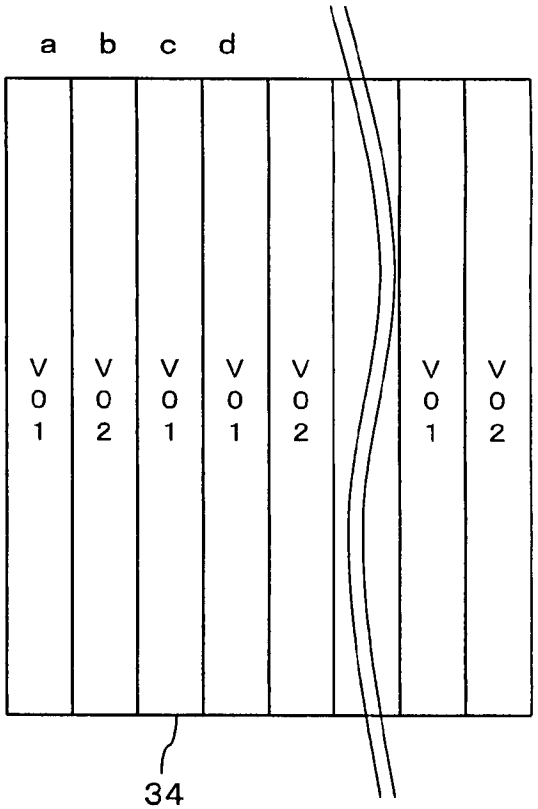

Of course, as shown in FIG. 121, the display screen 34 may be divided into a plurality of blocks. V01, V02, and the like shown in FIG. 121*a* denote voltage values obtained by measurement on each process block. Further, FIG. 121(B) shows the average of voltage values of the process blocks arranged in the vertical direction. For example, an a column in FIG. 121(A) has V01, V02, V01, V01, . . . , V04. The average of these values is V01 as shown in the a column in FIG. 121(B). Similarly, a b column in FIG. 121(A) has V02, V04, V06, V02, . . . , V02. The average of these values is V02 as shown in the b column in FIG. 121(B). A c column in FIG. 121(A) has V01, V02, V01, V01, . . . , V01. The average of these values is V01 as shown in the c column in FIG. 121(B).

In the present invention, as described with reference to FIG. 109, laser beams are preferably applied parallel to the source signal line 18. The direction of doping is preferably adjusted so that the transistors 11*a* have approximate characteristics in a direction parallel to the source signal line 18. This makes the V0 or V1 voltage, described with reference to FIG. 121 and others, approximate to one another in the direction of pixel column, thus facilitating correction or compensation.

Figure 122:
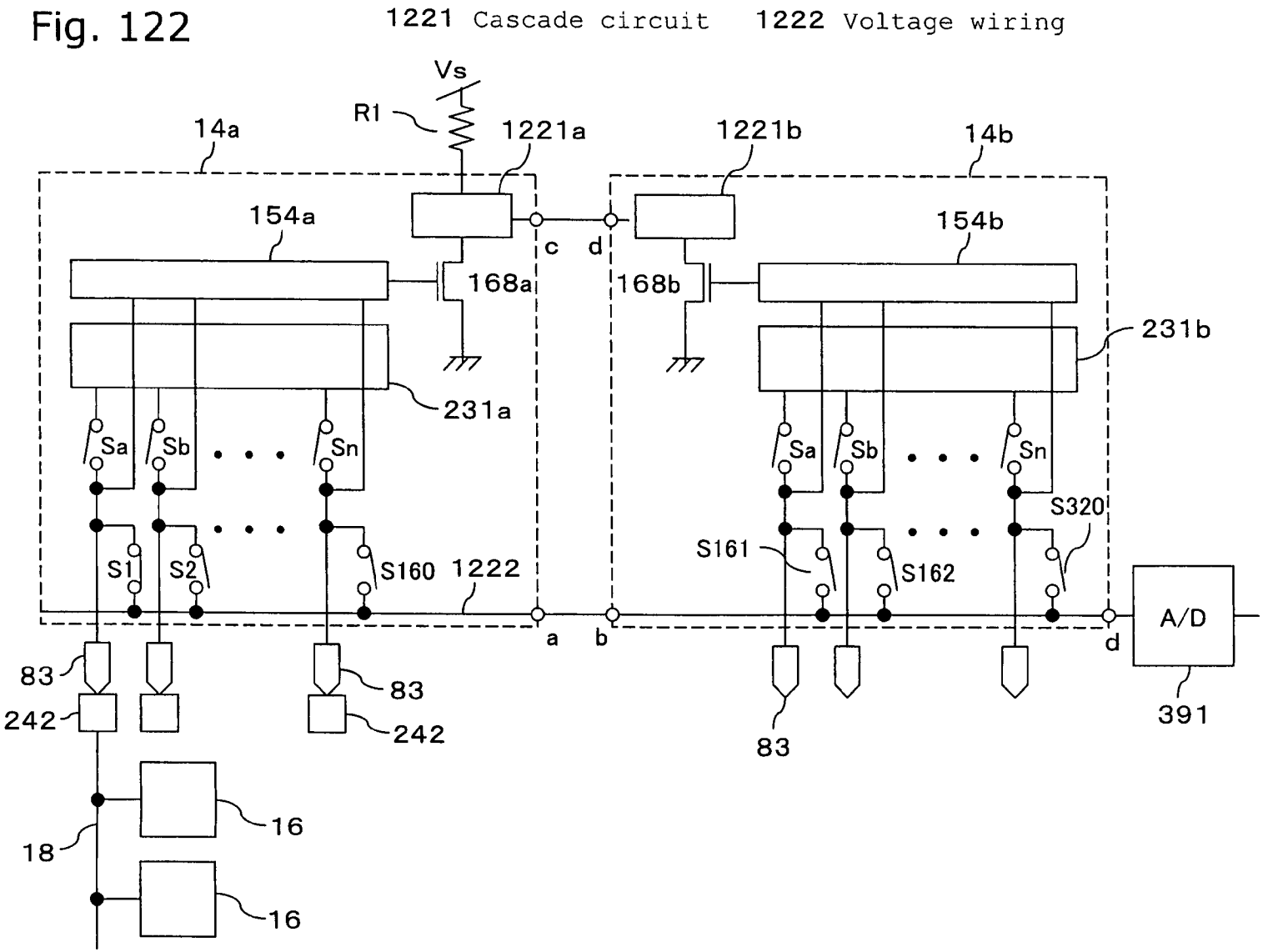

As shown in FIG. 122, the current tone circuit 154 in the source driver IC (circuit) 14*a* is configured to be able to pass the constant current to the driver IC 14*b* located adjacent to the driver IC 14*a* through cascading. The current tone circuit 154*a* in the source driver IC (circuit) 14 in FIG. 122 is configured to be able to apply the constant current to the source signal line 18 via the switches Sa to Sn. Further, the voltage tone circuit 231*a* is configured so that a tone voltage corrected on the basis of the V0 or V1 voltage is applied to the source signal line 18.

The voltage applied (output) to each source signal line 18 is connected to or arranged so as to reach all switches S1 to S160 in the source driver IC (circuit) 14*a* and all switches S161 to S320 in the source driver IC (circuit) 14*b*. The potentials across the 320 source signal lines 18 are output to the single A/D conversion circuit 391. Voltage wiring 1222 in the switch S is extended in a traverse direction in each source driver IC (circuit) 14. The source driver ICs (circuits) 14*a* and 14*b* are connected together via an a and b terminals of the source driver IC (circuit) 14.

The current tone circuit 154*a* in the source driver IC (circuit) 14*a* constitutes a current mirror circuit together with a transistor 168*a*. A current flowing to the transistor 168*a* is adjusted by the external resistor R1 (see FIG. 17 and others). A cascade circuit 1221*a* is formed on a path to the transistor 168*a*. The cascade circuit 1221 is basically composed of an operational amplifier circuit 151*a* and a transistor 167*a* as described with reference to FIGS. 17 and 15. Similarly, the current tone circuit 154*b* in the source driver IC (circuit) 14*b* constitutes a current mirror circuit together with a transistor 168*b*.

The cascade circuit 1221*a* generates two identical constant currents and supplies one of them to the transistor 168*a*, while supplying the other to a cascade circuit 1221*b* in the source driver IC (circuit) 14*b* via terminals c and d. This configuration supplies the same current to both transistors 168*a* and 168*b*. Accordingly, an output current from the current tone circuit 154*a* in the source driver IC (circuit) 14*a* is adjusted or varied by the resistor R1. The same current is also applied to the current tone circuit 154*b* in the source driver IC (circuit) 14*b*. This allows the same constant current to be supplied to the 320 source signal lines 18.

Figure 124:
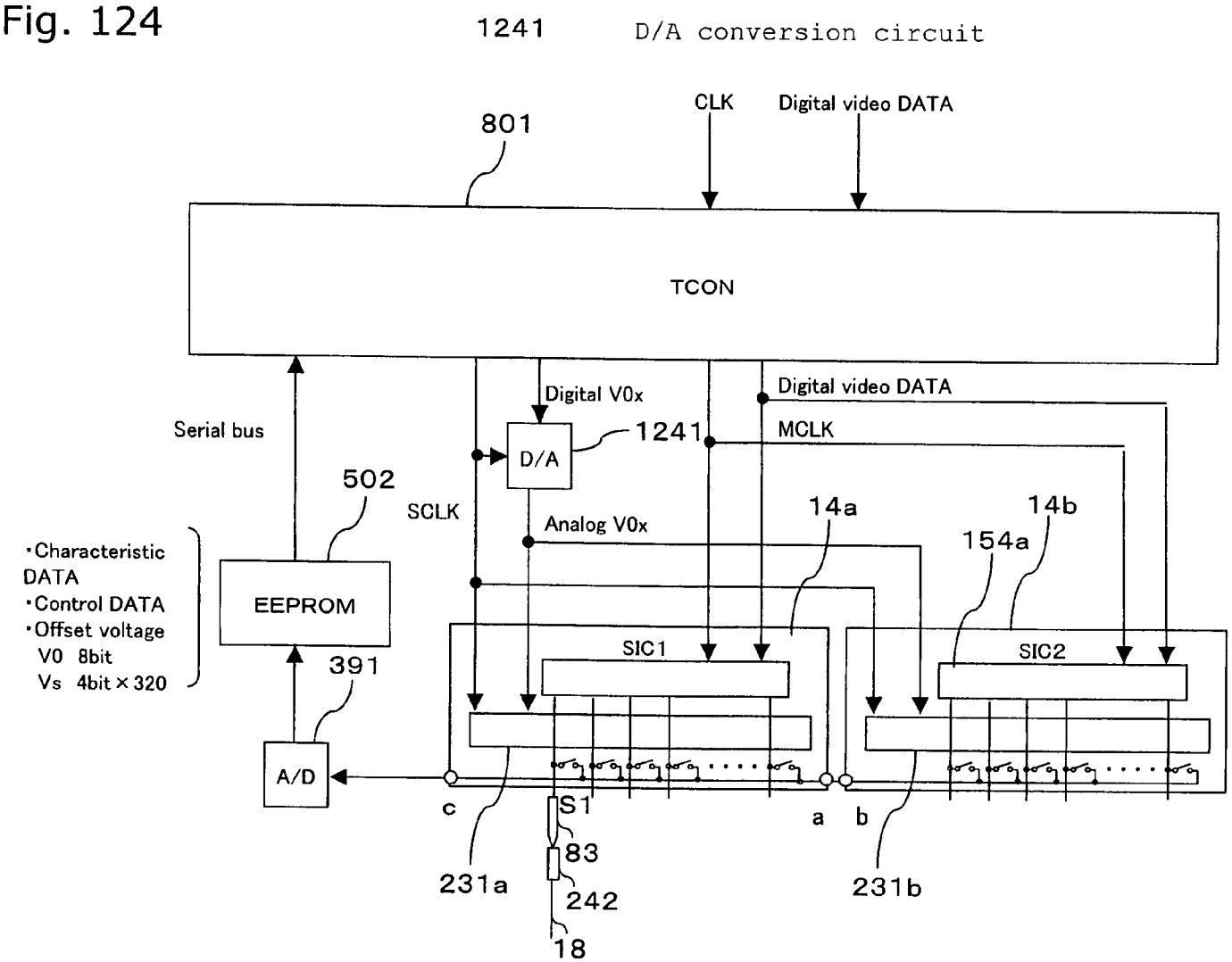

FIG. 124 is a diagram mainly illustrating connections to the EEPROM 502 or the like, shown in FIG. 122. The source signal line 18 is held open so as to allow the measurement of the V0 voltage or the current tone circuit 154 supplies the constant current to each source signal line 18 so as to allow the measurement of a voltage such as the V1. The measurement is carried out by sequentially closing the switches S1 to Sn.

The measured V0 or V1 voltage or the like is output from the terminal c and subjected to an analog-digital conversion by the A/D conversion circuit 391. The resulting data is stored in the memory 502 such as the EEPROM. The following data is stored in the memory 502: V0 data indicative of one absolute value and Vs data indicative of the difference between the V0 data and the voltage across the source signal line. Specifically, when V0=1.5 V, if the source signal line S1 has a voltage value of 1.6 V, the difference Vs1=0.1 V is stored, if the source signal line S2 has a voltage value of 1.7 V, the difference Vs2=0.2 V is stored, . . . , if the source signal line Sn has a voltage value of 1.4 V, the difference Vs1=−0.1 V is stored in the EEPROM 502. The difference data or the like may of course be subjected to a JPEG compression or the like. The EEPROM 502 also stores panel characteristic data (gamma curves and the like) and control DATA (timing signals for the gate signal lines and the like).

Data V0*x* in the EEPROM 502 is transferred to a memory area in the controller circuit (IC) 801 through a three-line serial bus in accordance with a control signal from the controller circuit (IC) 801. The stored data is transferred to the sample hold circuit 241 in accordance with a clock SCLK that is slower than the CLK of the digital video signal DATA; the clock SCLK operates at a half rate equal to or lower than that of a normal clock. The digital data V0*x* is converted into analog voltage data V0*x* by a D/A conversion circuit 1241.

On the other hand, the digital video signal DATA is applied to the controller circuit (IC) 801 in synchronism with the CLK. The controller circuit (IC) 801 processes the digital video signal DATA so that it is compatible with an input format for the source driver IC (circuit) 14. The digital video signal DATA is then applied to the source driver IC (circuit) 14 in synchronism with a clock MCLK.

Figure 123:
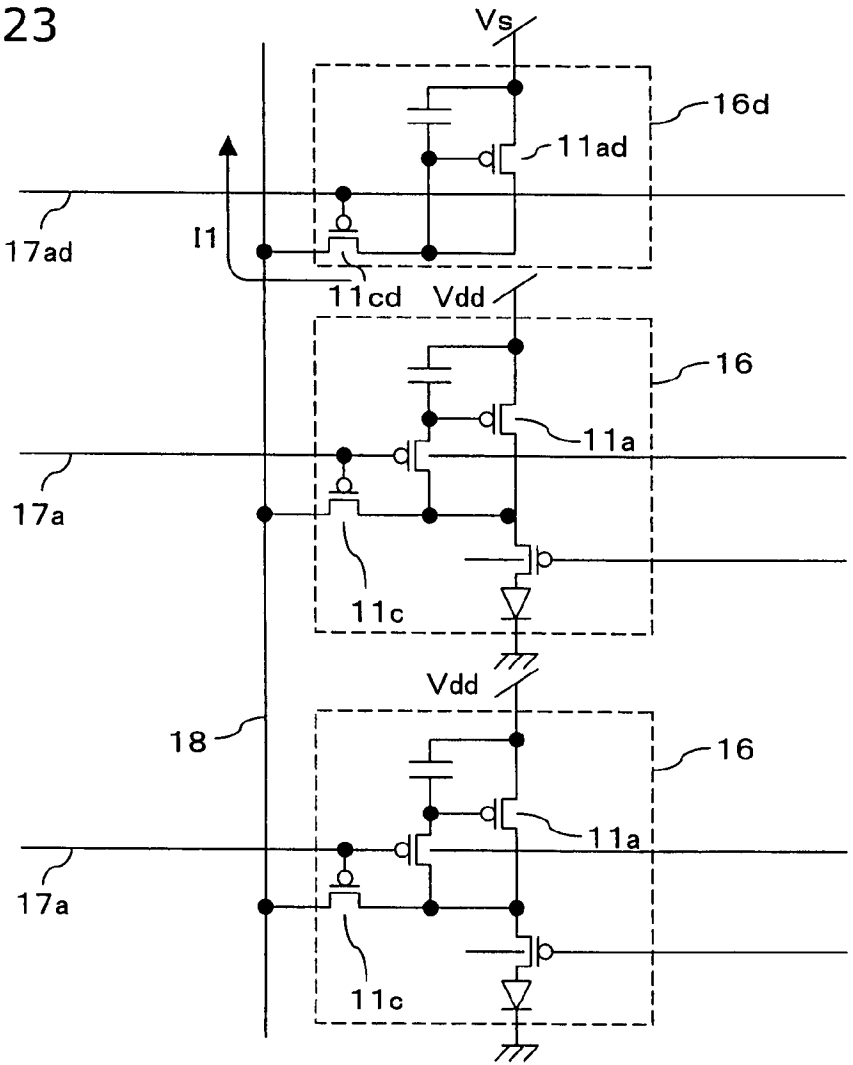

The above embodiment supplies the constant current to each pixel 16 involved in display and measures or calculates or acquires the potential across the corresponding source signal line 18. However, the present invention is not limited to this. For example, as shown in FIG. 123, a pixel 16*d* may be formed on which the V0 voltage is measured. The V0 or V1 voltage or the like is measured on the pixel 16*d*, and the measured data is used as characteristic data on the pixel column connected to the source signal line 18 to which the pixel 16*d* is connected.

As shown in FIG. 123, the constant current I1 is applied to the pixel 16*d*. Further, the on voltage is applied to the gate signal line 17*ad*. This allows the driving transistor had to supply the current I1. A measurement is made of the potential V0, V1, or the like across the source signal line 18 through which the current I1 is flowing. The other arrangements are the same as or similar to those described above and their description is thus omitted.

Figure 125:
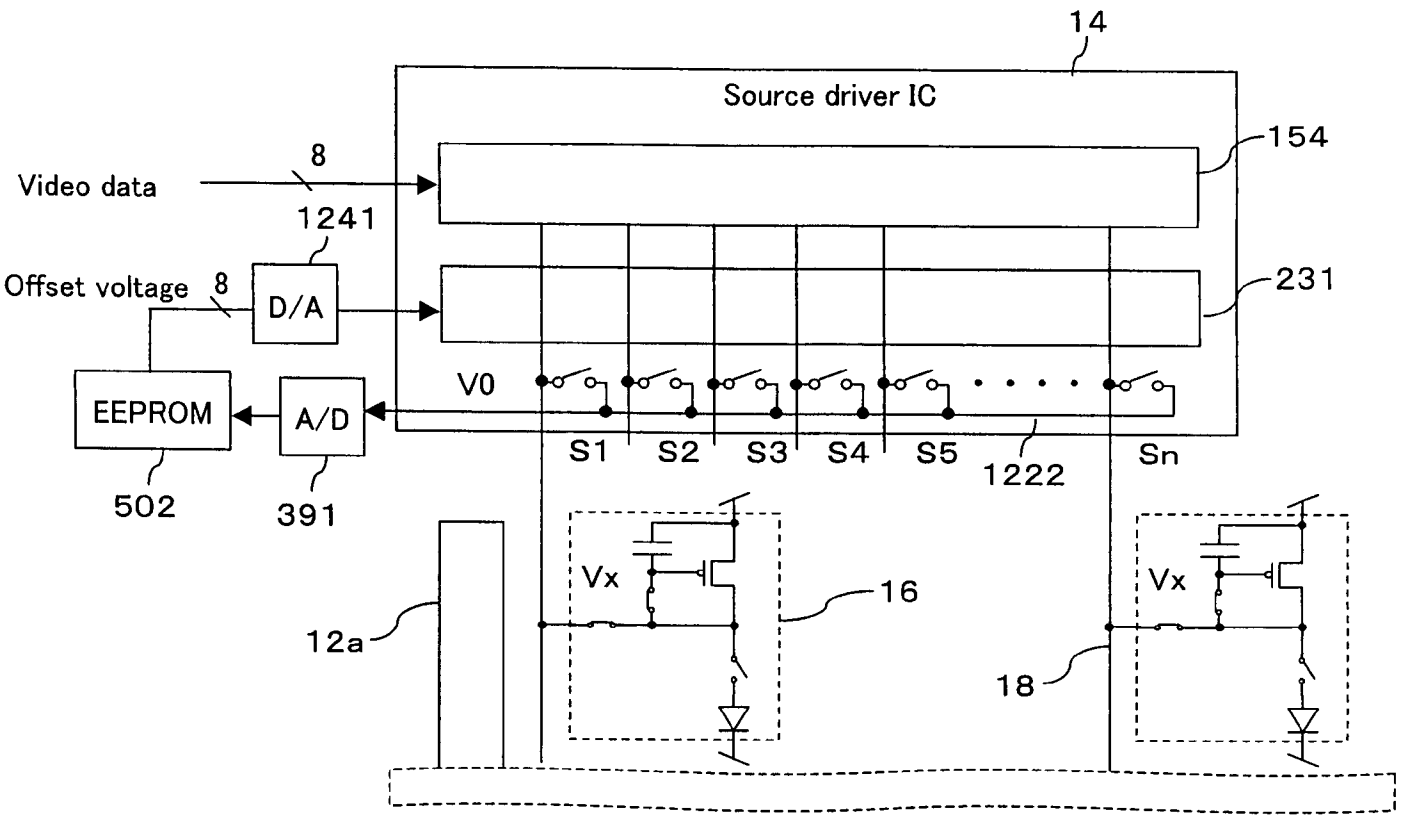

The voltage tone circuit 231 may be composed of a sample hold circuit as shown in FIG. 125. The current tone circuit 154 supplies the constant current to the source signal line 18. Further, the switches S1 to Sn read and load the potential across each source signal line 18 onto the voltage wiring. The potential is then converted into digital data by the A/D conversion circuit 391 and then stored in the EEPROM 502.

The data stored in the EEPROM 502 is periodically read by the controller circuit 801 and converted into analog data by the D/A conversion circuit 1241. On this occasion, the value is corrected so as to be compatible with precharging. The sample hold circuit 241 samples and holds the data. The sample hold circuit is used because of its small scale, contributing to reducing the chip size of the source driver IC (circuit) 14.

The sampled and held voltage is applied to each source signal line 18 in synchronism with a synchronous signal during the 1H. However, the sample hold voltage is not applied to source signal lines 18 to which the voltage need not be output. After the required application, a precharge process is executed on areas involving a change in tone and requiring current or voltage precharging. After the precharge process or the output of the sample hold voltage, the current tone circuit 154 outputs a driving current corresponding to the video signal, to the source signal line 18.

As described above, after applying the sample hold voltage to the source signal line 18 as required, the present invention executes current or voltage precharging as required. This driving scheme subsequently applies the tone current to the source signal line 18. In the above description, the signals are applied to the source signal line 18. However, of course, this means that the signals are applied or supplied to the pixel 16 or the driving transistor 11*a* in the pixel.

Figure 126:
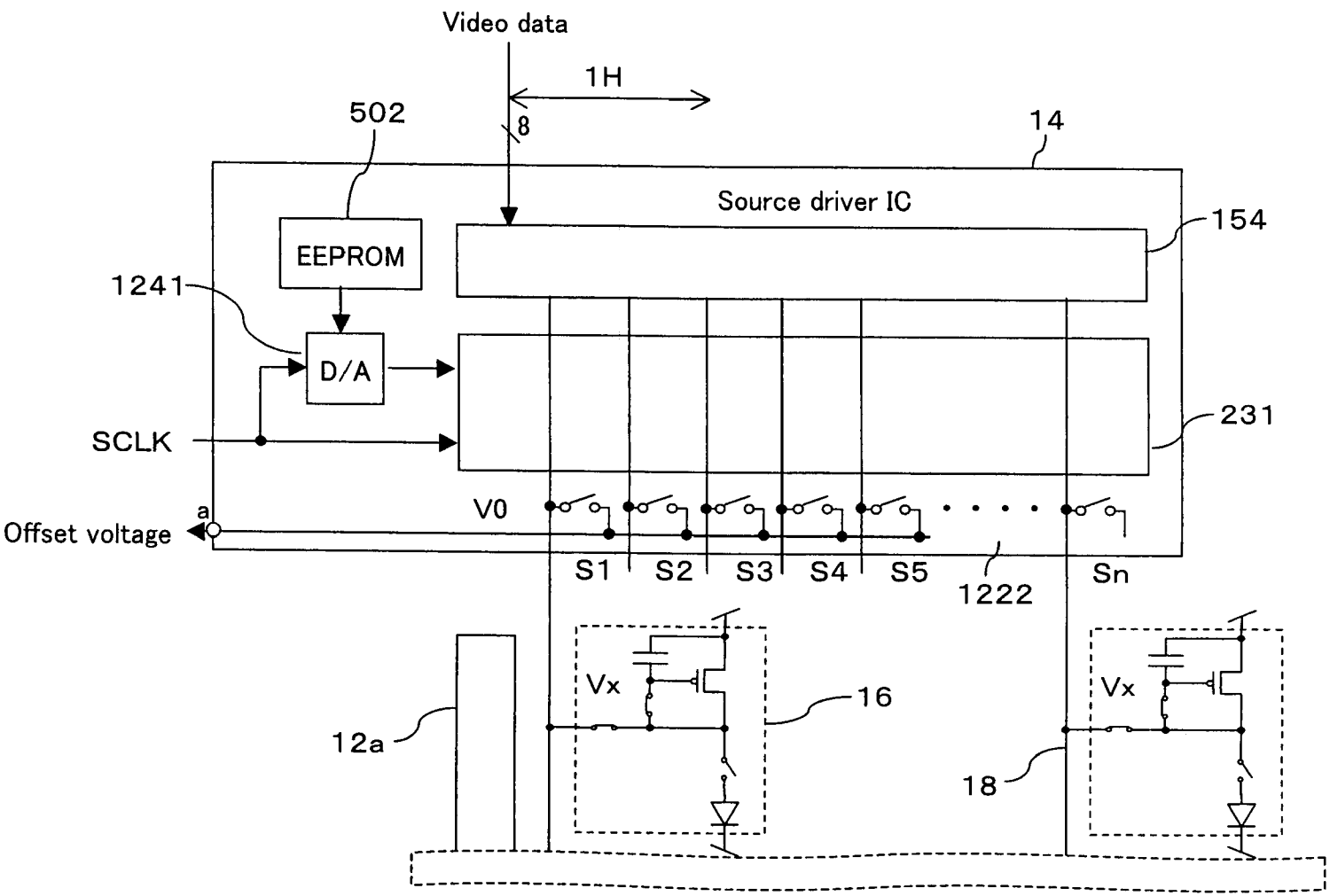

In FIG. 125, the A/D conversion circuit and the like are provided outside the source driver IC (circuit) 14. However, the present invention is not limited to this. For example, as shown in FIG. 126, the EEPROM 502 may be formed inside the source driver IC (circuit) 14. The offset voltage such as the V0 is output from the source driver IC (circuit) 14 via the terminal a. Further, data from the EEPROM 502 may be converted into analog data by the D/A conversion circuit 1241 formed inside the source driver IC (circuit) 14, with the resulting data supplied to the sample hold circuit 241. The sample hold circuit 241 operates in synchronism with the clock SCLK, which is slower than the synchronizing clock for the video signal. The SCLK operates at such a low speed that fluctuation does not occur due to discharging. For example, the SCLK operates in accordance with a horizontal synchronizing clock. The other arrangements and operations have been described in the other embodiments of the present invention. Their description is thus omitted.

Figure 127:
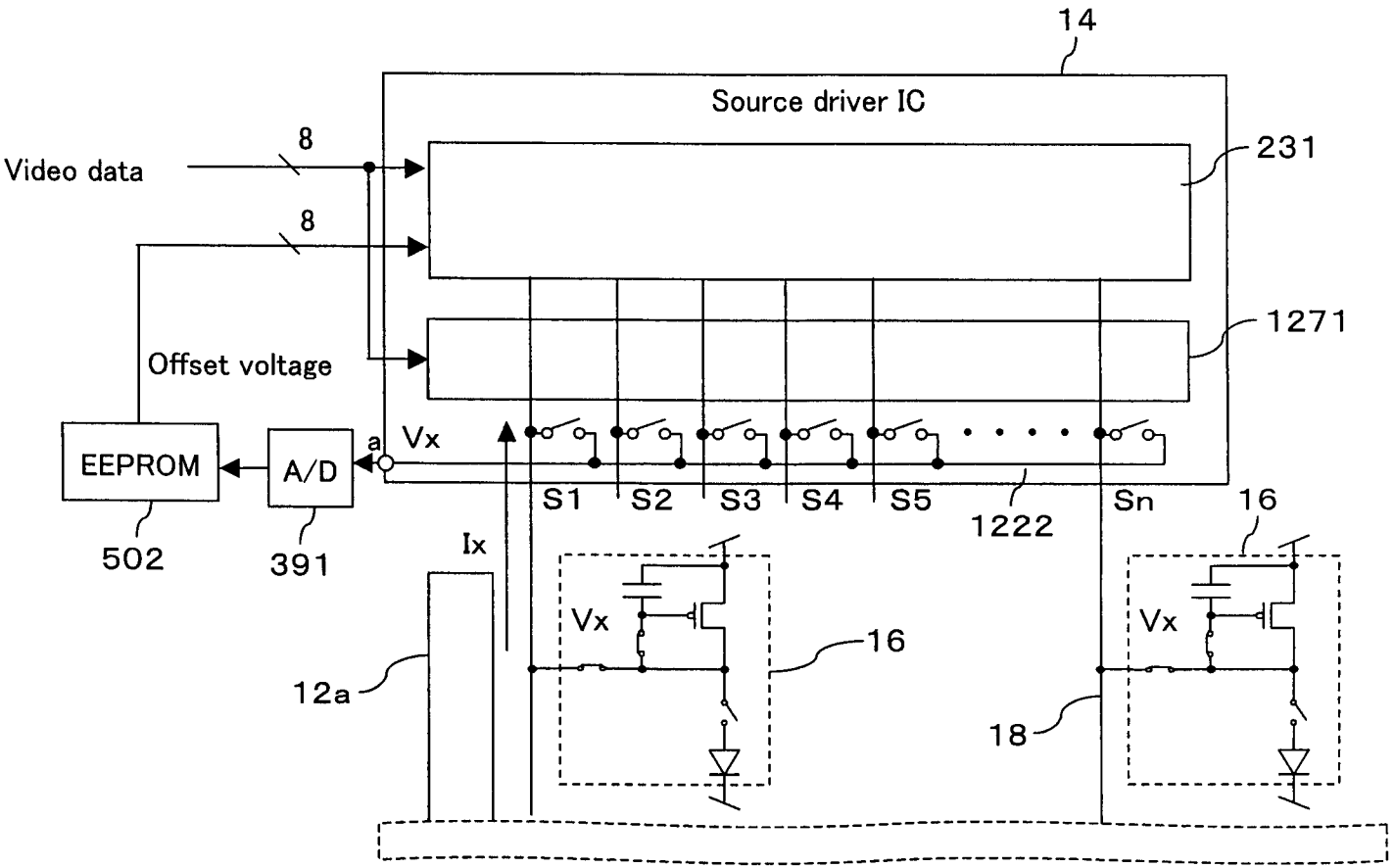

The above embodiment applies the program current after the precharge voltage Vp (program voltage VDATA). The present invention is not limited to this. For example, the apparatus may be completely voltage driven as shown in FIG. 127. If given conditions are met as described with reference to FIG. 81(B), the program current may be applied instead of the precharge voltage Vp (program voltage VDATA).

In FIG. 127, a constant current output circuit 1271 supplies the constant current (Iw=Ix) to the source signal line 18. The supply and application involve a discharge current and a sink current. The potential Vx across each source signal line 18 is output from the terminal a in response to an operation of any of the switches S1 to Sx (Vx denotes the voltage corresponding to the Ix in the V-I characteristic of the driving transistor 11*a*).

An operation of the driving transistor 11*a* in the selected pixel 16 sets the potential across the source signal line 18 at the Vx. The potential is at the V0 if the constant current is not supplied. Further, the potential is at the Vx if the constant current Ix is supplied. x corresponds to the tone and ranges from 1 to 255 (for 8-bit display).

The potential Vx (including the V0) across the source signal line 18 is subjected to an A/D conversion by the A/D conversion circuit 391 and held in the EEPROM 502. An output from the EEPROM 502 is subjected to a gamma process or the like corresponding to the video data, on the basis of the Vx voltage. The output is then applied to each source signal line 18. FIG. 127 shows a voltage driving state. However, this driving differs from the conventional program voltage driving in that the constant current is first supplied to the pixel 16 to acquire the offset voltage (V0).

The embodiment shown in FIG. 127 uses a scheme which holds the potential Vx across the source signal line 18 in the memory 502. However, the present invention is not limited to this. The potential Vx may be temporarily held in the sample hold circuit so as to allow the tone voltage (program voltage) corresponding to the video signal to be generated from the voltage Vx and then applied to the source signal line 18 (to the pixel 16).

Another embodiment of the present invention will be described below. A driver circuit and an EL display apparatus using the driver circuit in accordance with the present invention are configurations or methods which comprise a constant current generating circuit that outputs a constant current applied to a transistor driving an EL element, a voltage holding circuit that measures or holds, for a predetermined period, the voltage at a gate terminal of the transistor to which the constant current is being applied, and a voltage applying circuit which adds or subtracts a predetermined voltage signal to or from the voltage that is, for example, held in the voltage holding circuit or which executes a predetermined process on the voltage, the voltage applying circuit then applying the voltage to the gate terminal of the transistor.

Figure 128:
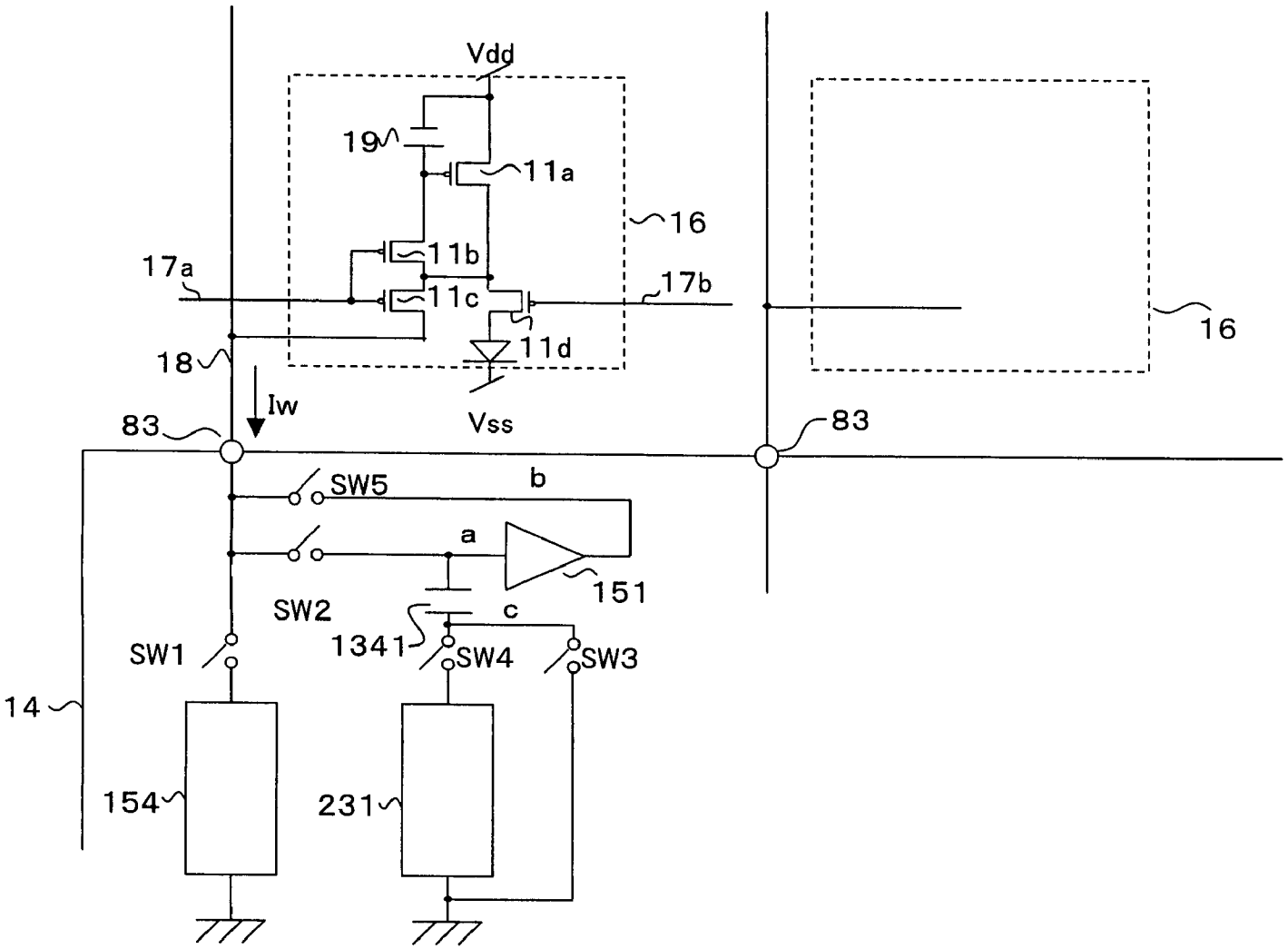

FIG. 128 illustrates a driving circuit section of the present invention. The output terminal 83 of the source driver IC (circuit) 14 is connected to the source signal line 18. The pixel 16 is connected to each source signal line 18. The current tone circuit 154 and voltage tone circuit 231 are constructed or formed for each output terminal 83. The current tone circuit 154 can output a tone current such as a program current. However, the current tone circuit 154 has only to be functionally configured to be able to output a predetermined constant current (program current).

The switches SW1, SW2, SW3, SW4, and SW5 are formed for or arranged at the respective outputs. Further, a capacitor 1341 and the buffer 151 are formed or arranged. The capacitor 1341 may have any configuration provided that it has a function which cuts a DC component. Alternatively, the capacitor 1341 may have any configuration provided that it can shift the potential. The buffer 151 may have any configuration provided that its input section a offers a high impedance, while its output section b offers a low impedance. The buffer 151 may be, for example, a buffer amplifier or an operational amplifier. In addition, an emitter follower circuit may be constructed using transistor elements.

As in the above embodiments, the pixels 16 on the EL display panel (EL display apparatus) in accordance with the present invention are each structured so that one pixel 16 is formed of four transistors 11 and the EL element 15 as shown in FIG. 1. This pixel configuration enables a current path via the transistor driving the EL element 15 to extend at least to the source signal line 18.

The present invention is characterized by passing the program current (constant current Iw) through the driving transistor 11*a* in the pixel 16 and measuring or holding, for a given period, the potential at the gate terminal of the driving transistor 11*a* through which the program current is flowing. The present invention is also characterized by adding or subtracting the tone voltage to or from the gate terminal potential and writing the resulting voltage to the gate terminal of the driving transistor 11*a* in the pixel.

Figure 129:
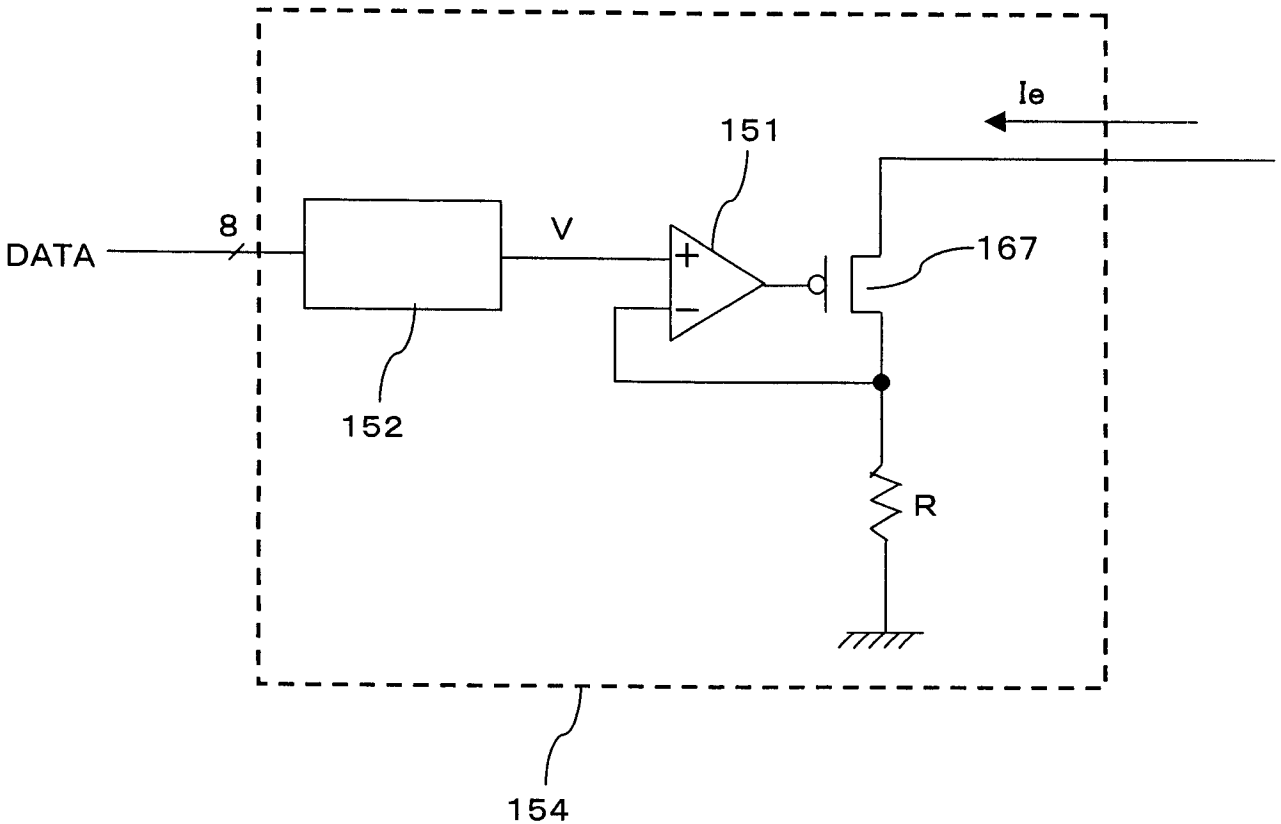

A first operation stores the value of a current flowing through the EL element 15. First, current tone circuit 154 in the source driver IC (circuit) 14 applies the predetermined constant current to the source signal line 18. FIG. 129 shows an example of the current tone circuit 154.

The current tone circuit 154 is composed of, by way of example, the operational amplifier 151, transistor 167, and resistor R. The electronic regulator 152 is connected to a plus side terminal of the operational amplifier 151. The electronic regulator operates as a D/A conversion circuit that converts digital data DATA into analog data V. The output voltage V of the electronic regulator 152 is varied by the setting data (digital data) DATA. The current Iw flowing through the source signal line 18 has a value equal to the output voltage V of the electronic regulator 152 divided by the resistor R.

In the present invention, the electronic regulator 152 may be removed and the constant current may be applied to the source signal line 18 by using a resistor partial pressure circuit or the like to generate a voltage V at the +terminal and applying the voltage V to the operational amplifier 151. Further, the constant current need not necessarily be generated by the current tone circuit 154. Any circuit can be used provided that it can generate a predetermined or given range of constant currents. For example, an emitter follower circuit can also generate a constant current.

The constant current Iw includes the state of the current 0 (passage of no current). In the pixel configuration shown in FIG. 1, setting the program current Iw=0 causes the driving transistor 11*a* to vary the potential at the gate terminal (potential at a—terminal of the capacitor 19) so as not pass the current through the driving transistor 11*a*. This sets the constant current Iw at zero. After the variation, the gate terminal voltage of the driving transistor 11*a* indicates the characteristics of the driving transistor 11*a*. The characteristics of the driving transistor 11*a* can thus be properly compensated for by setting the tone on the basis of the terminal voltage.

While the source driver IC (circuit) 14 is applying the program current Iw to the source signal line 18, the transistors 11*b* and 11*c* are on (closed) as shown in FIG. 5(A). Further, the transistor 11*d* is controlled to be open. The transistors 11*b*, 11*c*, and 11*d* are controlled by an on/off signal applied to the gate signal lines 17*a* and 17*b* (see FIG. 130(A)).

Figure 130:
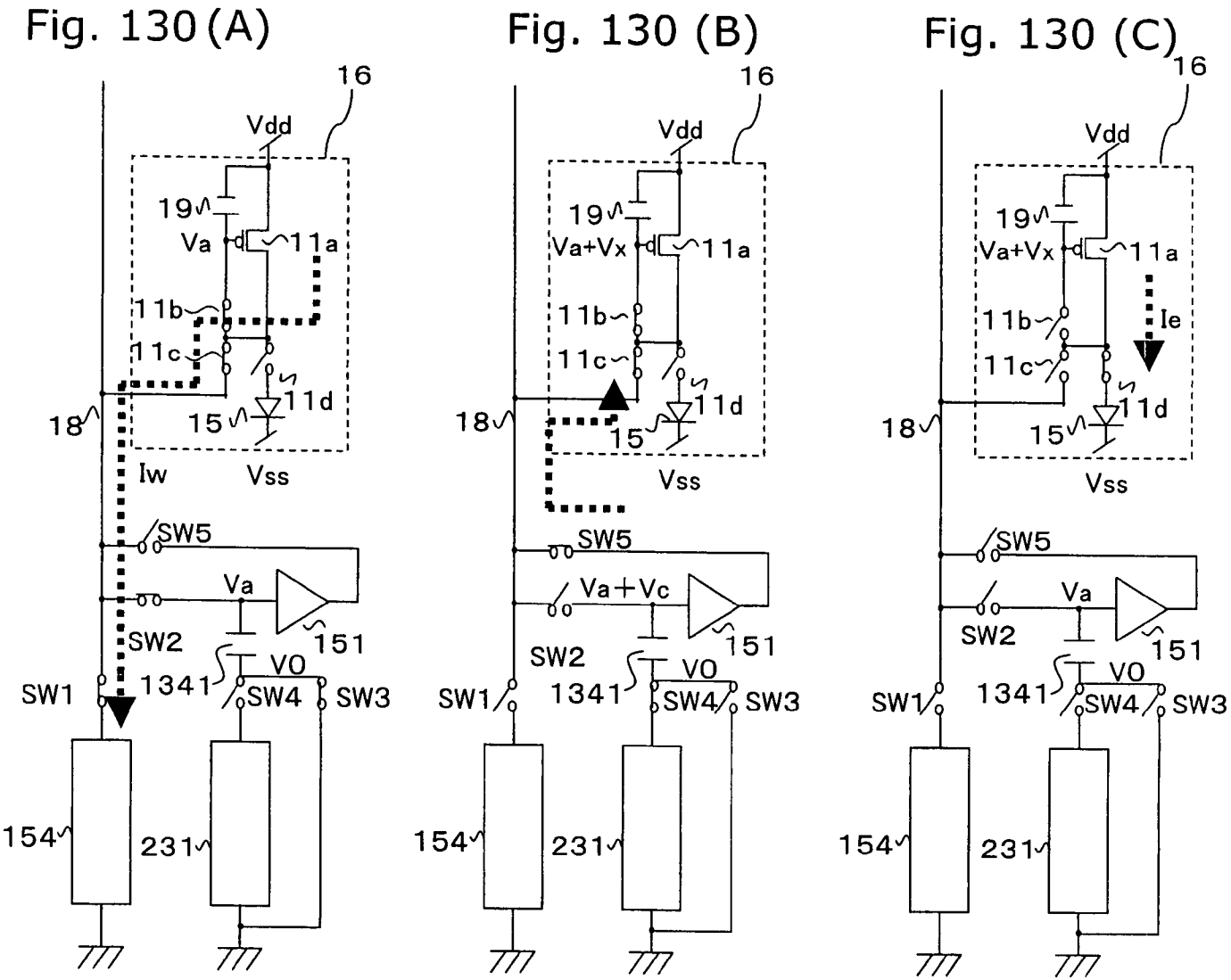

As shown FIG. 130(A), the source driver IC (circuit) 14 performs a reset operation before applying the program current (constant current). The reset operation opens the switches SW2, SW4, and SW5, shown in FIGS. 128 and 130, while closing the switch SW3, to apply a ground potential or a predetermined fixed voltage to the capacitor 1341. The program current may be applied to the source signal line 18 with the switch SW1 closed. The reset operation has been described. The reset operation applies a fixed (known) voltage to a—terminal of the capacitor 1341. The known voltage includes the ground voltage. The capacitor 1341 preferably has a capacity of at least 0.05 pF and at most 2 pF.

The subsequent voltage read operation closes the switch SW1 to apply the program current (constant current) Iw to the source signal line 18. At this time, the switches SW3, SW4, and SW5 are opened, while the switch SW2 is closed (see FIG. 130(A)).

The program current Iw flows through the driving transistor 11*a* in the pixel 16 shown in FIG. 1. The gate terminal potential is varied to allow the program current Iw to flow through the driving transistor 11*a*. Since the transistors 11*b* and 11*c* are closed, the gate terminal potential is output to (read and loaded onto) the source signal line 18. Since the switch SW2 in the source driver IC (circuit) 14 is closed, the a of the source driver IC (circuit) 14 is consequently subjected to the potential at the gate terminal of the driving transistor

11*a* through which the program current (constant current) Iw flows (the potential is read and loaded onto the a of the source driver IC (circuit) 14).

The magnitude of the program current (constant current) Iw may be zero but is preferably set at least one eighth of and at most two thirds of the maximum tone current. To reduce a write time, the magnitude of the program current may be set at least equal to and at most ten times as large as the maximum tone current. The maximum tone current is the magnitude of the current flowing through the EL element 15 for the maximum tone or the magnitude of the program current programmed in the pixel 16. For example, for 256 tones, the maximum tone current is programmed in the EL element 15 for the 255th tone (tone number starts from the 0 tone).

A small program current (constant current) requires a long time to charge or discharge the parasitic capacity of the source signal line 18. A variation in the gate potential of the driving transistor 11*a* does not converge in an initial short time during one horizontal scan period (1H period). A large program current (constant current) hinders characteristic compensations in low tone areas in which the effect of a variation in characteristics among the driving transistors 11*a* is likely to appear in an image display. In the embodiment described above, a constant current that is at least one eighth of and at most two thirds of the maximum tone current is applied to the pixel 16. However, this range may be expressed by tone numbers. The read operation has been described.

The above operation reads and loads the gate terminal potential of the driving transistor 11*a* into the a section of the capacitor 1341. Alternatively, the gate terminal potential is held in the a section of the capacitor 1341. The embodiment shown in FIG. 128 reads and holds the gate terminal potential of the driving transistor 11*a* in the a section of the capacitor 1341. The present invention is not limited to this. For example, it is possible to subject the potential in the a section to an A/D (Analog-Digital) conversion and to hold the resulting digital data in a memory circuit formed or constructed inside or outside the source driver IC (circuit) 14. Of course, the analog data may be held, for a given period, in the storage instrument or the like located outside or inside the source driver IC (circuit) 14.

The next operation applies the tone voltage using the read voltage as a reference (center or origin) (see FIG. 130(B)). This operation controllably opens the switches SW1, SW2, and SW3 and closes the switches SW4 and SW5. The gate terminal voltage of the driving transistor 11*a* in the selected pixel 16 is held in the a section of the capacitor 1341. The voltage held during the flow of the constant current is called a Va voltage. The gate terminal voltage is required for the driving transistor 11*a* to conduct the program current (constant current) to the EL element 15. If the ground (GND) voltage is being applied to the c section, the gate terminal voltage of the driving transistor 11*a* is held between the opposite electrodes of the capacitor 1341.

When the operational amplifier 151 offers a gain of 1, the voltage in the a section is applied to the source signal line 18 via the switch SW5. Since the transistors 11*b* and 11*c* in the pixel 16 are closed during one selected horizontal scan period (1H period), the read gate terminal voltage of the driving transistor 11*a* is, under this condition, applied to the gate terminal of the driving transistor 11*a* in the pixel 16 again. Accordingly, the driving transistor 11*a* conducts the current corresponding to the constant current to the EL element 15. In this state, a variation in characteristics among the driving transistor 11*a* is compensated for, and the constant current (programmed current) is precisely flowing through the EL element 15. Of course, the Va voltage varies among the pixels depending on the characteristics of the driving transistors 11*a*. However, the program current (constant current) is precisely applied to and passed through the EL element 15.

The voltage tone circuit 231 outputs the tone voltage Vx corresponding to each tone. The tone voltage Vx corresponds to the tone number of the video signal. The tone voltage Vx may be considered to be the video signal. The image can be displayed by applying, as a program voltage, the tone voltage Vx to the driving transistor 11*a* as it is or after executing a given process (proportional process, shift process, addition or subtraction process, or the like) on the tone voltage Vx.

The tone voltage Vx is applied to the c section of the capacitor 1341 via the switch SW4. The potential Va in the a section of the capacitor 1341 is shifted by the tone voltage Vx output by the voltage tone circuit 231. Accordingly, the potential in the a section is ideally Va+Vx.

The Va+Vx voltage is output after having its impedance reduced by the operational amplifier 151, offering a gain of 1. The Va+Vx voltage is applied to the source signal line 18 via the switch SW5 and output terminal 83 and then to the gate terminal of the driving transistor 11*a* in the pixel 16. Therefore, the driving transistor 11*a* applies the current corresponding to the Va+Vx to the EL element 15.

In FIG. 128, the operational amplifier 151 offers again of 1. However, the present invention is not limited to this. The gain may have a value other than 1. For example, if the gain has a value of 2, the operational amplifier 151 doubles the voltage applied to the a section and applies the resulting voltage to the source signal line 18. Further, the polarity of the voltage applied to the a section may be inverted. Furthermore, the tone voltage Vx is an arbitrary voltage for each tone. The tone voltage Vx is generated or set around the Va voltage.

In FIG. 128, the operational amplifier 151 is used. However, the present invention is not limited to this. Any component may be used provided that it offers a high input impedance and an low output impedance. For example, FIG. 146 shows an example of a configuration using a transistor-based emitter follower circuit 1431. The emitter follower circuit 1431 is composed of a transistor Q and the resistor R. The impedance seen looking toward the gate of the transistor Q from the a section is high, whereas the b section has a low output impedance. This makes it possible to stably hold the potential at the capacitor 1341, thus enabling the source signal line 18 to be properly charged or discharged by the voltage applied via the switch SW5. The tone voltage can thus be properly applied to the driving transistor 11*a* in the pixel 16.

Figure 131:
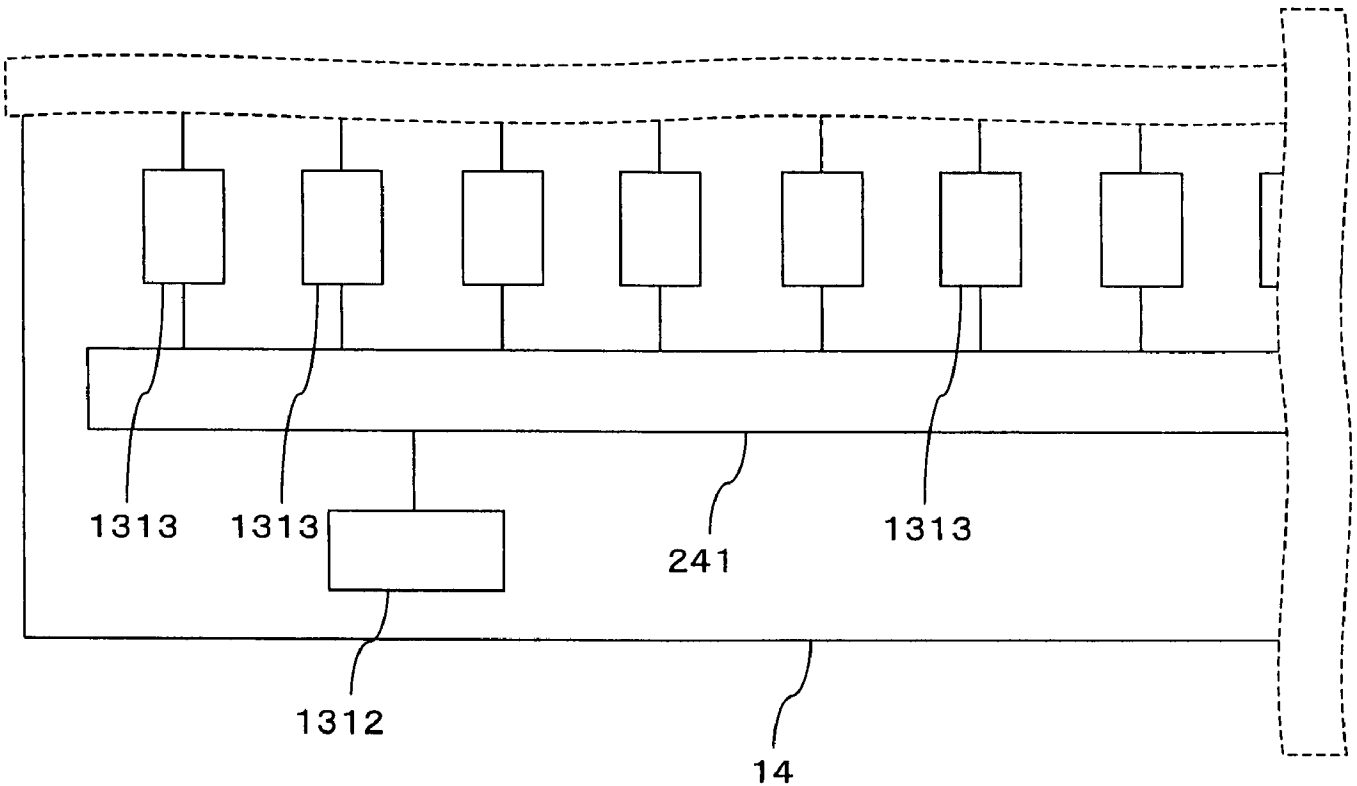

In FIG. 128, the current tone circuit 154 is placed or formed in the source driver IC (circuit) 14 in association with each source signal line 18. However, the present invention is not limited to this. For example, it is possible to arrange one or more constant current sources 1312 as shown in FIG. 131 and to use a switch circuit 1311 to switch the constant current sources 1312 so as to apply the constant current to a current output circuit 1313 formed or constructed in each source signal line 18 or output terminal 83. The current output circuit 1313 is provided with a current mirror or copier circuit so as to enable the value of a current applied by the constant current source 1312 to be held. The holding is carried out by the current mirror or copier circuit, constructed or formed in the current output circuit 1313.

The constant current (tone current) output by the constant current source 1312 need not necessarily have a constant value. The constant current enables the output of a plurality of tones such as 64 or 256 tones or a plurality of current magnitudes. Further, the apparatus may be configured so that the constant current has a value changing at intervals of one horizontal scan period (1H). Furthermore, the apparatus may be configured so that the constant current has a value varying with the pixel in synchronism with a dot clock. The constant current source 1312 may be replaced with the current tone circuit 154.

The tone voltage Va may be replaced with the tone number. For example, the Va voltage corresponds to the 128th of 256 tones, and the Vx=Vc−Va corresponds to a voltage for 64 tones. The voltage tone circuit 231 outputs the Vx to allow the Vc to cover 128+64=192 tones. Provided that the Vx acts in one direction and that the Va−Vx corresponds to a voltage for 64 tones, the voltage tone circuit 231 outputs the Vx to allow the Vb to cover 128-64=64 tones. In FIG. 132, the current corresponding to the Vb is the Ib. Of course, the tone voltage Va may have any unit or magnitude.

FIG. 132 shows the current passed through the tone voltage-based EL element 15. A solid line in FIG. 132 shows the V-I characteristic of the driving transistor 11*a* in the pixel 16. In FIG. 132, the Va voltage allows the current Ia to flow through the EL element 15. The tone voltage Vx corresponds to each tone. The tone voltage is varied around the Va toward a plus (+Va) or minus (−Vx) side. For example, if the tone voltage is changed toward the plus side, the current Iw is applied to the EL element 15. If the tone voltage is changed toward the minus side, the current Vb is applied to the EL element 15. That is, the voltage tone circuit 231 executes an addition, a subtraction, or the like on the voltage so as to change the voltage around the Va toward the plus or minus side. The voltage tone circuit 231 then holds the resulting voltage in the a section. Of course, the voltage tone circuit 231 may output the 0 voltage.

The Va voltage may zero the output current from the driving transistor 11*a*. In this case, the current tone circuit 154 outputs the 0 current (current tone circuit 154 is unwanted). The on voltage is applied to the gate signal line 17*a* connected to the corresponding selected pixel 16. Application of the on voltage to the gate signal line 17*a* causes the driving transistor 11*a* to vary the gate terminal potential so as to zero the current passed through the EL element 15. The potential V0 is held in the a section of the operational amplifier 151; the potential V0 zeroes the current passed through the EL element 15. The voltage tone circuit 231 outputs a plus side voltage, which is then added to the voltage held in the a section. The resulting voltage is then output to the b section of the operational amplifier 151 (see FIG. 133).

As shown in FIG. 133, after an operation is performed so as to zero the current conducted to the source signal line 18 by the current tone circuit 154 as well as the current conducted to the EL element 15 by the driving transistor 11*a*, the potential V0 across the source signal line 18 is measured. The V0 is obtained after a voltage offset cancel operation. An operation is performed so as to apply the tone voltage Vx based on the V0 to pass the current Ie through the EL element 15.

The second operation shown in FIG. 130(*c*) applies a current to the EL element 15. In FIG. 1, the second operation causes the driving transistor 11*a* to apply the current Ie to the EL element 15 on the basis of the voltage applied to the gate terminal of the driving transistor 11*a*. The applied current Ie allows the EL element 15 in each pixel 16 to perform a light emitting operation.

The above operations are performed by the gate driver circuit 12 by sequentially selecting the pixel rows. That is, one of the pixels rows is selected during each horizontal scan period. First, at the beginning of a horizontal scan period, the constant current is applied to the selected pixel row. With the constant current applied, the Va required to pass the constant current through the driving transistor 11*a* is read or held in the a section. Then, the tone voltage is added to or subtracted from the Va voltage, and the resulting voltage is applied to the gate terminal of the driving transistor 11*a*. This completes one horizontal scan period. The selected pixel row applies a current to the EL element 15 during a predetermined period after the next horizontal scan period. The EL element 15 thus emits light.

Then, during the next horizontal scan period, the next adjacent pixel row is selected. The pixel row is selected during this horizontal scan period, and the constant current is applied to the pixel row selected at the beginning of the horizontal scan period. The Va required to pass the constant current through the driving transistor 11*a* is read. Then, the tone voltage is added to or subtracted from the Va voltage, and the resulting voltage is applied to the gate terminal of the driving transistor 11*a*. This completes one horizontal scan period.

The magnitude of the constant current Iw applied to each pixel 16 may be varied or changed or adjusted depending on the magnitude of the current Ie passed through the EL element 15 in each pixel 16, the difference between the present current and the rewritten current, a lighting period, or the like. The magnitude of the constant current Iw may be varied or changed or adjusted depending on the ratio (lighting ratio) of the current used for each image display to the maximum current used for the entire display screen 34. In particular, the maximum value is defined as 100%, and the constant current Iw is preferably increased when the current value becomes 25% or less. That is, the magnitude of the constant current Iw is varied (controlled) depending on the lighting ratio.

The amplification scale of the operational amplifier 151 may be varied depending on the magnitude of the current passed through the EL element 15 in each pixel 16, the difference between the present current and the rewritten current, a lighting period, or the like. Alternatively, the period during which the constant current is applied may be varied. The amplification factor of the tone voltage Vx output by the voltage tone circuit 231 may be varied depending on the magnitude of the current passed through the EL element 15 in each pixel 16, the difference between the present current and the rewritten current, a lighting period, or the like. Further, Va and V0 voltages may be corrected by a given amount so that the corrected Va and V0 can be used as reference voltages. Further, the switch SW2 and the like may be omitted.

The apparatus shown in FIG. 128 may be configured as shown in FIG. 134. In FIG. 134, aD/A (Digital-Analog) conversion circuit 1241 is connected to the switch SW3. The D/A conversion circuit 1241 applies a voltage to the c section via the switch SW3 on the basis of the digital data DATA. Accordingly, not only the ground (GND) potential but also various voltages can be applied to the c section. For example, the voltage Va read from the gate terminal of the driving transistor 11*a* can be applied to one of the electrodes of the capacitor 1341, that is, the c section. This enables the offset canceling of the capacitor 1341 to be carried out or set easily, properly, and freely.

The configuration shown in FIG. 134 enables the voltage applied to the a section to be shifted by a given amount. This configuration makes it possible to suppress or enhance the shifting of the potential at the gate terminal of the driving transistor 11*a* caused by a punch-through voltage resulting from a change from the on voltage applied state to off voltage applied state of the gate signal line 17*a*. The other arrangements are similar to those shown in FIG. 128, and their description is thus omitted.

Further, in FIG. 128, the potential across the source signal line 18 is held in the capacitor 1341 in an analog manner.

However, the present invention is not limited to this. For example, a configuration such as the one shown in FIG. 135 may be used.

In FIG. 135, the potential across the source signal line 18 is subjected to an analog-digital conversion by the analog-digital (A/D) conversion circuit 391. The resulting digital data converted is added to the output voltage from the voltage tone circuit 231 by the addition circuit 651. As in the case of FIG. 128, the resulting voltage added is applied to the input a section of the operational amplifier 151. The voltage is subjected to an impedance conversion and the resulting voltage is output from the b section. The other operations and arrangements are similar to those shown in FIG. 128, and their description is thus omitted.

In FIG. 128, the addition circuit 651 provides a function same as or similar to a combination of the functions of the capacitor 1341 and voltage tone circuit. The A/D conversion circuit 391 has a function which measures and holds potentials and thus has the functions of the capacitor 1341 shown in FIG. 128. The addition circuit 651 adds the output data from the voltage tone circuit 231 to the output data from the A/D conversion circuit 391 (or executes a subtraction) to output the resulting data to the a section. This operation is similar to the addition of the voltage Va in the a section of the capacitor 1341 to the output voltage Vx of the voltage tone circuit, which shifts the potential in the a section.

Further, in the above description, the A/D conversion circuit 391 applies the measured or held voltage to the addition circuit 651 as digital data. However, the present invention is not limited to this. For example, the digital data from the A/D conversion circuit 391 may be held in a memory circuit (not shown) constructed or formed outside or inside the source driver IC (circuit) 14. The digital data is read and applied or output to the addition circuit 651 as required.

The potential across the source signal line 18 is varied by the voltage or current output by the source driver IC (circuit) 14. The potential across the source signal line 18 is basically rewritten at intervals of one horizontal scan period. The present invention applies the constant current to the driving transistor 11*a* at the beginning of a horizontal scan period (1H) to operate the driving transistor 11*a* and measures, acquires, or holds the gate potential of the driving transistor 11*a* having completed the operation and brought into a steady state. A variation in characteristics among the driving transistors 11*a*is compensated for by applying the tone voltage to the driving transistor 11*a* on the basis of the voltage obtained by measurement or the like.

The constant current Iw need not necessarily steadily have a predetermined constant value during one horizontal scan period (1H period). For example, the constant current Iw may have a large value at the beginning of application, and after a given period, may be set to a predetermined value. This operation enables the parasitic capacitance of the source signal line 18 or the like to be charged or discharged in a short time. That is, the constant current Iw may be varied among multiple levels during one H period. Further, the multiple levels of the constant current may be changed or altered depending on the potential across the source signal line 18.

In order to vary the potential at the gate terminal of the driving transistor 11*a* to compensate for a variation of characteristics among the driving transistors 11*a*, it is first necessary to use the constant current Iw (and of course the operation of the driving transistor 11*a*) to charge or discharge the parasitic capacitance of the source signal line 18. A charging or discharging time depends on the potential across the source signal line 18 during the preceding horizontal scan period. Thus, charging or discharging may not be completed within a predetermined time depending on the potential across the source signal line 18.

To solve this problem, the present invention applies the precharge voltage Vp to the source signal line 18 at the beginning of one horizontal scan period (1H). As described later, the apparatus is configured to form a precharge voltage Vp in the source driver IC (circuit) 14 to allow a predetermined voltage to be applied to the source signal line 18.

FIG. 137 shows that the precharge voltage Vp is applied during the A period of each horizontal scan period. Application of the precharge voltage Vp allows each source signal line to be instantaneously charged or discharged to set the potential Vp. The application period of the precharge voltage Vp can be varied or adjusted by the potential across the source signal line 18.

The present invention is not limited to application of the precharge voltage Vp during the A period. If the potential across the source signal line 18 is within a predetermined range before application of the precharge voltage Vp, the precharge voltage Vp need not be applied. As described above, whether or not to apply the precharge voltage Vp is determined or adjusted depending on the potential across the source signal line 18, the magnitude of the applied precharge voltage Vp, the difference between the applied precharge voltage Vp and the potential across the source signal line 18, or the applied tone value.

The precharge voltage Vp is set at a value close to the anode voltage Vdd that is closer to the Va or V0 voltage. The precharge voltage Vp may have a predetermined fixed value or the apparatus may be configured to be able to vary or adjust the precharge voltage Vp depending on the Va or V0 voltage.

Each of the first to third Hs (first to third horizontal scan periods) is one horizontal scan period. Further, the first to third Hs (first to third horizontal scan periods) corresponds to the order in which the pixel rows are selected. With n pixel rows, one field (frame) period is composed of n horizontal scan periods (pixel rows) and a blanking period. The precharge voltage Vp is applied during the first A period of each horizontal scan period. This allows the precharge voltage Vp to be instantaneously set regardless of the potential across the source signal line 18 during the preceding H.

The precharge voltage Vp is preferably set at the V0, corresponding to the tone 0. This enables a good black display to be realized. Of course, the Vp voltage varies depending on a variation in characteristics among the driving transistors 11*a* in the respective pixels 16. Panel characteristics may be evaluated or measured to determine the voltage V0 corresponding to the constant current Ia=0 (A) so that the voltage V0 can be used as the precharge voltage Vp. As described above, the present invention pre-measures the V0 voltage or the like to determine the precharge voltage Vp in order to set a constant convergence time. The V0 voltage can be measured or acquired by the embodiment described in FIGS. 92 to 113.

During a B period of the horizontal scan period, which follows the A period, the current tone circuit 154 outputs the constant current Iw. The constant current Iw may also be applied during the A period. The constant current Iw may also be 0 (A). The constant current Iw=0(A) corresponds to the V0 in FIG. 132. The constant current Iw flows from the driving transistor 11*a* in the pixel 16 to the current tone circuit 154 via the source signal line 18. The constant current Iw=Ia sets the potential at the gate terminal of the driving transistor 11*a* in the pixel, to the Va voltage.

Of course, the Va voltage varies depending on a variation in characteristics among the driving transistors 11*a* in the respective pixels 16. The voltage can be precisely written by determining and using the voltage Va corresponding to the constant current Ia which is determined by evaluating or measuring the panel characteristics. The Va voltage can be measured or acquired by the embodiment described in FIGS. 92 to 113.

During a C period, which follows the B period, a target voltage Vc as a video signal is applied. Accordingly, the target tone Vc=Va+Vx, based on the Va, is applied to the source signal line 18. In the example shown in FIG. 137, the target tone for the first H is V1. The target tone for the second H is V2. The target tone for the third H is V3. During the B period, the voltage required to obtain the target tone is applied. Subsequently, the pixel row selected position is sequentially shifted until the n-th H to apply the voltage corresponding to the target tone.

FIG. 137 shows the embodiment with the constant precharge voltage Vp. However, the present invention is not limited to this. For example, the precharge voltage Vp may be varied as shown in FIG. 137. In the example shown in FIG. 137, a precharge voltage Vp1 is applied during the first H. A precharge voltage Vp2 is applied during the second H. A precharge voltage Vp3 is applied during the third H.

FIG. 136 shows the embodiment with the constant precharge voltage Vp. However, the present invention is not limited to this. For example, the Va voltage may be varied as shown in FIG. 138. The target Va voltage is obtained by varying the constant current. In the example shown in FIG. 138, a voltage Va1 is applied during the first H. A voltage Va2 is applied during the second H. A voltage Va3 is applied during the third H.

The above embodiment applies the precharge voltage Vp at the beginning of the horizontal scan period and then the target voltage V. The present invention is not limited to this. It is also possible to apply the precharge voltage Vp at the beginning of the horizontal scan period and then the target program current. FIG. 139 shows a corresponding embodiment. The precharge voltage Vp is applied as required. The precharge voltage Vp need not necessarily be applied at the beginning of the horizontal scan period.

In the embodiment shown in FIG. 139, the precharge voltage Vp applied during the A period, that is, at the beginning of the horizontal scan period, corresponds to the program current Iw written to the pixel as a video signal. That is, the precharge voltage Vp has a value equal or close to that of the gate terminal potential obtained when the program current Iw corresponding to a target tone signal is written to the driving transistor 11*a* in the pixel 16. The precharge voltage Vp is acquired using the scheme described with reference to FIGS. 38 to 66, 74 to 78, 85, and others. The precharge voltage Vp is stored in the memory 502 and read and applied to the pixel 16 as required.

The precharge voltage Vp applied during the A period is a program voltage corresponding to a written video signal or an approximate voltage. The precharge voltage Vp allows the driving transistor 11*a* in the pixel 16 to be programmed so as to provide a current equal or close to the target tone current (program current) Iw.

During the first H (first horizontal scan period), the precharge voltage Vp=Vp1, which is applied to the source signal line 18. Application of the precharge voltage Vp1 sets the potential across the source signal line 18 at a target or similar voltage in a short time. Alternatively, application of the precharge voltage Vp1 sets the potential at the gate terminal of the driving transistor 11*a* in each pixel in the selected pixel row.

During the second H (second scan period), the precharge voltage Vp=Vp2. During the third H, the precharge voltage Vp=Vp3. The applied precharge voltage Vp has a value corresponding to the video signal written to the pixel 16. The precharge voltage Vp applied during the A period often deviates from the target value. The causes of the deviation include the dependence of the driving transistor 11*a* on temperature, the degradation of the driving transistor 11*a*, and the like. However, the present invention applies the program current Iw during the B period, following the A period. Application of the program current makes it possible to compensate for the dependence on temperature.

Accordingly, voltage driving during the A period enables the source signal line 18 to be charged or discharged in a short time to write an accurate program current to the pixel 16 during the B period. Further, since the potential is already set equal or close to the target value during the A period, the program current Iw insignificantly changes the potential. In spite of small program currents Iw in low tone areas, an insufficient writing (failure to reach the target value) is avoided, thus enabling accurate tone current settings. The program current Iw is output by the current tone circuit 154.

A program current Iw1 for the first H which is applied during the B period sets the potential across the source signal line 18 at the V1. The potential V1 is applied to and held in the gate terminal of the driving transistor 11*a* in the pixel 16.

The driving transistor 1*a* is programmed to pass the program current Iw1 through itself. During the second 2H (next pixel row), a program current Iw2 sets the potential across the source signal line 18 at the V2. The potential V2 is applied to and held in the gate terminal of the driving transistor 11*a* in the pixel 16. The driving transistor 11*a* is programmed to pass the program current Iw2 through itself.

Similarly, during the third H for the third row, a program current Iw3 sets the potential across the source signal line 18 at the V3. The potential V3 is applied to and held in the gate terminal of the driving transistor 11*a* in the pixel 16. The driving transistor 11*a* is programmed to pass the program current Iw3 through itself.

The precharge voltage Vp may correspond to the V0 voltage (tone 0). Even in this case, the V0 of the precharge voltage Vp applies the voltage corresponding to the characteristics of the driving transistor 11*a* in each pixel 16 (this has already described with reference to FIGS. 81 and 82). The V0 voltage corresponds to the constant current Iw=0. Accordingly, the measurement of the V0 voltage does not require the current tone circuit 154 to output the constant current. The gate driver circuit 12*a* has only to be controlled to sequentially select the corresponding pixel row (pixel). While the pixel row (pixel) is selected, the potential across the source signal line 18 is measured. The measured or measured and processed potential corresponds to the V0 voltage.

The length of the A period may be varied depending on the difference between the applied program voltage or the potential across the source signal line 18 and the potential of the written program voltage. For example, if the difference between the potential across the source signal line 18 and the applied precharge voltage Vp is at least 1.5 V, for example, the former is 2.5 V, whereas the latter is 4.1 V, the A period is 10 μsec. If the difference between the potential across the source signal line 18 and the applied precharge voltage Vp is at least 1.0 V and at most 1.5 V, for example, the former is 3.0 V, whereas the latter is 4.1 V, the A period is 6 μsec. Further, if the tone difference is at least 15, for example, the video signal applied to the pixels in the preceding pixel row corresponds to the tone 5, whereas the video signal applied to the pixels in the succeeding pixel row corresponds to the tone 21, then the A period is 10 μsec. If the tone difference is at least 10 and at most 15, for example, the video signal applied to the pixels in the preceding pixel row corresponds to the tone 10, whereas the video signal applied to the pixels in the succeeding pixel row corresponds to the tone 21, then the A period is 6 μsec.

The precharge voltage Vp and the program current Iw are not limited to a DC voltage and a DC, respectively, but may be a rectangular wave, a triangular wave, an AC, or a sine wave. The signal applied during the B period may be the program voltage output by the voltage tone circuit 231. The present embodiment uses the voltage driving both for the precharge voltage Vp and for the program voltage during the B period. Further, the voltage driving may of course be combined with duty ratio driving shown in FIGS. 6 and 9.

The above description is of course applied to the other embodiments of the present invention.

The circuit configuration shown in FIG. 128 can be used to realize a driving scheme shown in FIG. 139. Before applying the precharge voltage Vp, the source driver IC (circuit) 14 performs a reset operation as required. The reset operation opens the switches SW2, SW4, and SW5 shown in FIGS. 128 and 130, while closing the switch SW3, and applies the ground potential or a predetermined fixed voltage to the capacitor 1341.

Then, the switches SW2 and SW3 are opened, while the switches SW4 and SW5 are closed, and the voltage tone circuit 231 is operated to apply the precharge voltage Vp. During the A period, the precharge voltage Vp is applied to the source signal line 18 via the buffer circuit 151. The precharge voltage Vp is applied to the gate terminal of the driving transistor 11*a*. The gain of the buffer circuit 151 is set in association with the duty ratio shown in FIGS. 6 and 9.

During the B period, the switches SW2 and SW5 are opened, and the current tone circuit 154 is operated to apply the program current Iw to the source signal line 18.

After application of the program current Iw, the voltage tone circuit 231 may be operated to apply the tone voltage Vx. The above description is of course applied to the other embodiments of the present invention.

The other embodiments will be described below with reference to the drawings. In FIG. 140, the precharge voltage Vp is applied during the A period of each horizontal scan period. Application of the precharge voltage Vp causes each source signal line to be instantaneously charged or discharged to set the potential across the source signal line at the Vp.

The precharge voltage Vp is set close to the voltage corresponding to the maximum tone. The precharge voltage Vp may have a predetermined fixed value or the apparatus may be configured to be able to vary or adjust the precharge voltage Vp depending on the Va or V0 voltage.

Each of the first to third Hs (first to third horizontal scan periods) corresponds to one horizontal scan period as is the case of FIG. 136. Further, the first to third Hs (first to third horizontal scan periods) correspond to the order in which the pixel row is selected. The precharge voltage Vp is applied during the first A period of each horizontal scan period. This allows the voltage Vp to be instantaneously set regardless of the potential across the source signal line 18 during the preceding H. During the B period of the first H, which follows the A period, the current tone circuit 154 outputs the constant current Iw.

The constant current Iw may also be applied during the A period. The constant current Iw flows from the driving transistor 11*a* in the pixel 16 into the current tone circuit 154 via the source signal line 18. The constant current Iw sets the voltage at the gate terminal of the driving transistor 11*a* in the pixel 16 at the Va.

Of course, the Va voltage varies depending on a variation in characteristics among the driving transistors 11*a* in the respective pixels 16. However, the potential difference between the Va voltage and the Vp voltage is almost constant. Consequently, application of the precharge voltage Vp changes the Vp to the Va during application of the constant current regardless of the potential across the source signal line 18 during the preceding H. Therefore, the convergence time is substantially constant.

During the C period, which follows the B period, the target voltage Vc as a video signal is applied. Accordingly, the target tone Vc=Va+Vx, based on the Va, is applied to the source signal line 18. In the example shown in FIG. 140, the target tone for the first H is V1. The target tone for the second H is V2. The target tone for the third H is V3. Subsequently, the pixel row selected position is sequentially shifted until the n-th H.

FIG. 140 shows the embodiment with the constant precharge voltage Vp. However, the present invention is not limited to this. For example, the precharge voltage Vp may be varied as shown in FIG. 141. In the example shown in FIG. 141, a precharge voltage Vp1 is applied during the first H. A precharge voltage Vp2 is applied during the second H. A precharge voltage Vp3 is applied during the third H. Subsequently, the pixel row selected position is sequentially shifted until the n-th H.

FIG. 140 shows the embodiment with the constant precharge voltage Vp. However, the present invention is not limited to this. For example, the Va voltage may be varied. The target Va voltage is obtained by varying the constant current.

Current and voltage data needs to be transferred to the source driver IC (circuit) 14 in order to vary the constant current Iw depending on the tone or among multiple levels or to vary the tone voltage Vx with the pixel. FIG. 142 shows a corresponding embodiment. 8-bit constant current data ID (7:0) and 8-bit tone voltage data VD (7:0) are transferred in combination or alternately. The constant current data ID (7:0) is required to generate a constant current output by the current tone circuit 154. The voltage data VD (7:0) is required to generate a tone voltage Vx output by the voltage tone circuit 231.

In the embodiment shown in FIG. 128 and others, the gate driver circuit 12*a* sequentially selects each pixel row and applies the constant current Iw to the pixels in the selected pixel row. However, the present invention is not limited to this. For example, as shown in FIG. 143, it is possible to select a plurality of pixel rows and to apply the constant current Iw to them. Further, a plurality of pixels may be measured for the Va or V0 voltage at the same time. This is because adjacent pixel rows have approximate Va and V0 voltages.

The embodiment shown in FIG. 143(A) is configured to simultaneously select two adjacent pixel rows and allows the current tone circuit 154 to apply the constant current Iw to the two pixel rows. Currents output by the driving transistors 11*a* in each of the two selected pixel rows vary owing to a difference in characteristics among the driving transistors 11*a*. However, the difference in current between the adjacent pixel rows is very small. Two pixel rows may be sequentially selected, for example, in order of the first and second pixel rows, the third and fourth pixel rows, the fifth and sixth pixel rows, . . . Alternatively, two pixel rows may be sequentially selected with the selected pixel rows shifted by one row each time, for example, in order of the first and second pixel rows, the second and third pixel rows, the third and fourth pixel rows, . . .

FIG. 143(B) shows an embodiment that selects every other pixel rows instead of adjacent pixel rows. For example, this embodiment selects the first, third, and fifth pixel rows, the second, fourth, and sixth pixel rows, and then the third, fifth, and seventh rows.

In FIG. 143, the other arrangements and operations are similar to those of the embodiment described with reference to FIG. 128 and others. Thus, the explanation is omitted. The operation time of the current tone circuit 154 can be reduced by simultaneously selecting a plurality of pixel rows and measuring the Va voltage or the like. This also enables the configuration of the current tone circuit 154 and the like to be simplified.

The embodiment shown in FIG. 143 is based on a driving scheme that simultaneously selects a plurality of pixel rows. As shown in FIG. 143, the present invention is not limited to two pixel rows. Three or more pixel rows may be simultaneously selected. Further, selection of pixel rows is not limited to sequential scan and selection. Pixel rows may be randomly selected. Alternatively, pixel rows may be sequentially selected downward from the top of the screen for odd-numbered fields (frames) and upward from the bottom of the screen for even-numbered fields (frames).

It is also possible to sequentially select a plurality of pixel rows, apply the constant current Iw to each of the pixel rows, and measure the voltage Va or V0 or the like, during one H period. An example of a driving method selects the first pixel row and applies the constant current Iw to the pixel row during the former half of one H and then selects the second pixel row during the latter half of that H.

In the above description, the Va (see FIG. 132) and V0 (see FIG. 133) voltages are measured on sequentially selected pixel rows. However, the present invention is not limited to this. For example, it is possible to sequentially select and scan any of the pixel rows within the display area, then for example, measure the Va or V0 voltage, and store the voltage in the memory, during a blanking period of the video signal. It is also possible to simultaneously or sequentially select a plurality of pixel rows, to measure and hold the Va or V0 voltage for a given period, to sequentially read the held Va or V0 voltage, to add or subtract the Vx voltage to or from the Va or V0 voltage, and to sequentially apply the resulting voltages to the corresponding source signal lines 18.

If the V0 voltage is set so that no current flows through the driving transistor 11*a* (offset voltage) and the tone voltage Vx is applied on the basis of this V0 as shown in FIG. 133, the constant current output circuit (current tone circuit) 154 is not required as shown in FIG. 144. In the description below, matters similar to those shown in FIG. 128 are omitted.

In FIG. 144, the gate driver circuit 12 sequentially selects the pixel columns as in the case of FIG. 128. That is, a pixel row is selected during one horizontal scan period. First, the switch SW3 is closed, while the switches SW4, SW2, and SW5 are opened. Closure of the switch SW3 allows the ground (GND) voltage to be applied to and maintained at one of the terminals of the capacitor 1341, that is, the c section. Further, as described with reference to FIG. 134, the apparatus may be configured enable application of an arbitrary predetermined voltage.

The ground potential is applied to the c section of the capacitor 1341 to reset the capacitor 1341. Then, as shown in FIG. 145(A), the switches SW2 and SW3 are closed, while the switches SW4 and SW5 are opened. The a section of the capacitor 1341 holds a voltage (=gate terminal voltage of the driving transistor 11*a*) that prevents current from flowing from the driving transistor 11*a* to the EL element 15. Also during this period, the appropriate pixel row is selected. The gate terminal potential of the driving transistor 11*a* in each of the pixels 16 in the appropriate pixel row is kept offset (even closure of the transistor 11*d* does not allow current to flow through the EL element 15). The operation shown in FIG. 145(A) allows the reading of the V0 voltage required to offset (hold) the driving transistor 11*a*. Accordingly, as shown in FIG. 133, the driving transistor 11*a* is cut off by applying the V0 voltage as it is to the gate terminal of the driving transistor 11*a* (no current flows to the EL element 15).

The a section of the capacitor 1341 holds the voltage (=gate terminal voltage of the driving transistor 11*a*) that prevents current from flowing from the driving transistor 11*a* to the EL element 15. Also during this period, the appropriate pixel row is selected. The gate terminal potential of the driving transistor 11*a* in each of the pixels 16 in the appropriate pixel row is kept offset (even closure of the transistor 11*d* does not allow current to flow through the EL element 15).

Then, as shown in FIG. 145(B), the switches SW4 and SW5 are closed, while the switches SW2 and SW3 are opened. The voltage tone circuit 231 outputs the tone voltage Vx. The target voltage Vc=V0+Vx. Also during this period, the appropriate pixel row is selected.

The voltage Vx output to the voltage tone circuit 231 shifts the potential in the a section of the capacitor 1341. The voltage shift in the a section adds to the V0 and Vx voltages. This completes one horizontal scan period. In the selected pixel row, a current is applied to the EL element 15, which thus emits light, during the next horizontal scan period.

Figure 26:
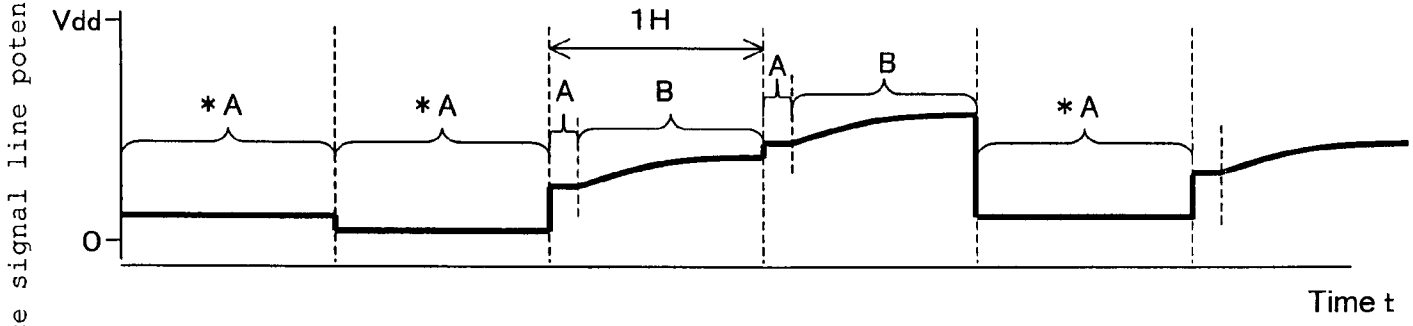

The driving scheme in accordance with the present invention described with reference to FIGS. 128, 134, 135, 132, 133 and others applies the constant current Iw, measures or acquires the V0 or Va voltage, determines the tone voltage on the basis of the V0 or Va voltage, and then applies the tone voltage to the source signal line 18. However, the present invention is not limited to this. It is also possible to determine the tone current (program current) on the basis of or using the V0 or Va voltage and apply the tone current determined to the source signal line 18 to display an image, during a horizontal scam period. The voltage applied state is shown in FIGS. 25, 81, and 82. Further, of course, the voltage determined may be applied throughput one horizontal scan period as shown in FIGS. 26, 27 and others.

The description of the above embodiment of the present invention focuses on the measurement of the Va or V0 and the addition or subtraction of the Vx voltage to or from the Va or V0 voltage, with the resulting voltage applied to the driving transistor 11*a* in the pixel 16. The description below focuses on image display provided by the EL display apparatus in accordance with the present invention.

The present invention measures (acquires) the potential (f in FIG. 1) at the gate terminal of the driving transistor 11*a* through which the program current (constant current) Iw is passed. Alternatively, the potential is held in the capacitor 1341, shown in FIG. 128. Alternatively, the data corresponding to the potential is held in the storage instrument such as the memory.

In FIG. 1, the potential f at the gate terminal is the same as that (shown at d) across the source signal line 18 because the transistors 11*b* and 11*c* are on. Accordingly, the measurement of the potential f at the gate terminal of the transistor 11*a* is equivalent to the measurement of the potential across the source signal line 18 via the output terminal 83 of the source driver circuit 14.

The second operation closes the transistors 11*b* and 11*c*, while opening the transistor 11*d*. FIG. 5(B) shows an equivalent circuit corresponding to this condition. The voltage between the source and gate of the transistor 11*a* remains held. In this case, the transistor 11*a* is always saturated during operation, thus making the current Ie=Ix constant. Reference character Ie denotes a current passed through the EL element 15 by the driving transistor 11*a*. Expression Ie=Iw indicates an ideal state free from a punch-through voltage or the like, which may affect the pixel 16.

The embodiment shown in FIG. 133 is based on the scheme which determines the voltage V0 and adds the tone voltage Vx to the voltage V0 to generate a target voltage Vc. Further, FIG. 130 shows the scheme which determines the voltage Va and adds or substracts the tone voltage Vx to or from the voltage Va to generate a target voltage Vc. The present invention is not limited to these schemes. For example, the constant current Iw corresponding to the maximum tone Iwm may be applied when determining the voltage Va.

When the constant current Iw corresponding to the maximum tone Iwm is applied to the driving transistor 11*a*, a voltage Vam is generated at the gate terminal of the driving transistor 11*a* so that the maximum tone current can flow through the driving transistor 11*a*. The tone voltage Vx is subtracted from the Vam to generate a target voltage Vc. The voltage Vcm generated is applied to the gate terminal of the driving transistor 11*a*.

As described above, the present invention relates to the EL display panel in which the current driving pixels (configured or arranged so that the drain or source terminal of the driving transistor 11*a* or the transistor 11*b* current-mirror-coupled to the driving transistor 1*a* is connected to the source signal line 18 so as to allow a DC to flow from the driving transistor 11*a* to the source signal line 18, or configured so that the current flowing through the driving transistor 11 (11*a* or 11*b*) can be passed to the source signal line 18, from which the current can be extracted, or the current can be input to the driving transistor 11*a* through the source signal line 18) are arranged in a matrix. The constant current is applied to the driving transistor 11 (or flows through the driving transistor 11). Then, in a substantially steady state, the potential at the gate terminal of the driving transistor 11 is measured (acquired).

The voltage corresponding to the tone voltage is added to or subtracted from the measured (acquired) potential, serving as a reference (origin or relative position) to generate a target voltage Vc. The target voltage generated is applied to the gate terminal of the driving transistor 11 or the like so that the driving transistor 11 can pass the current corresponding to the target voltage to the Element 15. Passing the current to the EL element 15 includes both the supply of the current to the EL element 15 and the flow of the current from the EL element 15 into the driving transistor 11.

In the above embodiment, a substantially unchanged constant current Ie is passed to the driving transistor 11 on the basis of the Va, V0, and Vam. However, the present invention is not limited to this. For example, of course, the constant current may be multiplied by N on the basis of the driving scheme that passes a current to the EL element 15 only during the 1F/N period, while passing no current during the other periods (1F(N−1)/N), as described with reference to FIGS. 6 and 9. That is, the Va voltage corresponding to the N-times constant current (reset current) is determined. A target voltage Vc is then generated on the basis of the voltage Va. In the above description, the constant current is multiplied by N. However, the present invention is not limited to this. N may be any value provided that it is at least 1.

This method is particularly effective if the source signal line 18 has a large parasitic capacitance. It is also effective if the EL display apparatus is large and at least 10 inches in size. If the source signal line 18 has a large parasitic capacitance, an "insufficient writing" with the constant current Iw can be improved by multiplying the reset current (program current Iw) by N (at least avoiding reducing the reset current).

As described above, the display apparatus in accordance with the present invention is based on the scheme which uses the pixel configuration based on the current program to carry out the voltage driving.

The above embodiment applies the constant current Iw to the pixel 16, measures the potential across the source signal line 18, and uses the measured or acquired voltage to program the EL display apparatus. The constant current Iw can be adjusted using the reference current. Further, in FIGS. 6 and 9, the duty ratio driving (intermittent driving) is carried out. Duty ratio control will be described later.

The specification of the present invention calls the ratio of the display area 63 to the entire display screen 34 a duty ratio. That is, the duty ratio is the area of the display area 63/the area of the entire display screen 34, or the number of gate signal lines 17*b* to which the on voltage is applied/the total number of gate signal lines 17*b*, or the number of selected pixel rows connected to the gate signal lines 17*b* to which the on voltage is applied/the total number of pixel rows on the display screen 34.

In the description of the present specification, it is assumed that the duty ratio control or the like is varied depending on the lighting ratio. However, the lighting ratio does not have a fixed meaning. For example, a low lighting ratio means not only that a small current flows through the display screen 34 but also that an image is composed of a large number of pixels displaying low tones. That is, a video constituting the display screen 34 is mostly composed of dark pixels (low tone pixels).

Accordingly, a low lighting ratio corresponds to a large number of video data with low tones resulting from a histogram process on video data constituting the screen. A high lighting ratio means a large current flowing through the display screen 34 but also means a large number of pixels with high tones which constitute the image. That is, the video constituting the display screen 34 has a large number of bright pixels (pixels with high tones). A high lighting ratio corresponds to a large number of video data with high tones resulting from a histogram process on the video data constituting the screen. That is, control based on the lighting ratio is the same as or similar to control based on the distribution of the tones of the pixels or a histogram distribution.

Thus, in some cases, the control based on the lighting ratio corresponds to control based on the distribution of tones in the image (low lighting ratio=a large number of low-tone pixels, high lighting ratio=a large number of high-tone pixels). For example, increasing a reference current ratio with decreasing lighting ratio while reducing the duty ratio with increasing lighting ratio corresponds to increasing the reference current ratio with increasing number of pixels with low tones while reducing the duty ration with increasing pixels with high tones. Accordingly, increasing the reference current ratio with decreasing lighting ratio while reducing the duty ration with increasing lighting ratio has a meaning that is the same as or similar to that of increasing the reference current ratio with increasing number of pixels with low tones while reducing the duty ratio with increasing pixels with high tones, or the former is an operation or control that is the same as or similar to that of the latter.

Further, for example, multiplying the reference current ratio by N at a predetermined low lighting ratio or lower and setting the number of selection signal lines at N has a meaning that is the same as or similar to that of multiplying the reference current ratio by N and setting the number of selection signal lines at N when the number of pixels with low tones is above a constant, or the former is an operation or control that is the same as or similar to that of the latter.

Furthermore, for example, carrying out driving in a duty ratio of 1:1 and reducing the duty ratio step by step or smoothly at a predetermined high lighting ratio or higher normally has a meaning that is the same as or similar to that of carrying out driving in a duty ratio of 1:1 while the number of pixels with low tones or high tones is within a given range and reducing the duty ratio step by step or smoothly when the number of pixels with high tones has at least a given value, or the former is an operation or control that is the same as or similar to that of the latter.

As shown in FIG. 147, the duty ratio may be reduced in a low lighting ratio area (in FIG. 147, a lighting ratio of at least 20%) (FIG. 147(A)), while increasing the reference current ratio with decreasing duty ratio (FIG. 147(B)). Carrying out the duty ratio control and reference current ratio control as described above avoids a variation in luminance as shown in FIG. 147(*c*).

In low lighting ratios, an insufficient writing with the program current is marked in a low tone area. However, increasing the reference current in the low lighting ratio area enables an increase in program current in proportion to the reference current as shown in FIGS. 147(A) and 147(B). This avoids an insufficient writing with current. Further, the constant luminance enables a good image display. That is, control may be performed so that the reference current ratio×duty ratio has a constant within the range of low or predetermined lighting ratios.

In FIG. 147, the duty ratio is reduced in an area with high lighting ratios (in FIG. 147, at least 40%), whereas the reference current ratio remains constant at 1. This allows the luminance to decrease consistently with duty ratio, thus enabling the power consumption of the panel to be controlled (basically reduced).

The relationships with the reference current ratio, the duty ratio and the lighting ratio are preferably fixed as described below. This is because degradation may be accelerated by an increase in the amount of flickers generated or the self-heating of the panel. In an area with a lighting ratio of at most 30%, the duty ratio×reference current ratio (A) is preferably at least 0.7 and at most 1.4, more preferably at least 0.8 and at most 1.2. Preferable control or setting for an area with a lighting ratio of at most 80% is such that the duty ratio× reference current ratio (A) is at least 0.1 and at most 0.8, more preferably at least 0.2 and at most 0.6.

If the duty ratio×reference current ratio is defined as A when the lighting ratio is 50%, preferable control or setting for an area with a lighting ratio of at most 30% is such that the duty ratio×reference current ratio×A is at least 0.7 and at most 1.4, more preferably at least 0.8 and at most 1.2. Further, preferable control or setting for an area with a lighting ratio of at most 80% is such that the duty ratio×reference current ratio×A is at least 0.1 and at most 0.8, more preferably at least 0.2 and at most 0.6.

However, a variation in reference current is required for the overcurrent driving, described with reference to FIG. 81. This is because the magnitude of the overcurrent is proportional to the magnitude of the reference current. Accordingly, varying the reference current in the low lighting ratio area as shown in FIG. 147(B) varies the magnitude of an overcurrent precharge in this area. Specifically, doubling the reference current ratio doubles the magnitude of the overcurrent, thus reducing the time required to reach the target tone value to half. Since the application period of the overcurrent is fixed, a variation such as an increase in reference current ratio causes deviation from the target value.

To solve this problem, as shown in FIG. 147(*d*), an overcurrent (precharge current) ratio (also called a precharge current ratio) is varied depending on the reference current ratio and lighting ratio. In FIG. 147(*d*), the reference current ratio varies to 2 when the lighting ratio is at most 20%. Accordingly, the program current ratio is varied from 1 to ½ when the lighting ratio is at most 20%. Settings are made such that the (overcurrent) precharge current ratio×reference current ratio results in a constant (C). That is, C=precharge current ratio× reference current ratio. Further, when the reference current ratio is multiplied by n, the precharge current ratio is multiplied by 1/n. The C need not necessarily have a fixed (constant) value. This is because a small variation is not reflected in the display. The range of a variation in C should be at least 0.8 and at most 1.2.

In FIG. 147(B), the precharge current ratio is linearly varied depending on the lighting ratio. However, the present invention is not limited to this. The precharge current ratio or the like may be varied step by step. For example, in the embodiment shown in FIG. 147, the precharge current ratio may be varied as follows: 2.0 when the lighting ratio is at least 0% and at most 5%, 1.75 when the lighting ratio is at least 5% and at most 10%, 1.50 when the lighting ratio is at least 10% and at most 15%, 1.25 when the lighting ratio is at least 15% and at most 20%, and 1.0 when the lighting ratio is at least 20%.

Even if the precharge current ratio is varied step by step, the reference current ratio is varied depending on the precharge current ratio. Further, the speed at which the reference or precharge current ratio or the like varies preferably has a low pass filter characteristic (the ratio does not follow a fast variation in lighting ratio). Preferably, the speed also has a hysteresis characteristic (once the ratio changes, it no longer changes even though the lighting ratio returns to its original value).

The above description (step-by-step variation and the provision of the hysteresis characteristic) is also applicable to the duty ratio.

As described above, the duty ratio, reference current ratio, and precharge current ratio are controlled so as to have correlations. The following correlations are established. The duty ratio×reference current ratio results in a constant. The reference current ratio×precharge current ratio also results in a constant. Consequently, the duty ratio×(1/precharge current ratio) also results in a constant or a substantial constant.

In the embodiment shown in FIG. 148, the overcurrent as the precharge current is provided by turning on (closing) the D7 switch, corresponding to the most significant bit. The magnitude of the overcurrent is controlled or adjusted on the basis of the period during which the D7 switch is closed.

The embodiment shown in FIG. 148 provides the tones using the tone switch control circuit 1481. That is, for an 8-bit video signal, the corresponding switches D0 to D7 are controllably turned on and off. On the other hand, the precharge current (overcurrent) is output by controlling the switches S0 to S7 in association with the reference current ratio.

FIG. 148 shows an output stage for an 8-bit video current signal. The video data D0 to D7 are output from the output terminal 83 by closing a switch D*a (* is 0 to 7, indicating a bit position). The appropriate switch D*a is closed in accordance with the video data. On the other hand, a switch D*b (* is 0 to 7, indicating a bit position) is closed during a current precharge period. Closure of the switch D*b causes the precharge current (overcurrent Id) to be output from the output terminal 83.

The precharge voltage V0, the offset voltage corresponding to the 0th tone, is output from the output terminal 83 by closing the switch 161*a*. The precharge current Id and program current Iw are output from the output terminal 83 by closing the switch 161*b*. The switches 161*a* and 161*b* are exclusively controlled by an inverter 1484 so as not to be simultaneously closed.

Logic data is applied to the inverter 1481 by a precharge-period determining section 1483. That is, the precharge-period determining section 1483 uses a set value for current precharge pulse length to control the inverter 1483.

The embodiment changes the reference current ratio from 1 to 2. The magnitude (ratio) of the precharge current is changed from 1 to ½. For example, if settings are such that, in a reference current ratio of 1, a precharge current control circuit 1482 closes the switch S7, when the reference current ratio changes to 2, the precharge current control circuit 1482 performs control such that the switch S6 is closed. This is because the magnitude of the precharge current obtained while the switch S6 is closed is double that obtained while the switch S7 is closed. The charge in precharge current during the change in reference current ratio from 1 to 2 can be linearly adjusted by controlling the switches S0 to S7.

The above operation makes it possible to set or control such that the precharge current ratio×reference current ratio results in the constant (c). That is, C=the precharge current ratio× referent current ratio. Further, the magnitude of the precharge current can be adjusted by combining adjustment of the precharge current period and selection from the switches S.

Even when the reference current is varied depending on the lighting ratio such as the range of low lighting ratios, the precharge current can be properly realized by varying the relative value of magnitude of the precharge current depending on the lighting ratio, as shown in FIG. 147. Consequently, in spite of a variation in tone, the target tone can be properly reached using the precharge current.

An increase in the magnitude of the reference current increases the magnitude of a current flowing through the EL element 15 as well as the voltage between the channels (S-D) of the driving transistor 11*a*. Consequently, an increase in reference current ratio requires an increase in the absolute value between the anode voltage (Vdd) and the cathode voltage (Vss).

An increase in the absolute value between the anode voltage (Vdd) and the cathode voltage (Vss) increases the power consumption of the EL display apparatus. An increase in the power consumption results in heat generation and degradation of the EL display apparatus. The present invention increases the reference current depending on the lighting ratio, particularly within the range of low lighting ratios, in order to prevent insufficient writings. An increase in the magnitude of the reference current in the low lighting ratio area requires an increase in the absolute value between the anode voltage (Vdd) and the cathode voltage (Vss). However, conventional voltage generating circuits keep the anode voltage (Vdd) ands cathode voltage (Vss) values fixed regardless of the lighting ratio. This increases the amount of current consumed, particularly in the high lighting ratio area, thus disadvantageously causing the EL display apparatus to generate heat.

To solve this problem, as shown in FIG. 149, the cathode voltage is reduced in the low lighting ratio area. The reducing control of the cathode voltage is performed depending on a variation in the magnitude of the reference current. The embodiment shown in FIG. 147 increases the magnitude of the reference current at a lighting ratio of at most 20%. Accordingly, the embodiment shown in FIG. 149 also reduces the cathode voltage at a lighting ratio of at most 20%.

In FIG. 149, the anode voltage is fixed, whereas the cathode voltage is varied depending on the reference current. This is because the driving transistor 11*a* in the pixel 16 in accordance with the embodiments of the present invention is of a P channel type. That is, the current programming is carried out using the anode potential as a starting point. Accordingly, an anode voltage of a fixed value makes it possible to keep the current programming accurate and to facilitate the configuration of a circuit. Further, in the EL display apparatus in accordance with the present invention, even a variation in cathode voltage does not affect the display because one of the terminals of the EL element 15 is connected to the cathode. However, the anode voltage may be varied depending on the reference voltage as shown in FIG. 151.

As described above, the present invention is characterized in that the power supply voltage of the EL display apparatus is varied depending on the lighting ratio. In particular, the power supply voltage is varied depending on the reference current. Further, this driving scheme varies the power supply voltage (at least one of the anode voltage Vdd and the cathode voltage Vss) depending on the lighting ratio. Furthermore, the power supply voltage is varied depending on the magnitude of the precharge current. Alternatively, the absolute values of the anode voltage Vdd and cathode voltage Vss are increased. In particular, the absolute value of the power supply voltage (anode voltage Vdd and cathode voltage Vss) is increased in the low lighting ratio area.

A method which increases the absolute value of the power supply voltage is easy. The power supply IC is normally subjected to pulse control. An increase in the frequency of an applied pulse (pulse generated inside the power supply IC) raises the voltage. A decrease in the frequency of an applied pulse (pulse generated or oscillated inside the power supply IC) lowers the voltage. Accordingly, the magnitude of the voltage output by the power supply IC can be easily controlled by performing pulse control on the power supply IC.

On the contrary, when an area with a large reference current is assumed to be a reference, the present invention corresponds to a driving scheme that lowers the power supply voltage (at least one of the anode voltage Vdd and cathode voltage Vss) depending on the lighting ratio. That is, the power supply voltage is lowered in the high lighting ratio area. Further, the power supply voltage is lowered depending on the magnitude of the precharge current. Alternatively, the absolute values of the anode voltage Vdd and cathode voltage Vss are increased. That is, the power supply voltage is reduced consistently with the magnitude of the precharge current. In particular, this scheme reduces the absolute value of the power supply voltage (anode voltage Vdd and cathode voltage Vss) in the high lighting ratio area.

FIG. 149 shows an embodiment based on a 2-power-supply scheme that generates an anode voltage and a cathode voltage. FIG. 151 shows a scheme that sets the cathode voltage equal to the ground (GND), while varying the anode voltage. The embodiment shown in FIG. 151 is characterized by varying the power supply voltage of the EL display apparatus depending on the lighting ratio as in the case of FIG. 149. In particular, the power supply voltage is varied depending on the variation of the reference current. Further, this driving scheme varies the power supply voltage (anode voltage Vdd) depending on the lighting ratio. Furthermore, the power supply voltage is varied depending on the magnitude of the precharge current. Alternatively, the absolute value of the anode voltage Vdd is increased. In particular, the absolute value of the power supply voltage (anode voltage Vdd) is increased in the low lighting ratio area.

With a single power supply shown in FIG. 151, a logic signal level Vcc on which pulse control or the like is performed is shifted up to the anode voltage Vdd level as shown in FIG. 150. For the precharge voltage Vp level such as the offset cancel voltage V0, the anode voltage Vdd is used as a reference. This configuration prevents the precharge voltage from being affected even by a variation in Vdd voltage.

In FIGS. 149 and 150, the cathode or anode voltage is varied linearly with the lighting ratio. However, the present invention is not limited to this. The cathode voltage or the like may be varied step by step. For example, in the embodiment shown in FIG. 149, the cathode voltage may be varied depending on the lighting ratio as follows: −9 V in a lighting ratio of at least 0% and at most 5%, −8.5 V in a lighting ratio of at least 5% and at most 10%, −8.0 V in a lighting ratio of at least 10% and at most 15%, −6.5 V in a lighting ratio of at least 15% and at most 20%, and −5.5 V in a lighting ratio of at least 20%.

Further, the cathode and anode voltages may be simultaneously varied. Furthermore, control may of course be performed such that the absolute values of the cathode and anode voltages are varied.

The variation in cathode voltage is adjusted on the basis of the voltage division ratio of external resistors for the power supply IC. Accordingly, the resistor value can be altered or varied step by step by using the switch circuit to switch among and select from the plurality of resistors. Further, the cathode voltage can be varied almost linearly with the lighting ratio by using an electronic regulator having other steps or the like.

Further, the speed at which the voltage such as the cathode or anode voltage value varies preferably has a low pass filter characteristic (the voltage does not follow a fast variation in lighting ratio). Preferably, the speed also has a hysteresis characteristic (once the cathode or anode voltage value changes, it no longer changes even though the lighting ratio returns to its original value).

The embodiments of the present invention pass the constant current through the source signal line 18 or the like or hold the source signal line 18 in a high impedance state and measure the V1 or V0 voltage or the like. The measured voltage is held in the EEPROM, ROM, or the like as voltage data (current data) or in the source driver IC (circuit) 14 or the like. However, in order to hold all voltage data or the like, it is necessary to hold an enormous amount of data. Thus, a compression technique may be used to hold the data in the ROM 502 or the like.

For example, a still image compressing technique or format such as JPEG may be used. In particular, the distribution of characteristics of the transistor 11*a* is not random but approximates that of characteristics of a peripheral part. Thus, the technique for compressing image data may be used to carry out proper compression. Further, a motion picture compressing technique such as MPEG may of course be used. The description in this paragraph is of course applicable to the other embodiments of the present invention.

Description will be given of apparatuses or the like which use the EL display panel, the EL display apparatus, or the method for driving the EL display panel or apparatus in accordance with the present invention. Apparatuses described below implement the previously described apparatuses or methods in accordance with the present invention. FIG. 152 is a plan view of a cellular phone as an example of an information terminal apparatus. An antenna 1521, ten keys 1522, and the like are attached to a housing 1523.

FIG. 153 is a perspective view of a video camera. The video camera comprises an image taking (pickup) lens section 1532 and a video camera body. The image taking lens section 1532 and a viewfinder section are arranged back to back. Further, an ocular cover is attached to the viewfinder section. An observer (user) observes the display section 184 of the display panel 1524 through the ocular cover section.

The EL display panel in accordance with the present invention is also used as a display monitor. The angle of the display section 184 can be freely adjusted via a supporting point 1531. While out of use, the display section 184 is housed in a storage section 1533.

The EL display apparatus in accordance with the present embodiment is applicable not only to the video camera but also to an electronic camera or a still camera such as the one shown in FIG. 154. The display apparatus is used as the monitor 184 attached to the camera body 1541. A photographic switch 1543 and a switch 1534 are attached to the camera body 1541.

It is possible to combine the pixel configurations, the display panels (display apparatuses), the circuits constituting the display panels (display apparatuses), the methods for controlling the display panels (display apparatuses), or the technical concepts for the display panels (display apparatuses) in accordance with the present invention which are described with reference to FIGS. 1, 3, 12, 13, 14, 73, 74, 75, 86, 103, 104, 105, 106, 107, 109, 115, 118, 124, 125, 126, 127, and others. They are applicable to one another or may be formed into a composite configuration or combined together. Further, the technical concepts and others may be partly or entirely combined together.

It is possible to mutually combine the power supply circuit configurations, the methods for controlling the power supply circuit, or the technical concepts for the power supply circuit described with reference to FIGS. 4, 149, 150, and 151. They are applicable to one another or may be formed into a composite configuration or combined together. Further, these technical concepts and others may be partly or entirely combined together.

It is possible to combine the source driver ICs (circuits), the circuits constituting the source driver ICs (circuits), the methods for controlling the source driver ICs (circuits), or the technical concepts for the source driver ICs (circuits) in accordance with the present invention which are described with reference to FIGS. 8, 15, 16, 17, 18, 19, 20, 21, 22, 23, 24, 29, 30, 32, 37, 38, 39, 41, 42, 43, 44, 45, 49, 50, 56, 57, 58, 59, 60, 61, 65, 66, 68, 71, 72, 77, 78, 79, 80, 87, 88, 89,90, 96, 114, 115, 116, 117, 122, 144, 145, 146, 148 and others. They are applicable to one another or may be formed into a composite configuration or combined together. Further, the technical concepts and others may be partly or entirely combined together.

It is possible to combine the driving and control methods or the technical concepts for the methods in accordance with the present invention which are described with reference to FIGS. 5, 6, 7, 9, 10, 11, 25, 26, 27, 28, 33, 34, 35, 36, 40, 46, 47, 48, 51, 52, 53, 54, 55, 62, 63, 64, 67, 69, 70, 76, 81, 82, 83, 84, 85, 86, 91, 92, 93, 94, 95, 97, 98, 99, 100, 101, 102, 108, 110, 111, 112, 113, 119, 120, 121, 123, 128, 129, 130, 131, 132, 133, 134, 135, 139, 140, 141, 142, 143, 147, and others. They are applicable to one another or may be formed into a composite configuration or combined together. Further, the technical concepts and others may be partly or entirely combined together.

The above described invention is applicable to the display apparatuses described in FIGS. 152, 153, 154, and others. These display apparatuses are applicable to one another or may be formed into a composite configuration or combined together. Further, technical concepts or the like for the display apparatuses may be partly or entirely combined together.

Moreover, it is possible to partly or entirely combine the pixel configurations or display panels (display apparatuses), the methods for controlling the pixel configurations, or the technical concepts for the pixel configurations, the driving and control methods for the display panels (display apparatuses), or the technical concepts for the display panels (display apparatuses), the driver circuits such as the source driver IC (circuit) and gate driver IC (circuit) or the controller ICs (circuits) or their control circuits (including the gate driver circuit or the like), the methods for adjusting or controlling these circuits, or the technical concepts for these circuits, the technical concepts for the inspection (evaluation) apparatuses and methods, or the like, which are described above. Further, of course, they are applicable to one another or may be mutually configured or formed. Furthermore, the technical concepts for the adjustment methods in accordance with the present invention and the like are of course applicable to the display panels or apparatuses or the like in accordance with the present invention. Additionally, these technical concepts and others may be partly or entirely combined together.

The technical concepts for the display apparatuses or the driving or control methods or schemes described in the embodiments of the present invention are also applicable to a video camera, a projector, a three-dimensional (3D) television, a projection television, a field emission display (FED), an SED (display developed by Canon and Toshiba), a PDP (Plasma Display Panel), or the like. The technical concepts are also applicable to a viewfinder, a main monitor and a submonitor or a clock display section of a cellular phone, a PHS, a portable information terminal and its monitor, a digital camera, a satellite television, or a satellite mobile television and its monitor. The technical concepts are also applicable to an electrophotographic system, a head mount display, a direct-vision monitor display, a notebook personal computer, a video camera, a digital still camera, or an electronic still camera. The technical concepts are also applicable to a monitor of a cash dispenser, a public telephone, a video telephone, a personal computer, a watch and its display apparatus, or the like. The technical concepts are also applicable to an instrument that generates information such as bar codes. The technical concepts and others may be partly or entirely combined together.

Of course, the present invention is also applicable or expandable to a display monitor of an electric appliance such as a rice cooker, a display section of a car audio system, a speed meter for a car, a display section of a shaver, a pocket game instrument and its monitor, the number of a telephone receiver, a display monitor such as an indicator of a measuring instrument in a factory, a destination display monitor for a train, a substitution of a neon display apparatus, a backlight for display panel or a lighting device for domestic or business use, a ceiling light, window glass, a lighting device such as a headlight of a car, or the like. The lighting device is preferably configured to vary color temperature. The color temperature can be varied by forming R, G, and B pixels that are striped or arranged in a dot matrix and adjusting currents passed through the pixels. The present invention is also applicable to a display apparatus for advertisement or posters, an RGB signal, an alarm display light, or the like. These technical concepts or the like may be partly or entirely combined together.

The self light emitting element, display apparatus, or organic EL display apparatus in accordance with the present invention is effectively used as a light source for a scanner. An RGB dot matrix is used as a light source to illuminate an object to read an image from the object. Of course, monochromatic tones may be used instead of the RGB. Further, of course, the display apparatus in accordance with the present invention can be configured to output light of a single or narrow-band wavelength. A laser display apparatus is thus obtained or may be used for a certain application. Band narrowing can be achieved by using an interference effect or an optical filter.

The present invention is not limited to the above embodiments. In implementation, many variations or changes may be made to the embodiments without departing from the spirit of the present invention. Further, the embodiments may be properly combined together if possible. In this case, the combinations produce characteristic effects.

The EL display apparatus and the method for driving the EL display apparatus in accordance with the present invention are effective in avoiding insufficient writings all over the tone area while reducing display unevenness. The present invention is thus useful for a self-emission display panel (display apparatus) such as an EL display panel (display apparatus) using an organic or inorganic electroluminescence (EL) element or the like, a driving method and apparatus for these display panels, and a display apparatus using these display panels.

What is claimed is:

1. An EL display apparatus containing a plurality of source signal lines, first pixels connected to said source signal lines and arranged in a matrix in an image display area, and first transistors used to supply current to EL elements of said first pixels, comprising:

second pixels which, being formed outside the image display area, have second transistors;

a constant current circuit which applies constant current to said second pixels;

a voltage measuring circuit which outputs or measures gate terminal potential of said second transistors with the constant current being applied to said second pixels;

a current generating circuit which generates tone current and applies said tone current to said source signal lines; and a voltage generating circuit which generates tone voltage and applies said tone voltage to said source signal lines.

* * * * *